US009175693B2

(12) United States Patent
Dutka et al.

(10) Patent No.: US 9,175,693 B2
(45) **Date of Patent: *Nov. 3, 2015**

(54) AIRFOIL SHAPE FOR A COMPRESSOR

(75) Inventors: Michael James Dutka, Simpsonville, SC (US); John Duong, Greer, SC (US); Ya-Tien Chiu, Greer, SC (US); Alexander David Shrum, Anderson, SC (US); Kelvin Rono Aaron, Simpsonville, SC (US); Christopher Edward LaMaster, Indianapolis, IN (US); San-Dar Gau, Greenville, SC (US); Franco Monteleone, Laval (CA); Paul Griffin Delvernois, Greer, SC (US); Matthew John McKeever, Greer, SC (US); Govindarajan Rengarajan, Simpsonville, SC (US); Jeremy Peter Latimer, Greenville, SC (US); Marc Edward Blohm, Greenville, SC (US); Eric Richard Bonini, Greer, SC (US); Venkata Siva Prasad Chaluvadi, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 771 days.

This patent is subject to a terminal disclaimer.

(21) Appl. No.: 13/526,832

(22) Filed: Jun. 19, 2012

(65) Prior Publication Data

US 2013/0336798 A1 Dec. 19, 2013

(51) Int. Cl.

| | |
|---|---|
| ***F01D 5/14*** | (2006.01) |
| ***F01D 5/16*** | (2006.01) |
| ***F04D 29/32*** | (2006.01) |

(52) U.S. Cl.

CPC ..... *F04D 29/324* (2013.01); *F01D 5/141* (2013.01); *F05D 2250/74* (2013.01)

(58) Field of Classification Search

CPC ..... F04D 29/324; F04D 29/38; F04D 29/384; F01D 5/141; F01D 5/142; F05D 2240/301; F05D 2240/305; F05D 2240/306; F05D 2250/74

USPC ..... 415/191–193, 199.4–199.5, 208.1, 415/208.2, 209.1, 211.2; 416/223 R, 223 A, 416/243, DIG. 2, DIG. 5

See application file for complete search history.

(56) References Cited

U.S. PATENT DOCUMENTS

| | | | | |
|---|---|---|---|---|
| 7,186,090 | B2 | 3/2007 | Tomberg et al. | |
| 7,997,861 | B2 | 8/2011 | Hudson et al. | |
| 8,038,390 | B2 | 10/2011 | Hudson et al. | |
| 2010/0068045 | A1 * | 3/2010 | Schott et al. | 415/191 |
| 2010/0068048 | A1 * | 3/2010 | Spracher et al. | 415/208.2 |
| 2010/0092298 | A1 | 4/2010 | Hudson et al. | |

(Continued)

*Primary Examiner* — Christopher Verdier

(74) *Attorney, Agent, or Firm* — James W. Pemrick; Ernest G. Cusick; Frank A. Landgraff

(57) ABSTRACT

An article of manufacture having a nominal airfoil profile substantially in accordance with Cartesian coordinate values of X, Y and Z set forth in a scalable table, the scalable table selected from the group of tables consisting of TABLES 1-11, wherein the Cartesian coordinate values of X, Y and Z are non-dimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined with one another to form a complete airfoil shape.

18 Claims, 2 Drawing Sheets

(56) References Cited

U.S. PATENT DOCUMENTS

| | | | | |
|---|---|---|---|---|
| 2012/0051926 | A1 | 3/2012 | Dutka et al. | |
| 2012/0051927 | A1 | 3/2012 | LaMaster et al. | |
| 2012/0051928 | A1* | 3/2012 | LaMaster et al. | 416/223 A |
| 2012/0051929 | A1* | 3/2012 | Blohm et al. | 416/223 A |
| 2012/0219410 | A1* | 8/2012 | Kathika et al. | 415/208.1 |
| 2012/0308395 | A1* | 12/2012 | Shrum et al. | 416/241 R |

* cited by examiner

AIRFOIL SHAPE FOR A COMPRESSOR

RELATED APPLICATIONS

The present application is related to U.S. Pat. No. 9,017,019, U.S. Pat. No. 8,926,287, U.S. Pat. No. 8,936,441 and U.S. Pat. No. 8,961,119 filed concurrently herewith, which are each fully incorporated by reference herein and made a part hereof.

BACKGROUND OF THE INVENTION

The present invention relates generally to an airfoil for use in turbomachinery, and more particularly relates to an airfoil profile or airfoil shape for use in a compressor.

In turbomachines, many system requirements should be met at each stage of the turbomachine's flow path to meet design goals. These design goals include, but are not limited to, overall improved efficiency, reduction of vibratory response and improved airfoil loading capability. For example, a compressor airfoil profile should achieve thermal and mechanical operating requirements for a particular stage in the compressor. Moreover, component lifetime, reliability and cost targets also should be met.

BRIEF DESCRIPTION OF THE INVENTION

According to one aspect of the present invention an article of manufacture is provided having a nominal airfoil profile substantially in accordance with Cartesian coordinate values of X, Y and Z set forth in a scalable table, the scalable table selected from the group of tables consisting of TABLES 1-11, wherein the Cartesian coordinate values of X, Y and Z are non-dimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined with one another to form a complete airfoil shape.

According to another aspect of the present invention an article of manufacture is provided having a suction-side nominal airfoil profile substantially in accordance with suction-side Cartesian coordinate values of X, Y and Z set forth in a scalable table, the scalable table selected from the group of tables consisting of TABLES 1-11, wherein the Cartesian coordinate values of X, Y and Z are non-dimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined smoothly with one another to form a complete suction-side airfoil shape, the X, Y and Z coordinate values being scalable as a function of the number to provide at least one of a non-scaled, scaled-up and scaled-down airfoil profile.

According to yet another aspect of the present invention a compressor is provided comprising a plurality of rotor blades, each of the rotor blades including an airfoil having a suction-side airfoil shape, the airfoil having a nominal profile substantially in accordance with suction-side Cartesian coordinate values of X, Y and Z set forth in a scalable table, the scalable table selected from the group of tables consisting of TABLES 1-11, wherein the Cartesian coordinate values of X, Y and Z are non-dimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined with one another to form a complete suction-side airfoil shape.

These and other features and improvements of the present invention should become apparent to one of ordinary skill in the art upon review of the following detailed description when taken in conjunction with the several drawings and the appended claims.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features. Turbomachinery is defined as one or more machines that transfer energy between a rotor and a fluid or vice-versa, including but not limited to gas turbines, steam turbines and compressors.

Figure 1:
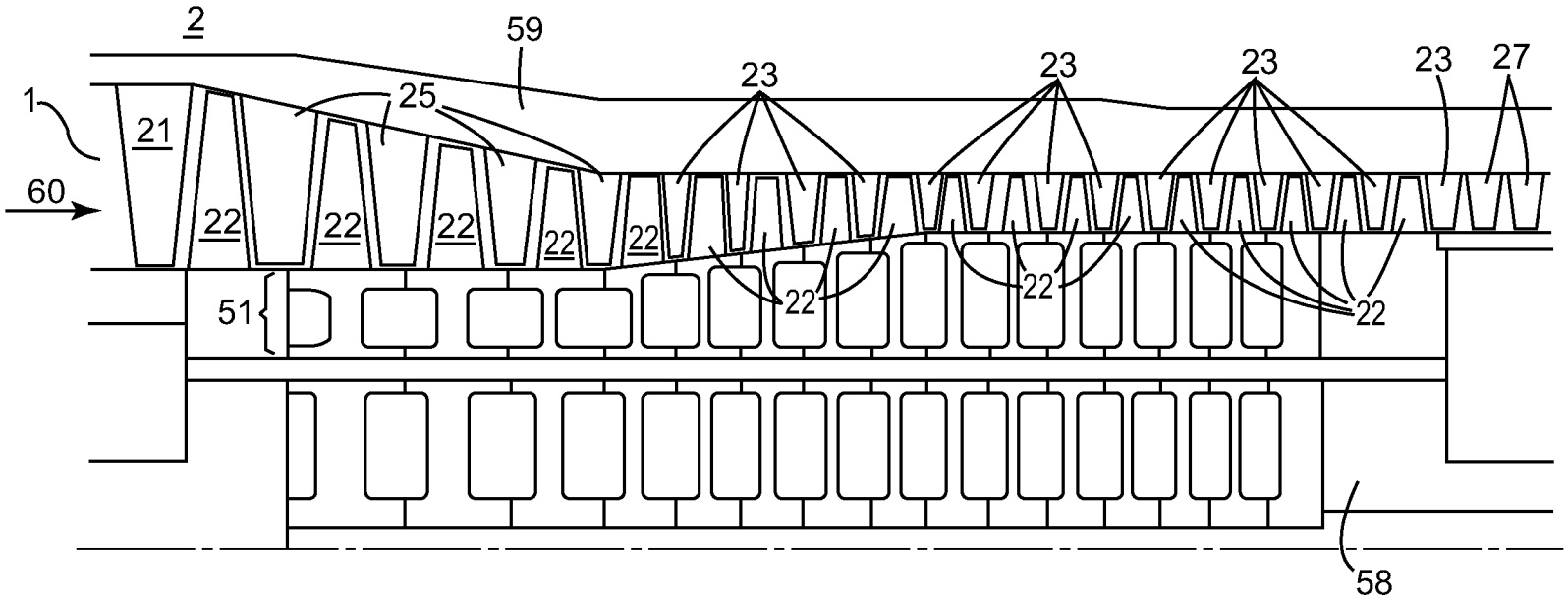
FIG. 1 is a schematic representation of a compressor flow path through multiple stages and illustrates exemplary compressor stages according to an aspect of the invention.

Referring now to the drawings, FIG. 1 illustrates an axial compressor flow path 1 of a compressor 2 that includes a plurality of compressor stages. The compressor 2 may be used in conjunction with, or as part of, a gas turbine. As one non-limiting example only, the compressor flow path 1 may comprise about eighteen rotor/stator stages. However, the exact number of rotor and stator stages is a choice of engineering design, and may be more or less than the illustrated eighteen stages. It is to be understood that any number of rotor and stator stages can be provided in the compressor, as embodied by the invention. The eighteen stages are merely exemplary of one turbine/compressor design, and are not intended to limit the invention in any manner.

The compressor rotor blades 22 impart kinetic energy to the airflow and therefore bring about a desired pressure rise. Directly following the rotor blades 22 is a stage of stator compressor vanes 23. However, in some designs the stator vanes may precede the rotor blades. Both the rotor blades and stator vanes turn the airflow, slow the airflow velocity (in the respective airfoil frame of reference), and yield a rise in the static pressure of the airflow. Typically, multiple rows of rotor/stator stages are arranged in axial flow compressors to achieve a desired discharge to inlet pressure ratio. Each rotor blade and stator vane includes an airfoil, and these airfoils can be secured to rotor wheels or a stator case by an appropriate attachment configuration, often known as a "root," "base" or "dovetail". In addition, compressors may also include inlet guide vanes (IGVs) 21, variable stator vanes (VSVs) 25 and exit or exhaust guide vanes (EGVs) 27. All of these blades and vanes have airfoils that act on the medium (e.g., air) passing through the compressor flow path 1.

Exemplary stages of the compressor 2 are illustrated in FIG. 1. One stage of the compressor 2 comprises a plurality of circumferentially spaced rotor blades 22 mounted on a rotor wheel 51 and a plurality of circumferentially spaced stator vanes 23 attached to a static compressor case 59. Each of the rotor wheels 51 may be attached to an aft drive shaft 58, which may be connected to the turbine section of the engine. The rotor blades and stator vanes lie in the flow path 1 of the compressor 2. The direction of airflow through the compressor flow path 1, as embodied by the invention, is indicated by the arrow 60 (FIG. 1), and flows generally from left to right in the illustration.

The rotor blades 22 and stator vanes 23 herein of the compressor 2 are merely exemplary of the stages of the compressor 2 within the scope of the invention. In addition, each inlet guide vane 21, rotor blade 22, stator vane 23, variable stator vane 25 and exit guide vane 27 may be considered an article of manufacture. Further, the article of manufacture may comprise a rotor blade configured for use with a compressor.

Figure 2:
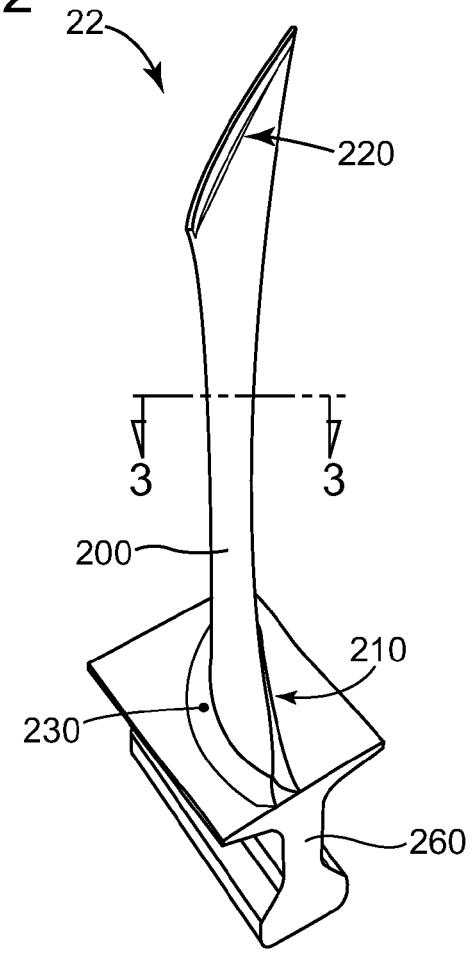
FIG. 2 is a perspective view of a rotor blade, according to an aspect of the invention.

A rotor blade 22, illustrated in FIG. 2, is provided with an airfoil 200. Each of the rotor blades 22 has an airfoil profile at any cross-section from the airfoil root 220 to the airfoil tip 210. The airfoil connects to a mounting base 260, which may also be referred to as a dovetail. The mounting base fits into a complementary shaped groove or slot in the rotor or rotor wheel 51. Embodiments of the compressor may incorporate a variety of blades 22 and vanes 21, 23, 25, 27 arranged in multiple stages.

Figure 3:
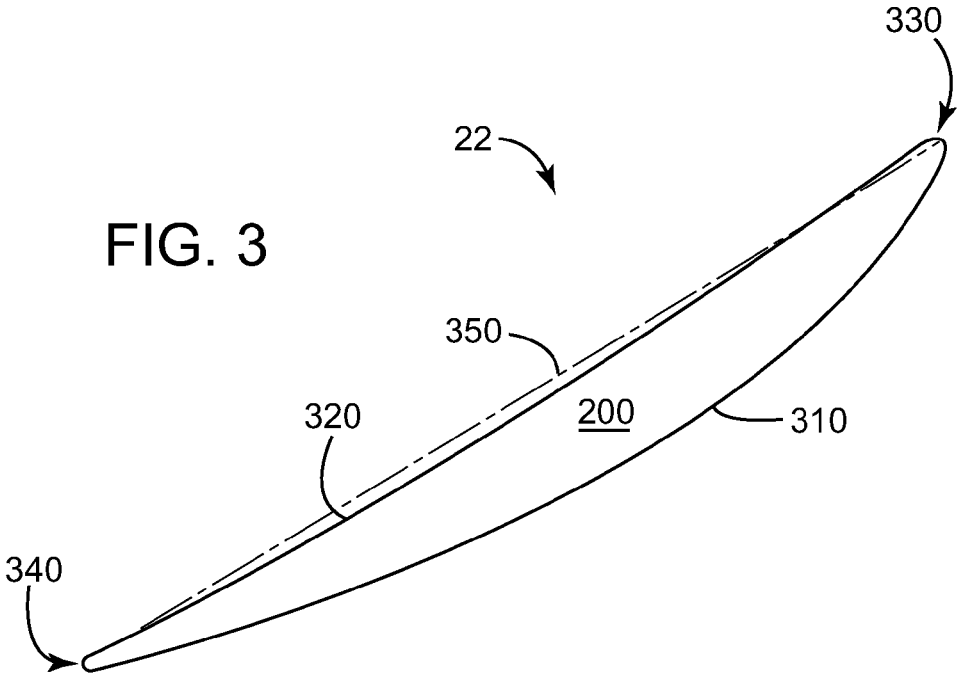
FIG. 3 is a cross-sectional view of the rotor blade airfoil taken generally about line 3-3 in FIG. 2, according to an aspect of the present invention.

Referring to FIG. 3, it will be appreciated that each rotor blade 22 has an airfoil 200 as illustrated. The airfoil 200 has a suction side 310 and a pressure side 320. The suction side 310 is located on the opposing side of the airfoil from the pressure side 320. Thus, each rotor blade 22 has an airfoil profile at any cross-section in the shape of the airfoil 200. The airfoil 200 also includes a leading edge 330 and a trailing edge 340, and a chord length 350 extends therebetween. The root of the airfoil corresponds to the lowest non-dimensional Z value of scalable Tables 1-11. The tip of the airfoil corresponds to the highest non-dimensional Z value of scalable Tables 1-11. An airfoil may extend beyond the compressor flowpath and may be tipped to achieve the desired endwall clearances. As non-limiting examples only, the height of the airfoil 200 may be from about 1 inch to about 20 inches or more, about 2 inches to about 18 inches, or about 4 inches to about 15 inches. However, any specific airfoil height may be used as desired in the specific application.

The compressor flow path 1 requires airfoils that meet system requirements of aerodynamic and mechanical blade/vane loading and efficiency. For example, it is desirable that the airfoils are designed to reduce the vibratory response or vibratory stress response of the respective blades and/or vanes. Materials such as high strength alloys, non-corrosive alloys and/or stainless steels may be used in the blades and/or vanes. To define the airfoil shape of each blade airfoil and/or vane airfoil, there is a unique set or loci of points in space that meet the stage requirements and can be manufactured. These unique loci of points meet the requirements for stage efficiency and are arrived at by iteration between aerodynamic and mechanical loadings enabling the turbine and compressor to run in an efficient, safe, reliable and smooth manner. These points are unique and specific to the system. The locus that defines the airfoil profile includes a set of points with X, Y and Z coordinates relative to a reference origin coordinate system. The three-dimensional Cartesian coordinate system of X, Y and Z values given in scalable Tables 1-11 below defines the profile of the rotor blade airfoil at various locations along its length. Scalable Tables 1-11 list data for a non-coated airfoil. The envelope/tolerance for the coordinates is about +/−5% of the chord length 350 in a direction normal to any airfoil surface location, or about +/−0.25 inches in a direction normal to any airfoil surface location. However, tolerances of about +/−0.15 inches to about +/−0.25 inches, or about +/−3% to about +/−5% in a direction normal to an airfoil surface location may also be used, as desired in the specific application.

The point data origin 230 may be the mid-point of the suction or pressure side of the base or tip of the airfoil, the leading edge or trailing edge of the base of the airfoil, or any other suitable location as desired. The coordinate values for the X, Y and Z coordinates are set forth in non-dimensionalized units in scalable Tables 1-11, although other units of dimensions may be used when the values are appropriately converted. As one example only, the Cartesian coordinate values of X, Y and Z may be convertible to dimensional distances by multiplying the X, Y and Z values by a multiplying by a constant number (e.g., 100). The number, used to convert the non-dimensional values to dimensional distances, may be a fraction (e.g., ½, ¼, etc.), decimal fraction (e.g., 0.5, 1.5, 10.25, etc.), integer (e.g., 1, 2, 10, 100, etc.) or a mixed number (e.g., 1½, 10¼, etc.). The dimensional distances may be any suitable format (e.g., inches, feet, millimeters, centimeters, meters, etc.). As one non-limiting example only, the Cartesian coordinate system has orthogonally-related X, Y and Z axes and the X axis may lie generally parallel to the compressor rotor centerline, i.e., the rotary axis and a positive X coordinate value is axial toward the aft, i.e., exhaust end of the turbine. The positive Y coordinate value extends tangentially in the direction of rotation of the rotor and the positive Z coordinate value is radially outwardly toward the rotor blade tip or stator vane base. All the values in scalable Tables 1-11 are given at room temperature and are unfilleted.

By defining X and Y coordinate values at selected locations in a Z direction (or height) normal to the X, Y plane, the profile section or airfoil shape of the airfoil, at each Z height along the length of the airfoil can be ascertained. By connecting the X and Y values with smooth continuing arcs, each profile section at each Z height is fixed. The airfoil profiles of the various surface locations between each Z height are determined by smoothly connecting the adjacent profile sections to one another to form the airfoil profile.

The values in Tables 1-11 are generated and shown from zero to four or more decimal places for determining the profile of the airfoil. As the airfoil heats up the associated stress and temperature will cause a change in the X, Y and Z values. Accordingly, the values for the profile given in Tables 1-11 represent ambient, non-operating or non-hot conditions (e.g., room temperature) and are for an uncoated airfoil.

There are typical manufacturing tolerances as well as optional coatings which must be accounted for in the actual profile of the airfoil. Each section is joined smoothly with the other sections to form the complete airfoil shape. It will therefore be appreciated that +/− typical manufacturing tolerances, i.e., +/− values, including any coating thicknesses, are additive to the X and Y values given in Tables 1-11 below. Accordingly, a distance of about +/−5% of chord length and/or +/−0.25 inches in a direction normal to a surface location along the airfoil profile defines an airfoil profile envelope for this particular airfoil design and compressor, i.e., a range of variation between measured points on the actual airfoil surface at nominal cold or room temperature and the ideal position of those points as given in the Tables below at the same temperature. Additionally, a distance of about +/−5% of a chord length in a direction normal to an airfoil surface location along the airfoil profile also may define an airfoil profile envelope for this particular airfoil design. The data is scalable and the geometry pertains to all aerodynamic scales, at, above and/or below about 3,600 RPM. The rotor blade airfoil design is robust to this range of variation without impairment of mechanical and aerodynamic functions.

The coordinate values given in scalable Tables 1-11 below provide the nominal profile for exemplary stages of a compressor rotor blade.

TABLE 1

| SUCTION SIDE | | | PRESSURE SIDE | | |
|---|---|---|---|---|---|
| X | Y | Z | X | Y | Z |
| 1.46793 | −0.83508 | −1.19413 | −3.41181 | 2.109294 | −1.19413 |
| 1.46601 | −0.8441 | −1.19413 | −3.41089 | 2.109878 | −1.19413 |
| 1.461668 | −0.85554 | −1.19413 | −3.40889 | 2.111131 | −1.19413 |
| 1.453735 | −0.86865 | −1.19413 | −3.4048 | 2.113302 | −1.19413 |
| 1.440876 | −0.88176 | −1.19413 | −3.39595 | 2.116224 | −1.19413 |
| 1.41925 | −0.89295 | −1.19413 | −3.38158 | 2.117811 | −1.19413 |
| 1.387353 | −0.89445 | −1.19413 | −3.35578 | 2.114137 | −1.19413 |
| 1.347189 | −0.89278 | −1.19413 | −3.32322 | 2.102113 | −1.19413 |
| 1.298425 | −0.89044 | −1.19413 | −3.28297 | 2.080319 | −1.19413 |
| 1.240393 | −0.88719 | −1.19413 | −3.23537 | 2.048172 | −1.19413 |
| 1.172507 | −0.88285 | −1.19413 | −3.17592 | 2.002748 | −1.19413 |
| 1.092347 | −0.877 | −1.19413 | −3.10829 | 1.949141 | −1.19413 |
| 0.999996 | −0.86882 | −1.19413 | −3.03581 | 1.892277 | −1.19413 |
| 0.895621 | −0.85771 | −1.19413 | −2.95398 | 1.828817 | −1.19413 |
| 0.779389 | −0.8431 | −1.19413 | −2.86263 | 1.758844 | −1.19413 |
| 0.6513 | −0.82473 | −1.19413 | −2.76151 | 1.682609 | −1.19413 |
| 0.511605 | −0.8016 | −1.19413 | −2.65513 | 1.603868 | −1.19413 |
| 0.366398 | −0.77421 | −1.19413 | −2.54324 | 1.522957 | −1.19413 |
| 0.215848 | −0.74232 | −1.19413 | −2.42584 | 1.439874 | −1.19413 |
| 0.05987 | −0.70558 | −1.19413 | −2.30318 | 1.354203 | −1.19413 |
| −0.10129 | −0.66324 | −1.19413 | −2.17534 | 1.265944 | −1.19413 |
| −0.26712 | −0.61473 | −1.19413 | −2.04249 | 1.174845 | −1.19413 |
| −0.43671 | −0.55962 | −1.19413 | −1.90464 | 1.080741 | −1.19413 |
| −0.60955 | −0.49733 | −1.19413 | −1.76177 | 0.983797 | −1.19413 |
| −0.77989 | −0.42969 | −1.19413 | −1.61881 | 0.887021 | −1.19413 |
| −0.94764 | −0.35655 | −1.19413 | −1.4757 | 0.790495 | −1.19413 |
| −1.1128 | −0.27797 | −1.19413 | −1.33241 | 0.694303 | −1.19413 |
| −1.27538 | −0.19405 | −1.19413 | −1.18862 | 0.598779 | −1.19413 |
| −1.43562 | −0.10488 | −1.19413 | −1.04433 | 0.504006 | −1.19413 |
| −1.59343 | −0.01086 | −1.19413 | −0.89963 | 0.409818 | −1.19413 |
| −1.74907 | 0.087842 | −1.19413 | −0.75459 | 0.316382 | −1.19413 |
| −1.90221 | 0.191549 | −1.19413 | −0.60888 | 0.223697 | −1.19413 |
| −2.05168 | 0.299849 | −1.19413 | −0.46259 | 0.132181 | −1.19413 |
| −2.19647 | 0.413158 | −1.19413 | −0.31538 | 0.041917 | −1.19413 |
| −2.33625 | 0.531645 | −1.19413 | −0.16733 | −0.04668 | −1.19413 |
| −2.46667 | 0.65105 | −1.19413 | −0.02305 | −0.13043 | −1.19413 |
| −2.58833 | 0.770872 | −1.19413 | 0.117401 | −0.20908 | −1.19413 |
| −2.70189 | 0.890361 | −1.19413 | 0.254091 | −0.28265 | −1.19413 |
| −2.80785 | 1.008931 | −1.19413 | 0.38719 | −0.35087 | −1.19413 |
| −2.90672 | 1.126248 | −1.19413 | 0.516531 | −0.41383 | −1.19413 |
| −2.99849 | 1.242063 | −1.19413 | 0.642032 | −0.47178 | −1.19413 |
| −3.08307 | 1.356124 | −1.19413 | 0.763274 | −0.52488 | −1.19413 |
| −3.16031 | 1.467763 | −1.19413 | 0.874997 | −0.57097 | −1.19413 |
| −3.22694 | 1.571721 | −1.19413 | 0.97695 | −0.61072 | −1.19413 |
| −3.28364 | 1.667328 | −1.19413 | 1.068717 | −0.64487 | −1.19413 |
| −3.3309 | 1.754085 | −1.19413 | 1.150129 | −0.67393 | −1.19413 |
| −3.37223 | 1.837 | −1.19413 | 1.221021 | −0.69798 | −1.19413 |
| −3.40438 | 1.910564 | −1.19413 | 1.281224 | −0.71777 | −1.19413 |
| −3.42417 | 1.969014 | −1.19413 | 1.332827 | −0.73413 | −1.19413 |
| −3.4341 | 2.017277 | −1.19413 | 1.376331 | −0.74749 | −1.19413 |
| −3.43569 | 2.054267 | −1.19413 | 1.412236 | −0.75818 | −1.19413 |
| −3.43085 | 2.081572 | −1.19413 | 1.439958 | −0.76912 | −1.19413 |
| −3.4245 | 2.095683 | −1.19413 | 1.456574 | −0.78523 | −1.19413 |
| −3.41849 | 2.103532 | −1.19413 | 1.46459 | −0.8006 | −1.19413 |
| −3.41482 | 2.106956 | −1.19413 | 1.468097 | −0.81471 | −1.19413 |
| −3.4129 | 2.108542 | −1.19413 | 1.468765 | −0.82632 | −1.19413 |
| 1.451731 | −0.85696 | −0.79751 | −3.41615 | 2.078065 | −0.79751 |

TABLE 1-continued

| SUCTION SIDE | | | PRESSURE SIDE | | |
|---|---|---|---|---|---|
| X | Y | Z | X | Y | Z |
| 1.44956 | −0.86581 | −0.79751 | −3.41523 | 2.078733 | −0.79751 |
| 1.444968 | −0.87692 | −0.79751 | −3.41331 | 2.080069 | −0.79751 |
| 1.436618 | −0.88953 | −0.79751 | −3.40931 | 2.082407 | −0.79751 |
| 1.423258 | −0.9018 | −0.79751 | −3.40062 | 2.085747 | −0.79751 |
| 1.401214 | −0.9114 | −0.79751 | −3.38634 | 2.087918 | −0.79751 |
| 1.369651 | −0.91132 | −0.79751 | −3.36054 | 2.085413 | −0.79751 |
| 1.330072 | −0.90848 | −0.79751 | −3.32764 | 2.074892 | −0.79751 |
| 1.281976 | −0.90481 | −0.79751 | −3.28656 | 2.054768 | −0.79751 |
| 1.224778 | −0.89996 | −0.79751 | −3.23788 | 2.024625 | −0.79751 |
| 1.157895 | −0.89378 | −0.79751 | −3.17701 | 1.981539 | −0.79751 |
| 1.078987 | −0.88585 | −0.79751 | −3.10804 | 1.930103 | −0.79751 |
| 0.987972 | −0.87533 | −0.79751 | −3.03447 | 1.87516 | −0.79751 |
| 0.885184 | −0.86164 | −0.79751 | −2.95173 | 1.81337 | −0.79751 |
| 0.770705 | −0.84435 | −0.79751 | −2.85979 | 1.744816 | −0.79751 |
| 0.644704 | −0.82323 | −0.79751 | −2.75842 | 1.66975 | −0.79751 |
| 0.507179 | −0.79726 | −0.79751 | −2.65196 | 1.591761 | −0.79751 |
| 0.364394 | −0.7672 | −0.79751 | −2.54024 | 1.511434 | −0.79751 |
| 0.216265 | −0.7328 | −0.79751 | −2.42309 | 1.428685 | −0.79751 |
| 0.062959 | −0.69372 | −0.79751 | −2.30068 | 1.343515 | −0.79751 |
| −0.09544 | −0.64938 | −0.79751 | −2.17309 | 1.255757 | −0.79751 |
| −0.25868 | −0.59911 | −0.79751 | −2.04049 | 1.165159 | −0.79751 |
| −0.42577 | −0.54267 | −0.79751 | −1.90297 | 1.071556 | −0.79751 |
| −0.59619 | −0.47946 | −0.79751 | −1.76051 | 0.97503 | −0.79751 |
| −0.76419 | −0.41132 | −0.79751 | −1.61806 | 0.878504 | −0.79751 |
| −0.92961 | −0.33818 | −0.79751 | −1.47553 | 0.782145 | −0.79751 |
| −1.09251 | −0.2601 | −0.79751 | −1.33274 | 0.686036 | −0.79751 |
| −1.253 | −0.17719 | −0.79751 | −1.18954 | 0.590596 | −0.79751 |
| −1.41098 | −0.08935 | −0.79751 | −1.04592 | 0.495907 | −0.79751 |
| −1.56679 | 0.002923 | −0.79751 | −0.90188 | 0.401886 | −0.79751 |
| −1.72027 | 0.099699 | −0.79751 | −0.75751 | 0.308533 | −0.79751 |
| −1.87132 | 0.201152 | −0.79751 | −0.61256 | 0.216098 | −0.79751 |
| −2.01987 | 0.307698 | −0.79751 | −0.46693 | 0.124666 | −0.79751 |
| −2.16465 | 0.419421 | −0.79751 | −0.32064 | 0.034569 | −0.79751 |
| −2.3051 | 0.536237 | −0.79751 | −0.17335 | −0.05394 | −0.79751 |
| −2.43661 | 0.654056 | −0.79751 | −0.02989 | −0.13778 | −0.79751 |
| −2.55978 | 0.772208 | −0.79751 | 0.109803 | −0.21668 | −0.79751 |
| −2.67501 | 0.890027 | −0.79751 | 0.245741 | −0.29066 | −0.79751 |
| −2.78255 | 1.006509 | −0.79751 | 0.378005 | −0.35955 | −0.79751 |
| −2.88275 | 1.121405 | −0.79751 | 0.506678 | −0.42335 | −0.79751 |
| −2.97602 | 1.234464 | −0.79751 | 0.631511 | −0.48238 | −0.79751 |
| −3.06211 | 1.345185 | −0.79751 | 0.752168 | −0.53674 | −0.79751 |
| −3.14135 | 1.453568 | −0.79751 | 0.863307 | −0.58425 | −0.79751 |
| −3.21024 | 1.554353 | −0.79751 | 0.964592 | −0.62533 | −0.79751 |
| −3.26936 | 1.646954 | −0.79751 | 1.055774 | −0.6609 | −0.79751 |
| −3.31946 | 1.730788 | −0.79751 | 1.136602 | −0.69121 | −0.79751 |
| −3.36371 | 1.810948 | −0.79751 | 1.206993 | −0.7166 | −0.79751 |
| −3.39887 | 1.88209 | −0.79751 | 1.266779 | −0.73747 | −0.79751 |
| −3.42108 | 1.93887 | −0.79751 | 1.318048 | −0.75484 | −0.79751 |
| −3.43335 | 1.985964 | −0.79751 | 1.361217 | −0.76912 | −0.79751 |
| −3.43678 | 2.022537 | −0.79751 | 1.396872 | −0.78056 | −0.79751 |
| −3.43344 | 2.049675 | −0.79751 | 1.424427 | −0.79158 | −0.79751 |
| −3.42793 | 2.063953 | −0.79751 | 1.44096 | −0.80745 | −0.79751 |
| −3.42233 | 2.072053 | −0.79751 | 1.448892 | −0.82281 | −0.79751 |
| −3.41899 | 2.075643 | −0.79751 | 1.452232 | −0.83684 | −0.79751 |
| −3.41715 | 2.07723 | −0.79751 | 1.452733 | −0.84828 | −0.79751 |
| 1.435532 | −0.87892 | −0.40088 | −3.41882 | 2.051512 | −0.40088 |
| 1.433111 | −0.88761 | −0.40088 | −3.41791 | 2.052263 | −0.40088 |
| 1.428184 | −0.89846 | −0.40088 | −3.41607 | 2.053599 | −0.40088 |
| 1.41925 | −0.91048 | −0.40088 | −3.41214 | 2.056104 | −0.40088 |
| 1.405305 | −0.92176 | −0.40088 | −3.40363 | 2.059778 | −0.40088 |
| 1.38276 | −0.92961 | −0.40088 | −3.38943 | 2.06245 | −0.40088 |
| 1.351531 | −0.92794 | −0.40088 | −3.36363 | 2.06078 | −0.40088 |
| 1.31237 | −0.92401 | −0.40088 | −3.3304 | 2.051345 | −0.40088 |
| 1.264942 | −0.91892 | −0.40088 | −3.28881 | 2.032557 | −0.40088 |
| 1.208496 | −0.91249 | −0.40088 | −3.2393 | 2.003917 | −0.40088 |
| 1.142447 | −0.90447 | −0.40088 | −3.17743 | 1.962584 | −0.40088 |
| 1.064542 | −0.89429 | −0.40088 | −3.10737 | 1.913069 | −0.40088 |
| 0.974779 | −0.88143 | −0.40088 | −3.03289 | 1.859712 | −0.40088 |
| 0.87341 | −0.86514 | −0.40088 | −2.94939 | 1.799425 | −0.40088 |
| 0.760518 | −0.8451 | −0.40088 | −2.85687 | 1.732041 | −0.40088 |
| 0.636187 | −0.82114 | −0.40088 | −2.75517 | 1.657893 | −0.40088 |
| 0.500583 | −0.79225 | −0.40088 | −2.6487 | 1.580572 | −0.40088 |
| 0.359802 | −0.75943 | −0.40088 | −2.53706 | 1.500579 | −0.40088 |
| 0.213844 | −0.72244 | −0.40088 | −2.42025 | 1.417997 | −0.40088 |
| 0.062709 | −0.68094 | −0.40088 | −1.29817 | 1.332994 | −0.40088 |
| −0.09335 | −0.63443 | −0.40088 | −2.17092 | 1.245319 | −0.40088 |

TABLE 1-continued

| SUCTION SIDE | | | PRESSURE SIDE | | |
|---|---|---|---|---|---|
| X | Y | Z | X | Y | Z |
| −0.25434 | −0.58225 | −0.40088 | −2.03857 | 1.154972 | −0.40088 |
| −0.41909 | −0.52421 | −0.40088 | −1.90138 | 1.061619 | −0.40088 |
| −0.58734 | −0.45992 | −0.40088 | −1.75926 | 0.965344 | −0.40088 |
| −0.75317 | −0.39103 | −0.40088 | −1.61706 | 0.869152 | −0.40088 |
| −0.91666 | −0.31772 | −0.40088 | −1.47486 | 0.77296 | −0.40088 |
| −1.07773 | −0.23973 | −0.40088 | −1.33249 | 0.677102 | −0.40088 |
| −1.23638 | −0.15723 | −0.40088 | −1.18962 | 0.581828 | −0.40088 |
| −1.3927 | −0.07031 | −0.40088 | −1.04642 | 0.487223 | −0.40088 |
| −1.54667 | 0.021042 | −0.40088 | −0.9028 | 0.393285 | −0.40088 |
| −1.69839 | 0.11665 | −0.40088 | −0.75876 | 0.299932 | −0.40088 |
| −1.84786 | 0.216516 | −0.40088 | −0.61423 | 0.207331 | −0.40088 |
| −1.99482 | 0.321225 | −0.40088 | −0.46894 | 0.115898 | −0.40088 |
| −2.13894 | 0.431111 | −0.40088 | −0.32289 | 0.025635 | −0.40088 |
| −2.27922 | 0.546007 | −0.40088 | −0.17593 | −0.06321 | −0.40088 |
| −2.41081 | 0.661571 | −0.40088 | −0.03282 | −0.14738 | −0.40088 |
| −2.53431 | 0.777135 | −0.40088 | 0.106463 | −0.22662 | −0.40088 |
| −2.65012 | 0.892365 | −0.40088 | 0.241816 | −0.30102 | −0.40088 |
| −2.75842 | 1.006342 | −0.40088 | 0.373412 | −0.37041 | −0.40088 |
| −2.85971 | 1.118566 | −0.40088 | 0.501084 | −0.43487 | −0.40088 |
| −2.95415 | 1.22887 | −0.40088 | 0.624831 | −0.49465 | −0.40088 |
| −3.04182 | 1.336919 | −0.40088 | 0.744486 | −0.54993 | −0.40088 |
| −3.12298 | 1.442379 | −0.40088 | 0.854456 | −0.59853 | −0.40088 |
| −3.19404 | 1.540325 | −0.40088 | 0.954739 | −0.64078 | −0.40088 |
| −3.25558 | 1.630087 | −0.40088 | 1.044919 | −0.67752 | −0.40088 |
| −3.30819 | 1.711333 | −0.40088 | 1.124912 | −0.70908 | −0.40088 |
| −3.3552 | 1.788988 | −0.40088 | 1.194468 | −0.73564 | −0.40088 |
| −3.39286 | 1.858042 | −0.40088 | 1.253586 | −0.75751 | −0.40088 |
| −3.41715 | 1.913403 | −0.40088 | 1.304187 | −0.7758 | −0.40088 |
| −3.43135 | 1.959578 | −0.40088 | 1.346855 | −0.79083 | −0.40088 |
| −3.43644 | 1.995567 | −0.40088 | 1.382092 | −0.80294 | −0.40088 |
| −3.43452 | 2.022621 | −0.40088 | 1.40948 | −0.81429 | −0.40088 |
| −3.42968 | 2.036983 | −0.40088 | 1.425679 | −0.83007 | −0.40088 |
| −3.42459 | 2.045333 | −0.40088 | 1.433361 | −0.84527 | −0.40088 |
| −3.4215 | 2.049007 | −0.40088 | 1.436451 | −0.85913 | −0.40088 |
| −3.41974 | 2.050677 | −0.40088 | 1.436701 | −0.87049 | −0.40088 |
| 1.419166 | −0.90105 | 0 | −3.4174 | 2.035897 | 0 |
| 1.416494 | −0.90957 | 0 | −3.41649 | 2.036732 | 0 |
| 1.41115 | −0.92017 | 0 | −3.41473 | 2.038152 | 0 |
| 1.401715 | −0.93161 | 0 | −3.41089 | 2.04074 | 0 |
| 1.387102 | −0.94188 | 0 | −3.40246 | 2.044581 | 0 |
| 1.364223 | −0.94781 | 0 | −3.38835 | 2.04742 | 0 |
| 1.333245 | −0.94472 | 0 | −3.36255 | 2.045917 | 0 |
| 1.294584 | −0.93954 | 0 | −3.32931 | 2.036816 | 0 |
| 1.247657 | −0.93303 | 0 | −3.28756 | 2.018529 | 0 |
| 1.191963 | −0.92493 | 0 | −3.2378 | 1.990473 | 0 |
| 1.126749 | −0.91499 | 0 | −3.17559 | 1.949892 | 0 |
| 1.049762 | −0.90255 | 0 | −3.1052 | 1.901128 | 0 |
| 0.961169 | −0.88719 | 0 | −3.03055 | 1.848523 | 0 |
| 0.861136 | −0.86815 | 0 | −2.9468 | 1.788904 | 0 |
| 0.749747 | −0.84535 | 0 | −2.85411 | 1.722188 | 0 |
| 0.627002 | −0.81838 | 0 | −2.75241 | 1.648541 | 0 |
| 0.493235 | −0.78657 | 0 | −2.64603 | 1.571554 | 0 |
| 0.354291 | −0.75092 | 0 | −2.53464 | 1.491728 | 0 |
| 0.21017 | −0.71125 | 0 | −2.41816 | 1.40923 | 0 |
| 0.061039 | −0.66733 | 0 | −2.2965 | 1.324143 | 0 |
| −0.0931 | −0.61865 | 0 | −2.16958 | 1.236635 | 0 |
| −0.25192 | −0.56463 | 0 | −2.03773 | 1.146288 | 0 |
| −0.41458 | −0.50518 | 0 | −1.90088 | 1.053102 | 0 |
| −0.58074 | −0.43954 | 0 | −1.75909 | 0.95691 | 0 |
| −0.74465 | −0.36982 | 0 | −1.61731 | 0.860802 | 0 |
| −0.90631 | −0.29592 | 0 | −1.47553 | 0.764777 | 0 |
| −1.06563 | −0.21777 | 0 | −1.3335 | 0.669002 | 0 |
| −1.22261 | −0.13544 | 0 | −1.19104 | 0.573896 | 0 |
| −1.37733 | −0.04876 | 0 | −1.04809 | 0.479541 | 0 |
| −1.5298 | 0.042001 | 0 | −0.90481 | 0.38577 | 0 |
| −1.68002 | 0.136773 | 0 | −0.76119 | 0.292501 | 0 |
| −1.82807 | 0.235637 | 0 | −0.61715 | 0.199983 | 0 |
| −1.97377 | 0.338927 | 0 | −0.47244 | 0.108383 | 0 |
| −2.11673 | 0.447143 | 0 | −0.32707 | 0.017869 | 0 |
| −2.25667 | 0.560369 | 0 | −0.18069 | −0.07106 | 0 |
| −2.38835 | 0.674012 | 0 | −0.03824 | −0.15548 | 0 |
| −2.5121 | 0.787572 | 0 | 0.100451 | −0.23514 | 0 |
| −2.62825 | 0.900464 | 0 | 0.23522 | −0.31004 | 0 |
| −2.73721 | 1.012271 | 0 | 0.366064 | −0.38001 | 0 |
| −2.83933 | 1.122324 | 0 | 0.492984 | −0.44522 | 0 |
| −2.93469 | 1.230289 | 0 | 0.615896 | −0.50593 | 0 |

TABLE 1-continued

| SUCTION SIDE | | | PRESSURE SIDE | | |
|---|---|---|---|---|---|
| X | Y | Z | X | Y | Z |
| −3.02362 | 1.336 | 0 | 0.73455 | −0.56221 | 0 |
| −3.1062 | 1.439039 | 0 | 0.843684 | −0.61206 | 0 |
| −3.17901 | 1.534647 | 0 | 0.943133 | −0.65556 | 0 |
| −3.24231 | 1.622238 | 0 | 1.032478 | −0.69363 | 0 |
| −3.29658 | 1.70148 | 0 | 1.111636 | −0.72645 | 0 |
| −3.34543 | 1.777131 | 0 | 1.180607 | −0.75417 | 0 |
| −3.38476 | 1.844599 | 0 | 1.239057 | −0.77713 | 0 |
| −3.41064 | 1.898874 | 0 | 1.28924 | −0.79642 | 0 |
| −3.42626 | 1.944298 | 0 | 1.331408 | −0.81237 | 0 |
| −3.4326 | 1.979702 | 0 | 1.366311 | −0.82523 | 0 |
| −3.43185 | 2.006756 | 0 | 1.393615 | −0.83667 | 0 |
| −3.42768 | 2.021118 | 0 | 1.409898 | −0.85237 | 0 |
| −3.423 | 2.029635 | 0 | 1.417496 | −0.86748 | 0 |
| −3.41999 | 2.033392 | 0 | 1.420502 | −0.88134 | 0 |
| −3.41832 | 2.035062 | 0 | 1.420502 | −0.89262 | 0 |
| 1.403134 | −0.92259 | 0.392367 | −3.41064 | 2.036816 | 0.392367 |
| 1.400212 | −0.93103 | 0.392367 | −3.40972 | 2.037567 | 0.392367 |
| 1.39445 | −0.9413 | 0.392367 | −3.40797 | 2.03907 | 0.392367 |
| 1.384514 | −0.95223 | 0.392367 | −3.40413 | 2.041659 | 0.392367 |
| 1.3694 | −0.96142 | 0.392367 | −3.39569 | 2.045416 | 0.392367 |
| 1.346271 | −0.96568 | 0.392367 | −3.38158 | 2.048005 | 0.392367 |
| 1.315543 | −0.96117 | 0.392367 | −3.35578 | 2.046001 | 0.392367 |
| 1.277383 | −0.95474 | 0.392367 | −3.35578 | 2.036315 | 0.392367 |
| 1.230957 | −0.94672 | 0.392367 | −3.28138 | 2.017527 | 0.392367 |
| 1.175847 | −0.93679 | 0.392367 | −3.23195 | 1.98897 | 0.392367 |
| 1.111469 | −0.92485 | 0.392367 | −3.17024 | 1.947888 | 0.392367 |
| 1.0354 | −0.91007 | 0.392367 | −3.10052 | 1.89854 | 0.392367 |
| 0.947892 | −0.89203 | 0.392367 | −3.02637 | 1.845434 | 0.392367 |
| 0.849028 | −0.87024 | 0.392367 | −2.94321 | 1.785397 | 0.392367 |
| 0.738892 | −0.84452 | 0.392367 | −2.85111 | 1.718263 | 0.392367 |
| 0.61765 | −0.81454 | 0.392367 | −2.74982 | 1.644282 | 0.392367 |
| 0.485386 | −0.77981 | 0.392367 | −2.64394 | 1.567128 | 0.392367 |
| 0.347861 | −0.74156 | 0.392367 | −2.53306 | 1.486968 | 0.392367 |
| 0.205327 | −0.6994 | 0.392367 | −2.41707 | 1.40422 | 0.392367 |
| 0.057782 | −0.65322 | 0.392367 | −2.29592 | 1.318883 | 0.392367 |
| −0.09469 | −0.60237 | 0.392367 | −2.1695 | 1.231208 | 0.392367 |
| −0.25184 | −0.54651 | 0.392367 | −2.03807 | 1.140777 | 0.392367 |
| −0.41266 | −0.4853 | 0.392367 | −1.90163 | 1.047424 | 0.392367 |
| −0.57707 | −0.41825 | 0.392367 | −1.76026 | 0.951232 | 0.392367 |
| −0.73923 | −0.34736 | 0.392367 | −1.6189 | 0.855124 | 0.392367 |
| −0.89921 | −0.27246 | 0.392367 | −1.47745 | 0.759099 | 0.392367 |
| −1.05703 | −0.19372 | 0.392367 | −1.33575 | 0.663408 | 0.392367 |
| −1.21267 | −0.11097 | 0.392367 | −1.19375 | 0.568301 | 0.392367 |
| −1.36598 | −0.02422 | 0.392367 | −1.05118 | 0.473863 | 0.392367 |
| −1.51711 | 0.06655 | 0.392367 | −0.90823 | 0.380009 | 0.392367 |
| −1.66616 | 0.160988 | 0.392367 | −0.76503 | 0.286739 | 0.392367 |
| −1.81312 | 0.259268 | 0.392367 | −0.62132 | 0.194054 | 0.392367 |
| −1.95774 | 0.361639 | 0.392367 | −0.47712 | 0.102204 | 0.392367 |
| −2.09969 | 0.468686 | 0.392367 | −0.33225 | 0.01144 | 0.392367 |
| −2.23897 | 0.580659 | 0.392367 | −0.18646 | −0.07799 | 0.392367 |
| −2.37065 | 0.69305 | 0.392367 | −0.04467 | −0.16274 | 0.392367 |
| −2.49456 | 0.805191 | 0.392367 | 0.093353 | −0.24282 | 0.392367 |
| −2.61088 | 0.91658 | 0.392367 | 0.227454 | −0.3183 | 0.392367 |
| −2.72026 | 1.0268 | 0.392367 | 0.357714 | −0.38911 | 0.392367 |
| −2.8228 | 1.135266 | 0.392367 | 0.483883 | −0.45516 | 0.392367 |
| −2.91874 | 1.241645 | 0.392367 | 0.60596 | −0.51678 | 0.392367 |
| −3.00825 | 1.345853 | 0.392367 | 0.723862 | −0.57415 | 0.392367 |
| −3.09167 | 1.447389 | 0.392367 | 0.832161 | −0.625 | 0.392367 |
| −3.16515 | 1.541577 | 0.392367 | 0.930858 | −0.66975 | 0.392367 |
| −3.22911 | 1.627916 | 0.392367 | 1.019452 | −0.70892 | 0.392367 |
| −3.28414 | 1.706072 | 0.392367 | 1.097942 | −0.74298 | 0.392367 |
| −3.37382 | 1.780638 | 0.392367 | 1.166161 | −0.77187 | 0.392367 |
| −3.37382 | 1.847187 | 0.392367 | 1.22411 | −0.79592 | 0.392367 |
| −3.40045 | 1.900711 | 0.392367 | 1.273709 | −0.81613 | 0.392367 |
| −3.41682 | 1.945467 | 0.392367 | 1.315543 | −0.83291 | 0.392367 |
| −3.42408 | 1.980537 | 0.392367 | 1.350028 | −0.84652 | 0.392367 |
| −3.42417 | 2.00734 | 0.392367 | 1.377249 | −0.85796 | 0.392367 |
| −3.42049 | 2.021869 | 0.392367 | 1.394033 | −0.87341 | 0.392367 |
| −3.41607 | 2.030386 | 0.392367 | 1.401965 | −0.88861 | 0.392367 |
| −3.41315 | 2.034227 | 0.392367 | 1.404888 | −0.90264 | 0.392367 |
| −3.41148 | 2.035981 | 0.392367 | 1.404721 | −0.91407 | 0.392367 |
| 1.385265 | −0.94497 | 0.788992 | −3.3977 | 2.056605 | 0.788992 |
| 1.382092 | −0.95324 | 0.788992 | −3.39686 | 2.05744 | 0.788992 |
| 1.375913 | −0.96326 | 0.788992 | −3.39503 | 2.05886 | 0.788992 |
| 1.365476 | −0.97353 | 0.788992 | −3.39119 | 2.061365 | 0.788992 |
| 1.349945 | −0.98188 | 0.788992 | −3.38267 | 2.064955 | 0.788992 |

TABLE 1-continued

| SUCTION SIDE | | | PRESSURE SIDE | | |
|---|---|---|---|---|---|
| X | Y | Z | X | Y | Z |
| 1.326648 | −0.98447 | 0.788992 | −3.36839 | 2.066959 | 0.788992 |
| 1.296338 | −0.97862 | 0.788992 | −3.34276 | 2.063953 | 0.788992 |
| 1.258596 | −0.97085 | 0.788992 | −3.31019 | 2.053265 | 0.788992 |
| 1.212838 | −0.96117 | 0.788992 | −3.26928 | 2.033225 | 0.788992 |
| 1.158396 | −0.9494 | 0.788992 | −3.2206 | 2.003332 | 0.788992 |
| 1.094685 | −0.93528 | 0.788992 | −3.15997 | 1.960831 | 0.788992 |
| 1.019619 | −0.91808 | 0.788992 | −3.09142 | 1.909896 | 0.788992 |
| 0.933113 | −0.89737 | 0.788992 | −3.01853 | 1.855287 | 0.788992 |
| 0.835501 | −0.87274 | 0.788992 | −2.9367 | 1.79358 | 0.788992 |
| 0.726701 | −0.84402 | 0.788992 | −2.84576 | 1.724943 | 0.788992 |
| 0.606795 | −0.81104 | 0.788992 | −2.74573 | 1.649459 | 0.788992 |
| 0.476034 | −0.77338 | 0.788992 | −2.64102 | 1.570886 | 0.788992 |
| 0.340096 | −0.7323 | 0.788992 | −2.53122 | 1.48939 | 0.788992 |
| 0.199064 | −0.68746 | 0.788992 | −2.41632 | 1.405305 | 0.788992 |
| 0.053023 | −0.63861 | 0.788992 | −2.29617 | 1.318883 | 0.788992 |
| −0.09778 | −0.58534 | 0.788992 | −2.17058 | 1.230206 | 0.788992 |
| −0.25309 | −0.52722 | 0.788992 | −2.03974 | 1.13894 | 0.788992 |
| −0.41216 | −0.46401 | 0.788992 | −1.90388 | 1.045086 | 0.788992 |
| −0.5749 | −0.39504 | 0.788992 | −1.76294 | 0.94856 | 0.788992 |
| −0.73564 | −0.32256 | 0.788992 | −1.62182 | 0.852285 | 0.788992 |
| −0.89437 | −0.24641 | 0.788992 | −1.48054 | 0.756176 | 0.788992 |
| −1.05101 | −0.16658 | 0.788992 | −1.33909 | 0.660485 | 0.788992 |
| −1.20557 | −0.08292 | 0.788992 | −1.19722 | 0.565295 | 0.788992 |
| −1.35804 | 0.004509 | 0.788992 | −1.05511 | 0.470523 | 0.788992 |
| −1.50843 | 0.095691 | 0.788992 | −0.91257 | 0.376335 | 0.788992 |
| −1.65689 | 0.19038 | 0.788992 | −0.7697 | 0.282648 | 0.788992 |
| −1.80335 | 0.28866 | 0.788992 | −0.62642 | 0.189545 | 0.788992 |
| −1.94755 | 0.390947 | 0.788992 | −0.48271 | 0.097278 | 0.788992 |
| −2.08925 | 0.497827 | 0.788992 | −0.33834 | 0.005929 | 0.788992 |
| −2.22811 | 0.609383 | 0.788992 | −0.19314 | −0.08417 | 0.788992 |
| −2.35921 | 0.721023 | 0.788992 | −0.05185 | −0.16967 | 0.788992 |
| −2.48246 | 0.832412 | 0.788992 | 0.085504 | −0.25058 | 0.788992 |
| −2.59835 | 0.943216 | 0.788992 | 0.218854 | −0.3269 | 0.788992 |
| −2.70724 | 1.052768 | 0.788992 | 0.348362 | −0.39863 | 0.788992 |
| −2.80927 | 1.16065 | 0.788992 | 0.473779 | −0.46576 | 0.788992 |
| −2.90488 | 1.266445 | 0.788992 | 0.595188 | −0.52864 | 0.788992 |
| −2.99398 | 1.370068 | 0.788992 | 0.712339 | −0.58726 | 0.788992 |
| −3.07706 | 1.47102 | 0.788992 | 0.81997 | −0.63936 | 0.788992 |
| −3.15029 | 1.564623 | 0.788992 | 0.917999 | −0.68537 | 0.788992 |
| −3.21408 | 1.650378 | 0.788992 | 1.006008 | −0.72578 | 0.788992 |
| −3.26903 | 1.728033 | 0.788992 | 1.08383 | −0.76102 | 0.788992 |
| −3.31862 | 1.802097 | 0.788992 | 1.151549 | −0.79108 | 0.788992 |
| −3.3587 | 1.868062 | 0.788992 | 1.208997 | −0.81613 | 0.788992 |
| −3.38551 | 1.921168 | 0.788992 | 1.258178 | −0.83725 | 0.788992 |
| −3.40229 | 1.96559 | 0.788992 | 1.299594 | −0.85487 | 0.788992 |
| −3.41006 | 2.00041 | 0.788992 | 1.333746 | −0.86915 | 0.788992 |
| −3.41064 | 2.027213 | 0.788992 | 1.3608 | −0.88101 | 0.788992 |
| −3.40738 | 2.041659 | 0.788992 | 1.377333 | −0.89629 | 0.788992 |
| −3.40313 | 2.050176 | 0.788992 | 1.384931 | −0.9114 | 0.788992 |
| −3.4002 | 2.054017 | 0.788992 | 1.387603 | −0.92535 | 0.788992 |
| −3.39862 | 2.05577 | 0.788992 | 1.387102 | −0.93662 | 0.788992 |
| 1.358211 | −0.97094 | 1.185617 | −3.37891 | 2.088001 | 1.185617 |
| 1.354621 | −0.97895 | 1.185617 | −3.37808 | 2.088753 | 1.185617 |
| 1.348024 | −0.98864 | 1.185617 | −3.37624 | 2.090172 | 1.185617 |
| 1.337086 | −0.99833 | 1.185617 | −3.3724 | 2.092677 | 1.185617 |
| 1.321137 | −1.00559 | 1.185617 | −3.36371 | 2.095934 | 1.185617 |
| 1.297841 | −1.00659 | 1.185617 | −3.34935 | 2.097353 | 1.185617 |
| 1.268031 | −0.99941 | 1.185617 | −3.32388 | 2.093345 | 1.185617 |
| 1.230874 | −0.99014 | 1.185617 | −3.29182 | 2.081488 | 1.185617 |
| 1.1857 | −0.9787 | 1.185617 | −3.25149 | 2.060112 | 1.185617 |
| 1.13201 | −0.96493 | 1.185617 | −3.2039 | 2.028967 | 1.185617 |
| 1.069218 | −0.94856 | 1.185617 | −3.14453 | 1.984879 | 1.185617 |
| 0.995237 | −0.92877 | 1.185617 | −3.07739 | 1.932274 | 1.185617 |
| 0.909983 | −0.90514 | 1.185617 | −3.006 | 1.875911 | 1.185617 |
| 0.813708 | −0.87733 | 1.185617 | −2.92576 | 1.812451 | 1.185617 |
| 0.706494 | −0.84519 | 1.185617 | −2.83658 | 1.741894 | 1.185617 |
| 0.588341 | −0.8087 | 1.185617 | −2.73847 | 1.664322 | 1.185617 |
| 0.45925 | −0.76745 | 1.185617 | −2.63559 | 1.583578 | 1.185617 |
| 0.325149 | −0.72303 | 1.185617 | −2.5278 | 1.499911 | 1.185617 |
| 0.185955 | −0.67493 | 1.185617 | −2.41482 | 1.413655 | 1.185617 |
| 0.041834 | −0.62299 | 1.185617 | −2.2965 | 1.325062 | 1.185617 |
| −0.10713 | −0.56688 | 1.185617 | −2.17259 | 1.234381 | 1.185617 |
| −0.26044 | −0.50626 | 1.185617 | −2.04333 | 1.141529 | 1.185617 |
| −0.41775 | −0.44071 | 1.185617 | −1.90856 | 1.046506 | 1.185617 |
| −0.57874 | −0.36982 | 1.185617 | −1.76836 | 0.949395 | 1.185617 |
| −0.73789 | −0.29559 | 1.185617 | −1.62775 | 0.852869 | 1.185617 |

TABLE 1-continued

| SUCTION SIDE | | | PRESSURE SIDE | | |
|---|---|---|---|---|---|
| X | Y | Z | X | Y | Z |
| −0.89529 | −0.2181 | 1.185617 | −1.48697 | 0.756594 | 1.185617 |
| −1.05068 | −0.13711 | 1.185617 | −1.34594 | 0.660736 | 1.185617 |
| −1.20415 | −0.05261 | 1.185617 | −1.20449 | 0.565295 | 1.185617 |
| −1.35562 | 0.035655 | 1.185617 | −1.06287 | 0.470356 | 1.185617 |
| −1.50509 | 0.127421 | 1.185617 | −0.92092 | 0.37575 | 1.185617 |
| −1.65272 | 0.222528 | 1.185617 | −0.77864 | 0.281646 | 1.185617 |
| −1.79834 | 0.321141 | 1.185617 | −0.63602 | 0.188209 | 1.185617 |
| −1.94188 | 0.423679 | 1.185617 | −0.49298 | 0.095357 | 1.185617 |
| −2.08282 | 0.530726 | 1.185617 | −0.34936 | 0.003424 | 1.185617 |
| −2.2206 | 0.642199 | 1.185617 | −0.20508 | −0.08742 | 1.185617 |
| −2.35036 | 0.753838 | 1.185617 | −0.06471 | −0.17393 | 1.185617 |
| −2.47227 | 0.865478 | 1.185617 | 0.071727 | −0.25601 | 1.185617 |
| −2.58666 | 0.976616 | 1.185617 | 0.204158 | −0.33367 | 1.185617 |
| −2.69413 | 1.086502 | 1.185617 | 0.332664 | −0.40681 | 1.185617 |
| −2.79483 | 1.194551 | 1.185617 | 0.456996 | −0.4757 | 1.185617 |
| −2.8891 | 1.300596 | 1.185617 | 0.577152 | −0.54033 | 1.185617 |
| −2.97711 | 1.40422 | 1.185617 | 0.693134 | −0.60078 | 1.185617 |
| −3.05927 | 1.505004 | 1.185617 | 0.799763 | −0.65472 | 1.185617 |
| −3.13175 | 1.598357 | 1.185617 | 0.896707 | −0.70249 | 1.185617 |
| −3.19504 | 1.683861 | 1.185617 | 0.983714 | −0.74457 | 1.185617 |
| −3.24957 | 1.761182 | 1.185617 | 1.060784 | −0.78131 | 1.185617 |
| −3.29883 | 1.834913 | 1.185617 | 1.127668 | −0.81279 | 1.185617 |
| −3.33875 | 1.900544 | 1.185617 | 1.184448 | −0.83909 | 1.185617 |
| −3.36555 | 1.953316 | 1.185617 | 1.233045 | −0.8613 | 1.185617 |
| −3.38242 | 1.997487 | 1.185617 | 1.27396 | −0.87984 | 1.185617 |
| −3.39052 | 2.032056 | 1.185617 | 1.307777 | −0.89495 | 1.185617 |
| −3.39144 | 2.058609 | 1.185617 | 1.334664 | −0.90731 | 1.185617 |
| −3.38843 | 2.073055 | 1.185617 | 1.351281 | −0.92242 | 1.185617 |
| −3.38434 | 2.081655 | 1.185617 | 1.358796 | −0.93754 | 1.185617 |
| −3.38142 | 2.085413 | 1.185617 | 1.361134 | −0.95148 | 1.185617 |
| −3.37983 | 2.087166 | 1.185617 | 1.360299 | −0.96267 | 1.185617 |
| 1.321889 | −1.00108 | 1.582242 | −3.35561 | 2.121318 | 1.582242 |
| 1.318048 | −1.00893 | 1.582242 | −3.3547 | 2.122069 | 1.582242 |
| 1.31095 | −1.0182 | 1.582242 | −3.35286 | 2.123489 | 1.582242 |
| 1.299594 | −1.02722 | 1.582242 | −3.34893 | 2.125827 | 1.582242 |
| 1.283312 | −1.03331 | 1.582242 | −3.34025 | 2.128833 | 1.582242 |
| 1.260099 | −1.03248 | 1.582242 | −3.32589 | 2.129751 | 1.582242 |
| 1.230874 | −1.02388 | 1.582242 | −3.30059 | 2.124741 | 1.582242 |
| 1.194301 | −1.01311 | 1.582242 | −3.26911 | 2.111882 | 1.582242 |
| 1.149962 | −0.99983 | 1.582242 | −3.22945 | 2.089337 | 1.582242 |
| 1.09719 | −0.98388 | 1.582242 | −3.18285 | 2.056939 | 1.582242 |
| 1.035484 | −0.96501 | 1.582242 | −3.1249 | 2.011432 | 1.582242 |
| 0.962755 | −0.94238 | 1.582242 | −3.05927 | 1.957324 | 1.582242 |
| 0.879005 | −0.91558 | 1.582242 | −2.98947 | 1.899458 | 1.582242 |
| 0.784399 | −0.88427 | 1.582242 | −2.91098 | 1.834245 | 1.582242 |
| 0.678939 | −0.84861 | 1.582242 | −2.82372 | 1.76185 | 1.582242 |
| 0.562707 | −0.80836 | 1.582242 | −2.72769 | 1.682191 | 1.582242 |
| 0.43562 | −0.76344 | 1.582242 | −2.62708 | 1.599276 | 1.582242 |
| 0.303523 | −0.71534 | 1.582242 | −2.5217 | 1.513187 | 1.582242 |
| 0.166332 | −0.66399 | 1.582242 | −2.41115 | 1.42451 | 1.582242 |
| 0.024299 | −0.60897 | 1.582242 | −2.29525 | 1.333328 | 1.582242 |
| −0.12258 | −0.55001 | 1.582242 | −2.17384 | 1.240142 | 1.582242 |
| −0.2738 | −0.48697 | 1.582242 | −2.04675 | 1.145036 | 1.582242 |
| −0.42886 | −0.41917 | 1.582242 | −1.9139 | 1.048259 | 1.582242 |
| −0.58767 | −0.34636 | 1.582242 | −1.77504 | 0.950147 | 1.582242 |
| −0.74474 | −0.27071 | 1.582242 | −1.63535 | 0.853036 | 1.582242 |
| −0.89996 | −0.19213 | 1.582242 | −1.49532 | 0.75651 | 1.582242 |
| −1.05335 | −0.11039 | 1.582242 | −1.35504 | 0.660318 | 1.582242 |
| −1.20474 | −0.02538 | 1.582242 | −1.21442 | 0.564711 | 1.582242 |
| −1.35395 | 0.063043 | 1.582242 | −1.07348 | 0.469604 | 1.582242 |
| −1.50125 | 0.154726 | 1.582242 | −0.93228 | 0.374832 | 1.582242 |
| −1.64654 | 0.249582 | 1.582242 | −0.79066 | 0.28056 | 1.582242 |
| −1.78982 | 0.347778 | 1.582242 | −0.6488 | 0.186706 | 1.582242 |
| −1.93085 | 0.449731 | 1.582242 | −0.50659 | 0.09352 | 1.582242 |
| −2.06921 | 0.555943 | 1.582242 | −0.36389 | 0.000835 | 1.582242 |
| −2.20473 | 0.666998 | 1.582242 | −0.22069 | −0.09085 | 1.582242 |
| −2.33274 | 0.779139 | 1.582242 | −0.08141 | −0.17827 | 1.582242 |
| −2.45348 | 0.892031 | 1.582242 | 0.053691 | −0.26152 | 1.582242 |
| −2.56671 | 1.004589 | 1.582242 | 0.184786 | −0.34043 | 1.582242 |
| −2.67292 | 1.115811 | 1.582242 | 0.311789 | −0.41516 | 1.582242 |
| −2.77262 | 1.225029 | 1.582242 | 0.434701 | −0.4858 | 1.582242 |
| −2.86597 | 1.331992 | 1.582242 | 0.553271 | −0.55244 | 1.582242 |
| −2.95323 | 1.436367 | 1.582242 | 0.667666 | −0.61514 | 1.582242 |
| −3.03489 | 1.537736 | 1.582242 | 0.772626 | −0.67134 | 1.582242 |
| −3.10704 | 1.631507 | 1.582242 | 0.868066 | −0.72127 | 1.582242 |
| −3.17016 | 1.717261 | 1.582242 | 0.953737 | −0.76544 | 1.582242 |

TABLE 1-continued

| SUCTION SIDE | | | PRESSURE SIDE | | |
|---|---|---|---|---|---|
| X | Y | Z | X | Y | Z |
| −3.2246 | 1.794666 | 1.582242 | 1.029555 | −0.80411 | 1.582242 |
| −3.27387 | 1.868396 | 1.582242 | 1.095353 | −0.83734 | 1.582242 |
| −3.31386 | 1.934111 | 1.582242 | 1.151131 | −0.86523 | 1.582242 |
| −3.34084 | 1.986799 | 1.582242 | 1.198893 | −0.88877 | 1.582242 |
| −3.35804 | 2.030887 | 1.582242 | 1.23914 | −0.90848 | 1.582242 |
| −3.36639 | 2.065289 | 1.582242 | 1.27229 | −0.9246 | 1.582242 |
| −3.36772 | 2.091926 | 1.582242 | 1.298843 | −0.93745 | 1.582242 |
| −3.36497 | 2.106371 | 1.582242 | 1.31571 | −0.95223 | 1.582242 |
| −3.36096 | 2.114972 | 1.582242 | 1.323225 | −0.96751 | 1.582242 |
| −3.35812 | 2.118813 | 1.582242 | 1.325396 | −0.98154 | 1.582242 |
| −3.35645 | 2.120566 | 1.582242 | 1.32431 | −0.99282 | 1.582242 |
| 1.2859 | −1.03423 | 1.978867 | −3.33098 | 2.157891 | 1.978867 |
| 1.281809 | −1.04183 | 1.978867 | −3.33015 | 2.158642 | 1.978867 |
| 1.274377 | −1.05076 | 1.978867 | −3.32823 | 2.159978 | 1.978867 |
| 1.26252 | −1.05903 | 1.978867 | −3.3243 | 2.162233 | 1.978867 |
| 1.245904 | −1.06404 | 1.978867 | −3.31545 | 2.164905 | 1.978867 |
| 1.223025 | −1.06137 | 1.978867 | −3.30109 | 2.165239 | 1.978867 |
| 1.194384 | −1.0516 | 1.978867 | −3.27604 | 2.15931 | 1.978867 |
| 1.158479 | −1.03941 | 1.978867 | −3.24498 | 2.145449 | 1.978867 |
| 1.114892 | −1.02446 | 1.978867 | −3.20607 | 2.121819 | 1.978867 |
| 1.063122 | −1.00659 | 1.978867 | −3.16039 | 2.088252 | 1.978867 |
| 1.002585 | −0.98547 | 1.978867 | −3.1037 | 2.041408 | 1.978867 |
| 0.931109 | −0.96025 | 1.978867 | −3.03957 | 1.985714 | 1.978867 |
| 0.848861 | −0.93069 | 1.978867 | −2.97118 | 1.926345 | 1.978867 |
| 0.755926 | −0.89654 | 1.978867 | −2.89428 | 1.859462 | 1.978867 |
| 0.652219 | −0.8578 | 1.978867 | −2.80886 | 1.785147 | 1.978867 |
| 0.537824 | −0.81438 | 1.978867 | −2.71484 | 1.703484 | 1.978867 |
| 0.412824 | −0.76611 | 1.978867 | −2.61639 | 1.61823 | 1.978867 |
| 0.282731 | −0.71484 | 1.978867 | −2.51335 | 1.529637 | 1.978867 |
| 0.147628 | −0.6604 | 1.978867 | −2.40538 | 1.438121 | 1.978867 |
| 0.007599 | −0.60254 | 1.978867 | −2.29224 | 1.344016 | 1.978867 |
| −0.13719 | −0.541 | 1.978867 | −2.17359 | 1.247574 | 1.978867 |
| −0.28632 | −0.47545 | 1.978867 | −2.04926 | 1.149294 | 1.978867 |
| −0.43954 | −0.40548 | 1.978867 | −1.91883 | 1.049679 | 1.978867 |
| −0.59661 | −0.33066 | 1.978867 | −1.78214 | 0.949145 | 1.978867 |
| −0.75217 | −0.25317 | 1.978867 | −1.64412 | 0.850531 | 1.978867 |
| −0.90614 | −0.17301 | 1.978867 | −1.50534 | 0.752836 | 1.978867 |
| −1.05828 | −0.08985 | 1.978867 | −1.36606 | 0.655893 | 1.978867 |
| −1.20858 | −0.00342 | 1.978867 | −1.22636 | 0.559617 | 1.978867 |
| −1.35688 | 0.086339 | 1.978867 | −1.08608 | 0.463926 | 1.978867 |
| −1.50325 | 0.179358 | 1.978867 | −0.94555 | 0.36882 | 1.978867 |
| −1.64771 | 0.275717 | 1.978867 | −0.80477 | 0.274131 | 1.978867 |
| −1.79007 | 0.375583 | 1.978867 | −0.66357 | 0.179943 | 1.978867 |
| −1.93002 | 0.479541 | 1.978867 | −0.52204 | 0.086172 | 1.978867 |
| −2.06729 | 0.588091 | 1.978867 | −0.38026 | −0.00701 | 1.978867 |
| −2.20139 | 0.701818 | 1.978867 | −0.23789 | −0.09945 | 1.978867 |
| −2.32715 | 0.816213 | 1.978867 | −0.09978 | −0.18796 | 1.978867 |
| −2.4448 | 0.930524 | 1.978867 | 0.034319 | −0.27229 | 1.978867 |
| −2.55502 | 1.044084 | 1.978867 | 0.164245 | −0.35262 | 1.978867 |
| −2.65856 | 1.156058 | 1.978867 | 0.289996 | −0.42886 | 1.978867 |
| −2.75592 | 1.265777 | 1.978867 | 0.411488 | −0.50108 | 1.978867 |
| −2.84718 | 1.372907 | 1.978867 | 0.528806 | −0.56947 | 1.978867 |
| −2.93277 | 1.477282 | 1.978867 | 0.641781 | −0.6341 | 1.978867 |
| −3.01301 | 1.578401 | 1.978867 | 0.745405 | −0.69222 | 1.978867 |
| −3.08407 | 1.671754 | 1.978867 | 0.839509 | −0.74415 | 1.978867 |
| −3.14636 | 1.757007 | 1.978867 | 0.923928 | −0.79016 | 1.978867 |
| −3.20022 | 1.833911 | 1.978867 | 0.998577 | −0.83066 | 1.978867 |
| −3.24899 | 1.90714 | 1.978867 | 1.063373 | −0.86539 | 1.978867 |
| −3.28865 | 1.972354 | 1.978867 | 1.118316 | −0.8947 | 1.978867 |
| −3.31537 | 2.024541 | 1.978867 | 1.165326 | −0.91959 | 1.978867 |
| −3.33257 | 2.068212 | 1.978867 | 1.204822 | −0.94038 | 1.978867 |
| −3.34109 | 2.10228 | 1.978867 | 1.23747 | −0.95741 | 1.978867 |
| −3.34276 | 2.128666 | 1.978867 | 1.263606 | −0.97094 | 1.978867 |
| −3.34025 | 2.143028 | 1.978867 | 1.28064 | −0.98555 | 1.978867 |
| −3.33633 | 2.151545 | 1.978867 | 1.288071 | −1.00075 | 1.978867 |
| −3.33357 | 2.155386 | 1.978867 | 1.289992 | −1.01478 | 1.978867 |
| −3.3319 | 2.157056 | 1.978867 | 1.288656 | −1.02605 | 1.978867 |
| 1.204989 | −1.13193 | 2.772117 | −3.28481 | 2.243478 | 2.772117 |
| 1.200313 | −1.13919 | 2.772117 | −3.28389 | 2.244146 | 2.772117 |
| 1.19213 | −1.14737 | 2.772117 | −3.28197 | 2.245482 | 2.772117 |
| 1.179605 | −1.15439 | 2.772117 | −3.27788 | 2.247486 | 2.772117 |
| 1.162654 | −1.15723 | 2.772117 | −3.26886 | 2.24949 | 2.772117 |
| 1.140443 | −1.1513 | 2.772117 | −3.2545 | 2.248572 | 2.772117 |
| 1.112721 | −1.13961 | 2.772117 | −3.22995 | 2.24089 | 2.772117 |
| 1.077985 | −1.12491 | 2.772117 | −3.19972 | 2.225108 | 2.772117 |
| 1.035901 | −1.10696 | 2.772117 | −3.16198 | 2.199557 | 2.772117 |

TABLE 1-continued

| SUCTION SIDE | | | PRESSURE SIDE | | |
|---|---|---|---|---|---|
| X | Y | Z | X | Y | Z |
| 0.985801 | −1.08558 | 2.772117 | −3.11789 | 2.16407 | 2.772117 |
| 0.927268 | −1.06037 | 2.772117 | −3.06311 | 2.114888 | 2.772117 |
| 0.85813 | −1.03039 | 2.772117 | −3.00116 | 2.056772 | 2.772117 |
| 0.778554 | −0.99549 | 2.772117 | −2.93503 | 1.994732 | 2.772117 |
| 0.688458 | −0.95566 | 2.772117 | −2.86054 | 1.925093 | 2.772117 |
| 0.588007 | −0.91065 | 2.772117 | −2.77771 | 1.847772 | 2.772117 |
| 0.477203 | −0.86047 | 2.772117 | −2.68661 | 1.762685 | 2.772117 |
| 0.356044 | −0.80494 | 2.772117 | −2.59134 | 1.673758 | 2.772117 |
| 0.229959 | −0.74641 | 2.772117 | −2.49181 | 1.581073 | 2.772117 |
| 0.098864 | −0.68478 | 2.772117 | −2.38785 | 1.484881 | 2.772117 |
| −0.03707 | −0.61999 | 2.772117 | −2.2793 | 1.385349 | 2.772117 |
| −0.17769 | −0.5516 | 2.772117 | −2.16574 | 1.282811 | 2.772117 |
| −0.32256 | −0.47946 | 2.772117 | −2.04709 | 1.177601 | 2.772117 |
| −0.47169 | −0.40305 | 2.772117 | −1.92267 | 1.07022 | 2.772117 |
| −0.62466 | −0.32223 | 2.772117 | −1.79183 | 0.961753 | 2.772117 |
| −0.77622 | −0.23914 | 2.772117 | −1.65898 | 0.855875 | 2.772117 |
| −0.92602 | −0.15347 | 2.772117 | −1.52471 | 0.752085 | 2.772117 |
| −1.07406 | −0.06505 | 2.772117 | −1.38919 | 0.649797 | 2.772117 |
| −1.22019 | 0.026386 | 2.772117 | −1.25283 | 0.548762 | 2.772117 |
| −1.36431 | 0.120908 | 2.772117 | −1.11564 | 0.448896 | 2.772117 |
| −1.50626 | 0.218687 | 2.772117 | −0.97787 | 0.349865 | 2.772117 |
| −1.64595 | 0.319889 | 2.772117 | −0.83959 | 0.251419 | 2.772117 |
| −1.78323 | 0.424932 | 2.772117 | −0.70098 | 0.153473 | 2.772117 |
| −1.91766 | 0.534317 | 2.772117 | −0.56196 | 0.056112 | 2.772117 |
| −2.04892 | 0.648461 | 2.772117 | −0.42251 | −0.04066 | 2.772117 |
| −2.17685 | 0.767699 | 2.772117 | −0.28273 | −0.13694 | 2.772117 |
| −2.29742 | 0.887355 | 2.772117 | −0.14713 | −0.22937 | 2.772117 |
| −2.41056 | 1.006092 | 2.772117 | −0.0157 | −0.31797 | 2.772117 |
| −2.51702 | 1.123075 | 2.772117 | 0.111473 | −0.40264 | 2.772117 |
| −2.61747 | 1.237554 | 2.772117 | 0.234468 | −0.48347 | 2.772117 |
| −2.71233 | 1.349193 | 2.772117 | 0.353205 | −0.56037 | 2.772117 |
| −2.80193 | 1.457576 | 2.772117 | 0.467767 | −0.63335 | 2.772117 |
| −2.88626 | 1.562703 | 2.772117 | 0.577987 | −0.70257 | 2.772117 |
| −2.9655 | 1.664322 | 2.772117 | 0.678939 | −0.76519 | 2.772117 |
| −3.03606 | 1.758009 | 2.772117 | 0.770622 | −0.82147 | 2.772117 |
| −3.09793 | 1.843346 | 2.772117 | 0.852869 | −0.87149 | 2.772117 |
| −3.15154 | 1.92025 | 2.772117 | 0.925514 | −0.91533 | 2.772117 |
| −3.2003 | 1.993479 | 2.772117 | 0.988557 | −0.95324 | 2.772117 |
| −3.23997 | 2.058442 | 2.772117 | 1.04208 | −0.98513 | 2.772117 |
| −3.26694 | 2.110463 | 2.772117 | 1.087755 | −1.01235 | 2.772117 |
| −3.28447 | 2.153966 | 2.772117 | 1.126248 | −1.03515 | 2.772117 |
| −3.29357 | 2.187867 | 2.772117 | 1.157811 | −1.05394 | 2.772117 |
| −3.29591 | 2.214086 | 2.772117 | 1.183195 | −1.06897 | 2.772117 |
| −3.29382 | 2.228532 | 2.772117 | 1.200814 | −1.08308 | 2.772117 |
| −3.29015 | 2.237216 | 2.772117 | 1.208496 | −1.09836 | 2.772117 |
| −3.28731 | 2.240973 | 2.772117 | 1.210166 | −1.11255 | 2.772117 |
| −3.28564 | 2.242643 | 2.772117 | 1.208245 | −1.12391 | 2.772117 |
| 1.119067 | −1.28824 | 3.565367 | −3.24431 | 2.338752 | 3.565367 |
| 1.113807 | −1.29517 | 3.565367 | −3.24331 | 2.33942 | 3.565367 |
| 1.104872 | −1.3026 | 3.565367 | −3.24139 | 2.340672 | 3.565367 |
| 1.091429 | −1.30803 | 3.565367 | −3.23704 | 2.342509 | 3.565367 |
| 1.074144 | −1.30819 | 3.565367 | −3.22786 | 2.343762 | 3.565367 |
| 1.052768 | −1.29893 | 3.565367 | −3.12135 | 2.341674 | 3.565367 |
| 1.025798 | −1.28498 | 3.565367 | −3.18945 | 2.332155 | 3.565367 |
| 0.992064 | −1.26745 | 3.565367 | −3.15972 | 2.314537 | 3.565367 |
| 0.951065 | −1.24624 | 3.565367 | −3.12307 | 2.286982 | 3.565367 |
| 0.902385 | −1.22085 | 3.565367 | −3.08015 | 2.249323 | 3.565367 |
| 0.845438 | −1.19113 | 3.565367 | −3.02688 | 2.197553 | 3.565367 |
| 0.77822 | −1.15564 | 3.565367 | −2.9665 | 2.136598 | 3.565367 |
| 0.700816 | −1.11456 | 3.565367 | −2.90204 | 2.071552 | 3.565367 |
| 0.613308 | −1.06771 | 3.565367 | −2.8294 | 1.998573 | 3.565367 |
| 0.515529 | −1.01503 | 3.565367 | −2.74857 | 1.917661 | 3.565367 |
| 0.407731 | −0.95641 | 3.565367 | −2.65956 | 1.82865 | 3.565367 |
| 0.289912 | −0.89186 | 3.565367 | −2.56637 | 1.735798 | 3.565367 |
| 0.167167 | −0.82406 | 3.565367 | −2.4691 | 1.638938 | 3.565367 |
| 0.039663 | −0.75292 | 3.565367 | −2.36764 | 1.538154 | 3.565367 |
| −0.0926 | −0.67835 | 3.565367 | −2.26176 | 1.433612 | 3.565367 |
| −0.22929 | −0.60011 | 3.565367 | −2.15146 | 1.325479 | 3.565367 |
| −0.37016 | −0.51795 | 3.565367 | −2.03657 | 1.213923 | 3.565367 |
| −0.51503 | −0.43144 | 3.565367 | −1.91674 | 1.099194 | 3.565367 |
| −0.66357 | −0.34035 | 3.565367 | −1.79124 | 0.982211 | 3.565367 |
| −0.81053 | −0.24741 | 3.565367 | −1.6639 | 0.867315 | 3.565367 |
| −0.95574 | −0.15222 | 3.565367 | −1.53481 | 0.754673 | 3.565367 |
| −1.09911 | −0.05478 | 3.565367 | −1.40405 | 0.643952 | 3.565367 |
| −1.24039 | 0.045341 | 3.565367 | −1.27204 | 0.534818 | 3.565367 |
| −1.37925 | 0.14838 | 3.565367 | −1.13894 | 0.427103 | 3.565367 |

TABLE 1-continued

| SUCTION SIDE | | | PRESSURE SIDE | | |
|---|---|---|---|---|---|
| X | Y | Z | X | Y | Z |
| −1.51569 | 0.254508 | 3.565367 | −1.00492 | 0.32039 | 3.565367 |
| −1.64954 | 0.363726 | 3.565367 | −0.87024 | 0.214512 | 3.565367 |
| −1.78055 | 0.476535 | 3.565367 | −0.73505 | 0.109302 | 3.565367 |
| −1.90839 | 0.593435 | 3.565367 | −0.59945 | 0.004509 | 3.565367 |
| −2.03281 | 0.714426 | 3.565367 | −0.46359 | −0.09995 | 3.565367 |
| −2.15413 | 0.839259 | 3.565367 | −0.32732 | −0.20391 | 3.565367 |
| −2.26895 | 0.962922 | 3.565367 | −0.19531 | −0.30386 | 3.565367 |
| −2.37783 | 1.084916 | 3.565367 | −0.06738 | −0.39988 | 3.565367 |
| −2.48112 | 1.204571 | 3.565367 | 0.056363 | −0.4919 | 3.565367 |
| −2.57932 | 1.321388 | 3.565367 | 0.176018 | −0.57991 | 3.565367 |
| −2.67258 | 1.435115 | 3.565367 | 0.291499 | −0.66391 | 3.565367 |
| −2.76101 | 1.545418 | 3.565367 | 0.402888 | −0.7439 | 3.565367 |
| −2.84443 | 1.652215 | 3.565367 | 0.510018 | −0.81997 | 3.565367 |
| −2.92308 | 1.755254 | 3.565367 | 0.608131 | −0.88886 | 3.565367 |
| −2.99314 | 1.849943 | 3.565367 | 0.697225 | −0.9509 | 3.565367 |
| −3.05468 | 1.936282 | 3.565367 | 0.777051 | −1.00618 | 3.565367 |
| −3.10812 | 2.013937 | 3.565367 | 0.847692 | −1.05469 | 3.565367 |
| −3.1568 | 2.087667 | 3.565367 | 0.908981 | −1.09661 | 3.565367 |
| −3.19663 | 2.153048 | 3.565367 | 0.960835 | −1.13209 | 3.565367 |
| −3.22385 | 2.205319 | 3.565367 | 1.005257 | −1.16232 | 3.565367 |
| −3.24197 | 2.248822 | 3.565367 | 1.042581 | −1.1877 | 3.565367 |
| −3.25166 | 2.282723 | 3.565367 | 1.073309 | −1.20858 | 3.565367 |
| −3.25475 | 2.309026 | 3.565367 | 1.097858 | −1.2252 | 3.565367 |
| −3.25308 | 2.323722 | 3.565367 | 1.115811 | −1.23914 | 3.565367 |
| −3.24965 | 2.332406 | 3.565367 | 1.12391 | −1.2545 | 3.565367 |
| −3.24681 | 2.336247 | 3.565367 | 1.12533 | −1.26895 | 3.565367 |
| −3.24514 | 2.337917 | 3.565367 | 1.122908 | −1.28031 | 3.565367 |
| 1.037488 | −1.46877 | 4.358617 | −3.20615 | 2.444964 | 4.358617 |
| 1.031726 | −1.47536 | 4.358617 | −3.20515 | 2.445632 | 4.358617 |
| 1.021957 | −1.48196 | 4.358617 | −3.20306 | 2.446801 | 4.358617 |
| 1.007845 | −1.48588 | 4.358617 | −3.19863 | 2.448387 | 4.358617 |
| 0.990477 | −1.48321 | 4.358617 | −3.1892 | 2.448888 | 4.358617 |
| 0.970103 | −1.47135 | 4.358617 | −3.17484 | 2.445632 | 4.358617 |
| 0.943968 | −1.45515 | 4.358617 | −3.15112 | 2.434359 | 4.358617 |
| 0.911319 | −1.43503 | 4.358617 | −3.12207 | 2.41482 | 4.358617 |
| 0.871657 | −1.41057 | 4.358617 | −3.08624 | 2.385178 | 4.358617 |
| 0.824396 | −1.38142 | 4.358617 | −3.04433 | 2.345098 | 4.358617 |
| 0.769202 | −1.34719 | 4.358617 | −2.99222 | 2.290405 | 4.358617 |
| 0.704072 | −1.30661 | 4.358617 | −2.93319 | 2.226277 | 4.358617 |
| 0.629089 | −1.25951 | 4.358617 | −2.87023 | 2.157891 | 4.358617 |
| 0.54417 | −1.20599 | 4.358617 | −2.79917 | 2.081071 | 4.358617 |
| 0.449397 | −1.14595 | 4.358617 | −2.72026 | 1.995734 | 4.358617 |
| 0.344855 | −1.07932 | 4.358617 | −2.63342 | 1.90188 | 4.358617 |
| 0.230544 | −1.00601 | 4.358617 | −2.54249 | 1.803851 | 4.358617 |
| 0.111556 | −0.9291 | 4.358617 | −2.44764 | 1.701647 | 4.358617 |
| −0.01219 | −0.84861 | 4.358617 | −2.3486 | 1.595268 | 4.358617 |
| −0.14036 | −0.76444 | 4.358617 | −2.2454 | 1.484881 | 4.358617 |
| −0.27279 | −0.67618 | 4.358617 | −2.13777 | 1.370736 | 4.358617 |
| −0.40932 | −0.58367 | 4.358617 | −2.02579 | 1.252584 | 4.358617 |
| −0.54968 | −0.48655 | 4.358617 | −1.90948 | 1.13059 | 4.358617 |
| −0.69338 | −0.3846 | 4.358617 | −1.78832 | 1.00534 | 4.358617 |
| −0.83567 | −0.28073 | 4.358617 | −1.66574 | 0.88151 | 4.358617 |
| −0.9762 | −0.17493 | 4.358617 | −1.54166 | 0.759349 | 4.358617 |
| −1.11481 | −0.0668 | 4.358617 | −1.41591 | 0.638775 | 4.358617 |
| −1.25125 | 0.043671 | 4.358617 | −1.28857 | 0.519955 | 4.358617 |
| −1.38552 | 0.156813 | 4.358617 | −1.1599 | 0.40247 | 4.358617 |
| −1.51736 | 0.272878 | 4.358617 | −1.03014 | 0.286155 | 4.358617 |
| −1.64645 | 0.391949 | 4.358617 | −0.89955 | 0.170674 | 4.358617 |
| −1.77279 | 0.51436 | 4.358617 | −0.76837 | 0.055862 | 4.358617 |
| −1.89603 | 0.640362 | 4.358617 | −0.63669 | −0.05837 | 4.358617 |
| −2.01636 | 0.769703 | 4.358617 | −0.50459 | −0.17209 | 4.358617 |
| −2.13426 | 0.902051 | 4.358617 | −0.37208 | −0.28532 | 4.358617 |
| −2.24632 | 1.03206 | 4.358617 | −0.24349 | −0.3942 | 4.358617 |
| −2.35295 | 1.159481 | 4.358617 | −0.11882 | −0.49883 | 4.358617 |
| −2.4544 | 1.283896 | 4.358617 | 0.001837 | −0.59911 | 4.358617 |
| −2.55059 | 1.404888 | 4.358617 | 0.118487 | −0.69522 | 4.358617 |
| −2.64186 | 1.522205 | 4.358617 | 0.231045 | −0.78699 | 4.358617 |
| −2.72836 | 1.635765 | 4.358617 | 0.339595 | −0.87458 | 4.358617 |
| −2.80994 | 1.745484 | 4.358617 | 0.444053 | −0.95791 | 4.358617 |
| −2.88693 | 1.851279 | 4.358617 | 0.539744 | −1.03365 | 4.358617 |
| −2.95557 | 1.948306 | 4.358617 | 0.626584 | −1.10195 | 4.358617 |
| −3.0161 | 2.036649 | 4.358617 | 0.704406 | −1.16274 | 4.358617 |
| −3.06863 | 2.11589 | 4.358617 | 0.77321 | −1.21626 | 4.358617 |
| −3.11672 | 2.19104 | 4.358617 | 0.832829 | −1.2626 | 4.358617 |
| −3.15622 | 2.257423 | 4.358617 | 0.883347 | −1.30185 | 4.358617 |
| −3.1836 | 2.310278 | 4.358617 | 0.926516 | −1.33525 | 4.358617 |

TABLE 1-continued

| SUCTION SIDE | | | PRESSURE SIDE | | |
|---|---|---|---|---|---|
| X | Y | Z | X | Y | Z |
| −3.20197 | 2.354199 | 4.358617 | 0.962839 | −1.36339 | 4.358617 |
| −3.21216 | 2.388351 | 4.358617 | 0.992815 | −1.38643 | 4.358617 |
| −3.21584 | 2.41482 | 4.358617 | 1.016696 | −1.40489 | 4.358617 |
| −3.21467 | 2.429683 | 4.358617 | 1.034732 | −1.41942 | 4.358617 |
| −3.21149 | 2.438618 | 4.358617 | 1.043333 | −1.43478 | 4.358617 |
| −3.20874 | 2.442459 | 4.358617 | 1.044669 | −1.44948 | 4.358617 |
| −3.20707 | 2.444129 | 4.358617 | 1.04183 | −1.46092 | 4.358617 |
| 0.96025 | −1.63376 | 5.151867 | −3.16841 | 2.562532 | 5.151867 |
| 0.953904 | −1.64011 | 5.151867 | −3.16732 | 2.5632 | 5.151867 |
| 0.943467 | −1.64595 | 5.151867 | −3.16523 | 2.564285 | 5.151867 |
| 0.928687 | −1.64821 | 5.151867 | −3.16056 | 2.565621 | 5.151867 |
| 0.91157 | −1.64303 | 5.151867 | −3.15096 | 2.565371 | 5.151867 |
| 0.892031 | −1.62917 | 5.151867 | −3.13668 | 2.560945 | 5.151867 |
| 0.86673 | −1.61097 | 5.151867 | −3.11321 | 2.548086 | 5.151867 |
| 0.835 | −1.58834 | 5.151867 | −3.08457 | 2.52671 | 5.151867 |
| 0.796507 | −1.56078 | 5.151867 | −3.04942 | 2.495147 | 5.151867 |
| 0.750665 | −1.52805 | 5.151867 | −3.00817 | 2.452896 | 5.151867 |
| 0.697058 | −1.48964 | 5.151867 | −2.95657 | 2.395699 | 5.151867 |
| 0.633765 | −1.44422 | 5.151867 | −2.89787 | 2.329066 | 5.151867 |
| 0.56087 | −1.39161 | 5.151867 | −2.83524 | 2.257924 | 5.151867 |
| 0.478372 | −1.33183 | 5.151867 | −2.76494 | 2.177931 | 5.151867 |
| 0.386271 | −1.26477 | 5.151867 | −2.68686 | 2.088836 | 5.151867 |
| 0.284652 | −1.19046 | 5.151867 | −2.60119 | 1.99064 | 5.151867 |
| 0.173597 | −1.10888 | 5.151867 | −2.51185 | 1.887852 | 5.151867 |
| 0.057949 | −1.02329 | 5.151867 | −2.41874 | 1.780471 | 5.151867 |
| −0.06229 | −0.93395 | 5.151867 | −2.3218 | 1.668581 | 5.151867 |
| −0.18679 | −0.84043 | 5.151867 | −2.22093 | 1.552265 | 5.151867 |
| −0.31563 | −0.74273 | 5.151867 | −2.11597 | 1.431691 | 5.151867 |
| −0.4484 | −0.64061 | 5.151867 | −2.00709 | 1.306608 | 5.151867 |
| −0.585 | −0.53382 | 5.151867 | −1.8942 | 1.177267 | 5.151867 |
| −0.72503 | −0.42201 | 5.151867 | −1.77671 | 1.044001 | 5.151867 |
| −0.86356 | −0.30853 | 5.151867 | −1.65806 | 0.911904 | 5.151867 |
| −1.00041 | −0.1933 | 5.151867 | −1.53807 | 0.781143 | 5.151867 |
| −1.13535 | −0.0759 | 5.151867 | −1.41641 | 0.651801 | 5.151867 |
| −1.2682 | 0.043754 | 5.151867 | −1.29316 | 0.524046 | 5.151867 |
| −1.39879 | 0.165831 | 5.151867 | −1.16833 | 0.397711 | 5.151867 |
| −1.5268 | 0.290664 | 5.151867 | −1.04233 | 0.272544 | 5.151867 |
| −1.65196 | 0.418502 | 5.151867 | −0.91566 | 0.148046 | 5.151867 |
| −1.77412 | 0.549681 | 5.151867 | −0.78832 | 0.024132 | 5.151867 |
| −1.89328 | 0.684199 | 5.151867 | −0.66065 | −0.09937 | 5.151867 |
| −2.00959 | 0.821724 | 5.151867 | −0.53248 | −0.22244 | 5.151867 |
| −2.12357 | 0.961753 | 5.151867 | −0.40397 | −0.34502 | 5.151867 |
| −2.23204 | 1.098944 | 5.151867 | −0.27939 | −0.46326 | 5.151867 |
| −2.33516 | 1.232878 | 5.151867 | −0.15873 | −0.5769 | 5.151867 |
| −2.43327 | 1.363054 | 5.151867 | −0.04192 | −0.6862 | 5.151867 |
| −2.52646 | 1.489306 | 5.151867 | 0.070892 | −0.79091 | 5.151867 |
| −2.61505 | 1.611467 | 5.151867 | 0.179943 | −0.89111 | 5.151867 |
| −2.69905 | 1.729536 | 5.151867 | 0.284986 | −0.98672 | 5.151867 |
| −2.77846 | 1.84343 | 5.151867 | 0.386188 | −1.07799 | 5.151867 |
| −2.85345 | 1.953065 | 5.151867 | 0.478789 | −1.1609 | 5.151867 |
| −2.92041 | 2.053516 | 5.151867 | 0.562874 | −1.23572 | 5.151867 |
| −2.97953 | 2.144698 | 5.151867 | 0.638274 | −1.30252 | 5.151867 |
| −3.03097 | 2.226444 | 5.151867 | 0.704824 | −1.3613 | 5.151867 |
| −3.07789 | 2.303849 | 5.151867 | 0.762522 | −1.41224 | 5.151867 |
| −3.11689 | 2.371985 | 5.151867 | 0.81137 | −1.45532 | 5.151867 |
| −3.14419 | 2.425842 | 5.151867 | 0.853203 | −1.49206 | 5.151867 |
| −3.16273 | 2.470348 | 5.151867 | 0.888357 | −1.52296 | 5.151867 |
| −3.17333 | 2.505 | 5.151867 | 0.917331 | −1.54834 | 5.151867 |
| −3.17751 | 2.531804 | 5.151867 | 0.940461 | −1.56855 | 5.151867 |
| −3.17676 | 2.546834 | 5.151867 | 0.958246 | −1.58425 | 5.151867 |
| −3.17375 | 2.556019 | 5.151867 | 0.967181 | −1.59969 | 5.151867 |
| −3.17108 | 2.560027 | 5.151867 | 0.96835 | −1.61456 | 5.151867 |
| −3.16933 | 2.56178 | 5.151867 | 0.96501 | −1.62608 | 5.151867 |
| 0.891029 | −1.76369 | 5.945117 | −3.13818 | 2.676426 | 5.945117 |
| 0.884182 | −1.7697 | 5.945117 | −3.13718 | 2.67701 | 5.945117 |
| 0.87316 | −1.77471 | 5.945117 | −3.13492 | 2.678096 | 5.945117 |
| 0.857963 | −1.77546 | 5.945117 | −3.13016 | 2.679098 | 5.945117 |
| 0.84143 | −1.76803 | 5.945117 | −3.1204 | 2.678012 | 5.945117 |
| 0.822475 | −1.75275 | 5.945117 | −3.10628 | 2.672418 | 5.945117 |
| 0.797843 | −1.73296 | 5.945117 | −3.08324 | 2.657972 | 5.945117 |
| 0.767031 | −1.70816 | 5.945117 | −3.05518 | 2.634926 | 5.945117 |
| 0.72954 | −1.67802 | 5.945117 | −3.0207 | 2.601359 | 5.945117 |
| 0.684951 | −1.64211 | 5.945.117 | −2.98003 | 2.556937 | 5.945117 |
| 0.63293 | −1.60011 | 5.945117 | −2.92893 | 2.497569 | 5.945117 |
| 0.571391 | −1.55034 | 5.945117 | −2.8704 | 2.428598 | 5.945117 |
| 0.500499 | −1.49281 | 5.945117 | −2.80802 | 2.355034 | 5.945117 |

TABLE 1-continued

| SUCTION SIDE | | | PRESSURE SIDE | | |
|---|---|---|---|---|---|
| X | Y | Z | X | Y | Z |
| 0.420256 | −1.4276 | 5.945117 | −2.73805 | 2.272035 | 5.945117 |
| 0.330577 | −1.35454 | 5.945117 | −2.66048 | 2.179768 | 5.945117 |
| 0.231713 | −1.27363 | 5.945117 | −2.57539 | 2.078065 | 5.945117 |
| 0.123497 | −1.18478 | 5.945117 | −2.48655 | 1.971519 | 5.945117 |
| 0.010855 | −1.09193 | 5.945.117 | −2.39411 | 1.860297 | 5.945117 |
| −0.10638 | −0.99499 | 5.945117 | −2.298 | 1.744148 | 5.945117 |
| −0.22787 | −0.89378 | 5.945117 | −2.19822 | 1.62324 | 5.945117 |
| −0.35362 | −0.78824 | 5.945117 | −2.09468 | 1.497656 | 5.945117 |
| −0.48338 | −0.6781 | 5.945117 | −1.98763 | 1.367146 | 5.945117 |
| −0.6169 | −0.56321 | 5.945117 | −1.87683 | 1.231876 | 5.945117 |
| −0.75384 | −0.44313 | 5.945117 | −1.76177 | 1.092347 | 5.945117 |
| −0.88944 | −0.32164 | 5.945117 | −1.64587 | 0.953487 | 5.945117 |
| −1.02329 | −0.19848 | 5.945117 | −1.5288 | 0.815628 | 5.945117 |
| −1.15531 | −0.0734 | 5.945117 | −1.4104 | 0.678939 | 5.945117 |
| −1.28515 | 0.053858 | 5.945117 | −1.29033 | 0.543836 | 5.945117 |
| −1.41257 | 0.183533 | 5.945117 | −1.16875 | 0.410152 | 5.945117 |
| −1.53724 | 0.316048 | 5.945117 | −1.04592 | 0.277554 | 5.945117 |
| −1.65889 | 0.451652 | 5.945117 | −0.92226 | 0.145624 | 5.945117 |
| −1.77738 | 0.590429 | 5.945117 | −0.79826 | 0.014112 | 5.945117 |
| −1.89278 | 0.732212 | 5.945117 | −0.67385 | −0.11707 | 5.945117 |
| −2.00559 | 0.87675 | 5.945117 | −0.54926 | −0.24808 | 5.945117 |
| −2.11631 | 1.023376 | 5.945117 | −0.42451 | −0.37892 | 5.945117 |
| −2.2216 | 1.166495 | 5.945117 | −0.30377 | −0.50526 | 5.945117 |
| −2.32188 | 1.305773 | 5.945117 | −0.18696 | −0.627 | 5.945117 |
| −2.41733 | 1.44096 | 5.945117 | −0.07406 | −0.74424 | 5.945117 |
| −2.50826 | 1.571804 | 5.945117 | 0.034987 | −0.85671 | 5.945117 |
| −2.59476 | 1.698223 | 5.945117 | 0.14028 | −0.96451 | 5.945117 |
| −2.67693 | 1.820217 | 5.945117 | 0.241733 | −1.06755 | 5.945117 |
| −2.75458 | 1.937868 | 5.945117 | 0.339261 | −1.16599 | 5.945117 |
| −2.82789 | 2.051094 | 5.945117 | 0.428606 | −1.25567 | 5.945117 |
| −2.89328 | 2.154718 | 5.945117 | 0.509601 | −1.33658 | 5.945117 |
| −2.95097 | 2.248822 | 5.945117 | 0.582162 | −1.40898 | 5.945117 |
| −3.00107 | 2.333074 | 5.945117 | 0.646207 | −1.47269 | 5.945117 |
| −3.04683 | 2.412816 | 5.945117 | 0.701818 | −1.52788 | 5.945117 |
| −3.08516 | 2.482706 | 5.945117 | 0.748912 | −1.57456 | 5.945117 |
| −3.1123 | 2.537649 | 5.945117 | 0.789159 | −1.61447 | 5.945117 |
| −3.131 | 2.582906 | 5.945117 | 0.822976 | −1.64796 | 5.945117 |
| −3.14194 | 2.617976 | 5.945117 | 0.850865 | −1.67543 | 5.945117 |
| −3.14661 | 2.645113 | 5.945117 | 0.87316 | −1.69747 | 5.945117 |
| −3.14636 | 2.660477 | 5.945117 | 0.890361 | −1.71434 | 5.945117 |
| −3.14361 | 2.669829 | 5.945117 | 0.899128 | −1.72987 | 5.945117 |
| −3.14094 | 2.673921 | 5.945117 | 0.899963 | −1.74482 | 5.945117 |
| −3.13918 | 2.675674 | 5.945117 | 0.896206 | −1.75626 | 5.945117 |
| 0.831577 | −1.86238 | 6.738367 | −3.10587 | 2.785978 | 6.738367 |
| 0.824312 | −1.86806 | 6.738367 | −3.10478 | 2.786646 | 6.738367 |
| 0.812706 | −1.87232 | 6.738367 | −3.10244 | 2.787564 | 6.738367 |
| 0.797342 | −1.87165 | 6.738367 | −3.09752 | 2.788149 | 6.738367 |
| 0.78156 | −1.86238 | 6.738367 | −3.08783 | 2.786145 | 6.738367 |
| 0.763023 | −1.8461 | 6.738367 | −3.07397 | 2.779298 | 6.738367 |
| 0.739059 | −1.82481 | 6.738367 | −3.05159 | 2.763015 | 6.738367 |
| 0.708999 | −1.79826 | 6.738367 | −3.02454 | 2.738132 | 6.738367 |
| 0.672593 | −1.76586 | 6.738367 | −2.99122 | 2.702394 | 6.738367 |
| 0.629256 | −1.72728 | 6.738367 | −2.95164 | 2.655718 | 6.738367 |
| 0.578655 | −1.68219 | 6.738367 | −2.90154 | 2.593844 | 6.738367 |
| 0.518869 | −1.62875 | 6.738367 | −2.84384 | 2.522368 | 6.738367 |
| 0.449898 | −1.56704 | 6.738367 | −2.78239 | 2.446133 | 6.738367 |
| 0.371742 | −1.49716 | 6.738367 | −2.71333 | 2.360211 | 6.738367 |
| 0.284401 | −1.419 | 6.738367 | −2.63685 | 2.264604 | 6.738367 |
| 0.187959 | −1.33249 | 6.738367 | −2.55268 | 2.159394 | 6.738367 |
| 0.082415 | −1.23772 | 6.738367 | −2.46484 | 2.049341 | 6.738367 |
| −0.02764 | −1.13877 | 6.738367 | −2.37332 | 1.934361 | 6.738367 |
| −0.14228 | −1.03565 | 6.738367 | −2.27813 | 1.814455 | 6.738367 |
| −0.26119 | −0.9281 | 6.738367 | −2.17943 | 1.689539 | 6.738367 |
| −0.38435 | −0.81613 | 6.738367 | −2.07715 | 1.559697 | 6.738367 |
| −0.51135 | −0.69931 | 6.738367 | −1.97135 | 1.424677 | 6.738367 |
| −0.64212 | −0.57757 | 6.738367 | −1.86213 | 1.284731 | 6.738367 |
| −0.77622 | −0.45048 | 6.738367 | −1.74907 | 1.139942 | 6.738367 |
| −0.90898 | −0.32214 | 6.738367 | −1.63577 | 0.995404 | 6.738367 |
| −1.04008 | −0.19222 | 6.738367 | −1.52179 | 0.851366 | 6.738367 |
| −1.16933 | −0.06045 | 6.738367 | −1.40664 | 0.708414 | 6.738367 |
| −1.29625 | 0.07348 | 6.738367 | −1.28991 | 0.566715 | 6.738367 |
| −1.4205 | 0.210003 | 6.738367 | −1.17159 | 0.426435 | 6.738367 |
| −1.54158 | 0.349531 | 6.738367 | −1.05177 | 0.287407 | 6.738367 |
| −1.6594 | 0.492233 | 6.738367 | −0.93086 | 0.149298 | 6.738367 |
| −1.77412 | 0.637857 | 6.738367 | −0.80953 | 0.011607 | 6.738367 |
| −1.88601 | 0.786153 | 6.738367 | −0.68796 | −0.12592 | 6.738367 |

TABLE 1-continued

| SUCTION SIDE | | | PRESSURE SIDE | | |
|---|---|---|---|---|---|
| X | Y | Z | X | Y | Z |
| −1.99573 | 0.936703 | 6.738367 | −0.56638 | −0.26344 | 6.738367 |
| −2.10362 | 1.088506 | 6.738367 | −0.4448 | −0.40097 | 6.738367 |
| −2.20649 | 1.236301 | 6.738367 | −0.32707 | −0.53373 | 6.738367 |
| −2.3046 | 1.379838 | 6.738367 | −0.21334 | −0.66182 | 6.738367 |
| −2.39804 | 1.519032 | 6.738367 | −0.10337 | −0.78515 | 6.738367 |
| −2.48721 | 1.653634 | 6.738367 | 0.002756 | −0.90372 | 6.738367 |
| −2.57205 | 1.783644 | 6.738367 | 0.105043 | −1.01736 | 6.738367 |
| −2.65254 | 1.909061 | 6.738367 | 0.203573 | −1.12633 | 6.738367 |
| −2.7287 | 2.029885 | 6.738367 | 0.298179 | −1.23046 | 6.738367 |
| −2.80026 | 2.146284 | 6.738367 | 0.384768 | −1.32548 | 6.738367 |
| −2.86405 | 2.25283 | 6.738367 | 0.463175 | −1.41132 | 6.738367 |
| −2.92025 | 2.34944 | 6.738367 | 0.533315 | −1.48805 | 6.738367 |
| −2.96901 | 2.436029 | 6.738367 | 0.595355 | −1.55577 | 6.738367 |
| −3.0136 | 2.517859 | 6.738367 | 0.649129 | −1.61439 | 6.738367 |
| −3.05101 | 2.589335 | 6.738367 | 0.694637 | −1.66399 | 6.738367 |
| −3.07798 | 2.64528 | 6.738367 | 0.733548 | −1.70632 | 6.738367 |
| −3.09693 | 2.691205 | 6.738367 | 0.76628 | −1.74189 | 6.738367 |
| −3.1082 | 2.726693 | 6.738367 | 0.793167 | −1.7712 | 6.738367 |
| −3.11338 | 2.754164 | 6.738367 | 0.81471 | −1.79458 | 6.738367 |
| −3.11355 | 2.769612 | 6.738367 | 0.831326 | −1.81262 | 6.738367 |
| −3.11121 | 2.779298 | 6.738367 | 0.840511 | −1.82832 | 6.738367 |
| −3.10862 | 2.783556 | 6.738367 | 0.841263 | −1.84351 | 6.738367 |
| −3.10687 | 2.78531 | 6.738367 | 0.837171 | −1.85495 | 6.738367 |
| 0.768117 | −1.94714 | 7.531617 | −3.06387 | 2.897367 | 7.531617 |
| 0.760435 | −1.95256 | 7.531617 | −3.06278 | 2.897951 | 7.531617 |
| 0.748494 | −1.95607 | 7.531617 | −3.06036 | 2.898703 | 7.531617 |
| 0.733047 | −1.95398 | 7.531617 | −3.05535 | 2.898786 | 7.531617 |
| 0.717933 | −1.94313 | 7.531617 | −3.04575 | 2.895697 | 7.531617 |
| 0.700064 | −1.92568 | 7.531617 | −3.03247 | 2.887681 | 7.531617 |
| 0.676851 | −1.90297 | 7.531617 | −3.01093 | 2.869645 | 7.531617 |
| 0.64796 | −1.87449 | 7.531617 | −2.98513 | 2.842925 | 7.531617 |
| 0.612807 | −1.83984 | 7.531617 | −2.95306 | 2.805099 | 7.531617 |
| 0.57114 | −1.79851 | 7.531617 | −2.9149 | 2.756168 | 7.531617 |
| 0.522376 | −1.75016 | 7.531617 | −2.86589 | 2.69204 | 7.531617 |
| 0.464511 | −1.69313 | 7.531617 | −2.80936 | 2.618143 | 7.531617 |
| 0.397794 | −1.62742 | 7.531617 | −2.74915 | 2.539235 | 7.531617 |
| 0.322143 | −1.55293 | 7.531617 | −2.68144 | 2.450391 | 7.531617 |
| 0.237725 | −1.46952 | 7.531617 | −2.60637 | 2.351527 | 7.531617 |
| 0.144372 | −1.3775 | 7.531617 | −2.52395 | 2.242643 | 7.531617 |
| 0.041917 | −1.2768 | 7.531617 | −2.43795 | 2.128749 | 7.531617 |
| −0.06496 | −1.17176 | 7.531617 | −2.34835 | 2.009762 | 7.531617 |
| −0.17635 | −1.06229 | 7.531617 | −2.25534 | 1.885597 | 7.531617 |
| −0.29208 | −0.94848 | 7.531617 | −2.15889 | 1.756256 | 7.531617 |
| −0.41207 | −0.83007 | 7.531617 | −2.05903 | 1.621737 | 7.531617 |
| −0.53607 | −0.70683 | 7.531617 | −1.9559 | 1.481875 | 7.531617 |
| −0.66383 | −0.57866 | 7.531617 | −1.84961 | 1.336668 | 7.531617 |
| −0.79517 | −0.44531 | 7.531617 | −1.73972 | 1.186368 | 7.531617 |
| −0.92535 | −0.31095 | 7.531617 | −1.62992 | 1.036068 | 7.531617 |
| −1.05402 | −0.17527 | 7.531617 | −1.51962 | 0.886102 | 7.531617 |
| −1.18061 | −0.03774 | 7.531617 | −1.40839 | 0.736888 | 7.531617 |
| −1.30452 | 0.102121 | 7.531617 | −1.2955 | 0.589009 | 7.531617 |
| −1.42526 | 0.244739 | 7.531617 | −1.18052 | 0.442801 | 7.531617 |
| −1.54241 | 0.390613 | 7.531617 | −1.06346 | 0.298095 | 7.531617 |
| −1.65597 | 0.539661 | 7.531617 | −0.94497 | 0.154642 | 7.531617 |
| −1.76628 | 0.691547 | 7.531617 | −0.82582 | 0.011607 | 7.531617 |
| −1.87391 | 0.845772 | 7.531617 | −0.70674 | −0.13135 | 7.531617 |
| −1.97962 | 1.001666 | 7.531617 | −0.58784 | −0.27455 | 7.531617 |
| −2.08399 | 1.158479 | 7.531617 | −0.46894 | −0.41775 | 7.531617 |
| −2.18378 | 1.310867 | 7.531617 | −0.35404 | −0.55611 | 7.531617 |
| −2.27905 | 1.458578 | 7.531617 | −0.24307 | −0.68979 | 7.531617 |
| −2.3699 | 1.601781 | 7.531617 | −0.13611 | −0.81863 | 7.531617 |
| −2.45665 | 1.74014 | 7.531617 | −0.0329 | −0.94263 | 7.531617 |
| −2.53924 | 1.873573 | 7.531617 | 0.066383 | −1.06179 | 7.531617 |
| −2.61773 | 2.00233 | 7.531617 | 0.161823 | −1.17601 | 7.531617 |
| −2.69196 | 2.126161 | 7.531617 | 0.253423 | −1.2854 | 7.531617 |
| −2.76185 | 2.245399 | 7.531617 | 0.337257 | −1.38518 | 7.531617 |
| −2.82414 | 2.35445 | 7.531617 | 0.413075 | −1.47536 | 7.531617 |
| −2.879 | 2.453314 | 7.531617 | 0.48096 | −1.55602 | 7.531617 |
| −2.92668 | 2.54174 | 7.531617 | 0.54083 | −1.62733 | 7.531617 |
| −2.97018 | 2.625324 | 7.531617 | 0.592683 | −1.68904 | 7.531617 |
| −3.00684 | 2.698303 | 7.531617 | 0.636771 | −1.74114 | 7.531617 |
| −3.03364 | 2.755083 | 7.531617 | 0.674513 | −1.78565 | 7.531617 |
| −3.05276 | 2.801509 | 7.531617 | 0.70616 | −1.82306 | 7.531617 |
| −3.06445 | 2.83733 | 7.531617 | 0.732128 | −1.85387 | 7.531617 |
| −3.07021 | 2.864969 | 7.531617 | 0.752836 | −1.87858 | 7.531617 |
| −3.07096 | 2.880583 | 7.531617 | 0.768785 | −1.89762 | 7.531617 |

TABLE 1-continued

| SUCTION SIDE | | | PRESSURE SIDE | | |
|---|---|---|---|---|---|
| X | Y | Z | X | Y | Z |
| −3.06913 | 2.89052 | 7.531617 | 0.777886 | −1.91349 | 7.531617 |
| −3.0667 | 2.894862 | 7.531617 | 0.778387 | −1.92868 | 7.531617 |
| −3.06487 | 2.896615 | 7.531617 | 0.773962 | −1.94004 | 7.531617 |
| 0.693885 | −2.03565 | 8.324867 | −3.01702 | 3.013599 | 8.324867 |
| 0.685786 | −2.04066 | 8.324867 | −3.01585 | 3.014183 | 8.324867 |
| 0.673344 | −2.04333 | 8.324867 | −3.01343 | 3.014768 | 8.324867 |
| 0.658064 | −2.03965 | 8.324867 | −3.00834 | 3.01435 | 8.324867 |
| 0.643869 | −2.02705 | 8.324867 | −2.99899 | 3.010342 | 8.324867 |
| 0.626751 | −2.00843 | 8.324867 | −2.98613 | 3.001157 | 8.324867 |
| 0.60454 | −1.98413 | 8.324867 | −2.9655 | 2.981702 | 8.324867 |
| 0.576735 | −1.95382 | 8.324867 | −2.9407 | 2.953312 | 8.324867 |
| 0.543001 | −1.91691 | 8.324867 | −2.90981 | 2.913649 | 8.324867 |
| 0.502921 | −1.87291 | 8.324867 | −2.87273 | 2.862714 | 8.324867 |
| 0.455994 | −1.82147 | 8.324867 | −2.82497 | 2.796332 | 8.324867 |
| 0.400383 | −1.76085 | 8.324867 | −2.76986 | 2.719762 | 8.324867 |
| 0.336088 | −1.69096 | 8.324867 | −2.71116 | 2.637932 | 8.324867 |
| 0.263359 | −1.61172 | 8.324867 | −2.6452 | 2.545748 | 8.324867 |
| 0.181947 | −1.52312 | 8.324867 | −2.57213 | 2.443377 | 8.324867 |
| 0.091934 | −1.42535 | 8.324867 | −2.49172 | 2.330652 | 8.324867 |
| −0.00676 | −1.3183 | 8.324867 | −2.40781 | 2.212667 | 8.324867 |
| −0.10989 | −1.20674 | 8.324867 | −2.3203 | 2.089588 | 8.324867 |
| −0.21727 | −1.09059 | 8.324867 | −2.22945 | 1.961165 | 8.324867 |
| −0.32907 | −0.96969 | 8.324867 | −2.13501 | 1.827481 | 8.324867 |
| −0.44497 | −0.84419 | 8.324867 | −2.03715 | 1.688621 | 8.324867 |
| −0.56479 | −0.71359 | 8.324867 | −1.93603 | 1.544333 | 8.324867 |
| −0.68829 | −0.57782 | 8.324867 | −1.83174 | 1.394534 | 8.324867 |
| −0.81529 | −0.43662 | 8.324867 | −1.72411 | 1.239391 | 8.324867 |
| −0.94121 | −0.29459 | 8.324867 | −1.61673 | 1.084164 | 8.324867 |
| −1.06563 | −0.15122 | 8.324867 | −1.50926 | 0.928938 | 8.324867 |
| −1.18821 | −0.00618 | 8.324867 | −1.40105 | 0.774212 | 8.324867 |
| −1.30845 | 0.140948 | 8.324867 | −1.29133 | 0.620656 | 8.324867 |
| −1.42585 | 0.290497 | 8.324867 | −1.17977 | 0.468519 | 8.324867 |
| −1.53974 | 0.443051 | 8.324867 | −1.06646 | 0.317634 | 8.324867 |
| −1.64979 | 0.598111 | 8.324867 | −0.95198 | 0.167585 | 8.324867 |
| −1.75659 | 0.755425 | 8.324867 | −0.83709 | 0.017869 | 8.324867 |
| −1.86105 | 0.914409 | 8.324867 | −0.72236 | −0.13185 | 8.324867 |
| −1.96375 | 1.074395 | 8.324867 | −0.60771 | −0.28181 | 8.324867 |
| −2.06546 | 1.235216 | 8.324867 | −0.49323 | −0.43178 | 8.324867 |
| −2.16282 | 1.391194 | 8.324867 | −0.3826 | −0.57682 | 8.324867 |
| −2.25567 | 1.542496 | 8.324867 | −0.27588 | −0.71693 | 8.324867 |
| −2.34418 | 1.689038 | 8.324867 | −0.17301 | −0.85203 | 8.324867 |
| −2.42851 | 1.830738 | 8.324867 | −0.07381 | −0.98204 | 8.324867 |
| −2.50867 | 1.967511 | 8.324867 | 0.021627 | −1.10704 | 8.324867 |
| −2.58449 | 2.099441 | 8.324867 | 0.113331 | −1.22695 | 8.324867 |
| −2.6563 | 2.226361 | 8.324867 | 0.201235 | −1.34185 | 8.324867 |
| −2.32369 | 2.348521 | 8.324867 | 0.281646 | −1.44664 | 8.324867 |
| −2.78364 | 2.460244 | 8.324867 | 0.354374 | −1.54149 | 8.324867 |
| −2.83658 | 2.561446 | 8.324867 | 0.419421 | −1.62633 | 8.324867 |
| −2.88234 | 2.65196 | 8.324867 | 0.476785 | −1.70131 | 8.324867 |
| −2.92417 | 2.737381 | 8.324867 | 0.526468 | −1.76619 | 8.324867 |
| −2.95949 | 2.811863 | 8.324867 | 0.568635 | −1.82105 | 8.324867 |
| −2.98563 | 2.869645 | 8.324867 | 0.604707 | −1.86798 | 8.324867 |
| −3.00458 | 2.916655 | 8.324867 | 0.634934 | −1.90739 | 8.324867 |
| −3.01644 | 2.952811 | 8.324867 | 0.659817 | −1.93987 | 8.324867 |
| −3.02253 | 2.9807 | 8.324867 | 0.67969 | −1.96584 | 8.324867 |
| −3.02362 | 2.996481 | 8.324867 | 0.694887 | −1.9858 | 8.324867 |
| −3.02212 | 3.006501 | 8.324867 | 0.704323 | −2.00191 | 8.324867 |
| −3.01986 | 3.01101 | 8.324867 | 0.704824 | −2.01728 | 8.324867 |
| −3.01811 | 3.012847 | 8.324867 | 0.700064 | −2.02863 | 8.324867 |
| 0.649296 | −2.07973 | 8.721492 | −2.98262 | 3.076641 | 8.721492 |
| 0.64103 | −2.08449 | 8.721492 | −2.98145 | 3.077226 | 8.721492 |
| 0.628421 | −2.08667 | 8.721492 | −2.97895 | 3.077727 | 8.721492 |
| 0.613224 | −2.08216 | 8.721492 | −2.97385 | 3.077059 | 8.721492 |
| 0.599614 | −2.0688 | 8.721492 | −2.96467 | 3.072633 | 8.721492 |
| 0.582914 | −2.04959 | 8.721492 | −2.95198 | 3.063031 | 8.721492 |
| 0.56112 | −2.02462 | 8.721492 | −2.93185 | 3.042824 | 8.721492 |
| 0.533983 | −1.9934 | 8.721492 | −2.90755 | 3.013682 | 8.721492 |
| 0.500917 | −1.9554 | 8.721492 | −2.87733 | 2.973101 | 8.721492 |
| 0.461588 | −1.91031 | 8.721492 | −2.84092 | 2.921248 | 8.721492 |
| 0.41558 | −1.85746 | 8.721492 | −2.79383 | 2.85378 | 8.721492 |
| 0.361138 | −1.79508 | 8.721492 | −2.73955 | 2.775791 | 8.721492 |
| 0.298179 | −1.72319 | 8.721492 | −2.68177 | 2.692541 | 8.721492 |
| 0.226786 | −1.64178 | 8.721492 | −2.61697 | 2.598771 | 8.721492 |
| 0.147044 | −1.55076 | 8.721492 | −2.545 | 2.494563 | 8.721492 |
| 0.058784 | −1.45023 | 8.721492 | −2.46601 | 2.379834 | 8.721492 |
| −0.03791 | −1.34018 | 8.721492 | −2.38351 | 2.259761 | 8.721492 |

TABLE 1-continued

| SUCTION SIDE | | | PRESSURE SIDE | | |
|---|---|---|---|---|---|
| X | Y | Z | X | Y | Z |
| −0.13894 | −1.22545 | 8.721492 | −2.29759 | 2.134427 | 8.721492 |
| −0.24424 | −1.10604 | 8.721492 | −2.20816 | 2.00375 | 8.721492 |
| −0.35387 | −0.98188 | 8.721492 | −2.11531 | 1.867728 | 8.721492 |
| −0.46752 | −0.85279 | 8.721492 | −2.01903 | 1.72653 | 8.721492 |
| −0.585 | −0.7186 | 8.721492 | −1.91941 | 1.579737 | 8.721492 |
| −0.70599 | −0.57907 | 8.721492 | −1.81679 | 1.427516 | 8.721492 |
| −0.83041 | −0.43403 | 8.721492 | −1.71083 | 1.269785 | 8.721492 |
| −0.95357 | −0.28799 | 8.721492 | −1.6052 | 1.111886 | 8.721492 |
| −1.07515 | −0.14053 | 8.721492 | −1.49966 | 0.953904 | 8.721492 |
| −1.1948 | 0.008517 | 8.721492 | −1.3937 | 0.796256 | 8.721492 |
| −1.31195 | 0.159569 | 8.721492 | −1.28657 | 0.63936 | 8.721492 |
| −1.42626 | 0.313125 | 8.721492 | −1.17785 | 0.483632 | 8.721492 |
| −1.53698 | 0.46902 | 8.721492 | −1.06755 | 0.329074 | 8.721492 |
| −1.6442 | 0.627252 | 8.721492 | −0.95616 | 0.175267 | 8.721492 |
| −1.74849 | 0.787405 | 8.721492 | −0.84419 | 0.021877 | 8.721492 |
| −1.85078 | 0.948894 | 8.721492 | −0.73213 | −0.13143 | 8.721492 |
| −1.95156 | 1.111385 | 8.721492 | −0.62015 | −0.28482 | 8.721492 |
| −2.05134 | 1.274544 | 8.721492 | −0.50835 | −0.43829 | 8.721492 |
| −2.14695 | 1.432777 | 8.721492 | −0.40038 | −0.58675 | 8.721492 |
| −2.23813 | 1.58625 | 8.721492 | −0.29617 | −0.73021 | 8.721492 |
| −2.32489 | 1.734963 | 8.721492 | −0.19572 | −0.86848 | 8.721492 |
| −2.40739 | 1.878667 | 8.721492 | −0.09895 | −1.00158 | 8.721492 |
| −2.4858 | 2.017444 | 8.721492 | −0.00585 | −1.1295 | 8.721492 |
| −2.55994 | 2.151294 | 8.721492 | 0.083667 | −1.25225 | 8.721492 |
| −2.63017 | 2.279968 | 8.721492 | 0.169505 | −1.3699 | 8.721492 |
| −2.69596 | 2.403798 | 8.721492 | 0.247912 | −1.47728 | 8.721492 |
| −2.7545 | 2.517108 | 8.721492 | 0.318803 | −1.57439 | 8.721492 |
| −2.8061 | 2.619646 | 8.721492 | 0.38218 | −1.6614 | 8.721492 |
| −2.85077 | 2.711329 | 8.721492 | 0.438041 | −1.73814 | 8.721492 |
| −2.89152 | 2.797835 | 8.721492 | 0.486471 | −1.80469 | 8.721492 |
| −2.92592 | 2.873235 | 8.721492 | 0.527553 | −1.86096 | 8.721492 |
| −2.95147 | 2.931685 | 8.721492 | 0.56254 | −1.90906 | 8.721492 |
| −2.97018 | 2.979113 | 8.721492 | 0.592015 | −1.94947 | 8.721492 |
| −2.98187 | 3.015519 | 8.721492 | 0.61623 | −1.98271 | 8.721492 |
| −2.98788 | 3.043575 | 8.721492 | 0.635602 | −2.00934 | 8.721492 |
| −2.98905 | 3.05944 | 8.721492 | 0.650549 | −2.0298 | 8.721492 |
| −2.98771 | 3.06946 | 8.721492 | 0.660068 | −2.046 | 8.721492 |
| −2.98546 | 3.074053 | 8.721492 | 0.660652 | −2.06145 | 8.721492 |
| −2.98371 | 3.075973 | 8.721492 | 0.655726 | −2.0728 | 8.721492 |
| 0.597025 | −2.11973 | 9.118117 | −2.93611 | 3.143692 | 9.118117 |
| 0.588592 | −2.12432 | 9.118117 | −2.93494 | 3.144193 | 9.118117 |
| 0.575816 | −2.12599 | 9.118117 | −2.93244 | 3.14461 | 9.118117 |
| 0.56087 | −2.12065 | 9.118117 | −2.92734 | 3.143775 | 9.118117 |
| 0.54776 | −2.10662 | 9.118117 | −2.91824 | 3.138932 | 9.118117 |
| 0.531394 | −2.08692 | 9.118117 | −2.90588 | 3.128912 | 9.118117 |
| 0.510185 | −2.06128 | 9.118117 | −2.88626 | 3.108037 | 9.118117 |
| 0.483632 | −2.0293 | 9.118117 | −2.86255 | 3.078228 | 9.118117 |
| 0.451318 | −1.99039 | 9.118117 | −2.83307 | 3.036812 | 9.118117 |
| 0.412824 | −1.94421 | 9.118117 | −2.79725 | 2.984207 | 9.118117 |
| 0.367818 | −1.89011 | 9.118117 | −2.75091 | 2.915737 | 9.118117 |
| 0.314545 | −1.82615 | 9.118117 | −2.69747 | 2.836662 | 9.118117 |
| 0.253005 | −1.7525 | 9.118117 | −2.6406 | 2.752244 | 9.118117 |
| 0.183199 | −1.66908 | 9.118117 | −2.57689 | 2.657137 | 9.118117 |
| 0.105043 | −1.57598 | 9.118117 | −2.50617 | 2.551343 | 9.118117 |
| 0.018704 | −1.47302 | 9.118117 | −2.42868 | 2.434777 | 9.118117 |
| −0.0759 | −1.3603 | 9.118117 | −2.34802 | 2.3127 | 9.118117 |
| −0.17485 | −1.24273 | 9.118117 | −2.2641 | 2.185195 | 9.118117 |
| −0.27797 | −1.12049 | 9.118117 | −2.17685 | 2.05218 | 9.118117 |
| −0.38535 | −0.9934 | 9.118117 | −2.08633 | 1.913737 | 9.118117 |
| −0.49683 | −0.8613 | 9.118117 | −1.99264 | 1.769783 | 9.118117 |
| −0.61197 | −0.72411 | 9.118117 | −1.89595 | 1.620234 | 9.118117 |
| −0.73071 | −0.58149 | 9.118117 | −1.79617 | 1.465008 | 9.118117 |
| −0.8527 | −0.43328 | 9.118117 | −1.69338 | 1.304187 | 9.118117 |
| −0.97328 | −0.28398 | 9.118117 | −1.59101 | 1.143199 | 9.118117 |
| −1.09193 | −0.13302 | 9.118117 | −1.48897 | 0.981877 | 9.118117 |
| −1.20816 | 0.019957 | 9.118117 | −1.38694 | 0.820555 | 9.118117 |
| −1.32114 | 0.175434 | 9.118117 | −1.28448 | 0.659567 | 9.118117 |
| −1.43052 | 0.333499 | 9.118117 | −1.18069 | 0.499497 | 9.118117 |
| −1.53607 | 0.493986 | 9.118117 | −1.07498 | 0.340597 | 9.118117 |
| −1.63852 | 0.656394 | 9.118117 | −0.96743 | 0.182949 | 9.118117 |
| −1.73872 | 0.820221 | 9.118117 | −0.85871 | 0.026136 | 9.118117 |
| −1.83733 | 0.98505 | 9.118117 | −0.74933 | −0.13026 | 9.118117 |
| −1.93478 | 1.15063 | 9.118117 | −0.63969 | −0.28657 | 9.118117 |
| −2.0313 | 1.316795 | 9.118117 | −0.53031 | −0.44305 | 9.118117 |
| −2.12374 | 1.477867 | 9.118117 | −0.42485 | −0.59444 | 9.118117 |
| −2.212 | 1.634012 | 9.118117 | −0.32323 | −0.74073 | 9.118117 |

TABLE 1-continued

| SUCTION SIDE | | | PRESSURE SIDE | | |
|---|---|---|---|---|---|
| X | Y | Z | X | Y | Z |
| −2.296 | 1.785147 | 9.118117 | −0.22537 | −0.88193 | 9.118117 |
| −2.37599 | 1.931188 | 9.118117 | −0.1311 | −1.01787 | 9.118117 |
| −2.45198 | 2.072136 | 9.118117 | −0.04041 | −1.14863 | 9.118117 |
| −2.52404 | 2.207907 | 9.118117 | 0.04676 | −1.27396 | 9.118117 |
| −2.59251 | 2.338334 | 9.118117 | 0.130344 | −1.39412 | 9.118117 |
| −2.65672 | 2.463751 | 9.118117 | 0.206496 | −1.50384 | 9.118117 |
| −2.71375 | 2.578397 | 9.118117 | 0.275383 | −1.6032 | 9.118117 |
| −2.7641 | 2.682187 | 9.118117 | 0.336923 | −1.69213 | 9.118117 |
| −2.80769 | 2.774956 | 9.118117 | 0.391281 | −1.77062 | 9.118117 |
| −2.84743 | 2.86238 | 9.118117 | 0.438375 | −1.83867 | 9.118117 |
| −2.88092 | 2.938616 | 9.118117 | 0.478205 | −1.8962 | 9.118117 |
| −2.9058 | 2.99765 | 9.118117 | 0.512189 | −1.94538 | 9.118117 |
| −2.92409 | 3.045496 | 9.118117 | 0.54083 | −1.98672 | 9.118117 |
| −2.93553 | 3.082236 | 9.118117 | 0.564377 | −2.0207 | 9.118117 |
| −2.94145 | 3.110375 | 9.118117 | 0.583248 | −2.04784 | 9.118117 |
| −2.94254 | 3.126324 | 9.118117 | 0.59786 | −2.06871 | 9.118117 |
| −2.9412 | 3.136511 | 9.118117 | 0.607713 | −2.085 | 9.118117 |
| −2.93903 | 3.141103 | 9.118117 | 0.608799 | −2.10094 | 9.118117 |
| −2.9372 | 3.14294 | 9.118117 | 0.603789 | −2.11272 | 9.118117 |
| 0.463592 | −2.18737 | 9.911367 | −2.82314 | 3.274453 | 9.911367 |
| 0.454908 | −2.19154 | 9.911367 | −2.82188 | 3.274954 | 9.911367 |
| 0.442049 | −2.19238 | 9.911367 | −2.81929 | 3.275121 | 9.911367 |
| 0.42752 | −2.1857 | 9.911367 | −2.81437 | 3.273701 | 9.911367 |
| 0.415329 | −2.17075 | 9.911367 | −2.80577 | 3.268023 | 9.911367 |
| 0.399715 | −2.15038 | 9.911367 | −2.79408 | 3.256918 | 9.911367 |
| 0.379508 | −2.12382 | 9.911367 | −2.77571 | 3.234874 | 9.911367 |
| 0.354124 | −2.09059 | 9.911367 | −2.75341 | 3.203645 | 9.911367 |
| 0.323312 | −2.05026 | 9.911367 | −2.72544 | 3.160809 | 9.911367 |
| 0.286656 | −2.00233 | 9.911367 | −2.69104 | 3.106868 | 9.911367 |
| 0.243737 | −1.94622 | 9.911367 | −2.64628 | 3.036728 | 9.911367 |
| 0.192969 | −1.87984 | 9.911367 | −2.59468 | 2.955733 | 9.911367 |
| 0.134435 | −1.80335 | 9.911367 | −2.53965 | 2.869394 | 9.911367 |
| 0.067969 | −1.71668 | 9.911367 | −2.47795 | 2.7722 | 9.911367 |
| −0.00618 | −1.61973 | 9.911367 | −2.40956 | 2.664068 | 9.911367 |
| −0.08809 | −1.5126 | 9.911367 | −2.33474 | 2.54483 | 9.911367 |
| −0.17777 | −1.3952 | 9.911367 | −2.25726 | 2.419663 | 9.911367 |
| −0.27138 | −1.27271 | 9.911367 | −2.17693 | 2.288819 | 9.911367 |
| −0.3689 | −1.14504 | 9.911367 | −2.0936 | 2.152213 | 9.911367 |
| −0.47011 | −1.01227 | 9.911367 | −2.00776 | 2.009678 | 9.911367 |
| −0.57498 | −0.87416 | 9.911367 | −1.91958 | 1.861132 | 9.911367 |
| −0.68311 | −0.73046 | 9.911367 | −1.8289 | 1.706573 | 9.911367 |
| −0.79425 | −0.58099 | 9.911367 | −1.73588 | 1.546086 | 9.911367 |
| −0.90781 | −0.42535 | 9.911367 | −1.64036 | 1.379587 | 9.911367 |
| −1.01928 | −0.26829 | 9.911367 | −1.54567 | 1.212587 | 9.911367 |
| −1.12783 | −0.10905 | 9.911367 | −1.45198 | 1.045086 | 9.911367 |
| −1.23288 | 0.052772 | 9.911367 | −1.3593 | 0.877001 | 9.911367 |
| −1.33383 | 0.217518 | 9.911367 | −1.26745 | 0.708414 | 9.911367 |
| −1.43061 | 0.384768 | 9.911367 | −1.17551 | 0.539911 | 9.911367 |
| −1.52396 | 0.553856 | 9.911367 | −1.08216 | 0.372243 | 9.911367 |
| −1.61556 | 0.723862 | 9.911367 | −0.98647 | 0.205995 | 9.911367 |
| −1.70632 | 0.894452 | 9.911367 | −0.88836 | 0.041166 | 9.911367 |
| −1.79642 | 1.065293 | 9.911367 | −0.78857 | −0.12266 | 9.911367 |
| −1.88585 | 1.236552 | 9.911367 | −0.68779 | −0.2859 | 9.911367 |
| −1.97461 | 1.408144 | 9.911367 | −0.58675 | −0.4489 | 9.911367 |
| −2.05986 | 1.574226 | 9.911367 | −0.48906 | −0.60646 | 9.911367 |
| −2.14178 | 1.73488 | 9.911367 | −0.39479 | −0.75868 | 9.911367 |
| −2.22018 | 1.890106 | 9.911367 | −0.30394 | −0.90556 | 9.911367 |
| −2.29508 | 2.039822 | 9.911367 | −0.21643 | −1.04684 | 9.911367 |
| −2.36656 | 2.18411 | 9.911367 | −0.1321 | −1.18261 | 9.911367 |
| −2.43494 | 2.322636 | 9.911367 | −0.05085 | −1.31279 | 9.911367 |
| −2.50007 | 2.455652 | 9.911367 | 0.027054 | −1.43754 | 9.911367 |
| −2.56136 | 2.583407 | 9.911367 | 0.09828 | −1.55135 | 9.911367 |
| −2.6158 | 2.70014 | 9.911367 | 0.162658 | −1.65439 | 9.911367 |
| −2.66373 | 2.805684 | 9.911367 | 0.220273 | −1.74657 | 9.911367 |
| −2.70515 | 2.900039 | 9.911367 | 0.271125 | −1.8279 | 9.911367 |
| −2.74272 | 2.98905 | 9.911367 | 0.315296 | −1.89829 | 9.911367 |
| −2.77412 | 3.066621 | 9.911367 | 0.352621 | −1.95791 | 9.911367 |
| −2.79733 | 3.126658 | 9.911367 | 0.384601 | −2.00884 | 9.911367 |
| −2.81403 | 3.175422 | 9.911367 | 0.411488 | −2.0516 | 9.911367 |
| −2.8243 | 3.212663 | 9.911367 | 0.433616 | −2.08675 | 9.911367 |
| −2.8294 | 3.24122 | 9.911367 | 0.451401 | −2.1148 | 9.911367 |
| −2.83007 | 3.257252 | 9.911367 | 0.465095 | −2.13643 | 9.911367 |
| −2.8284 | 3.267355 | 9.911367 | 0.474781 | −2.15296 | 9.911367 |
| −2.82606 | 3.271948 | 9.911367 | 0.475867 | −2.16891 | 9.911367 |
| −2.82422 | 3.273785 | 9.911367 | 0.470606 | −2.1806 | 9.911367 |
| 0.387858 | −2.21267 | 10.30799 | −2.7646 | 3.332068 | 10.30799 |

TABLE 1-continued

| SUCTION SIDE | | | PRESSURE SIDE | | |
|---|---|---|---|---|---|
| X | Y | Z | X | Y | Z |
| 0.379007 | −2.21659 | 10.30799 | −2.76335 | 3.332485 | 10.30799 |
| 0.366148 | −2.21709 | 10.30799 | −2.76076 | 3.332402 | 10.30799 |
| 0.351953 | −2.20983 | 10.30799 | −2.75592 | 3.330481 | 10.30799 |
| 0.340096 | −2.19463 | 10.30799 | −2.74782 | 3.324302 | 10.30799 |
| 0.324815 | −2.17401 | 10.30799 | −2.7368 | 3.312612 | 10.30799 |
| 0.304859 | −2.1472 | 10.30799 | −2.71926 | 3.289817 | 10.30799 |
| 0.279976 | −2.11364 | 10.30799 | −2.69797 | 3.25792 | 10.30799 |
| 0.249665 | −2.07289 | 10.30799 | −2.67091 | 3.2145 | 10.30799 |
| 0.213677 | −2.02446 | 10.30799 | −2.63735 | 3.159974 | 10.30799 |
| 0.171676 | −1.96759 | 10.30799 | −2.59393 | 3.089083 | 10.30799 |
| 0.121994 | −1.90046 | 10.30799 | −2.54358 | 3.007336 | 10.30799 |
| 0.064796 | −1.82289 | 10.30799 | −2.4898 | 2.920162 | 10.30799 |
| 8.35E−05 | −1.73496 | 10.30799 | −2.42943 | 2.822133 | 10.30799 |
| −0.07214 | −1.6366 | 10.30799 | −2.36247 | 2.712999 | 10.30799 |
| −0.15172 | −1.52763 | 10.30799 | −2.28907 | 2.592926 | 10.30799 |
| −0.23856 | −1.40806 | 10.30799 | −2.213 | 2.466924 | 10.30799 |
| −0.32874 | −1.28314 | 10.30799 | −2.13409 | 2.335161 | 10.30799 |
| −0.42243 | −1.15272 | 10.30799 | −2.05243 | 2.197637 | 10.30799 |
| −0.51937 | −1.01678 | 10.30799 | −1.96826 | 2.0541 | 10.30799 |
| −0.61915 | −0.87508 | 10.30799 | −1.88192 | 1.904468 | 10.30799 |
| −0.72144 | −0.72729 | 10.30799 | −1.79333 | 1.748657 | 10.30799 |
| −0.82573 | −0.57314 | 10.30799 | −1.70257 | 1.586834 | 10.30799 |
| −0.93144 | −0.41224 | 10.30799 | −1.60946 | 1.418999 | 10.30799 |
| −1.03457 | −0.24958 | 10.30799 | −1.51745 | 1.25058 | 10.30799 |
| −1.13468 | −0.08492 | 10.30799 | −1.4266 | 1.081492 | 10.30799 |
| −1.23137 | 0.081914 | 10.30799 | −1.33675 | 0.91182 | 10.30799 |
| −1.32506 | 0.250834 | 10.30799 | −1.24791 | 0.741647 | 10.30799 |
| −1.41616 | 0.421258 | 10.30799 | −1.1599 | 0.570973 | 10.30799 |
| −1.50576 | 0.592433 | 10.30799 | −1.07214 | 0.400216 | 10.30799 |
| −1.59443 | 0.764109 | 10.30799 | −0.98363 | 0.229876 | 10.30799 |
| −1.68253 | 0.936119 | 10.30799 | −0.89378 | 0.060204 | 10.30799 |
| −1.76995 | 1.108379 | 10.30799 | −0.80244 | −0.10863 | 10.30799 |
| −1.85671 | 1.281141 | 10.30799 | −0.70983 | −0.2768 | 10.30799 |
| −1.94288 | 1.454069 | 10.30799 | −0.61631 | −0.44447 | 10.30799 |
| −2.02588 | 1.621403 | 10.30799 | −0.52522 | −0.60621 | 10.30799 |
| −2.10579 | 1.783059 | 10.30799 | −0.43662 | −0.76202 | 10.30799 |
| −2.18244 | 1.939204 | 10.30799 | −0.35078 | −0.91207 | 10.30799 |
| −2.25559 | 2.089838 | 10.30799 | −0.2677 | −1.05619 | 10.30799 |
| −2.32548 | 2.234961 | 10.30799 | −0.18729 | −1.19455 | 10.30799 |
| −2.39228 | 2.374323 | 10.30799 | −0.10964 | −1.32715 | 10.30799 |
| −2.45582 | 2.508173 | 10.30799 | −0.03482 | −1.4539 | 10.30799 |
| −2.51544 | 2.636763 | 10.30799 | 0.033818 | −1.56947 | 10.30799 |
| −2.56854 | 2.754164 | 10.30799 | 0.096025 | −1.67401 | 10.30799 |
| −2.61505 | 2.860293 | 10.30799 | 0.151887 | −1.76736 | 10.30799 |
| −2.65497 | 2.955316 | 10.30799 | 0.201319 | −1.84969 | 10.30799 |
| −2.69112 | 3.044911 | 10.30799 | 0.244154 | −1.921 | 10.30799 |
| −2.72127 | 3.123067 | 10.30799 | 0.280393 | −1.98137 | 10.30799 |
| −2.74323 | 3.183605 | 10.30799 | 0.311455 | −2.03289 | 10.30799 |
| −2.75867 | 3.232786 | 10.30799 | 0.337591 | −2.07623 | 10.30799 |
| −2.76786 | 3.270278 | 10.30799 | 0.359134 | −2.1118 | 10.30799 |
| −2.77203 | 3.299002 | 10.30799 | 0.376418 | −2.14027 | 10.30799 |
| −2.7722 | 3.315117 | 10.30799 | 0.389695 | −2.16215 | 10.30799 |
| −2.77011 | 3.325137 | 10.30799 | 0.399214 | −2.17877 | 10.30799 |
| −2.76761 | 3.329646 | 10.30799 | 0.400216 | −2.19455 | 10.30799 |
| −2.76569 | 3.3314 | 10.30799 | 0.394872 | −2.20607 | 10.30799 |
| 0.332247 | −2.2196 | 10.70462 | −2.70674 | 3.384172 | 10.70462 |
| 0.323312 | −2.22335 | 10.70462 | −2.0548 | 3.384589 | 10.70462 |
| 0.310453 | −2.22344 | 10.70462 | −2.7029 | 3.384255 | 10.70462 |
| 0.296509 | −2.21559 | 10.70462 | −2.69839 | 3.38175 | 10.70462 |
| 0.284986 | −2.20023 | 10.70462 | −2.69087 | 3.37482 | 10.70462 |
| 0.269789 | −2.17943 | 10.70462 | −2.68068 | 3.362462 | 10.70462 |
| 0.250083 | −2.15246 | 10.70462 | −2.6644 | 3.338831 | 10.70462 |
| 0.22545 | −2.11881 | 10.70462 | −2.64428 | 3.306099 | 10.70462 |
| 0.195557 | −2.07773 | 10.70462 | −2.61823 | 3.262095 | 10.70462 |
| 0.16007 | −2.02897 | 10.70462 | −2.58583 | 3.206985 | 10.70462 |
| 0.11857 | −1.97177 | 10.70462 | −2.54358 | 3.135342 | 10.70462 |
| 0.069639 | −1.90405 | 10.70462 | −2.49465 | 3.052927 | 10.70462 |
| 0.013193 | −1.82598 | 10.70462 | −2.44246 | 2.964918 | 10.70462 |
| −0.05052 | −1.7373 | 10.70462 | −2.38384 | 2.865804 | 10.70462 |
| −0.12149 | −1.63802 | 10.70462 | −2.31896 | 2.755667 | 10.70462 |
| −0.19965 | −1.52805 | 10.70462 | −2.24782 | 2.634342 | 10.70462 |
| −0.28474 | −1.40731 | 10.70462 | −2.17401 | 2.507088 | 10.70462 |
| −0.37299 | −1.28097 | 10.70462 | −2.09744 | 2.374072 | 10.70462 |
| −0.46418 | −1.14896 | 10.70462 | −2.01828 | 2.235212 | 10.70462 |
| −0.55811 | −1.01102 | 10.70462 | −1.93678 | 2.090256 | 10.70462 |
| −0.65431 | −0.86698 | 10.70462 | −1.85303 | 1.939288 | 10.70462 |

TABLE 1-continued

| SUCTION SIDE | | | PRESSURE SIDE | | |
|---|---|---|---|---|---|
| X | Y | Z | X | Y | Z |
| −0.75242 | −0.7166 | 10.70462 | −1.76719 | 1.782224 | 10.70462 |
| −0.85195 | −0.55945 | 10.70462 | −1.67927 | 1.618982 | 10.70462 |
| −0.95223 | −0.39521 | 10.70462 | −1.58901 | 1.449727 | 10.70462 |
| −1.0496 | −0.22912 | 10.70462 | −1.49983 | 1.279888 | 10.70462 |
| −1.14378 | −0.06104 | 10.70462 | −1.41182 | 1.109548 | 10.70462 |
| −1.2348 | 0.108968 | 10.70462 | −1.32473 | 0.938624 | 10.70462 |
| −1.32331 | 0.280644 | 10.70462 | −1.23864 | 0.767282 | 10.70462 |
| −1.41023 | 0.453155 | 10.70462 | −1.15355 | 0.595355 | 10.70462 |
| −1.49649 | 0.625916 | 10.70462 | −1.06964 | 0.422844 | 10.70462 |
| −1.58241 | 0.798928 | 10.70462 | −0.98588 | 0.25025 | 10.70462 |
| −1.66775 | 0.972191 | 10.70462 | −0.90138 | 0.077989 | 10.70462 |
| −1.75241 | 1.145787 | 10.70462 | −0.81563 | −0.0936 | 10.70462 |
| −1.83633 | 1.319718 | 10.70462 | −0.72854 | −0.26453 | 10.70462 |
| −1.91975 | 1.493899 | 10.70462 | −0.64028 | −0.43478 | 10.70462 |
| −2.00024 | 1.662402 | 10.70462 | −0.55377 | −0.59886 | 10.70462 |
| −2.07756 | 1.825227 | 10.70462 | −0.46935 | −0.75676 | 10.70462 |
| −2.15163 | 1.982457 | 10.70462 | −0.38711 | −0.90856 | 10.70462 |
| −2.22235 | 2.134177 | 10.70462 | −0.30711 | −1.05435 | 10.70462 |
| −2.28999 | 2.280218 | 10.70462 | −0.22946 | −1.19413 | 10.70462 |
| −2.35445 | 2.420665 | 10.70462 | −0.15422 | −1.3279 | 10.70462 |
| −2.41549 | 2.555518 | 10.70462 | −0.08141 | −1.45582 | 10.70462 |
| −2.47294 | 2.685026 | 10.70462 | −0.01461 | −1.57231 | 10.70462 |
| −2.52412 | 2.803179 | 10.70462 | 0.046176 | −1.67752 | 10.70462 |
| −2.56896 | 2.910059 | 10.70462 | 0.100785 | −1.77154 | 10.70462 |
| −2.60737 | 3.005583 | 10.70462 | 0.149131 | −1.85445 | 10.70462 |
| −2.64211 | 3.095679 | 10.70462 | 0.191048 | −1.92626 | 10.70462 |
| −2.67083 | 3.174336 | 10.70462 | 0.226536 | −1.98697 | 10.70462 |
| −2.69121 | 3.235375 | 10.70462 | 0.257013 | −2.03882 | 10.70462 |
| −2.70507 | 3.284974 | 10.70462 | 0.282564 | −2.08241 | 10.70462 |
| −2.71292 | 3.322799 | 10.70462 | 0.30369 | −2.11823 | 10.70462 |
| −2.71592 | 3.351607 | 10.70462 | 0.320557 | −2.14687 | 10.70462 |
| −2.71525 | 3.367639 | 10.70462 | 0.333583 | −2.16891 | 10.70462 |
| −2.71266 | 3.377575 | 10.70462 | 0.343102 | −2.18553 | 10.70462 |
| −2.70991 | 3.381917 | 10.70462 | 0.344521 | −2.20139 | 10.70462 |
| −2.70791 | 3.383504 | 10.70462 | 0.339261 | −2.213 | 10.70462 |
| 0.291833 | −2.21442 | 11.10124 | −2.64954 | 3.434021 | 11.10124 |
| 0.282898 | −2.21818 | 11.10124 | −2.64829 | 3.434272 | 11.10124 |
| 0.270039 | −2.21793 | 11.10124 | −2.64586 | 3.43352 | 11.10124 |
| 0.256429 | −2.20949 | 11.10124 | −2.64177 | 3.430431 | 11.10124 |
| 0.245073 | −2.19396 | 11.10124 | −2.63501 | 3.422749 | 11.10124 |
| 0.230043 | −2.17309 | 11.10124 | −2.62599 | 3.409556 | 11.10124 |
| 0.210587 | −2.14603 | 11.10124 | −2.6113 | 3.38484 | 11.10124 |
| 0.186289 | −2.11205 | 11.10124 | −2.59268 | 3.351356 | 11.10124 |
| 0.15673 | −2.0708 | 11.10124 | −2.56771 | 3.306851 | 11.10124 |
| 0.12166 | −2.0217 | 11.10124 | −2.5364 | 3.251156 | 11.10124 |
| 0.080661 | −1.96417 | 11.10124 | −2.49548 | 3.178929 | 11.10124 |
| 0.032231 | −1.8962 | 11.10124 | −2.44797 | 3.095763 | 11.10124 |
| −0.02355 | −1.81771 | 11.10124 | −1.39737 | 3.006919 | 11.10124 |
| −0.08659 | −1.72862 | 11.10124 | −2.34067 | 2.906969 | 11.10124 |
| −0.15681 | −1.62883 | 11.10124 | −2.2778 | 2.795747 | 11.10124 |
| −0.23413 | −1.51836 | 11.10124 | −2.20949 | 2.673002 | 11.10124 |
| −0.3183 | −1.39704 | 11.10124 | −2.13894 | 2.544162 | 11.10124 |
| −0.40539 | −1.27004 | 11.10124 | −2.06546 | 2.409643 | 11.10124 |
| −0.49524 | −1.13719 | 11.10124 | −1.98964 | 2.269113 | 11.10124 |
| −0.58734 | −0.99816 | 11.10124 | −1.91165 | 2.12257 | 11.10124 |
| −0.68136 | −0.85287 | 11.10124 | −1.83141 | 1.969932 | 11.10124 |
| −0.77713 | −0.70098 | 11.10124 | −1.74916 | 1.811115 | 11.10124 |
| −0.87399 | −0.54233 | 11.10124 | −1.66482 | 1.646203 | 11.10124 |
| −0.97161 | −0.37659 | 11.10124 | −1.57832 | 1.475278 | 11.10124 |
| −1.06621 | −0.20892 | 11.10124 | −1.49265 | 1.303936 | 11.10124 |
| −1.15756 | −0.03925 | 11.10124 | −1.40781 | 1.132177 | 11.10124 |
| −1.24557 | 0.132431 | 11.10124 | −1.32389 | 0.96 | 11.10124 |
| −1.33099 | 0.305527 | 11.10124 | −1.24089 | 0.787322 | 11.10124 |
| −1.41466 | 0.479457 | 11.10124 | −1.15873 | 0.614226 | 11.10124 |
| −1.49757 | 0.653805 | 11.10124 | −1.07748 | 0.440713 | 11.10124 |
| −1.58007 | 0.82832 | 11.10124 | −0.99624 | 0.2672 | 11.10124 |
| −1.66207 | 1.003086 | 11.10124 | −0.91416 | 0.094105 | 11.10124 |
| −1.74331 | 1.178102 | 11.10124 | −0.83083 | −0.07841 | 11.10124 |
| −1.82397 | 1.353535 | 11.10124 | −0.74607 | −0.25025 | 11.10124 |
| −1.90413 | 1.529136 | 11.10124 | −0.66015 | −0.42142 | 11.10124 |
| −1.98129 | 1.699058 | 11.10124 | −0.57598 | −0.58642 | 11.10124 |
| −2.05527 | 1.863303 | 11.10124 | −0.49382 | −0.74524 | 11.10124 |
| −2.12599 | 2.022036 | 11.10124 | −0.41366 | −0.89796 | 11.10124 |
| −2.19355 | 2.175008 | 11.10124 | −0.33559 | −1.04459 | 11.10124 |
| −2.25809 | 2.322386 | 11.10124 | −0.25952 | −1.18495 | 11.10124 |
| −2.31955 | 2.464085 | 11.10124 | −0.1857 | −1.31938 | 11.10124 |

TABLE 1-continued

| SUCTION SIDE | | | PRESSURE SIDE | | |
|---|---|---|---|---|---|
| X | Y | Z | X | Y | Z |
| −2.37758 | 2.60019 | 11.10124 | −0.11431 | −1.44772 | 11.10124 |
| −2.43236 | 2.730701 | 11.10124 | −0.0486 | −1.56471 | 11.10124 |
| −2.48104 | 2.849855 | 11.10124 | 0.011106 | −1.67033 | 11.10124 |
| −2.52379 | 2.957487 | 11.10124 | 0.064629 | −1.76486 | 11.10124 |
| −2.56061 | 3.053679 | 11.10124 | 0.112057 | −1.84811 | 11.10124 |
| −2.59376 | 3.144276 | 11.10124 | 0.153139 | −1.92025 | 11.10124 |
| −2.62107 | 3.223351 | 11.10124 | 0.188042 | −1.98129 | 11.10124 |
| −2.63969 | 3.28489 | 11.10124 | 0.217852 | −2.03339 | 11.10124 |
| −2.65196 | 3.334907 | 11.10124 | 0.242985 | −2.07715 | 11.10124 |
| −2.65839 | 3.372983 | 11.10124 | 0.263693 | −2.11313 | 11.10124 |
| −2.66023 | 3.401874 | 11.10124 | 0.28031 | −2.14194 | 11.10124 |
| −2.65881 | 3.417906 | 11.10124 | 0.293002 | −2.16407 | 11.10124 |
| −2.65572 | 3.427592 | 11.10124 | 0.302437 | −2.18077 | 11.10124 |
| −2.65271 | 3.431767 | 11.10124 | 0.304024 | −2.19638 | 11.10124 |
| −2.65062 | 3.433353 | 11.10124 | 0.298847 | −2.20799 | 11.10124 |
| 0.272461 | −2.21091 | 11.29955 | −2.62274 | 3.45999 | 11.29955 |
| 0.263526 | −2.21459 | 11.29955 | −2.62157 | 3.460324 | 11.29955 |
| 0.250667 | −2.21425 | 11.29955 | −2.61906 | 3.459656 | 11.29955 |
| 0.137224 | −2.20565 | 11.29955 | −2.61514 | 3.456399 | 11.29955 |
| 0.226035 | −2.19004 | 11.29955 | −2.60871 | 3.448467 | 11.29955 |
| 0.211088 | −2.16916 | 11.29955 | −2.60011 | 3.435023 | 11.29955 |
| 0.191716 | −2.14194 | 11.29955 | −2.58616 | 3.40989 | 11.29955 |
| 0.167585 | −2.10796 | 11.29955 | −2.56804 | 3.376156 | 11.29955 |
| 0.138193 | −2.06654 | 11.29955 | −2.54358 | 3.331316 | 11.29955 |
| 0.103373 | −2.01728 | 11.29955 | −2.51293 | 3.275371 | 11.29955 |
| 0.062625 | −1.95958 | 11.29955 | −2.47269 | 3.202726 | 11.29955 |
| 0.014446 | −1.89136 | 11.29955 | −2.42601 | 3.119143 | 11.29955 |
| −0.041 | −1.8127 | 11.29955 | −2.37624 | 3.029881 | 11.29955 |
| −0.10371 | −1.72336 | 11.29955 | −2.32047 | 2.929431 | 11.29955 |
| −0.17351 | −1.62332 | 11.29955 | −2.25876 | 2.817624 | 11.29955 |
| −0.25042 | −1.51252 | 11.29955 | −2.19188 | 2.694128 | 11.29955 |
| −0.33417 | −1.39094 | 11.29955 | −2.1229 | 2.564452 | 11.29955 |
| −0.42084 | −1.26369 | 11.29955 | −2.05093 | 2.429182 | 11.29955 |
| −0.51002 | −1.13042 | 11.29955 | −1.97686 | 2.287817 | 11.29955 |
| −0.60128 | −0.99089 | 11.29955 | −1.90063 | 2.140356 | 11.29955 |
| −0.69439 | −0.8451 | 11.29955 | −1.82214 | 1.986883 | 11.29955 |
| −0.78908 | −0.69263 | 11.29955 | −1.74164 | 1.827231 | 11.29955 |
| −0.88485 | −0.5334 | 11.29955 | −1.65923 | 1.6614 | 11.29955 |
| −0.98121 | −0.36707 | 11.29955 | −1.57464 | 1.489557 | 11.29955 |
| −1.07465 | −0.1989 | 11.29955 | −1.49064 | 1.31738 | 11.29955 |
| −1.16466 | −0.02881 | 11.29955 | −1.40748 | 1.144869 | 11.29955 |
| −1.25141 | 0.14337 | 11.29955 | −1.32515 | 0.97194 | 11.29955 |
| −1.33542 | 0.317217 | 11.29955 | −1.24373 | 0.798594 | 11.29955 |
| −1.41758 | 0.491899 | 11.29955 | −1.16299 | 0.624831 | 11.29955 |
| −1.49883 | 0.666915 | 11.29955 | −1.083 | 0.450817 | 11.29955 |
| −1.57957 | 0.842265 | 11.29955 | −1.00275 | 0.276886 | 11.29955 |
| −1.65981 | 1.017865 | 11.29955 | −0.92167 | 0.103373 | 11.29955 |
| −1.73939 | 1.193716 | 11.29955 | −0.83926 | −0.06947 | 11.29955 |
| −1.8183 | 1.369901 | 11.29955 | −0.75534 | −0.24173 | 11.29955 |
| −1.89679 | 1.546253 | 11.29955 | −0.67034 | −0.41333 | 11.29955 |
| −1.97227 | 1.716927 | 11.29955 | −0.58717 | −0.57874 | 11.29955 |
| −2.0445 | 1.882007 | 11.29955 | −0.50593 | −0.73806 | 11.29955 |
| −2.11355 | 2.041492 | 11.29955 | −0.42669 | −0.89111 | 11.29955 |
| −2.1796 | 2.195215 | 11.29955 | −0.34945 | −1.03807 | 11.29955 |
| −2.24256 | 2.343177 | 11.29955 | −0.27413 | −1.17885 | 11.29955 |
| −2.30235 | 2.485628 | 11.29955 | −0.20098 | −1.31346 | 11.29955 |
| −2.35904 | 2.622318 | 11.29955 | −0.13018 | −1.44213 | 11.29955 |
| −2.41232 | 2.75349 | 11.29955 | −0.06505 | −1.55936 | 11.29955 |
| −2.45949 | 2.83235 | 11.29955 | −0.00585 | −1.66532 | 11.29955 |
| −2.50108 | 2.981368 | 11.29955 | 0.047178 | −1.76001 | 11.29955 |
| −2.5369 | 3.07781 | 11.29955 | 0.094105 | −1.84351 | 11.29955 |
| −2.56921 | 3.168825 | 11.29955 | 0.134769 | −1.91591 | 11.29955 |
| −2.5956 | 3.24815 | 11.29955 | 0.169338 | −1.97703 | 11.29955 |
| −2.61347 | 3.310024 | 11.29955 | 0.198897 | −2.0293 | 11.29955 |
| −2.62507 | 3.360207 | 11.29955 | 0.223864 | −2.07314 | 11.29955 |
| −2.631 | 3.398367 | 11.29955 | 0.244321 | −2.10921 | 11.29955 |
| −2.63267 | 3.427258 | 11.29955 | 0.260771 | −2.1381 | 11.29955 |
| −2.63134 | 3.44329 | 11.29955 | 0.273379 | −2.16031 | 11.29955 |
| −2.62841 | 3.453143 | 11.29955 | 0.282815 | −2.17701 | 11.29955 |
| −2.62566 | 3.457485 | 11.29955 | 0.284735 | −2.19271 | 11.29955 |
| −2.62374 | 3.459238 | 11.29955 | 0.279558 | −2.2044 | 11.29955 |
| 0.252922 | −2.20699 | 11.49787 | −2.59802 | 3.487294 | 11.49787 |
| 0.243987 | −2.21058 | 11.49787 | −2.59693 | 3.487962 | 11.49787 |
| 0.231295 | −2.21041 | 11.49787 | −2.59443 | 3.487795 | 11.49787 |
| 0.218019 | −2.20173 | 11.49787 | −2.59034 | 3.484622 | 11.49787 |
| 0.20683 | −2.18603 | 11.49787 | −2.58399 | 3.47669 | 11.49787 |

TABLE 1-continued

| SUCTION SIDE | | | PRESSURE SIDE | | |
|---|---|---|---|---|---|
| X | Y | Z | X | Y | Z |
| 0.19205 | −2.16507 | 11.49787 | −2.57547 | 3.463163 | 11.49787 |
| 0.172762 | −2.13777 | 11.49787 | −2.56186 | 3.437862 | 11.49787 |
| 0.148714 | −2.10362 | 11.49787 | −2.54416 | 3.403961 | 11.49787 |
| 0.119572 | −2.06212 | 11.49787 | −2.52028 | 3.358788 | 11.49787 |
| 0.085003 | −2.01268 | 11.49787 | −2.4903 | 3.302425 | 11.49787 |
| 0.044506 | −1.95482 | 11.49787 | −2.45098 | 3.229363 | 11.49787 |
| −0.00334 | −1.88643 | 11.49787 | −2.4053 | 3.145195 | 11.49787 |
| −0.05853 | −1.80744 | 11.49787 | −2.35662 | 3.055349 | 11.49787 |
| −0.12082 | −1.71785 | 11.49787 | −2.30193 | 2.95423 | 11.49787 |
| −0.1903 | −1.61748 | 11.49787 | −2.24156 | 2.841756 | 11.49787 |
| −0.2667 | −1.50642 | 11.49787 | −2.17618 | 2.717424 | 11.49787 |
| −0.34995 | −1.38451 | 11.49787 | −2.10863 | 2.587081 | 11.49787 |
| −0.43612 | −1.25684 | 11.49787 | −2.03824 | 2.450976 | 11.49787 |
| −0.5248 | −1.12324 | 11.49787 | −1.96567 | 2.308775 | 11.49787 |
| −0.61548 | −0.98338 | 11.49787 | −1.89102 | 2.160479 | 11.49787 |
| −0.70783 | −0.83709 | 11.49787 | −1.81412 | 2.006171 | 11.49787 |
| −0.8016 | −0.68412 | 11.49787 | −1.73538 | 1.845684 | 11.49787 |
| −0.89637 | −0.5243 | 11.49787 | −1.65464 | 1.679018 | 11.49787 |
| −0.99156 | −0.35738 | 11.49787 | −1.57172 | 1.50634 | 11.49787 |
| −1.08358 | −0.18854 | 11.49787 | −1.48947 | 1.333328 | 11.49787 |
| −1.17217 | −0.01762 | 11.49787 | −1.40789 | 1.160066 | 11.49787 |
| −1.25734 | 0.15531 | 11.49787 | −1.32707 | 0.986386 | 11.49787 |
| −1.33976 | 0.329742 | 11.49787 | −1.24707 | 0.812288 | 11.49787 |
| −1.42042 | 0.505259 | 11.49787 | −1.16783 | 0.637857 | 11.49787 |
| −1.50008 | 0.68111 | 11.49787 | −1.08901 | 0.463175 | 11.49787 |
| −1.57924 | 0.857128 | 11.49787 | −1.0101 | 0.28866 | 11.49787 |
| −1.65781 | 1.033563 | 11.49787 | −0.93011 | 0.114562 | 11.49787 |
| −1.73571 | 1.210166 | 11.49787 | −0.84861 | −0.05878 | 11.49787 |
| −1.81304 | 1.387102 | 11.49787 | −0.76578 | −0.23146 | 11.49787 |
| −1.88986 | 1.564206 | 11.49787 | −0.68161 | −0.40364 | 11.49787 |
| −1.96367 | 1.735631 | 11.49787 | −0.59936 | −0.56947 | 11.49787 |
| −2.03423 | 1.901462 | 11.49787 | −0.51895 | −0.72929 | 11.49787 |
| −2.10161 | 2.061615 | 11.49787 | −0.44055 | −0.88285 | 11.49787 |
| −2.16607 | 2.216007 | 11.49787 | −0.36398 | −1.03031 | 11.49787 |
| −2.22745 | 2.36472 | 11.49787 | −0.28933 | −1.17151 | 11.49787 |
| −2.28573 | 2.507839 | 11.49787 | −0.21685 | −1.30661 | 11.49787 |
| −2.34084 | 2.645197 | 11.49787 | −0.14663 | −1.43578 | 11.49787 |
| −2.39261 | 2.77696 | 11.49787 | −0.08208 | −1.55343 | 11.49787 |
| −2.43837 | 2.897283 | 11.49787 | −0.02338 | −1.65965 | 11.49787 |
| −2.47853 | 3.005917 | 11.49787 | 0.029225 | −1.75475 | 11.49787 |
| −2.51318 | 3.10286 | 11.49787 | 0.075735 | −1.8385 | 11.49787 |
| −2.5445 | 3.194209 | 11.49787 | 0.116065 | −1.91115 | 11.49787 |
| −2.5698 | 3.273952 | 11.49787 | 0.150384 | −1.97252 | 11.49787 |
| −2.58691 | 3.336076 | 11.49787 | 0.179692 | −2.02488 | 11.49787 |
| −2.59802 | 3.386343 | 11.49787 | 0.204408 | −2.06888 | 11.49787 |
| −2.60386 | 3.424502 | 11.49787 | 0.224782 | −2.10512 | 11.49787 |
| −2.60578 | 3.453477 | 11.49787 | 0.241065 | −2.13409 | 11.49787 |
| −2.60487 | 3.469425 | 11.49787 | 0.25359 | −2.1563 | 11.49787 |
| −2.60261 | 3.479529 | 11.49787 | 0.263025 | −2.17309 | 11.49787 |
| −2.60044 | 3.484205 | 11.49787 | 0.26528 | −2.18879 | 11.49787 |
| −2.59885 | 3.486292 | 11.49787 | 0.260103 | −2.20048 | 11.49787 |

TABLE 2

| SUCTION SIDE | | | PRESSURE SIDE | | |
|---|---|---|---|---|---|
| X | Y | Z | X | Y | Z |
| 1.83719 | −1.31725 | −0.60665 | −1.66439 | 1.65104 | −0.60665 |
| 1.83413 | −1.32388 | −0.60665 | −1.66362 | 1.65155 | −0.60665 |
| 1.828435 | −1.3317 | −0.60665 | −1.66192 | 1.652315 | −0.60665 |
| 1.819085 | −1.33926 | −0.60665 | −1.65827 | 1.653335 | −0.60665 |
| 1.8054 | −1.34419 | −0.60665 | −1.65087 | 1.653675 | −0.60665 |
| 1.78619 | −1.34266 | −0.60665 | −1.63948 | 1.65104 | −0.60665 |
| 1.76137 | −1.33688 | −0.60665 | −1.6207 | 1.64186 | −0.60665 |
| 1.730515 | −1.32957 | −0.60665 | −1.59809 | 1.62588 | −0.60665 |
| 1.692945 | −1.32056 | −0.60665 | −1.57012 | 1.60157 | −0.60665 |
| 1.648405 | −1.3096 | −0.60665 | −1.53697 | 1.56927 | −0.60665 |
| 1.596215 | −1.29642 | −0.60665 | −1.49473 | 1.526515 | −0.60665 |
| 1.53476 | −1.28044 | −0.60665 | −1.44628 | 1.47679 | −0.60665 |
| 1.46404 | −1.2614 | −0.60665 | −1.39494 | 1.42358 | −0.60665 |
| 1.38414 | −1.23879 | −0.60665 | −1.33697 | 1.36374 | −0.60665 |
| 1.2954 | −1.21227 | −0.60665 | −1.27237 | 1.297525 | −0.60665 |

TABLE 2-continued

| SUCTION SIDE | | | PRESSURE SIDE | | |
|---|---|---|---|---|---|
| X | Y | Z | X | Y | Z |
| 1.19782 | −1.18133 | −0.60665 | −1.20105 | 1.224935 | −0.60665 |
| 1.091655 | −1.14521 | −0.60665 | −1.12642 | 1.149115 | −0.60665 |
| 0.981835 | −1.105 | −0.60665 | −1.04822 | 1.07032 | −0.60665 |
| 0.868445 | −1.06012 | −0.60665 | −0.96654 | 0.98838 | −0.60665 |
| 0.75157 | −1.01014 | −0.60665 | −0.88145 | 0.903465 | −0.60665 |
| 0.63206 | −0.95472 | −0.60665 | −0.7928 | 0.81549 | −0.60665 |
| 0.510595 | −0.89361 | −0.60665 | −0.70066 | 0.724455 | −0.60665 |
| 0.38743 | −0.82637 | −0.60665 | −0.60495 | 0.630445 | −0.60665 |
| 0.26282 | −0.75251 | −0.60665 | −0.50567 | 0.533545 | −0.60665 |
| 0.1411 | −0.67431 | −0.60665 | −0.40579 | 0.437155 | −0.60665 |
| 0.022185 | −0.59186 | −0.60665 | −0.30524 | 0.341445 | −0.60665 |
| −0.09367 | −0.50482 | −0.60665 | −0.20392 | 0.24667 | −0.60665 |
| −0.20655 | −0.41327 | −0.60665 | −0.10132 | 0.15317 | −0.60665 |
| −0.31646 | −0.31731 | −0.60665 | 0.002465 | 0.061115 | −0.60665 |
| −0.42373 | −0.21752 | −0.60665 | 0.107355 | −0.02975 | −0.60665 |

TABLE 2-continued

| SUCTION SIDE | | | PRESSURE SIDE | | |
|---|---|---|---|---|---|
| X | Y | Z | X | Y | Z |
| −0.52785 | −0.11501 | −0.60665 | 0.21301 | −0.11977 | −0.60665 |
| −0.62892 | −0.01012 | −0.60665 | 0.31909 | −0.20919 | −0.60665 |
| −0.72692 | 0.09707 | −0.60665 | 0.42585 | −0.29776 | −0.60665 |
| −0.82204 | 0.20638 | −0.60665 | 0.53329 | −0.38556 | −0.60665 |
| −0.91443 | 0.317645 | −0.60665 | 0.64158 | −0.47218 | −0.60665 |
| −1.0013 | 0.42721 | −0.60665 | 0.747235 | −0.5548 | −0.60665 |
| −1.08273 | 0.534735 | −0.60665 | 0.85017 | −0.63334 | −0.60665 |
| −1.15898 | 0.640135 | −0.60665 | 0.95047 | −0.7078 | −0.60665 |
| −1.23012 | 0.74324 | −0.60665 | 1.047965 | −0.77826 | −0.60665 |
| −1.29651 | 0.84405 | −0.60665 | 1.142655 | −0.84473 | −0.60665 |
| −1.35805 | 0.94248 | −0.60665 | 1.23437 | −0.90729 | −0.60665 |
| −1.41483 | 1.03836 | −0.60665 | 1.323025 | −0.96603 | −0.60665 |
| −1.46719 | 1.131605 | −0.60665 | 1.40471 | −1.01873 | −0.60665 |
| −1.513 | 1.217625 | −0.60665 | 1.47917 | −1.06556 | −0.60665 |
| −1.55253 | 1.29642 | −0.60665 | 1.54615 | −1.1067 | −0.60665 |
| −1.58644 | 1.367225 | −0.60665 | 1.60565 | −1.14257 | −0.60665 |
| −1.61653 | 1.434375 | −0.60665 | 1.657415 | −1.17326 | −0.60665 |
| −1.64093 | 1.49328 | −0.60665 | 1.70136 | −1.19893 | −0.60665 |
| −1.65835 | 1.53918 | −0.60665 | 1.739015 | −1.22069 | −0.60665 |
| −1.66983 | 1.576665 | −0.60665 | 1.77072 | −1.23888 | −0.60665 |
| −1.67535 | 1.605565 | −0.60665 | 1.7969 | −1.25375 | −0.60665 |
| −1.67586 | 1.62758 | −0.60665 | 1.817895 | −1.26557 | −0.60665 |
| −1.67323 | 1.639565 | −0.60665 | 1.831495 | −1.27772 | −0.60665 |
| −1.66949 | 1.64645 | −0.60665 | 1.837615 | −1.29005 | −0.60665 |
| −1.66685 | 1.64934 | −0.60665 | 1.83957 | −1.30135 | −0.60665 |
| −1.66524 | 1.65053 | −0.60665 | 1.83889 | −1.31053 | −0.60665 |
| 1.84671 | −1.28367 | 0 | −1.68742 | 1.60973 | 0 |
| 1.843565 | −1.29005 | 0 | −1.68666 | 1.61024 | 0 |
| 1.83753 | −1.29753 | 0 | −1.68504 | 1.61109 | 0 |
| 1.82784 | −1.30441 | 0 | −1.68164 | 1.612535 | 0 |
| 1.81407 | −1.30832 | 0 | −1.67425 | 1.61364 | 0 |
| 1.7952 | −1.30577 | 0 | −1.66277 | 1.612365 | 0 |
| 1.770975 | −1.29948 | 0 | −1.64322 | 1.60514 | 0 |
| 1.740715 | −1.29149 | 0 | −1.61942 | 1.59137 | 0 |
| 1.70408 | −1.28155 | 0 | −1.58984 | 1.56944 | 0 |
| 1.660475 | −1.26956 | 0 | −1.55474 | 1.539775 | 0 |
| 1.609475 | −1.2552 | 0 | −1.50994 | 1.500165 | 0 |
| 1.549465 | −1.23769 | 0 | −1.45894 | 1.45384 | 0 |
| 1.48036 | −1.21695 | 0 | −1.40488 | 1.403945 | 0 |
| 1.402415 | −1.19247 | 0 | −1.34402 | 1.34793 | 0 |
| 1.315715 | −1.16391 | 0 | −1.27628 | 1.28571 | 0 |
| 1.22043 | −1.13093 | 0 | −1.20182 | 1.217285 | 0 |
| 1.11673 | −1.09293 | 0 | −1.12404 | 1.14563 | 0 |
| 1.00929 | −1.05111 | 0 | −1.04287 | 1.071 | 0 |
| 0.898365 | −1.00521 | 0 | −0.95821 | 0.993225 | 0 |
| 0.78387 | −0.95472 | 0 | −0.87023 | 0.91239 | 0 |
| 0.66657 | −0.89956 | 0 | −0.77886 | 0.828325 | 0 |
| 0.546805 | −0.83938 | 0 | −0.68417 | 0.7412 | 0 |
| 0.425 | −0.77384 | 0 | −0.58608 | 0.65093 | 0 |
| 0.301325 | −0.70261 | 0 | −0.4845 | 0.5576 | 0 |
| 0.1802 | −0.62773 | 0 | −0.38276 | 0.464525 | 0 |
| 0.061625 | −0.5491 | 0 | −0.2805 | 0.37196 | 0 |
| −0.05423 | −0.4664 | 0 | −0.17782 | 0.27999 | 0 |
| −0.1672 | −0.37953 | 0 | −0.07421 | 0.18887 | 0 |
| −0.27727 | −0.28841 | 0 | 0.03026 | 0.098855 | 0 |
| −0.38488 | −0.19363 | 0 | 0.135405 | 0.00969 | 0 |
| −0.49028 | −0.09571 | 0 | 0.240975 | −0.07905 | 0 |
| −0.59347 | 0.005185 | 0 | 0.346885 | −0.16737 | 0 |
| −0.69411 | 0.108545 | 0 | 0.453135 | −0.25526 | 0 |
| −0.79237 | 0.2142 | 0 | 0.559895 | −0.34255 | 0 |
| −0.88825 | 0.321895 | 0 | 0.667335 | −0.42891 | 0 |
| −0.97886 | 0.427975 | 0 | 0.77197 | −0.51153 | 0 |
| −1.06429 | 0.532185 | 0 | 0.8738 | −0.59024 | 0 |
| −1.1447 | 0.634185 | 0 | 0.972825 | −0.66513 | 0 |
| −1.22001 | 0.733975 | 0 | 1.069045 | −0.7361 | 0 |
| −1.29056 | 0.83147 | 0 | 1.162205 | −0.80325 | 0 |
| −1.35626 | 0.926415 | 0 | 1.25256 | −0.86666 | 0 |
| −1.41712 | 1.018895 | 0 | 1.33977 | −0.92642 | 0 |
| −1.47339 | 1.10857 | 0 | 1.420095 | −0.98005 | 0 |
| −1.52278 | 1.19119 | 0 | 1.49328 | −1.02774 | 0 |
| −1.56519 | 1.266755 | 0 | 1.559155 | −1.06981 | 0 |
| −1.60174 | 1.334585 | 0 | 1.617635 | −1.10645 | 0 |
| −1.63421 | 1.3991 | 0 | 1.668465 | −1.13781 | 0 |
| −1.66056 | 1.455795 | 0 | 1.71173 | −1.16416 | 0 |
| −1.67935 | 1.500165 | 0 | 1.74879 | −1.18643 | 0 |
| −1.69176 | 1.536545 | 0 | 1.779985 | −1.20505 | 0 |

TABLE 2-continued

| SUCTION SIDE | | | PRESSURE SIDE | | |
|---|---|---|---|---|---|
| X | Y | Z | X | Y | Z |
| −1.69771 | 1.564765 | 0 | 1.805655 | −1.22026 | 0 |
| −1.69839 | 1.586355 | 0 | 1.82631 | −1.23242 | 0 |
| −1.69584 | 1.59817 | 0 | 1.840505 | −1.24381 | 0 |
| −1.69227 | 1.60497 | 0 | 1.84722 | −1.25613 | 0 |
| −1.68972 | 1.60786 | 0 | 1.84943 | −1.26761 | 0 |
| −1.68827 | 1.609135 | 0 | 1.848665 | −1.27696 | 0 |
| 1.85164 | −1.26676 | 0.30719 | −1.69949 | 1.59443 | 0.30719 |
| 1.848325 | −1.27313 | 0.30719 | −1.69873 | 1.59494 | 0.30719 |
| 1.842205 | −1.28036 | 0.30719 | −1.69711 | 1.595875 | 0.30719 |
| 1.832345 | −1.28699 | 0.30719 | −1.69371 | 1.597405 | 0.30719 |
| 1.818575 | −1.29047 | 0.30719 | −1.6864 | 1.598765 | 0.30719 |
| 1.79979 | −1.28741 | 0.30719 | −1.67484 | 1.59783 | 0.30719 |
| 1.77582 | −1.2807 | 0.30719 | −1.65521 | 1.5912 | 0.30719 |
| 1.745815 | −1.2722 | 0.30719 | −1.63098 | 1.578195 | 0.30719 |
| 1.709435 | −1.26166 | 0.30719 | −1.60081 | 1.557285 | 0.30719 |
| 1.666255 | −1.24891 | 0.30719 | −1.56485 | 1.528725 | 0.30719 |
| 1.615765 | −1.23378 | 0.30719 | −1.51904 | 1.49056 | 0.30719 |
| 1.55618 | −1.21533 | 0.30719 | −1.46685 | 1.445765 | 0.30719 |
| 1.487755 | −1.19349 | 0.30719 | −1.41151 | 1.397485 | 0.30719 |
| 1.41049 | −1.1679 | 0.30719 | −1.34929 | 1.343085 | 0.30719 |
| 1.324555 | −1.13824 | 0.30719 | −1.28019 | 1.28282 | 0.30719 |
| 1.230035 | −1.10407 | 0.30719 | −1.20428 | 1.216265 | 0.30719 |
| 1.127185 | −1.06497 | 0.30719 | −1.12506 | 1.14648 | 0.30719 |
| 1.02051 | −1.02238 | 0.30719 | −1.04244 | 1.07372 | 0.30719 |
| 0.910265 | −0.97589 | 0.30719 | −0.95642 | 0.99773 | 0.30719 |
| 0.79645 | −0.92514 | 0.30719 | −0.86709 | 0.91868 | 0.30719 |
| 0.67966 | −0.87006 | 0.30719 | −0.77444 | 0.8364 | 0.30719 |
| 0.560235 | −0.81031 | 0.30719 | −0.67856 | 0.750975 | 0.30719 |
| 0.4386 | −0.74554 | 0.30719 | −0.57928 | 0.66232 | 0.30719 |
| 0.314925 | −0.67533 | 0.30719 | −0.47668 | 0.570605 | 0.30719 |
| 0.193545 | −0.60163 | 0.30719 | −0.37392 | 0.47906 | 0.30719 |
| 0.07463 | −0.52437 | 0.30719 | −0.27073 | 0.387855 | 0.30719 |
| −0.04165 | −0.44319 | 0.30719 | −0.16703 | 0.29733 | 0.30719 |
| −0.15504 | −0.35768 | 0.30719 | −0.06265 | 0.207655 | 0.30719 |
| −0.26554 | −0.26801 | 0.30719 | 0.042585 | 0.11883 | 0.30719 |
| −0.37375 | −0.17493 | 0.30719 | 0.14841 | 0.030855 | 0.30719 |
| −0.47983 | −0.07871 | 0.30719 | 0.254235 | −0.05712 | 0.30719 |
| −0.58395 | 0.0204 | 0.30719 | 0.36006 | −0.14518 | 0.30719 |
| −0.68553 | 0.12189 | 0.30719 | 0.46614 | −0.23299 | 0.30719 |
| −0.78464 | 0.225335 | 0.30719 | 0.57256 | −0.32028 | 0.30719 |
| −0.88145 | 0.33065 | 0.30719 | 0.679575 | −0.40681 | 0.30719 |
| −0.97291 | 0.434095 | 0.30719 | 0.7837 | −0.4896 | 0.30719 |
| −1.05927 | 0.535585 | 0.30719 | 0.88502 | −0.56865 | 0.30719 |
| −1.1407 | 0.63495 | 0.30719 | 0.98362 | −0.64379 | 0.30719 |
| −1.2172 | 0.73219 | 0.30719 | 1.079245 | −0.71511 | 0.30719 |
| −1.28894 | 0.827135 | 0.30719 | 1.17198 | −0.78268 | 0.30719 |
| −1.35592 | 0.919785 | 0.30719 | 1.26174 | −0.84652 | 0.30719 |
| −1.41814 | 1.01014 | 0.30719 | 1.348525 | −0.90661 | 0.30719 |
| −1.47594 | 1.09803 | 0.30719 | 1.42834 | −0.96067 | 0.30719 |
| −1.52669 | 1.179205 | 0.30719 | 1.501015 | −1.00887 | 0.30719 |
| −1.57063 | 1.25375 | 0.30719 | 1.566465 | −1.05137 | 0.30719 |
| −1.60854 | 1.320815 | 0.30719 | 1.62452 | −1.08843 | 0.30719 |
| −1.64229 | 1.384735 | 0.30719 | 1.67501 | −1.12022 | 0.30719 |
| −1.66983 | 1.44092 | 0.30719 | 1.717935 | −1.14682 | 0.30719 |
| −1.68938 | 1.48495 | 0.30719 | 1.75474 | −1.16935 | 0.30719 |
| −1.70247 | 1.52116 | 0.30719 | 1.78568 | −1.18822 | 0.30719 |
| −1.70893 | 1.549295 | 0.30719 | 1.811265 | −1.20369 | 0.30719 |
| −1.70995 | 1.570885 | 0.30719 | 1.83175 | −1.21593 | 0.30719 |
| −1.70765 | 1.5827 | 0.30719 | 1.845945 | −1.2274 | 0.30719 |
| −1.70417 | 1.589585 | 0.30719 | 1.85249 | −1.23956 | 0.30719 |
| −1.7017 | 1.592475 | 0.30719 | 1.85453 | −1.25095 | 0.30719 |
| −1.70026 | 1.593835 | 0.30719 | 1.85368 | −1.26013 | 0.30719 |
| 1.85402 | −1.25724 | 0.48433 | −1.70638 | 1.59086 | 0.48433 |
| 1.850705 | −1.26353 | 0.48433 | −1.70561 | 1.59137 | 0.48433 |
| 1.8445 | −1.27075 | 0.48433 | −1.70408 | 1.59239 | 0.48433 |
| 1.834555 | −1.27721 | 0.48433 | −1.70068 | 1.59392 | 0.48433 |
| 1.8207 | −1.28044 | 0.48433 | −1.69337 | 1.59528 | 0.48433 |
| 1.802 | −1.27713 | 0.48433 | −1.68181 | 1.594345 | 0.48433 |
| 1.778115 | −1.27016 | 0.48433 | −1.66209 | 1.587885 | 0.48433 |
| 1.748365 | −1.26132 | 0.48433 | −1.63787 | 1.57505 | 0.48433 |
| 1.712155 | −1.25052 | 0.48433 | −1.60752 | 1.554395 | 0.48433 |
| 1.669145 | −1.23735 | 0.48433 | −1.57131 | 1.526175 | 0.48433 |
| 1.61891 | −1.22179 | 0.48433 | −1.52516 | 1.488435 | 0.48433 |
| 1.559665 | −1.20284 | 0.48433 | −1.47246 | 1.444235 | 0.48433 |
| 1.49158 | −1.1804 | 0.48433 | −1.4167 | 1.396635 | 0.48433 |
| 1.414655 | −1.15422 | 0.48433 | −1.35388 | 1.343 | 0.48433 |

TABLE 2-continued

| SUCTION SIDE | | | PRESSURE SIDE | | |
|---|---|---|---|---|---|
| X | Y | Z | X | Y | Z |
| 1.32906 | −1.12396 | 0.48433 | −1.2841 | 1.283415 | 0.48433 |
| 1.234965 | −1.08928 | 0.48433 | −1.2076 | 1.217625 | 0.48433 |
| 1.13254 | −1.04984 | 0.48433 | −1.1277 | 1.148775 | 0.48433 |
| 1.026205 | −1.00691 | 0.48433 | −1.0444 | 1.07678 | 0.48433 |
| 0.9163 | −0.96033 | 0.48433 | −0.95778 | 1.00164 | 0.48433 |
| 0.80274 | −0.90967 | 0.48433 | −0.86777 | 0.92344 | 0.48433 |
| 0.68612 | −0.85476 | 0.48433 | −0.77444 | 0.84201 | 0.48433 |
| 0.566865 | −0.79535 | 0.48433 | −0.67788 | 0.75735 | 0.48433 |
| 0.445145 | −0.73109 | 0.48433 | −0.578 | 0.66946 | 0.48433 |
| 0.321385 | −0.66147 | 0.48433 | −0.47473 | 0.57851 | 0.48433 |
| 0.199835 | −0.58846 | 0.48433 | −0.37137 | 0.487645 | 0.48433 |
| 0.080665 | −0.51187 | 0.48433 | −0.26767 | 0.397205 | 0.48433 |
| −0.03596 | −0.43138 | 0.48433 | −0.16346 | 0.30736 | 0.48433 |
| −0.1496 | −0.34663 | 0.48433 | −0.05857 | 0.218365 | 0.48433 |
| −0.26053 | −0.25772 | 0.48433 | 0.04709 | 0.13022 | 0.48433 |
| −0.36916 | −0.16533 | 0.48433 | 0.15334 | 0.042755 | 0.48433 |
| −0.47575 | −0.06987 | 0.48433 | 0.259505 | −0.0448 | 0.48433 |
| −0.5803 | 0.02839 | 0.48433 | 0.365415 | −0.13269 | 0.48433 |
| −0.68238 | 0.128945 | 0.48433 | 0.471495 | −0.22032 | 0.48433 |
| −0.782 | 0.23154 | 0.48433 | 0.577915 | −0.30753 | 0.48433 |
| −0.87933 | 0.336005 | 0.48433 | 0.68476 | −0.39423 | 0.48433 |
| −0.97138 | 0.4386 | 0.48433 | 0.7888 | −0.47711 | 0.48433 |
| −1.05834 | 0.53924 | 0.48433 | 0.88995 | −0.55624 | 0.48433 |
| −1.14036 | 0.63784 | 0.48433 | 0.988295 | −0.63155 | 0.48433 |
| −1.21746 | 0.73423 | 0.48433 | 1.08375 | −0.70312 | 0.48433 |
| −1.28979 | 0.82841 | 0.48433 | 1.176315 | −0.77087 | 0.48433 |
| −1.35737 | 0.92038 | 0.48433 | 1.265905 | −0.83487 | 0.48433 |
| −1.42018 | 1.010055 | 0.48433 | 1.35235 | −0.89531 | 0.48433 |
| −1.47858 | 1.097265 | 0.48433 | 1.431995 | −0.94954 | 0.48433 |
| −1.52992 | 1.17793 | 0.48433 | 1.5045 | −0.99799 | 0.48433 |
| −1.57437 | 1.251965 | 0.48433 | 1.56978 | −1.04074 | 0.48433 |
| −1.61279 | 1.318605 | 0.48433 | 1.62758 | −1.07797 | 0.48433 |
| −1.64705 | 1.382015 | 0.48433 | 1.677985 | −1.10993 | 0.48433 |
| −1.67501 | 1.437945 | 0.48433 | 1.72074 | −1.13671 | 0.48433 |
| −1.69499 | 1.481635 | 0.48433 | 1.757375 | −1.15949 | 0.48433 |
| −1.70842 | 1.517675 | 0.48433 | 1.788315 | −1.17844 | 0.48433 |
| −1.71522 | 1.54564 | 0.48433 | 1.81373 | −1.194 | 0.48433 |
| −1.71649 | 1.56723 | 0.48433 | 1.83413 | −1.20641 | 0.48433 |
| −1.71437 | 1.579045 | 0.48433 | 1.84841 | −1.21788 | 0.48433 |
| −1.71105 | 1.58593 | 0.48433 | 1.85504 | −1.23004 | 0.48433 |
| −1.70859 | 1.588905 | 0.48433 | 1.856995 | −1.24134 | 0.48433 |
| −1.70714 | 1.590265 | 0.48433 | 1.856145 | −1.25061 | 0.48433 |
| 1.852235 | −1.24568 | 0.73933 | −1.71496 | 1.5929 | 0.73933 |
| 1.84875 | −1.25188 | 0.73933 | −1.7142 | 1.59341 | 0.73933 |
| 1.84246 | −1.25894 | 0.73933 | −1.71258 | 1.59443 | 0.73933 |
| 1.83243 | −1.26514 | 0.73933 | −1.70927 | 1.59596 | 0.73933 |
| 1.818575 | −1.2682 | 0.73933 | −1.70196 | 1.59732 | 0.73933 |
| 1.79996 | −1.26455 | 0.73933 | −1.6904 | 1.5963 | 0.73933 |
| 1.776245 | −1.25724 | 0.73933 | −1.67076 | 1.58967 | 0.73933 |
| 1.74658 | −1.24814 | 0.73933 | −1.64654 | 1.57675 | 0.73933 |
| 1.710625 | −1.23684 | 0.73933 | −1.61619 | 1.556095 | 0.73933 |
| 1.66787 | −1.22324 | 0.73933 | −1.57998 | 1.52796 | 0.73933 |
| 1.61789 | −1.20709 | 0.73933 | −1.53366 | 1.49039 | 0.73933 |
| 1.558985 | −1.18754 | 0.73933 | −1.4807 | 1.44653 | 0.73933 |
| 1.49124 | −1.1645 | 0.73933 | −1.42452 | 1.399355 | 0.73933 |
| 1.414655 | −1.13773 | 0.73933 | −1.36128 | 1.346315 | 0.73933 |
| 1.329485 | −1.10687 | 0.73933 | −1.29107 | 1.287325 | 0.73933 |
| 1.23573 | −1.07168 | 0.73933 | −1.21397 | 1.2223 | 0.73933 |
| 1.133645 | −1.03182 | 0.73933 | −1.13348 | 1.15413 | 0.73933 |
| 1.02765 | −0.98864 | 0.73933 | −1.04958 | 1.0829 | 0.73933 |
| 0.917915 | −0.94197 | 0.73933 | −0.96229 | 1.008695 | 0.73933 |
| 0.80461 | −0.8914 | 0.73933 | −0.87159 | 0.93126 | 0.73933 |
| 0.68816 | −0.83674 | 0.73933 | −0.77758 | 0.85068 | 0.73933 |
| 0.56899 | −0.77767 | 0.73933 | −0.68034 | 0.76687 | 0.73933 |
| 0.44727 | −0.71375 | 0.73933 | −0.57979 | 0.67983 | 0.73933 |
| 0.323425 | −0.64464 | 0.73933 | −0.47592 | 0.589645 | 0.73933 |
| 0.20179 | −0.57214 | 0.73933 | −0.37196 | 0.499545 | 0.73933 |
| 0.082535 | −0.49606 | 0.73933 | −0.26767 | 0.40987 | 0.73933 |
| −0.03426 | −0.41625 | 0.73933 | −0.16286 | 0.320705 | 0.73933 |
| −0.14824 | −0.33218 | 0.73933 | −0.05746 | 0.232305 | 0.73933 |
| −0.25951 | −0.24395 | 0.73933 | 0.048705 | 0.14484 | 0.73933 |
| −0.36839 | −0.15232 | 0.73933 | 0.155295 | 0.057885 | 0.73933 |
| −0.47532 | −0.05763 | 0.73933 | 0.2618 | −0.02924 | 0.73933 |
| −0.5803 | 0.039865 | 0.73933 | 0.367965 | −0.11671 | 0.73933 |
| −0.68272 | 0.13974 | 0.73933 | 0.474215 | −0.204 | 0.73933 |
| −0.78277 | 0.241655 | 0.73933 | 0.58072 | −0.29113 | 0.73933 |

TABLE 2-continued

| SUCTION SIDE | | | PRESSURE SIDE | | |
|---|---|---|---|---|---|
| X | Y | Z | X | Y | Z |
| −0.88043 | 0.345355 | 0.73933 | 0.687565 | −0.37774 | 0.73933 |
| −0.97274 | 0.447355 | 0.73933 | 0.791435 | −0.4607 | 0.73933 |
| −1.06004 | 0.5474 | 0.73933 | 0.892415 | −0.54001 | 0.73933 |
| −1.1424 | 0.645405 | 0.73933 | 0.99059 | −0.61557 | 0.73933 |
| −1.21984 | 0.7412 | 0.73933 | 1.08579 | −0.6874 | 0.73933 |
| −1.29251 | 0.83487 | 0.73933 | 1.178015 | −0.75548 | 0.73933 |
| −1.36043 | 0.926245 | 0.73933 | 1.267265 | −0.81991 | 0.73933 |
| −1.42358 | 1.01541 | 0.73933 | 1.353455 | −0.88069 | 0.73933 |
| −1.48223 | 1.10211 | 0.73933 | 1.432675 | −0.93543 | 0.73933 |
| −1.534 | 1.182265 | 0.73933 | 1.50484 | −0.98422 | 0.73933 |
| −1.57888 | 1.25579 | 0.73933 | 1.569865 | −1.0274 | 0.73933 |
| −1.61764 | 1.322005 | 0.73933 | 1.62741 | −1.06505 | 0.73933 |
| −1.6524 | 1.385075 | 0.73933 | 1.67756 | −1.09735 | 0.73933 |
| −1.68096 | 1.44058 | 0.73933 | 1.720145 | −1.12447 | 0.73933 |
| −1.70145 | 1.484015 | 0.73933 | 1.75661 | −1.1475 | 0.73933 |
| −1.71539 | 1.5198 | 0.73933 | 1.787295 | −1.16671 | 0.73933 |
| −1.7227 | 1.547595 | 0.73933 | 1.812625 | −1.18244 | 0.73933 |
| −1.72448 | 1.5691 | 0.73933 | 1.83294 | −1.19502 | 0.73933 |
| −1.7227 | 1.580915 | 0.73933 | 1.847135 | −1.20641 | 0.73933 |
| −1.71947 | 1.587885 | 0.73933 | 1.853595 | −1.21856 | 0.73933 |
| −1.71709 | 1.590945 | 0.73933 | 1.855465 | −1.22987 | 0.73933 |
| −1.71573 | 1.592305 | 0.73933 | 1.854445 | −1.23905 | 0.73933 |
| 1.84365 | −1.24058 | 0.91647 | −1.71768 | 1.59681 | 0.91647 |
| 1.840165 | −1.2467 | 0.91647 | −1.71692 | 1.597405 | 0.91647 |
| 1.833705 | −1.25367 | 0.91647 | −1.7153 | 1.598425 | 0.91647 |
| 1.82359 | −1.25979 | 0.91647 | −1.71199 | 1.59987 | 0.91647 |
| 1.80982 | −1.26259 | 0.91647 | −1.70468 | 1.601145 | 0.91647 |
| 1.791205 | −1.25885 | 0.91647 | −1.6932 | 1.60004 | 0.91647 |
| 1.767575 | −1.25146 | 0.91647 | −1.67365 | 1.593325 | 0.91647 |
| 1.73808 | −1.24211 | 0.91647 | −1.64951 | 1.580235 | 0.91647 |
| 1.70221 | −1.23063 | 0.91647 | −1.61925 | 1.559495 | 0.91647 |
| 1.659625 | −1.21678 | 0.91647 | −1.58313 | 1.53136 | 0.91647 |
| 1.609815 | −1.20037 | 0.91647 | −1.53697 | 1.49379 | 0.91647 |
| 1.551165 | −1.18057 | 0.91647 | −1.48402 | 1.450015 | 0.91647 |
| 1.48359 | −1.15728 | 0.91647 | −1.42783 | 1.40301 | 0.91647 |
| 1.40726 | −1.13025 | 0.91647 | −1.36459 | 1.35014 | 0.91647 |
| 1.322345 | −1.09914 | 0.91647 | −1.2943 | 1.291405 | 0.91647 |
| 1.228845 | −1.06378 | 0.91647 | −1.21712 | 1.226635 | 0.91647 |
| 1.12693 | −1.02374 | 0.91647 | −1.13654 | 1.158805 | 0.91647 |
| 1.02119 | −0.98048 | 0.91647 | −1.05256 | 1.088 | 0.91647 |
| 0.911795 | −0.93373 | 0.91647 | −0.96518 | 1.01405 | 0.91647 |
| 0.798745 | −0.88307 | 0.91647 | −0.8744 | 0.93704 | 0.91647 |
| 0.68255 | −0.82833 | 0.91647 | −0.7803 | 0.8568 | 0.91647 |
| 0.563635 | −0.76917 | 0.91647 | −0.68298 | 0.77333 | 0.91647 |
| 0.442255 | −0.70516 | 0.91647 | −0.58234 | 0.686715 | 0.91647 |
| 0.31875 | −0.63589 | 0.91647 | −0.47838 | 0.59687 | 0.91647 |
| 0.197455 | −0.5633 | 0.91647 | −0.37434 | 0.50711 | 0.91647 |
| 0.078455 | −0.48714 | 0.91647 | −0.27005 | 0.417775 | 0.91647 |
| −0.038 | −0.40732 | 0.91647 | −0.16533 | 0.328865 | 0.91647 |
| −0.15173 | −0.32343 | 0.91647 | −0.05993 | 0.240805 | 0.91647 |
| −0.26274 | −0.23554 | 0.91647 | 0.046155 | 0.153425 | 0.91647 |
| −0.37154 | −0.14416 | 0.91647 | 0.152575 | 0.06664 | 0.91647 |
| −0.47821 | −0.04973 | 0.91647 | 0.25891 | −0.02032 | 0.91647 |
| −0.58302 | 0.0476 | 0.91647 | 0.365075 | −0.10753 | 0.91647 |
| −0.68527 | 0.147305 | 0.91647 | 0.471325 | −0.19465 | 0.91647 |
| −0.78515 | 0.24905 | 0.91647 | 0.57766 | −0.28152 | 0.91647 |
| −0.88264 | 0.35258 | 0.91647 | 0.68442 | −0.36805 | 0.91647 |
| −0.97478 | 0.45441 | 0.91647 | 0.78812 | −0.45093 | 0.91647 |
| −1.06191 | 0.554285 | 0.91647 | 0.888845 | −0.53032 | 0.91647 |
| −1.1441 | 0.652035 | 0.91647 | 0.986595 | −0.60605 | 0.91647 |
| −1.22137 | 0.74766 | 0.91647 | 1.081455 | −0.67805 | 0.91647 |
| −1.29379 | 0.84116 | 0.91647 | 1.173255 | −0.74639 | 0.91647 |
| −1.36162 | 0.93228 | 0.91647 | 1.261995 | −0.81116 | 0.91647 |
| −1.42469 | 1.021275 | 0.91647 | 1.34776 | −0.87236 | 0.91647 |
| −1.48325 | 1.107635 | 0.91647 | 1.426555 | −0.92744 | 0.91647 |
| −1.53493 | 1.187535 | 0.91647 | 1.498295 | −0.97674 | 0.91647 |
| −1.57981 | 1.260805 | 0.91647 | 1.562895 | −1.02026 | 0.91647 |
| −1.61857 | 1.326765 | 0.91647 | 1.6201 | −1.05825 | 0.91647 |
| −1.65351 | 1.389665 | 0.91647 | 1.66991 | −1.09089 | 0.91647 |
| −1.68224 | 1.445 | 0.91647 | 1.71224 | −1.11826 | 0.91647 |
| −1.70298 | 1.48818 | 0.91647 | 1.74845 | −1.14155 | 0.91647 |
| −1.71717 | 1.523795 | 0.91647 | 1.778965 | −1.16093 | 0.91647 |
| −1.72474 | 1.551505 | 0.91647 | 1.804125 | −1.17691 | 0.91647 |
| −1.72686 | 1.57301 | 0.91647 | 1.82427 | −1.18958 | 0.91647 |
| −1.72525 | 1.584825 | 0.91647 | 1.83855 | −1.20088 | 0.91647 |
| −1.72219 | 1.59188 | 0.91647 | 1.84518 | −1.21321 | 0.91647 |

TABLE 2-continued

| SUCTION SIDE | | | PRESSURE SIDE | | |
|---|---|---|---|---|---|
| X | Y | Z | X | Y | Z |
| −1.71981 | 1.594855 | 0.91647 | 1.84705 | −1.22468 | 0.91647 |
| −1.71845 | 1.596215 | 0.91647 | 1.845945 | −1.23395 | 0.91647 |
| 1.813985 | −1.24109 | 1.22111 | −1.71199 | 1.60378 | 1.22111 |
| 1.81033 | −1.24712 | 1.22111 | −1.71122 | 1.604375 | 1.22111 |
| 1.80387 | −1.25392 | 1.22111 | −1.70961 | 1.60531 | 1.22111 |
| 1.793755 | −1.25979 | 1.22111 | −1.70629 | 1.60684 | 1.22111 |
| 1.7799 | −1.26242 | 1.22111 | −1.69898 | 1.60803 | 1.22111 |
| 1.76154 | −1.25851 | 1.22111 | −1.68759 | 1.606755 | 1.22111 |
| 1.738165 | −1.25086 | 1.22111 | −1.66821 | 1.599955 | 1.22111 |
| 1.708925 | −1.24126 | 1.22111 | −1.64424 | 1.58678 | 1.22111 |
| 1.673395 | −1.22953 | 1.22111 | −1.61424 | 1.56604 | 1.22111 |
| 1.63115 | −1.21533 | 1.22111 | −1.57837 | 1.53799 | 1.22111 |
| 1.58185 | −1.1985 | 1.22111 | −1.53247 | 1.500505 | 1.22111 |
| 1.523625 | −1.17827 | 1.22111 | −1.47985 | 1.4569 | 1.22111 |
| 1.45673 | −1.15447 | 1.22111 | −1.42401 | 1.41015 | 1.22111 |
| 1.38108 | −1.12693 | 1.22111 | −1.36111 | 1.357535 | 1.22111 |
| 1.296845 | −1.0954 | 1.22111 | −1.29124 | 1.299055 | 1.22111 |
| 1.204195 | −1.05953 | 1.22111 | −1.21448 | 1.234625 | 1.22111 |
| 1.103215 | −1.0189 | 1.22111 | −1.13433 | 1.167135 | 1.22111 |
| 0.99841 | −0.97504 | 1.22111 | −1.05077 | 1.096585 | 1.22111 |
| 0.890035 | −0.92761 | 1.22111 | −0.96382 | 1.022975 | 1.22111 |
| 0.77809 | −0.87618 | 1.22111 | −0.87363 | 0.94622 | 1.22111 |
| 0.663085 | −0.82059 | 1.22111 | −0.78013 | 0.86632 | 1.22111 |
| 0.545445 | −0.76058 | 1.22111 | −0.6834 | 0.78319 | 1.22111 |
| 0.425425 | −0.69573 | 1.22111 | −0.58344 | 0.69683 | 1.22111 |
| 0.30328 | −0.6256 | 1.22111 | −0.48017 | 0.607325 | 1.22111 |
| 0.18343 | −0.55216 | 1.22111 | −0.37681 | 0.517905 | 1.22111 |
| 0.065875 | −0.47541 | 1.22111 | −0.27328 | 0.428655 | 1.22111 |
| −0.0493 | −0.39508 | 1.22111 | −0.16941 | 0.33983 | 1.22111 |
| −0.16176 | −0.31093 | 1.22111 | −0.06486 | 0.25177 | 1.22111 |
| −0.27175 | −0.22296 | 1.22111 | 0.040205 | 0.16439 | 1.22111 |
| −0.37927 | −0.1315 | 1.22111 | 0.145605 | 0.07735 | 1.22111 |
| −0.48476 | −0.03706 | 1.22111 | 0.251005 | −0.00961 | 1.22111 |
| −0.58837 | 0.06018 | 1.22111 | 0.35632 | −0.09673 | 1.22111 |
| −0.68961 | 0.1598 | 1.22111 | 0.461635 | −0.18377 | 1.22111 |
| −0.78838 | 0.261375 | 1.22111 | 0.567205 | −0.27056 | 1.22111 |
| −0.88485 | 0.36482 | 1.22111 | 0.67303 | −0.35709 | 1.22111 |
| −0.97597 | 0.466395 | 1.22111 | 0.775795 | −0.44013 | 1.22111 |
| −1.06216 | 0.566015 | 1.22111 | 0.875415 | −0.51978 | 1.22111 |
| −1.14342 | 0.663595 | 1.22111 | 0.971975 | −0.59594 | 1.22111 |
| −1.21975 | 0.758965 | 1.22111 | 1.06556 | −0.66853 | 1.22111 |
| −1.29149 | 0.85204 | 1.22111 | 1.156085 | −0.73763 | 1.22111 |
| −1.35856 | 0.942905 | 1.22111 | 1.24355 | −0.80325 | 1.22111 |
| −1.42095 | 1.03139 | 1.22111 | 1.32787 | −0.86547 | 1.22111 |
| −1.47892 | 1.11741 | 1.22111 | 1.40539 | −0.92157 | 1.22111 |
| −1.53009 | 1.1968 | 1.22111 | 1.475855 | −0.97181 | 1.22111 |
| −1.57454 | 1.269645 | 1.22111 | 1.539265 | −1.01626 | 1.22111 |
| −1.61288 | 1.33518 | 1.22111 | 1.59545 | −1.05519 | 1.22111 |
| −1.64756 | 1.39774 | 1.22111 | 1.644325 | −1.08868 | 1.22111 |
| −1.6762 | 1.452735 | 1.22111 | 1.685805 | −1.11682 | 1.22111 |
| −1.69686 | 1.495745 | 1.22111 | 1.721335 | −1.1407 | 1.22111 |
| −1.71097 | 1.53119 | 1.22111 | 1.75134 | −1.16068 | 1.22111 |
| −1.71862 | 1.55873 | 1.22111 | 1.77599 | −1.177 | 1.22111 |
| −1.72083 | 1.57998 | 1.22111 | 1.795795 | −1.19009 | 1.22111 |
| −1.71938 | 1.591795 | 1.22111 | 1.80982 | −1.20165 | 1.22111 |
| −1.71641 | 1.59885 | 1.22111 | 1.816195 | −1.21397 | 1.22111 |
| −1.71411 | 1.601825 | 1.22111 | 1.81781 | −1.22536 | 1.22111 |
| −1.71267 | 1.603185 | 1.22111 | 1.81645 | −1.23454 | 1.22111 |
| 1.78262 | −1.25647 | 1.525665 | −1.69643 | 1.61143 | 1.525665 |
| 1.77888 | −1.26242 | 1.525665 | −1.69567 | 1.61194 | 1.525665 |
| 1.77225 | −1.26905 | 1.525665 | −1.69414 | 1.61296 | 1.525665 |
| 1.762135 | −1.27475 | 1.525665 | −1.69074 | 1.614405 | 1.525665 |
| 1.748365 | −1.27704 | 1.525665 | −1.68351 | 1.615595 | 1.525665 |
| 1.730175 | −1.27271 | 1.525665 | −1.67221 | 1.61432 | 1.525665 |
| 1.707055 | −1.2648 | 1.525665 | −1.65291 | 1.60735 | 1.525665 |
| 1.67807 | −1.25477 | 1.525665 | −1.62911 | 1.59426 | 1.525665 |
| 1.642965 | −1.24253 | 1.525665 | −1.59928 | 1.573605 | 1.525665 |
| 1.60123 | −1.22774 | 1.525665 | −1.56358 | 1.54564 | 1.525665 |
| 1.552525 | −1.21023 | 1.525665 | −1.51802 | 1.508325 | 1.525665 |
| 1.495065 | −1.18924 | 1.525665 | −1.46574 | 1.464805 | 1.525665 |
| 1.42885 | −1.16459 | 1.525665 | −1.41015 | 1.41814 | 1.525665 |
| 1.354135 | −1.13603 | 1.525665 | −1.34776 | 1.36561 | 1.525665 |
| 1.27092 | −1.10339 | 1.525665 | −1.2784 | 1.307215 | 1.525665 |
| 1.17929 | −1.06633 | 1.525665 | −1.20224 | 1.242785 | 1.525665 |
| 1.079585 | −1.02451 | 1.525665 | −1.12277 | 1.175295 | 1.525665 |
| 0.97614 | −0.97929 | 1.525665 | −1.03998 | 1.104745 | 1.525665 |

TABLE 2-continued

| SUCTION SIDE | | | PRESSURE SIDE | | |
|---|---|---|---|---|---|
| X | Y | Z | X | Y | Z |
| 0.86904 | −0.93058 | 1.525665 | −0.95387 | 1.030965 | 1.525665 |
| 0.75854 | −0.87788 | 1.525665 | −0.86454 | 0.954125 | 1.525665 |
| 0.64498 | −0.8211 | 1.525665 | −0.77197 | 0.87397 | 1.525665 |
| 0.52887 | −0.75982 | 1.525665 | −0.67262 | 0.79067 | 1.525665 |
| 0.410465 | −0.69377 | 1.525665 | −0.57732 | 0.704055 | 1.525665 |
| 0.289935 | −0.62246 | 1.525665 | −0.47515 | 0.614295 | 1.525665 |
| 0.1717 | −0.54808 | 1.525665 | −0.37298 | 0.524535 | 1.525665 |
| 0.055675 | −0.47039 | 1.525665 | −0.27064 | 0.434945 | 1.525665 |
| −0.05797 | −0.38913 | 1.525665 | −0.16796 | 0.34578 | 1.525665 |
| −0.16898 | −0.30422 | 1.525665 | −0.06486 | 0.257125 | 1.525665 |
| −0.27736 | −0.21548 | 1.525665 | 0.03893 | 0.16915 | 1.525665 |
| −0.38335 | −0.12334 | 1.525665 | 0.142885 | 0.081515 | 1.525665 |
| −0.48739 | −0.02831 | 1.525665 | 0.24684 | −0.00621 | 1.525665 |
| −0.58948 | 0.06936 | 1.525665 | 0.35071 | −0.09401 | 1.525665 |
| −0.68918 | 0.169235 | 1.525665 | 0.45458 | −0.18182 | 1.525665 |
| −0.78651 | 0.27098 | 1.525665 | 0.558535 | −0.26945 | 1.525665 |
| −0.88162 | 0.374425 | 1.525665 | 0.662745 | −0.35683 | 1.525665 |
| −0.97155 | 0.476085 | 1.525665 | 0.763895 | −0.44081 | 1.525665 |
| −1.05647 | 0.575705 | 1.525665 | 0.861985 | −0.52139 | 1.525665 |
| −1.13662 | 0.6732 | 1.525665 | 0.957015 | −0.59857 | 1.525665 |
| −1.21193 | 0.768485 | 1.525665 | 1.048985 | −0.67227 | 1.525665 |
| −1.28265 | 0.861475 | 1.525665 | 1.13798 | −0.74248 | 1.525665 |
| −1.34887 | 0.95217 | 1.525665 | 1.223915 | −0.8092 | 1.525665 |
| −1.41041 | 1.040485 | 1.525665 | 1.306705 | −0.87261 | 1.525665 |
| −1.46761 | 1.126335 | 1.525665 | 1.382695 | −0.9299 | 1.525665 |
| −1.5181 | 1.205555 | 1.525665 | 1.451885 | −0.98124 | 1.525665 |
| −1.56188 | 1.27823 | 1.525665 | 1.51402 | −1.02689 | 1.525665 |
| −1.5997 | 1.343595 | 1.525665 | 1.5691 | −1.06675 | 1.525665 |
| −1.63379 | 1.405985 | 1.525665 | 1.616955 | −1.10109 | 1.525665 |
| −1.66184 | 1.460895 | 1.525665 | 1.65767 | −1.12999 | 1.525665 |
| −1.68207 | 1.50382 | 1.525665 | 1.69152 | −1.15456 | 1.525665 |
| −1.69584 | 1.53918 | 1.525665 | 1.721845 | −1.17513 | 1.525665 |
| −1.70323 | 1.566635 | 1.525665 | 1.745985 | −1.19196 | 1.525665 |
| −1.70536 | 1.5878 | 1.525665 | 1.765365 | −1.20539 | 1.525665 |
| −1.70383 | 1.59953 | 1.525665 | 1.779135 | −1.21712 | 1.525665 |
| −1.70085 | 1.6065 | 1.525665 | 1.785255 | −1.22953 | 1.525665 |
| −1.69856 | 1.609475 | 1.525665 | 1.786615 | −1.24092 | 1.525665 |
| −1.6972 | 1.610835 | 1.525665 | 1.78517 | −1.25001 | 1.525665 |
| 1.75338 | −1.28376 | 1.830305 | −1.67739 | 1.6218 | 1.830305 |
| 1.749555 | −1.28954 | 1.830305 | −1.67663 | 1.622395 | 1.830305 |
| 1.74284 | −1.296 | 1.830305 | −1.6751 | 1.62333 | 1.830305 |
| 1.732555 | −1.30144 | 1.830305 | −1.6717 | 1.624775 | 1.830305 |
| 1.718785 | −1.30331 | 1.830305 | −1.66447 | 1.62588 | 1.830305 |
| 1.70085 | −1.29855 | 1.830305 | −1.65317 | 1.62452 | 1.830305 |
| 1.677985 | −1.29013 | 1.830305 | −1.63396 | 1.617465 | 1.830305 |
| 1.649425 | −1.27951 | 1.830305 | −1.61033 | 1.60429 | 1.830305 |
| 1.614745 | −1.26659 | 1.830305 | −1.58058 | 1.58355 | 1.830305 |
| 1.57352 | −1.25095 | 1.830305 | −1.54513 | 1.555585 | 1.830305 |
| 1.525325 | −1.2325 | 1.830305 | −1.49974 | 1.518185 | 1.830305 |
| 1.468545 | −1.2104 | 1.830305 | −1.44781 | 1.474665 | 1.830305 |
| 1.40318 | −1.18448 | 1.830305 | −1.39264 | 1.42783 | 1.830305 |
| 1.3294 | −1.15456 | 1.830305 | −1.33068 | 1.37513 | 1.830305 |
| 1.247205 | −1.1203 | 1.830305 | −1.26183 | 1.316565 | 1.830305 |
| 1.15685 | −1.08163 | 1.830305 | −1.18626 | 1.25188 | 1.830305 |
| 1.058335 | −1.03802 | 1.830305 | −1.10747 | 1.18405 | 1.830305 |
| 0.956165 | −0.9911 | 1.830305 | −1.02544 | 1.113075 | 1.830305 |
| 0.85051 | −0.94061 | 1.830305 | −0.94019 | 1.03887 | 1.830305 |
| 0.74137 | −0.88621 | 1.830305 | −0.85179 | 0.961435 | 1.830305 |
| 0.62934 | −0.82782 | 1.830305 | −0.76016 | 0.88077 | 1.830305 |
| 0.51476 | −0.76492 | 1.830305 | −0.66555 | 0.796705 | 1.830305 |
| 0.3978 | −0.69734 | 1.830305 | −0.56772 | 0.709495 | 1.830305 |
| 0.2788 | −0.62467 | 1.830305 | −0.46674 | 0.61897 | 1.830305 |
| 0.16201 | −0.54885 | 1.830305 | −0.36567 | 0.528445 | 1.830305 |
| 0.047515 | −0.4698 | 1.830305 | −0.26461 | 0.43809 | 1.830305 |
| −0.0646 | −0.38735 | 1.830305 | −0.1632 | 0.34799 | 1.830305 |
| −0.174 | −0.30116 | 1.830305 | −0.06137 | 0.258485 | 1.830305 |
| −0.28076 | −0.21114 | 1.830305 | 0.04097 | 0.16949 | 1.830305 |
| −0.38522 | −0.11798 | 1.830305 | 0.14365 | 0.080835 | 1.830305 |
| −0.48773 | −0.02202 | 1.830305 | 0.246075 | −0.00799 | 1.830305 |
| −0.58829 | 0.0765 | 1.830305 | 0.34816 | −0.09724 | 1.830305 |
| −0.68646 | 0.176885 | 1.830305 | 0.450245 | −0.18649 | 1.830305 |
| −0.78234 | 0.27914 | 1.830305 | 0.55233 | −0.27574 | 1.830305 |
| −0.87601 | 0.383095 | 1.830305 | 0.65467 | −0.36474 | 1.830305 |
| −0.96458 | 0.48518 | 1.830305 | 0.75395 | −0.45042 | 1.830305 |
| −1.04831 | 0.58514 | 1.830305 | 0.85017 | −0.53261 | 1.830305 |
| −1.12719 | 0.68289 | 1.830305 | 0.943415 | −0.61141 | 1.830305 |

TABLE 2-continued

| SUCTION SIDE | | | PRESSURE SIDE | | |
|---|---|---|---|---|---|
| X | Y | Z | X | Y | Z |
| −1.20139 | 0.77843 | 1.830305 | 1.033685 | −0.68663 | 1.830305 |
| −1.27109 | 0.87159 | 1.830305 | 1.12098 | −0.75837 | 1.830305 |
| −1.33629 | 0.962455 | 1.830305 | 1.2053 | −0.82663 | 1.830305 |
| −1.39698 | 1.050855 | 1.830305 | 1.286645 | −0.8914 | 1.830305 |
| −1.45333 | 1.136705 | 1.830305 | 1.361275 | −0.95013 | 1.830305 |
| −1.50297 | 1.216095 | 1.830305 | 1.42919 | −1.00266 | 1.830305 |
| −1.54607 | 1.288685 | 1.830305 | 1.49022 | −1.04941 | 1.830305 |
| −1.58321 | 1.354135 | 1.830305 | 1.54428 | −1.0903 | 1.830305 |
| −1.61662 | 1.41661 | 1.830305 | 1.59137 | −1.12557 | 1.830305 |
| −1.64416 | 1.47152 | 1.830305 | 1.631235 | −1.15515 | 1.830305 |
| −1.66379 | 1.514445 | 1.830305 | 1.66549 | −1.1804 | 1.830305 |
| −1.67722 | 1.549805 | 1.830305 | 1.694305 | −1.20148 | 1.830305 |
| −1.68436 | 1.577175 | 1.830305 | 1.71802. | −1.21882 | 1.830305 |
| −1.68632 | 1.598255 | 1.830305 | 1.73706 | −1.23259 | 1.830305 |
| −1.68479 | 1.609985 | 1.830305 | 1.750575 | −1.24449 | 1.830305 |
| −1.68181 | 1.61687 | 1.830305 | 1.75661 | −1.2569 | 1.830305 |
| −1.67952 | 1.61993 | 1.830305 | 1.757715 | −1.26829 | 1.830305 |
| −1.67807 | 1.621205 | 1.830305 | 1.7561 | −1.27738 | 1.830305 |
| 1.681385 | −1.34564 | 2.4395 | −1.64178 | 1.651975 | 2.4395 |
| 1.677305 | −1.35125 | 2.4395 | −1.64101 | 1.652485 | 2.4395 |
| 1.670335 | −1.3572 | 2.4395 | −1.63948 | 1.65342 | 2.4395 |
| 1.65988 | −1.36196 | 2.4395 | −1.63608 | 1.65478 | 2.4395 |
| 1.64611 | −1.36298 | 2.4395 | −1.62886 | 1.65563 | 2.4395 |
| 1.628685 | −1.35711 | 2.4395 | −1.61764 | 1.653845 | 2.4395 |
| 1.606415 | −1.34768 | 2.4395 | −1.59877 | 1.64628 | 2.4395 |
| 1.57862 | −1.33586 | 2.4395 | −1.57556 | 1.63251 | 2.4395 |
| 1.544875 | −1.32141 | 2.4395 | −1.54641 | 1.61126 | 2.4395 |
| 1.50484 | −1.30407 | 2.4395 | −1.51156 | 1.58287 | 2.4395 |
| 1.45809 | −1.28359 | 2.4395 | −1.46702 | 1.54496 | 2.4395 |
| 1.402925 | −1.25911 | 2.4395 | −1.41602 | 1.50076 | 2.4395 |
| 1.33943 | −1.23046 | 2.4395 | −1.36179 | 1.45333 | 2.4395 |
| 1.267775 | −1.1974 | 2.4395 | −1.30093 | 1.39995 | 2.4395 |
| 1.18796 | −1.15983 | 2.4395 | −1.23327 | 1.340535 | 2.4395 |
| 1.10024 | −1.1175 | 2.4395 | −1.15915 | 1.275 | 2.4395 |
| 1.004615 | −1.06998 | 2.4395 | −1.0818 | 1.206235 | 2.4395 |
| 0.90559 | −1.01915 | 2.4395 | −1.00139 | 1.134155 | 2.4395 |
| 0.80308 | −0.96475 | 2.4395 | −0.91783 | 1.05876 | 2.4395 |
| 0.69734 | −0.90653 | 2.4395 | −0.8313 | 0.98005 | 2.4395 |
| 0.588795 | −0.84422 | 2.4395 | −0.7418 | 0.89794 | 2.4395 |
| 0.4777 | −0.77758 | 2.4395 | −0.64932 | 0.812345 | 2.4395 |
| 0.364395 | −0.70627 | 2.4395 | −0.55386 | 0.723435 | 2.4395 |
| 0.249135 | −0.62985 | 2.4395 | −0.45526 | 0.631125 | 2.4395 |
| 0.136085 | −0.55063 | 2.4395 | −0.35683 | 0.538815 | 2.4395 |
| 0.025245 | −0.46835 | 2.4395 | −0.25832 | 0.44642 | 2.4395 |
| −0.08322 | −0.38293 | 2.4395 | −0.15972 | 0.35428 | 2.4395 |
| −0.18896 | −0.29385 | 2.4395 | −0.06069 | 0.262565 | 2.4395 |
| −0.29206 | −0.20128 | 2.4395 | 0.038675 | 0.17119 | 2.4395 |
| −0.39296 | −0.10574 | 2.4395 | 0.13821 | 0.08007 | 2.4395 |
| −0.49198 | −0.00774 | 2.4395 | 0.237405 | −0.01156 | 2.4395 |
| −0.58905 | 0.09248 | 2.4395 | 0.336005 | −0.10379 | 2.4395 |
| −0.68391 | 0.194565 | 2.4395 | 0.434265 | −0.19627 | 2.4395 |
| −0.77673 | 0.298605 | 2.4395 | 0.53244 | −0.28892 | 2.4395 |
| −0.8676 | 0.404345 | 2.4395 | 0.6307 | −0.38157 | 2.4395 |
| −0.95362 | 0.508215 | 2.4395 | 0.725815 | −0.47082 | 2.4395 |
| −1.03488 | 0.60996 | 2.4395 | 0.817955 | −0.55675 | 2.4395 |
| −1.11155 | 0.709325 | 2.4395 | 0.90712 | −0.6392 | 2.4395 |
| −1.18363 | 0.806395 | 2.4395 | 0.99348 | −0.71808 | 2.4395 |
| −1.25129 | 0.900915 | 2.4395 | 1.077035 | −0.79348 | 2.4395 |
| −1.31444 | 0.99297 | 2.4395 | 1.1577 | −0.8653 | 2.4395 |
| −1.37326 | 1.082305 | 2.4395 | 1.23539 | −0.93356 | 2.4395 |
| −1.42775 | 1.16892 | 2.4395 | 1.306875 | −0.99544 | 2.4395 |
| −1.47552 | 1.248735 | 2.4395 | 1.371815 | −1.05103 | 2.4395 |
| −1.51691 | 1.321495 | 2.4395 | 1.430295 | −1.10033 | 2.4395 |
| −1.55253 | 1.38686 | 2.4395 | 1.48206 | −1.14359 | 2.4395 |
| −1.5844 | 1.44891 | 2.4395 | 1.52711 | −1.18091 | 2.4395 |
| −1.61058 | 1.503395 | 2.4395 | 1.56536 | −1.21227 | 2.4395 |
| −1.62928 | 1.54598 | 2.4395 | 1.59817 | −1.23905 | 2.4395 |
| −1.64195 | 1.581 | 2.4395 | 1.625795 | −1.2614 | 2.4395 |
| −1.64875 | 1.60803 | 2.4395 | 1.648575 | −1.27976 | 2.4395 |
| −1.65062 | 1.62877 | 2.4395 | 1.66685 | −1.29418 | 2.4395 |
| −1.64909 | 1.64033 | 2.4395 | 1.67994 | −1.30662 | 2.4395 |
| −1.6462 | 1.647215 | 2.4395 | 1.685635 | −1.31912 | 2.4395 |
| −1.6439 | 1.650105 | 2.4395 | 1.6864 | −1.33051 | 2.4395 |
| −1.64254 | 1.65138 | 2.4395 | 1.68436 | −1.33943 | 2.4395 |
| 1.595195 | −1.39494 | 3.04878 | −1.61152 | 1.688525 | 3.04878 |
| 1.59086 | −1.40029 | 3.04878 | −1.61075 | 1.689035 | 3.04878 |

TABLE 2-continued

| SUCTION SIDE | | | PRESSURE SIDE | | |
|---|---|---|---|---|---|
| X | Y | Z | X | Y | Z |
| 1.583635 | −1.4059 | 3.04878 | −1.60922 | 1.68997 | 3.04878 |
| 1.57301 | −1.40998 | 3.04878 | −1.60574 | 1.691075 | 3.04878 |
| 1.559325 | −1.41007 | 3.04878 | −1.59851 | 1.6915 | 3.04878 |
| 1.54224 | −1.40327 | 3.04878 | −1.58755 | 1.6891.2 | 3.04878 |
| 1.520565 | −1.39307 | 3.04878 | −1.56919 | 1.68079 | 3.04878 |
| 1.49345 | −1.38032 | 3.04878 | −1.54658 | 1.666255 | 3.04878 |
| 1.46047 | −1.36459 | 3.04878 | −1.51827 | 1.64424 | 3.04878 |
| 1.42137 | −1.34581 | 3.04878 | −1.48444 | 1.615085 | 3.04878 |
| 1.375725 | −1.32362 | 3.04878 | −1.44118 | 1.57624 | 3.04878 |
| 1.32192 | −1.2971 | 3.04878 | −1.39145 | 1.53119 | 3.04878 |
| 1.259955 | −1.26616 | 3.04878 | −1.3385 | 1.482995 | 3.04878 |
| 1.190085 | −1.23055 | 3.04878 | −1.279 | 1.428765 | 3.04878 |
| 1.112395 | −1.19009 | 3.04878 | −1.21295 | 1.3685 | 3.04878 |
| 1.026885 | −1.14453 | 3.04878 | −1.14045 | 1.30203 | 3.04878 |
| 0.933895 | −1.09344 | 3.04878 | −1.0648 | 1.232245 | 3.04878 |
| 0.83759 | −1.03896 | 3.04878 | −0.98626 | 1.159145 | 3.04878 |
| 0.73797 | −0.98073 | 3.04878 | −0.90466 | 1.082645 | 3.04878 |
| 0.63546 | −0.91843 | 3.04878 | −0.82025 | 1.002745 | 3.04878 |
| 0.530315 | −0.85204 | 3.04878 | −0.73296 | 0.919275 | 3.04878 |
| 0.423045 | −0.78132 | 3.04878 | −0.64277 | 0.832405 | 3.04878 |
| 0.313735 | −0.70584 | 3.04878 | −0.5497 | 0.74205 | 3.04878 |
| 0.202725 | −0.62535 | 3.04878 | −0.45382 | 0.64891 | 3.04878 |
| 0.09401 | −0.54222 | 3.04878 | −0.35811 | 0.554115 | 3.04878 |
| −0.01241 | −0.45637 | 3.04878 | −0.26257 | 0.46002 | 3.04878 |
| −0.11628 | −0.36771 | 3.04878 | −0.16694 | 0.36584 | 3.04878 |
| −0.2176 | −0.27591 | 3.04878 | −0.07123 | 0.27183 | 3.04878 |
| −0.31637 | −0.18105 | 3.04878 | 0.024735 | 0.178075 | 3.04878 |
| −0.41285 | −0.08373 | 3.04878 | 0.120785 | 0.084405 | 3.04878 |
| −0.50745 | 0.015895 | 3.04878 | 0.216495 | −0.00969 | 3.04878 |
| −0.60027 | 0.11764 | 3.04878 | 0.31161 | −0.1043 | 3.04878 |
| −0.69131 | 0.22151 | 3.04878 | 0.406385 | −0.19924 | 3.04878 |
| −0.78056 | 0.327165 | 3.04878 | 0.500905 | −0.29444 | 3.04878 |
| −0.86785 | 0.43452 | 3.04878 | 0.59534 | −0.38981 | 3.04878 |
| −0.9503 | 0.53975 | 3.04878 | 0.68663 | −0.48195 | 3.04878 |
| −1.02825 | 0.642685 | 3.04878 | 0.77486 | −0.57078 | 3.04878 |
| −1.10169 | 0.74324 | 3.04878 | 0.8602 | −0.6562 | 3.04878 |
| −1.17079 | 0.841245 | 3.04878 | 0.94265 | −0.73814 | 3.04878 |
| −1.23548 | 0.9367 | 3.04878 | 1.022295 | −0.81668 | 3.04878 |
| −1.29608 | 1.02935 | 3.04878 | 1.09905 | −0.89165 | 3.04878 |
| −1.35244 | 1.119195 | 3.04878 | 1.173 | −0.96322 | 3.04878 |
| −1.40463 | 1.206235 | 3.04878 | 1.24083 | −1.02808 | 3.04878 |
| −1.45053 | 1.286305 | 3.04878 | 1.30254 | −1.08647 | 3.04878 |
| −1.49031 | 1.35915 | 3.04878 | 1.358045 | −1.13849 | 3.04878 |
| −1.52456 | 1.4246 | 3.04878 | 1.407175 | −1.18414 | 3.04878 |
| −1.55525 | 1.486565 | 3.04878 | 1.450015 | −1.22349 | 3.04878 |
| −1.58066 | 1.54088 | 3.04878 | 1.48631 | −1.25673 | 3.04878 |
| −1.59885 | 1.583295 | 3.04878 | 1.51742 | −1.28495 | 3.04878 |
| −1.61118 | 1.61806 | 3.04878 | 1.5436 | −1.30866 | 3.04878 |
| −1.61798 | 1.64492 | 3.04878 | 1.565275 | −1.32813 | 3.04878 |
| −1.62002 | 1.665575 | 3.04878 | 1.58253 | −1.3436 | 3.04878 |
| −1.61866 | 1.676965 | 3.04878 | 1.59511 | −1.35626 | 3.04878 |
| −1.61594 | 1.683765 | 3.04878 | 1.60038 | −1.36884 | 3.04878 |
| −1.61364 | 1.68674 | 3.04878 | 1.60072 | −1.38015 | 3.04878 |
| −1.61228 | 1.688015 | 3.04878 | 1.598425 | −1.3889 | 3.04878 |
| 1.5079 | −1.44466 | 3.65806 | −1.58083 | 1.72261 | 3.65806 |
| 1.503395 | −1.44976 | 3.65806 | −1.58007 | 1.72312 | 3.65806 |
| 1.495915 | −1.45503 | 3.65806 | −1.57845 | 1.72397 | 3.65806 |
| 1.485205 | −1.45852 | 3.65806 | −1.57497 | 1.72499 | 3.65806 |
| 1.471605 | −1.45775 | 3.65806 | −1.56783 | 1.72499 | 3.65806 |
| 1.45503 | −1.4501 | 3.65806 | −1.55695 | 1.7221 | 3.65806 |
| 1.433865 | −1.43922 | 3.65806 | −1.53918 | 1.71292 | 3.65806 |
| 1.407515 | −1.42545 | 3.65806 | −1.51717 | 1.697705 | 3.65806 |
| 1.37547 | −1.40862 | 3.65806 | −1.48971 | 1.67501 | 3.65806 |
| 1.33739 | −1.38856 | 3.65806 | −1.45682 | 1.64509 | 3.65806 |
| 1.292935 | −1.36476 | 3.65806 | −1.41474 | 1.60548 | 3.65806 |
| 1.240575 | −1.33637 | 3.65806 | −1.36629 | 1.55958 | 3.65806 |
| 1.180395 | −1.30331 | 3.65806 | −1.3147 | 1.51062 | 3.65806 |
| 1.11248 | −1.26523 | 3.65806 | −1.25656 | 1.45554 | 3.65806 |
| 1.037 | −1.22196 | 3.65806 | −1.19204 | 1.394255 | 3.65806 |
| 0.954125 | −1.17334 | 3.65806 | −1.12124 | 1.326765 | 3.65806 |
| 0.864025 | −1.11894 | 3.65806 | −1.04737 | 1.25596 | 3.65806 |
| 0.77078 | −1.0608 | 3.65806 | −0.9707 | 1.181755 | 3.65806 |
| 0.674475 | −0.99875 | 3.65806 | −0.89114 | 1.104065 | 3.65806 |
| 0.575535 | −0.93262 | 3.65806 | −0.80886 | 1.022805 | 3.65806 |
| 0.4743 | −0.86224 | 3.65806 | −0.72386 | 0.937975 | 3.65806 |
| 0.371025 | −0.78744 | 3.65806 | −0.63614 | 0.849575 | 3.65806 |

TABLE 2-continued

| SUCTION SIDE | | | PRESSURE SIDE | | |
|---|---|---|---|---|---|
| X | Y | Z | X | Y | Z |
| 0.265965 | −0.70788 | 3.65806 | −0.5457 | 0.757605 | 3.65806 |
| 0.15946 | −0.62322 | 3.65806 | −0.45254 | 0.662065 | 3.65806 |
| 0.055165 | −0.53627 | 3.65806 | −0.35972 | 0.566185 | 3.65806 |
| −0.04692 | −0.44685 | 3.65806 | −0.26707 | 0.470135 | 3.65806 |
| −0.14654 | −0.35488 | 3.65806 | −0.17459 | 0.373915 | 3.65806 |
| −0.24378 | −0.26027 | 3.65806 | −0.08211 | 0.27778 | 3.65806 |
| −0.33864 | −0.16303 | 3.65806 | 0.01054 | 0.18173 | 3.65806 |
| −0.43129 | −0.0635 | 3.65806 | 0.10302 | 0.085595 | 3.65806 |
| −0.52199 | 0.03808 | 3.65806 | 0.19516 | −0.01097 | 3.65806 |
| −0.61098 | 0.14161 | 3.65806 | 0.286875 | −0.10787 | 3.65806 |
| −0.69811 | 0.24701 | 3.65806 | 0.37808 | −0.20519 | 3.65806 |
| −0.78362 | 0.35428 | 3.65806 | 0.46903 | −0.30286 | 3.65806 |
| −0.86717 | 0.46308 | 3.65806 | 0.559725 | −0.40069 | 3.65806 |
| −0.94614 | 0.56967 | 3.65806 | 0.647275 | −0.49538 | 3.65806 |
| −1.02068 | 0.673795 | 3.65806 | 0.731765 | −0.58693 | 3.65806 |
| −1.09098 | 0.77537 | 3.65806 | 0.81328 | −0.67507 | 3.65806 |
| −1.15702 | 0.87431 | 3.65806 | 0.89182 | −0.75999 | 3.65806 |
| −1.21899 | 0.97036 | 3.65806 | 0.967555 | −0.84142 | 3.65806 |
| −1.27696 | 1.06369 | 3.65806 | 1.0404 | −0.91936 | 3.65806 |
| −1.33102 | 1.15396 | 3.65806 | 1.110525 | −0.99391 | 3.65806 |
| −1.38108 | 1.241255 | 3.65806 | 1.174785 | −1.06165 | 3.65806 |
| −1.42511 | 1.321495 | 3.65806 | 1.233095 | −1.12285 | 3.65806 |
| −1.46345 | 1.394425 | 3.65806 | 1.285455 | −1.17734 | 3.65806 |
| −1.49634 | 1.45979 | 3.65806 | 1.331865 | −1.22528 | 3.65806 |
| −1.52601 | 1.521755 | 3.65806 | 1.37224 | −1.26667 | 3.65806 |
| −1.55057 | 1.5759 | 3.65806 | 1.406495 | −1.30161 | 3.65806 |
| −1.56808 | 1.618145 | 3.65806 | 1.43582 | −1.33136 | 3.65806 |
| −1.58015 | 1.65274 | 3.65806 | 1.460555 | −1.35635 | 3.65806 |
| −1.58687 | 1.679345 | 3.65806 | 1.480955 | −1.37683 | 3.65806 |
| −1.58899 | 1.699745 | 3.65806 | 1.497275 | −1.39324 | 3.65806 |
| −1.5878 | 1.711135 | 3.65806 | 1.50926 | −1.40633 | 3.65806 |
| −1.58517 | 1.717935 | 3.65806 | 1.51402 | −1.41899 | 3.65806 |
| −1.58296 | 1.720825 | 3.65806 | 1.51402 | −1.43021 | 3.65806 |
| −1.5816 | 1.7221 | 3.65806 | 1.5113 | −1.4388 | 3.65806 |
| 1.43514 | −1.51003 | 4.267255 | −1.54224 | 1.749385 | 4.267255 |
| 1.430465 | −1.51487 | 4.267255 | −1.54148 | 1.749895 | 4.267255 |
| 1.422815 | −1.51963 | 4.267255 | −1.53986 | 1.75066 | 4.267255 |
| 1.41185 | −1.52244 | 4.267255 | −1.53638 | 1.751595 | 4.267255 |
| 1.398505 | −1.52074 | 4.267255 | −1.52915 | 1.751425 | 4.267255 |
| 1.38244 | −1.51215 | 4.267255 | −1.51844 | 1.74811 | 4.267255 |
| 1.361955 | −1.50034 | 4.267255 | −1.50093 | 1.73859 | 4.267255 |
| 1.336285 | −1.48538 | 4.267255 | −1.47934 | 1.722865 | 4.267255 |
| 1.305175 | −1.46719 | 4.267255 | −1.4524 | 1.69966 | 4.267255 |
| 1.268285 | −1.44534 | 4.267255 | −1.4201 | 1.669145 | 4.267255 |
| 1.22519 | −1.41967 | 4.267255 | −1.37887 | 1.62877 | 4.267255 |
| 1.174445 | −1.38899 | 4.267255 | −1.33153 | 1.58202 | 4.267255 |
| 1.11605 | −1.35329 | 4.267255 | −1.28104 | 1.53204 | 4.267255 |
| 1.05026 | −1.31232 | 4.267255 | −1.22426 | 1.47577 | 4.267255 |
| 0.97716 | −1.26591 | 4.267255 | −1.16127 | 1.41321 | 4.267255 |
| 0.896835 | −1.21372 | 4.267255 | −1.09217 | 1.34419 | 4.267255 |
| 0.809625 | −1.15558 | 4.267255 | −1.02026 | 1.271685 | 4.267255 |
| 0.719355 | −1.0937 | 4.267255 | −0.94554 | 1.195695 | 4.267255 |
| 0.62628 | −1.02782 | 4.267255 | −0.86819 | 1.116135 | 4.267255 |
| 0.530655 | −0.95778 | 4.267255 | −0.78812 | 1.03292 | 4.267255 |
| 0.43299 | −0.88358 | 4.267255 | −0.70559 | 0.94605 | 4.267255 |
| 0.333285 | −0.80487 | 4.267255 | −0.62042 | 0.855525 | 4.267255 |
| 0.23205 | −0.72148 | 4.267255 | −0.5327 | 0.76126 | 4.267255 |
| 0.12937 | −0.63308 | 4.267255 | −0.44243 | 0.66334 | 4.267255 |
| 0.0289 | −0.54256 | 4.267255 | −0.35241 | 0.56508 | 4.267255 |
| −0.06936 | −0.44974 | 4.267255 | −0.26282 | 0.466565 | 4.267255 |
| −0.16524 | −0.35454 | 4.267255 | −0.1734 | 0.36788 | 4.267255 |
| −0.25866 | −0.25696 | 4.267255 | −0.08398 | 0.269195 | 4.267255 |
| −0.34978 | −0.15708 | 4.267255 | 0.00544 | 0.170425 | 4.267255 |
| −0.43877 | −0.05508 | 4.267255 | 0.094775 | 0.071655 | 4.267255 |
| −0.52598 | 0.048705 | 4.267255 | 0.1836 | −0.02763 | 4.267255 |
| −0.61149 | 0.154275 | 4.267255 | 0.27183 | −0.12733 | 4.267255 |
| −0.69522 | 0.261545 | 4.267255 | 0.35955 | −0.22755 | 4.267255 |
| −0.77733 | 0.37043 | 4.267255 | 0.446845 | −0.3281 | 4.267255 |
| −0.85774 | 0.480845 | 4.267255 | 0.5338 | −0.429 | 4.267255 |
| −0.93373 | 0.588795 | 4.267255 | 0.61761 | −0.52675 | 4.267255 |
| −1.00547 | 0.694195 | 4.267255 | 0.698275 | −0.62127 | 4.267255 |
| −1.07304 | 0.796875 | 4.267255 | 0.776135 | −0.71247 | 4.267255 |
| −1.13662 | 0.896835 | 4.267255 | 0.85102 | −0.80028 | 4.267255 |
| −1.19621 | 0.99382 | 4.267255 | 0.923185 | −0.88468 | 4.267255 |
| −1.25205 | 1.087745 | 4.267255 | 0.992545 | −0.96552 | 4.267255 |
| −1.30399 | 1.178695 | 4.267255 | 1.059185 | −1.04287 | 4.267255 |

TABLE 2-continued

| SUCTION SIDE | | | PRESSURE SIDE | | |
|---|---|---|---|---|---|
| X | Y | Z | X | Y | Z |
| −1.35218 | 1.266585 | 4.267255 | 1.120215 | −1.11333 | 4.267255 |
| −1.39451 | 1.34725 | 4.267255 | 1.175635 | −1.17691 | 4.267255 |
| −1.43132 | 1.42052 | 4.267255 | 1.22536 | −1.23369 | 4.267255 |
| −1.46285 | 1.486225 | 4.267255 | 1.269475 | −1.28359 | 4.267255 |
| −1.49124 | 1.54836 | 4.267255 | 1.30781 | −1.32677 | 4.267255 |
| −1.51462 | 1.60276 | 4.267255 | 1.34028 | −1.36315 | 4.267255 |
| −1.53128 | 1.645175 | 4.267255 | 1.36816 | −1.39426 | 4.267255 |
| −1.54258 | 1.6977 | 4.267255 | 1.39162 | −1.42027 | 4.267255 |
| −1.54879 | 1.706375 | 4.267255 | 1.411 | −1.44169 | 4.267255 |
| −1.55057 | 1.726775 | 4.267255 | 1.426555 | −1.45877 | 4.267255 |
| −1.5493 | 1.737995 | 4.267255 | 1.437945 | −1.47237 | 4.267255 |
| −1.54658 | 1.744795 | 4.267255 | 1.442195 | −1.48495 | 4.267255 |
| −1.54437 | 1.747685 | 4.267255 | 1.44177 | −1.496 | 4.267255 |
| −1.54301 | 1.748875 | 4.267255 | 1.438795 | −1.50442 | 4.267255 |
| 1.375385 | −1.58134 | 4.876535 | −1.50255 | 1.77684 | 4.876535 |
| 1.370455 | −1.58593 | 4.876535 | −1.50178 | 1.777265 | 4.876535 |
| 1.36255 | −1.59035 | 4.876535 | −1.50017 | 1.77803 | 4.876535 |
| 1.3515 | −1.59239 | 4.876535 | −1.4966 | 1.77888 | 4.876535 |
| 1.33824 | −1.58959 | 4.876535 | −1.48946 | 1.778455 | 4.876535 |
| 1.32277 | −1.58007 | 4.876535 | −1.47883 | 1.77497 | 4.876535 |
| 1.30288 | −1.56715 | 4.876535 | −1.46141 | 1.765025 | 4.876535 |
| 1.27806 | −1.551 | 4.876535 | −1.44007 | 1.748875 | 4.876535 |
| 1.247885 | −1.53119 | 4.876535 | −1.41355 | 1.72516 | 4.876535 |
| 1.2121 | −1.50756 | 4.876535 | −1.38168 | 1.69405 | 4.876535 |
| 1.170365 | −1.47977 | 4.876535 | −1.34122 | 1.652825 | 4.876535 |
| 1.12115 | −1.4467 | 4.876535 | −1.29481 | 1.604885 | 4.876535 |
| 1.064625 | −1.4082 | 4.876535 | −1.24542 | 1.553545 | 4.876535 |
| 1.000875 | −1.36417 | 4.876535 | −1.18992 | 1.49583 | 4.876535 |
| 0.929985 | −1.31444 | 4.876535 | −1.12846 | 1.431485 | 4.876535 |
| 0.852125 | −1.25868 | 4.876535 | −1.06114 | 1.36051 | 4.876535 |
| 0.76755 | −1.19672 | 4.876535 | −0.9911 | 1.28588 | 4.876535 |
| 0.680085 | −1.13101 | 4.876535 | −0.91843 | 1.20768 | 4.876535 |
| 0.589815 | −1.06131 | 4.876535 | −0.84329 | 1.12574 | 4.876535 |
| 0.49725 | −0.98762 | 4.876535 | −0.17656 | 1.039975 | 4.876535 |
| 0.40256 | −0.90967 | 4.876535 | −0.68544 | 0.950555 | 4.876535 |
| 0.306 | −0.82731 | 4.876535 | −0.60282 | 0.85731 | 4.876535 |
| 0.207825 | −0.74027 | 4.876535 | −0.51782 | 0.76024 | 4.876535 |
| 0.108375 | −0.64821 | 4.876535 | −0.43027 | 0.659515 | 4.876535 |
| 0.011135 | −0.5542 | 4.876535 | −0.34323 | 0.558365 | 4.876535 |
| −0.08381 | −0.45798 | 4.876535 | −0.25645 | 0.45696 | 4.876535 |
| −0.17638 | −0.35964 | 4.876535 | −0.16992 | 0.3553 | 4.876535 |
| −0.26639 | −0.25883 | 4.876535 | −0.08347 | 0.25364 | 4.876535 |
| −0.35403 | −0.15581 | 4.876535 | 0.002975 | 0.15198 | 4.876535 |
| −0.43979 | −0.05109 | 4.876535 | 0.08942 | 0.05032 | 4.876535 |
| −0.52377 | 0.055335 | 4.876535 | 0.175355 | −0.05185 | 4.876535 |
| −0.60614 | 0.1632 | 4.876535 | 0.26044 | −0.15462 | 4.876535 |
| −0.68697 | 0.272595 | 4.876535 | 0.344845 | −0.25798 | 4.876535 |
| −0.76628 | 0.383435 | 4.876535 | 0.428655 | −0.36176 | 4.876535 |
| −0.84397 | 0.49555 | 4.876535 | 0.51204 | −0.46597 | 4.876535 |
| −0.91749 | 0.6052 | 4.876535 | 0.592365 | −0.56695 | 4.876535 |
| −0.98694 | 0.712045 | 4.876535 | 0.669715 | −0.66453 | 4.876535 |
| −1.05239 | 0.816 | 4.876535 | 0.744175 | −0.7588 | 4.876535 |
| −1.11393 | 0.917065 | 4.876535 | 0.815915 | −0.84949 | 4.876535 |
| −1.17164 | 1.01507 | 4.876535 | 0.88502 | −0.93662 | 4.876535 |
| −1.22562 | 1.1101 | 4.876535 | 0.95149 | −1.02017 | 4.876535 |
| −1.27585 | 1.2019 | 4.876535 | 1.015325 | −1.10007 | 4.876535 |
| −1.32243 | 1.290555 | 4.876535 | 1.07389 | −1.17292 | 4.876535 |
| −1.36315 | 1.371985 | 4.876535 | 1.127015 | −1.23862 | 4.876535 |
| −1.39859 | 1.44585 | 4.876535 | 1.174785 | −1.29727 | 4.876535 |
| −1.42885 | 1.512065 | 4.876535 | 1.217115 | −1.34887 | 4.876535 |
| −1.45597 | 1.57471 | 4.876535 | 1.25392 | −1.39349 | 4.876535 |
| −1.47815 | 1.62962 | 4.876535 | 1.285115 | −1.43115 | 4.876535 |
| −1.49379 | 1.672375 | 4.876535 | 1.31189 | −1.46328 | 4.876535 |
| −1.50433 | 1.707225 | 4.876535 | 1.3334415 | −1.49022 | 4.876535 |
| −1.50986 | 1.733915 | 4.876535 | 1.35303 | −1.51241 | 4.876535 |
| −1.51139 | 1.754315 | 4.876535 | 1.367905 | −1.53009 | 4.876535 |
| −1.50986 | 1.76562 | 4.876535 | 1.378955 | −1.54403 | 4.876535 |
| −1.50705 | 1.77225 | 4.876535 | 1.38312 | −1.55652 | 4.876535 |
| −1.50476 | 1.77514 | 4.876535 | 1.38244 | −1.56757 | 4.876535 |
| −1.50331 | 1.77633 | 4.876535 | 1.37921 | −1.57582 | 4.876535 |
| 1.31427 | −1.63464 | 5.48573 | −1.47382 | 1.81628 | 5.48573 |
| 1.30917 | −1.63914 | 5.48573 | −1.47297 | 1.816705 | 5.48573 |
| 1.301095 | −1.64314 | 5.48573 | −1.47135 | 1.817385 | 5.48573 |
| 1.289875 | −1.64458 | 5.48573 | −1.46778 | 1.818065 | 5.48573 |
| 1.27687 | −1.64084 | 5.48573 | −1.46056 | 1.817385 | 5.48573 |
| 1.261825 | −1.63056 | 5.48573 | −1.4501 | 1.81339 | 5.48573 |

TABLE 2-continued

| SUCTION SIDE | | | PRESSURE SIDE | | |
|---|---|---|---|---|---|
| X | Y | Z | X | Y | Z |
| 1.242445 | −1.61679 | 5.48573 | −1.43302 | 1.80268 | 5.48573 |
| 1.218305 | −1.59962 | 5.48573 | −1.41219 | 1.785765 | 5.48573 |
| 1.18898 | −1.57862 | 5.48573 | −1.38627 | 1.7612 | 5.48573 |
| 1.15413 | −1.55355 | 5.48573 | −1.35533 | 1.72907 | 5.48573 |
| 1.1135 | −1.52405 | 5.48573 | −1.31589 | 1.686485 | 5.48573 |
| 1.06556 | −1.48895 | 5.48573 | −1.27075 | 1.6371 | 5.48573 |
| 1.010565 | −1.44815 | 5.48573 | −1.22273 | 1.58423 | 5.48573 |
| 0.9486 | −1.40148 | 5.48573 | −1.16884 | 1.52473 | 5.48573 |
| 0.87975 | −1.34887 | 5.48573 | −1.10891 | 1.458515 | 5.48573 |
| 0.8041 | −1.28988 | 5.48573 | −1.04338 | 1.3855 | 5.48573 |
| 0.72199 | −1.22451 | 5.48573 | −0.97521 | 1.308745 | 5.48573 |
| 0.63716 | −1.15515 | 5.48573 | −0.90457 | 1.22825 | 5.48573 |
| 0.54978 | −1.08188 | 5.48573 | −0.83147 | 1.144015 | 5.48573 |
| 0.460105 | −1.00445 | 5.48573 | −0.75591 | 1.055955 | 5.48573 |
| 0.368475 | −0.92268 | 5.48573 | −0.67813 | 0.963985 | 5.48573 |
| 0.275145 | −0.83657 | 5.48573 | −0.59789 | 0.868105 | 5.48573 |
| 0.180285 | −0.74571 | 5.48573 | −0.51544 | 0.7684 | 5.48573 |
| 0.084235 | −0.64991 | 5.48573 | −0.43053 | 0.66487 | 5.48573 |
| −0.00969 | −0.55225 | 5.48573 | −0.34612 | 0.561 | 5.48573 |
| −0.10124 | −0.45263 | 5.48573 | −0.26206 | 0.45679 | 5.48573 |
| −0.19057 | −0.35097 | 5.48573 | −0.17816 | 0.35241 | 5.48573 |
| −0.27736 | −0.24718 | 5.48573 | −0.09444 | 0.24803 | 5.48573 |
| −0.36185 | −0.14136 | 5.48573 | −0.01063 | 0.143565 | 5.48573 |
| −0.44464 | −0.03409 | 5.48573 | 0.0731 | 0.039185 | 5.48573 |
| −0.52573 | 0.074715 | 5.48573 | 0.1564 | −0.06571 | 5.48573 |
| −0.60529 | 0.18479 | 5.48573 | 0.23885 | −0.17111 | 5.48573 |
| −0.68332 | 0.296225 | 5.48573 | 0.32062 | −0.2771 | 5.48573 |
| −0.7599 | 0.408935 | 5.48573 | 0.401795 | −0.38352 | 5.48573 |
| −0.83504 | 0.52292 | 5.48573 | 0.48246 | −0.49037 | 5.48573 |
| −0.90619 | 0.634185 | 5.48573 | 0.560065 | −0.5939 | 5.48573 |
| −0.97342 | 0.742475 | 5.48573 | 0.634865 | −0.69403 | 5.48573 |
| −1.03683 | 0.847875 | 5.48573 | 0.706775 | −0.79059 | 5.48573 |
| −1.09659 | 0.95013 | 5.48573 | 0.77605 | −0.88375 | 5.48573 |
| −1.1526 | 1.04924 | 5.48573 | 0.84269 | −0.97317 | 5.48573 |
| −1.20496 | 1.14512 | 5.48573 | 0.90678 | −1.05902 | 5.48573 |
| −1.25392 | 1.237855 | 5.48573 | 0.96832 | −1.14113 | 5.48573 |
| −1.29914 | 1.327275 | 5.48573 | 1.02476 | −1.21593 | 5.48573 |
| −1.33867 | 1.4093 | 5.48573 | 1.07593 | −1.2835 | 5.48573 |
| −1.37309 | 1.483675 | 5.48573 | 1.121915 | −1.34385 | 5.48573 |
| −1.4025 | 1.5504 | 5.48573 | 1.16263 | −1.39689 | 5.48573 |
| −1.42885 | 1.61347 | 5.48573 | 1.198075 | −1.44288 | 5.48573 |
| −1.45036 | 1.668635 | 5.48573 | 1.228165 | −1.48164 | 5.48573 |
| −1.46549 | 1.71156 | 5.48573 | 1.25392 | −1.5147 | 5.48573 |
| −1.47569 | 1.74658 | 5.48573 | 1.27568 | −1.5425 | 5.48573 |
| −1.48104 | 1.773355 | 5.48573 | 1.293615 | −1.56528 | 5.48573 |
| −1.48249 | 1.793755 | 5.48573 | 1.307895 | −1.58355 | 5.48573 |
| −1.48104 | 1.80506 | 5.48573 | 1.31869 | −1.59775 | 5.48573 |
| −1.47824 | 1.811775 | 5.48573 | 1.3226 | −1.61033 | 5.48573 |
| −1.47594 | 1.81458 | 5.48573 | 1.321665 | −1.62129 | 5.48573 |
| −1.47458 | 1.81577 | 5.48573 | 1.318265 | −1.62937 | 5.48573 |
| 1.25409 | −1.67765 | 6.094925 | −1.44951 | 1.861245 | 6.094925 |
| 1.24882 | −1.6819 | 6.094925 | −1.44866 | 1.86167 | 6.094925 |
| 1.24049 | −1.68555 | 6.094925 | −1.44696 | 1.862265 | 6.094925 |
| 1.22927 | −1.68632 | 6.094925 | −1.44339 | 1.862775 | 6.094925 |
| 1.21652 | −1.68164 | 6.094925 | −1.43625 | 1.861585 | 6.094925 |
| 1.20207 | −1.67051 | 6.094925 | −1.42596 | 1.85691 | 6.094925 |
| 1.183285 | −1.65589 | 6.094925 | −1.40947 | 1.84535 | 6.094925 |
| 1.159825 | −1.63761 | 6.094925 | −1.38933 | 1.827415 | 6.094925 |
| 1.131435 | −1.61526 | 6.094925 | −1.36434 | 1.80166 | 6.094925 |
| 1.09769 | −1.58865 | 6.094925 | −1.33459 | 1.768255 | 6.094925 |
| 1.05842 | −1.55729 | 6.094925 | −1.29676 | 1.724055 | 6.094925 |
| 1.012095 | −1.52006 | 6.094925 | −1.25333 | 1.672885 | 6.094925 |
| 0.958885 | −1.47679 | 6.094925 | −1.207 | 1.618145 | 6.094925 |
| 0.898875 | −1.42741 | 6.094925 | −1.15498 | 1.55669 | 6.094925 |
| 0.83232 | −1.37165 | 6.094925 | −1.09718 | 1.488265 | 6.094925 |
| 0.759305 | −1.30934 | 6.094925 | −1.03377 | 1.41287 | 6.094925 |
| 0.68 | −1.24032 | 6.094925 | −0.96781 | 1.33382 | 6.094925 |
| 0.598145 | −1.16731 | 6.094925 | −0.89947 | 1.250945 | 6.094925 |
| 0.513825 | −1.09013 | 6.094925 | −0.82875 | 1.16416 | 6.094925 |
| 0.427465 | −1.00887 | 6.094925 | −0.75565 | 1.07355 | 6.094925 |
| 0.339235 | −0.92336 | 6.094925 | −0.68043 | 0.97903 | 6.094925 |
| 0.24939 | −0.83334 | 6.094925 | −0.60282 | 0.880515 | 6.094925 |
| 0.158185 | −0.73865 | 6.094925 | −0.52292 | 0.778175 | 6.094925 |
| 0.06579 | −0.63903 | 6.094925 | −0.44081 | 0.671925 | 6.094925 |
| −0.02457 | −0.5378 | 6.094925 | −0.35904 | 0.565335 | 6.094925 |
| −0.11271 | −0.43486 | 6.094925 | −0.27761 | 0.45849 | 6.094925 |

TABLE 2-continued

| SUCTION SIDE | | | PRESSURE SIDE | | |
|---|---|---|---|---|---|
| X | Y | Z | X | Y | Z |
| −0.19873 | −0.33014 | 6.094925 | −0.19644 | 0.35156 | 6.094925 |
| −0.28237 | −0.22355 | 6.094925 | −0.11535 | 0.24446 | 6.094925 |
| −0.36406 | −0.11535 | 6.094925 | −0.03426 | 0.13736 | 6.094925 |
| −0.44404 | −0.00578 | 6.094925 | 0.04692 | 0.030345 | 6.094925 |
| −0.52241 | 0.10506 | 6.094925 | 0.12767 | −0.07701 | 6.094925 |
| −0.59934 | 0.217005 | 6.094925 | 0.20774 | −0.18479 | 6.094925 |
| −0.67482 | 0.33014 | 6.094925 | 0.2873 | −0.293 | 6.094925 |
| −0.74902 | 0.44438 | 6.094925 | 0.366265 | −0.40163 | 6.094925 |
| −0.82178 | 0.559725 | 6.094925 | 0.444805 | −0.5106 | 6.094925 |
| −0.8908 | 0.672265 | 6.094925 | 0.520455 | −0.61608 | 6.094925 |
| −0.95625 | 0.781915 | 6.094925 | 0.593215 | −0.71817 | 6.094925 |
| −1.01796 | 0.888335 | 6.094925 | 0.663255 | −0.81668 | 6.094925 |
| −1.07627 | 0.991525 | 6.094925 | 0.73066 | −0.91154 | 6.094925 |
| −1.13101 | 1.091485 | 6.094925 | 0.795515 | −1.00275 | 6.094925 |
| −1.18244 | 1.188045 | 6.094925 | 0.857905 | −1.0903 | 6.094925 |
| −1.23046 | 1.28129 | 6.094925 | 0.917745 | −1.17411 | 6.094925 |
| −1.275 | 1.371135 | 6.094925 | 0.97257 | −1.25044 | 6.094925 |
| −1.31402 | 1.4535 | 6.094925 | 1.02238 | −1.31937 | 6.094925 |
| −1.3481 | 1.52813 | 6.094925 | 1.06709 | −1.381 | 6.094925 |
| −1.37726 | 1.595025 | 6.094925 | 1.106615 | −1.43523 | 6.094925 |
| −1.40344 | 1.65818 | 6.094925 | 1.141125 | −1.48215 | 6.094925 |
| −1.42494 | 1.71343 | 6.094925 | 1.17028 | −1.52184 | 6.094925 |
| −1.44016 | 1.756355 | 6.094925 | 1.195355 | −1.55559 | 6.094925 |
| −1.45044 | 1.791375 | 6.094925 | 1.21652 | −1.58398 | 6.094925 |
| −1.45605 | 1.81815 | 6.094925 | 1.23386 | −1.60727 | 6.094925 |
| −1.45767 | 1.83855 | 6.094925 | 1.247885 | −1.62597 | 6.094925 |
| −1.45648 | 1.849855 | 6.094925 | 1.25851 | −1.64033 | 6.094925 |
| −1.45393 | 1.856655 | 6.094925 | 1.26276 | −1.653 | 6.094925 |
| −1.45172 | 1.859545 | 6.094925 | 1.26191 | −1.66413 | 6.094925 |
| −1.45027 | 1.860735 | 6.094925 | 1.25834 | −1.67238 | 6.094925 |
| 1.19612 | −1.71683 | 6.704205 | −1.42418 | 1.91114 | 6.704205 |
| 1.190595 | −1.72091 | 6.704205 | −1.42333 | 1.911565 | 6.704205 |
| 1.182095 | −1.72406 | 6.704205 | −1.42163 | 1.91216 | 6.704205 |
| 1.17079 | −1.72406 | 6.704205 | −1.41797 | 1.912415 | 6.704205 |
| 1.15855 | −1.71828 | 6.704205 | −1.41092 | 1.91063 | 6.704205 |
| 1.14461 | −1.70638 | 6.704205 | −1.40097 | 1.905275 | 6.704205 |
| 1.126675 | −1.69082 | 6.704205 | −1.38499 | 1.892695 | 6.704205 |
| 1.10415 | −1.67136 | 6.704205 | −1.36578 | 1.873655 | 6.704205 |
| 1.076865 | −1.64756 | 6.704205 | −1.34198 | 1.846795 | 6.704205 |
| 1.044565 | −1.61925 | 6.704205 | −1.31359 | 1.811945 | 6.704205 |
| 1.006825 | −1.58593 | 6.704205 | −1.27755 | 1.765875 | 6.704205 |
| 0.96237 | −1.54632 | 6.704205 | −1.23607 | 1.712665 | 6.704205 |
| 0.91137 | −1.50042 | 6.704205 | −1.19187 | 1.655885 | 6.704205 |
| 0.85391 | −1.44806 | 6.704205 | −1.14206 | 1.592135 | 6.704205 |
| 0.790075 | −1.38899 | 6.704205 | −1.08664 | 1.521245 | 6.704205 |
| 0.72012 | −1.32311 | 6.704205 | −1.02587 | 1.443215 | 6.704205 |
| 0.644215 | −1.25027 | 6.704205 | −0.96254 | 1.361445 | 6.704205 |
| 0.565845 | −1.17334 | 6.704205 | −0.89684 | 1.27585 | 6.704205 |
| 0.48518 | −1.09234 | 6.704205 | −0.82892 | 1.18626 | 6.704205 |
| 0.40256 | −1.00708 | 6.704205 | −0.75871 | 1.09276 | 6.704205 |
| 0.318155 | −0.91766 | 6.704205 | −0.68629 | 0.99535 | 6.704205 |
| 0.232135 | −0.82365 | 6.704205 | −0.61158 | 0.893945 | 6.704205 |
| 0.14467 | −0.72505 | 6.704205 | −0.53457 | 0.788715 | 6.704205 |
| 0.0561 | −0.62169 | 6.704205 | −0.45535 | 0.67949 | 6.704205 |
| −0.03069 | −0.51689 | 6.704205 | −0.37647 | 0.570095 | 6.704205 |
| −0.11543 | −0.41064 | 6.704205 | −0.29784 | 0.460445 | 6.704205 |
| −0.19814 | −0.30277 | 6.704205 | −0.21947 | 0.350625 | 6.704205 |
| −0.2788 | −0.19346 | 6.704205 | −0.1411 | 0.240805 | 6.704205 |
| −0.35768 | −0.08271 | 6.704205 | −0.06273 | 0.13107 | 6.704205 |
| −0.43503 | 0.02924 | 6.704205 | 0.01581 | 0.021335 | 6.704205 |
| −0.51094 | 0.142205 | 6.704205 | 0.094095 | −0.08849 | 6.704205 |
| −0.58548 | 0.25619 | 6.704205 | 0.171955 | −0.19873 | 6.704205 |
| −0.65875 | 0.37111 | 6.704205 | 0.249305 | −0.30915 | 6.704205 |
| −0.73083 | 0.486965 | 6.704205 | 0.326315 | −0.41999 | 6.704205 |
| −0.80181 | 0.603755 | 6.704205 | 0.402985 | −0.53091 | 6.704205 |
| −0.86913 | 0.717485 | 6.704205 | 0.476935 | −0.63835 | 6.704205 |
| −0.93305 | 0.828155 | 6.704205 | 0.548165 | −0.74214 | 6.704205 |
| −0.99357 | 0.93551 | 6.704205 | 0.61676 | −0.84235 | 6.704205 |
| −1.05069 | 1.039465 | 6.704205 | 0.68289 | −0.93874 | 6.704205 |
| −1.10466 | 1.14002 | 6.704205 | 0.74647 | −1.03148 | 6.704205 |
| −1.15541 | 1.23709 | 6.704205 | 0.807585 | −1.12039 | 6.704205 |
| −1.20292 | 1.330675 | 6.704205 | 0.86632 | −1.20556 | 6.704205 |
| −1.24721 | 1.420775 | 6.704205 | 0.920125 | −1.28316 | 6.704205 |
| −1.28622 | 1.50331 | 6.704205 | 0.968915 | −1.35329 | 6.704205 |
| −1.32031 | 1.578025 | 6.704205 | 1.012775 | −1.41585 | 6.704205 |
| −1.34963 | 1.64492 | 6.704205 | 1.05162 | −1.47101 | 6.704205 |

TABLE 2-continued

| SUCTION SIDE | | | PRESSURE SIDE | | |
|---|---|---|---|---|---|
| X | Y | Z | X | Y | Z |
| −1.37598 | 1.708075 | 6.704205 | 1.085365 | −1.5187 | 6.704205 |
| −1.39783 | 1.76324 | 6.704205 | 1.11401 | −1.55907 | 6.704205 |
| −1.4133 | 1.80625 | 6.704205 | 1.138575 | −1.59341 | 6.704205 |
| −1.42384 | 1.841185 | 6.704205 | 1.159315 | −1.62231 | 6.704205 |
| −1.4297 | 1.86796 | 6.704205 | 1.1764 | −1.64603 | 6.704205 |
| −1.43174 | 1.88836 | 6.704205 | 1.190085 | −1.66498 | 6.704205 |
| −1.43089 | 1.89975 | 6.704205 | 1.20054 | −1.6796 | 6.704205 |
| −1.42851 | 1.906635 | 6.704205 | 1.20513 | −1.69218 | 6.704205 |
| −1.42639 | 1.909525 | 6.704205 | 1.204195 | −1.7034 | 6.704205 |
| −1.42494 | 1.910715 | 6.704205 | 1.200455 | −1.71156 | 6.704205 |
| 1.138575 | −1.75432 | 7.313485 | −1.39689 | 1.970555 | 7.313485 |
| 1.13288 | −1.75823 | 7.313485 | −1.39604 | 1.97098 | 7.313485 |
| 1.12421 | −1.76095 | 7.313485 | −1.39426 | 1.971405 | 7.313485 |
| 1.11282 | −1.76018 | 7.313485 | −1.3906 | 1.971405 | 7.313485 |
| 1.10109 | −1.7533 | 7.313485 | −1.38363 | 1.96911 | 7.313485 |
| 1.087745 | −1.74063 | 7.313485 | −1.37403 | 1.963075 | 7.313485 |
| 1.07049 | −1.72414 | 7.313485 | −1.35864 | 1.94956 | 7.313485 |
| 1.048985 | −1.70349 | 7.313485 | −1.34028 | 1.929585 | 7.313485 |
| 1.02289 | −1.67833 | 7.313485 | −1.31759 | 1.90145 | 7.313485 |
| 0.991865 | −1.64832 | 7.313485 | −1.29064 | 1.865155 | 7.313485 |
| 0.95574 | −1.61305 | 7.313485 | −1.25639 | 1.8173 | 7.313485 |
| 0.91324 | −1.57123 | 7.313485 | −1.21695 | 1.76205 | 7.313485 |
| 0.86445 | −1.52269 | 7.313485 | −1.17479 | 1.703145 | 7.313485 |
| 0.809455 | −1.46736 | 7.313485 | −1.12719 | 1.637015 | 7.313485 |
| 0.748425 | −1.40505 | 7.313485 | −1.07423 | 1.563575 | 7.313485 |
| 0.681615 | −1.33569 | 7.313485 | −1.01609 | 1.482825 | 7.313485 |
| 0.609025 | −1.25902 | 7.313485 | −0.9554 | 1.398165 | 7.313485 |
| 0.53414 | −1.17827 | 7.313485 | −0.89242 | 1.30968 | 7.313485 |
| 0.457215 | −1.09336 | 7.313485 | −0.82722 | 1.217285 | 7.313485 |
| 0.37825 | −1.00419 | 7.313485 | −0.75982 | 1.12081 | 7.313485 |
| 0.297585 | −0.91069 | 7.313485 | −0.69029 | 1.02034 | 7.313485 |
| 0.21539 | −0.81277 | 7.313485 | −0.61846 | 0.915875 | 7.313485 |
| 0.13175 | −0.71018 | 7.313485 | −0.54451 | 0.8075 | 7.313485 |
| 0.04692 | −0.60282 | 7.313485 | −0.46835 | 0.69513 | 7.313485 |
| −0.03621 | −0.49428 | 7.313485 | −0.39245 | 0.582505 | 7.313485 |
| −0.11756 | −0.38446 | 7.313485 | −0.3168 | 0.469795 | 7.313485 |
| −0.19712 | −0.27336 | 7.313485 | −0.24132 | 0.356915 | 7.313485 |
| −0.27481 | −0.16099 | 7.313485 | −0.16575 | 0.24412 | 7.313485 |
| −0.35088 | −0.04735 | 7.313485 | −0.0901 | 0.13141 | 7.313485 |
| −0.4256 | 0.067235 | 7.313485 | −0.01428 | 0.018785 | 7.313485 |
| −0.49895 | 0.18275 | 7.313485 | 0.06154 | −0.09393 | 7.313485 |
| −0.57112 | 0.299115 | 7.313485 | 0.13702 | −0.20672 | 7.313485 |
| −0.64226 | 0.41633 | 7.313485 | 0.212245 | −0.31977 | 7.313485 |
| −0.7123 | 0.534225 | 7.313485 | 0.2873 | −0.43291 | 7.313485 |
| −0.78132 | 0.652885 | 7.313485 | 0.3621 | −0.54621 | 7.313485 |
| −0.84694 | 0.768315 | 7.313485 | 0.434265 | −0.65586 | 7.313485 |
| −0.90942 | 0.880345 | 7.313485 | 0.50388 | −0.76169 | 7.313485 |
| −0.96858 | 0.98889 | 7.313485 | 0.57103 | −0.86377 | 7.313485 |
| −1.02476 | 1.093865 | 7.313485 | 0.635715 | −0.96212 | 7.313485 |
| −1.0778 | 1.195355 | 7.313485 | 0.69802 | −1.05655 | 7.313485 |
| −1.12787 | 1.29319 | 7.313485 | 0.757945 | −1.14716 | 7.313485 |
| −1.17487 | 1.387455 | 7.313485 | 0.81549 | −1.23386 | 7.313485 |
| −1.21873 | 1.47815 | 7.313485 | 0.86819 | −1.31291 | 7.313485 |
| −1.25749 | 1.56111 | 7.313485 | 0.916045 | −1.3844 | 7.313485 |
| −1.29149 | 1.63625 | 7.313485 | 0.959055 | −1.44823 | 7.313485 |
| −1.32073 | 1.7034 | 7.313485 | 0.99705 | −1.50442 | 7.313485 |
| −1.34725 | 1.76681 | 7.313485 | 1.0302 | −1.55304 | 7.313485 |
| −1.36918 | 1.822145 | 7.313485 | 1.05825 | −1.59418 | 7.313485 |
| −1.38482 | 1.865155 | 7.313485 | 1.082305 | −1.6292 | 7.313485 |
| −1.39553 | 1.90026 | 7.313485 | 1.10262 | −1.65869 | 7.313485 |
| −1.40157 | 1.927035 | 7.313485 | 1.119365 | −1.68292 | 7.313485 |
| −1.40386 | 1.94752 | 7.313485 | 1.13271 | −1.70221 | 7.313485 |
| −1.40327 | 1.95891 | 7.313485 | 1.14308 | −1.71709 | 7.313485 |
| −1.40114 | 1.96588 | 7.313485 | 1.147925 | −1.72967 | 7.313485 |
| −1.39902 | 1.96894 | 7.313485 | 1.14699 | −1.74097 | 7.313485 |
| −1.39766 | 1.970045 | 7.313485 | 1.143165 | −1.74922 | 7.313485 |
| 1.08069 | −1.79342 | 7.92268 | −1.36808 | 2.033455 | 7.92268 |
| 1.074825 | −1.79707 | 7.92268 | −1.36723 | 2.03388 | 7.92268 |
| 1.0659 | −1.79937 | 7.92268 | −1.36544 | 2.03422 | 7.92268 |
| 1.05451 | −1.79775 | 7.92268 | −1.3617 | 2.033965 | 7.92268 |
| 1.043375 | −1.78976 | 7.92268 | −1.3549 | 2.03116 | 7.92268 |
| 1.03071 | −1.77642 | 7.92268 | −1.34564 | 2.02453 | 7.92268 |
| 1.01422 | −1.75899 | 7.92268 | −1.33085 | 2.010165 | 7.92268 |
| 0.99365 | −1.73715 | 7.92268 | −1.31317 | 1.989255 | 7.92268 |
| 0.968745 | −1.71054 | 7.92268 | −1.29149 | 1.960015 | 7.92268 |
| 0.939165 | −1.67884 | 7.92268 | −1.26582 | 1.92236 | 7.92268 |

TABLE 2-continued

| SUCTION SIDE | | | PRESSURE SIDE | | |
|---|---|---|---|---|---|
| X | Y | Z | X | Y | Z |
| 0.904655 | −1.64161 | 7.92268 | −1.23318 | 1.872805 | 7.92268 |
| 0.86411 | −1.59741 | 7.92268 | −1.19561 | 1.8156 | 7.92268 |
| 0.817615 | −1.54624 | 7.92268 | −1.15549 | 1.754655 | 7.92268 |
| 0.765255 | −1.48793 | 7.92268 | −1.1101 | 1.68623 | 7.92268 |
| 0.707115 | −1.42239 | 7.92268 | −1.05953 | 1.610325 | 7.92268 |
| 0.64345 | −1.34938 | 7.92268 | −1.00385 | 1.52677 | 7.92268 |
| 0.57443 | −1.26888 | 7.92268 | −0.9458 | 1.43939 | 7.92268 |
| 0.5032 | −1.18422 | 7.92268 | −0.88553 | 1.348015 | 7.92268 |
| 0.42993 | −1.09531 | 7.92268 | −0.82297 | 1.252645 | 7.92268 |
| 0.354875 | −1.00215 | 7.92268 | −0.75837 | 1.153195 | 7.92268 |
| 0.278035 | −0.90457 | 7.92268 | −0.69156 | 1.04975 | 7.92268 |
| 0.199665 | −0.80257 | 7.92268 | −0.62263 | 0.94214 | 7.92268 |
| 0.11985 | −0.6959 | 7.92268 | −0.55157 | 0.83062 | 7.92268 |
| 0.038845 | −0.58463 | 7.92268 | −0.4783 | 0.71502 | 7.92268 |
| −0.04072 | −0.47226 | 7.92268 | −0.40528 | 0.59925 | 7.92268 |
| −0.11858 | −0.35887 | 7.92268 | −0.33244 | 0.483395 | 7.92268 |
| −0.19499 | −0.24438 | 7.92268 | −0.25968 | 0.36754 | 7.92268 |
| −0.26971 | −0.12878 | 7.92268 | −0.18692 | 0.2516 | 7.92268 |
| −0.34306 | −0.01224 | 7.92268 | −0.1139 | 0.13583 | 7.92268 |
| −0.41523 | 0.10506 | 7.92268 | −0.04072 | 0.02023 | 7.92268 |
| −0.48629 | 0.223125 | 7.92268 | 0.03247 | −0.09546 | 7.92268 |
| −0.55624 | 0.341955 | 7.92268 | 0.10557 | −0.21114 | 7.92268 |
| −0.62526 | 0.461465 | 7.92268 | 0.178415 | −0.327 | 7.92268 |
| −0.69335 | 0.58157 | 7.92268 | 0.25109 | −0.44294 | 7.92268 |
| −0.7605 | 0.702185 | 7.92268 | 0.32368 | −0.55896 | 7.92268 |
| −0.8245 | 0.8194 | 7.92268 | 0.393805 | −0.67116 | 7.92268 |
| −0.88545 | 0.933045 | 7.92268 | 0.461465 | −0.77945 | 7.92268 |
| −0.94342 | 1.043035 | 7.92268 | 0.52683 | −0.88383 | 7.92268 |
| −0.9985 | 1.14937 | 7.92268 | 0.589815 | −0.9843 | 7.92268 |
| −1.0506 | 1.251965 | 7.92268 | 0.650505 | −1.08086 | 7.92268 |
| −1.0999 | 1.350905 | 7.92268 | 0.7089 | −1.17351 | 7.92268 |
| −1.14631 | 1.446105 | 7.92268 | 0.765085 | −1.26208 | 7.92268 |
| −1.18975 | 1.537565 | 7.92268 | 0.81651 | −1.34292 | 7.92268 |
| −1.22817 | 1.62129 | 7.92268 | 0.86326 | −1.41593 | 7.92268 |
| −1.26191 | 1.697025 | 7.92268 | 0.90525 | −1.48113 | 7.92268 |
| −1.29107 | 1.764685 | 7.92268 | 0.942395 | −1.53859 | 7.92268 |
| −1.3175 | 1.82852 | 7.92268 | 0.974695 | −1.58831 | 7.92268 |
| −1.33952 | 1.884195 | 7.92268 | 1.00215 | −1.6303 | 7.92268 |
| −1.35516 | 1.92746 | 7.92268 | 1.025695 | −1.66617 | 7.92268 |
| −1.36595 | 1.962735 | 7.92268 | 1.045585 | −1.69626 | 7.92268 |
| −1.37216 | 1.989595 | 7.92268 | 1.061905 | −1.721 | 7.92268 |
| −1.37462 | 2.010165 | 7.92268 | 1.074995 | −1.74072 | 7.92268 |
| −1.37428 | 2.02164 | 7.92268 | 1.08511 | −1.75593 | 7.92268 |
| −1.37233 | 2.02878 | 7.92268 | 1.090295 | −1.76851 | 7.92268 |
| −1.37029 | 2.03184 | 7.92268 | 1.08953 | −1.77999 | 7.92268 |
| −1.36893 | 2.03303 | 7.92268 | 1.08545 | −1.78832 | 7.92268 |
| 1.05145 | −1.81118 | 8.22732 | −1.35303 | 2.067625 | 8.22732 |
| 1.045415 | −1.81475 | 8.22732 | −1.35218 | 2.067965 | 8.22732 |
| 1.03649 | −1.81679 | 8.22732 | −1.35031 | 2.068305 | 8.22732 |
| 1.0251 | −1.81475 | 8.22732 | −1.34666 | 2.067965 | 8.22732 |
| 1.01422 | −1.80625 | 8.22732 | −1.33994 | 2.06482 | 8.22732 |
| 1.001895 | −1.79257 | 8.22732 | −1.33076 | 2.05785 | 8.22732 |
| 0.985745 | −1.77463 | 8.22732 | −1.31631 | 2.04306 | 8.22732 |
| 0.965685 | −1.75228 | 8.22732 | −1.29914 | 2.021725 | 8.22732 |
| 0.941375 | −1.72499 | 8.22732 | −1.27798 | 1.991805 | 8.22732 |
| 0.91256 | −1.69244 | 8.22732 | −1.25307 | 1.953385 | 8.22732 |
| 0.8789 | −1.65419 | 8.22732 | −1.22137 | 1.90298 | 8.22732 |
| 0.839375 | −1.60888 | 8.22732 | −1.18482 | 1.844755 | 8.22732 |
| 0.793985 | −1.55644 | 8.22732 | −1.14572 | 1.78279 | 8.22732 |
| 0.7429 | −1.49668 | 8.22732 | −1.10152 | 1.713175 | 8.22732 |
| 0.68629 | −1.42945 | 8.22732 | −1.05222 | 1.63591 | 8.22732 |
| 0.62424 | −1.35473 | 8.22732 | −0.9979 | 1.550995 | 8.22732 |
| 0.55692 | −1.27237 | 8.22732 | −0.94121 | 1.46217 | 8.22732 |
| 0.487475 | −1.18575 | 8.22732 | −0.8823 | 1.36935 | 8.22732 |
| 0.41616 | −1.09489 | 8.22732 | −0.82127 | 1.27245 | 8.22732 |
| 0.34289 | −0.99977 | 8.22732 | −0.75803 | 1.17147 | 8.22732 |
| 0.268005 | −0.90015 | 8.22732 | −0.69275 | 1.06641 | 8.22732 |
| 0.19159 | −0.79611 | 8.22732 | −0.62535 | 0.95727 | 8.22732 |
| 0.11373 | −0.68748 | 8.22732 | −0.55582 | 0.84405 | 8.22732 |
| 0.034595 | −0.57418 | 8.22732 | −0.48408 | 0.726835 | 8.22732 |
| −0.0431 | −0.45994 | 8.22732 | −0.41251 | 0.60945 | 8.22732 |
| −0.11926 | −0.34476 | 8.22732 | −0.34119 | 0.49198 | 8.22732 |
| −0.19397 | −0.22857 | 8.22732 | −0.26979 | 0.37451 | 8.22732 |
| −0.26724 | −0.11135 | 8.22732 | −0.19848 | 0.25704 | 8.22732 |
| −0.33924 | 0.00663 | 8.22732 | −0.12691 | 0.13974 | 8.22732 |
| −0.41013 | 0.125375 | 8.22732 | −0.05508 | 0.022525 | 8.22732 |

TABLE 2-continued

| SUCTION SIDE | | | PRESSURE SIDE | | |
|---|---|---|---|---|---|
| X | Y | Z | X | Y | Z |
| −0.47991 | 0.2448 | 8.22732 | 0.016745 | −0.09461 | 8.22732 |
| −0.54876 | 0.364905 | 8.22732 | 0.08857 | −0.21191 | 8.22732 |
| −0.61668 | 0.48552 | 8.22732 | 0.16014 | −0.32921 | 8.22732 |
| −0.68374 | 0.606815 | 8.22732 | 0.23171 | −0.44659 | 8.22732 |
| −0.74996 | 0.728535 | 8.22732 | 0.303195 | −0.56398 | 8.22732 |
| −0.81311 | 0.1846685 | 8.22732 | 0.3723 | −0.67745 | 8.22732 |
| −0.87329 | 0.196118 | 8.22732 | 0.439025 | −0.78693 | 8.22732 |
| −0.93058 | 1.071935 | 8.22732 | 0.503455 | −0.8925 | 8.22732 |
| −0.98498 | 1.179035 | 8.22732 | 0.565675 | −0.99416 | 8.22732 |
| −1.03666 | 1.28231 | 8.22732 | 0.625685 | −1.09174 | 8.22732 |
| −1.08554 | 1.381845 | 8.22732 | 0.6834 | −1.18533 | 8.22732 |
| −1.13161 | 1.477555 | 8.22732 | 0.738905 | −1.27483 | 8.22732 |
| −1.17479 | 1.56961 | 8.22732 | 0.78982 | −1.35652 | 8.22732 |
| −1.21304 | 1.65376 | 8.22732 | 0.83606 | −1.43021 | 8.22732 |
| −1.24661 | 1.72975 | 8.22732 | 0.877625 | −1.49609 | 8.22732 |
| −1.27568 | 1.79775 | 8.22732 | 0.91443 | −1.55414 | 8.22732 |
| −1.30203 | 1.86184 | 8.22732 | 0.946475 | −1.60438 | 8.22732 |
| −1.32405 | 1.91777 | 8.22732 | 0.97359 | −1.64679 | 8.22732 |
| −1.33977 | 1.961205 | 8.22732 | 0.996965 | −1.683 | 8.22732 |
| −1.35057 | 1.996565 | 8.22732 | 1.0166 | −1.71335 | 8.22732 |
| −1.35677 | 2.02351 | 8.22732 | 1.032835 | −1.73834 | 8.22732 |
| −1.35932 | 2.044165 | 8.22732 | 1.04584 | −1.75831 | 8.22732 |
| −1.35907 | 2.055725 | 8.22732 | 1.05587 | −1.7737 | 8.22732 |
| −1.3572 | 2.062865 | 8.22732 | 1.061225 | −1.78628 | 8.22732 |
| −1.35524 | 2.065925 | 8.22732 | 1.060375 | −1.79784 | 8.22732 |
| −1.35388 | 2.067115 | 8.22732 | 1.056295 | −1.80617 | 8.22732 |
| 1.01983 | −1.83209 | 8.53196 | −1.33212 | 2.104175 | 8.53196 |
| 1.013795 | −1.83558 | 8.53196 | −1.33127 | 2.104515 | 8.53196 |
| 1.0047 | −1.83736 | 8.53196 | −1.3294 | 2.104855 | 8.53196 |
| 0.993395 | −1.83481 | 8.53196 | −1.32566 | 2.10426 | 8.53196 |
| 0.982855 | −1.82589 | 8.53196 | −1.31903 | 2.100945 | 8.53196 |
| 0.97087 | −1.81169 | 8.53196 | −1.31011 | 2.093635 | 8.53196 |
| 0.95523 | −1.79333 | 8.53196 | −1.29608 | 2.078335 | 8.53196 |
| 0.93568 | −1.7703 | 8.53196 | −1.27934 | 2.056405 | 8.53196 |
| 0.91205 | −1.74233 | 8.53196 | −1.25894 | 2.02589 | 8.53196 |
| 0.884 | −1.70893 | 8.53196 | −1.2348 | 1.98662 | 8.53196 |
| 0.85136 | −1.66966 | 8.53196 | −1.20428 | 1.935195 | 8.53196 |
| 0.81294 | −1.62316 | 8.53196 | −1.16892 | 1.875865 | 8.53196 |
| 0.76891 | −1.56927 | 8.53196 | −1.1311 | 1.81271 | 8.53196 |
| 0.71927 | −1.50799 | 8.53196 | −1.08826 | 1.741735 | 8.53196 |
| 0.664275 | −1.43914 | 8.53196 | −1.0404 | 1.66311 | 8.53196 |
| 0.60401 | −1.36255 | 8.53196 | −0.9877 | 1.576665 | 8.53196 |
| 0.538645 | −1.27815 | 8.53196 | −0.93262 | 1.486225 | 8.53196 |
| 0.47124 | −1.18958 | 8.53196 | −0.87542 | 1.39179 | 8.53196 |
| 0.40188 | −1.09676 | 8.53196 | −0.816 | 1.29319 | 8.53196 |
| 0.33082 | −0.99952 | 8.53196 | −0.75446 | 1.190595 | 8.53196 |
| 0.257975 | −0.89794 | 8.53196 | −0.69088 | 1.08375 | 8.53196 |
| 0.183685 | −0.79186 | 8.53196 | −0.62526 | 0.97291 | 8.53196 |
| 0.10795 | −0.68111 | 8.53196 | −0.55743 | 0.857905 | 8.53196 |
| 0.030855 | −0.56568 | 8.53196 | −0.48748 | 0.73882 | 8.53196 |
| −0.0448 | −0.4494 | 8.53196 | −0.41769 | 0.61965 | 8.53196 |
| −0.11909 | −0.33218 | 8.53196 | −0.34808 | 0.500395 | 8.53196 |
| −0.19202 | −0.21412 | 8.53196 | −0.27846 | 0.381225 | 8.53196 |
| −0.26359 | −0.0952 | 8.53196 | −0.20876 | 0.26197 | 8.53196 |
| −0.33388 | 0.024565 | 8.53196 | −0.13889 | 0.142885 | 8.53196 |
| −0.40324 | 0.14501 | 8.53196 | −0.06868 | 0.02397 | 8.53196 |
| −0.47167 | 0.26605 | 8.53196 | 0.001615 | −0.09486 | 8.53196 |
| −0.53907 | 0.387685 | 8.53196 | 0.071825 | −0.21378 | 8.53196 |
| −0.60571 | 0.509745 | 8.53196 | 0.14195 | −0.33269 | 8.53196 |
| −0.67159 | 0.632315 | 8.53196 | 0.212075 | −0.45169 | 8.53196 |
| −0.73661 | 0.755225 | 8.53196 | 0.282115 | −0.57069 | 8.53196 |
| −0.79875 | 0.874565 | 8.53196 | 0.349945 | −0.6857 | 8.53196 |
| −0.85799 | 0.99008 | 8.53196 | 0.41548 | −0.79662 | 8.53196 |
| −0.91443 | 1.101855 | 8.53196 | 0.478805 | −0.90355 | 8.53196 |
| −0.96807 | 1.209805 | 8.53196 | 0.540005 | −1.0064 | 8.53196 |
| −1.01907 | 1.31393 | 8.53196 | 0.598995 | −1.10517 | 8.53196 |
| −1.06735 | 1.414145 | 8.53196 | 0.65586 | −1.19986 | 8.53196 |
| −1.11291 | 1.51062 | 8.53196 | 0.710685 | −1.29047 | 8.53196 |
| −1.15566 | 1.60327 | 8.53196 | 0.76092 | −1.37309 | 8.53196 |
| −1.19349 | 1.68793 | 8.53196 | 0.806565 | −1.44764 | 8.53196 |
| −1.22681 | 1.76443 | 8.53196 | 0.84762 | −1.51428 | 8.53196 |
| −1.25554 | 1.832855 | 8.53196 | 0.884085 | −1.57293 | 8.53196 |
| −1.28163 | 1.897285 | 8.53196 | 0.91579 | −1.62367 | 8.53196 |
| −1.30348 | 1.953555 | 8.53196 | 0.942735 | −1.66651 | 8.53196 |
| −1.31895 | 1.997245 | 8.53196 | 0.965855 | −1.70306 | 8.53196 |
| −1.32966 | 2.032775 | 8.53196 | 0.98532 | −1.73375 | 8.53196 |

TABLE 2-continued

| SUCTION SIDE | | | PRESSURE SIDE | | |
|---|---|---|---|---|---|
| X | Y | Z | X | Y | Z |
| −1.33578 | 2.05989 | 8.53196 | 1.00147 | −1.75899 | 8.53196 |
| −1.33833 | 2.08063 | 8.53196 | 1.014305 | −1.77914 | 8.53196 |
| −1.33807 | 2.09219 | 8.53196 | 1.02425 | −1.79469 | 8.53196 |
| −1.33629 | 2.099415 | 8.53196 | 1.029775 | −1.80727 | 8.53196 |
| −1.33433 | 2.102475 | 8.53196 | 1.02901 | −1.81883 | 8.53196 |
| −1.33297 | 2.10375 | 8.53196 | 1.024845 | −1.82716 | 8.53196 |
| 0.98277 | −1.84986 | 8.836515 | −1.30016 | 2.14404 | 8.836515 |
| 0.97665 | −1.85326 | 8.836515 | −1.29923 | 2.144295 | 8.836515 |
| 0.96747 | −1.85479 | 8.836515 | −1.29736 | 2.14455 | 8.836515 |
| 0.956165 | −1.8519 | 8.836515 | −1.2937 | 2.14387 | 8.836515 |
| 0.94605 | −1.84238 | 8.836515 | −1.28716 | 2.1403 | 8.836515 |
| 0.93432 | −1.82793 | 8.836515 | −1.27849 | 2.13265 | 8.836515 |
| 0.91919 | −1.80914 | 8.836515 | −1.2648 | 2.116925 | 8.836515 |
| 0.900235 | −1.7856 | 8.836515 | −1.24874 | 2.094485 | 8.836515 |
| 0.8772 | −1.75695 | 8.836515 | −1.2291 | 2.063205 | 8.836515 |
| 0.85 | −1.7227 | 8.836515 | −1.20598 | 2.023255 | 8.836515 |
| 0.818295 | −1.68258 | 8.836515 | −1.17683 | 1.97081 | 8.836515 |
| 0.781065 | −1.63498 | 8.836515 | −1.143 | 1.91029 | 8.836515 |
| 0.73831 | −1.5799 | 8.836515 | −1.10679 | 1.845945 | 8.836515 |
| 0.6902 | −1.51717 | 8.836515 | −1.06565 | 1.773695 | 8.836515 |
| 0.636905 | −1.4467 | 8.836515 | −1.01966 | 1.693625 | 8.836515 |
| 0.57851 | −1.36842 | 8.836515 | −0.969 | 1.605565 | 8.836515 |
| 0.51527 | −1.28214 | 8.836515 | −0.91596 | 1.51351 | 8.836515 |
| 0.45016 | −1.1917 | 8.836515 | −0.8608 | 1.417375 | 8.836515 |
| 0.383095 | −1.09693 | 8.836515 | −0.80359 | 1.31716 | 8.836515 |
| 0.31433 | −0.99773 | 8.836515 | −0.74426 | 1.21278 | 8.836515 |
| 0.243865 | −0.89403 | 8.836515 | −0.68289 | 1.104235 | 8.836515 |
| 0.171955 | −0.78583 | 8.836515 | −0.61948 | 0.99161 | 8.836515 |
| 0.098685 | −0.67303 | 8.836515 | −0.55403 | 0.874735 | 8.836515 |
| 0.024225 | −0.55548 | 8.836515 | −0.48646 | 0.753865 | 8.836515 |
| −0.04896 | −0.43716 | 8.836515 | −0.41905 | 0.632825 | 8.836515 |
| −0.12087 | −0.3179 | 8.836515 | −0.35173 | 0.5117 | 8.836515 |
| −0.19134 | −0.1978 | 8.836515 | −0.28441 | 0.39066 | 8.836515 |
| −0.26061 | −0.07693 | 8.836515 | −0.21701 | 0.26962 | 8.836515 |
| −0.3287 | 0.04471 | 8.836515 | −0.14943 | 0.14875 | 8.836515 |
| −0.39593 | 0.166855 | 8.836515 | −0.08143 | 0.027965 | 8.836515 |
| −0.46223 | 0.28951 | 8.836515 | −0.01335 | −0.09265 | 8.836515 |
| −0.52768 | 0.412675 | 8.836515 | 0.054825 | −0.21327 | 8.836515 |
| −0.59237 | 0.53618 | 8.836515 | 0.12291 | −0.33388 | 8.836515 |
| −0.65637 | 0.66011 | 8.836515 | 0.19091 | −0.45458 | 8.836515 |
| −0.7197 | 0.78438 | 8.836515 | 0.258995 | −0.5752 | 8.836515 |
| −0.7803 | 0.904825 | 8.836515 | 0.32487 | −0.69182 | 8.836515 |
| −0.8381 | 1.021445 | 8.836515 | 0.388705 | −0.80427 | 8.836515 |
| −0.89318 | 1.13424 | 8.836515 | 0.4505 | −0.91256 | 8.836515 |
| −0.94563 | 1.243125 | 8.836515 | 0.51017 | −1.01669 | 8.836515 |
| −0.99544 | 1.3481 | 8.836515 | 0.567885 | −1.11665 | 8.836515 |
| −1.04261 | 1.44925 | 8.836515 | 0.623645 | −1.21244 | 8.836515 |
| −1.08715 | 1.546405 | 8.836515 | 0.677365 | −1.30407 | 8.836515 |
| −1.12889 | 1.63982 | 8.836515 | 0.726835 | −1.38754 | 8.836515 |
| −1.16586 | 1.725075 | 8.836515 | 0.7718 | −1.46285 | 8.836515 |
| −1.19842 | 1.80217 | 8.836515 | 0.812345 | −1.53009 | 8.836515 |
| −1.22647 | 1.871105 | 8.836515 | 0.848385 | −1.58925 | 8.836515 |
| −1.25188 | 1.936045 | 8.836515 | 0.87975 | −1.64042 | 8.836515 |
| −1.27313 | 1.99257 | 8.836515 | 0.90644 | −1.68368 | 8.836515 |
| −1.28809 | 2.0366 | 8.836515 | 0.929305 | −1.72049 | 8.836515 |
| −1.29838 | 2.072385 | 8.836515 | 0.948685 | −1.75143 | 8.836515 |
| −1.30416 | 2.09967 | 8.836515 | 0.96458 | −1.77684 | 8.836515 |
| −1.30654 | 2.12041 | 8.836515 | 0.977415 | −1.79716 | 8.836515 |
| −1.30611 | 2.132055 | 8.836515 | 0.987275 | −1.8128 | 8.836515 |
| −1.30433 | 2.139195 | 8.836515 | 0.9928 | −1.82538 | 8.836515 |
| −1.30237 | 2.14234 | 8.836515 | 0.99195 | −1.83685 | 8.836515 |
| −1.30093 | 2.14353 | 8.836515 | 0.9877 | −1.84501 | 8.836515 |
| 0.95132 | −1.85368 | 9.056155 | −1.27279 | 2.18008 | 9.056155 |
| 0.945115 | −1.857 | 9.056155 | −1.27186 | 2.180335 | 9.056155 |
| 0.935935 | −1.85844 | 9.056155 | −1.26999 | 2.180505 | 9.056155 |
| 0.924715 | −1.85521 | 9.056155 | −1.26633 | 2.17974 | 9.056155 |
| 0.914855 | −1.84544 | 9.056155 | −1.25996 | 2.175915 | 9.056155 |
| 0.90338 | −1.83082 | 9.056155 | −1.25146 | 2.16801 | 9.056155 |
| 0.88842 | −1.81178 | 9.056155 | −1.23828 | 2.15186 | 9.056155 |
| 0.869805 | −1.78789 | 9.056155 | −1.22273 | 2.128995 | 9.056155 |
| 0.84728 | −1.75882 | 9.056155 | −1.20386 | 2.097205 | 9.056155 |
| 0.82059 | −1.72423 | 9.056155 | −1.18167 | 2.05666 | 9.056155 |
| 0.78948 | −1.68351 | 9.056155 | −1.15371 | 2.00345 | 9.056155 |
| 0.753015 | −1.63532 | 9.056155 | −1.12132 | 1.942165 | 9.056155 |
| 0.71111 | −1.57947 | 9.056155 | −1.08656 | 1.876885 | 9.056155 |
| 0.66402 | −1.51581 | 9.056155 | −1.04695 | 1.8037 | 9.056155 |

TABLE 2-continued

| SUCTION SIDE | | | PRESSURE SIDE | | |
|---|---|---|---|---|---|
| X | Y | Z | X | Y | Z |
| 0.611915 | −1.44441 | 9.056155 | −1.00266 | 1.722525 | 9.056155 |
| 0.55488 | −1.3651 | 9.056155 | −0.9537 | 1.63336 | 9.056155 |
| 0.493085 | −1.27772 | 9.056155 | −0.90253 | 1.5402 | 9.056155 |
| 0.429505 | −1.18601 | 9.056155 | −0.84915 | 1.442875 | 9.056155 |
| 0.364055 | −1.08996 | 9.056155 | −0.79382 | 1.34147 | 9.056155 |
| 0.297075 | −0.98949 | 9.056155 | −0.73644 | 1.2359 | 9.056155 |
| 0.22848 | −0.88451 | 9.056155 | −0.67703 | 1.12608 | 9.056155 |
| 0.15844 | −0.77486 | 9.056155 | −0.61557 | 1.01218 | 9.056155 |
| 0.087125 | −0.66062 | 9.056155 | −0.55208 | 0.894115 | 9.056155 |
| 0.01462 | −0.54162 | 9.056155 | −0.48663 | 0.771885 | 9.056155 |
| −0.05661 | −0.42186 | 9.056155 | −0.42126 | 0.64957 | 9.056155 |
| −0.1264 | −0.30116 | 9.056155 | −0.35598 | 0.52717 | 9.056155 |
| −0.19491 | −0.17969 | 9.056155 | −0.2907 | 0.404855 | 9.056155 |
| −0.26214 | −0.05746 | 9.056155 | −0.22525 | 0.28254 | 9.056155 |
| −0.32836 | 0.065535 | 9.056155 | −0.15955 | 0.160395 | 9.056155 |
| −0.39364 | 0.18887 | 9.056155 | −0.0935 | 0.038505 | 9.056155 |
| −0.45807 | 0.312715 | 9.056155 | −0.0272 | −0.0833 | 9.056155 |
| −0.52165 | 0.436985 | 9.056155 | 0.039185 | −0.20511 | 9.056155 |
| −0.58455 | 0.561595 | 9.056155 | 0.10557 | −0.32683 | 9.056155 |
| −0.64677 | 0.686545 | 9.056155 | 0.171955 | −0.44863 | 9.056155 |
| −0.70839 | 0.811835 | 9.056155 | 0.238425 | −0.57035 | 9.056155 |
| −0.76738 | 0.933215 | 9.056155 | 0.302855 | −0.68791 | 9.056155 |
| −0.82365 | 1.05077 | 9.056155 | 0.36533 | −0.80121 | 9.056155 |
| −0.87737 | 1.16433 | 9.056155 | 0.425935 | −0.91035 | 9.056155 |
| −0.92854 | 1.27398 | 9.056155 | 0.4845 | −1.01533 | 9.056155 |
| −0.97708 | 1.37972 | 9.056155 | 0.54128 | −1.11597 | 9.056155 |
| −1.02306 | 1.481465 | 9.056155 | 0.596105 | −1.21244 | 9.056155 |
| −1.0665 | 1.5793 | 9.056155 | 0.64906 | −1.30467 | 9.056155 |
| −1.10721 | 1.673225 | 9.056155 | 0.697765 | −1.38865 | 9.056155 |
| −1.14325 | 1.759075 | 9.056155 | 0.74222 | −1.46438 | 9.056155 |
| −1.17487 | 1.836595 | 9.056155 | 0.782255 | −1.53204 | 9.056155 |
| −1.20216 | 1.90587 | 9.056155 | 0.81787 | −1.59154 | 9.056155 |
| −1.22681 | 1.971235 | 9.056155 | 0.848895 | −1.64297 | 9.056155 |
| −1.24738 | 2.0281 | 9.056155 | 0.87533 | −1.6864 | 9.056155 |
| −1.26183 | 2.0723 | 9.056155 | 0.898025 | −1.72346 | 9.056155 |
| −1.2716 | 2.108255 | 9.056155 | 0.917235 | −1.75457 | 9.056155 |
| −1.27713 | 2.135625 | 9.056155 | 0.933045 | −1.78016 | 9.056155 |
| −1.27925 | 2.15645 | 9.056155 | 0.94571 | −1.80056 | 9.056155 |
| −1.27883 | 2.168095 | 9.056155 | 0.955485 | −1.8162 | 9.056155 |
| −1.27696 | 2.175235 | 9.056155 | 0.961265 | −1.82878 | 9.056155 |
| −1.275 | 2.17838 | 9.056155 | 0.96067 | −1.84042 | 9.056155 |
| −1.27364 | 2.17957 | 9.056155 | 0.95642 | −1.84875 | 9.056155 |
| 0.89845 | −1.85054 | 9.396155 | −1.22749 | 2.25182 | 9.396155 |
| 0.89216 | −1.85385 | 9.396155 | −1.22664 | 2.252075 | 9.396155 |
| 0.88281 | −1.85504 | 9.396155 | −1.22477 | 2.25216 | 9.396155 |
| 0.87176 | −1.85139 | 9.396155 | −1.22111 | 2.251055 | 9.396155 |
| 0.86224 | −1.8411 | 9.396155 | −1.21508 | 2.246805 | 9.396155 |
| 0.85102 | −1.82614 | 9.396155 | −1.207 | 2.238305 | 9.396155 |
| 0.8364 | −1.80668 | 9.396155 | −1.19476 | 2.221475 | 9.396155 |
| 0.81821 | −1.78237 | 9.396155 | −1.1804 | 2.19776 | 9.396155 |
| 0.79628 | −1.7527 | 9.396155 | −1.16297 | 2.16495 | 9.396155 |
| 0.770185 | −1.71734 | 9.396155 | −1.14274 | 2.123215 | 9.396155 |
| 0.739925 | −1.67578 | 9.396155 | −1.11716 | 2.068645 | 9.396155 |
| 0.70431 | −1.62648 | 9.396155 | −1.08741 | 2.00583 | 9.396155 |
| 0.663595 | −1.56944 | 9.396155 | −1.05511 | 1.93902 | 9.396155 |
| 0.617865 | −1.50442 | 9.396155 | −1.0183 | 1.864135 | 9.396155 |
| 0.56729 | −1.4314 | 9.396155 | −0.97699 | 1.78109 | 9.396155 |
| 0.51204 | −1.35031 | 9.396155 | −0.93118 | 1.68997 | 9.396155 |
| 0.452285 | −1.26098 | 9.396155 | −0.88315 | 1.59477 | 9.396155 |
| 0.39083 | −1.16714 | 9.396155 | −0.833 | 1.495405 | 9.396155 |
| 0.327675 | −1.06888 | 9.396155 | −0.78081 | 1.39196 | 9.396155 |
| 0.263075 | −0.96611 | 9.396155 | −0.72667 | 1.28418 | 9.396155 |
| 0.1972 | −0.85884 | 9.396155 | −0.67057 | 1.17232 | 9.396155 |
| 0.129965 | −0.7469 | 9.396155 | −0.61243 | 1.05621 | 9.396155 |
| 0.061625 | −0.63028 | 9.396155 | −0.55242 | 0.935935 | 9.396155 |
| −0.00765 | −0.5089 | 9.396155 | −0.49037 | 0.81141 | 9.396155 |
| −0.07565 | −0.38684 | 9.396155 | −0.4284 | 0.686885 | 9.396155 |
| −0.14221 | −0.26401 | 9.396155 | −0.36644 | 0.56236 | 9.396155 |
| −0.2074 | −0.14051 | 9.396155 | −0.30447 | 0.437835 | 9.396155 |
| −0.27132 | −0.01624 | 9.396155 | −0.24225 | 0.313395 | 9.396155 |
| −0.33422 | 0.108545 | 9.396155 | −0.17969 | 0.18921 | 9.396155 |
| −0.3961 | 0.233835 | 9.396155 | −0.11671 | 0.065195 | 9.396155 |
| −0.45722 | 0.359635 | 9.396155 | −0.0533 | −0.05865 | 9.396155 |
| −0.51748 | 0.485775 | 9.396155 | 0.010285 | −0.18233 | 9.396155 |
| −0.57707 | 0.61234 | 9.396155 | 0.07412 | −0.30592 | 9.396155 |
| −0.63614 | 0.73916 | 9.396155 | 0.13804 | −0.42942 | 9.396155 |

TABLE 2-continued

| SUCTION SIDE | | | PRESSURE SIDE | | |
|---|---|---|---|---|---|
| X | Y | Z | X | Y | Z |
| −0.69454 | 0.86632 | 9.396155 | 0.2023 | −0.55284 | 9.396155 |
| −0.75047 | 0.98957 | 9.396155 | 0.264605 | −0.67193 | 9.396155 |
| −0.80385 | 1.108825 | 9.396155 | 0.32521 | −0.78676 | 9.396155 |
| −0.85476 | 1.224085 | 9.396155 | 0.38403 | −0.89726 | 9.396155 |
| −0.90321 | 1.335265 | 9.396155 | 0.441065 | −1.00351 | 9.396155 |
| −0.94928 | 1.044245 | 9.396155 | 0.496315 | −1.10534 | 9.396155 |
| −0.99289 | 1.545555 | 9.396155 | 0.549865 | −1.20292 | 9.396155 |
| −1.03411 | 1.644665 | 9.396155 | 0.60163 | −1.29617 | 9.396155 |
| −1.07262 | 1.739865 | 9.396155 | 0.649315 | −1.38108 | 9.396155 |
| −1.1067 | 1.826735 | 9.396155 | 0.692835 | −1.45767 | 9.396155 |
| −1.13662 | 1.90519 | 9.396155 | 0.732105 | −1.52601 | 9.396155 |
| −1.16229 | 1.975315 | 9.396155 | 0.76704 | −1.5861 | 9.396155 |
| −1.1855 | 2.04136 | 9.396155 | 0.797555 | −1.63812 | 9.396155 |
| −1.20471 | 1.09882 | 9.396155 | 0.823565 | −1.68198 | 9.396155 |
| −1.21831 | 2.14353 | 9.396155 | 0.84592 | −1.71947 | 9.396155 |
| −1.22732 | 2.17974 | 9.396155 | 0.86479 | −1.75083 | 9.396155 |
| −1.23233 | 2.20728 | 9.396155 | 0.880345 | −1.77667 | 9.396155 |
| −1.23412 | 2.22819 | 9.396155 | 0.89284 | −1.79724 | 9.396155 |
| −1.23352 | 2.239835 | 9.396155 | 0.90253 | −1.81305 | 9.396155 |
| −1.23174 | 2.24706 | 9.396155 | 0.908395 | −1.82572 | 9.396155 |
| −1.22978 | 2.250205 | 9.396155 | 0.9078 | −1.83736 | 9.396155 |
| −1.22834 | 2.251395 | 9.396155 | 0.90355 | −1.84569 | 9.396155 |
| 0.852805 | −1.84654 | 9.685155 | −1.18805 | 2.31931 | 9.685155 |
| 0.846515 | −1.84977 | 9.685155 | −1.18711 | 2.319565 | 9.685155 |
| 0.837165 | −1.85071 | 9.685155 | −1.18524 | 2.31948 | 9.685155 |
| 0.8262 | −1.84646 | 9.685155 | −1.18176 | 2.31812 | 9.685155 |
| 0.816935 | −1.83592 | 9.685155 | −1.17598 | 2.31336 | 9.685155 |
| 0.80597 | −1.8207 | 9.685155 | −1.16841 | 2.30435 | 9.685155 |
| 0.79169 | −1.80098 | 9.685155 | −1.15702 | 2.28684 | 9.685155 |
| 0.77384 | −1.77625 | 9.685155 | −1.14376 | 2.262275 | 9.685155 |
| 0.75225 | −1.74616 | 9.685155 | −1.12787 | 2.228615 | 9.685155 |
| 0.72675 | −1.7102 | 9.685155 | −1.10942 | 2.18586 | 9.685155 |
| 0.69717 | −1.66796 | 9.685155 | −1.08596 | 2.1301 | 9.685155 |
| 0.662405 | −1.61789 | 9.685155 | −1.05851 | 2.06584 | 9.685155 |
| 0.62271 | −1.55992 | 9.685155 | −1.02859 | 1.99767 | 9.685155 |
| 0.57817 | −1.49379 | 9.685155 | −0.99425 | 1.92117 | 9.685155 |
| 0.528955 | −1.41959 | 9.685155 | −0.95566 | 1.83651 | 9.685155 |
| 0.475235 | −1.33714 | 9.685155 | −0.91265 | 1.74352 | 9.685155 |
| 0.417265 | −1.24627 | 9.685155 | −0.86734 | 1.646535 | 9.685155 |
| 0.35768 | −1.1509 | 9.685155 | −0.82 | 1.5453 | 9.685155 |
| 0.296735 | −1.05103 | 9.685155 | −0.7707 | 1.4399 | 9.685155 |
| 0.234345 | −0.94665 | 9.685155 | −0.71944 | 1.33025 | 9.685155 |
| 0.170765 | −0.83751 | 9.685155 | −0.66623 | 1.21635 | 9.685155 |
| 0.105995 | −0.72369 | 9.685155 | −0.61107 | 1.098285 | 9.685155 |
| 0.040205 | −0.6052 | 9.685155 | −0.55403 | 0.975885 | 9.685155 |
| −0.02644 | −0.48178 | 9.685155 | −0.49496 | 0.84932 | 9.685155 |
| −0.0918 | −0.3576 | 9.685155 | −0.43597 | 0.722755 | 9.685155 |
| −0.15572 | −0.23273 | 9.685155 | −0.37689 | 0.59619 | 9.685155 |
| −0.21837 | −0.1071 | 9.685155 | −0.31765 | 0.46971 | 9.685155 |
| −0.27965 | 0.01921 | 9.685155 | −0.25815 | 0.3434 | 9.685155 |
| −0.33992 | 0.146115 | 9.685155 | −0.19831 | 0.217175 | 9.685155 |
| −0.39925 | 0.273615 | 9.685155 | −0.13787 | 0.09129 | 9.685155 |
| −0.45756 | 0.401455 | 9.685155 | −0.07693 | −0.03443 | 9.685155 |
| −0.5151 | 0.52972 | 9.685155 | −0.01556 | −0.1598 | 9.685155 |
| −0.57197 | 0.65824 | 9.685155 | 0.04607 | −0.28518 | 9.685155 |
| −0.62815 | 0.7871 | 9.685155 | 0.10812 | −0.4103 | 9.685155 |
| −0.68366 | 0.916215 | 9.685155 | 0.170425 | −0.53525 | 9.685155 |
| −0.73678 | 1.04125 | 9.685155 | 0.231115 | −0.65586 | 9.685155 |
| −0.78753 | 1.162205 | 9.685155 | 0.29019 | −0.77206 | 9.685155 |
| −0.83589 | 1.27908 | 9.685155 | 0.34765 | −0.88383 | 9.685155 |
| −0.88188 | 1.391875 | 9.685155 | 0.40341 | −0.99127 | 9.685155 |
| −0.92565 | 1.500505 | 9.685155 | 0.45747 | −1.09429 | 9.685155 |
| −0.96705 | 1.605055 | 9.685155 | 0.509915 | −1.19298 | 9.685155 |
| −1.00606 | 1.705525 | 9.685155 | 0.560745 | −1.28724 | 9.685155 |
| −1.04261 | 1.801915 | 9.685155 | 0.60758 | −1.37309 | 9.685155 |
| −1.07491 | 1.88989 | 9.685155 | 0.650335 | −1.45044 | 9.685155 |
| −1.10313 | 1.969365 | 9.685155 | 0.68901 | −1.51955 | 9.685155 |
| −1.12744 | 2.040255 | 9.685155 | 0.723435 | −1.58032 | 9.685155 |
| −1.14979 | 2.107065 | 9.685155 | 0.753525 | −1.63285 | 9.685155 |
| −1.16748 | 2.165205 | 9.685155 | 0.77911 | −1.67722 | 9.685155 |
| −1.18014 | 2.210255 | 9.685155 | 0.801125 | −1.71496 | 9.685155 |
| −1.18856 | 2.246805 | 9.685155 | 0.81974 | −1.74667 | 9.685155 |
| −1.19315 | 2.274515 | 9.685155 | 0.835125 | −1.77276 | 9.685155 |
| −1.19468 | 2.295595 | 9.685155 | 0.847535 | −1.79359 | 9.685155 |
| −1.194 | 2.30724 | 9.685155 | 0.857055 | −1.80957 | 9.685155 |
| −1.19221 | 2.31455 | 9.685155 | 0.862665 | −1.82215 | 9.685155 |

TABLE 2-continued

| SUCTION SIDE | | | PRESSURE SIDE | | |
|---|---|---|---|---|---|
| X | Y | Z | X | Y | Z |
| −1.19034 | 2.317695 | 9.685155 | 0.861985 | −1.83362 | 9.685155 |
| −1.1889 | 2.318885 | 9.685155 | 0.85782 | −1.84178 | 9.685155 |

TABLE 3

| SUCTION SIDE | | | PRESSURE SIDE | | |
|---|---|---|---|---|---|
| X | Y | Z | X | Y | Z |
| 2.0257 | −1.5466 | −0.2129 | −1.3293 | 1.7498 | −0.2129 |
| 2.0216 | −1.5529 | −0.2129 | −1.3284 | 1.7502 | −0.2129 |
| 2.0147 | −1.5599 | −0.2129 | −1.3266 | 1.7510 | −0.2129 |
| 2.0040 | −1.5663 | −0.2129 | −1.3231 | 1.7521 | −0.2129 |
| 1.9895 | −1.5697 | −0.2129 | −1.3154 | 1.7531 | −0.2129 |
| 1.9700 | −1.5665 | −0.2129 | −1.3035 | 1.7522 | −0.2129 |
| 1.9458 | −1.5568 | −0.2129 | −1.2831 | 1.7453 | −0.2129 |
| 1.9156 | −1.5445 | −0.2129 | −1.2583 | 1.7308 | −0.2129 |
| 1.8790 | −1.5296 | −0.2129 | −1.2285 | 1.7073 | −0.2129 |
| 1.8355 | −1.5117 | −0.2129 | −1.1941 | 1.6746 | −0.2129 |
| 1.7845 | −1.4906 | −0.2129 | −1.1521 | 1.6293 | −0.2129 |
| 1.7245 | −1.4655 | −0.2129 | −1.1058 | 1.5752 | −0.2129 |
| 1.6552 | −1.4362 | −0.2129 | −1.0576 | 1.5164 | −0.2129 |
| 1.5772 | −1.4024 | −0.2129 | −1.0037 | 1.4501 | −0.2129 |
| 1.4902 | −1.3639 | −0.2129 | −0.9435 | 1.3767 | −0.2129 |
| 1.3944 | −1.3205 | −0.2129 | −0.8774 | 1.2957 | −0.2129 |
| 1.2901 | −1.2716 | −0.2129 | −0.8084 | 1.2112 | −0.2129 |
| 1.1820 | −1.2193 | −0.2129 | −0.7358 | 1.1232 | −0.2129 |
| 1.0703 | −1.1631 | −0.2129 | −0.6600 | 1.0321 | −0.2129 |
| 0.9550 | −1.1028 | −0.2129 | −0.5805 | 0.9377 | −0.2129 |
| 0.8363 | −1.0379 | −0.2129 | −0.4974 | 0.8401 | −0.2129 |
| 0.7148 | −0.9684 | −0.2129 | −0.4104 | 0.7398 | −0.2129 |
| 0.5909 | −0.8939 | −0.2129 | −0.3194 | 0.6366 | −0.2129 |
| 0.4651 | −0.8140 | −0.2129 | −0.2243 | 0.5308 | −0.2129 |
| 0.3418 | −0.7311 | −0.2129 | −0.1282 | 0.4257 | −0.2129 |
| 0.2210 | −0.6451 | −0.2129 | −0.0311 | 0.3217 | −0.2129 |
| 0.1028 | −0.5559 | −0.2129 | 0.0668 | 0.2183 | −0.2129 |
| −0.0125 | −0.4632 | −0.2129 | 0.1650 | 0.1152 | −0.2129 |
| −0.1249 | −0.3669 | −0.2129 | 0.2634 | 0.0123 | −0.2129 |
| −0.2340 | −0.2664 | −0.2129 | 0.3623 | −0.0902 | −0.2129 |
| −0.3396 | −0.1618 | −0.2129 | 0.4619 | −0.1920 | −0.2129 |
| −0.4416 | −0.0529 | −0.2129 | 0.5624 | −0.2929 | −0.2129 |
| −0.5404 | 0.0601 | −0.2129 | 0.6638 | −0.3927 | −0.2129 |
| −0.6358 | 0.1773 | −0.2129 | 0.7665 | −0.4911 | −0.2129 |
| −0.7272 | 0.2977 | −0.2129 | 0.8707 | −0.5880 | −0.2129 |
| −0.8113 | 0.4171 | −0.2129 | 0.9728 | −0.6803 | −0.2129 |
| −0.8888 | 0.5349 | −0.2129 | 1.0727 | −0.7678 | −0.2129 |
| −0.9598 | 0.6511 | −0.2129 | 1.1705 | −0.8509 | −0.2129 |
| −1.0246 | 0.7651 | −0.2129 | 1.2656 | −0.9296 | −0.2129 |
| −1.0834 | 0.8766 | −0.2129 | 1.3581 | −1.0041 | −0.2129 |
| −1.1364 | 0.9854 | −0.2129 | 1.4476 | −1.0745 | −0.2129 |
| −1.1838 | 1.0913 | −0.2129 | 1.5342 | −1.1412 | −0.2129 |
| −1.2263 | 1.1938 | −0.2129 | 1.6138 | −1.2013 | −0.2129 |
| −1.2617 | 1.2883 | −0.2129 | 1.6863 | −1.2552 | −0.2129 |
| −1.2915 | 1.3741 | −0.2129 | 1.7515 | −1.3029 | −0.2129 |
| −1.3162 | 1.4508 | −0.2129 | 1.8091 | −1.3447 | −0.2129 |
| −1.3364 | 1.5239 | −0.2129 | 1.8593 | −1.3807 | −0.2129 |
| −1.3503 | 1.5880 | −0.2129 | 1.9018 | −1.4111 | −0.2129 |
| −1.3572 | 1.6380 | −0.2129 | 1.9382 | −1.4370 | −0.2129 |
| −1.3586 | 1.6783 | −0.2129 | 1.9688 | −1.4586 | −0.2129 |
| −1.3551 | 1.7083 | −0.2129 | 1.9940 | −1.4764 | −0.2129 |
| −1.3480 | 1.7300 | −0.2129 | 2.0142 | −1.4907 | −0.2129 |
| −1.3412 | 1.7405 | −0.2129 | 2.0262 | −1.5053 | −0.2129 |
| −1.3354 | 1.7461 | −0.2129 | 2.0306 | −1.5188 | −0.2129 |
| −1.3320 | 1.7484 | −0.2129 | 2.0308 | −1.5308 | −0.2129 |
| −1.3303 | 1.7493 | −0.2129 | 2.0287 | −1.5400 | −0.2129 |
| 2.0205 | −1.5195 | 0.0000 | −1.3573 | 1.7399 | 0.0000 |
| 2.0163 | −1.5257 | 0.0000 | −1.3564 | 1.7403 | 0.0000 |
| 2.0093 | −1.5326 | 0.0000 | −1.3546 | 1.7410 | 0.0000 |
| 1.9986 | −1.5388 | 0.0000 | −1.3511 | 1.7422 | 0.0000 |
| 1.9842 | −1.5420 | 0.0000 | −1.3434 | 1.7434 | 0.0000 |
| 1.9648 | −1.5388 | 0.0000 | −1.3316 | 1.7425 | 0.0000 |
| 1.9408 | −1.5289 | 0.0000 | −1.3112 | 1.7357 | 0.0000 |
| 1.9109 | −1.5166 | 0.0000 | −1.2865 | 1.7213 | 0.0000 |

TABLE 3-continued

| SUCTION SIDE | | | PRESSURE SIDE | | |
|---|---|---|---|---|---|
| X | Y | Z | X | Y | Z |
| 1.8745 | −1.5016 | 0.0000 | −1.2566 | 1.6983 | 0.0000 |
| 1.8313 | −1.4836 | 0.0000 | −1.2219 | 1.6659 | 0.0000 |
| 1.7808 | −1.4624 | 0.0000 | −1.1795 | 1.6213 | 0.0000 |
| 1.7212 | −1.4371 | 0.0000 | −1.1322 | 1.5683 | 0.0000 |
| 1.6526 | −1.4075 | 0.0000 | −1.0829 | 1.5108 | 0.0000 |
| 1.5751 | −1.3736 | 0.0000 | −1.0276 | 1.4460 | 0.0000 |
| 1.4887 | −1.3350 | 0.0000 | −0.9659 | 1.3742 | 0.0000 |
| 1.3936 | −1.2915 | 0.0000 | −0.8981 | 1.2952 | 0.0000 |
| 1.2901 | −1.2428 | 0.0000 | −0.8273 | 1.2124 | 0.0000 |
| 1.1827 | −1.1904 | 0.0000 | −0.7531 | 1.1265 | 0.0000 |
| 1.0716 | −1.1344 | 0.0000 | −0.6752 | 1.0373 | 0.0000 |
| 0.9570 | −1.0743 | 0.0000 | −0.5940 | 0.9449 | 0.0000 |
| 0.8390 | −1.0099 | 0.0000 | −0.5090 | 0.8495 | 0.0000 |
| 0.7180 | −0.9408 | 0.0000 | −0.4203 | 0.7512 | 0.0000 |
| 0.5947 | −0.8669 | 0.0000 | −0.3276 | 0.6499 | 0.0000 |
| 0.4694 | −0.7877 | 0.0000 | −0.2311 | 0.5460 | 0.0000 |
| 0.3464 | −0.7056 | 0.0000 | −0.1337 | 0.4426 | 0.0000 |
| 0.2260 | −0.6204 | 0.0000 | −0.0356 | 0.3400 | 0.0000 |
| 0.1080 | −0.5321 | 0.0000 | 0.0632 | 0.2380 | 0.0000 |
| −0.0073 | −0.4405 | 0.0000 | 0.1621 | 0.1362 | 0.0000 |
| −0.1198 | −0.3455 | 0.0000 | 0.2613 | 0.0345 | 0.0000 |
| −0.2293 | −0.2466 | 0.0000 | 0.3608 | −0.0669 | 0.0000 |
| −0.3354 | −0.1437 | 0.0000 | 0.4608 | −0.1676 | 0.0000 |
| −0.4381 | −0.0366 | 0.0000 | 0.5617 | −0.2675 | 0.0000 |
| −0.5378 | 0.0744 | 0.0000 | 0.6634 | −0.3664 | 0.0000 |
| −0.6341 | 0.1894 | 0.0000 | 0.7663 | −0.4641 | 0.0000 |
| −0.7268 | 0.3078 | 0.0000 | 0.8706 | −0.5604 | 0.0000 |
| −0.8122 | 0.4250 | 0.0000 | 0.9726 | −0.6522 | 0.0000 |
| −0.8910 | 0.5410 | 0.0000 | 1.0724 | −0.7395 | 0.0000 |
| −0.9634 | 0.6553 | 0.0000 | 1.1698 | −0.8224 | 0.0000 |
| −1.0296 | 0.7675 | 0.0000 | 1.2646 | −0.9010 | 0.0000 |
| −1.0900 | 0.8772 | 0.0000 | 1.3565 | −0.9755 | 0.0000 |
| −1.1448 | 0.9845 | 0.0000 | 1.4457 | −1.0461 | 0.0000 |
| −1.1939 | 1.0888 | 0.0000 | 1.5318 | −1.1128 | 0.0000 |
| −1.2383 | 1.1898 | 0.0000 | 1.6110 | −1.1731 | 0.0000 |
| −1.2756 | 1.2828 | 0.0000 | 1.6830 | −1.2270 | 0.0000 |
| −1.3072 | 1.3673 | 0.0000 | 1.7478 | −1.2749 | 0.0000 |
| −1.3336 | 1.4431 | 0.0000 | 1.8051 | −1.3169 | 0.0000 |
| −1.3554 | 1.5150 | 0.0000 | 1.8549 | −1.3531 | 0.0000 |
| −1.3714 | 1.5783 | 0.0000 | 1.8972 | −1.3835 | 0.0000 |
| −1.3802 | 1.6277 | 0.0000 | 1.9333 | −1.4095 | 0.0000 |
| −1.3831 | 1.6677 | 0.0000 | 1.9638 | −1.4312 | 0.0000 |
| −1.3810 | 1.6976 | 0.0000 | 1.9889 | −1.4492 | 0.0000 |
| −1.3749 | 1.7193 | 0.0000 | 2.0088 | −1.4635 | 0.0000 |
| −1.3688 | 1.7302 | 0.0000 | 2.0210 | −1.4780 | 0.0000 |
| −1.3632 | 1.7360 | 0.0000 | 2.0254 | −1.4916 | 0.0000 |
| −1.3599 | 1.7384 | 0.0000 | 2.0256 | −1.5036 | 0.0000 |
| −1.3582 | 1.7394 | 0.0000 | 2.0234 | −1.5129 | 0.0000 |
| 2.0152 | −1.4933 | 0.2071 | −1.3842 | 1.7305 | 0.2071 |
| 2.0111 | −1.4993 | 0.2071 | −1.3833 | 1.7310 | 0.2071 |
| 2.0040 | −1.5063 | 0.2071 | −1.3816 | 1.7317 | 0.2071 |
| 1.9934 | −1.5123 | 0.2071 | −1.3779 | 1.7330 | 0.2071 |
| 1.9790 | −1.5155 | 0.2071 | −1.3704 | 1.7342 | 0.2071 |
| 1.9597 | −1.5121 | 0.2071 | −1.3586 | 1.7333 | 0.2071 |
| 1.9359 | −1.5021 | 0.2071 | −1.3383 | 1.7265 | 0.2071 |
| 1.9062 | −1.4897 | 0.2071 | −1.3135 | 1.7124 | 0.2071 |
| 1.8702 | −1.4745 | 0.2071 | −1.2836 | 1.6895 | 0.2071 |
| 1.8273 | −1.4563 | 0.2071 | −1.2487 | 1.6576 | 0.2071 |
| 1.7772 | −1.4349 | 0.2071 | −1.2058 | 1.6136 | 0.2071 |
| 1.7180 | −1.4094 | 0.2071 | −1.1577 | 1.5616 | 0.2071 |
| 1.6499 | −1.3797 | 0.2071 | −1.1072 | 1.5054 | 0.2071 |
| 1.5729 | −1.3456 | 0.2071 | −1.0506 | 1.4420 | 0.2071 |
| 1.4871 | −1.3069 | 0.2071 | −0.9873 | 1.3719 | 0.2071 |
| 1.3928 | −1.2632 | 0.2071 | −0.9178 | 1.2946 | 0.2071 |
| 1.2900 | −1.2144 | 0.2071 | −0.8453 | 1.2139 | 0.2071 |
| 1.1833 | −1.1623 | 0.2071 | −0.7691 | 1.1299 | 0.2071 |
| 1.0727 | −1.1064 | 0.2071 | −0.6896 | 1.0427 | 0.2071 |
| 0.9587 | −1.0468 | 0.2071 | −0.6065 | 0.9523 | 0.2071 |
| 0.8412 | −0.9827 | 0.2071 | −0.5197 | 0.8589 | 0.2071 |
| 0.7209 | −0.9141 | 0.2071 | −0.4293 | 0.7626 | 0.2071 |
| 0.5982 | −0.8408 | 0.2071 | −0.3350 | 0.6633 | 0.2071 |
| 0.4733 | −0.7622 | 0.2071 | −0.2370 | 0.5609 | 0.2071 |
| 0.3508 | −0.6807 | 0.2071 | −0.1385 | 0.4592 | 0.2071 |
| 0.2305 | −0.5963 | 0.2071 | −0.0395 | 0.3578 | 0.2071 |
| 0.1128 | −0.5088 | 0.2071 | 0.0599 | 0.2569 | 0.2071 |
| −0.0025 | −0.4182 | 0.2071 | 0.1595 | 0.1561 | 0.2071 |

TABLE 3-continued

| SUCTION SIDE | | | PRESSURE SIDE | | |
|---|---|---|---|---|---|
| X | Y | Z | X | Y | Z |
| −0.1151 | −0.3242 | 0.2071 | 0.2592 | 0.0556 | 0.2071 |
| −0.2249 | −0.2268 | 0.2071 | 0.3593 | −0.0448 | 0.2071 |
| −0.3316 | −0.1254 | 0.2071 | 0.4599 | −0.1446 | 0.2071 |
| −0.4352 | −0.0200 | 0.2071 | 0.5611 | −0.2436 | 0.2071 |
| −0.5358 | 0.0890 | 0.2071 | 0.6633 | −0.3417 | 0.2071 |
| −0.6332 | 0.2020 | 0.2071 | 0.7664 | −0.4387 | 0.2071 |
| −0.7269 | 0.3184 | 0.2071 | 0.8709 | −0.5345 | 0.2071 |
| −0.8136 | 0.4337 | 0.2071 | 0.9731 | −0.6257 | 0.2071 |
| −0.8936 | 0.5477 | 0.2071 | 1.0727 | −0.7127 | 0.2071 |
| −0.9673 | 0.6602 | 0.2071 | 1.1700 | −0.7953 | 0.2071 |
| −1.0350 | 0.7707 | 0.2071 | 1.2645 | −0.8737 | 0.2071 |
| −1.0968 | 0.8788 | 0.2071 | 1.3562 | −0.9482 | 0.2071 |
| −1.1530 | 0.9843 | 0.2071 | 1.4449 | −1.0189 | 0.2071 |
| −1.2039 | 1.0870 | 0.2071 | 1.5306 | −1.0857 | 0.2071 |
| −1.2499 | 1.1865 | 0.2071 | 1.6093 | −1.1461 | 0.2071 |
| −1.2891 | 1.2781 | 0.2071 | 1.6810 | −1.2003 | 0.2071 |
| −1.3222 | 1.3615 | 0.2071 | 1.7453 | −1.2484 | 0.2071 |
| −1.3500 | 1.4362 | 0.2071 | 1.8023 | −1.2906 | 0.2071 |
| −1.3738 | 1.5071 | 0.2071 | 1.8518 | −1.3270 | 0.2071 |
| −1.3917 | 1.5693 | 0.2071 | 1.8938 | −1.3576 | 0.2071 |
| −1.4022 | 1.6181 | 0.2071 | 1.9298 | −1.3838 | 0.2071 |
| −1.4067 | 1.6577 | 0.2071 | 1.9600 | −1.4056 | 0.2071 |
| −1.4059 | 1.6875 | 0.2071 | 1.9849 | −1.4236 | 0.2071 |
| −1.4009 | 1.7093 | 0.2071 | 2.0047 | −1.4381 | 0.2071 |
| −1.3952 | 1.7204 | 0.2071 | 2.0163 | −1.4526 | 0.2071 |
| −1.3899 | 1.7264 | 0.2071 | 2.0205 | −1.4661 | 0.2071 |
| −1.3868 | 1.7289 | 0.2071 | 2.0205 | −1.4778 | 0.2071 |
| −1.3851 | 1.7300 | 0.2071 | 2.0181 | −1.4869 | 0.2071 |
| 2.0096 | −1.4702 | 0.4129 | −1.4075 | 1.7202 | 0.4129 |
| 2.0055 | −1.4763 | 0.4129 | −1.4066 | 1.7207 | 0.4129 |
| 1.9984 | −1.4831 | 0.4128 | −1.4049 | 1.7214 | 0.4129 |
| 1.9878 | −1.4890 | 0.4128 | −1.4013 | 1.7228 | 0.4128 |
| 1.9734 | −1.4921 | 0.4129 | −1.3938 | 1.7241 | 0.4129 |
| 1.9543 | −1.4884 | 0.4128 | −1.3820 | 1.7232 | 0.4128 |
| 1.9308 | −1.4783 | 0.4128 | −1.3617 | 1.7165 | 0.4128 |
| 1.9013 | −1.4656 | 0.4128 | −1.3371 | 1.7027 | 0.4128 |
| 1.8656 | −1.4503 | 0.4129 | −1.3069 | 1.6802 | 0.4128 |
| 1.8230 | −1.4319 | 0.4128 | −1.2716 | 1.6488 | 0.4129 |
| 1.7734 | −1.4102 | 0.4129 | −1.2283 | 1.6056 | 0.4128 |
| 1.7147 | −1.3845 | 0.4128 | −1.1794 | 1.5547 | 0.4128 |
| 1.6472 | −1.3545 | 0.4128 | −1.1277 | 1.4998 | 0.4128 |
| 1.5708 | −1.3201 | 0.4128 | −1.0697 | 1.4380 | 0.4129 |
| 1.4858 | −1.2811 | 0.4128 | −1.0050 | 1.3694 | 0.4129 |
| 1.3922 | −1.2373 | 0.4129 | −0.9340 | 1.2939 | 0.4129 |
| 1.2900 | −1.1883 | 0.4128 | −0.8597 | 1.2151 | 0.4129 |
| 1.1840 | −1.1361 | 0.4128 | −0.7820 | 1.1330 | 0.4128 |
| 1.0742 | −1.0804 | 0.4129 | −0.7008 | 1.0478 | 0.4129 |
| 0.9608 | −1.0209 | 0.4129 | −0.6161 | 0.9593 | 0.4128 |
| 0.8440 | −0.9572 | 0.4128 | −0.5279 | 0.8678 | 0.4128 |
| 0.7244 | −0.8889 | 0.4129 | −0.4359 | 0.7732 | 0.4129 |
| 0.6022 | −0.8160 | 0.4129 | −0.3404 | 0.6756 | 0.4129 |
| 0.4779 | −0.7380 | 0.4128 | −0.2412 | 0.5749 | 0.4128 |
| 0.3558 | −0.6572 | 0.4128 | −0.1418 | 0.4745 | 0.4128 |
| 0.2360 | −0.5734 | 0.4129 | −0.0420 | 0.3745 | 0.4128 |
| 0.1184 | −0.4868 | 0.4128 | 0.0580 | 0.2746 | 0.4129 |
| 0.0031 | −0.3970 | 0.4128 | 0.1580 | 0.1748 | 0.4128 |
| −0.1095 | −0.3042 | 0.4128 | 0.2582 | 0.0752 | 0.4129 |
| −0.2196 | −0.2080 | 0.4128 | 0.3586 | −0.0242 | 0.4129 |
| −0.3268 | −0.1081 | 0.4129 | 0.4595 | −0.1231 | 0.4129 |
| −0.4311 | −0.0045 | 0.4128 | 0.5611 | −0.2213 | 0.4128 |
| −0.5323 | 0.1029 | 0.4129 | 0.6635 | −0.3188 | 0.4128 |
| −0.6307 | 0.2141 | 0.4128 | 0.7668 | −0.4151 | 0.4128 |
| −0.7253 | 0.3284 | 0.4129 | 0.8712 | −0.5103 | 0.4128 |
| −0.8131 | 0.4418 | 0.4129 | 0.9733 | −0.6011 | 0.4129 |
| −0.8944 | 0.5540 | 0.4128 | 1.0728 | −0.6878 | 0.4129 |
| −0.9695 | 0.6646 | 0.4128 | 1.1698 | −0.7702 | 0.4128 |
| −1.0385 | 0.7732 | 0.4129 | 1.2639 | −0.8485 | 0.4128 |
| −1.1016 | 0.8796 | 0.4128 | 1.3552 | −0.9230 | 0.4128 |
| −1.1594 | 0.9836 | 0.4128 | 1.4435 | −0.9937 | 0.4129 |
| −1.2118 | 1.0847 | 0.4128 | 1.5287 | −1.0608 | 0.4129 |
| −1.2594 | 1.1827 | 0.4128 | 1.6070 | −1.1213 | 0.4129 |
| −1.3002 | 1.2730 | 0.4128 | 1.6781 | −1.1758 | 0.4129 |
| −1.3349 | 1.3551 | 0.4128 | 1.7420 | −1.2240 | 0.4128 |
| −1.3643 | 1.4287 | 0.4128 | 1.7986 | −1.2665 | 0.4128 |
| −1.3897 | 1.4986 | 0.4129 | 1.8477 | −1.3031 | 0.4128 |
| −1.4093 | 1.5598 | 0.4128 | 1.8893 | −1.3340 | 0.4128 |

TABLE 3-continued

| SUCTION SIDE | | | PRESSURE SIDE | | |
|---|---|---|---|---|---|
| X | Y | Z | X | Y | Z |
| −1.4214 | 1.6079 | 0.4129 | 1.9251 | −1.3604 | 0.4129 |
| −1.4272 | 1.6471 | 0.4129 | 1.9550 | −1.3824 | 0.4128 |
| −1.4274 | 1.6768 | 0.4129 | 1.9797 | −1.4006 | 0.4128 |
| −1.4233 | 1.6986 | 0.4129 | 1.9993 | −1.4151 | 0.4129 |
| −1.4181 | 1.7098 | 0.4128 | 2.0110 | −1.4297 | 0.4128 |
| −1.4131 | 1.7160 | 0.4129 | 2.0150 | −1.4431 | 0.4128 |
| −1.4101 | 1.7185 | 0.4128 | 2.0150 | −1.4548 | 0.4128 |
| −1.4084 | 1.7196 | 0.4128 | 2.0126 | −1.4638 | 0.4129 |
| 1.9991 | −1.4506 | 0.7258 | −1.4284 | 1.7004 | 0.7258 |
| 1.9948 | −1.4566 | 0.7258 | −1.4277 | 1.7008 | 0.7258 |
| 1.9878 | −1.4632 | 0.7258 | −1.4259 | 1.7017 | 0.7258 |
| 1.9771 | −1.4689 | 0.7258 | −1.4224 | 1.7032 | 0.7258 |
| 1.9629 | −1.4715 | 0.7258 | −1.4150 | 1.7046 | 0.7258 |
| 1.9440 | −1.4674 | 0.7258 | −1.4031 | 1.7042 | 0.7258 |
| 1.9209 | −1.4570 | 0.7258 | −1.3828 | 1.6981 | 0.7258 |
| 1.8920 | −1.4438 | 0.7258 | −1.3578 | 1.6850 | 0.7258 |
| 1.8570 | −1.4279 | 0.7258 | −1.3271 | 1.6636 | 0.7258 |
| 1.8152 | −1.4087 | 0.7258 | −1.2911 | 1.6335 | 0.7258 |
| 1.7665 | −1.3863 | 0.7258 | −1.2466 | 1.5919 | 0.7258 |
| 1.7089 | −1.3597 | 0.7258 | −1.1962 | 1.5427 | 0.7258 |
| 1.6425 | −1.3288 | 0.7258 | −1.1430 | 1.4899 | 0.7258 |
| 1.5676 | −1.2934 | 0.7258 | −1.0832 | 1.4304 | 0.7258 |
| 1.4839 | −1.2533 | 0.7258 | −1.0166 | 1.3642 | 0.7258 |
| 1.3918 | −1.2085 | 0.7258 | −0.9437 | 1.2911 | 0.7258 |
| 1.2914 | −1.1585 | 0.7258 | −0.8676 | 1.2148 | 0.7258 |
| 1.1870 | −1.1054 | 0.7258 | −0.7880 | 1.1351 | 0.7258 |
| 1.0789 | −1.0491 | 0.7258 | −0.7052 | 1.0522 | 0.7258 |
| 0.9671 | −0.9891 | 0.7258 | −0.6188 | 0.9662 | 0.7258 |
| 0.8519 | −0.9252 | 0.7258 | −0.5290 | 0.8770 | 0.7258 |
| 0.7336 | −0.8571 | 0.7258 | −0.4357 | 0.7846 | 0.7258 |
| 0.6128 | −0.7846 | 0.7258 | −0.3389 | 0.6890 | 0.7258 |
| 0.4896 | −0.7071 | 0.7258 | −0.2387 | 0.5904 | 0.7258 |
| 0.3683 | −0.6271 | 0.7258 | −0.1383 | 0.4918 | 0.7258 |
| 0.2490 | −0.5443 | 0.7258 | −0.0377 | 0.3933 | 0.7258 |
| 0.1319 | −0.4589 | 0.7258 | 0.0627 | 0.2949 | 0.7258 |
| 0.0170 | −0.3706 | 0.7258 | 0.1631 | 0.1962 | 0.7258 |
| −0.0958 | −0.2794 | 0.7258 | 0.2633 | 0.0976 | 0.7258 |
| −0.2060 | −0.1849 | 0.7258 | 0.3638 | −0.0009 | 0.7258 |
| −0.3135 | −0.0869 | 0.7258 | 0.4646 | −0.0990 | 0.7258 |
| −0.4182 | 0.0147 | 0.7258 | 0.5659 | −0.1966 | 0.7258 |
| −0.5201 | 0.1198 | 0.7258 | 0.6681 | −0.2933 | 0.7258 |
| −0.6194 | 0.2285 | 0.7258 | 0.7710 | −0.3892 | 0.7258 |
| −0.7150 | 0.3399 | 0.7258 | 0.8749 | −0.4841 | 0.7258 |
| −0.8042 | 0.4505 | 0.7258 | 0.9763 | −0.5748 | 0.7258 |
| −0.8870 | 0.5598 | 0.7258 | 1.0751 | −0.6614 | 0.7258 |
| −0.9639 | 0.6676 | 0.7258 | 1.1712 | −0.7440 | 0.7258 |
| −1.0348 | 0.7736 | 0.7258 | 1.2644 | −0.8226 | 0.7258 |
| −1.1000 | 0.8773 | 0.7258 | 1.3546 | −0.8975 | 0.7258 |
| −1.1599 | 0.9787 | 0.7258 | 1.4419 | −0.9687 | 0.7258 |
| −1.2145 | 1.0773 | 0.7258 | 1.5260 | −1.0363 | 0.7258 |
| −1.2644 | 1.1730 | 0.7258 | 1.6032 | −1.0976 | 0.7258 |
| −1.3074 | 1.2611 | 0.7258 | 1.6733 | −1.1526 | 0.7258 |
| −1.3441 | 1.3414 | 0.7258 | 1.7362 | −1.2015 | 0.7258 |
| −1.3754 | 1.4134 | 0.7258 | 1.7919 | −1.2447 | 0.7258 |
| −1.4028 | 1.4816 | 0.7258 | 1.8403 | −1.2817 | 0.7258 |
| −1.4244 | 1.5417 | 0.7258 | 1.8813 | −1.3132 | 0.7258 |
| −1.4381 | 1.5888 | 0.7258 | 1.9163 | −1.3399 | 0.7258 |
| −1.4452 | 1.6274 | 0.7258 | 1.9458 | −1.3624 | 0.7258 |
| −1.4466 | 1.6567 | 0.7258 | 1.9701 | −1.3808 | 0.7258 |
| −1.4433 | 1.6785 | 0.7258 | 1.9895 | −1.3956 | 0.7258 |
| −1.4386 | 1.6897 | 0.7258 | 2.0010 | −1.4102 | 0.7258 |
| −1.4338 | 1.6960 | 0.7258 | 2.0049 | −1.4236 | 0.7258 |
| −1.4309 | 1.6987 | 0.7258 | 2.0047 | −1.4353 | 0.7258 |
| −1.4292 | 1.6998 | 0.7258 | 2.0022 | −1.4442 | 0.7258 |
| 1.9812 | −1.4507 | 1.0387 | −1.4321 | 1.6824 | 1.0387 |
| 1.9768 | −1.4564 | 1.0387 | −1.4314 | 1.6828 | 1.0387 |
| 1.9696 | −1.4628 | 1.0387 | −1.4298 | 1.6838 | 1.0387 |
| 1.9590 | −1.4682 | 1.0387 | −1.4263 | 1.6853 | 1.0387 |
| 1.9448 | −1.4703 | 1.0387 | −1.4189 | 1.6871 | 1.0387 |
| 1.9263 | −1.4657 | 1.0387 | −1.4072 | 1.6871 | 1.0387 |
| 1.9037 | −1.4548 | 1.0387 | −1.3867 | 1.6819 | 1.0387 |
| 1.8754 | −1.4410 | 1.0387 | −1.3612 | 1.6698 | 1.0387 |
| 1.8412 | −1.4242 | 1.0387 | −1.3300 | 1.6496 | 1.0387 |
| 1.8004 | −1.4041 | 1.0387 | −1.2932 | 1.6209 | 1.0387 |
| 1.7528 | −1.3805 | 1.0387 | −1.2475 | 1.5810 | 1.0387 |
| 1.6966 | −1.3526 | 1.0387 | −1.1959 | 1.5336 | 1.0387 |

TABLE 3-continued

| SUCTION SIDE | | | PRESSURE SIDE | | |
|---|---|---|---|---|---|
| X | Y | Z | X | Y | Z |
| 1.6317 | −1.3201 | 1.0387 | −1.1415 | 1.4824 | 1.0387 |
| 1.5585 | −1.2832 | 1.0387 | −1.0806 | 1.4248 | 1.0387 |
| 1.4767 | −1.2414 | 1.0387 | −1.0129 | 1.3604 | 1.0387 |
| 1.3867 | −1.1948 | 1.0387 | −0.9389 | 1.2892 | 1.0387 |
| 1.2883 | −1.1431 | 1.0387 | −0.8617 | 1.2146 | 1.0387 |
| 1.1861 | −1.0884 | 1.0387 | −0.7813 | 1.1368 | 1.0387 |
| 1.0801 | −1.0305 | 1.0387 | −0.6975 | 1.0555 | 1.0387 |
| 0.9705 | −0.9691 | 1.0387 | −0.6105 | 0.9710 | 1.0387 |
| 0.8574 | −0.9043 | 1.0387 | −0.5201 | 0.8832 | 1.0387 |
| 0.7411 | −0.8354 | 1.0387 | −0.4265 | 0.7922 | 1.0387 |
| 0.6219 | −0.7625 | 1.0387 | −0.3294 | 0.6979 | 1.0387 |
| 0.5003 | −0.6850 | 1.0387 | −0.2290 | 0.6003 | 1.0387 |
| 0.3802 | −0.6052 | 1.0387 | −0.1285 | 0.5028 | 1.0387 |
| 0.2621 | −0.5230 | 1.0387 | −0.0280 | 0.4054 | 1.0387 |
| 0.1458 | −0.4384 | 1.0387 | 0.0725 | 0.3079 | 1.0387 |
| 0.0316 | −0.3510 | 1.0387 | 0.1725 | 0.2100 | 1.0387 |
| −0.0805 | −0.2608 | 1.0387 | 0.2723 | 0.1118 | 1.0387 |
| −0.1902 | −0.1676 | 1.0387 | 0.3720 | 0.0134 | 1.0387 |
| −0.2974 | −0.0708 | 1.0387 | 0.4720 | −0.0846 | 1.0387 |
| −0.4016 | 0.0296 | 1.0387 | 0.5723 | −0.1821 | 1.0387 |
| −0.5036 | 0.1332 | 1.0387 | 0.6732 | −0.2791 | 1.0387 |
| −0.6027 | 0.2399 | 1.0387 | 0.7749 | −0.3753 | 1.0387 |
| −0.6987 | 0.3492 | 1.0387 | 0.8775 | −0.4705 | 1.0387 |
| −0.7885 | 0.4575 | 1.0387 | 0.9775 | −0.5618 | 1.0387 |
| −0.8723 | 0.5645 | 1.0387 | 1.0749 | −0.6490 | 1.0387 |
| −0.9502 | 0.6700 | 1.0387 | 1.1694 | −0.7324 | 1.0387 |
| −1.0224 | 0.7735 | 1.0387 | 1.2611 | −0.8119 | 1.0387 |
| −1.0892 | 0.8748 | 1.0387 | 1.3498 | −0.8877 | 1.0387 |
| −1.1507 | 0.9738 | 1.0387 | 1.4355 | −0.9600 | 1.0387 |
| −1.2070 | 1.0703 | 1.0387 | 1.5179 | −1.0287 | 1.0387 |
| −1.2587 | 1.1638 | 1.0387 | 1.5936 | −1.0911 | 1.0387 |
| −1.3032 | 1.2501 | 1.0387 | 1.6623 | −1.1472 | 1.0387 |
| −1.3414 | 1.3288 | 1.0387 | 1.7239 | −1.1972 | 1.0387 |
| −1.3740 | 1.3993 | 1.0387 | 1.7784 | −1.2412 | 1.0387 |
| −1.4027 | 1.4663 | 1.0387 | 1.8258 | −1.2792 | 1.0387 |
| −1.4253 | 1.5253 | 1.0387 | 1.8659 | −1.3112 | 1.0387 |
| −1.4396 | 1.5717 | 1.0387 | 1.9002 | −1.3385 | 1.0387 |
| −1.4475 | 1.6098 | 1.0387 | 1.9291 | −1.3615 | 1.0387 |
| −1.4494 | 1.6388 | 1.0387 | 1.9528 | −1.3804 | 1.0387 |
| −1.4465 | 1.6604 | 1.0387 | 1.9719 | −1.3954 | 1.0387 |
| −1.4420 | 1.6716 | 1.0387 | 1.9835 | −1.4100 | 1.0387 |
| −1.4374 | 1.6779 | 1.0387 | 1.9874 | −1.4235 | 1.0387 |
| −1.4346 | 1.6806 | 1.0387 | 1.9871 | −1.4353 | 1.0387 |
| −1.4330 | 1.6818 | 1.0387 | 1.9844 | −1.4444 | 1.0387 |
| 1.9038 | −1.4626 | 1.6645 | −1.4202 | 1.6968 | 1.6645 |
| 1.8992 | −1.4680 | 1.6645 | −1.4194 | 1.6974 | 1.6645 |
| 1.8918 | −1.4739 | 1.6645 | −1.4177 | 1.6983 | 1.6644 |
| 1.8810 | −1.4787 | 1.6644 | −1.4143 | 1.6998 | 1.6645 |
| 1.8669 | −1.4801 | 1.6644 | −1.4071 | 1.7016 | 1.6644 |
| 1.8490 | −1.4744 | 1.6645 | −1.3954 | 1.7015 | 1.6645 |
| 1.8272 | −1.4626 | 1.6644 | −1.3751 | 1.6962 | 1.6645 |
| 1.8000 | −1.4478 | 1.6645 | −1.3500 | 1.6843 | 1.6645 |
| 1.7668 | −1.4299 | 1.6645 | −1.3190 | 1.6643 | 1.6644 |
| 1.7274 | −1.4085 | 1.6644 | −1.2824 | 1.6360 | 1.6644 |
| 1.6813 | −1.3835 | 1.6644 | −1.2369 | 1.5968 | 1.6644 |
| 1.6270 | −1.3537 | 1.6644 | −1.1856 | 1.5502 | 1.6645 |
| 1.5643 | −1.3194 | 1.6645 | −1.1314 | 1.4999 | 1.6644 |
| 1.4934 | −1.2802 | 1.6645 | −1.0708 | 1.4431 | 1.6645 |
| 1.4142 | −1.2361 | 1.6645 | −1.0036 | 1.3797 | 1.6644 |
| 1.3270 | −1.1871 | 1.6645 | −0.9300 | 1.3096 | 1.6644 |
| 1.2317 | −1.1329 | 1.6645 | −0.8534 | 1.2359 | 1.6645 |
| 1.1327 | −1.0756 | 1.6644 | −0.7738 | 1.1590 | 1.6645 |
| 1.0301 | −1.0152 | 1.6644 | −0.6909 | 1.0786 | 1.6645 |
| 0.9239 | −0.9512 | 1.6645 | −0.6049 | 0.9947 | 1.6645 |
| 0.8144 | −0.8836 | 1.6644 | −0.5158 | 0.9075 | 1.6644 |
| 0.7019 | −0.8121 | 1.6645 | −0.4234 | 0.8170 | 1.6644 |
| 0.5868 | −0.7365 | 1.6645 | −0.3279 | 0.7231 | 1.6645 |
| 0.4693 | −0.6565 | 1.6645 | −0.2294 | 0.6256 | 1.6644 |
| 0.3535 | −0.5746 | 1.6644 | −0.1309 | 0.5282 | 1.6644 |
| 0.2396 | −0.4903 | 1.6645 | −0.0325 | 0.4306 | 1.6644 |
| 0.1277 | −0.4039 | 1.6644 | 0.0657 | 0.3329 | 1.6644 |
| 0.0178 | −0.3151 | 1.6644 | 0.1636 | 0.2349 | 1.6644 |
| −0.0899 | −0.2237 | 1.6644 | 0.2612 | 0.1365 | 1.6645 |
| −0.1953 | −0.1296 | 1.6645 | 0.3586 | 0.0380 | 1.6645 |
| −0.2983 | −0.0326 | 1.6645 | 0.4562 | −0.0605 | 1.6644 |
| −0.3986 | 0.0672 | 1.6645 | 0.5537 | −0.1588 | 1.6644 |

TABLE 3-continued

| SUCTION SIDE | | | PRESSURE SIDE | | |
|---|---|---|---|---|---|
| X | Y | Z | X | Y | Z |
| −0.4966 | 0.1699 | 1.6644 | 0.6517 | −0.2568 | 1.6645 |
| −0.5923 | 0.2753 | 1.6645 | 0.7502 | −0.3543 | 1.6644 |
| −0.6856 | 0.3834 | 1.6644 | 0.8492 | −0.4511 | 1.6644 |
| −0.7734 | 0.4907 | 1.6645 | 0.9455 | −0.5443 | 1.6644 |
| −0.8557 | 0.5966 | 1.6645 | 1.0391 | −0.6336 | 1.6644 |
| −0.9325 | 0.7008 | 1.6644 | 1.1299 | −0.7192 | 1.6645 |
| −1.0041 | 0.8029 | 1.6645 | 1.2178 | −0.8009 | 1.6645 |
| −1.0703 | 0.9028 | 1.6645 | 1.3028 | −0.8791 | 1.6645 |
| −1.1315 | 1.0003 | 1.6644 | 1.3848 | −0.9538 | 1.6644 |
| −1.1880 | 1.0950 | 1.6645 | 1.4636 | −1.0249 | 1.6644 |
| −1.2397 | 1.1870 | 1.6645 | 1.5359 | −1.0898 | 1.6645 |
| −1.2846 | 1.2718 | 1.6644 | 1.6014 | −1.1481 | 1.6644 |
| −1.3234 | 1.3489 | 1.6644 | 1.6601 | −1.2002 | 1.6645 |
| −1.3564 | 1.4183 | 1.6645 | 1.7120 | −1.2461 | 1.6644 |
| −1.3858 | 1.4839 | 1.6644 | 1.7571 | −1.2858 | 1.6644 |
| −1.4091 | 1.5418 | 1.6645 | 1.7952 | −1.3194 | 1.6644 |
| −1.4242 | 1.5873 | 1.6645 | 1.8280 | −1.3479 | 1.6645 |
| −1.4328 | 1.6247 | 1.6644 | 1.8554 | −1.3720 | 1.6645 |
| −1.4356 | 1.6532 | 1.6645 | 1.8779 | −1.3918 | 1.6644 |
| −1.4336 | 1.6747 | 1.6645 | 1.8960 | −1.4076 | 1.6645 |
| −1.4295 | 1.6859 | 1.6644 | 1.9074 | −1.4222 | 1.6644 |
| −1.4252 | 1.6923 | 1.6644 | 1.9109 | −1.4357 | 1.6645 |
| −1.4225 | 1.6950 | 1.6644 | 1.9103 | −1.4475 | 1.6645 |
| −1.4209 | 1.6962 | 1.6645 | 1.9074 | −1.4564 | 1.6645 |
| 1.8086 | −1.5046 | 2.2903 | −1.3752 | 1.7154 | 2.2903 |
| 1.8039 | −1.5098 | 2.2903 | −1.3745 | 1.7160 | 2.2903 |
| 1.7963 | −1.5152 | 2.2903 | −1.3728 | 1.7168 | 2.2903 |
| 1.7854 | −1.5193 | 2.2903 | −1.3694 | 1.7182 | 2.2903 |
| 1.7715 | −1.5197 | 2.2903 | −1.3621 | 1.7195 | 2.2903 |
| 1.7543 | −1.5127 | 2.2903 | −1.3506 | 1.7188 | 2.2903 |
| 1.7333 | −1.5002 | 2.2903 | −1.3309 | 1.7124 | 2.2903 |
| 1.7071 | −1.4846 | 2.2903 | −1.3068 | 1.6995 | 2.2903 |
| 1.6754 | −1.4654 | 2.2903 | −1.2769 | 1.6785 | 2.2903 |
| 1.6376 | −1.4427 | 2.2903 | −1.2416 | 1.6495 | 2.2903 |
| 1.5933 | −1.4160 | 2.2903 | −1.1978 | 1.6096 | 2.2903 |
| 1.5411 | −1.3845 | 2.2903 | −1.1484 | 1.5622 | 2.2903 |
| 1.4810 | −1.3479 | 2.2903 | −1.0963 | 1.5113 | 2.2903 |
| 1.4129 | −1.3064 | 2.2903 | −1.0378 | 1.4538 | 2.2903 |
| 1.3369 | −1.2598 | 2.2903 | −0.9729 | 1.3896 | 2.2903 |
| 1.2532 | −1.2078 | 2.2903 | −0.9020 | 1.3187 | 2.2903 |
| 1.1617 | −1.1505 | 2.2903 | −0.8281 | 1.2443 | 2.2903 |
| 1.0667 | −1.0901 | 2.2903 | −0.7512 | 1.1665 | 2.2903 |
| 0.9681 | −1.0264 | 2.2903 | −0.6712 | 1.0853 | 2.2903 |
| 0.8662 | −0.9592 | 2.2903 | −0.5881 | 1.0006 | 2.2903 |
| 0.7613 | −0.8884 | 2.2903 | −0.5021 | 0.9126 | 2.2903 |
| 0.6534 | −0.8139 | 2.2903 | −0.4131 | 0.8211 | 2.2903 |
| 0.5430 | −0.7353 | 2.2903 | −0.3210 | 0.7262 | 2.2903 |
| 0.4303 | −0.6523 | 2.2903 | −0.2260 | 0.6278 | 2.2903 |
| 0.3194 | −0.5674 | 2.2903 | −0.1312 | 0.5292 | 2.2903 |
| 0.2103 | −0.4805 | 2.2903 | −0.0364 | 0.4305 | 2.2903 |
| 0.1033 | −0.3916 | 2.2903 | 0.0581 | 0.3317 | 2.2903 |
| −0.0017 | −0.3003 | 2.2903 | 0.1524 | 0.2326 | 2.2903 |
| −0.1045 | −0.2068 | 2.2903 | 0.2463 | 0.1332 | 2.2903 |
| −0.2050 | −0.1107 | 2.2903 | 0.3399 | 0.0335 | 2.2903 |
| −0.3030 | −0.0120 | 2.2903 | 0.4334 | −0.0664 | 2.2903 |
| −0.3985 | 0.0894 | 2.2903 | 0.5270 | −0.1662 | 2.2903 |
| −0.4918 | 0.1932 | 2.2903 | 0.6207 | −0.2658 | 2.2903 |
| −0.5826 | 0.2996 | 2.2903 | 0.7147 | −0.3651 | 2.2903 |
| −0.6712 | 0.4085 | 2.2903 | 0.8092 | −0.4640 | 2.2903 |
| −0.7545 | 0.5161 | 2.2903 | 0.9009 | −0.5592 | 2.2903 |
| −0.8327 | 0.6225 | 2.2903 | 0.9900 | −0.6507 | 2.2903 |
| −0.9059 | 0.7270 | 2.2903 | 1.0762 | −0.7385 | 2.2903 |
| −0.9738 | 0.8291 | 2.2903 | 1.1596 | −0.8228 | 2.2903 |
| −1.0369 | 0.9289 | 2.2903 | 1.2403 | −0.9033 | 2.2903 |
| −1.0954 | 1.0260 | 2.2903 | 1.3180 | −0.9803 | 2.2903 |
| −1.1492 | 1.1204 | 2.2903 | 1.3927 | −1.0539 | 2.2903 |
| −1.1987 | 1.2118 | 2.2903 | 1.4612 | −1.1209 | 2.2903 |
| −1.2417 | 1.2958 | 2.2903 | 1.5232 | −1.1814 | 2.2903 |
| −1.2792 | 1.3723 | 2.2903 | 1.5789 | −1.2354 | 2.2903 |
| −1.3111 | 1.4408 | 2.2903 | 1.6280 | −1.2830 | 2.2903 |
| −1.3395 | 1.5056 | 2.2903 | 1.6707 | −1.3241 | 2.2903 |
| −1.3625 | 1.5626 | 2.2903 | 1.7068 | −1.3589 | 2.2903 |
| −1.3775 | 1.6074 | 2.2903 | 1.7377 | −1.3886 | 2.2903 |
| −1.3863 | 1.6442 | 2.2903 | 1.7637 | −1.4136 | 2.2903 |
| −1.3895 | 1.6723 | 2.2903 | 1.7851 | −1.4340 | 2.2903 |
| −1.3880 | 1.6934 | 2.2903 | 1.8022 | −1.4504 | 2.2903 |

TABLE 3-continued

| SUCTION SIDE | | | PRESSURE SIDE | | |
|---|---|---|---|---|---|
| X | Y | Z | X | Y | Z |
| −1.3843 | 1.7048 | 2.2903 | 1.8132 | −1.4650 | 2.2903 |
| −1.3802 | 1.7110 | 2.2903 | 1.8164 | −1.4784 | 2.2903 |
| −1.3775 | 1.7137 | 2.2903 | 1.8154 | −1.4899 | 2.2903 |
| −1.3760 | 1.7148 | 2.2903 | 1.8123 | −1.4987 | 2.2903 |
| 1.7181 | −1.5773 | 2.9161 | −1.3227 | 1.6958 | 2.9161 |
| 1.7132 | −1.5822 | 2.9161 | −1.3219 | 1.6962 | 2.9161 |
| 1.7054 | −1.5872 | 2.9161 | −1.3204 | 1.6970 | 2.9161 |
| 1.6946 | −1.5904 | 2.9161 | −1.3169 | 1.6984 | 2.9161 |
| 1.6808 | −1.5896 | 2.9161 | −1.3097 | 1.6994 | 2.9160 |
| 1.6645 | −1.5812 | 2.9161 | −1.2984 | 1.6981 | 2.9160 |
| 1.6446 | −1.5679 | 2.9161 | −1.2793 | 1.6912 | 2.9161 |
| 1.6196 | −1.5512 | 2.9161 | −1.2557 | 1.6778 | 2.9160 |
| 1.5893 | −1.5309 | 2.9161 | −1.2267 | 1.6565 | 2.9161 |
| 1.5532 | −1.5068 | 2.9161 | −1.1927 | 1.6269 | 2.9161 |
| 1.5110 | −1.4785 | 2.9161 | −1.1505 | 1.5865 | 2.9161 |
| 1.4612 | −1.4450 | 2.9161 | −1.1029 | 1.5387 | 2.9161 |
| 1.4037 | −1.4064 | 2.9161 | −1.0527 | 1.4870 | 2.9161 |
| 1.3387 | −1.3624 | 2.9161 | −0.9966 | 1.4287 | 2.9161 |
| 1.2662 | −1.3130 | 2.9161 | −0.9344 | 1.3637 | 2.9161 |
| 1.1862 | −1.2582 | 2.9161 | −0.8663 | 1.2918 | 2.9161 |
| 1.0988 | −1.1978 | 2.9161 | −0.7954 | 1.2164 | 2.9161 |
| 1.0080 | −1.1342 | 2.9160 | −0.7217 | 1.1376 | 2.9161 |
| 0.9139 | −1.0674 | 2.9161 | −0.6451 | 1.0553 | 2.9161 |
| 0.8167 | −0.9969 | 2.9160 | −0.5656 | 0.9696 | 2.9161 |
| 0.7165 | −0.9230 | 2.9161 | −0.4832 | 0.8803 | 2.9160 |
| 0.6136 | −0.8452 | 2.9161 | −0.3978 | 0.7877 | 2.9161 |
| 0.5084 | −0.7634 | 2.9160 | −0.3096 | 0.6916 | 2.9161 |
| 0.4011 | −0.6773 | 2.9161 | −0.2185 | 0.5920 | 2.9160 |
| 0.2953 | −0.5896 | 2.9160 | −0.1276 | 0.4924 | 2.9161 |
| 0.1915 | −0.5000 | 2.9161 | −0.0367 | 0.3926 | 2.9161 |
| 0.0897 | −0.4084 | 2.9161 | 0.0541 | 0.2928 | 2.9161 |
| −0.0101 | −0.3147 | 2.9161 | 0.1447 | 0.1926 | 2.9160 |
| −0.1076 | −0.2191 | 2.9161 | 0.2346 | 0.0921 | 2.9161 |
| −0.2029 | −0.1210 | 2.9161 | 0.3242 | −0.0088 | 2.9161 |
| −0.2959 | −0.0206 | 2.9161 | 0.4136 | −0.1100 | 2.9161 |
| −0.3865 | 0.0820 | 2.9161 | 0.5028 | −0.2112 | 2.9161 |
| −0.4751 | 0.1867 | 2.9161 | 0.5920 | −0.3125 | 2.9161 |
| −0.5616 | 0.2934 | 2.9161 | 0.6815 | −0.4135 | 2.9161 |
| −0.6459 | 0.4023 | 2.9161 | 0.7713 | −0.5142 | 2.9161 |
| −0.7253 | 0.5096 | 2.9161 | 0.8586 | −0.6112 | 2.9161 |
| −0.7999 | 0.6151 | 2.9161 | 0.9432 | −0.7046 | 2.9161 |
| −0.8700 | 0.7189 | 2.9161 | 1.0250 | −0.7943 | 2.9161 |
| −0.9354 | 0.8204 | 2.9161 | 1.1042 | −0.8803 | 2.9161 |
| −0.9962 | 0.9193 | 2.9161 | 1.1807 | −0.9628 | 2.9160 |
| −1.0526 | 1.0155 | 2.9161 | 1.2545 | −1.0416 | 2.9161 |
| −1.1047 | 1.1088 | 2.9161 | 1.3253 | −1.1171 | 2.9161 |
| −1.1525 | 1.1991 | 2.9160 | 1.3901 | −1.1857 | 2.9161 |
| −1.1941 | 1.2822 | 2.9160 | 1.4489 | −1.2478 | 2.9161 |
| −1.2303 | 1.3576 | 2.9160 | 1.5016 | −1.3032 | 2.9161 |
| −1.2612 | 1.4251 | 2.9161 | 1.5482 | −1.3522 | 2.9161 |
| −1.2889 | 1.4892 | 2.9161 | 1.5885 | −1.3944 | 2.9161 |
| −1.3108 | 1.5454 | 2.9161 | 1.6228 | −1.4302 | 2.9161 |
| −1.3252 | 1.5895 | 2.9161 | 1.6520 | −1.4608 | 2.9160 |
| −1.3337 | 1.6257 | 2.9160 | 1.6765 | −1.4865 | 2.9160 |
| −1.3368 | 1.6535 | 2.9161 | 1.6968 | −1.5075 | 2.9161 |
| −1.3354 | 1.6742 | 2.9161 | 1.7129 | −1.5244 | 2.9160 |
| −1.3318 | 1.6853 | 2.9160 | 1.7236 | −1.5389 | 2.9160 |
| −1.3278 | 1.6914 | 2.9161 | 1.7265 | −1.5521 | 2.9161 |
| −1.3251 | 1.6941 | 2.9161 | 1.7252 | −1.5633 | 2.9161 |
| −1.3235 | 1.6952 | 2.9160 | 1.7219 | −1.5717 | 2.9161 |
| 1.6290 | −1.6773 | 3.5419 | −1.2686 | 1.6499 | 3.5419 |
| 1.6241 | −1.6819 | 3.5419 | −1.2678 | 1.6503 | 3.5419 |
| 1.6162 | −1.6864 | 3.5419 | −1.2662 | 1.6511 | 3.5419 |
| 1.6052 | −1.6887 | 3.5419 | −1.2628 | 1.6522 | 3.5419 |
| 1.5919 | −1.6867 | 3.5419 | −1.2556 | 1.6531 | 3.5419 |
| 1.5765 | −1.6770 | 3.5419 | −1.2445 | 1.6517 | 3.5419 |
| 1.5574 | −1.6630 | 3.5419 | −1.2257 | 1.6443 | 3.5419 |
| 1.5336 | −1.6454 | 3.5419 | −1.2029 | 1.6305 | 3.5419 |
| 1.5047 | −1.6241 | 3.5419 | −1.1748 | 1.6087 | 3.5419 |
| 1.4703 | −1.5987 | 3.5419 | −1.1416 | 1.5789 | 3.5419 |
| 1.4301 | −1.5689 | 3.5419 | −1.1008 | 1.5381 | 3.5419 |
| 1.3826 | −1.5336 | 3.5419 | −1.0552 | 1.4897 | 3.5419 |
| 1.3279 | −1.4927 | 3.5419 | −1.0069 | 1.4374 | 3.5419 |
| 1.2660 | −1.4464 | 3.5419 | −0.9530 | 1.3784 | 3.5419 |
| 1.1971 | −1.3943 | 3.5419 | −0.8934 | 1.3124 | 3.5419 |
| 1.1209 | −1.3365 | 3.5419 | −0.8282 | 1.2396 | 3.5419 |

TABLE 3-continued

| SUCTION SIDE | | | PRESSURE SIDE | | |
|---|---|---|---|---|---|
| X | Y | Z | X | Y | Z |
| 1.0379 | −1.2728 | 3.5419 | −0.7605 | 1.1632 | 3.5419 |
| 0.9517 | −1.2058 | 3.5419 | −0.6900 | 1.0833 | 3.5419 |
| 0.8623 | −1.1353 | 3.5419 | −0.6167 | 0.9998 | 3.5419 |
| 0.7700 | −1.0615 | 3.5419 | −0.5406 | 0.9129 | 3.5419 |
| 0.6748 | −0.9840 | 3.5419 | −0.4619 | 0.8225 | 3.5419 |
| 0.5771 | −0.9029 | 3.5419 | −0.3802 | 0.7287 | 3.5419 |
| 0.4771 | −0.8179 | 3.5419 | −0.2958 | 0.6315 | 3.5419 |
| 0.3750 | −0.7287 | 3.5419 | −0.2085 | 0.5307 | 3.5419 |
| 0.2744 | −0.6382 | 3.5419 | −0.1214 | 0.4299 | 3.5419 |
| 0.1755 | −0.5460 | 3.5419 | −0.0343 | 0.3291 | 3.5419 |
| 0.0785 | −0.4523 | 3.5419 | 0.0529 | 0.2283 | 3.5419 |
| −0.0165 | −0.3566 | 3.5419 | 0.1398 | 0.1273 | 3.5419 |
| −0.1092 | −0.2589 | 3.5419 | 0.2262 | 0.0259 | 3.5419 |
| −0.1995 | −0.1593 | 3.5419 | 0.3120 | −0.0760 | 3.5419 |
| −0.2876 | −0.0575 | 3.5419 | 0.3973 | −0.1785 | 3.5419 |
| −0.3736 | 0.0460 | 3.5419 | 0.4823 | −0.2811 | 3.5419 |
| −0.4577 | 0.1513 | 3.5419 | 0.5671 | −0.3839 | 3.5419 |
| −0.5401 | 0.2583 | 3.5419 | 0.6518 | −0.4868 | 3.5419 |
| −0.6204 | 0.3670 | 3.5419 | 0.7367 | −0.5895 | 3.5419 |
| −0.6960 | 0.4739 | 3.5419 | 0.8189 | −0.6886 | 3.5419 |
| −0.7671 | 0.5786 | 3.5419 | 0.8987 | −0.7841 | 3.5419 |
| −0.8340 | 0.6813 | 3.5419 | 0.9757 | −0.8760 | 3.5419 |
| −0.8966 | 0.7818 | 3.5419 | 1.0503 | −0.9642 | 3.5419 |
| −0.9550 | 0.8800 | 3.5419 | 1.1222 | −1.0488 | 3.5419 |
| −1.0093 | 0.975 | 3.5419 | 1.1916 | −1.1297 | 3.5419 |
| −1.0597 | 1.0681 | 3.5419 | 1.2583 | −1.2071 | 3.5419 |
| −1.1060 | 1.1579 | 3.5419 | 1.3194 | −1.2777 | 3.5419 |
| −1.1462 | 1.2403 | 3.5419 | 1.3747 | −1.3414 | 3.5419 |
| −1.1813 | 1.3150 | 3.5419 | 1.4243 | −1.3983 | 3.5419 |
| −1.2112 | 1.3820 | 3.5419 | 1.4682 | −1.4484 | 3.5419 |
| −1.2376 | 1.4455 | 3.5419 | 1.5063 | −1.4918 | 3.5419 |
| −1.2587 | 1.5012 | 3.5419 | 1.5387 | −1.5285 | 3.5419 |
| −1.2722 | 1.5450 | 3.5419 | 1.5662 | −1.5598 | 3.5419 |
| −1.2802 | 1.5809 | 3.5419 | 1.5894 | −1.5861 | 3.5419 |
| −1.2828 | 1.6082 | 3.5419 | 1.6085 | −1.6078 | 3.5419 |
| −1.2813 | 1.6288 | 3.5419 | 1.6239 | −1.6250 | 3.5419 |
| −1.2776 | 1.6397 | 3.5419 | 1.6345 | −1.6392 | 3.5419 |
| −1.2736 | 1.6457 | 3.5419 | 1.6378 | −1.6523 | 3.5419 |
| −1.2709 | 1.6482 | 3.5419 | 1.6365 | −1.6635 | 3.5419 |
| −1.2694 | 1.6493 | 3.5419 | 1.6331 | −1.6718 | 3.5419 |
| 1.5486 | −1.7704 | 4.1677 | −1.2290 | 1.6066 | 4.1677 |
| 1.5435 | −1.7748 | 4.1677 | −1.2282 | 1.6071 | 4.1677 |
| 1.5355 | −1.7787 | 4.1677 | −1.2265 | 1.6079 | 4.1677 |
| 1.5244 | −1.7801 | 4.1676 | −1.2232 | 1.6089 | 4.1676 |
| 1.5116 | −1.7767 | 4.1677 | −1.2161 | 1.6096 | 4.1676 |
| 1.4971 | −1.7660 | 4.1677 | −1.2051 | 1.6074 | 4.1676 |
| 1.4787 | −1.7515 | 4.1677 | −1.1869 | 1.5994 | 4.1677 |
| 1.4559 | −1.7334 | 4.1676 | −1.1648 | 1.5848 | 4.1677 |
| 1.4281 | −1.7114 | 4.1677 | −1.1376 | 1.5622 | 4.1677 |
| 1.3951 | −1.6850 | 4.1677 | −1.1059 | 1.5316 | 4.1677 |
| 1.3564 | −1.6542 | 4.1677 | −1.0667 | 1.4899 | 4.1677 |
| 1.3108 | −1.6177 | 4.1677 | −1.0229 | 1.4405 | 4.1676 |
| 1.2584 | −1.5754 | 4.1677 | −0.9769 | 1.3873 | 4.1676 |
| 1.1991 | −1.5273 | 4.1677 | −0.9253 | 1.3272 | 4.1677 |
| 1.1330 | −1.4734 | 4.1676 | −0.8683 | 1.2601 | 4.1676 |
| 1.0602 | −1.4133 | 4.1677 | −0.8060 | 1.1861 | 4.1677 |
| 0.9809 | −1.3471 | 4.1676 | −0.7412 | 1.1082 | 4.1676 |
| 0.8986 | −1.2775 | 4.1676 | −0.6737 | 1.0270 | 4.1677 |
| 0.8133 | −1.2043 | 4.1676 | −0.6036 | 0.9423 | 4.1676 |
| 0.7254 | −1.1276 | 4.1676 | −0.5308 | 0.8540 | 4.1677 |
| 0.6348 | −1.0473 | 4.1677 | −0.4553 | 0.7623 | 4.1677 |
| 0.5419 | −0.9632 | 4.1677 | −0.3770 | 0.6671 | 4.1676 |
| 0.4467 | −0.8752 | 4.1677 | −0.2960 | 0.5684 | 4.1676 |
| 0.3494 | −0.7830 | 4.1677 | −0.2124 | 0.4664 | 4.1677 |
| 0.2536 | −0.6897 | 4.1676 | −0.1286 | 0.3642 | 4.1677 |
| 0.1593 | −0.5951 | 4.1677 | −0.0448 | 0.2622 | 4.1677 |
| 0.0668 | −0.4988 | 4.1677 | 0.0391 | 0.1603 | 4.1676 |
| −0.0240 | −0.4011 | 4.1677 | 0.1229 | 0.0581 | 4.1677 |
| −0.1126 | −0.3015 | 4.1677 | 0.2062 | −0.0441 | 4.1677 |
| −0.1989 | −0.2000 | 4.1677 | 0.2890 | −0.1471 | 4.1677 |
| −0.2832 | −0.0969 | 4.1677 | 0.3712 | −0.2503 | 4.1677 |
| −0.3658 | 0.0078 | 4.1677 | 0.4530 | −0.3539 | 4.1676 |
| −0.4465 | 0.1141 | 4.1677 | 0.5347 | −0.4577 | 4.1676 |
| −0.5256 | 0.2219 | 4.1676 | 0.6161 | −0.5617 | 4.1677 |
| −0.6028 | 0.3312 | 4.1677 | 0.6975 | −0.6656 | 4.1677 |
| −0.6756 | 0.4385 | 4.1677 | 0.7762 | −0.7661 | 4.1676 |

TABLE 3-continued

| SUCTION SIDE | | | PRESSURE SIDE | | |
|---|---|---|---|---|---|
| X | Y | Z | X | Y | Z |
| −0.7441 | 0.5435 | 4.1676 | 0.8523 | −0.8630 | 4.1677 |
| −0.8084 | 0.6464 | 4.1676 | 0.9259 | −0.9563 | 4.1677 |
| −0.8688 | 0.7467 | 4.1677 | 0.9970 | −1.0460 | 4.1677 |
| −0.9252 | 0.8446 | 4.1677 | 1.0656 | −1.1321 | 4.1677 |
| −0.9775 | 0.9396 | 4.1677 | 1.1315 | −1.2145 | 4.1676 |
| −1.0263 | 1.0314 | 4.1677 | 1.1949 | −1.2935 | 4.1676 |
| −1.0709 | 1.1202 | 4.1677 | 1.2531 | −1.3654 | 4.1677 |
| −1.1098 | 1.2019 | 4.1676 | 1.3057 | −1.4302 | 4.1677 |
| −1.1437 | 1.2758 | 4.1677 | 1.3530 | −1.4883 | 4.1676 |
| −1.1728 | 1.3421 | 4.1677 | 1.3947 | −1.5394 | 4.1676 |
| −1.1984 | 1.4048 | 4.1677 | 1.4310 | −1.5837 | 4.1676 |
| −1.2188 | 1.4599 | 4.1676 | 1.4618 | −1.6211 | 4.1676 |
| −1.2320 | 1.5032 | 4.1677 | 1.4881 | −1.6530 | 4.1677 |
| −1.2397 | 1.5385 | 4.1677 | 1.5102 | −1.6798 | 4.1676 |
| −1.2425 | 1.5654 | 4.1677 | 1.5285 | −1.7018 | 4.1677 |
| −1.2412 | 1.5857 | 4.1677 | 1.5430 | −1.7194 | 4.1676 |
| −1.2378 | 1.5964 | 4.1677 | 1.5538 | −1.7334 | 4.1676 |
| −1.2339 | 1.6026 | 4.1677 | 1.5574 | −1.7461 | 4.1676 |
| −1.2312 | 1.6051 | 4.1677 | 1.5562 | −1.7571 | 4.1677 |
| −1.2298 | 1.6062 | 4.1676 | 1.5527 | −1.7651 | 4.1677 |
| 1.4899 | −1.8572 | 4.7935 | −1.2150 | 1.5850 | 4.7935 |
| 1.4847 | −1.8613 | 4.7935 | −1.2142 | 1.5855 | 4.7935 |
| 1.4764 | −1.8648 | 4.7935 | −1.2125 | 1.5861 | 4.7935 |
| 1.4653 | −1.8651 | 4.7935 | −1.2090 | 1.5872 | 4.7935 |
| 1.4530 | −1.8601 | 4.7935 | −1.2020 | 1.5872 | 4.7935 |
| 1.4392 | −1.8486 | 4.7935 | −1.1912 | 1.5842 | 4.7935 |
| 1.4214 | −1.8336 | 4.7935 | −1.1736 | 1.5747 | 4.7935 |
| 1.3991 | −1.8148 | 4.7935 | −1.1525 | 1.5588 | 4.7935 |
| 1.3721 | −1.7920 | 4.7935 | −1.1265 | 1.5348 | 4.7935 |
| 1.3400 | −1.7648 | 4.7935 | −1.0963 | 1.5028 | 4.7935 |
| 1.3023 | −1.7330 | 4.7935 | −1.0590 | 1.4595 | 4.7935 |
| 1.2580 | −1.6951 | 4.7935 | −1.0171 | 1.4084 | 4.7935 |
| 1.2070 | −1.6514 | 4.7935 | −0.9729 | 1.3535 | 4.7935 |
| 1.1493 | −1.6017 | 4.7935 | −0.9236 | 1.2916 | 4.7935 |
| 1.0851 | −1.5458 | 4.7935 | −0.8688 | 1.2227 | 4.7935 |
| 1.0144 | −1.4838 | 4.7935 | −0.8089 | 1.1465 | 4.7935 |
| 0.9373 | −1.4153 | 4.7935 | −0.7464 | 1.0668 | 4.7935 |
| 0.8576 | −1.3432 | 4.7935 | −0.6813 | 0.9836 | 4.7935 |
| 0.7750 | −1.2676 | 4.7935 | −0.6136 | 0.8968 | 4.7935 |
| 0.6900 | −1.1882 | 4.7935 | −0.5433 | 0.8065 | 4.7935 |
| 0.6027 | −1.1050 | 4.7935 | −0.4702 | 0.7128 | 4.7935 |
| 0.5131 | −1.0177 | 4.7935 | −0.3944 | 0.6156 | 4.7935 |
| 0.4215 | −0.9266 | 4.7935 | −0.3158 | 0.5149 | 4.7935 |
| 0.3279 | −0.8310 | 4.7935 | −0.2346 | 0.4107 | 4.7935 |
| 0.2359 | −0.7344 | 4.7935 | −0.1533 | 0.3067 | 4.7935 |
| 0.1453 | −0.6364 | 4.7935 | −0.0719 | 0.2027 | 4.7935 |
| 0.0563 | −0.5370 | 4.7935 | 0.0096 | 0.0988 | 4.7935 |
| −0.0309 | −0.4362 | 4.7935 | 0.0913 | −0.0050 | 4.7935 |
| −0.1164 | −0.3340 | 4.7935 | 0.1728 | −0.1090 | 4.7935 |
| −0.2000 | −0.2302 | 4.7935 | 0.2540 | −0.2131 | 4.7935 |
| −0.2819 | −0.1248 | 4.7935 | 0.3349 | −0.3175 | 4.7935 |
| −0.3622 | −0.0181 | 4.7935 | 0.4155 | −0.4221 | 4.7935 |
| −0.4409 | 0.0898 | 4.7935 | 0.4959 | −0.5270 | 4.7935 |
| −0.5180 | 0.1992 | 4.7935 | 0.5762 | −0.6318 | 4.7935 |
| −0.5934 | 0.3101 | 4.7935 | 0.6564 | −0.7367 | 4.7935 |
| −0.6645 | 0.4187 | 4.7935 | 0.7340 | −0.8382 | 4.7935 |
| −0.7316 | 0.5248 | 4.7935 | 0.8089 | −0.9361 | 4.7935 |
| −0.7948 | 0.6284 | 4.7935 | 0.8811 | −1.0305 | 4.7935 |
| −0.8538 | 0.7292 | 4.7935 | 0.9508 | −1.1213 | 4.7935 |
| −0.9090 | 0.8271 | 4.7935 | 1.0179 | −1.2086 | 4.7935 |
| −0.9604 | 0.9219 | 4.7935 | 1.0824 | −1.2923 | 4.7935 |
| −1.0083 | 1.0135 | 4.7935 | 1.1442 | −1.3724 | 4.7935 |
| −1.0525 | 1.1020 | 4.7935 | 1.2009 | −1.4455 | 4.7935 |
| −1.0911 | 1.1831 | 4.7935 | 1.2522 | −1.5116 | 4.7935 |
| −1.1249 | 1.2566 | 4.7935 | 1.2981 | −1.5707 | 4.7935 |
| −1.1540 | 1.3224 | 4.7935 | 1.3387 | −1.6228 | 4.7935 |
| −1.1800 | 1.3845 | 4.7935 | 1.3739 | −1.6678 | 4.7935 |
| −1.2009 | 1.4392 | 4.7935 | 1.4038 | −1.7060 | 4.7935 |
| −1.2145 | 1.4820 | 4.7935 | 1.4293 | −1.7385 | 4.7935 |
| −1.2230 | 1.5169 | 4.7935 | 1.4508 | −1.7658 | 4.7935 |
| −1.2266 | 1.5437 | 4.7935 | 1.4685 | −1.7883 | 4.7935 |
| −1.2261 | 1.5639 | 4.7935 | 1.4828 | −1.8063 | 4.7935 |
| −1.2234 | 1.5747 | 4.7935 | 1.4935 | −1.8202 | 4.7935 |
| −1.2198 | 1.5809 | 4.7935 | 1.4982 | −1.8325 | 4.7935 |
| −1.2172 | 1.5835 | 4.7935 | 1.4976 | −1.8436 | 4.7935 |
| −1.2158 | 1.5846 | 4.7935 | 1.4941 | −1.8519 | 4.7935 |

TABLE 3-continued

| SUCTION SIDE | | | PRESSURE SIDE | | |
|---|---|---|---|---|---|
| X | Y | Z | X | Y | Z |
| 1.4636 | −1.9721 | 5.4193 | −1.2133 | 1.5699 | 5.4192 |
| 1.4581 | −1.9761 | 5.4193 | −1.2124 | 1.5704 | 5.4193 |
| 1.4496 | −1.9790 | 5.4193 | −1.2107 | 1.5710 | 5.4193 |
| 1.4383 | −1.9784 | 5.4193 | −1.2072 | 1.5717 | 5.4193 |
| 1.4267 | −1.9716 | 5.4193 | −1.2000 | 1.5711 | 5.4193 |
| 1.4132 | −1.9596 | 5.4192 | −1.1894 | 1.5673 | 5.4192 |
| 1.3956 | −1.9438 | 5.4193 | −1.1723 | 1.5567 | 5.4193 |
| 1.3738 | −1.9240 | 5.4192 | −1.1517 | 1.5393 | 5.4192 |
| 1.3472 | −1.9001 | 5.4192 | −1.1265 | 1.5139 | 5.4192 |
| 1.3157 | −1.8715 | 5.4193 | −1.0973 | 1.4803 | 5.4193 |
| 1.2788 | −1.8380 | 5.4193 | −1.0611 | 1.4351 | 5.4193 |
| 1.2354 | −1.7984 | 5.4193 | −1.0203 | 1.3819 | 5.4193 |
| 1.1852 | −1.7526 | 5.4193 | −0.9773 | 1.3250 | 5.4193 |
| 1.1286 | −1.7004 | 5.4192 | −0.9290 | 1.2608 | 5.4192 |
| 1.0656 | −1.6419 | 5.4193 | −0.8755 | 1.1893 | 5.4193 |
| 0.9961 | −1.5770 | 5.4193 | −0.8168 | 1.1106 | 5.4192 |
| 0.9205 | −1.5054 | 5.4193 | −0.7557 | 1.0282 | 5.4193 |
| 0.8421 | −1.4301 | 5.4193 | −0.6918 | 0.9421 | 5.4192 |
| 0.7612 | −1.3511 | 5.4193 | −0.6253 | 0.8525 | 5.4192 |
| 0.6777 | −1.2683 | 5.4193 | −0.5561 | 0.7595 | 5.4192 |
| 0.5919 | −1.1816 | 5.4192 | −0.4842 | 0.6628 | 5.4193 |
| 0.5040 | −1.0909 | 5.4193 | −0.4096 | 0.5626 | 5.4193 |
| 0.4140 | −0.9959 | 5.4192 | −0.3321 | 0.4589 | 5.4193 |
| 0.3222 | −0.8967 | 5.4193 | −0.2519 | 0.3517 | 5.4192 |
| 0.2318 | −0.7962 | 5.4192 | −0.1715 | 0.2446 | 5.4193 |
| 0.1430 | −0.6945 | 5.4192 | −0.0909 | 0.1376 | 5.4192 |
| 0.0557 | −0.5916 | 5.4192 | −0.0102 | 0.0309 | 5.4193 |
| −0.0300 | −0.4873 | 5.4192 | 0.0707 | −0.0757 | 5.4193 |
| −0.1140 | −0.3816 | 5.4192 | 0.1515 | −0.1824 | 5.4193 |
| −0.1963 | −0.2744 | 5.4193 | 0.2324 | −0.2892 | 5.4192 |
| −0.2771 | −0.1661 | 5.4193 | 0.3129 | −0.3961 | 5.4193 |
| −0.3565 | −0.0564 | 5.4193 | 0.3932 | −0.5032 | 5.4193 |
| −0.4343 | 0.0543 | 5.4193 | 0.4733 | −0.6105 | 5.4193 |
| −0.5107 | 0.1664 | 5.4193 | 0.5534 | −0.7178 | 5.4193 |
| −0.5854 | 0.2798 | 5.4192 | 0.6334 | −0.8252 | 5.4193 |
| −0.6562 | 0.3907 | 5.4193 | 0.7105 | −0.9290 | 5.4193 |
| −0.7228 | 0.4987 | 5.4193 | 0.7851 | −1.0293 | 5.4193 |
| −0.7856 | 0.6039 | 5.4193 | 0.8570 | −1.1259 | 5.4192 |
| −0.8444 | 0.7062 | 5.4193 | 0.9264 | −1.2190 | 5.4193 |
| −0.8996 | 0.8052 | 5.4193 | 0.9931 | −1.3084 | 5.4193 |
| −0.9510 | 0.9012 | 5.4193 | 1.0573 | −1.3942 | 5.4193 |
| −0.9990 | 0.9938 | 5.4193 | 1.1188 | −1.4764 | 5.4192 |
| −1.0436 | 1.0830 | 5.4192 | 1.1750 | −1.5513 | 5.4193 |
| −1.0827 | 1.1649 | 5.4193 | 1.2261 | −1.6191 | 5.4193 |
| −1.1171 | 1.2391 | 5.4193 | 1.2718 | −1.6796 | 5.4193 |
| −1.1467 | 1.3052 | 5.4192 | 1.3121 | −1.7330 | 5.4193 |
| −1.1733 | 1.3679 | 5.4192 | 1.3471 | −1.7792 | 5.4193 |
| −1.1949 | 1.4227 | 5.4193 | 1.3768 | −1.8183 | 5.4193 |
| −1.2095 | 1.4657 | 5.4192 | 1.4022 | −1.8517 | 5.4193 |
| −1.2188 | 1.5008 | 5.4193 | 1.4236 | −1.8797 | 5.4193 |
| −1.2230 | 1.5277 | 5.4193 | 1.4412 | −1.9028 | 5.4192 |
| −1.2234 | 1.5481 | 5.4193 | 1.4553 | −1.9212 | 5.4192 |
| −1.2212 | 1.5592 | 5.4193 | 1.4662 | −1.9354 | 5.4193 |
| −1.2180 | 1.5656 | 5.4193 | 1.4716 | −1.9475 | 5.4192 |
| −1.2155 | 1.5683 | 5.4193 | 1.4713 | −1.9587 | 5.4193 |
| −1.2141 | 1.5695 | 5.4193 | 1.4679 | −1.9668 | 5.4192 |
| 1.4595 | −2.1178 | 6.0451 | −1.2205 | 1.5590 | 6.0451 |
| 1.4538 | −2.1217 | 6.0451 | −1.2196 | 1.5594 | 6.0451 |
| 1.4448 | −2.1242 | 6.0451 | −1.2179 | 1.5600 | 6.0451 |
| 1.4334 | −2.1225 | 6.0451 | −1.2142 | 1.5606 | 6.0451 |
| 1.4222 | −2.1144 | 6.0451 | −1.2068 | 1.5596 | 6.0451 |
| 1.4087 | −2.1017 | 6.0451 | −1.1962 | 1.5551 | 6.0451 |
| 1.3914 | −2.0851 | 6.0451 | −1.1792 | 1.5434 | 6.0451 |
| 1.3696 | −2.0643 | 6.0451 | −1.1588 | 1.5249 | 6.0451 |
| 1.3433 | −2.0390 | 6.0451 | −1.1339 | 1.4980 | 6.0451 |
| 1.3120 | −2.0088 | 6.0451 | −1.1050 | 1.4628 | 6.0451 |
| 1.2752 | −1.9736 | 6.0451 | −1.0690 | 1.4155 | 6.0451 |
| 1.2320 | −1.9318 | 6.0451 | −1.0285 | 1.3601 | 6.0451 |
| 1.1823 | −1.8834 | 6.0451 | −0.9857 | 1.3008 | 6.0451 |
| 1.1260 | −1.8285 | 6.0451 | −0.9378 | 1.2340 | 6.0451 |
| 1.0633 | −1.7669 | 6.0451 | −0.8846 | 1.1596 | 6.0451 |
| 0.9943 | −1.6985 | 6.0451 | −0.8262 | 1.0777 | 6.0451 |
| 0.9192 | −1.6232 | 6.0451 | −0.7653 | 0.9920 | 6.0451 |
| 0.8412 | −1.5441 | 6.0451 | −0.7018 | 0.9025 | 6.0451 |
| 0.7607 | −1.4614 | 6.0451 | −0.6356 | 0.8094 | 6.0451 |
| 0.6777 | −1.3746 | 6.0451 | −0.5666 | 0.7125 | 6.0451 |

TABLE 3-continued

| SUCTION SIDE | | | PRESSURE SIDE | | |
|---|---|---|---|---|---|
| X | Y | Z | X | Y | Z |
| 0.5924 | −1.2837 | 6.0451 | −0.4949 | 0.6121 | 6.0451 |
| 0.5048 | −1.1888 | 6.0451 | −0.4203 | 0.5080 | 6.0451 |
| 0.4152 | −1.0894 | 6.0451 | −0.3431 | 0.4004 | 6.0451 |
| 0.3237 | −0.9857 | 6.0451 | −0.2629 | 0.2891 | 6.0451 |
| 0.2335 | −0.8808 | 6.0451 | −0.1824 | 0.1780 | 6.0451 |
| 0.1448 | −0.7747 | 6.0451 | −0.1018 | 0.0671 | 6.0451 |
| 0.0577 | −0.6674 | 6.0451 | −0.0208 | −0.0437 | 6.0451 |
| −0.0279 | −0.5587 | 6.0451 | 0.0603 | −0.1542 | 6.0451 |
| −0.1118 | −0.4484 | 6.0451 | 0.1416 | −0.2647 | 6.0451 |
| −0.1940 | −0.3369 | 6.0451 | 0.2227 | −0.3752 | 6.0451 |
| −0.2748 | −0.2241 | 6.0451 | 0.3035 | −0.4860 | 6.0451 |
| −0.3544 | −0.1103 | 6.0451 | 0.3842 | −0.5970 | 6.0451 |
| −0.4324 | 0.0046 | 6.0451 | 0.4646 | −0.7081 | 6.0451 |
| −0.5089 | 0.1206 | 6.0451 | 0.5449 | −0.8193 | 6.0451 |
| −0.5839 | 0.2376 | 6.0451 | 0.6250 | −0.9305 | 6.0451 |
| −0.6546 | 0.3517 | 6.0451 | 0.7025 | −1.0381 | 6.0451 |
| −0.7216 | 0.4628 | 6.0451 | 0.7772 | −1.1421 | 6.0451 |
| −0.7846 | 0.5709 | 6.0451 | 0.8494 | −1.2422 | 6.0451 |
| −0.8438 | 0.6757 | 6.0451 | 0.9188 | −1.3385 | 6.0451 |
| −0.8995 | 0.7773 | 6.0451 | 0.9858 | −1.4311 | 6.0451 |
| −0.9514 | 0.8755 | 6.0451 | 1.0502 | −1.5201 | 6.0451 |
| −1.0000 | 0.9704 | 6.0451 | 1.1119 | −1.6052 | 6.0451 |
| −1.0452 | 1.0616 | 6.0451 | 1.1684 | −1.6828 | 6.0451 |
| −1.0849 | 1.1454 | 6.0451 | 1.2196 | −1.7529 | 6.0451 |
| −1.1198 | 1.2211 | 6.0451 | 1.2655 | −1.8156 | 6.0451 |
| −1.1500 | 1.2888 | 6.0451 | 1.3060 | −1.8710 | 6.0451 |
| −1.1772 | 1.3527 | 6.0451 | 1.3413 | −1.9188 | 6.0451 |
| −1.1994 | 1.4087 | 6.0451 | 1.3711 | −1.9593 | 6.0451 |
| −1.2145 | 1.4525 | 6.0451 | 1.3966 | −1.9939 | 6.0451 |
| −1.2243 | 1.4883 | 6.0451 | 1.4180 | −2.0229 | 6.0451 |
| −1.2292 | 1.5156 | 6.0451 | 1.4357 | −2.0468 | 6.0451 |
| −1.2301 | 1.5364 | 6.0451 | 1.4498 | −2.0660 | 6.0451 |
| −1.2282 | 1.5478 | 6.0451 | 1.4607 | −2.0806 | 6.0451 |
| −1.2252 | 1.5546 | 6.0451 | 1.4670 | −2.0927 | 6.0451 |
| −1.2227 | 1.5574 | 6.0451 | 1.4672 | −2.1040 | 6.0451 |
| −1.2212 | 1.5585 | 6.0451 | 1.4638 | −2.1125 | 6.0451 |
| 1.4572 | −2.2538 | 6.6708 | −1.2369 | 1.5599 | 6.6709 |
| 1.4513 | −2.2576 | 6.6709 | −1.2361 | 1.5604 | 6.6708 |
| 1.4420 | −2.2597 | 6.6709 | −1.2344 | 1.5609 | 6.6709 |
| 1.4305 | −2.2571 | 6.6709 | −1.2305 | 1.5615 | 6.6709 |
| 1.4196 | −2.2481 | 6.6708 | −1.2230 | 1.5602 | 6.6708 |
| 1.4060 | −2.2347 | 6.6708 | −1.2123 | 1.5550 | 6.6708 |
| 1.3886 | −2.2174 | 6.6709 | −1.1953 | 1.5425 | 6.6709 |
| 1.3666 | −2.1956 | 6.6708 | −1.1748 | 1.5230 | 6.6709 |
| 1.3401 | −2.1692 | 6.6709 | −1.1499 | 1.4950 | 6.6708 |
| 1.3085 | −2.1379 | 6.6708 | −1.1209 | 1.4582 | 6.6709 |
| 1.2715 | −2.1010 | 6.6708 | −1.0848 | 1.4091 | 6.6709 |
| 1.2281 | −2.0573 | 6.6708 | −1.0442 | 1.3517 | 6.6709 |
| 1.1779 | −2.0068 | 6.6709 | −1.0013 | 1.2901 | 6.6709 |
| 1.1212 | −1.9495 | 6.6709 | −0.9531 | 1.2207 | 6.6709 |
| 1.0582 | −1.8852 | 6.6708 | −0.8999 | 1.1435 | 6.6708 |
| 0.9888 | −1.8137 | 6.6708 | −0.8415 | 1.0585 | 6.6708 |
| 0.9132 | −1.7352 | 6.6709 | −0.7805 | 0.9695 | 6.6708 |
| 0.8350 | −1.6527 | 6.6708 | −0.7169 | 0.8765 | 6.6709 |
| 0.7540 | −1.5662 | 6.6708 | −0.6506 | 0.7799 | 6.6709 |
| 0.6705 | −1.4757 | 6.6708 | −0.5816 | 0.6793 | 6.6709 |
| 0.5849 | −1.3810 | 6.6709 | −0.5098 | 0.5750 | 6.6709 |
| 0.4968 | −1.2818 | 6.6709 | −0.4352 | 0.4669 | 6.6709 |
| 0.4070 | −1.1784 | 6.6708 | −0.3577 | 0.3552 | 6.6708 |
| 0.3152 | −1.0702 | 6.6709 | −0.2773 | 0.2397 | 6.6708 |
| 0.2249 | −0.9608 | 6.6709 | −0.1966 | 0.1244 | 6.6708 |
| 0.1361 | −0.8503 | 6.6708 | −0.1155 | 0.0094 | 6.6708 |
| 0.0488 | −0.7384 | 6.6708 | −0.0342 | −0.1054 | 6.6709 |
| −0.0367 | −0.6252 | 6.6708 | 0.0475 | −0.2200 | 6.6708 |
| −0.1205 | −0.5105 | 6.6708 | 0.1295 | −0.3344 | 6.6709 |
| −0.2028 | −0.3946 | 6.6708 | 0.2113 | −0.4488 | 6.6708 |
| −0.2838 | −0.2775 | 6.6708 | 0.2930 | −0.5634 | 6.6709 |
| −0.3634 | −0.1595 | 6.6709 | 0.3743 | −0.6783 | 6.6709 |
| −0.4417 | −0.0405 | 6.6708 | 0.4554 | −0.7932 | 6.6709 |
| −0.5184 | 0.0793 | 6.6709 | 0.5363 | −0.9083 | 6.6708 |
| −0.5937 | 0.2003 | 6.6709 | 0.6171 | −1.0236 | 6.6708 |
| −0.6649 | 0.3180 | 6.6709 | 0.6951 | −1.1350 | 6.6709 |
| −0.7321 | 0.4327 | 6.6708 | 0.7703 | −1.2426 | 6.6708 |
| −0.7956 | 0.5440 | 6.6708 | 0.8430 | −1.3464 | 6.6708 |
| −0.8552 | 0.6521 | 6.6709 | 0.9129 | −1.4463 | 6.6708 |
| −0.9113 | 0.7567 | 6.6709 | 0.9802 | −1.5422 | 6.6708 |

TABLE 3-continued

| SUCTION SIDE | | | PRESSURE SIDE | | |
|---|---|---|---|---|---|
| X | Y | Z | X | Y | Z |
| −0.9639 | 0.8578 | 6.6708 | 1.0450 | −1.6344 | 6.6709 |
| −1.0129 | 0.9554 | 6.6708 | 1.1070 | −1.7227 | 6.6708 |
| −1.0585 | 1.0493 | 6.6708 | 1.1638 | −1.8031 | 6.6709 |
| −1.0987 | 1.1352 | 6.6709 | 1.2152 | −1.8759 | 6.6708 |
| −1.1340 | 1.2131 | 6.6708 | 1.2613 | −1.9410 | 6.6709 |
| −1.1646 | 1.2826 | 6.6709 | 1.3021 | −1.9983 | 6.6709 |
| −1.1921 | 1.3483 | 6.6708 | 1.3375 | −1.0480 | 6.6708 |
| −1.2146 | 1.4058 | 6.6708 | 1.3674 | −2.0900 | 6.6709 |
| −1.2300 | 1.4507 | 6.6709 | 1.3931 | −2.1259 | 6.6708 |
| −1.2401 | 1.4874 | 6.6709 | 1.4147 | −2.1560 | 6.6708 |
| −1.2452 | 1.5154 | 6.6709 | 1.4324 | −2.1808 | 6.6708 |
| −1.2463 | 1.5366 | 6.6708 | 1.4466 | −2.2006 | 6.6708 |
| −1.2448 | 1.5484 | 6.6709 | 1.4576 | −2.2158 | 6.6708 |
| −1.2417 | 1.5553 | 6.6708 | 1.4645 | −2.2280 | 6.6709 |
| −1.2393 | 1.5583 | 6.6708 | 1.4652 | −2.2397 | 6.6709 |
| −1.2378 | 1.5594 | 6.6709 | 1.4618 | −2.2484 | 6.6709 |
| 1.4417 | −2.3336 | 7.2967 | −1.2514 | 1.5756 | 7.2967 |
| 1.4355 | −2.3374 | 7.2967 | −1.2505 | 1.5761 | 7.2967 |
| 1.4260 | −2.3391 | 7.2967 | −1.2487 | 1.5766 | 7.2967 |
| 1.4146 | −2.3358 | 7.2967 | −1.2448 | 1.5771 | 7.2967 |
| 1.4039 | −2.3259 | 7.2967 | −1.2373 | 1.5755 | 7.2967 |
| 1.3904 | −2.3122 | 7.2967 | −1.2265 | 1.5701 | 7.2967 |
| 1.3728 | −2.2944 | 7.2967 | −1.2094 | 1.5570 | 7.2967 |
| 1.3508 | −2.2720 | 7.2967 | −1.1890 | 1.5369 | 7.2967 |
| 1.3242 | −2.2449 | 7.2967 | −1.1640 | 1.5081 | 7.2967 |
| 1.2925 | −2.2126 | 7.2967 | −1.1349 | 1.4704 | 7.2967 |
| 1.2555 | −2.1746 | 7.2967 | −1.0987 | 1.4202 | 7.2967 |
| 1.2118 | −2.1297 | 7.2967 | −1.0580 | 1.3614 | 7.2967 |
| 1.1616 | −2.0777 | 7.2967 | −1.0151 | 1.2983 | 7.2967 |
| 1.1048 | −2.0187 | 7.2967 | −0.9670 | 1.2272 | 7.2967 |
| 1.0416 | −1.9525 | 7.2967 | −0.9137 | 1.1481 | 7.2967 |
| 0.9722 | −1.8789 | 7.2967 | −0.8555 | 1.0609 | 7.2967 |
| 0.8964 | −1.7980 | 7.2967 | −0.7946 | 0.9697 | 7.2967 |
| 0.8180 | −1.7130 | 7.2967 | −0.7312 | 0.8744 | 7.2967 |
| 0.7372 | −1.6240 | 7.2967 | −0.6652 | 0.7753 | 7.2967 |
| 0.6537 | −1.5308 | 7.2967 | −0.5963 | 0.6721 | 7.2967 |
| 0.5681 | −1.4333 | 7.2967 | −0.5247 | 0.5652 | 7.2967 |
| 0.4804 | −1.3312 | 7.2967 | −0.4502 | 0.4544 | 7.2967 |
| 0.3907 | −1.2246 | 7.2967 | −0.3730 | 0.3398 | 7.2967 |
| 0.2993 | −1.1132 | 7.2967 | −0.2927 | 0.2214 | 7.2967 |
| 0.2093 | −1.0006 | 7.2967 | −0.2121 | 0.1033 | 7.2967 |
| 0.1210 | −0.8868 | 7.2967 | −0.1312 | −0.0147 | 7.2967 |
| 0.0343 | −0.7717 | 7.2967 | −0.0500 | −0.1324 | 7.2967 |
| −0.0506 | −0.6551 | 7.2967 | 0.0317 | −0.2498 | 7.2967 |
| −0.1340 | −0.5373 | 7.2967 | 0.1137 | −0.3670 | 7.2967 |
| −0.2158 | −0.4183 | 7.2967 | 0.1958 | −0.4841 | 7.2967 |
| −0.2966 | −0.2985 | 7.2967 | 0.2778 | −0.6013 | 7.2967 |
| −0.3761 | −0.1776 | 7.2967 | 0.3593 | −0.7188 | 7.2967 |
| −0.4542 | −0.0559 | 7.2967 | 0.4406 | −0.8365 | 7.2967 |
| −0.5308 | 0.0666 | 7.2967 | 0.5217 | −0.9544 | 7.2967 |
| −0.6060 | 0.1902 | 7.2967 | 0.6026 | −1.0723 | 7.2967 |
| −0.6772 | 0.3106 | 7.2967 | 0.6806 | −1.1864 | 7.2967 |
| −0.7446 | 0.4276 | 7.2967 | 0.7559 | −1.2967 | 7.2967 |
| −0.8081 | 0.5412 | 7.2967 | 0.8285 | −1.4030 | 7.2967 |
| −0.8679 | 0.6514 | 7.2967 | 0.8982 | −1.5055 | 7.2967 |
| −0.9241 | 0.7580 | 7.2967 | 0.9654 | −1.6040 | 7.2967 |
| −0.9769 | 0.8609 | 7.2967 | 1.0300 | −1.6985 | 7.2967 |
| −1.0260 | 0.9604 | 7.2967 | 1.0918 | −1.7890 | 7.2967 |
| −1.0720 | 1.0560 | 7.2967 | 1.1483 | −1.8716 | 7.2967 |
| −1.1124 | 1.1435 | 7.2967 | 1.1995 | −1.9463 | 7.2967 |
| −1.1478 | 1.2228 | 7.2967 | 1.2454 | −2.0131 | 7.2967 |
| −1.1785 | 1.2936 | 7.2967 | 1.2861 | −2.0720 | 7.2967 |
| −1.2061 | 1.3605 | 7.2967 | 1.3213 | −2.1230 | 7.2967 |
| −1.2286 | 1.4189 | 7.2967 | 1.3512 | −2.1661 | 7.2967 |
| −1.2441 | 1.4646 | 7.2967 | 1.3767 | −2.2029 | 7.2967 |
| −1.2542 | 1.5018 | 7.2967 | 1.3982 | −2.2338 | 7.2967 |
| −1.2594 | 1.5302 | 7.2967 | 1.4160 | −2.2593 | 7.2967 |
| −1.2607 | 1.5519 | 7.2967 | 1.4302 | −2.2795 | 7.2967 |
| −1.2591 | 1.5639 | 7.2967 | 1.4412 | −2.2951 | 7.2967 |
| −1.2562 | 1.5709 | 7.2967 | 1.4487 | −2.3072 | 7.2967 |
| −1.2537 | 1.5739 | 7.2967 | 1.4498 | −2.3192 | 7.2967 |
| −1.2523 | 1.5752 | 7.2967 | 1.4465 | −2.3281 | 7.2967 |
| 1.4296 | −2.3528 | 7.6096 | −1.2547 | 1.5856 | 7.6096 |
| 1.4234 | −2.3565 | 7.6096 | −1.2538 | 1.5860 | 7.6096 |
| 1.4139 | −2.3580 | 7.6096 | −1.2520 | 1.5866 | 7.6096 |
| 1.4025 | −2.3542 | 7.6096 | −1.2481 | 1.5869 | 7.6096 |

TABLE 3-continued

| SUCTION SIDE | | | PRESSURE SIDE | | |
|---|---|---|---|---|---|
| X | Y | Z | X | Y | Z |
| 1.3920 | −2.3442 | 7.6096 | −1.2406 | 1.5854 | 7.6096 |
| 1.3786 | −2.3303 | 7.6096 | −1.2299 | 1.5798 | 7.6096 |
| 1.3610 | −2.3122 | 7.6096 | −1.2128 | 1.5664 | 7.6096 |
| 1.3392 | −2.2897 | 7.6096 | −1.1925 | 1.5462 | 7.6096 |
| 1.3126 | −2.2623 | 7.6096 | −1.1676 | 1.5170 | 7.6096 |
| 1.2811 | −2.2296 | 7.6096 | −1.1385 | 1.4792 | 7.6096 |
| 1.2442 | −2.1912 | 7.6096 | −1.1023 | 1.4284 | 7.6096 |
| 1.2008 | −2.1458 | 7.6096 | −1.0616 | 1.3693 | 7.6096 |
| 1.1507 | −2.0933 | 7.6096 | −1.0190 | 1.3058 | 7.6096 |
| 1.0941 | −2.0337 | 7.6096 | −0.9710 | 1.2341 | 7.6096 |
| 1.0312 | −1.9668 | 7.6096 | −0.9180 | 1.1545 | 7.6096 |
| 0.9620 | −1.8926 | 7.6096 | −0.8598 | 1.0667 | 7.6096 |
| 0.8866 | −1.8108 | 7.6096 | −0.7993 | 0.9747 | 7.6096 |
| 0.8084 | −1.7251 | 7.6096 | −0.7362 | 0.8789 | 7.6096 |
| 0.7278 | −1.6352 | 7.6096 | −0.6703 | 0.7788 | 7.6096 |
| 0.6447 | −1.5411 | 7.6096 | −0.6018 | 0.6750 | 7.6096 |
| 0.5593 | −1.4428 | 7.6096 | −0.5305 | 0.5673 | 7.6096 |
| 0.4720 | −1.3399 | 7.6096 | −0.4564 | 0.4556 | 7.6096 |
| 0.3826 | −1.2322 | 7.6096 | −0.3793 | 0.3401 | 7.6096 |
| 0.2916 | −1.1198 | 7.6096 | −0.2994 | 0.2209 | 7.6096 |
| 0.2022 | −1.0062 | 7.6096 | −0.2191 | 0.1018 | 7.6096 |
| 0.1142 | −0.8913 | 7.6096 | −0.1385 | −0.0170 | 7.6096 |
| 0.0280 | −0.7752 | 7.6096 | −0.0576 | −0.1356 | 7.6096 |
| −0.0564 | −0.6574 | 7.6096 | 0.0239 | −0.2539 | 7.6096 |
| −0.1393 | −0.5386 | 7.6096 | 0.1055 | −0.3721 | 7.6096 |
| −0.2209 | −0.4188 | 7.6096 | 0.1874 | −0.4900 | 7.6096 |
| −0.3013 | −0.2979 | 7.6096 | 0.2692 | −0.6080 | 7.6096 |
| −0.3804 | −0.1763 | 7.6096 | 0.3507 | −0.7263 | 7.6096 |
| −0.4582 | −0.0538 | 7.6096 | 0.4318 | −0.8448 | 7.6096 |
| −0.5346 | 0.0697 | 7.6096 | 0.5125 | −0.9635 | 7.6096 |
| −0.6095 | 0.1939 | 7.6096 | 0.5932 | −1.0824 | 7.6096 |
| −0.6805 | 0.3149 | 7.6096 | 0.6709 | −1.1973 | 7.6096 |
| −0.7477 | 0.4325 | 7.6096 | 0.7458 | −1.3085 | 7.6096 |
| −0.8111 | 0.5468 | 7.6096 | 0.8179 | −1.4157 | 7.6096 |
| −0.8708 | 0.6574 | 7.6096 | 0.8875 | −1.5188 | 7.6096 |
| −0.9270 | 0.7646 | 7.6096 | 0.9544 | −1.6181 | 7.6096 |
| −0.9797 | 0.8681 | 7.6096 | 1.0185 | −1.7134 | 7.6096 |
| −1.0289 | 0.9679 | 7.6096 | 1.0802 | −1.8045 | 7.6096 |
| −1.0748 | 1.0640 | 7.6096 | 1.1366 | −1.8878 | 7.6096 |
| −1.1153 | 1.1519 | 7.6096 | 1.1876 | −1.9630 | 7.6096 |
| −1.1507 | 1.2314 | 7.6096 | 1.2335 | −2.0303 | 7.6096 |
| −1.1815 | 1.3026 | 7.6096 | 1.2739 | −2.0896 | 7.6096 |
| −1.2092 | 1.3696 | 7.6096 | 1.3091 | −2.1410 | 7.6096 |
| −1.2317 | 1.4283 | 7.6096 | 1.3388 | −2.1843 | 7.6096 |
| −1.2471 | 1.4741 | 7.6096 | 1.3643 | −2.2214 | 7.6096 |
| −1.2573 | 1.5116 | 7.6096 | 1.3858 | −2.2525 | 7.6096 |
| −1.2627 | 1.5401 | 7.6096 | 1.4036 | −2.2781 | 7.6096 |
| −1.2640 | 1.5617 | 7.6096 | 1.4178 | −2.2986 | 7.6096 |
| −1.2625 | 1.5737 | 7.6096 | 1.4288 | −2.3142 | 7.6096 |
| −1.2596 | 1.5809 | 7.6096 | 1.4364 | −2.3264 | 7.6096 |
| −1.2572 | 1.5839 | 7.6096 | 1.4377 | −2.3383 | 7.6096 |
| −1.2556 | 1.5851 | 7.6096 | 1.4344 | −2.3473 | 7.6096 |
| 1.4077 | −2.3523 | 7.9224 | −1.2545 | 1.5934 | 7.9224 |
| 1.4015 | −2.3560 | 7.9225 | −1.2537 | 1.5939 | 7.9224 |
| 1.3919 | −2.3575 | 7.9224 | −1.2518 | 1.5944 | 7.9225 |
| 1.3807 | −2.3533 | 7.9225 | −1.2479 | 1.5948 | 7.9225 |
| 1.3704 | −2.3432 | 7.9224 | −1.2404 | 1.5930 | 7.9224 |
| 1.3571 | −2.3292 | 7.9225 | −1.2298 | 1.5873 | 7.9225 |
| 1.3397 | −2.3110 | 7.9224 | −1.2130 | 1.5738 | 7.9225 |
| 1.3181 | −2.2884 | 7.9225 | −1.1927 | 1.5533 | 7.9224 |
| 1.2918 | −2.2607 | 7.9224 | −1.1680 | 1.5242 | 7.9225 |
| 1.2606 | −2.2279 | 7.9225 | −1.1393 | 1.4861 | 7.9225 |
| 1.2242 | −2.1894 | 7.9224 | −1.1034 | 1.4354 | 7.9225 |
| 1.1810 | −2.1437 | 7.9224 | −1.0630 | 1.3761 | 7.9225 |
| 1.1315 | −2.0909 | 7.9225 | −1.0207 | 1.3125 | 7.9225 |
| 1.0755 | −2.0310 | 7.9225 | −0.9731 | 1.2408 | 7.9224 |
| 1.0133 | −1.9637 | 7.9224 | −0.9204 | 1.1610 | 7.9224 |
| 0.9447 | −1.8891 | 7.9224 | −0.8628 | 1.0731 | 7.9225 |
| 0.8701 | −1.8070 | 7.9224 | −0.8027 | 0.9810 | 7.9225 |
| 0.7928 | −1.7209 | 7.9225 | −0.7401 | 0.8848 | 7.9224 |
| 0.7130 | −1.6306 | 7.9225 | −0.6749 | 0.7848 | 7.9224 |
| 0.6307 | −1.5361 | 7.9225 | −0.6069 | 0.6806 | 7.9224 |
| 0.5462 | −1.4373 | 7.9224 | −0.5363 | 0.5727 | 7.9224 |
| 0.4595 | −1.3340 | 7.9224 | −0.4628 | 0.4609 | 7.9225 |
| 0.3711 | −1.2261 | 7.9225 | −0.3864 | 0.3452 | 7.9225 |
| 0.2809 | −1.1133 | 7.9225 | −0.3071 | 0.2257 | 7.9225 |

TABLE 3-continued

| SUCTION SIDE | | | PRESSURE SIDE | | |
|---|---|---|---|---|---|
| X | Y | Z | X | Y | Z |
| 0.1923 | −0.9993 | 7.9224 | −0.2276 | 0.1064 | 7.9224 |
| 0.1053 | −0.8840 | 7.9225 | −0.1476 | −0.0127 | 7.9225 |
| 0.0199 | −0.7673 | 7.9224 | −0.0673 | −0.1314 | 7.9225 |
| −0.0636 | −0.6493 | 7.9224 | 0.0134 | −0.2500 | 7.9225 |
| −0.1456 | −0.5301 | 7.9224 | 0.0944 | −0.3683 | 7.9225 |
| −0.2265 | −0.4099 | 7.9224 | 0.1757 | −0.4864 | 7.9225 |
| −0.3061 | −0.2888 | 7.9224 | 0.2570 | −0.6046 | 7.9225 |
| −0.3845 | −0.1671 | 7.9225 | 0.3379 | −0.7230 | 7.9225 |
| −0.4617 | −0.0445 | 7.9225 | 0.4184 | −0.8417 | 7.9224 |
| −0.5374 | 0.0790 | 7.9225 | 0.4985 | −0.9605 | 7.9224 |
| −0.6117 | 0.2034 | 7.9224 | 0.5785 | −1.0796 | 7.9224 |
| −0.6822 | 0.3244 | 7.9225 | 0.6555 | −1.1948 | 7.9224 |
| −0.7488 | 0.4420 | 7.9225 | 0.7298 | −1.3061 | 7.9225 |
| −0.8118 | 0.5562 | 7.9225 | 0.8014 | −1.4136 | 7.9225 |
| −0.8711 | 0.6668 | 7.9225 | 0.8702 | −1.5170 | 7.9225 |
| −0.9270 | 0.7738 | 7.9225 | 0.9365 | −1.6165 | 7.9225 |
| −0.9794 | 0.8772 | 7.9225 | 1.0002 | −1.7119 | 7.9225 |
| −1.0285 | 0.9770 | 7.9224 | 1.0613 | −1.8033 | 7.9225 |
| −1.0742 | 1.0728 | 7.9224 | 1.1172 | −1.8866 | 7.9225 |
| −1.1145 | 1.1607 | 7.9225 | 1.1678 | −1.9620 | 7.9224 |
| −1.1499 | 1.2401 | 7.9224 | 1.2132 | −2.0294 | 7.9225 |
| −1.1806 | 1.3110 | 7.9225 | 1.2533 | −1.0889 | 7.9224 |
| −1.2081 | 1.3779 | 7.9224 | 1.2881 | −2.1403 | 7.9224 |
| −1.2308 | 1.4365 | 7.9225 | 1.3176 | −2.1839 | 7.9224 |
| −1.2462 | 1.4823 | 7.9225 | 1.3429 | −2.2211 | 7.9225 |
| −1.2565 | 1.5195 | 7.9224 | 1.3642 | −2.2522 | 7.9224 |
| −1.2620 | 1.5480 | 7.9225 | 1.3817 | −2.2779 | 7.9225 |
| −1.2635 | 1.5697 | 7.9224 | 1.3957 | −2.2984 | 7.9225 |
| −1.2621 | 1.5816 | 7.9225 | 1.4066 | −2.3141 | 7.9224 |
| −1.2593 | 1.5887 | 7.9225 | 1.4143 | −2.3262 | 7.9225 |
| −1.2570 | 1.5917 | 7.9225 | 1.4157 | −2.3380 | 7.9224 |
| −1.2554 | 1.5930 | 7.9225 | 1.4124 | −2.3470 | 7.9224 |
| 1.3700 | −2.3300 | 8.2354 | −1.2499 | 1.6026 | 8.2354 |
| 1.3638 | −2.3336 | 8.2354 | −1.2490 | 1.6029 | 8.2354 |
| 1.3543 | −2.3350 | 8.2354 | −1.2471 | 1.6035 | 8.2354 |
| 1.3433 | −2.3306 | 8.2354 | −1.2433 | 1.6037 | 8.2354 |
| 1.3332 | −2.3203 | 8.2354 | −1.2359 | 1.6018 | 8.2354 |
| 1.3201 | −2.3064 | 8.2354 | −1.2255 | 1.5960 | 8.2354 |
| 1.3030 | −2.2883 | 8.2354 | −1.2089 | 1.5824 | 8.2354 |
| 1.2816 | −2.2656 | 8.2354 | −1.1890 | 1.5618 | 8.2354 |
| 1.2557 | −2.2381 | 8.2354 | −1.1648 | 1.5327 | 8.2354 |
| 1.2249 | −2.2053 | 8.2354 | −1.1365 | 1.4948 | 8.2354 |
| 1.1890 | −2.1669 | 8.2354 | −1.1011 | 1.4442 | 8.2354 |
| 1.1467 | −2.1213 | 8.2354 | −1.0613 | 1.3852 | 8.2354 |
| 1.0978 | −2.0685 | 8.2354 | −1.0195 | 1.3218 | 8.2354 |
| 1.0427 | −2.0086 | 8.2354 | −0.9727 | 1.2504 | 8.2354 |
| 0.9815 | −1.9414 | 8.2354 | −0.9209 | 1.1710 | 8.2354 |
| 0.9141 | −1.8668 | 8.2354 | −0.8641 | 1.0834 | 8.2354 |
| 0.8409 | −1.7846 | 8.2354 | −0.8049 | 0.9916 | 8.2354 |
| 0.7651 | −1.6984 | 8.2354 | −0.7432 | 0.8959 | 8.2354 |
| 0.6867 | −1.6081 | 8.2354 | −0.6789 | 0.7962 | 8.2354 |
| 0.6060 | −1.5136 | 8.2354 | −0.6120 | 0.6926 | 8.2354 |
| 0.5232 | −1.4146 | 8.2354 | −0.5424 | 0.5851 | 8.2354 |
| 0.4384 | −1.3112 | 8.2354 | −0.4700 | 0.4736 | 8.2354 |
| 0.3516 | −1.2031 | 8.2354 | −0.3948 | 0.3585 | 8.2354 |
| 0.2633 | −1.0903 | 8.2354 | −0.3167 | 0.2395 | 8.2354 |
| 0.1764 | −0.9763 | 8.2354 | −0.2382 | 0.1207 | 8.2354 |
| 0.0911 | −0.8612 | 8.2354 | −0.1595 | 0.0021 | 8.2354 |
| 0.0075 | −0.7446 | 8.2354 | −0.0804 | −0.1163 | 8.2354 |
| −0.0745 | −0.6268 | 8.2354 | −0.0010 | −0.2343 | 8.2354 |
| −0.1551 | −0.5079 | 8.2354 | 0.0787 | −0.3522 | 8.2354 |
| −0.2346 | −0.3882 | 8.2354 | 0.1589 | −0.4698 | 8.2354 |
| −0.3129 | −0.2677 | 8.2354 | 0.2390 | −0.5876 | 8.2354 |
| −0.3901 | −0.1465 | 8.2354 | 0.3188 | −0.7054 | 8.2354 |
| −0.4659 | −0.0244 | 8.2354 | 0.3982 | −0.8235 | 8.2354 |
| −0.5405 | 0.0984 | 8.2354 | 0.4771 | −0.9419 | 8.2354 |
| −0.6136 | 0.2221 | 8.2354 | 0.5560 | −1.0604 | 8.2354 |
| −0.6831 | 0.3425 | 8.2354 | 0.6319 | −1.1751 | 8.2354 |
| −0.7488 | 0.4594 | 8.2354 | 0.7052 | −1.2860 | 8.2354 |
| −0.8109 | 0.5729 | 8.2354 | 0.7756 | −1.3929 | 8.2354 |
| −0.8695 | 0.6829 | 8.2354 | 0.8434 | −1.4960 | 8.2354 |
| −0.9246 | 0.7892 | 8.2354 | 0.9085 | −1.5951 | 8.2354 |
| −0.9763 | 0.8919 | 8.2354 | 0.9710 | −1.6903 | 8.2354 |
| −1.0248 | 0.9909 | 8.2354 | 1.0310 | −1.7815 | 8.2354 |
| −1.0699 | 1.0861 | 8.2354 | 1.0857 | −1.8647 | 8.2354 |
| −1.1099 | 1.1732 | 8.2354 | 1.1353 | −1.9400 | 8.2354 |

TABLE 3-continued

| SUCTION SIDE | | | PRESSURE SIDE | | |
|---|---|---|---|---|---|
| X | Y | Z | X | Y | Z |
| −1.1450 | 1.2520 | 8.2354 | 1.1798 | −2.0074 | 8.2354 |
| −1.1754 | 1.3224 | 8.2354 | 1.2190 | −2.0667 | 8.2354 |
| −1.2029 | 1.3888 | 8.2354 | 1.2531 | −2.1181 | 8.2354 |
| −1.2253 | 1.4469 | 8.2354 | 1.2818 | −2.1617 | 8.2354 |
| −1.2407 | 1.4923 | 8.2354 | 1.3065 | −2.1988 | 8.2354 |
| −1.2512 | 1.5291 | 8.2354 | 1.3273 | −2.2300 | 8.2354 |
| −1.2568 | 1.5574 | 8.2354 | 1.3444 | −2.2557 | 8.2354 |
| −1.2584 | 1.5789 | 8.2354 | 1.3582 | −2.2761 | 8.2354 |
| −1.2572 | 1.5907 | 8.2354 | 1.3688 | −2.2919 | 8.2354 |
| −1.2546 | 1.5979 | 8.2354 | 1.3765 | −2.3038 | 8.2354 |
| −1.2523 | 1.6009 | 8.2354 | 1.3780 | −2.3156 | 8.2354 |
| −1.2507 | 1.6020 | 8.2354 | 1.3748 | −2.3246 | 8.2354 |
| 1.3261 | −2.3020 | 8.5483 | −1.2370 | 1.6196 | 8.5483 |
| 1.3199 | −2.3055 | 8.5483 | −1.2361 | 1.6201 | 8.5483 |
| 1.3107 | −2.3066 | 8.5483 | −1.2344 | 1.6206 | 8.5483 |
| 1.3000 | −2.3023 | 8.5483 | −1.2305 | 1.6208 | 8.5483 |
| 1.2902 | −2.2921 | 8.5483 | −1.2232 | 1.6186 | 8.5483 |
| 1.2772 | −2.2781 | 8.5483 | −1.2130 | 1.6126 | 8.5483 |
| 1.2606 | −2.2599 | 8.5483 | −1.1968 | 1.5988 | 8.5483 |
| 1.2396 | −2.2373 | 8.5483 | −1.1775 | 1.5782 | 8.5483 |
| 1.2142 | −2.2098 | 8.5483 | −1.1537 | 1.5491 | 8.5483 |
| 1.1840 | −2.1769 | 8.5483 | −1.1260 | 1.5111 | 8.5483 |
| 1.1488 | −2.1384 | 8.5483 | −1.0916 | 1.4606 | 8.5483 |
| 1.1072 | −2.0927 | 8.5483 | −1.0526 | 1.4018 | 8.5483 |
| 1.0594 | −2.0400 | 8.5483 | −1.0118 | 1.3385 | 8.5483 |
| 1.0054 | −1.9800 | 8.5483 | −0.9660 | 1.2674 | 8.5483 |
| 0.9454 | −1.9127 | 8.5483 | −0.9152 | 1.1881 | 8.5483 |
| 0.8794 | −1.8380 | 8.5483 | −0.8596 | 1.1008 | 8.5483 |
| 0.8076 | −1.7557 | 8.5483 | −0.8017 | 1.0095 | 8.5483 |
| 0.7334 | −1.6695 | 8.5483 | −0.7413 | 0.9141 | 8.5483 |
| 0.6569 | −1.5790 | 8.5483 | −0.6784 | 0.8148 | 8.5483 |
| 0.5780 | −1.4842 | 8.5483 | −0.6128 | 0.7115 | 8.5483 |
| 0.4972 | −1.3852 | 8.5483 | −0.5447 | 0.6044 | 8.5483 |
| 0.4144 | −1.2816 | 8.5483 | −0.4738 | 0.4934 | 8.5483 |
| 0.3300 | −1.1734 | 8.5483 | −0.4002 | 0.3786 | 8.5483 |
| 0.2439 | −1.0604 | 8.5483 | −0.3237 | 0.2600 | 8.5483 |
| 0.1594 | −0.9463 | 8.5483 | −0.2470 | 0.1415 | 8.5483 |
| 0.0764 | −0.8310 | 8.5483 | −0.1699 | 0.0233 | 8.5483 |
| −0.0050 | −0.7144 | 8.5483 | −0.0926 | −0.0948 | 8.5483 |
| −0.0849 | −0.5968 | 8.5483 | −0.0149 | −0.2126 | 8.5483 |
| −0.1636 | −0.4784 | 8.5483 | 0.0631 | −0.3302 | 8.5483 |
| −0.2412 | −0.3591 | 8.5483 | 0.1415 | −0.4476 | 8.5483 |
| −0.3179 | −0.2390 | 8.5483 | 0.2199 | −0.5648 | 8.5483 |
| −0.3933 | −0.1182 | 8.5483 | 0.2981 | −0.6823 | 8.5483 |
| −0.4675 | 0.0034 | 8.5483 | 0.3760 | −0.7999 | 8.5483 |
| −0.5405 | 0.1257 | 8.5483 | 0.4535 | −0.9178 | 8.5483 |
| −0.6121 | 0.2486 | 8.5483 | 0.5307 | −1.0360 | 8.5483 |
| −0.6801 | 0.3684 | 8.5483 | 0.6050 | −1.1504 | 8.5483 |
| −0.7445 | 0.4847 | 8.5483 | 0.6767 | −1.2609 | 8.5483 |
| −0.8054 | 0.5975 | 8.5483 | 0.7456 | −1.3675 | 8.5483 |
| −0.8627 | 0.7067 | 8.5483 | 0.8118 | −1.4703 | 8.5483 |
| −0.9168 | 0.8124 | 8.5483 | 0.8754 | −1.5692 | 8.5483 |
| −0.9677 | 0.9145 | 8.5483 | 0.9364 | −1.6642 | 8.5483 |
| −1.0152 | 1.0127 | 8.5483 | 0.9949 | −1.7553 | 8.5483 |
| −1.0595 | 1.1073 | 8.5483 | 1.0484 | −1.8383 | 8.5483 |
| −1.0988 | 1.1938 | 8.5483 | 1.0968 | −1.9134 | 8.5483 |
| −1.1332 | 1.2720 | 8.5483 | 1.1402 | −1.9806 | 8.5483 |
| −1.1631 | 1.3418 | 8.5483 | 1.1785 | −2.0399 | 8.5483 |
| −1.1901 | 1.4077 | 8.5483 | 1.2117 | −2.0912 | 8.5483 |
| −1.2122 | 1.4654 | 8.5483 | 1.2398 | −2.1346 | 8.5483 |
| −1.2275 | 1.5103 | 8.5483 | 1.2640 | −2.1716 | 8.5483 |
| −1.2378 | 1.5468 | 8.5483 | 1.2843 | −2.2027 | 8.5483 |
| −1.2434 | 1.5748 | 8.5483 | 1.3011 | −2.2282 | 8.5483 |
| −1.2452 | 1.5961 | 8.5483 | 1.3145 | −2.2487 | 8.5483 |
| −1.2441 | 1.6079 | 8.5483 | 1.3250 | −2.2644 | 8.5483 |
| −1.2416 | 1.6150 | 8.5483 | 1.3325 | −2.2763 | 8.5483 |
| −1.2393 | 1.6181 | 8.5483 | 1.3341 | −2.2879 | 8.5483 |
| −1.2378 | 1.6192 | 8.5483 | 1.3308 | −2.2968 | 8.5483 |
| 1.2749 | −2.2680 | 8.8612 | −1.2048 | 1.6418 | 8.8612 |
| 1.2687 | −2.2714 | 8.8612 | −1.2039 | 1.6421 | 8.8612 |
| 1.2596 | −2.2724 | 8.8612 | −1.2020 | 1.6427 | 8.8612 |
| 1.2489 | −2.2674 | 8.8612 | −1.1983 | 1.6428 | 8.8612 |
| 1.2394 | −2.2571 | 8.8612 | −1.1910 | 1.6406 | 8.8612 |
| 1.2268 | −2.2432 | 8.8612 | −1.1810 | 1.6345 | 8.8612 |
| 1.2104 | −2.2252 | 8.8612 | −1.1652 | 1.6208 | 8.8612 |
| 1.1899 | −2.2027 | 8.8612 | −1.1464 | 1.6000 | 8.8612 |

TABLE 3-continued

| SUCTION SIDE | | | PRESSURE SIDE | | |
|---|---|---|---|---|---|
| X | Y | Z | X | Y | Z |
| 1.1651 | −2.1752 | 8.8612 | −1.1235 | 1.5708 | 8.8612 |
| 1.1356 | −2.1424 | 8.8612 | −1.0968 | 1.5328 | 8.8612 |
| 1.1012 | −2.1040 | 8.8612 | −1.0638 | 1.4823 | 8.8612 |
| 1.0605 | −2.0586 | 8.8612 | −1.0264 | 1.4234 | 8.8612 |
| 1.0139 | −2.0059 | 8.8612 | −0.9869 | 1.3604 | 8.8612 |
| 0.9613 | −1.9460 | 8.8612 | −0.9428 | 1.2892 | 8.8612 |
| 0.9028 | −1.8788 | 8.8612 | −0.8941 | 1.2102 | 8.8612 |
| 0.8385 | −1.8042 | 8.8612 | −0.8407 | 1.1229 | 8.8612 |
| 0.7688 | −1.7221 | 8.8612 | −0.7849 | 1.0317 | 8.8612 |
| 0.6966 | −1.6359 | 8.8612 | −0.7268 | 0.9365 | 8.8612 |
| 0.6223 | −1.5454 | 8.8612 | −0.6662 | 0.8373 | 8.8612 |
| 0.5458 | −1.4507 | 8.8612 | −0.6031 | 0.7343 | 8.8612 |
| 0.4674 | −1.3516 | 8.8612 | −0.5375 | 0.6273 | 8.8612 |
| 0.3873 | −1.2480 | 8.8612 | −0.4693 | 0.5164 | 8.8612 |
| 0.3055 | −1.1397 | 8.8612 | −0.3984 | 0.4019 | 8.8612 |
| 0.2224 | −1.0266 | 8.8612 | −0.3247 | 0.2835 | 8.8612 |
| 0.1408 | −0.9125 | 8.8612 | −0.2508 | 0.1652 | 8.8612 |
| 0.0608 | −0.7970 | 8.8612 | −0.1765 | 0.0472 | 8.8612 |
| −0.0176 | −0.6804 | 8.8612 | −0.1019 | −0.0706 | 8.8612 |
| −0.0945 | −0.5628 | 8.8612 | −0.0270 | −0.1882 | 8.8612 |
| −0.1706 | −0.4443 | 8.8612 | 0.0483 | −0.3055 | 8.8612 |
| −0.2455 | −0.3252 | 8.8612 | 0.1240 | −0.4227 | 8.8612 |
| −0.3194 | −0.2055 | 8.8612 | 0.1999 | −0.5396 | 8.8612 |
| −0.3922 | −0.0852 | 8.8612 | 0.2759 | −0.6567 | 8.8612 |
| −0.4638 | 0.0360 | 8.8612 | 0.3513 | −0.7739 | 8.8612 |
| −0.5342 | 0.1577 | 8.8612 | 0.4264 | −0.8914 | 8.8612 |
| −0.6035 | 0.2802 | 8.8612 | 0.5012 | −1.0090 | 8.8612 |
| −0.6692 | 0.3993 | 8.8612 | 0.5732 | −1.1229 | 8.8612 |
| −0.7314 | 0.5150 | 8.8612 | 0.6427 | −1.2330 | 8.8612 |
| −0.7900 | 0.6272 | 8.8612 | 0.7095 | −1.3393 | 8.8612 |
| −0.8456 | 0.7358 | 8.8612 | 0.7737 | −1.4417 | 8.8612 |
| −0.8978 | 0.8408 | 8.8612 | 0.8355 | −1.5400 | 8.8612 |
| −0.9467 | 0.9421 | 8.8612 | 0.8949 | −1.6345 | 8.8612 |
| −0.9927 | 1.0398 | 8.8612 | 0.9518 | −1.7250 | 8.8612 |
| −1.0354 | 1.1337 | 8.8612 | 1.0037 | −1.8076 | 8.8612 |
| −1.0733 | 1.2196 | 8.8612 | 1.0510 | −1.8823 | 8.8612 |
| −1.1063 | 1.2972 | 8.8612 | 1.0932 | −1.9490 | 8.8612 |
| −1.1351 | 1.3666 | 8.8612 | 1.1306 | −2.0078 | 8.8612 |
| −1.1610 | 1.4320 | 8.8612 | 1.1631 | −2.0588 | 8.8612 |
| −1.1823 | 1.4892 | 8.8612 | 1.1906 | −2.1019 | 8.8612 |
| −1.1969 | 1.5337 | 8.8612 | 1.2142 | −2.1386 | 8.8612 |
| −1.2067 | 1.5699 | 8.8612 | 1.2340 | −2.1696 | 8.8612 |
| −1.2120 | 1.5976 | 8.8612 | 1.2505 | −2.1949 | 8.8612 |
| −1.2133 | 1.6186 | 8.8612 | 1.2636 | −2.2151 | 8.8612 |
| −1.2121 | 1.6303 | 8.8612 | 1.2738 | −2.2308 | 8.8612 |
| −1.2094 | 1.6373 | 8.8612 | 1.2812 | −2.2426 | 8.8612 |
| −1.2070 | 1.6402 | 8.8612 | 1.2828 | −2.2540 | 8.8612 |
| −1.2056 | 1.6414 | 8.8612 | 1.2797 | −2.2627 | 8.8612 |
| 1.2168 | −2.2268 | 9.1740 | −1.1524 | 1.6763 | 9.1741 |
| 1.2107 | −2.2300 | 9.1741 | −1.1515 | 1.6766 | 9.1741 |
| 1.2015 | −2.2309 | 9.1741 | −1.1497 | 1.6771 | 9.1741 |
| 1.1913 | −2.2259 | 9.1740 | −1.1460 | 1.6771 | 9.1740 |
| 1.1819 | −2.2156 | 9.1740 | −1.1389 | 1.6748 | 9.1741 |
| 1.1695 | −2.2018 | 9.1740 | −1.1292 | 1.6687 | 9.1740 |
| 1.1535 | −2.1840 | 9.1740 | −1.1138 | 1.6547 | 9.1741 |
| 1.1333 | −2.1616 | 9.1740 | −1.0959 | 1.6339 | 9.1740 |
| 1.1089 | −2.1344 | 9.1740 | −1.0743 | 1.6043 | 9.1741 |
| 1.0800 | −2.1019 | 9.1741 | −1.0493 | 1.5660 | 9.1740 |
| 1.0462 | −2.0638 | 9.1741 | −1.0183 | 1.5150 | 9.1740 |
| 1.0064 | −2.0187 | 9.1741 | −0.9832 | 1.4559 | 9.1740 |
| 0.9607 | −1.9664 | 9.1740 | −0.9463 | 1.3926 | 9.1740 |
| 9.9093 | −1.9068 | 9.1740 | −0.9050 | 1.3212 | 9.1740 |
| 0.8522 | −1.8400 | 9.1741 | −0.8593 | 1.2416 | 9.1740 |
| 0.7896 | −1.7657 | 9.1741 | −0.8092 | 1.1542 | 9.1741 |
| 0.7217 | −1.6838 | 9.1741 | −0.7569 | 1.0625 | 9.1740 |
| 0.6516 | −1.5978 | 9.1740 | −0.7024 | 0.9670 | 9.1740 |
| 0.5796 | −1.5075 | 9.1741 | −0.6455 | 0.8676 | 9.1741 |
| 0.5056 | −1.4129 | 9.1740 | −0.5862 | 0.7642 | 9.1741 |
| 0.4300 | −1.3138 | 9.1740 | −0.5244 | 0.6570 | 9.1741 |
| 0.3528 | −1.2102 | 9.1741 | −0.4602 | 0.5459 | 9.1740 |
| 0.2743 | −1.1017 | 9.1740 | −0.3932 | 0.4310 | 9.1740 |
| 0.1947 | −0.9885 | 9.1740 | −0.3237 | 0.3124 | 9.1740 |
| 0.1167 | −0.8740 | 9.1740 | −0.2538 | 0.1940 | 9.1741 |
| 0.0403 | −0.7584 | 9.1740 | −0.1835 | 0.0759 | 9.1741 |
| −0.0343 | −0.6415 | 9.1740 | −0.1127 | −0.0420 | 9.1741 |
| −0.1077 | −0.5237 | 9.1741 | −0.0414 | −0.1596 | 9.1740 |

TABLE 3-continued

| SUCTION SIDE | | | PRESSURE SIDE | | |
|---|---|---|---|---|---|
| X | Y | Z | X | Y | Z |
| −0.1801 | −0.4052 | 9.1740 | 0.0302 | −0.2769 | 9.1741 |
| −0.2513 | −0.2862 | 9.1741 | 0.1025 | −0.3939 | 9.1740 |
| −0.3216 | −0.1663 | 9.1741 | 0.1752 | −0.5107 | 9.1741 |
| −0.3905 | −0.0459 | 9.1741 | 0.2480 | −0.6273 | 9.1741 |
| −0.4584 | 0.0753 | 9.1740 | 0.3207 | −0.7441 | 9.1740 |
| −0.5251 | 0.1970 | 9.1741 | 0.3931 | −0.8609 | 9.1740 |
| −0.5906 | 0.3195 | 9.1740 | 0.4652 | −0.9780 | 9.1741 |
| −0.6525 | 0.4385 | 9.1740 | 0.5349 | −1.0912 | 9.1741 |
| −0.7112 | 0.5541 | 9.1740 | 0.6021 | −1.2006 | 9.1740 |
| −0.7666 | 0.6661 | 9.1740 | 0.6668 | −1.3060 | 9.1740 |
| −0.8188 | 0.7745 | 9.1740 | 0.7292 | −1.4076 | 9.1741 |
| −0.8680 | 0.8793 | 9.1740 | 0.7892 | −1.5053 | 9.1741 |
| −0.9140 | 0.9803 | 9.1741 | 0.8468 | −1.5990 | 9.1740 |
| −0.9570 | 1.0778 | 9.1741 | 0.9022 | −1.6887 | 9.1740 |
| −0.9972 | 1.1713 | 9.1740 | 0.9528 | −1.7706 | 9.1741 |
| −1.0328 | 1.2569 | 9.1740 | 0.9986 | −1.8446 | 9.1741 |
| −1.0636 | 1.3343 | 9.1740 | 1.0398 | −1.9108 | 9.1740 |
| −1.0902 | 1.4034 | 9.1741 | 1.0762 | −1.9692 | 9.1740 |
| −1.1143 | 1.4684 | 9.1740 | 1.1078 | −2.0197 | 9.1740 |
| −1.1341 | 1.5253 | 9.1741 | 1.1346 | −2.0625 | 9.1741 |
| −1.1478 | 1.5696 | 9.1740 | 1.1575 | −2.0989 | 9.1740 |
| −1.1565 | 1.6055 | 9.1740 | 1.1769 | −2.2195 | 9.1741 |
| −1.1609 | 1.6330 | 9.1741 | 1.1928 | −2.1547 | 9.1741 |
| −1.1617 | 1.6537 | 9.1741 | 1.2057 | −2.1747 | 9.1740 |
| −1.1600 | 1.6651 | 9.1740 | 1.2156 | −2.1902 | 9.1740 |
| −1.1572 | 1.6719 | 9.1740 | 1.2229 | −2.2018 | 9.1740 |
| −1.1547 | 1.6747 | 9.1740 | 1.2246 | −2.2130 | 9.1740 |
| −1.1533 | 1.6759 | 9.1740 | 1.2215 | −2.2216 | 9.1740 |
| 1.1773 | −2.1984 | 9.3799 | −1.1097 | 1.1708 | 9.3799 |
| 1.1713 | −2.2017 | 9.3799 | −1.1088 | 1.7111 | 9.3799 |
| 1.1622 | −2.2024 | 9.3799 | −1.1070 | 1.7115 | 9.3799 |
| 1.1521 | −2.1972 | 9.3799 | −1.1033 | 1.7114 | 9.3799 |
| 1.1428 | −2.1870 | 9.3799 | −1.0964 | 1.7089 | 9.3799 |
| 1.1306 | −2.1734 | 9.3799 | −1.0870 | 1.7024 | 9.3799 |
| 1.1146 | −2.1556 | 9.3799 | −1.0723 | 1.6880 | 9.3799 |
| 1.0947 | −2.1333 | 9.3799 | −1.0552 | 1.6667 | 9.3799 |
| 1.0705 | −2.1062 | 9.3799 | −1.0348 | 1.6367 | 9.3799 |
| 1.0418 | −2.0739 | 9.3799 | −1.0112 | 1.5979 | 9.3799 |
| 1.0084 | −2.0359 | 9.3799 | −0.9821 | 1.5464 | 9.3799 |
| 0.9691 | −1.9910 | 9.3799 | −0.9492 | 1.4867 | 9.3799 |
| 0.9240 | −1.9389 | 9.3799 | −0.9144 | 1.4228 | 9.3799 |
| 0.8732 | −1.8796 | 9.3799 | −0.8755 | 1.3508 | 9.3799 |
| 0.8168 | −1.8129 | 9.3799 | −0.8325 | 1.2708 | 9.3799 |
| 0.7551 | −1.7388 | 9.3799 | −0.7852 | 1.1825 | 9.3799 |
| 0.6882 | −1.6570 | 9.3799 | −0.7360 | 1.0903 | 9.3799 |
| 0.6194 | −1.5710 | 9.3799 | −0.6843 | 0.9942 | 9.3799 |
| 0.5487 | −1.4809 | 9.3799 | −0.6306 | 0.8941 | 9.3799 |
| 0.4763 | −1.3862 | 9.3799 | −0.5743 | 0.7900 | 9.3799 |
| 0.4024 | −1.2870 | 9.3799 | −0.5158 | 0.6822 | 9.3799 |
| 0.3270 | −1.1832 | 9.3799 | −0.4546 | 0.5705 | 9.3799 |
| 0.2507 | −1.0745 | 9.3799 | −0.3910 | 0.4552 | 9.3799 |
| 0.1733 | −0.9611 | 9.3799 | −0.3246 | 0.3361 | 9.3799 |
| 0.0976 | −0.8463 | 9.3799 | −0.2576 | 0.2173 | 9.3799 |
| 0.0237 | −0.7301 | 9.3799 | −0.1902 | 0.0988 | 9.3799 |
| −0.0485 | −0.6130 | 9.3799 | −0.1222 | −0.0195 | 9.3799 |
| −0.1194 | −0.4948 | 9.3799 | −0.0535 | −0.1373 | 9.3799 |
| −0.1892 | −0.3760 | 9.3799 | 0.0157 | −0.2548 | 9.3799 |
| −0.2578 | −0.2565 | 9.3799 | 0.0855 | −0.3721 | 9.3799 |
| −0.3252 | −0.1363 | 9.3799 | 0.1558 | −0.4889 | 9.3799 |
| −0.3913 | −0.0153 | 9.3799 | 0.2267 | −0.6055 | 9.3799 |
| −0.4563 | 0.1062 | 9.3799 | 0.2976 | −0.7221 | 9.3799 |
| −0.5199 | 0.2285 | 9.3799 | 0.3684 | −0.8387 | 9.3799 |
| −0.5822 | 0.3515 | 9.3799 | 0.4390 | −0.9554 | 9.3799 |
| −0.6411 | 0.4710 | 9.3799 | 0.5072 | −1.0681 | 9.3799 |
| −0.6968 | 0.5869 | 9.3799 | 0.5732 | −1.1771 | 9.3799 |
| −0.7492 | 0.6993 | 9.3799 | 0.6367 | −1.2822 | 9.3799 |
| −0.7986 | 0.8082 | 9.3799 | 0.6980 | −1.3834 | 9.3799 |
| −0.8449 | 0.9132 | 9.3799 | 0.7569 | −1.4806 | 9.3799 |
| −0.8883 | 1.0146 | 9.3799 | 0.8135 | −1.5739 | 9.3799 |
| −0.9287 | 1.1123 | 9.3799 | 0.8679 | −1.6633 | 9.3799 |
| −0.9663 | 1.2061 | 9.3799 | 0.9176 | −1.7447 | 9.3799 |
| −0.9997 | 1.2918 | 9.3799 | 0.9628 | −1.8184 | 9.3799 |
| −1.0286 | 1.3693 | 9.3799 | 1.0032 | −1.8844 | 9.3799 |
| −1.0534 | 1.4384 | 9.3799 | 1.0390 | −1.9424 | 9.3799 |
| −1.0758 | 1.5036 | 9.3799 | 1.0702 | −1.9927 | 9.3799 |
| −1.0942 | 1.5605 | 9.3799 | 1.0965 | −2.0353 | 9.3799 |

TABLE 3-continued

| SUCTION SIDE | | | PRESSURE SIDE | | |
|---|---|---|---|---|---|
| X | Y | Z | X | Y | Z |
| −1.1069 | 1.6046 | 9.3799 | 1.1190 | −2.0716 | 9.3799 |
| −1.1150 | 1.6405 | 9.3799 | 1.1380 | −2.1020 | 9.3799 |
| −1.1188 | 1.6678 | 9.3799 | 1.1538 | −2.1270 | 9.3799 |
| −1.1191 | 1.6885 | 9.3799 | 1.1665 | −2.1470 | 9.3799 |
| −1.1173 | 1.6998 | 9.3799 | 1.1762 | −2.1624 | 9.3799 |
| −1.1144 | 1.7065 | 9.3799 | 1.1834 | −2.1739 | 9.3799 |
| −1.1120 | 1.7092 | 9.3799 | 1.1851 | −2.1850 | 9.3799 |
| −1.1105 | 1.7104 | 9.3799 | 1.1819 | −2.1934 | 9.3799 |
| 1.0970 | −2.1407 | 9.7999 | −1.0147 | 1.7933 | 9.7999 |
| 1.0910 | −2.1440 | 9.7999 | −1.0138 | 1.7936 | 9.7999 |
| 1.0819 | −2.1447 | 9.7999 | −1.0120 | 1.7938 | 9.7999 |
| 1.0721 | −2.1393 | 9.7999 | −1.0084 | 1.7932 | 9.7999 |
| 1.0630 | −2.1291 | 9.7999 | −1.0021 | 1.7899 | 9.7999 |
| 1.0509 | −2.1156 | 9.7999 | −0.9936 | 1.7825 | 9.7999 |
| 1.0353 | −2.0979 | 9.7999 | −0.9807 | 1.7669 | 9.7999 |
| 1.0157 | −2.0757 | 9.7999 | −0.9658 | 1.7444 | 9.7999 |
| 0.9921 | −2.0488 | 9.7999 | −0.9483 | 1.7133 | 9.7999 |
| 0.9640 | −2.0167 | 9.7999 | −0.9283 | 1.6732 | 9.7999 |
| 0.9313 | −1.9789 | 9.7999 | −0.9035 | 1.6204 | 9.7999 |
| 0.8928 | −1.9341 | 9.7999 | −0.8755 | 1.5593 | 9.7999 |
| 0.8486 | −1.8823 | 9.7999 | −0.8458 | 1.4940 | 9.7999 |
| 0.7990 | −1.8231 | 9.7999 | −0.8126 | 1.4205 | 9.7999 |
| 0.7440 | −1.7566 | 9.7999 | −0.7756 | 1.3387 | 9.7999 |
| 0.6840 | −1.6826 | 9.7999 | −0.7351 | 1.2489 | 9.7999 |
| 0.6191 | −1.6008 | 9.7999 | −0.6924 | 1.1551 | 9.7999 |
| 0.5526 | −1.5148 | 9.7999 | −0.6476 | 1.0573 | 9.7999 |
| 0.4844 | −1.4244 | 9.7999 | −0.6007 | 0.9555 | 9.7999 |
| 0.4148 | −1.3296 | 9.7999 | −0.5514 | 0.8499 | 9.7999 |
| 0.3441 | −1.2300 | 9.7999 | −0.4997 | 0.7405 | 9.7999 |
| 0.2723 | −1.1257 | 9.7999 | −0.4455 | 0.6273 | 9.7999 |
| 0.1998 | −1.0164 | 9.7999 | −0.3886 | 0.5105 | 9.7999 |
| 0.1267 | −0.9022 | 9.7999 | −0.3291 | 0.3901 | 9.7999 |
| 0.0557 | −0.7865 | 9.7999 | −0.2685 | 0.2700 | 9.7999 |
| −0.0133 | −0.6694 | 9.7999 | −0.2070 | 0.1505 | 9.7999 |
| −0.0806 | −0.5513 | 9.7999 | −0.1447 | 0.0314 | 9.7999 |
| −0.1466 | −0.4322 | 9.7999 | −0.0814 | −0.0874 | 9.7999 |
| −0.2111 | −0.3123 | 9.7999 | −0.0172 | −0.2055 | 9.7999 |
| −0.2742 | −0.1915 | 9.7999 | 0.0478 | −0.3233 | 9.7999 |
| −0.3358 | −0.0701 | 9.7999 | 0.1139 | −0.4405 | 9.7999 |
| −0.3958 | 0.0520 | 9.7999 | 0.1808 | −0.5572 | 9.7999 |
| −0.4544 | 0.1749 | 9.7999 | 0.2482 | −0.6736 | 9.7999 |
| −0.5113 | 0.2987 | 9.7999 | 0.3157 | −0.7899 | 9.7999 |
| −0.5667 | 0.4231 | 9.7999 | 0.3833 | −0.9062 | 9.7999 |
| −0.6187 | 0.5440 | 9.7999 | 0.4488 | −1.0185 | 9.7999 |
| −0.6674 | 0.6615 | 9.7999 | 0.5121 | −1.1269 | 9.7999 |
| −0.7130 | 0.7752 | 9.7999 | 0.5732 | −1.2313 | 9.7999 |
| −0.7557 | 0.8852 | 9.7999 | 0.6322 | −1.3319 | 9.7999 |
| −0.7954 | 0.9915 | 9.7999 | 0.6891 | −1.4284 | 9.7999 |
| −0.8325 | 1.0940 | 9.7999 | 0.7439 | −1.5211 | 9.7999 |
| −0.8669 | 1.1927 | 9.7999 | 0.7965 | −1.6098 | 9.7999 |
| −0.8987 | 1.2873 | 9.7999 | 0.8447 | −1.6906 | 9.7999 |
| −0.9267 | 1.3737 | 9.7999 | 0.8885 | −1.7638 | 9.7999 |
| −0.9509 | 1.4517 | 9.7999 | 0.9278 | −1.8291 | 9.7999 |
| −0.9717 | 1.5214 | 9.7999 | 0.9625 | −1.8866 | 9.7999 |
| −0.9903 | 1.5869 | 9.7999 | 0.9928 | −1.9366 | 9.7999 |
| −1.0054 | 1.6439 | 9.7999 | 1.0183 | −1.9787 | 9.7999 |
| −1.0156 | 1.6882 | 9.7999 | 1.0403 | −2.0147 | 9.7999 |
| −1.0219 | 1.7240 | 9.7999 | 1.0587 | −2.0449 | 9.7999 |
| −1.0246 | 1.7511 | 9.7999 | 1.0741 | −2.0696 | 9.7999 |
| −1.0244 | 1.7715 | 9.7999 | 1.0864 | −2.0895 | 9.7999 |
| −1.0223 | 1.7827 | 9.7999 | 1.0959 | −2.1047 | 9.7999 |
| −1.0195 | 1.7893 | 9.7999 | 1.1030 | −2.1161 | 9.7999 |
| −1.0171 | 1.7920 | 9.7999 | 1.1047 | −2.1272 | 9.7999 |
| −1.0156 | 1.7930 | 9.7999 | 1.1015 | −2.1356 | 9.7999 |

TABLE 4

| SUCTION SIDE | | | PRESSURE SIDE | | |
|---|---|---|---|---|---|
| X | Y | Z | X | Y | Z |
| 1.6322 | −1.1163 | −0.2115 | −1.1451 | 1.4158 | −0.2115 |
| 1.6290 | −1.1214 | −0.2115 | −1.1444 | 1.4161 | −0.2115 |

TABLE 4-continued

| SUCTION SIDE | | | PRESSURE SIDE | | |
|---|---|---|---|---|---|
| X | Y | Z | X | Y | Z |
| 1.6237 | −1.1274 | −0.2115 | −1.1429 | 1.4166 | −0.2115 |
| 1.6155 | −1.1331 | −0.2115 | −1.1400 | 1.4175 | −0.2115 |
| 1.6041 | −1.1366 | −0.2115 | −1.1338 | 1.4181 | −0.2115 |
| 1.5882 | −1.1355 | −0.2115 | −1.1244 | 1.4170 | −0.2115 |
| 1.5684 | −1.1286 | −0.2115 | −1.1082 | 1.4108 | −0.2115 |
| 1.5438 | −1.1198 | −0.2115 | −1.0890 | 1.3984 | −0.2115 |
| 1.5137 | −1.1090 | −0.2115 | −1.0660 | 1.3785 | −0.2115 |
| 1.4781 | −1.0960 | −0.2115 | −1.0399 | 1.3510 | −0.2115 |
| 1.4364 | −1.0809 | −0.2115 | −1.0081 | 1.3131 | −0.2115 |
| 1.3872 | −1.0631 | −0.2115 | −0.9728 | 1.2683 | −0.2115 |
| 1.3305 | −1.0423 | −0.2115 | −0.9357 | 1.2202 | −0.2115 |
| 1.2665 | −1.0178 | −0.2115 | −0.8938 | 1.1661 | −0.2115 |
| 1.1952 | −0.9900 | −0.2115 | −0.8471 | 1.1062 | −0.2115 |
| 1.1164 | −0.9590 | −0.2115 | −0.7950 | 1.0408 | −0.2115 |
| 1.0305 | −0.9245 | −0.2115 | −0.7396 | 0.9734 | −0.2115 |
| 0.9412 | −0.8875 | −0.2115 | −0.6810 | 0.9038 | −0.2115 |
| 0.8486 | −0.8479 | −0.2115 | −0.6190 | 0.8322 | −0.2115 |
| 0.7529 | −0.8054 | −0.2115 | −0.5535 | 0.7588 | −0.2115 |
| 0.6543 | −0.7595 | −0.2115 | −0.4844 | 0.6834 | −0.2115 |
| 0.5530 | −0.7099 | −0.2115 | −0.4118 | 0.6063 | −0.2115 |
| 0.4500 | −0.6560 | −0.2115 | −0.3353 | 0.5276 | −0.2115 |
| 0.3454 | −0.5971 | −0.2115 | −0.2551 | 0.4473 | −0.2115 |
| 0.2432 | −0.5350 | −0.2115 | −0.1735 | 0.3681 | −0.2115 |
| 0.1434 | −0.4695 | −0.2115 | −0.0906 | 0.2903 | −0.2115 |
| 0.0462 | −0.4002 | −0.2115 | −0.0065 | 0.2135 | −0.2115 |
| −0.0484 | −0.3272 | −0.2115 | 0.0786 | 0.1379 | −0.2115 |
| −0.1403 | −0.2505 | −0.2115 | 0.1646 | 0.0631 | −0.2115 |
| −0.2298 | −0.1702 | −0.2115 | 0.2509 | −0.0112 | −0.2115 |
| −0.3170 | −0.0867 | −0.2115 | 0.3374 | −0.0855 | −0.2115 |
| −0.4017 | −0.0003 | −0.2115 | 0.4239 | −0.1595 | −0.2115 |
| −0.4832 | 0.0884 | −0.2115 | 0.5107 | −0.2332 | −0.2115 |
| −0.5614 | 0.1794 | −0.2115 | 0.5979 | −0.3065 | −0.2115 |
| −0.6364 | 0.2727 | −0.2115 | 0.6856 | −0.3792 | −0.2115 |
| −0.7059 | 0.3649 | −0.2115 | 0.7709 | −0.4488 | −0.2115 |
| −0.7701 | 0.4562 | −0.2115 | 0.8539 | −0.5154 | −0.2115 |
| −0.8292 | 0.5461 | −0.2115 | 0.9344 | −0.5790 | −0.2115 |
| −0.8834 | 0.6346 | −0.2115 | 1.0124 | −0.6395 | −0.2115 |
| −0.9328 | 0.7215 | −0.2115 | 1.0879 | −0.6970 | −0.2115 |
| −0.9778 | 0.8069 | −0.2115 | 1.1611 | −0.7514 | −0.2115 |
| −1.0184 | 0.8903 | −0.2115 | 1.2317 | −0.8028 | −0.2115 |
| −1.0548 | 0.9716 | −0.2115 | 1.2967 | −0.8491 | −0.2115 |
| −1.0857 | 1.0465 | −0.2115 | 1.3560 | −0.8902 | −0.2115 |
| −1.1113 | 1.1147 | −0.2115 | 1.4091 | −0.9269 | −0.2115 |
| −1.1317 | 1.1763 | −0.2115 | 1.4559 | −0.9593 | −0.2115 |
| −1.1486 | 1.2346 | −0.2115 | 1.4968 | −0.9872 | −0.2115 |
| −1.1607 | 1.2859 | −0.2115 | 1.5314 | −1.0105 | −0.2115 |
| −1.1669 | 1.3260 | −0.2115 | 1.5612 | −1.0303 | −0.2115 |
| −1.1683 | 1.3582 | −0.2115 | 1.5862 | −1.0469 | −0.2115 |
| −1.1657 | 1.3824 | −0.2115 | 1.6067 | −1.0606 | −0.2115 |
| −1.1602 | 1.3998 | −0.2115 | 1.6231 | −1.0717 | −0.2115 |
| −1.1546 | 1.4083 | −0.2115 | 1.6323 | −1.0835 | −0.2115 |
| −1.1500 | 1.4128 | −0.2115 | 1.6356 | −1.0943 | −0.2115 |
| −1.1473 | 1.4147 | −0.2115 | 1.6358 | −1.1037 | −0.2115 |
| −1.1458 | 1.4154 | −0.2115 | 1.6343 | −1.1111 | −0.2115 |
| 1.6305 | −1.1205 | 0.0000 | −1.1651 | 1.3955 | 0.0000 |
| 1.6272 | −1.1256 | 0.0000 | −1.1645 | 1.3958 | 0.0000 |
| 1.6219 | −1.1315 | 0.0000 | −1.1630 | 1.3964 | 0.0000 |
| 1.6135 | −1.1369 | 0.0000 | −1.1601 | 1.3973 | 0.0000 |
| 1.6021 | −1.1403 | 0.0000 | −1.1540 | 1.3981 | 0.0000 |
| 1.5863 | −1.1387 | 0.0000 | −1.1445 | 1.3972 | 0.0000 |
| 1.5667 | −1.1315 | 0.0000 | −1.1283 | 1.3913 | 0.0000 |
| 1.5422 | −1.1224 | 0.0000 | −1.1088 | 1.3794 | 0.0000 |
| 1.5125 | −1.1113 | 0.0000 | −1.0853 | 1.3602 | 0.0000 |
| 1.4772 | −1.0979 | 0.0000 | −1.0583 | 1.3334 | 0.0000 |
| 1.4359 | −1.0823 | 0.0000 | −1.0254 | 1.2965 | 0.0000 |
| 1.3870 | −1.0637 | 0.0000 | −0.9888 | 1.2530 | 0.0000 |
| 1.3308 | −1.0421 | 0.0000 | −0.9500 | 1.2061 | 0.0000 |
| 1.2673 | −1.0169 | 0.0000 | −0.9067 | 1.1532 | 0.0000 |
| 1.1966 | −0.9883 | 0.0000 | −0.8583 | 1.0946 | 0.0000 |
| 1.1186 | −0.9564 | 0.0000 | −0.8046 | 1.0308 | 0.0000 |
| 1.0334 | −0.9209 | 0.0000 | −0.7476 | 0.9646 | 0.0000 |
| 0.9448 | −0.8831 | 0.0000 | −0.6875 | 0.8964 | 0.0000 |
| 0.8529 | −0.8427 | 0.0000 | −0.6240 | 0.8260 | 0.0000 |
| 0.7580 | −0.7994 | 0.0000 | −0.5571 | 0.7538 | 0.0000 |
| 0.6599 | −0.7528 | 0.0000 | −0.4868 | 0.6795 | 0.0000 |
| 0.5594 | −0.7027 | 0.0000 | −0.4129 | 0.6036 | 0.0000 |

TABLE 4-continued

| SUCTION SIDE | | | PRESSURE SIDE | | |
|---|---|---|---|---|---|
| X | Y | Z | X | Y | Z |
| 0.4569 | −0.6483 | 0.0000 | −0.3353 | 0.5259 | 0.0000 |
| 0.3528 | −0.5896 | 0.0000 | −0.2538 | 0.4466 | 0.0000 |
| 0.2508 | −0.5277 | 0.0000 | −0.1713 | 0.3685 | 0.0000 |
| 0.1511 | −0.4627 | 0.0000 | −0.0877 | 0.2915 | 0.0000 |
| 0.0539 | −0.3943 | 0.0000 | −0.0028 | 0.2156 | 0.0000 |
| −0.0408 | −0.3223 | 0.0000 | 0.0828 | 0.1406 | 0.0000 |
| −0.1330 | −0.2468 | 0.0000 | 0.1692 | 0.0664 | 0.0000 |
| −0.2228 | −0.1680 | 0.0000 | 0.2558 | −0.0076 | 0.0000 |
| −0.3104 | −0.0861 | 0.0000 | 0.3424 | −0.0816 | 0.0000 |
| −0.3958 | −0.0012 | 0.0000 | 0.4290 | −0.1555 | 0.0000 |
| −0.4786 | 0.0866 | 0.0000 | 0.5158 | −0.2293 | 0.0000 |
| −0.5581 | 0.1763 | 0.0000 | 0.6030 | −0.3027 | 0.0000 |
| −0.6344 | 0.2683 | 0.0000 | 0.6904 | −0.3756 | 0.0000 |
| −0.7051 | 0.3593 | 0.0000 | 0.7754 | −0.4456 | 0.0000 |
| −0.7703 | 0.4491 | 0.0000 | 0.8581 | −0.5126 | 0.0000 |
| −0.8305 | 0.5375 | 0.0000 | 0.9381 | −0.5766 | 0.0000 |
| −0.8859 | 0.6245 | 0.0000 | 1.0157 | −0.6376 | 0.0000 |
| −0.9365 | 0.7099 | 0.0000 | 1.0908 | −0.6957 | 0.0000 |
| −0.9826 | 0.7935 | 0.0000 | 1.1634 | −0.7506 | 0.0000 |
| −1.0245 | 0.8751 | 0.0000 | 1.2336 | −0.8026 | 0.0000 |
| −1.0623 | 0.9547 | 0.0000 | 1.2981 | −0.8495 | 0.0000 |
| −1.0947 | 1.0285 | 0.0000 | 1.3570 | −0.8914 | 0.0000 |
| −1.1220 | 1.0959 | 0.0000 | 1.4096 | −0.9286 | 0.0000 |
| −1.1441 | 1.1567 | 0.0000 | 1.4561 | −0.9615 | 0.0000 |
| −1.1626 | 1.2145 | 0.0000 | 1.4966 | −0.9898 | 0.0000 |
| −1.1762 | 1.2652 | 0.0000 | 1.5310 | −1.0135 | 0.0000 |
| −1.1836 | 1.3050 | 0.0000 | 1.5604 | −1.0337 | 0.0000 |
| −1.1862 | 1.3373 | 0.0000 | 1.5851 | −1.0507 | 0.0000 |
| −1.1845 | 1.3615 | 0.0000 | 1.6056 | −1.0646 | 0.0000 |
| −1.1796 | 1.3789 | 0.0000 | 1.6218 | −1.0759 | 0.0000 |
| −1.1745 | 1.3877 | 0.0000 | 1.6309 | −1.0877 | 0.0000 |
| −1.1699 | 1.3924 | 0.0000 | 1.6342 | −1.0986 | 0.0000 |
| −1.1673 | 1.3942 | 0.0000 | 1.6343 | −1.1079 | 0.0000 |
| −1.1658 | 1.3951 | 0.0000 | 1.6326 | −1.1153 | 0.0000 |
| 1.6272 | −1.1273 | 0.3035 | −1.1921 | 1.3672 | 0.3035 |
| 1.6240 | −1.1323 | 0.3035 | −1.1915 | 1.3675 | 0.3035 |
| 1.6184 | −1.1380 | 0.3035 | −1.1900 | 1.3682 | 0.3035 |
| 1.6102 | −1.1432 | 0.3035 | −1.1872 | 1.3692 | 0.3035 |
| 1.5987 | −1.1464 | 0.3035 | −1.1811 | 1.3702 | 0.3035 |
| 1.5830 | −1.1444 | 0.3035 | −1.1716 | 1.3695 | 0.3035 |
| 1.5638 | −1.1369 | 0.3035 | −1.1553 | 1.3641 | 0.3035 |
| 1.5396 | −1.1274 | 0.3035 | −1.1354 | 1.3528 | 0.3035 |
| 1.5104 | −1.1159 | 0.3035 | −1.1112 | 1.3344 | 0.3035 |
| 1.4756 | −1.1020 | 0.3035 | −1.0831 | 1.3089 | 0.3035 |
| 1.4349 | −1.0856 | 0.3035 | −1.0486 | 1.2736 | 0.3035 |
| 1.3869 | −1.0659 | 0.3035 | −1.0099 | 1.2318 | 0.3035 |
| 1.3317 | −1.0431 | 0.3035 | −0.9691 | 1.1868 | 0.3035 |
| 1.2692 | −1.0170 | 0.3035 | −0.9235 | 1.1359 | 0.3035 |
| 1.1996 | −0.9875 | 0.3035 | −0.8728 | 1.0795 | 0.3035 |
| 1.1227 | −0.9543 | 0.3035 | −0.8168 | 1.0176 | 0.3035 |
| 1.0388 | −0.9174 | 0.3035 | −0.7576 | 0.9534 | 0.3035 |
| 0.9516 | −0.8785 | 0.3035 | −0.6955 | 0.8869 | 0.3035 |
| 0.8610 | −0.8370 | 0.3035 | −0.6303 | 0.8183 | 0.3035 |
| 0.7673 | −0.7928 | 0.3035 | −0.5617 | 0.7475 | 0.3035 |
| 0.6707 | −0.7455 | 0.3035 | −0.4898 | 0.6748 | 0.3035 |
| 0.5715 | −0.6947 | 0.3035 | −0.4143 | 0.6003 | 0.3035 |
| 0.4701 | −0.6402 | 0.3035 | −0.3351 | 0.5241 | 0.3035 |
| 0.3668 | −0.5815 | 0.3035 | −0.2522 | 0.4464 | 0.3035 |
| 0.2655 | −0.5204 | 0.3035 | −0.1683 | 0.3697 | 0.3035 |
| 0.1662 | −0.4565 | 3.3035 | −0.0835 | 0.2938 | 0.3035 |
| 0.0690 | −0.3896 | 0.3035 | 0.0021 | 0.2189 | 0.3035 |
| −0.0257 | −0.3194 | 0.3035 | 0.0885 | 0.1447 | 0.3035 |
| −0.1180 | −0.2460 | 0.3035 | 0.1754 | 0.0710 | 0.3035 |
| −0.2080 | −0.1693 | 0.3035 | 0.2622 | −0.0026 | 0.3035 |
| −0.2957 | −0.0898 | 0.3035 | 0.3490 | −0.0763 | 0.3035 |
| −0.3815 | −0.0076 | 0.3035 | 0.4357 | −0.1501 | 0.3035 |
| −0.4652 | 0.0775 | 0.3035 | 0.5226 | −0.2239 | 0.3035 |
| −0.5465 | 0.1656 | 0.3035 | 0.6094 | −0.2975 | 0.3035 |
| −0.6252 | 0.2560 | 0.3035 | 0.6966 | −0.3708 | 0.3035 |
| −0.6983 | 0.3458 | 0.3035 | 0.7811 | −0.4413 | 0.3035 |
| −0.7662 | 0.4346 | 0.3035 | 0.8632 | −0.5088 | 0.3035 |
| −0.8292 | 0.5223 | 0.3035 | 0.9427 | −0.5736 | 0.3035 |
| −0.8871 | 0.6086 | 0.3035 | 1.0196 | −0.6353 | 0.3035 |
| −0.9404 | 0.6931 | 0.3035 | 1.0940 | −0.6942 | 0.3035 |
| −0.9892 | 0.7759 | 0.3035 | 1.1661 | −0.7501 | 0.3035 |
| −1.0336 | 0.8563 | 0.3035 | 1.2355 | −0.8029 | 0.3035 |

TABLE 4-continued

| SUCTION SIDE | | | PRESSURE SIDE | | |
|---|---|---|---|---|---|
| X | Y | Z | X | Y | Z |
| −1.0739 | 0.9345 | 0.3035 | 1.2994 | −0.8507 | 0.3035 |
| −1.1086 | 1.0067 | 0.3035 | 1.3573 | −0.8937 | 0.3035 |
| −1.1379 | 1.0724 | 0.3035 | 1.4093 | −0.9318 | 0.3035 |
| −1.1619 | 1.1317 | 0.3035 | 1.4554 | −0.9652 | 0.3035 |
| −1.1822 | 1.1882 | 0.3035 | 1.4955 | −0.9941 | 0.3035 |
| −1.1974 | 1.2379 | 0.3035 | 1.5294 | −1.0184 | 0.3035 |
| −1.2063 | 1.2770 | 0.3035 | 1.5584 | −1.0392 | 0.3035 |
| −1.2100 | 1.3087 | 0.3035 | 1.5828 | −1.0566 | 0.3035 |
| −1.2095 | 1.3327 | 0.3035 | 1.6028 | −1.0710 | 0.3035 |
| −1.2055 | 1.3503 | 0.3035 | 1.6189 | −1.0826 | 0.3035 |
| −1.2010 | 1.3591 | 0.3035 | 1.6280 | −1.0945 | 0.3035 |
| −1.1967 | 1.3639 | 0.3035 | 1.6312 | −1.1053 | 0.3035 |
| −1.1942 | 1.3659 | 0.3035 | 1.6312 | −1.1147 | 0.3035 |
| −1.1929 | 1.3668 | 0.3035 | 1.6294 | −1.1222 | 0.3035 |
| 1.6199 | −1.1390 | 0.5611 | −1.2073 | 1.3496 | 0.5611 |
| 1.6167 | −1.1440 | 0.5611 | −1.2066 | 1.3499 | 0.5611 |
| 1.6111 | −1.1495 | 0.5611 | −1.2052 | 1.3507 | 0.5611 |
| 1.6026 | −1.1545 | 0.5611 | −1.2024 | 1.3517 | 0.5611 |
| 1.5912 | −1.1573 | 0.5611 | −1.1963 | 1.3529 | 0.5611 |
| 1.5757 | −1.1550 | 0.5611 | −1.1867 | 1.3524 | 0.5611 |
| 1.5566 | −1.1471 | 0.5611 | −1.1703 | 1.3472 | 0.5611 |
| 1.5328 | −1.1373 | 0.5611 | −1.1502 | 1.3363 | 0.5611 |
| 1.5039 | −1.1251 | 0.5611 | −1.1255 | 1.3187 | 0.5611 |
| 1.4695 | −1.1107 | 0.5611 | −1.0967 | 1.2939 | 0.5611 |
| 1.4293 | −1.0936 | 0.5611 | −1.0610 | 1.2598 | 0.5611 |
| 1.3820 | −1.0732 | 0.5611 | −1.0210 | 1.2194 | 0.5611 |
| 1.3274 | −1.0494 | 0.5611 | −0.9790 | 1.1756 | 0.5611 |
| 1.2657 | −1.0223 | 0.5611 | −0.9320 | 1.1259 | 0.5611 |
| 1.1968 | −0.9916 | 0.5611 | −0.8799 | 1.0709 | 0.5611 |
| 1.1210 | −0.9572 | 0.5611 | −0.8224 | 1.0103 | 0.5611 |
| 1.0381 | −0.9191 | 0.5611 | −0.7618 | 0.9475 | 0.5611 |
| 0.9519 | −0.8788 | 0.5611 | −0.6984 | 0.8822 | 0.5611 |
| 0.8624 | −0.8362 | 0.5611 | −0.6319 | 0.8146 | 0.5611 |
| 0.7698 | −0.7907 | 0.5611 | −0.5622 | 0.7450 | 0.5611 |
| 0.6743 | −0.7423 | 0.5611 | −0.4893 | 0.6732 | 0.5611 |
| 0.5762 | −0.6905 | 0.5611 | −0.4127 | 0.5997 | 0.5611 |
| 0.4757 | −0.6352 | 0.5611 | −0.3327 | 0.5243 | 0.5611 |
| 0.3732 | −0.5762 | 0.5611 | −0.2490 | 0.4474 | 0.5611 |
| 0.2725 | −0.5149 | 0.5611 | −0.1645 | 0.3712 | 0.5611 |
| 0.1735 | −0.4511 | 0.5611 | −0.0793 | 0.2959 | 0.5611 |
| 0.0767 | −0.3846 | 0.5611 | 0.0067 | 0.2214 | 0.5611 |
| −0.0180 | −0.3151 | 0.5611 | 0.0933 | 0.1474 | 0.5611 |
| −0.1103 | −0.2424 | 0.5611 | 0.1802 | 0.0738 | 0.5611 |
| −0.2003 | −0.1666 | 0.5611 | 0.2670 | 0.0002 | 0.5611 |
| −0.2882 | −0.0881 | 0.5611 | 0.3537 | −0.0737 | 0.5611 |
| −0.3742 | −0.0069 | 0.5611 | 0.4402 | −0.1478 | 0.5611 |
| −0.4581 | 0.0769 | 0.5611 | 0.5266 | −0.2220 | 0.5611 |
| −0.5400 | 0.1636 | 0.5611 | 0.6130 | −0.2961 | 0.5611 |
| −0.6194 | 0.2528 | 0.5611 | 0.6996 | −0.3701 | 0.5611 |
| −0.6936 | 0.3413 | 0.5611 | 0.7835 | −0.4414 | 0.5611 |
| −0.7625 | 0.4288 | 0.5611 | 0.8648 | −0.5098 | 0.5611 |
| −0.8264 | 0.5152 | 0.5611 | 0.9435 | −0.5754 | 0.5611 |
| −0.8857 | 0.6003 | 0.5611 | 1.0197 | −0.6382 | 0.5611 |
| −0.9403 | 0.6835 | 0.5611 | 1.0934 | −0.6980 | 0.5611 |
| −0.9905 | 0.7649 | 0.5611 | 1.1646 | −0.7548 | 0.5611 |
| −1.0365 | 0.8441 | 0.5611 | 1.2333 | −0.8086 | 0.5611 |
| −1.0784 | 0.9212 | 0.5611 | 1.2963 | −0.8573 | 0.5611 |
| −1.1145 | 0.9922 | 0.5611 | 1.3536 | −0.9012 | 0.5611 |
| −1.1451 | 1.0571 | 0.5611 | 1.4050 | −0.9402 | 0.5611 |
| −1.1705 | 1.1157 | 0.5611 | 1.4506 | −0.9743 | 0.5611 |
| −1.1919 | 1.1715 | 0.5611 | 1.4902 | −1.0038 | 0.5611 |
| −1.2083 | 1.2206 | 0.5611 | 1.5237 | −1.0208 | 0.5611 |
| −1.2182 | 1.2593 | 0.5611 | 1.5524 | −1.0500 | 0.5611 |
| −1.2229 | 1.2908 | 0.5611 | 1.5765 | −1.0678 | 0.5611 |
| −1.2232 | 1.3145 | 0.5611 | 1.5962 | −1.0826 | 0.5611 |
| −1.2200 | 1.3322 | 0.5611 | 1.6121 | −1.0944 | 0.5611 |
| −1.2158 | 1.3413 | 0.5611 | 1.6212 | −1.1064 | 0.5611 |
| −1.2117 | 1.3462 | 0.5611 | 1.6243 | −1.1172 | 0.5611 |
| −1.2093 | 1.3483 | 0.5611 | 1.6242 | −1.1266 | 0.5611 |
| −1.2079 | 1.3492 | 0.5611 | 1.6223 | −1.1339 | 0.5611 |
| 1.6054 | −1.1601 | 0.8186 | −1.2112 | 1.3417 | 0.8186 |
| 1.6019 | −1.1649 | 0.8186 | −1.2105 | 1.3421 | 0.8186 |
| 1.5962 | −1.1703 | 0.8186 | −1.2091 | 1.3427 | 0.8186 |
| 1.5878 | −1.1751 | 0.8186 | −1.2063 | 1.3439 | 0.8186 |
| 1.5762 | −1.1774 | 0.8186 | −1.2002 | 1.3450 | 0.8186 |
| 1.5610 | −1.1743 | 0.8186 | −1.1907 | 1.3446 | 0.8186 |

TABLE 4-continued

| SUCTION SIDE | | | PRESSURE SIDE | | |
|---|---|---|---|---|---|
| X | Y | Z | X | Y | Z |
| 1.5421 | −1.1661 | 0.8186 | −1.1742 | 1.3396 | 0.8186 |
| 1.5186 | −1.1558 | 0.8186 | −1.1540 | 1.3290 | 0.8186 |
| 1.4901 | −1.1431 | 0.8186 | −1.1291 | 1.3117 | 0.8186 |
| 1.4562 | −1.1280 | 0.8186 | −1.0998 | 1.2875 | 0.8186 |
| 1.4165 | −1.1102 | 0.8186 | −1.0634 | 1.2541 | 0.8186 |
| 1.3698 | −1.0890 | 0.8186 | −1.0227 | 1.2145 | 0.8186 |
| 1.3160 | −1.0643 | 0.8186 | −0.9799 | 1.1715 | 0.8186 |
| 1.2552 | −1.0360 | 0.8186 | −0.9321 | 1.1227 | 0.8186 |
| 1.1873 | −1.0041 | 0.8186 | −0.8791 | 1.0684 | 0.8186 |
| 1.1125 | −0.9682 | 0.8186 | −0.8208 | 1.0088 | 0.8186 |
| 1.0309 | −0.9287 | 0.8186 | −0.7595 | 0.9467 | 0.8186 |
| 0.9458 | −0.8867 | 0.8186 | −0.6953 | 0.8822 | 0.8186 |
| 0.8578 | −0.8424 | 0.8186 | −0.6281 | 0.8153 | 0.8186 |
| 0.7664 | −0.7953 | 0.8186 | −0.5577 | 0.7463 | 0.8186 |
| 0.6723 | −0.7453 | 0.8186 | −0.4842 | 0.6751 | 0.8186 |
| 0.5755 | −0.6921 | 0.8186 | −0.4074 | 0.6019 | 0.8186 |
| 0.4765 | −0.6355 | 0.8186 | −0.3271 | 0.5267 | 0.8186 |
| 0.3751 | −0.5753 | 0.8186 | −0.2434 | 0.4498 | 0.8186 |
| 0.2753 | −0.5132 | 0.8186 | −0.1590 | 0.3736 | 0.8186 |
| 0.1772 | −0.4487 | 0.8186 | −0.0738 | 0.2981 | 0.8186 |
| 0.0811 | −0.3816 | 0.8186 | 0.0119 | 0.2233 | 0.8186 |
| −0.0131 | −0.3118 | 0.8186 | 0.0982 | 0.1490 | 0.8186 |
| −0.1050 | −0.2389 | 0.8186 | 0.1846 | 0.0750 | 0.8186 |
| −0.1947 | −0.1629 | 0.8186 | 0.2708 | 0.0006 | 0.8186 |
| −0.2823 | −0.0844 | 0.8186 | 0.3568 | −0.0740 | 0.8186 |
| −0.3682 | −0.0032 | 0.8186 | 0.4424 | −0.1489 | 0.8186 |
| −0.4521 | 0.0804 | 0.8186 | 0.5279 | −0.2241 | 0.8186 |
| −0.5339 | 0.1667 | 0.8186 | 0.6133 | −0.2994 | 0.8186 |
| −0.6131 | 0.2553 | 0.8186 | 0.6988 | −0.3746 | 0.8186 |
| −0.6874 | 0.3431 | 0.8186 | 0.7815 | −0.4472 | 0.8186 |
| −0.7566 | 0.4298 | 0.8186 | 0.8616 | −0.5170 | 0.8186 |
| −0.8210 | 0.5153 | 0.8186 | 0.9390 | −0.5840 | 0.8186 |
| −0.8808 | 0.5994 | 0.8186 | 1.0140 | −0.6482 | 0.8186 |
| −0.9360 | 0.6817 | 0.8186 | 1.0865 | −0.7094 | 0.8186 |
| −0.9869 | 0.7622 | 0.8186 | 1.1566 | −0.7675 | 0.8186 |
| −1.0336 | 0.8406 | 0.8186 | 1.2242 | −0.8227 | 0.8186 |
| −1.0762 | 0.9167 | 0.8186 | 1.2863 | −0.8726 | 0.8186 |
| −1.1131 | 0.9870 | 0.8186 | 1.3427 | −0.9174 | 0.8186 |
| −1.1443 | 1.0512 | 0.8186 | 1.3934 | −0.9575 | 0.8186 |
| −1.1702 | 1.1092 | 0.8186 | 1.4382 | −0.9925 | 0.8186 |
| −1.1923 | 1.1644 | 0.8186 | 1.4771 | −1.0228 | 0.8186 |
| −1.2093 | 1.2132 | 0.8186 | 1.5102 | −1.0483 | 0.8186 |
| −1.2197 | 1.2514 | 0.8186 | 1.5383 | −1.0701 | 0.8186 |
| −1.2251 | 1.2827 | 0.8186 | 1.5621 | −1.0885 | 0.8186 |
| −1.2261 | 1.3064 | 0.8186 | 1.5817 | −1.1034 | 0.8186 |
| −1.2232 | 1.3241 | 0.8186 | 1.5974 | −1.1155 | 0.8186 |
| −1.2194 | 1.3331 | 0.8186 | 1.6067 | −1.1273 | 0.8186 |
| −1.2155 | 1.3382 | 0.8186 | 1.6099 | −1.1382 | 0.8186 |
| −1.2132 | 1.3403 | 0.8186 | 1.6098 | −1.1476 | 0.8186 |
| −1.2118 | 1.3413 | 0.8186 | 1.6079 | −1.1550 | 0.8186 |
| 1.5594 | −1.2200 | 1.3336 | −1.1959 | 1.3495 | 1.3336 |
| 1.5558 | −1.2246 | 1.3336 | −1.1952 | 1.3499 | 1.3336 |
| 1.5499 | −1.2296 | 1.3336 | −1.1938 | 1.3507 | 1.3336 |
| 1.5410 | −1.2336 | 1.3336 | −1.1910 | 1.3518 | 1.3336 |
| 1.5293 | −1.2346 | 1.3336 | −1.1850 | 1.3530 | 1.3336 |
| 1.5146 | −1.2296 | 1.3336 | −1.1754 | 1.3524 | 1.3336 |
| 1.4962 | −1.2207 | 1.3336 | −1.1590 | 1.3472 | 1.3336 |
| 1.4733 | −1.2095 | 1.3336 | −1.1388 | 1.3366 | 1.3336 |
| 1.4454 | −1.1958 | 1.3336 | −1.1138 | 1.3195 | 1.3336 |
| 1.4124 | −1.1794 | 1.3336 | −1.0842 | 1.2957 | 1.3336 |
| 1.3736 | −1.1601 | 1.3336 | −1.0474 | 1.2629 | 1.3336 |
| 1.3281 | −1.1370 | 1.3336 | −1.0059 | 1.2240 | 1.3336 |
| 1.2756 | −1.1101 | 1.3336 | −0.9626 | 1.1816 | 1.3336 |
| 1.2164 | −1.0793 | 1.3336 | −0.9143 | 1.1333 | 1.3336 |
| 1.1503 | −1.0445 | 1.3336 | −0.8609 | 1.0795 | 1.3336 |
| 1.0777 | −1.0056 | 1.3336 | −0.8023 | 1.0203 | 1.3336 |
| 0.9983 | −0.9625 | 1.3336 | −0.7408 | 0.9584 | 1.3336 |
| 0.9157 | −0.9169 | 1.3336 | −0.6764 | 0.8941 | 1.3336 |
| 0.8301 | −0.8689 | 1.3336 | −0.6093 | 0.8273 | 1.3336 |
| 0.7415 | −0.8181 | 1.3336 | −0.5391 | 0.7580 | 1.3336 |
| 0.6502 | −0.7641 | 1.3336 | −0.4660 | 0.6863 | 1.3336 |
| 0.5565 | −0.7072 | 1.3336 | −0.3899 | 0.6123 | 1.3336 |
| 0.4605 | −0.6469 | 1.3336 | −0.3107 | 0.5362 | 1.3336 |
| 0.3624 | −0.5829 | 1.3336 | −0.2283 | 0.4578 | 1.3336 |
| 0.2658 | −0.5171 | 1.3336 | −0.1454 | 0.3799 | 1.3336 |
| 0.1707 | −0.4495 | 1.3336 | −0.0620 | 0.3025 | 1.3336 |

TABLE 4-continued

| SUCTION SIDE | | | PRESSURE SIDE | | |
|---|---|---|---|---|---|
| X | Y | Z | X | Y | Z |
| 0.0775 | −0.3796 | 1.3336 | 0.0218 | 0.2257 | 1.3336 |
| −0.0138 | −0.3072 | 1.3336 | 0.1059 | 0.1490 | 1.3336 |
| −0.1028 | −0.2323 | 1.3336 | 0.1900 | 0.0724 | 1.3336 |
| −0.1898 | −0.1547 | 1.3336 | 0.2737 | −0.0047 | 1.3336 |
| −0.2747 | −0.0746 | 1.3336 | 0.3569 | −0.0822 | 1.3336 |
| −0.3578 | 0.0076 | 1.3336 | 0.4396 | −0.1603 | 1.3336 |
| −0.4392 | 0.0922 | 1.3336 | 0.5220 | −0.2388 | 1.3336 |
| −0.5188 | 0.1788 | 1.3336 | 0.6042 | −0.3175 | 1.3336 |
| −0.5965 | 0.2678 | 1.3336 | 0.6863 | −0.3963 | 1.3336 |
| −0.6696 | 0.3558 | 1.3336 | 0.7657 | −0.4723 | 1.3336 |
| −0.7379 | 0.4427 | 1.3336 | 0.8427 | −0.5455 | 1.3336 |
| −0.8017 | 0.5280 | 1.3336 | 0.9170 | −0.6159 | 1.3336 |
| −0.8610 | 0.6117 | 1.3336 | 0.9890 | −0.6833 | 1.3336 |
| −0.9161 | 0.0937 | 1.3336 | 1.0586 | −0.7477 | 1.3336 |
| −0.9669 | 0.7737 | 1.3336 | 1.1259 | −0.8090 | 1.3336 |
| −1.0136 | 0.8516 | 1.3336 | 1.1909 | −0.8672 | 1.3336 |
| −1.0563 | 0.9272 | 1.3336 | 1.2506 | −0.9199 | 1.3336 |
| −1.0934 | 0.9969 | 1.3336 | 1.3049 | −0.9672 | 1.3336 |
| −1.1249 | 1.0606 | 1.3336 | 1.3537 | −1.0093 | 1.3336 |
| −1.1511 | 1.1182 | 1.3336 | 1.3969 | −1.0464 | 1.3336 |
| −1.1735 | 1.1730 | 1.3336 | 1.4345 | −1.0784 | 1.3336 |
| −1.1907 | 1.2213 | 1.3336 | 1.4663 | −1.1053 | 1.3336 |
| −1.2016 | 1.2594 | 1.3336 | 1.4935 | −1.1284 | 1.3336 |
| −1.2076 | 1.2904 | 1.3336 | 1.5164 | −1.1476 | 1.3336 |
| −1.2093 | 1.3139 | 1.3336 | 1.5353 | −1.1634 | 1.3336 |
| −1.2072 | 1.3316 | 1.3336 | 1.5505 | −1.1760 | 1.3336 |
| −1.2038 | 1.3408 | 1.3336 | 1.5605 | −1.1872 | 1.3336 |
| −1.2001 | 1.3460 | 1.3336 | 1.5642 | −1.1981 | 1.3336 |
| −1.1978 | 1.3482 | 1.3336 | 1.5641 | −1.2075 | 1.3336 |
| −1.1965 | 1.3491 | 1.3336 | 1.5621 | −1.2149 | 1.3336 |
| 1.5072 | −1.2843 | 1.8486 | −1.1689 | 1.3672 | 1.8486 |
| 1.5035 | −1.2887 | 1.8486 | −1.1683 | 1.3676 | 1.8486 |
| 1.4972 | −1.2933 | 1.8486 | −1.1669 | 1.3683 | 1.8486 |
| 1.4881 | −1.2965 | 1.8486 | −1.1641 | 1.3694 | 1.8486 |
| 1.4764 | −1.2961 | 1.8486 | −1.1579 | 1.3704 | 1.8486 |
| 1.4622 | −1.2897 | 1.8486 | −1.1484 | 1.3693 | 1.8486 |
| 1.4443 | −1.2800 | 1.8486 | −1.1321 | 1.3636 | 1.8486 |
| 1.4220 | −1.2677 | 1.8486 | −1.1123 | 1.3515 | 1.8486 |
| 1.3949 | −1.2529 | 1.8486 | −1.0877 | 1.3349 | 1.8486 |
| 1.3627 | −1.2351 | 1.8486 | −1.0584 | 1.3107 | 1.8486 |
| 1.3250 | −1.2141 | 1.8486 | −1.0219 | 1.2777 | 1.8486 |
| 1.2806 | −1.1892 | 1.8486 | −0.9808 | 1.2384 | 1.8486 |
| 1.2296 | −1.1602 | 1.8486 | −0.9379 | 1.1956 | 1.8486 |
| 1.1719 | −1.1269 | 1.8486 | −0.8901 | 1.1469 | 1.8486 |
| 1.1077 | −1.0893 | 1.8486 | −0.8373 | 1.0924 | 1.8486 |
| 1.0370 | −1.0475 | 1.8486 | −0.7794 | 1.0325 | 1.8486 |
| 0.9598 | −1.0012 | 1.8486 | −0.7188 | 0.9699 | 1.8486 |
| 0.8794 | −0.9524 | 1.8486 | −0.6553 | 0.9047 | 1.8486 |
| 0.7962 | −0.9010 | 1.8486 | −0.5893 | 0.8368 | 1.8486 |
| 0.7101 | −0.8468 | 1.8486 | −0.5204 | 0.7664 | 1.8486 |
| 0.6215 | −0.7895 | 1.8486 | −0.4485 | 0.6935 | 1.8486 |
| 0.5305 | −0.7290 | 1.8486 | −0.3740 | 0.6181 | 1.8486 |
| 0.4374 | −0.6652 | 1.8486 | −0.2964 | 0.5401 | 1.8486 |
| 0.3423 | −0.5976 | 1.8486 | −0.2158 | 0.4599 | 1.8486 |
| 0.2487 | −0.5285 | 1.8486 | −0.1351 | 0.3799 | 1.8486 |
| 0.1568 | −0.4575 | 1.8486 | −0.0539 | 0.3002 | 1.8486 |
| 0.0666 | −0.3843 | 1.8486 | 0.0274 | 0.2209 | 1.8486 |
| −0.0215 | −0.3088 | 1.8486 | 0.1089 | 0.1416 | 1.8486 |
| −0.1074 | −0.2310 | 1.8486 | 0.1904 | 0.0622 | 1.8486 |
| −0.1912 | −0.1506 | 1.8486 | 0.2712 | −0.0178 | 1.8486 |
| −0.2732 | −0.0682 | 1.8486 | 0.3514 | −0.0983 | 1.8486 |
| −0.3535 | 0.0162 | 1.8486 | 0.4311 | −0.1794 | 1.8486 |
| −0.4322 | 0.1025 | 1.8486 | 0.5104 | −0.2610 | 1.8486 |
| −0.5090 | 0.1907 | 1.8486 | 0.5894 | −0.3427 | 1.8486 |
| −0.5842 | 0.2810 | 1.8486 | 0.6683 | −0.4246 | 1.8486 |
| −0.6552 | 0.3701 | 1.8486 | 0.7446 | −0.5038 | 1.8486 |
| −0.7217 | 0.4578 | 1.8486 | 0.8184 | −0.5801 | 1.8486 |
| −0.7838 | 0.5439 | 1.8486 | 0.8897 | −0.6535 | 1.8486 |
| −0.8415 | 0.6282 | 1.8486 | 0.9587 | −0.7238 | 1.8486 |
| −0.8951 | 0.7106 | 1.8486 | 1.0254 | −0.7912 | 1.8486 |
| −0.9447 | 0.7911 | 1.8486 | 1.0900 | −0.8552 | 1.8486 |
| −0.9902 | 0.8692 | 1.8486 | 1.1523 | −0.9163 | 1.8486 |
| −1.0319 | 0.9450 | 1.8486 | 1.2096 | −0.9715 | 1.8486 |
| −1.0680 | 1.0148 | 1.8486 | 1.2618 | −1.0211 | 1.8486 |
| −1.0988 | 1.0787 | 1.8486 | 1.3087 | −1.0653 | 1.8486 |
| −1.1244 | 1.1362 | 1.8486 | 1.3502 | −1.1043 | 1.8486 |

TABLE 4-continued

| SUCTION SIDE | | | PRESSURE SIDE | | |
|---|---|---|---|---|---|
| X | Y | Z | X | Y | Z |
| −1.1462 | 1.1910 | 1.8486 | 1.3862 | −1.1379 | 1.8486 |
| −1.1629 | 1.2394 | 1.8486 | 1.4168 | −1.1663 | 1.8486 |
| −1.1736 | 1.2772 | 1.8486 | 1.4430 | −1.1903 | 1.8486 |
| −1.1798 | 1.3081 | 1.8486 | 1.4650 | −1.2106 | 1.8486 |
| −1.1817 | 1.3316 | 1.8486 | 1.4833 | −1.2272 | 1.8486 |
| −1.1799 | 1.3492 | 1.8486 | 1.4978 | −1.2405 | 1.8486 |
| −1.1766 | 1.3584 | 1.8486 | 1.5082 | −1.2514 | 1.8486 |
| −1.1732 | 1.3637 | 1.8486 | 1.5123 | −1.2622 | 1.8486 |
| −1.1709 | 1.3659 | 1.8486 | 1.5123 | −1.2718 | 1.8486 |
| −1.1696 | 1.3668 | 1.8486 | 1.5102 | −1.2793 | 1.8486 |
| 1.3861 | −1.4239 | 2.8787 | −1.1006 | 1.3978 | 2.8787 |
| 1.3819 | −1.4279 | 2.8787 | −1.1000 | 1.3982 | 2.8787 |
| 1.3752 | −1.4317 | 2.8787 | −1.0985 | 1.3988 | 2.8787 |
| 1.3658 | −1.4335 | 2.8787 | −1.0956 | 1.3997 | 2.8787 |
| 1.3544 | −1.4313 | 2.8787 | −1.0895 | 1.4000 | 2.8787 |
| 1.3413 | −1.4229 | 2.8787 | −1.0802 | 1.3981 | 2.8787 |
| 1.3244 | −1.4117 | 2.8787 | −1.0646 | 1.3909 | 2.8787 |
| 1.3034 | −1.3977 | 2.8787 | −1.0457 | 1.3783 | 2.8787 |
| 1.2779 | −1.3805 | 2.8787 | −1.0222 | 1.3593 | 2.8787 |
| 1.2476 | −1.3600 | 2.8787 | −0.9942 | 1.3337 | 2.8787 |
| 1.2122 | −1.3359 | 2.8787 | −0.9593 | 1.2992 | 2.8787 |
| 1.1706 | −1.3072 | 2.8787 | −0.9202 | 1.2580 | 2.8787 |
| 1.1225 | −1.2740 | 2.8787 | −0.8794 | 1.2133 | 2.8787 |
| 1.0682 | −1.2361 | 2.8787 | −0.8342 | 1.1624 | 2.8787 |
| 1.0078 | −1.1935 | 2.8787 | −0.7841 | 1.1056 | 2.8787 |
| 0.9414 | −1.1459 | 2.8787 | −0.7293 | 1.0430 | 2.8787 |
| 0.8688 | −1.0936 | 2.8787 | −0.6719 | 0.9776 | 2.8787 |
| 0.7934 | −1.0385 | 2.8787 | −0.6120 | 0.9093 | 2.8787 |
| 0.7151 | −0.9806 | 2.8787 | −0.5496 | 0.8382 | 2.8787 |
| 0.6344 | −0.9198 | 2.8787 | −0.4846 | 0.7642 | 2.8787 |
| 0.5515 | −0.8558 | 2.8787 | −0.4171 | 0.6877 | 2.8787 |
| 0.4663 | −0.7884 | 2.8787 | −0.3468 | 0.6083 | 2.8787 |
| 0.3794 | −0.7176 | 2.8787 | −0.2738 | 0.5263 | 2.8787 |
| 0.2907 | −0.6431 | 2.8787 | −0.1981 | 0.4418 | 2.8787 |
| 0.2036 | −0.5671 | 2.8787 | −0.1223 | 0.3573 | 2.8787 |
| 0.1181 | −0.4895 | 2.8787 | −0.0463 | 0.2730 | 2.8787 |
| 0.0347 | −0.4100 | 2.8787 | 0.0298 | 0.1887 | 2.8787 |
| −0.0468 | −0.3284 | 2.8787 | 0.1059 | 0.1045 | 2.8787 |
| −0.1262 | −0.2448 | 2.8787 | 0.1818 | 0.0200 | 2.8787 |
| −0.2034 | −0.1593 | 2.8787 | 0.2569 | −0.0651 | 2.8787 |
| −0.2790 | −0.0720 | 2.8787 | 0.3311 | −0.1510 | 2.8787 |
| −0.3530 | 0.0165 | 2.8787 | 0.4046 | −0.2375 | 2.8787 |
| −0.4256 | 0.1067 | 2.8787 | 0.4774 | −0.3246 | 2.8787 |
| −0.4965 | 0.1984 | 2.8787 | 0.5498 | −0.4120 | 2.8787 |
| −0.5656 | 0.2919 | 2.8787 | 0.6220 | −0.4996 | 2.8787 |
| −0.6307 | 0.3838 | 2.8787 | 0.6917 | −0.5844 | 2.8787 |
| −0.6920 | 0.4742 | 2.8787 | 0.7590 | −0.6662 | 2.8787 |
| −0.7492 | 0.5629 | 2.8787 | 0.8241 | −0.7450 | 2.8787 |
| −0.8024 | 0.6495 | 2.8787 | 0.8870 | −0.8206 | 2.8787 |
| −0.8516 | 0.7339 | 2.8787 | 0.9478 | −0.8931 | 2.8787 |
| −0.8970 | 0.8161 | 2.8787 | 1.0066 | −0.9623 | 2.8787 |
| −0.9386 | 0.8958 | 2.8787 | 1.0634 | −1.0282 | 2.8787 |
| −0.9767 | 0.9728 | 2.8787 | 1.1157 | −1.0880 | 2.8787 |
| −1.0098 | 1.0437 | 2.8787 | 1.1633 | −1.1420 | 2.8787 |
| −1.0379 | 1.1084 | 2.8787 | 1.2061 | −1.1900 | 2.8787 |
| −1.0612 | 1.1664 | 2.8787 | 1.2439 | −1.2323 | 2.8787 |
| −1.0809 | 1.2217 | 2.8787 | 1.2768 | −1.2689 | 2.8787 |
| −1.0959 | 1.2703 | 2.8787 | 1.3048 | −1.2997 | 2.8787 |
| −1.1054 | 1.3082 | 2.8787 | 1.3288 | −1.3260 | 2.8787 |
| −1.1110 | 1.3389 | 2.8787 | 1.3490 | −1.3481 | 2.8787 |
| −1.1128 | 1.3623 | 2.8787 | 1.3655 | −1.3662 | 2.8787 |
| −1.1113 | 1.3798 | 2.8787 | 1.3788 | −1.3806 | 2.8787 |
| −1.1082 | 1.3891 | 2.8787 | 1.3887 | −1.3921 | 2.8787 |
| −1.1049 | 1.3943 | 2.8787 | 1.3922 | −1.4027 | 2.8787 |
| −1.1026 | 1.3964 | 2.8787 | 1.3918 | −1.4121 | 2.8787 |
| −1.1012 | 1.3974 | 2.8787 | 1.3892 | −1.4192 | 2.8787 |
| 1.3344 | −1.4865 | 3.3938 | −1.0703 | 1.4020 | 3.3938 |
| 1.3302 | −1.4904 | 3.3938 | −1.0696 | 1.4024 | 3.3938 |
| 1.3232 | −1.4938 | 3.3938 | −1.0681 | 1.4029 | 3.3938 |
| 1.3137 | −1.4952 | 3.3938 | −1.0652 | 1.4038 | 3.3938 |
| 1.3026 | −1.4922 | 3.3938 | −1.0591 | 1.4038 | 3.3938 |
| 1.2898 | −1.4833 | 3.3938 | −1.0499 | 1.4014 | 3.3938 |
| 1.2734 | −1.4715 | 3.3938 | −1.0347 | 1.3935 | 3.3938 |
| 1.2529 | −1.4569 | 3.3938 | −1.0163 | 1.3802 | 3.3938 |
| 1.2279 | −1.4388 | 3.3938 | −0.9935 | 1.3604 | 3.3938 |
| 1.1984 | −1.4175 | 3.3938 | −0.9662 | 1.3341 | 3.3938 |

TABLE 4-continued

| SUCTION SIDE | | | PRESSURE SIDE | | |
|---|---|---|---|---|---|
| X | Y | Z | X | Y | Z |
| 1.1639 | −1.3924 | 3.3938 | −0.9323 | 1.2986 | 3.3938 |
| 1.1231 | −1.3624 | 3.3938 | −0.8944 | 1.2565 | 3.3938 |
| 1.0763 | −1.3277 | 3.3938 | −0.8548 | 1.2108 | 3.3938 |
| 1.0233 | −1.2884 | 3.3938 | −0.8109 | 1.1588 | 3.3938 |
| 0.9645 | −1.2439 | 3.3938 | −0.7625 | 1.1008 | 3.3938 |
| 0.8996 | −1.1942 | 3.3938 | −0.7092 | 1.0369 | 3.3938 |
| 0.8290 | −1.1397 | 3.3938 | −0.6536 | 0.9700 | 3.3938 |
| 0.7553 | −1.0824 | 3.3938 | −0.5955 | 0.9003 | 3.3938 |
| 0.6792 | −1.0222 | 3.3938 | −0.5351 | 0.8276 | 3.3938 |
| 0.6007 | −0.9589 | 3.3938 | −0.4722 | 0.7521 | 3.3938 |
| 0.5199 | −0.8924 | 3.3938 | −0.4067 | 0.6739 | 3.3938 |
| 0.4372 | −0.8226 | 3.3938 | −0.3387 | 0.5927 | 3.3938 |
| 0.3528 | −0.7492 | 3.3938 | −0.2681 | 0.5088 | 3.3938 |
| 0.2667 | −0.6721 | 3.3938 | −0.1948 | 0.4222 | 3.3938 |
| 0.1823 | −0.5934 | 3.3938 | −0.1214 | 0.3358 | 3.3938 |
| 0.0996 | −0.5132 | 3.3938 | −0.0480 | 0.2494 | 3.3938 |
| 0.0190 | −0.4311 | 3.3938 | 0.0256 | 0.1630 | 3.3938 |
| −0.0595 | −0.3471 | 3.3938 | 0.0991 | 0.0767 | 3.3938 |
| −0.1358 | −0.2611 | 3.3938 | 0.1725 | −0.0098 | 3.3938 |
| −0.2101 | −0.1733 | 3.3938 | 0.2450 | −0.0970 | 3.3938 |
| −0.2828 | −0.0840 | 3.3938 | 0.3169 | −0.1847 | 3.3938 |
| −0.3541 | 0.0066 | 3.3938 | 0.3878 | −0.2732 | 3.3938 |
| −0.4237 | 0.0986 | 3.3938 | 0.4581 | −0.3621 | 3.3938 |
| −0.4918 | 0.1922 | 3.3938 | 0.5280 | −0.4514 | 3.3938 |
| −0.5583 | 0.2871 | 3.3938 | 0.5976 | −0.5410 | 3.3938 |
| −0.6208 | 0.3804 | 3.3938 | 0.6649 | −0.6276 | 3.3938 |
| −0.6795 | 0.4721 | 3.3938 | 0.7298 | −0.7112 | 3.3938 |
| −0.7344 | 0.5619 | 3.3938 | 0.7925 | −0.7917 | 3.3938 |
| −0.7854 | 0.6496 | 3.3938 | 0.8532 | −0.8691 | 3.3938 |
| −0.8326 | 0.7348 | 3.3938 | 0.9117 | −0.9432 | 3.3938 |
| −0.8762 | 0.8178 | 3.3938 | 0.9682 | −1.0141 | 3.3938 |
| −0.9161 | 0.8981 | 3.3938 | 1.0231 | −1.0815 | 3.3938 |
| −0.9525 | 0.9758 | 3.3938 | 1.0736 | −1.1428 | 3.3938 |
| −0.9842 | 1.0471 | 3.3938 | 1.1195 | −1.1981 | 3.3938 |
| −1.0110 | 1.1120 | 3.3938 | 1.1606 | −1.2475 | 3.3938 |
| −1.0332 | 1.1703 | 3.3938 | 1.1972 | −1.2908 | 3.3938 |
| −1.0519 | 1.2258 | 3.3938 | 1.2290 | −1.3283 | 3.3938 |
| −1.0662 | 1.2745 | 3.3938 | 1.2559 | −1.3599 | 3.3938 |
| −1.0752 | 1.3125 | 3.3938 | 1.2790 | −1.3869 | 3.3938 |
| −1.0804 | 1.3432 | 3.3938 | 1.2985 | −1.4096 | 3.3938 |
| −1.0822 | 1.3666 | 3.3938 | 1.3145 | −1.4282 | 3.3938 |
| −1.0808 | 1.3841 | 3.3938 | 1.3274 | −1.4430 | 3.3938 |
| −1.0779 | 1.3934 | 3.3938 | 1.3371 | −1.4547 | 3.3938 |
| −1.0745 | 1.3986 | 3.3938 | 1.3409 | −1.4653 | 3.3938 |
| −1.0722 | 1.4007 | 3.3938 | 1.3405 | −1.4748 | 3.3938 |
| −1.0710 | 1.4017 | 3.3938 | 1.3378 | −1.4818 | 3.3938 |
| 1.2961 | −1.5434 | 3.9088 | −1.0500 | 1.3982 | 3.9088 |
| 1.2916 | −1.5470 | 3.9088 | −1.0493 | 1.3985 | 3.9088 |
| 1.2847 | −1.5503 | 3.9088 | −1.0478 | 1.3991 | 3.9088 |
| 1.2751 | −1.5511 | 3.9088 | −1.0449 | 1.3998 | 3.9088 |
| 1.2642 | −1.5473 | 3.9088 | −1.0387 | 1.3995 | 3.9088 |
| 1.2518 | −1.5380 | 3.9088 | −1.0297 | 1.3966 | 3.9088 |
| 1.2357 | −1.5259 | 3.9088 | −1.0148 | 1.3881 | 3.9088 |
| 1.2156 | −1.5106 | 3.9088 | −0.9969 | 1.3742 | 3.9088 |
| 1.1911 | −1.4920 | 3.9088 | −0.9746 | 1.3536 | 3.9088 |
| 1.1621 | −1.4698 | 3.9088 | −0.9482 | 1.3266 | 3.9088 |
| 1.1283 | −1.4438 | 3.9088 | −0.9153 | 1.2903 | 3.9088 |
| 1.0884 | −1.4129 | 3.9088 | −0.8783 | 1.2472 | 3.9088 |
| 1.0424 | −1.3771 | 3.9088 | −0.8397 | 1.2004 | 3.9088 |
| 0.9904 | −1.3364 | 3.9088 | −0.7970 | 1.1474 | 3.9088 |
| 0.9326 | −1.2905 | 3.9088 | −0.7499 | 1.0882 | 3.9088 |
| 0.8693 | −1.2391 | 3.9088 | −0.6981 | 1.0231 | 3.9088 |
| 0.8001 | −1.1828 | 3.9088 | −0.6439 | 0.9549 | 3.9088 |
| 0.7279 | −1.1237 | 3.9088 | −0.5875 | 0.8839 | 3.9088 |
| 0.6533 | −1.0616 | 3.9088 | −0.5285 | 0.8099 | 3.9088 |
| 0.5765 | −0.9964 | 3.9088 | −0.4673 | 0.7330 | 3.9088 |
| 0.4975 | −0.9280 | 3.9088 | −0.4034 | 0.6532 | 3.9088 |
| 0.4166 | −0.8563 | 3.9088 | −0.3370 | 0.5706 | 3.9088 |
| 0.3340 | −0.7809 | 3.9088 | −0.2682 | 0.4853 | 3.9088 |
| 0.2499 | −0.7016 | 3.9088 | −0.1968 | 0.3971 | 3.9088 |
| 0.1673 | −0.6211 | 3.9088 | −0.1251 | 0.3090 | 3.9088 |
| 0.0867 | −0.5389 | 3.9088 | −0.0535 | 0.2210 | 3.9088 |
| 0.0081 | −0.4549 | 3.9088 | 0.0182 | 0.1330 | 3.9088 |
| −0.0683 | −0.3689 | 3.9088 | 0.0901 | 0.0451 | 3.9088 |
| −0.1425 | −0.2812 | 3.9088 | 0.1617 | −0.0429 | 3.9088 |
| −0.2148 | −0.1916 | 3.9088 | 0.2327 | −0.1314 | 3.9088 |

TABLE 4-continued

| SUCTION SIDE | | | PRESSURE SIDE | | |
|---|---|---|---|---|---|
| X | Y | Z | X | Y | Z |
| −0.2854 | −0.1007 | 3.9088 | 0.3028 | −0.2205 | 3.9088 |
| −0.3547 | −0.0086 | 3.9088 | 0.3723 | −0.3104 | 3.9088 |
| −0.4224 | 0.0848 | 3.9088 | 0.4410 | −0.4007 | 3.9088 |
| −0.4885 | 0.1797 | 3.9088 | 0.5093 | −0.4913 | 3.9088 |
| −0.5530 | 0.2759 | 3.9088 | 0.5772 | −0.5821 | 3.9088 |
| −0.6138 | 0.3704 | 3.9088 | 0.6429 | −0.6701 | 3.9088 |
| −0.6707 | 0.4631 | 3.9088 | 0.7062 | −0.7549 | 3.9088 |
| −0.7240 | 0.5538 | 3.9088 | 0.7674 | −0.8367 | 3.9088 |
| −0.7736 | 0.6422 | 3.9088 | 0.8266 | −0.9154 | 3.9088 |
| −0.8193 | 0.7282 | 3.9088 | 0.8836 | −0.9908 | 3.9088 |
| −0.8616 | 0.8117 | 3.9088 | 0.9388 | −1.0628 | 3.9088 |
| −0.9003 | 0.8926 | 3.9088 | 0.9922 | −1.1315 | 3.9088 |
| −0.9357 | 0.9708 | 3.9088 | 1.0416 | −1.1937 | 3.9088 |
| −0.9662 | 1.0425 | 3.9088 | 1.0863 | −1.2500 | 3.9088 |
| −0.9922 | 1.1076 | 3.9088 | 1.1263 | −1.3004 | 3.9088 |
| −1.0137 | 1.1662 | 3.9088 | 1.1619 | −1.3446 | 3.9088 |
| −1.0319 | 1.2218 | 3.9088 | 1.1929 | −1.3827 | 3.9088 |
| −1.0456 | 1.2706 | 3.9088 | 1.2191 | −1.4150 | 3.9088 |
| −1.0544 | 1.3086 | 3.9088 | 1.2417 | −1.4425 | 3.9088 |
| −1.0597 | 1.3394 | 3.9088 | 1.2606 | −1.4656 | 3.9088 |
| −1.0614 | 1.3626 | 3.9088 | 1.2763 | −1.4845 | 3.9088 |
| −1.0602 | 1.3801 | 3.9088 | 1.2889 | −1.4997 | 3.9088 |
| −1.0575 | 1.3895 | 3.9088 | 1.2984 | −1.5114 | 3.9088 |
| −1.0542 | 1.3948 | 3.9088 | 1.3026 | −1.5220 | 3.9088 |
| −1.0520 | 1.3970 | 3.9088 | 1.3023 | −1.5315 | 3.9088 |
| −1.0507 | 1.3978 | 3.9088 | 1.2995 | −1.5386 | 3.9088 |
| 1.2572 | −1.6550 | 4.9389 | −1.0379 | 1.3756 | 4.9389 |
| 1.2526 | −1.6586 | 4.9389 | −1.0371 | 1.3759 | 4.9389 |
| 1.2452 | −1.6613 | 4.9389 | −1.0357 | 1.3764 | 4.9389 |
| 1.2356 | −1.6611 | 4.9389 | −1.0326 | 1.3769 | 4.9389 |
| 1.2253 | −1.6556 | 4.9389 | −1.0265 | 1.3760 | 4.9389 |
| 1.2133 | −1.6458 | 4.9389 | −1.0177 | 1.3722 | 4.9389 |
| 1.1976 | −1.6328 | 4.9389 | −1.0034 | 1.3625 | 4.9389 |
| 1.1781 | −1.6167 | 4.9389 | −0.9864 | 1.3473 | 4.9389 |
| 1.1543 | −1.5970 | 4.9389 | −0.9651 | 1.3252 | 4.9389 |
| 1.1262 | −1.5734 | 4.9389 | −0.9399 | 1.2966 | 4.9389 |
| 1.0933 | −1.5459 | 4.9389 | −0.9083 | 1.2582 | 4.9389 |
| 1.0545 | −1.5131 | 4.9389 | −0.8730 | 1.2132 | 4.9389 |
| 1.0098 | −1.4753 | 4.9389 | −0.8362 | 1.1644 | 4.9389 |
| 0.9593 | −1.4323 | 4.9389 | −0.7951 | 1.1092 | 4.9389 |
| 0.9032 | −1.3839 | 4.9389 | −0.7498 | 1.0477 | 4.9389 |
| 0.8415 | −1.3299 | 4.9389 | −0.6997 | 0.9802 | 4.9389 |
| 0.7742 | −1.2707 | 4.9389 | −0.6474 | 0.9097 | 4.9389 |
| 0.7041 | −1.2085 | 4.9389 | −0.5926 | 0.8362 | 4.9389 |
| 0.6317 | −1.1432 | 4.9389 | −0.5355 | 0.7596 | 4.9389 |
| 0.5569 | −1.0748 | 4.9389 | −0.4760 | 0.6802 | 4.9389 |
| 0.4801 | −1.0032 | 4.9389 | −0.4139 | 0.5978 | 4.9389 |
| 0.4014 | −0.9280 | 4.9389 | −0.3491 | 0.5126 | 4.9389 |
| 0.3210 | −0.8493 | 4.9389 | −0.2820 | 0.4246 | 4.9389 |
| 0.2391 | −0.7667 | 4.9389 | −0.2122 | 0.3337 | 4.9389 |
| 0.1588 | −0.6827 | 4.9389 | −0.1421 | 0.2431 | 4.9389 |
| 0.0802 | −0.5972 | 4.9389 | −0.0719 | 0.1525 | 4.9389 |
| 0.0037 | −0.5099 | 4.9389 | −0.0017 | 0.0619 | 4.9389 |
| −0.0708 | −0.4209 | 4.9389 | 0.0686 | −0.0286 | 4.9389 |
| −0.1432 | −0.3300 | 4.9389 | 0.1389 | −0.1191 | 4.9389 |
| −0.2138 | −0.2377 | 4.9389 | 0.2086 | −0.2100 | 4.9389 |
| −0.2831 | −0.1441 | 4.9389 | 0.2776 | −0.3014 | 4.9389 |
| −0.3510 | −0.0494 | 4.9389 | 0.3459 | −0.3934 | 4.9389 |
| −0.4176 | 0.0464 | 4.9389 | 0.4135 | −0.4859 | 4.9389 |
| −0.4827 | 0.1436 | 4.9389 | 0.4807 | −0.5788 | 4.9389 |
| −0.5461 | 0.2421 | 4.9389 | 0.5476 | −0.6718 | 4.9389 |
| −0.6058 | 0.3387 | 4.9389 | 0.6121 | −0.7617 | 4.9389 |
| −0.6616 | 0.4329 | 4.9389 | 0.6744 | −0.8486 | 4.9389 |
| −0.7138 | 0.5248 | 4.9389 | 0.7347 | −0.9323 | 4.9389 |
| −0.7623 | 0.6143 | 4.9389 | 0.7929 | −1.0127 | 4.9389 |
| −0.8072 | 0.7012 | 4.9389 | 0.8492 | −1.0899 | 4.9389 |
| −0.8486 | 0.7854 | 4.9389 | 0.9035 | −1.1636 | 4.9389 |
| −0.8867 | 0.8671 | 4.9389 | 0.9562 | −1.2340 | 4.9389 |
| −0.9215 | 0.9458 | 4.9389 | 1.0047 | −1.2979 | 4.9389 |
| −0.9517 | 1.0180 | 4.9389 | 1.0487 | −1.3556 | 4.9389 |
| −0.9775 | 1.0836 | 4.9389 | 1.0882 | −1.4071 | 4.9389 |
| −0.9988 | 1.1425 | 4.9389 | 1.1232 | −1.4524 | 4.9389 |
| −1.0169 | 1.1983 | 4.9389 | 1.1538 | −1.4915 | 4.9389 |
| −1.0309 | 1.2473 | 4.9389 | 1.1798 | −1.5246 | 4.9389 |
| −1.0400 | 1.2853 | 4.9389 | 1.2021 | −1.5527 | 4.9389 |
| −1.0456 | 1.3162 | 4.9389 | 1.2208 | −1.5763 | 4.9389 |

TABLE 4-continued

| SUCTION SIDE | | | PRESSURE SIDE | | |
|---|---|---|---|---|---|
| X | Y | Z | X | Y | Z |
| −1.0478 | 1.3396 | 4.9389 | 1.2362 | −1.5958 | 4.9389 |
| −1.0473 | 1.3572 | 4.9389 | 1.2486 | −1.6113 | 4.9389 |
| −1.0450 | 1.3667 | 4.9389 | 1.2581 | −1.6233 | 4.9389 |
| −1.0421 | 1.3721 | 4.9389 | 1.2632 | −1.6335 | 4.9389 |
| −1.0399 | 1.3742 | 4.9389 | 1.2634 | −1.6432 | 4.9389 |
| −1.0385 | 1.3753 | 4.9389 | 1.2607 | −1.6504 | 4.9389 |
| 1.2565 | −1.7035 | 5.4539 | −1.0474 | 1.3598 | 5.4539 |
| 1.2519 | −1.7069 | 5.4539 | −1.0468 | 1.3601 | 5.4539 |
| 1.2445 | −1.7094 | 5.4539 | −1.0452 | 1.3606 | 5.4539 |
| 1.2348 | −1.7087 | 5.4539 | −1.0422 | 1.3609 | 5.4539 |
| 1.2249 | −1.7025 | 5.4539 | −1.0360 | 1.3597 | 5.4539 |
| 1.2129 | −1.6925 | 5.4539 | −1.0273 | 1.3555 | 5.4539 |
| 1.1973 | −1.6793 | 5.4539 | −1.0135 | 1.3450 | 5.4539 |
| 1.1778 | −1.6628 | 5.4539 | −0.9967 | 1.3291 | 5.4539 |
| 1.1541 | −1.6427 | 5.4539 | −0.9760 | 1.3064 | 5.4539 |
| 1.1261 | −1.6189 | 5.4539 | −0.9514 | 1.2767 | 5.4539 |
| 1.0933 | −1.5907 | 5.4539 | −0.9205 | 1.2374 | 5.4539 |
| 1.0547 | −1.5573 | 5.4539 | −0.8859 | 1.1912 | 5.4539 |
| 1.0103 | −1.5186 | 5.4539 | −0.8497 | 1.1413 | 5.4539 |
| 0.9601 | −1.4748 | 5.4539 | −0.8093 | 1.0850 | 5.4539 |
| 0.9043 | −1.4253 | 5.4539 | −0.7646 | 1.0224 | 5.4539 |
| 0.8428 | −1.3704 | 5.4539 | −0.7150 | 0.9536 | 5.4539 |
| 0.7758 | −1.3099 | 5.4539 | −0.6631 | 0.8819 | 5.4539 |
| 0.7060 | −1.2467 | 5.4539 | −0.6087 | 0.8072 | 5.4539 |
| 0.6338 | −1.1804 | 5.4539 | −0.5519 | 0.7296 | 5.4539 |
| 0.5593 | −1.1109 | 5.4539 | −0.4925 | 0.6489 | 5.4539 |
| 0.4827 | −1.0381 | 5.4539 | −0.4306 | 0.5655 | 5.4539 |
| 0.4041 | −0.9619 | 5.4539 | −0.3661 | 0.4792 | 5.4539 |
| 0.3238 | −0.8819 | 5.4539 | −0.2990 | 0.3900 | 5.4539 |
| 0.2419 | −0.7982 | 5.4539 | −0.2291 | 0.2980 | 5.4539 |
| 0.1616 | −0.7130 | 5.4539 | −0.1591 | 0.2062 | 5.4539 |
| 0.0828 | −0.6264 | 5.4539 | −0.0887 | 0.1147 | 5.4539 |
| 0.0062 | −0.5382 | 5.4539 | −0.0182 | 0.0231 | 5.4539 |
| −0.0686 | −0.4481 | 5.4539 | 0.0526 | −0.0681 | 5.4539 |
| −0.1414 | −0.3564 | 5.4539 | 0.1234 | −0.1594 | 5.4539 |
| −0.2125 | −0.2632 | 5.4539 | 0.1938 | −0.2508 | 5.4539 |
| −0.2823 | −0.1688 | 5.4539 | 0.2637 | −0.3429 | 5.4539 |
| −0.3508 | −0.0732 | 5.4539 | 0.3328 | −0.4353 | 5.4539 |
| −0.4178 | 0.0236 | 5.4539 | 0.4013 | −0.5283 | 5.4539 |
| −0.4833 | 0.1217 | 5.4539 | 0.4694 | −0.6216 | 5.4539 |
| −0.5472 | 0.2211 | 5.4539 | 0.5371 | −0.7151 | 5.4539 |
| −0.6072 | 0.3181 | 5.4539 | 0.6026 | −0.8056 | 5.4539 |
| −0.6635 | 0.4128 | 5.4539 | 0.6658 | −0.8928 | 5.4539 |
| −0.7161 | 0.5053 | 5.4539 | 0.7270 | −0.9769 | 5.4539 |
| −0.7650 | 0.5951 | 5.4539 | 0.7860 | −1.0578 | 5.4539 |
| −0.8104 | 0.6825 | 5.4539 | 0.8431 | −1.1353 | 5.4539 |
| −0.8523 | 0.7671 | 5.4539 | 0.8982 | −1.2094 | 5.4539 |
| −0.8909 | 0.8491 | 5.4539 | 0.9515 | −1.2801 | 5.4539 |
| −0.9262 | 0.9281 | 5.4539 | 1.0005 | −1.3444 | 5.4539 |
| −0.9569 | 1.0006 | 5.4539 | 1.0450 | −1.4024 | 5.4539 |
| −0.9831 | 1.0665 | 5.4539 | 1.0850 | −1.4542 | 5.4539 |
| −1.0049 | 1.1256 | 5.4539 | 1.1205 | −1.4998 | 5.4539 |
| −1.0236 | 1.1817 | 5.4539 | 1.1514 | −1.5392 | 5.4539 |
| −1.0381 | 1.2307 | 5.4539 | 1.1777 | −1.5724 | 5.4539 |
| −1.0477 | 1.2689 | 5.4539 | 1.2001 | −1.6009 | 5.4539 |
| −1.0537 | 1.2998 | 5.4539 | 1.2189 | −1.6246 | 5.4539 |
| −1.0564 | 1.3232 | 5.4539 | 1.2345 | −1.6442 | 5.4539 |
| −1.0563 | 1.3409 | 5.4539 | 1.2470 | −1.6599 | 5.4539 |
| −1.0544 | 1.3506 | 5.4539 | 1.2566 | −1.6720 | 5.4539 |
| −1.0516 | 1.3562 | 5.4539 | 1.2623 | −1.6819 | 5.4539 |
| −1.0495 | 1.3585 | 5.4539 | 1.2627 | −1.6915 | 5.4539 |
| −1.0481 | 1.3595 | 5.4539 | 1.2601 | −1.6989 | 5.4539 |
| 1.2545 | −1.7477 | 5.9690 | −1.0576 | 1.3438 | 5.9690 |
| 1.2498 | −1.7512 | 5.9690 | −1.0568 | 1.3441 | 5.9690 |
| 1.2423 | −1.7535 | 5.9690 | −1.0554 | 1.3446 | 5.9690 |
| 1.2326 | −1.7521 | 5.9690 | −1.0522 | 1.3447 | 5.9690 |
| 1.2230 | −1.7453 | 5.9690 | −1.0462 | 1.3432 | 5.9690 |
| 1.2111 | −1.7349 | 5.9690 | −1.0376 | 1.3385 | 5.9690 |
| 1.1956 | −1.7215 | 5.9690 | −1.0239 | 1.3275 | 5.9690 |
| 1.1762 | −1.7046 | 5.9690 | −1.0076 | 1.3110 | 5.9690 |
| 1.1528 | −1.6842 | 5.9690 | −0.9872 | 1.2876 | 5.9690 |
| 1.1249 | −1.6598 | 5.9690 | −0.9631 | 1.2573 | 5.9690 |
| 1.0923 | −1.6311 | 5.9690 | −0.9328 | 1.2171 | 5.9690 |
| 1.0540 | −1.5971 | 5.9690 | −0.8986 | 1.1700 | 5.9690 |
| 1.0098 | −1.5577 | 5.9690 | −0.8628 | 1.1193 | 5.9690 |
| 0.9600 | −1.5130 | 5.9690 | −0.8228 | 1.0622 | 5.9690 |

TABLE 4-continued

| SUCTION SIDE | | | PRESSURE SIDE | | |
|---|---|---|---|---|---|
| X | Y | Z | X | Y | Z |
| 0.9045 | −1.4627 | 5.9690 | −0.7784 | 0.9987 | 5.9690 |
| 0.8433 | −1.4068 | 5.9690 | −0.7292 | 0.9290 | 5.9690 |
| 0.7766 | −1.3454 | 5.9690 | −0.6776 | 0.8563 | 5.9690 |
| 0.7073 | −1.2810 | 5.9690 | −0.6234 | 0.7806 | 5.9690 |
| 0.6354 | −1.2136 | 5.9690 | −0.5667 | 0.7019 | 5.9690 |
| 0.5614 | −1.1429 | 5.9690 | −0.5076 | 0.6204 | 5.9690 |
| 0.4852 | −1.0690 | 5.9690 | −0.4458 | 0.5360 | 5.9690 |
| 0.4069 | −0.9915 | 5.9690 | −0.3813 | 0.4486 | 5.9690 |
| 0.3268 | −0.9104 | 5.9690 | −0.3143 | 0.3584 | 5.9690 |
| 0.2453 | −0.8254 | 5.9690 | −0.2444 | 0.2654 | 5.9690 |
| 0.1649 | −0.7392 | 5.9690 | −0.1743 | 0.1727 | 5.9690 |
| 0.0863 | −0.6517 | 5.9690 | −0.1038 | 0.0802 | 5.9690 |
| 0.0095 | −0.5623 | 5.9690 | −0.0330 | −0.0121 | 5.9690 |
| −0.0653 | −0.4714 | 5.9690 | 0.0380 | −0.1042 | 5.9690 |
| −0.1383 | −0.3788 | 5.9690 | 0.1092 | −0.1961 | 5.9690 |
| −0.2099 | −0.2848 | 5.9690 | 0.1803 | −0.2882 | 5.9690 |
| −0.2801 | −0.1898 | 5.9690 | 0.2507 | −0.3808 | 5.9690 |
| −0.3490 | −0.0935 | 5.9690 | 0.3204 | −0.4739 | 5.9690 |
| −0.4166 | 0.0041 | 5.9690 | 0.3896 | −0.5674 | 5.9690 |
| −0.4824 | 0.1026 | 5.9690 | 0.4583 | −0.6611 | 5.9690 |
| −0.5467 | 0.2023 | 5.9690 | 0.5267 | −0.7551 | 5.9690 |
| −0.6072 | 0.2998 | 5.9690 | 0.5929 | −0.8460 | 5.9690 |
| −0.6639 | 0.3948 | 5.9690 | 0.6568 | −0.9338 | 5.9690 |
| −0.7170 | 0.4875 | 5.9690 | 0.7186 | −1.0182 | 5.9690 |
| −0.7665 | 0.5775 | 5.9690 | 0.7782 | −1.0996 | 5.9690 |
| −0.8126 | 0.6651 | 5.9690 | 0.8358 | −1.1775 | 5.9690 |
| −0.8552 | 0.7499 | 5.9690 | 0.8915 | −1.2520 | 5.9690 |
| −0.8944 | 0.8320 | 5.9690 | 0.9452 | −1.3231 | 5.9690 |
| −0.9305 | 0.9112 | 5.9690 | 0.9946 | −1.3877 | 5.9690 |
| −0.9619 | 0.9837 | 5.9690 | 1.0397 | −1.4461 | 5.9690 |
| −0.9888 | 1.0497 | 5.9690 | 1.0801 | −1.4981 | 5.9690 |
| −1.0112 | 1.1089 | 5.9690 | 1.1160 | −1.5439 | 5.9690 |
| −1.0305 | 1.1650 | 5.9690 | 1.1472 | −1.5835 | 5.9690 |
| −1.0457 | 1.2141 | 5.9690 | 1.1737 | −1.6169 | 5.9690 |
| −1.0559 | 1.2523 | 5.9690 | 1.1963 | −1.6454 | 5.9690 |
| −1.0624 | 1.2833 | 5.9690 | 1.2155 | −1.6693 | 5.9690 |
| −1.0655 | 1.3069 | 5.9690 | 1.2312 | −1.6889 | 5.9690 |
| −1.0658 | 1.3246 | 5.9690 | 1.2439 | −1.7046 | 5.9690 |
| −1.0643 | 1.3343 | 5.9690 | 1.2536 | −1.7167 | 5.9690 |
| −1.0616 | 1.3401 | 5.9690 | 1.2597 | −1.7264 | 5.9690 |
| −1.0596 | 1.3425 | 5.9690 | 1.2605 | −1.7359 | 5.9690 |
| −1.0583 | 1.3434 | 5.9690 | 1.2581 | −1.7432 | 5.9690 |
| 1.2473 | −1.7796 | 6.4840 | −1.0627 | 1.3383 | 6.4840 |
| 1.2425 | −1.7832 | 6.4840 | −1.0620 | 1.3386 | 6.4840 |
| 1.2349 | −1.7853 | 6.4840 | −1.0604 | 1.3391 | 6.4840 |
| 1.2252 | −1.7835 | 6.4840 | −1.0573 | 1.3392 | 6.4840 |
| 1.2158 | −1.7763 | 6.4840 | −1.0512 | 1.3374 | 6.4840 |
| 1.2039 | −1.7658 | 6.4840 | −1.0428 | 1.3323 | 6.4840 |
| 1.1884 | −1.7523 | 6.4840 | −1.0295 | 1.3209 | 6.4840 |
| 1.1691 | −1.7352 | 6.4840 | −1.0134 | 1.3040 | 6.4840 |
| 1.1457 | −1.7145 | 6.4840 | −0.9935 | 1.2800 | 6.4840 |
| 1.1180 | −1.6897 | 6.4840 | −0.9697 | 1.2491 | 6.4840 |
| 1.0856 | −1.6605 | 6.4840 | −0.9400 | 1.2082 | 6.4840 |
| 1.0474 | −1.6261 | 6.4840 | −0.9063 | 1.1604 | 6.4840 |
| 1.0035 | −1.5861 | 6.4840 | −0.8710 | 1.1091 | 6.4840 |
| 0.9540 | −1.5406 | 6.4840 | −0.8315 | 1.0512 | 6.4840 |
| 0.8988 | −1.4895 | 6.4840 | −0.7876 | 0.9868 | 6.4840 |
| 0.8380 | −1.4329 | 6.4840 | −0.7390 | 0.9162 | 6.4840 |
| 0.7716 | −1.3707 | 6.4840 | −0.6880 | 0.8426 | 6.4840 |
| 0.7026 | −1.3054 | 6.4840 | −0.6345 | 0.7659 | 6.4840 |
| 0.6311 | −1.2371 | 6.4840 | −0.5784 | 0.6863 | 6.4840 |
| 0.5575 | −1.1653 | 6.4840 | −0.5197 | 0.6038 | 6.4840 |
| 0.4818 | −1.0902 | 6.4840 | −0.4585 | 0.5183 | 6.4840 |
| 0.4041 | −1.0117 | 6.4840 | −0.3946 | 0.4300 | 6.4840 |
| 0.3246 | −0.9294 | 6.4840 | −0.3280 | 0.3388 | 6.4840 |
| 0.2436 | −0.8432 | 6.4840 | −0.2587 | 0.2447 | 6.4840 |
| 0.1639 | −0.7559 | 6.4840 | −0.1889 | 0.1510 | 6.4840 |
| 0.0858 | −0.6671 | 6.4840 | −0.1188 | 0.0576 | 6.4840 |
| 0.0094 | −0.5767 | 6.4840 | −0.0483 | −0.0356 | 6.4840 |
| −0.0649 | −0.4845 | 6.4840 | 0.0225 | −0.1286 | 6.4840 |
| −0.1376 | −0.3909 | 6.4840 | 0.0935 | −0.2214 | 6.4840 |
| −0.2089 | −0.2960 | 6.4840 | 0.1645 | −0.3142 | 6.4840 |
| −0.2790 | −0.2001 | 6.4840 | 0.2351 | −0.4074 | 6.4840 |
| −0.3478 | −0.1030 | 6.4840 | 0.3049 | −0.5010 | 6.4840 |
| −0.4151 | −0.0049 | 6.4840 | 0.3743 | −0.5950 | 6.4840 |
| −0.4809 | 0.0942 | 6.4840 | 0.4433 | −0.6894 | 6.4840 |

TABLE 4-continued

| SUCTION SIDE | | | PRESSURE SIDE | | |
|---|---|---|---|---|---|
| X | Y | Z | X | Y | Z |
| −0.5451 | 0.1944 | 6.4840 | 0.5121 | −0.7837 | 6.4840 |
| −0.6055 | 0.2923 | 6.4840 | 0.5786 | −0.8750 | 6.4840 |
| −0.6624 | 0.3877 | 6.4840 | 0.6429 | −0.9632 | 6.4840 |
| −0.7157 | 0.4807 | 6.4840 | 0.7050 | −1.0480 | 6.4840 |
| −0.7654 | 0.5709 | 6.4840 | 0.7651 | −1.1296 | 6.4840 |
| −0.8117 | 0.6587 | 6.4840 | 0.8230 | −1.2078 | 6.4840 |
| −0.8546 | 0.7437 | 6.4840 | 0.8790 | −1.2827 | 6.4840 |
| −0.8942 | 0.8259 | 6.4840 | 0.9332 | −1.3540 | 6.4840 |
| −0.9307 | 0.9052 | 6.4840 | 0.9831 | −1.4188 | 6.4840 |
| −0.9626 | 0.9779 | 6.4840 | 1.0287 | −1.4773 | 6.4840 |
| −0.9899 | 1.0438 | 6.4840 | 1.0696 | −1.5293 | 6.4840 |
| −1.0128 | 1.1031 | 6.4840 | 1.1058 | −1.5751 | 6.4840 |
| −1.0329 | 1.1591 | 6.4840 | 1.1374 | −1.6147 | 6.4840 |
| −1.0486 | 1.2084 | 6.4840 | 1.1642 | −1.6481 | 6.4840 |
| −1.0591 | 1.2466 | 6.4840 | 1.1872 | −1.6767 | 6.4840 |
| −1.0662 | 1.2775 | 6.4840 | 1.2066 | −1.7005 | 6.4840 |
| −1.0697 | 1.3010 | 6.4840 | 1.2224 | −1.7202 | 6.4840 |
| −1.0703 | 1.3189 | 6.4840 | 1.2352 | −1.7360 | 6.4840 |
| −1.0691 | 1.3287 | 6.4840 | 1.2450 | −1.7481 | 6.4840 |
| −1.0667 | 1.3345 | 6.4840 | 1.2516 | −1.7576 | 6.4840 |
| −1.0647 | 1.3370 | 6.4840 | 1.2531 | −1.7674 | 6.4840 |
| −1.0633 | 1.3380 | 6.4840 | 1.2509 | −1.7749 | 6.4840 |
| 1.2400 | −1.7905 | 6.7415 | −1.0638 | 1.3430 | 6.7415 |
| 1.2352 | −1.7940 | 6.7415 | −1.0631 | 1.3433 | 6.7415 |
| 1.2277 | −1.7960 | 6.7415 | −1.0615 | 1.3438 | 6.7415 |
| 1.2182 | −1.7942 | 6.7415 | −1.0584 | 1.3438 | 6.7415 |
| 1.2089 | −1.7868 | 6.7415 | −1.0524 | 1.3419 | 6.7415 |
| 1.1969 | −1.7764 | 6.7415 | −1.0441 | 1.3366 | 6.7415 |
| 1.1816 | −1.7626 | 6.7415 | −1.0309 | 1.3251 | 6.7415 |
| 1.1623 | −1.7456 | 6.7415 | −1.0149 | 1.3078 | 6.7415 |
| 1.1389 | −1.7246 | 6.7415 | −0.9953 | 1.2837 | 6.7415 |
| 1.1112 | −1.6997 | 6.7415 | −0.9718 | 1.2524 | 6.7415 |
| 1.0789 | −1.6704 | 6.7415 | −0.9424 | 1.2111 | 6.7415 |
| 1.0408 | −1.6357 | 6.7415 | −0.9092 | 1.1629 | 6.7415 |
| 0.9970 | −1.5954 | 6.7415 | −0.8742 | 1.1112 | 6.7415 |
| 0.9475 | −1.5496 | 6.7415 | −0.8350 | 1.0527 | 6.7415 |
| 0.8924 | −1.4982 | 6.7415 | −0.7916 | 0.9879 | 6.7415 |
| 0.8318 | −1.4412 | 6.7415 | −0.7435 | 0.9167 | 6.7415 |
| 0.7656 | −1.3784 | 6.7415 | −0.6929 | 0.8426 | 6.7415 |
| 0.6968 | −1.3127 | 6.7415 | −0.6398 | 0.7654 | 6.7415 |
| 0.6257 | −1.2438 | 6.7415 | −0.5842 | 0.6852 | 6.7415 |
| 0.5524 | −1.1715 | 6.7415 | −0.5260 | 0.6020 | 6.7415 |
| 0.4770 | −1.0958 | 6.7415 | −0.4653 | 0.5160 | 6.7415 |
| 0.3996 | −1.0166 | 6.7415 | −0.4017 | 0.4270 | 6.7415 |
| 0.3205 | −0.9337 | 6.7415 | −0.3355 | 0.3352 | 6.7415 |
| 0.2398 | −0.8469 | 6.7415 | −0.2666 | 0.2406 | 6.7415 |
| 0.1605 | −0.7588 | 6.7415 | −0.1972 | 0.1463 | 6.7415 |
| 0.0828 | −0.6694 | 6.7415 | −0.1273 | 0.0523 | 6.7415 |
| 0.0070 | −0.5783 | 6.7415 | −0.0572 | −0.0415 | 6.7415 |
| −0.0670 | −0.4855 | 6.7415 | 0.0134 | −0.1349 | 6.7415 |
| −0.1394 | −0.3913 | 6.7415 | 0.0843 | −0.2282 | 6.7415 |
| −0.2103 | −0.2959 | 6.7415 | 0.1552 | −0.3214 | 6.7415 |
| −0.2801 | −0.1996 | 6.7415 | 0.2257 | −0.4149 | 6.7415 |
| −0.3486 | −0.1021 | 6.7415 | 0.2955 | −0.5088 | 6.7415 |
| −0.4157 | −0.0035 | 6.7415 | 0.3649 | −0.6032 | 6.7415 |
| −0.4812 | 0.0960 | 6.7415 | 0.4341 | −0.6977 | 6.7415 |
| −0.5452 | 0.1967 | 6.7415 | 0.5030 | −0.7925 | 6.7415 |
| −0.6055 | 0.2948 | 6.7415 | 0.5696 | −0.8840 | 6.7415 |
| −0.6621 | 0.3906 | 6.7415 | 0.6339 | −0.9723 | 6.7415 |
| −0.7152 | 0.4838 | 6.7415 | 0.6962 | −1.0575 | 6.7415 |
| −0.7649 | 0.5744 | 6.7415 | 0.7563 | −1.1391 | 6.7415 |
| −0.8112 | 0.6624 | 6.7415 | 0.8144 | −1.2176 | 6.7415 |
| −0.8541 | 0.7476 | 6.7415 | 0.8705 | −1.2926 | 6.7415 |
| −0.8938 | 0.8299 | 6.7415 | 0.9248 | −1.3641 | 6.7415 |
| −0.9303 | 0.9094 | 6.7415 | 0.9748 | −1.4290 | 6.7415 |
| −0.9623 | 0.9822 | 6.7415 | 1.0205 | −1.4875 | 6.7415 |
| −0.9897 | 1.0482 | 6.7415 | 1.0614 | −1.5398 | 6.7415 |
| −1.0127 | 1.1075 | 6.7415 | 1.0978 | −1.5857 | 6.7415 |
| −1.0329 | 1.1636 | 6.7415 | 1.1294 | −1.6254 | 6.7415 |
| −1.0488 | 1.2129 | 6.7415 | 1.1563 | −1.6589 | 6.7415 |
| −1.0597 | 1.2511 | 6.7415 | 1.1794 | −1.6875 | 6.7415 |
| −1.0668 | 1.2821 | 6.7415 | 1.1987 | −1.7114 | 6.7415 |
| −1.0704 | 1.3056 | 6.7415 | 1.2146 | −1.7311 | 6.7415 |
| −1.0713 | 1.3234 | 6.7415 | 1.2274 | −1.7469 | 6.7415 |
| −1.0701 | 1.3333 | 6.7415 | 1.2373 | −1.7591 | 6.7415 |
| −1.0678 | 1.3393 | 6.7415 | 1.2441 | −1.7685 | 6.7415 |

TABLE 4-continued

| SUCTION SIDE | | | PRESSURE SIDE | | |
|---|---|---|---|---|---|
| X | Y | Z | X | Y | Z |
| −1.0658 | 1.3417 | 6.7415 | 1.2457 | −1.7782 | 6.7415 |
| −1.0646 | 1.3427 | 6.7415 | 1.2435 | −1.7858 | 6.7415 |
| 1.2246 | −1.8000 | 6.9990 | −1.0635 | 1.3528 | 6.9990 |
| 1.2197 | −1.8035 | 6.9990 | −1.0628 | 1.3531 | 6.9990 |
| 1.2120 | −1.8055 | 6.9990 | −1.0613 | 1.3535 | 6.9990 |
| 1.2024 | −1.8033 | 6.9990 | −1.0581 | 1.3534 | 6.9990 |
| 1.1932 | −1.7957 | 6.9990 | −1.0521 | 1.3514 | 6.9990 |
| 1.1813 | −1.7852 | 6.9990 | −1.0438 | 1.3461 | 6.9990 |
| 1.1661 | −1.7713 | 6.9990 | −1.0308 | 1.3342 | 6.9990 |
| 1.1468 | −1.7541 | 6.9990 | −1.0150 | 1.3169 | 6.9990 |
| 1.1235 | −1.7331 | 6.9990 | −0.9956 | 1.2923 | 6.9990 |
| 1.0959 | −1.7080 | 6.9990 | −0.9725 | 1.2608 | 6.9990 |
| 1.0637 | −1.6786 | 6.9990 | −0.9434 | 1.2190 | 6.9990 |
| 1.0258 | −1.6436 | 6.9990 | −0.9106 | 1.1705 | 6.9990 |
| 0.9823 | −1.6031 | 6.9990 | −0.8761 | 1.1183 | 6.9990 |
| 0.9331 | −1.5570 | 6.9990 | −0.8374 | 1.0594 | 6.9990 |
| 0.8783 | −1.5051 | 6.9990 | −0.7945 | 0.9940 | 6.9990 |
| 0.8180 | −1.4475 | 6.9990 | −0.7470 | 0.9223 | 6.9990 |
| 0.7523 | −1.3842 | 6.9990 | −0.6970 | 0.8475 | 6.9990 |
| 0.6841 | −1.3178 | 6.9990 | −0.6444 | 0.7697 | 6.9990 |
| 0.6137 | −1.2482 | 6.9990 | −0.5895 | 0.6890 | 6.9990 |
| 0.5410 | −1.1751 | 6.9990 | −0.5319 | 0.6052 | 6.9990 |
| 0.4663 | −1.0985 | 6.9990 | −0.4717 | 0.5185 | 6.9990 |
| 0.3898 | −1.0184 | 6.9990 | −0.4087 | 0.4288 | 6.9990 |
| 0.3114 | −0.9346 | 6.9990 | −0.3432 | 0.3364 | 6.9990 |
| 0.2316 | −0.8468 | 6.9990 | −0.2748 | 0.2411 | 6.9990 |
| 0.1532 | −0.7578 | 6.9990 | −0.2060 | 0.1461 | 6.9990 |
| 0.0763 | −0.6673 | 6.9990 | −0.1368 | 0.0514 | 6.9990 |
| 0.0014 | −0.5752 | 6.9990 | −0.0671 | −0.0429 | 6.9990 |
| −0.0719 | −0.4817 | 6.9990 | 0.0028 | −0.1370 | 6.9990 |
| −0.1436 | −0.3867 | 6.9990 | 0.0732 | −0.2309 | 6.9990 |
| −0.2140 | −0.2906 | 6.9990 | 0.1436 | −0.3247 | 6.9990 |
| −0.2833 | −0.9134 | 6.9990 | 0.2137 | −0.4187 | 6.9990 |
| −0.3512 | −0.0954 | 6.9990 | 0.2834 | −0.5131 | 6.9990 |
| −0.4177 | 0.0036 | 6.9990 | 0.3525 | −0.6078 | 6.9990 |
| −0.4827 | 0.1036 | 6.9990 | 0.4212 | −0.7029 | 6.9990 |
| −0.5461 | 0.2045 | 6.9990 | 0.4898 | −0.7980 | 6.9990 |
| −0.6060 | 0.3031 | 6.9990 | 0.5561 | −0.8900 | 6.9990 |
| −0.6622 | 0.3992 | 6.9990 | 0.6202 | −0.9787 | 6.9990 |
| −0.7150 | 0.4926 | 6.9990 | 0.6821 | −1.0642 | 6.9990 |
| −0.7645 | 0.5834 | 6.9990 | 0.7420 | −1.1463 | 6.9990 |
| −0.8105 | 0.6716 | 6.9990 | 0.7998 | −1.2250 | 6.9990 |
| −0.8533 | 0.7569 | 6.9990 | 0.8558 | −1.3003 | 6.9990 |
| −0.8927 | 0.8393 | 6.9990 | 0.9099 | −1.3721 | 6.9990 |
| −0.9293 | 0.9189 | 6.9990 | 0.9598 | −1.4374 | 6.9990 |
| −0.9611 | 0.9918 | 6.9990 | 1.0051 | −1.4961 | 6.9990 |
| −0.9886 | 1.0579 | 6.9990 | 1.0459 | −1.5486 | 6.9990 |
| −1.0017 | 1.1172 | 6.9990 | 1.0822 | −1.5947 | 6.9990 |
| −1.0319 | 1.1733 | 6.9990 | 1.1138 | −1.6345 | 6.9990 |
| −1.0479 | 1.2225 | 6.9990 | 1.1406 | −1.6681 | 6.9990 |
| −1.0588 | 1.2607 | 6.9990 | 1.1635 | −1.6968 | 6.9990 |
| −1.0660 | 1.2917 | 6.9990 | 1.1829 | −1.7209 | 6.9990 |
| −1.0699 | 1.3153 | 6.9990 | 1.1988 | −1.7407 | 6.9990 |
| −1.0709 | 1.3331 | 6.9990 | 1.2116 | −1.7565 | 6.9990 |
| −1.0697 | 1.3430 | 6.9990 | 1.2216 | −1.7686 | 6.9990 |
| −1.6075 | 1.3489 | 6.9990 | 1.2285 | −1.7780 | 6.9990 |
| −1.0655 | 1.3514 | 6.9990 | 1.2302 | −1.7877 | 6.9990 |
| −1.0643 | 1.3524 | 6.9990 | 1.2280 | −1.7952 | 6.9990 |
| 1.2010 | −1.8085 | 7.2566 | −1.0536 | 1.3759 | 7.2566 |
| 1.1962 | −1.8120 | 7.2566 | −1.0529 | 1.3762 | 7.2566 |
| 1.1885 | −1.8140 | 7.2566 | −1.0513 | 1.3765 | 7.2566 |
| 1.1789 | −1.8115 | 7.2566 | −1.0481 | 1.3764 | 7.2566 |
| 1.1697 | −1.8040 | 7.2566 | −1.0422 | 1.3743 | 7.2566 |
| 1.1579 | −1.7934 | 7.2566 | −1.0340 | 1.3688 | 7.2566 |
| 1.1424 | −1.7796 | 7.2566 | −1.0211 | 1.3566 | 7.2566 |
| 1.1232 | −1.7623 | 7.2566 | −1.0057 | 1.3388 | 7.2566 |
| 1.0999 | −1.7413 | 7.2566 | −0.9868 | 1.3140 | 7.2566 |
| 1.0722 | −1.7161 | 7.2566 | −0.9643 | 1.2820 | 7.2566 |
| 1.0401 | −1.6865 | 7.2566 | −0.9360 | 1.2396 | 7.2566 |
| 1.0022 | −1.6513 | 7.2566 | −0.9040 | 1.1902 | 7.2566 |
| 0.9586 | −1.6106 | 7.2566 | −0.8704 | 1.1374 | 7.2566 |
| 0.9095 | −1.5642 | 7.2566 | −0.8328 | 1.0777 | 7.2566 |
| 0.8549 | −1.5119 | 7.2566 | −0.7911 | 1.0114 | 7.2566 |
| 0.7948 | −1.4539 | 7.2566 | −0.7448 | 0.9386 | 7.2566 |
| 0.7295 | −1.3899 | 7.2566 | −0.6961 | 0.8628 | 7.2566 |
| 0.6618 | −1.3228 | 7.2566 | −0.6449 | 0.7839 | 7.2566 |

TABLE 4-continued

| SUCTION SIDE | | | PRESSURE SIDE | | |
|---|---|---|---|---|---|
| X | Y | Z | X | Y | Z |
| 0.5920 | −1.2523 | 7.2566 | −0.5912 | 0.7019 | 7.2566 |
| 0.5200 | −1.1784 | 7.2566 | −0.5351 | 0.6170 | 7.2566 |
| 0.4462 | −1.1008 | 7.2566 | −0.4763 | 0.5291 | 7.2566 |
| 0.3706 | −1.0196 | 7.2566 | −0.4149 | 0.4383 | 7.2566 |
| 0.2934 | −0.9344 | 7.2566 | −0.3508 | 0.3445 | 7.2566 |
| 0.2150 | −0.8452 | 7.2566 | −0.2839 | 0.2480 | 7.2566 |
| 0.1380 | −0.7547 | 7.2566 | −0.2166 | 0.1517 | 7.2566 |
| 0.0627 | −0.6627 | 7.2566 | −0.1487 | 0.0558 | 7.2566 |
| −0.0107 | −0.5690 | 7.2566 | −0.0804 | −0.0397 | 7.2566 |
| −0.0824 | −0.4741 | 7.2566 | −0.0116 | −0.1350 | 7.2566 |
| −0.1527 | −0.3777 | 7.2566 | 0.0574 | −0.2301 | 7.2566 |
| −0.2218 | −0.2803 | 7.2566 | 0.1267 | −0.3249 | 7.2566 |
| −0.2897 | −0.1820 | 7.2566 | 0.1959 | −0.4199 | 7.2566 |
| −0.3562 | −0.0828 | 7.2566 | 0.2648 | −0.5151 | 7.2566 |
| −0.4213 | 0.0173 | 7.2566 | 0.3332 | −0.6106 | 7.2566 |
| −0.4849 | 0.1183 | 7.2566 | 0.4012 | −0.7064 | 7.2566 |
| −0.5470 | 0.2203 | 7.2566 | 0.4691 | −0.8023 | 7.2566 |
| −0.6056 | 0.3199 | 7.2566 | 0.5348 | −0.8949 | 7.2566 |
| −0.6607 | 0.4168 | 7.2566 | 0.5984 | −0.9843 | 7.2566 |
| −0.7123 | 0.5111 | 7.2566 | 0.6599 | −1.0702 | 7.2566 |
| −0.7607 | 0.6027 | 7.2566 | 0.7195 | −1.1529 | 7.2566 |
| −0.8058 | 0.6914 | 7.2566 | 0.7770 | −1.2320 | 7.2566 |
| −0.8477 | 0.7773 | 7.2566 | 0.8327 | −1.3077 | 7.2566 |
| −0.8865 | 0.8603 | 7.2566 | 0.8867 | −1.3799 | 7.2566 |
| −0.9222 | 0.9403 | 7.2566 | 0.9363 | −1.4454 | 7.2566 |
| −0.9535 | 1.0136 | 7.2566 | 0.9815 | −1.5045 | 7.2566 |
| −0.9804 | 1.0800 | 7.2566 | 1.0224 | −1.5572 | 7.2566 |
| −1.0031 | 1.1396 | 7.2566 | 1.0586 | −1.6034 | 7.2566 |
| −1.0229 | 1.1960 | 7.2566 | 1.0902 | −1.6433 | 7.2566 |
| −1.0386 | 1.2453 | 7.2566 | 1.1170 | −1.6770 | 7.2566 |
| −1.0494 | 1.2837 | 7.2566 | 1.1401 | −1.7057 | 7.2566 |
| −1.0564 | 1.3148 | 7.2566 | 1.1595 | −1.7298 | 7.2566 |
| −1.0601 | 1.3383 | 7.2566 | 1.1755 | −1.7496 | 7.2566 |
| −1.0609 | 1.3562 | 7.2566 | 1.1884 | −1.7654 | 7.2566 |
| −1.0598 | 1.3661 | 7.2566 | 1.1982 | −1.7775 | 7.2566 |
| −1.0576 | 1.3720 | 7.2566 | 1.2050 | −1.7869 | 7.2566 |
| −1.0556 | 1.3746 | 7.2566 | 1.2067 | −1.7965 | 7.2566 |
| −1.0543 | 1.3755 | 7.2566 | 1.2045 | −1.8038 | 7.2566 |
| 1.1695 | −1.8155 | 7.5142 | −1.0289 | 1.4168 | 7.5142 |
| 1.1646 | −1.8191 | 7.5142 | −1.0281 | 1.4171 | 7.5142 |
| 1.1568 | −1.8211 | 7.5142 | −1.0266 | 1.4174 | 7.5142 |
| 1.1473 | −1.8186 | 7.5142 | −1.0234 | 1.4171 | 7.5142 |
| 1.1381 | −1.8109 | 7.5142 | −1.0176 | 1.4147 | 7.5142 |
| 1.1263 | −1.8003 | 7.5142 | −1.0097 | 1.4088 | 7.5142 |
| 1.1108 | −1.7864 | 7.5142 | −0.9972 | 1.3961 | 7.5142 |
| 1.0915 | −1.7691 | 7.5142 | −0.9826 | 1.3777 | 7.5142 |
| 1.0681 | −1.7479 | 7.5142 | −0.9645 | 1.3520 | 7.5142 |
| 1.0405 | −1.7226 | 7.5142 | −0.9432 | 1.3192 | 7.5142 |
| 1.0083 | −1.6928 | 7.5142 | −0.9165 | 1.2756 | 7.5142 |
| 0.9705 | −1.6574 | 7.5142 | −0.8862 | 1.2251 | 7.5142 |
| 0.9271 | −1.6162 | 7.5142 | −0.8545 | 1.1709 | 7.5142 |
| 0.8781 | −1.5694 | 7.5142 | −0.8190 | 1.1098 | 7.5142 |
| 0.8237 | −1.5167 | 7.5142 | −0.7795 | 1.0420 | 7.5142 |
| 0.7639 | −1.4580 | 7.5142 | −0.7357 | 0.9675 | 7.5142 |
| 0.6990 | −1.3933 | 7.5142 | −0.6895 | 0.8900 | 7.5142 |
| 0.6318 | −1.3252 | 7.5142 | −0.6408 | 0.8094 | 7.5142 |
| 0.5626 | −1.2538 | 7.5142 | −0.5897 | 0.7256 | 7.5142 |
| 0.4913 | −1.1788 | 7.5142 | −0.5361 | 0.6389 | 7.5142 |
| 0.4184 | −1.1001 | 7.5142 | −0.4798 | 0.5492 | 7.5142 |
| 0.3438 | −1.0176 | 7.5142 | −0.4210 | 0.4565 | 7.5142 |
| 0.2679 | −0.9310 | 7.5142 | −0.3593 | 0.3609 | 7.5142 |
| 0.1908 | −0.8402 | 7.5142 | −0.2949 | 0.2624 | 7.5142 |
| 0.1155 | −0.7478 | 7.5142 | −0.2299 | 0.1643 | 7.5142 |
| 0.0420 | −0.6539 | 7.5142 | −0.1642 | 0.0667 | 7.5142 |
| −0.0295 | −0.5584 | 7.5142 | −0.0980 | −0.0305 | 7.5142 |
| −0.0993 | −0.4615 | 7.5142 | −0.0312 | −0.1274 | 7.5142 |
| −0.1677 | −0.3633 | 7.5142 | 0.0361 | −0.2240 | 7.5142 |
| −0.2348 | −0.2641 | 7.5142 | 0.1039 | −0.3202 | 7.5142 |
| −0.3005 | −0.1640 | 7.5142 | 0.1718 | −0.4164 | 7.5142 |
| −0.3648 | −0.0629 | 7.5142 | 0.2397 | −0.5126 | 7.5142 |
| −0.4277 | 0.0390 | 7.5142 | 0.3072 | −0.6089 | 7.5142 |
| −0.4889 | 0.1419 | 7.5142 | 0.3745 | −0.7056 | 7.5142 |
| −0.5487 | 0.2458 | 7.5142 | 0.4417 | −0.8023 | 7.5142 |
| −0.6049 | 0.3470 | 7.5142 | 0.5067 | −0.8957 | 7.5142 |
| −0.6576 | 0.4456 | 7.5142 | 0.5697 | −0.9857 | 7.5142 |
| −0.7071 | 0.5414 | 7.5142 | 0.6307 | −1.0723 | 7.5142 |

TABLE 4-continued

| SUCTION SIDE | | | PRESSURE SIDE | | |
|---|---|---|---|---|---|
| X | Y | Z | X | Y | Z |
| −0.7532 | 0.6344 | 7.5142 | 0.6897 | −1.1555 | 7.5142 |
| −0.7962 | 0.7246 | 7.5142 | 0.7469 | −1.2353 | 7.5142 |
| −0.8360 | 0.8118 | 7.5142 | 0.8022 | −1.3115 | 7.5142 |
| −0.8727 | 0.8960 | 7.5142 | 0.8557 | −1.3842 | 7.5142 |
| −0.9067 | 0.9770 | 7.5142 | 0.9050 | −1.4503 | 7.5142 |
| −0.9363 | 1.0512 | 7.5142 | 0.9499 | −1.5096 | 7.5142 |
| −0.9617 | 1.1184 | 7.5142 | 0.9906 | −1.5625 | 7.5142 |
| −0.9831 | 1.1787 | 7.5142 | 1.0268 | −1.6090 | 7.5142 |
| −1.0016 | 1.2356 | 7.5142 | 1.0583 | −1.6491 | 7.5142 |
| −1.0164 | 1.2854 | 7.5142 | 1.0850 | −1.6831 | 7.5142 |
| −1.0265 | 1.3241 | 7.5142 | 1.1080 | −1.7119 | 7.5142 |
| −1.0329 | 1.3554 | 7.5142 | 1.1274 | −1.7360 | 7.5142 |
| −1.0360 | 1.3792 | 7.5142 | 1.1434 | −1.7559 | 7.5142 |
| −1.0365 | 1.3972 | 7.5142 | 1.1562 | −1.7719 | 7.5142 |
| −1.0353 | 1.4070 | 7.5142 | 1.1661 | −1.7840 | 7.5142 |
| −1.0330 | 1.4130 | 7.5142 | 1.1731 | −1.7934 | 7.5142 |
| −1.0310 | 1.4154 | 7.5142 | 1.1751 | −1.8031 | 7.5142 |
| −1.0296 | 1.4163 | 7.5142 | 1.1730 | −1.8107 | 7.5142 |
| 1.1428 | −1.8201 | 7.6670 | −1.0083 | 1.4472 | 7.6670 |
| 1.1380 | −1.8237 | 7.6670 | −1.0075 | 1.4474 | 7.6670 |
| 1.1302 | −1.8257 | 7.6670 | −1.0059 | 1.4478 | 7.6670 |
| 1.1206 | −1.8231 | 7.6670 | −1.0028 | 1.4474 | 7.6670 |
| 1.1114 | −1.8154 | 7.6670 | −0.9970 | 1.4447 | 7.6670 |
| 1.0996 | −1.8047 | 7.6670 | −0.9894 | 1.4385 | 7.6670 |
| 1.0841 | −1.7909 | 7.6670 | −0.9773 | 1.4254 | 7.6670 |
| 1.0648 | −1.7734 | 7.6670 | −0.9633 | 1.4066 | 7.6670 |
| 1.0415 | −1.7522 | 7.6670 | −0.9460 | 1.3803 | 7.6670 |
| 1.0139 | −1.7267 | 7.6670 | −0.9257 | 1.3467 | 7.6670 |
| 0.9817 | −1.6969 | 7.6670 | −0.9004 | 1.3024 | 7.6670 |
| 0.9439 | −1.6613 | 7.6670 | −0.8716 | 1.2510 | 7.6670 |
| 0.9006 | −1.6200 | 7.6670 | −0.8413 | 1.1959 | 7.6670 |
| 0.8518 | −1.5728 | 7.6670 | −0.8074 | 1.1338 | 7.6670 |
| 0.7977 | −1.5196 | 7.6670 | −0.7697 | 1.0649 | 7.6670 |
| 0.7383 | −1.4604 | 7.6670 | −0.7277 | 0.9893 | 7.6670 |
| 0.6739 | −1.3951 | 7.6670 | −0.6834 | 0.9106 | 7.6670 |
| 0.6073 | −1.3264 | 7.6670 | −0.6366 | 0.8288 | 7.6670 |
| 0.5388 | −1.2540 | 7.6670 | −0.5874 | 0.7438 | 7.6670 |
| 0.4684 | −1.1781 | 7.6670 | −0.5355 | 0.6560 | 7.6670 |
| 0.3965 | −1.0983 | 7.6670 | −0.4812 | 0.5650 | 7.6670 |
| 0.3230 | −1.0145 | 7.6670 | −0.4240 | 0.4711 | 7.6670 |
| 0.2482 | −0.9268 | 7.6670 | −0.3642 | 0.3743 | 7.6670 |
| 0.1724 | −0.8345 | 7.6670 | −0.3016 | 0.2746 | 7.6670 |
| 0.0984 | −0.7408 | 7.6670 | −0.2382 | 0.1754 | 7.6670 |
| 0.0265 | −0.6455 | 7.6670 | −0.1741 | 0.0767 | 7.6670 |
| −0.0437 | −0.5486 | 7.6670 | −0.1094 | −0.0218 | 7.6670 |
| −0.1122 | −0.4503 | 7.6670 | −0.0440 | −0.1197 | 7.6670 |
| −0.1792 | −0.3508 | 7.6670 | 0.0220 | −0.2173 | 7.6670 |
| −0.2448 | −0.2505 | 7.6670 | 0.0886 | −0.3146 | 7.6670 |
| −0.3090 | −0.1492 | 7.6670 | 0.1554 | −0.4115 | 7.6670 |
| −0.3717 | −0.0470 | 7.6670 | 0.2223 | −0.5085 | 7.6670 |
| −0.4328 | 0.0561 | 7.6670 | 0.2890 | −0.6057 | 7.6670 |
| −0.4924 | 0.1603 | 7.6670 | 0.3555 | −0.7030 | 7.6670 |
| −0.5504 | 0.2654 | 7.6670 | 0.4218 | −0.8005 | 7.6670 |
| −0.6048 | 0.3678 | 7.6670 | 0.4859 | −0.8946 | 7.6670 |
| −0.6557 | 0.4675 | 7.6670 | 0.5480 | −0.9853 | 7.6670 |
| −0.7033 | 0.5643 | 7.6670 | 0.6081 | −1.0727 | 7.6670 |
| −0.7477 | 0.6584 | 7.6670 | 0.6663 | −1.1566 | 7.6670 |
| −0.7889 | 0.7495 | 7.6670 | 0.7228 | −1.2369 | 7.6670 |
| −0.8269 | 0.8377 | 7.6670 | 0.7774 | −1.3138 | 7.6670 |
| −0.8621 | 0.9227 | 7.6670 | 0.8304 | −1.3870 | 7.6670 |
| −0.8943 | 1.0045 | 7.6670 | 0.8793 | −1.4534 | 7.6670 |
| −0.9225 | 1.0793 | 7.6670 | 0.9242 | −1.5131 | 7.6670 |
| −0.9467 | 1.1472 | 7.6670 | 0.9646 | −1.5662 | 7.6670 |
| −0.9668 | 1.2079 | 7.6670 | 1.0005 | −1.6129 | 7.6670 |
| −0.9843 | 1.2623 | 7.6670 | 1.0319 | −1.6532 | 7.6670 |
| −0.9982 | 1.3155 | 7.6670 | 1.0586 | −1.6871 | 7.6670 |
| −1.0074 | 1.3543 | 7.6670 | 1.0815 | −1.7161 | 7.6670 |
| −1.0133 | 1.3859 | 7.6670 | 1.1008 | −1.7403 | 7.6670 |
| −1.0160 | 1.4097 | 7.6670 | 1.1168 | −1.7603 | 7.6670 |
| −1.0162 | 1.4276 | 7.6670 | 1.1295 | −1.7763 | 7.6670 |
| −1.0147 | 1.4376 | 7.6670 | 1.1394 | −1.7885 | 7.6670 |
| −1.0124 | 1.4435 | 7.6670 | 1.1464 | −1.7980 | 7.6670 |
| −1.0103 | 1.4460 | 7.6670 | 1.1484 | −1.8077 | 7.6670 |
| −1.0091 | 1.4469 | 7.6670 | 1.1463 | −1.8153 | 7.6670 |
| 1.1146 | −1.8248 | 7.8197 | −0.9792 | 1.4846 | 7.8197 |
| 1.1097 | −1.8284 | 7.8197 | −0.9785 | 1.4849 | 7.8197 |

TABLE 4-continued

| SUCTION SIDE | | | PRESSURE SIDE | | |
|---|---|---|---|---|---|
| X | Y | Z | X | Y | Z |
| 1.1020 | −1.8304 | 7.8197 | −0.9769 | 1.4851 | 7.8197 |
| 1.0923 | −1.8278 | 7.8197 | −0.9738 | 1.4846 | 7.8197 |
| 1.0832 | −1.8200 | 7.8197 | −0.9680 | 1.4818 | 7.8197 |
| 1.0713 | −1.8093 | 7.8197 | −0.9606 | 1.4753 | 7.8197 |
| 1.0558 | −1.7954 | 7.8197 | −0.9491 | 1.4618 | 7.8197 |
| 1.0364 | −1.7779 | 7.8197 | −0.9357 | 1.4423 | 7.8197 |
| 1.0131 | −1.7567 | 7.8197 | −0.9193 | 1.4155 | 7.8197 |
| 0.9854 | −1.7311 | 7.8197 | −0.9003 | 1.3810 | 7.8197 |
| 0.9533 | −1.7011 | 7.8197 | −0.8765 | 1.3358 | 7.8197 |
| 0.9154 | −1.6654 | 7.8197 | −0.8496 | 1.2832 | 7.8197 |
| 0.8719 | −1.6239 | 7.8197 | −0.8211 | 1.2271 | 7.8197 |
| 0.8232 | −1.5765 | 7.8197 | −0.7892 | 1.1639 | 7.8197 |
| 0.7693 | −1.5228 | 7.8197 | −0.7536 | 1.0937 | 7.8197 |
| 0.7100 | −1.4631 | 7.8197 | −0.7139 | 1.0167 | 7.8197 |
| 0.6459 | −1.3973 | 7.8197 | −0.6718 | 0.9367 | 7.8197 |
| 0.5797 | −1.3278 | 7.8197 | −0.6272 | 0.8535 | 7.8197 |
| 0.5119 | −1.2546 | 7.8197 | −0.5803 | 0.7672 | 7.8197 |
| 0.4424 | −1.1777 | 7.8197 | −0.5306 | 0.6779 | 7.8197 |
| 0.3714 | −1.0967 | 7.8197 | −0.4785 | 0.5854 | 7.8197 |
| 0.2992 | −1.0116 | 7.8197 | −0.4236 | 0.4901 | 7.8197 |
| 0.2258 | −0.9223 | 7.8197 | −0.3660 | 0.3918 | 7.8197 |
| 0.1516 | −0.8284 | 7.8197 | −0.3056 | 0.2905 | 7.8197 |
| 0.0795 | −0.7329 | 7.8197 | −0.2443 | 0.1898 | 7.8197 |
| 0.0093 | −0.6359 | 7.8197 | −0.1823 | 0.0895 | 7.8197 |
| −0.0589 | −0.5371 | 7.8197 | −0.1195 | −0.0104 | 7.8197 |
| −0.1256 | −0.4371 | 7.8197 | −0.0559 | −0.1097 | 7.8197 |
| −0.1907 | −0.3360 | 7.8197 | 0.0083 | −0.2087 | 7.8197 |
| −0.2545 | −0.2342 | 7.8197 | 0.0732 | −0.3072 | 7.8197 |
| −0.3167 | −0.1313 | 7.8197 | 0.1385 | −0.4055 | 7.8197 |
| −0.3773 | −0.0276 | 7.8197 | 0.2042 | −0.5036 | 7.8197 |
| −0.4364 | 0.0771 | 7.8197 | 0.2697 | −0.6018 | 7.8197 |
| −0.4939 | 0.1826 | 7.8197 | 0.3349 | −0.7002 | 7.8197 |
| −0.5497 | 0.2892 | 7.8197 | 0.4000 | −0.7985 | 7.8197 |
| −0.6019 | 0.3930 | 7.8197 | 0.4631 | −0.8936 | 7.8197 |
| −0.6506 | 0.4941 | 7.8197 | 0.5241 | −0.9853 | 7.8197 |
| −0.6961 | 0.5923 | 7.8197 | 0.5832 | −1.0735 | 7.8197 |
| −0.7384 | 0.6876 | 7.8197 | 0.6407 | −1.1581 | 7.8197 |
| −0.7773 | 0.7798 | 7.8197 | 0.6964 | −1.2391 | 7.8197 |
| −0.8133 | 0.8691 | 7.8197 | 0.7504 | −1.3165 | 7.8197 |
| −0.8463 | 0.9551 | 7.8197 | 0.8029 | −1.3903 | 7.8197 |
| −0.8766 | 1.0380 | 7.8197 | 0.8516 | −1.4570 | 7.8197 |
| −0.9029 | 1.1138 | 7.8197 | 0.8962 | −1.5170 | 7.8197 |
| −0.9253 | 1.1824 | 7.8197 | 0.9366 | −1.5703 | 7.8197 |
| −0.9438 | 1.2439 | 7.8197 | 0.9725 | −1.6171 | 7.8197 |
| −0.9599 | 1.3018 | 7.8197 | 1.0037 | −1.6576 | 7.8197 |
| −0.9724 | 1.3524 | 7.8197 | 1.0304 | −1.6916 | 7.8197 |
| −0.9807 | 1.3916 | 7.8197 | 1.0534 | −1.7207 | 7.8197 |
| −0.9857 | 1.4232 | 7.8197 | 1.0727 | −1.7449 | 7.8197 |
| −0.9879 | 1.4472 | 7.8197 | 1.0887 | −1.7649 | 7.8197 |
| −0.9876 | 1.4652 | 7.8197 | 1.1014 | −1.7810 | 7.8197 |
| −0.9859 | 1.4751 | 7.8197 | 1.1112 | −1.7933 | 7.8197 |
| −0.9834 | 1.4811 | 7.8197 | 1.1182 | −1.8028 | 7.8197 |
| −0.9813 | 1.4835 | 7.8197 | 1.1201 | −1.8124 | 7.8197 |
| −0.9800 | 1.4843 | 7.8197 | 1.1180 | −1.8199 | 7.8197 |
| 1.0760 | −1.8312 | 8.0292 | −0.9214 | 1.5497 | 8.0292 |
| 1.0711 | −1.8349 | 8.0292 | −0.9207 | 1.5500 | 8.0292 |
| 1.0633 | −1.8369 | 8.0292 | −0.9191 | 1.5501 | 8.0292 |
| 1.0536 | −1.8342 | 8.0292 | −0.9160 | 1.5494 | 8.0292 |
| 1.0444 | −1.8264 | 8.0292 | −0.9104 | 1.5461 | 8.0292 |
| 1.0323 | −1.8156 | 8.0292 | −0.9034 | 1.5392 | 8.0292 |
| 1.0168 | −1.8017 | 8.0292 | −0.8927 | 1.5248 | 8.0292 |
| 0.9974 | −1.7841 | 8.0292 | −0.8806 | 1.5045 | 8.0292 |
| 0.9739 | −1.7626 | 8.0292 | −0.8660 | 1.4765 | 8.0292 |
| 0.9461 | −1.7369 | 8.0292 | −0.8494 | 1.4407 | 8.0292 |
| 0.9138 | −1.7066 | 8.0292 | −0.8288 | 1.3936 | 8.0292 |
| 0.8758 | −1.6707 | 8.0292 | −0.8053 | 1.3392 | 8.0292 |
| 0.8321 | −1.6289 | 8.0292 | −0.7804 | 1.2811 | 8.0292 |
| 0.7833 | −1.5808 | 8.0292 | −0.7523 | 1.2158 | 8.0292 |
| 0.7294 | −1.5266 | 8.0292 | −0.7207 | 1.1433 | 8.0292 |
| 0.6703 | −1.4661 | 8.0292 | −0.6854 | 1.0640 | 8.0292 |
| 0.6063 | −1.3993 | 8.0292 | −0.6476 | 0.9814 | 8.0292 |
| 0.5407 | −1.3287 | 8.0292 | −0.6073 | 0.8957 | 8.0292 |
| 0.4735 | −1.2542 | 8.0292 | −0.5644 | 0.8069 | 8.0292 |
| 0.4051 | −1.1756 | 8.0292 | −0.5190 | 0.7149 | 8.0292 |
| 0.3352 | −1.0930 | 8.0292 | −0.4708 | 0.6200 | 8.0292 |
| 0.2645 | −1.0059 | 8.0292 | −0.4199 | 0.5220 | 8.0292 |

TABLE 4-continued

| SUCTION SIDE | | | PRESSURE SIDE | | |
|---|---|---|---|---|---|
| X | Y | Z | X | Y | Z |
| 0.1930 | −0.9145 | 8.0292 | −0.3662 | 0.4211 | 8.0292 |
| 0.1211 | −0.8182 | 8.0292 | −0.3097 | 0.3172 | 8.0292 |
| 0.0513 | −0.7202 | 8.0292 | −0.2520 | 0.2138 | 8.0292 |
| −0.0161 | −0.6204 | 8.0292 | −0.1933 | 0.1110 | 8.0292 |
| −0.0816 | −0.5189 | 8.0292 | −0.1335 | 0.0088 | 8.0292 |
| −0.1454 | −0.4163 | 8.0292 | −0.0728 | −0.0930 | 8.0292 |
| −0.2078 | −0.3126 | 8.0292 | −0.0113 | −0.1943 | 8.0292 |
| −0.2684 | −0.2081 | 8.0292 | 0.0511 | −0.2949 | 8.0292 |
| −0.3275 | −0.1026 | 8.0292 | 0.1142 | −0.3951 | 8.0292 |
| −0.3846 | 0.0038 | 8.0292 | 0.1779 | −0.4950 | 8.0292 |
| −0.4402 | 0.1111 | 8.0292 | 0.2417 | −0.5948 | 8.0292 |
| −0.4941 | 0.2194 | 8.0292 | 0.3054 | −0.6947 | 8.0292 |
| −0.5459 | 0.3286 | 8.0292 | 0.3688 | −0.7946 | 8.0292 |
| −0.5943 | 0.4350 | 8.0292 | 0.4305 | −0.8912 | 8.0292 |
| −0.6390 | 0.5386 | 8.0292 | 0.4902 | −0.9843 | 8.0292 |
| −0.6805 | 0.6393 | 8.0292 | 0.5481 | −1.0737 | 8.0292 |
| −0.7186 | 0.7369 | 8.0292 | 0.6045 | −1.1595 | 8.0292 |
| −0.7536 | 0.8315 | 8.0292 | 0.6594 | −1.2415 | 8.0292 |
| −0.7854 | 0.9228 | 8.0292 | 0.7128 | −1.3198 | 8.0292 |
| −0.8144 | 1.0109 | 8.0292 | 0.7649 | −1.3941 | 8.0292 |
| −0.8407 | 1.0956 | 8.0292 | 0.8133 | −1.4615 | 8.0292 |
| −0.8632 | 1.1731 | 8.0292 | 0.8578 | −1.5219 | 8.0292 |
| −0.8822 | 1.2431 | 8.0292 | 0.8982 | −1.5755 | 8.0292 |
| −0.8974 | 1.3059 | 8.0292 | 0.9340 | −1.6227 | 8.0292 |
| −0.9104 | 1.3649 | 8.0292 | 0.9652 | −1.6635 | 8.0292 |
| −0.9206 | 1.4163 | 8.0292 | 0.9919 | −1.6977 | 8.0292 |
| −0.9270 | 1.4561 | 8.0292 | 1.0149 | −1.7268 | 8.0292 |
| −0.9305 | 1.4883 | 8.0292 | 1.0343 | −1.7512 | 8.0292 |
| −0.9316 | 1.5124 | 8.0292 | 1.0502 | −1.7714 | 8.0292 |
| −0.9305 | 1.5305 | 8.0292 | 1.0630 | −1.7875 | 8.0292 |
| −0.9284 | 1.5404 | 8.0292 | 1.0729 | −1.7999 | 8.0292 |
| −0.9257 | 1.5462 | 8.0292 | 1.0797 | −1.8095 | 8.0292 |
| −0.9236 | 1.5486 | 8.0292 | 1.0814 | −1.8190 | 8.0292 |
| −0.9222 | 1.5494 | 8.0292 | 1.0793 | −1.8264 | 8.0292 |

TABLE 5

| SUCTION SIDE | | | PRESSURE SIDE | | |
|---|---|---|---|---|---|
| X | Y | Z | X | Y | Z |
| 1.2979 | −1.0304 | −0.1886 | −0.9727 | 1.1006 | −0.1886 |
| 1.2950 | −1.0343 | −0.1886 | −0.9722 | 1.1009 | −0.1886 |
| 1.2898 | −1.0382 | −0.1886 | −0.9709 | 1.1015 | −0.1886 |
| 1.2820 | −1.0403 | −0.1886 | −0.9686 | 1.1022 | −0.1886 |
| 1.2725 | −1.0385 | −0.1886 | −0.9636 | 1.1032 | −0.1886 |
| 1.2605 | −1.0333 | −0.1886 | −0.9557 | 1.1029 | −0.1886 |
| 1.2449 | −1.0264 | −0.1886 | −0.9421 | 1.0989 | −0.1886 |
| 1.2254 | −1.0177 | −0.1886 | −0.9253 | 1.0902 | −0.1886 |
| 1.2018 | −1.0071 | −0.1886 | −0.9050 | 1.0754 | −0.1886 |
| 1.1738 | −0.9944 | −0.1886 | −0.8815 | 1.0547 | −0.1886 |
| 1.1410 | −0.9794 | −0.1886 | −0.8527 | 1.0258 | −0.1886 |
| 1.1024 | −0.9615 | −0.1886 | −0.8205 | 0.9915 | −0.1886 |
| 1.0579 | −0.9406 | −0.1886 | −0.7868 | 0.9543 | −0.1886 |
| 1.0077 | −0.9165 | −0.1886 | −0.7492 | 0.9123 | −0.1886 |
| 0.9518 | −0.8892 | −0.1886 | −0.7072 | 0.8657 | −0.1886 |
| 0.8903 | −0.8585 | −0.1886 | −0.6608 | 0.8145 | −0.1886 |
| 0.8230 | −0.8244 | −0.1886 | −0.6120 | 0.7614 | −0.1886 |
| 0.7532 | −0.7882 | −0.1886 | −0.5609 | 0.7063 | −0.1886 |
| 0.6809 | −0.7500 | −0.1886 | −0.5072 | 0.6492 | −0.1886 |
| 0.6061 | −0.7097 | −0.1886 | −0.4508 | 0.5903 | −0.1886 |
| 0.5290 | −0.6668 | −0.1886 | −0.3918 | 0.5297 | −0.1886 |
| 0.4499 | −0.6213 | −0.1886 | −0.3301 | 0.4674 | −0.1886 |
| 0.3688 | −0.5729 | −0.1886 | −0.2656 | 0.4034 | −0.1886 |
| 0.2859 | −0.5214 | −0.1886 | −0.1985 | 0.3376 | −0.1886 |
| 0.2040 | −0.4683 | −0.1886 | −0.1312 | 0.2719 | −0.1886 |
| 0.1234 | −0.4136 | −0.1886 | −0.0638 | 0.2065 | −0.1886 |
| 0.0439 | −0.3572 | −0.1886 | 0.0037 | 0.1409 | −0.1886 |
| −0.0343 | −0.2988 | −0.1886 | 0.0710 | 0.0755 | −0.1886 |
| −0.1111 | −0.2383 | −0.1886 | 0.1385 | 0.0099 | −0.1886 |
| −0.1862 | −0.1756 | −0.1886 | 0.2058 | −0.0556 | −0.1886 |
| −0.2597 | −0.1104 | −0.1886 | 0.2732 | −0.1212 | −0.1886 |
| −0.3314 | −0.0428 | −0.1886 | 0.3407 | −0.1866 | −0.1886 |

TABLE 5-continued

| SUCTION SIDE | | | PRESSURE SIDE | | |
|---|---|---|---|---|---|
| X | Y | Z | X | Y | Z |
| −0.4013 | 0.0273 | −0.1886 | 0.4085 | −0.2516 | −0.1886 |
| −0.4689 | 0.0997 | −0.1886 | 0.4767 | −0.3163 | −0.1886 |
| −0.5338 | 0.1742 | −0.1886 | 0.5453 | −0.3807 | −0.1886 |
| −0.5940 | 0.2484 | −0.1886 | 0.6120 | −0.4423 | −0.1886 |
| −0.6499 | 0.3221 | −0.1886 | 0.6770 | −0.5012 | −0.1886 |
| −0.7014 | 0.3949 | −0.1886 | 0.7401 | −0.5575 | −0.1886 |
| −0.7484 | 0.4666 | −0.1886 | 0.8014 | −0.6112 | −0.1886 |
| −0.7913 | 0.5372 | −0.1886 | 0.8610 | −0.6622 | −0.1886 |
| −0.8301 | 0.6063 | −0.1886 | 0.9185 | −0.7105 | −0.1886 |
| −0.8651 | 0.6737 | −0.1886 | 0.9741 | −0.7564 | −0.1886 |
| −0.8960 | 0.7395 | −0.1886 | 1.0254 | −0.7977 | −0.1886 |
| −0.9223 | 0.8001 | −0.1886 | 1.0719 | −0.8348 | −0.1886 |
| −0.9440 | 0.8555 | −0.1886 | 1.1137 | −0.8678 | −0.1886 |
| −0.9617 | 0.9054 | −0.1886 | 1.1508 | −0.8967 | −0.1886 |
| −0.9758 | 0.9529 | −0.1886 | 1.1831 | −0.9216 | −0.1886 |
| −0.9858 | 0.9947 | −0.1886 | 1.2104 | −0.9425 | −0.1886 |
| −0.9908 | 1.0273 | −0.1886 | 1.2339 | −0.9604 | −0.1886 |
| −0.9919 | 1.0537 | −0.1886 | 1.2536 | −0.9754 | −0.1886 |
| −0.9897 | 1.0735 | −0.1886 | 1.2699 | −0.9876 | −0.1886 |
| −0.9850 | 1.0875 | −0.1886 | 1.2829 | −0.9973 | −0.1886 |
| −0.9805 | 1.0945 | −0.1886 | 1.2929 | −1.0049 | −0.1886 |
| −0.9767 | 1.0982 | −0.1886 | 1.2988 | −1.0122 | −0.1886 |
| −0.9744 | 1.0997 | −0.1886 | 1.3006 | −1.0198 | −0.1886 |
| −0.9733 | 1.1003 | −0.1886 | 1.2998 | −1.0260 | −0.1886 |
| 1.2911 | −1.0261 | 0.0000 | −0.9793 | 1.1133 | 0.0000 |
| 1.2880 | −1.0299 | 0.0000 | −0.9788 | 1.1136 | 0.0000 |
| 1.2827 | −1.0336 | 0.0000 | −0.9776 | 1.1141 | 0.0000 |
| 1.2748 | −1.0354 | 0.0000 | −0.9752 | 1.1151 | 0.0000 |
| 1.2654 | −1.0333 | 0.0000 | −0.9703 | 1.1161 | 0.0000 |
| 1.2535 | −1.0277 | 0.0000 | −0.9623 | 1.1161 | 0.0000 |
| 1.2381 | −1.0205 | 0.0000 | −0.9485 | 1.1126 | 0.0000 |
| 1.2189 | −1.0115 | 0.0000 | −0.9315 | 1.1042 | 0.0000 |
| 1.1956 | −1.0004 | 0.0000 | −0.9108 | 1.0900 | 0.0000 |
| 1.1679 | −0.9871 | 0.0000 | −0.8868 | 1.0698 | 0.0000 |
| 1.1355 | −0.9714 | 0.0000 | −0.8574 | 1.0415 | 0.0000 |
| 1.0973 | −0.9528 | 0.0000 | −0.8245 | 1.0077 | 0.0000 |
| 1.0534 | −0.9310 | 0.0000 | −0.7901 | 0.9710 | 0.0000 |
| 1.0037 | −0.9061 | 0.0000 | −0.7518 | 0.9295 | 0.0000 |
| 0.9484 | −0.8779 | 0.0000 | −0.7091 | 0.8835 | 0.0000 |
| 0.8875 | −0.8462 | 0.0000 | −0.6620 | 0.8329 | 0.0000 |
| 0.8210 | −0.8111 | 0.0000 | −0.6125 | 0.7803 | 0.0000 |
| 0.7519 | −0.7739 | 0.0000 | −0.5607 | 0.7256 | 0.0000 |
| 0.6803 | −0.7347 | 0.0000 | −0.5064 | 0.6689 | 0.0000 |
| 0.6063 | −0.6933 | 0.0000 | −0.4494 | 0.6104 | 0.0000 |
| 0.5302 | −0.6494 | 0.0000 | −0.3899 | 0.5501 | 0.0000 |
| 0.4519 | −0.6029 | 0.0000 | −0.3279 | 0.4879 | 0.0000 |
| 0.3717 | −0.5536 | 0.0000 | −0.2632 | 0.4240 | 0.0000 |
| 0.2898 | −0.5012 | 0.0000 | −0.1958 | 0.3580 | 0.0000 |
| 0.2090 | −0.4475 | 0.0000 | −0.1284 | 0.2923 | 0.0000 |
| 0.1294 | −0.3923 | 0.0000 | −0.0609 | 0.2267 | 0.0000 |
| 0.0509 | −0.3354 | 0.0000 | 0.0065 | 0.1609 | 0.0000 |
| −0.0262 | −0.2768 | 0.0000 | 0.0739 | 0.0952 | 0.0000 |
| −0.1020 | −0.2165 | 0.0000 | 0.1411 | 0.0292 | 0.0000 |
| −0.1761 | −0.1539 | 0.0000 | 0.2083 | −0.0368 | 0.0000 |
| −0.2487 | −0.0894 | 0.0000 | 0.2754 | −0.1028 | 0.0000 |
| −0.3196 | −0.0226 | 0.0000 | 0.3427 | −0.1687 | 0.0000 |
| −0.3888 | 0.0464 | 0.0000 | 0.4101 | −0.2345 | 0.0000 |
| −0.4560 | 0.1178 | 0.0000 | 0.4779 | −0.2998 | 0.0000 |
| −0.5215 | 0.1918 | 0.0000 | 0.5460 | −0.3648 | 0.0000 |
| −0.5827 | 0.2656 | 0.0000 | 0.6123 | −0.4272 | 0.0000 |
| −0.6395 | 0.3388 | 0.0000 | 0.6767 | −0.4869 | 0.0000 |
| −0.6920 | 0.4110 | 0.0000 | 0.7394 | −0.5440 | 0.0000 |
| −0.7403 | 0.4824 | 0.0000 | 0.8002 | −0.5985 | 0.0000 |
| −0.7845 | 0.5524 | 0.0000 | 0.8592 | −0.6502 | 0.0000 |
| −0.8246 | 0.6210 | 0.0000 | 0.9161 | −0.6995 | 0.0000 |
| −0.8610 | 0.6879 | 0.0000 | 0.9713 | −0.7461 | 0.0000 |
| −0.8934 | 0.7531 | 0.0000 | 1.0220 | −0.7882 | 0.0000 |
| −0.9209 | 0.8133 | 0.0000 | 1.0680 | −0.8261 | 0.0000 |
| −0.9440 | 0.8682 | 0.0000 | 1.1094 | −0.8599 | 0.0000 |
| −0.9629 | 0.9178 | 0.0000 | 1.1460 | −0.8894 | 0.0000 |
| −0.9784 | 0.9651 | 0.0000 | 1.1779 | −0.9150 | 0.0000 |
| −0.9894 | 1.0067 | 0.0000 | 1.2049 | −0.9364 | 0.0000 |
| −0.9954 | 1.0393 | 0.0000 | 1.2280 | −0.9547 | 0.0000 |
| −0.9972 | 1.0656 | 0.0000 | 1.2476 | −0.9701 | 0.0000 |
| −0.9955 | 1.0855 | 0.0000 | 1.2636 | −0.9827 | 0.0000 |
| −0.9912 | 1.0998 | 0.0000 | 1.2764 | −0.9928 | 0.0000 |

TABLE 5-continued

| SUCTION SIDE | | | PRESSURE SIDE | | |
|---|---|---|---|---|---|
| X | Y | Z | X | Y | Z |
| −0.9869 | 1.1068 | 0.0000 | 1.2863 | −1.0005 | 0.0000 |
| −0.9832 | 1.1106 | 0.0000 | 1.2922 | −1.0079 | 0.0000 |
| −0.9810 | 1.1122 | 0.0000 | 1.2939 | −1.0155 | 0.0000 |
| −0.9799 | 1.1130 | 0.0000 | 1.2930 | −1.0218 | 0.0000 |
| 1.2826 | −1.0215 | 0.2331 | −0.9869 | 1.1292 | 0.2331 |
| 1.2794 | −1.0252 | 0.2331 | −0.9863 | 1.1295 | 0.2331 |
| 1.2740 | −1.0287 | 0.2331 | −0.9852 | 1.1300 | 0.2331 |
| 1.2661 | −1.0303 | 0.2331 | −0.9828 | 1.1311 | 0.2331 |
| 1.2567 | −1.0278 | 0.2331 | −0.9779 | 1.1323 | 0.2331 |
| 1.2451 | −1.0221 | 0.2331 | −0.9700 | 1.1324 | 0.2331 |
| 1.2299 | −1.0144 | 0.2331 | −0.9560 | 1.1292 | 0.2331 |
| 1.2110 | −1.0049 | 0.2331 | −0.9388 | 1.1213 | 0.2331 |
| 1.1881 | −0.9933 | 0.2331 | −0.9177 | 1.1076 | 0.2331 |
| 1.1607 | −0.9793 | 0.2331 | −0.8931 | 1.0880 | 0.2331 |
| 1.1289 | −0.9629 | 0.2331 | −0.8628 | 1.0603 | 0.2331 |
| 1.0913 | −0.9433 | 0.2331 | −0.8291 | 1.0273 | 0.2331 |
| 1.0480 | −0.9206 | 0.2331 | −0.7939 | 0.9914 | 0.2331 |
| 0.9990 | −0.8946 | 0.2331 | −0.7546 | 0.9507 | 0.2331 |
| 0.9446 | −0.8651 | 0.2331 | −0.7109 | 0.9054 | 0.2331 |
| 0.8845 | −0.8322 | 0.2331 | −0.6628 | 0.8556 | 0.2331 |
| 0.8191 | −0.7957 | 0.2331 | −0.6124 | 0.8036 | 0.2331 |
| 0.7510 | −0.7572 | 0.2331 | −0.5598 | 0.7495 | 0.2331 |
| 0.6804 | −0.7165 | 0.2331 | −0.5047 | 0.6933 | 0.2331 |
| 0.6075 | −0.6737 | 0.2331 | −0.4473 | 0.6351 | 0.2331 |
| 0.5322 | −0.6285 | 0.2331 | −0.3873 | 0.5748 | 0.2331 |
| 0.4550 | −0.5808 | 0.2331 | −0.3249 | 0.5126 | 0.2331 |
| 0.3758 | −0.5304 | 0.2331 | −0.2599 | 0.4485 | 0.2331 |
| 0.2948 | −0.4769 | 0.2331 | −0.1926 | 0.3824 | 0.2331 |
| 0.2147 | −0.4222 | 0.2331 | −0.1252 | 0.3163 | 0.2331 |
| 0.1357 | −0.3661 | 0.2331 | −0.0576 | 0.2504 | 0.2331 |
| 0.0579 | −0.3084 | 0.2331 | 0.0098 | 0.1844 | 0.2331 |
| −0.0186 | −0.2491 | 0.2331 | 0.0772 | 0.1182 | 0.2331 |
| −0.0938 | −0.1882 | 0.2331 | 0.1443 | 0.0519 | 0.2331 |
| −0.1676 | −0.1253 | 0.2331 | 0.2114 | −0.0146 | 0.2331 |
| −0.2398 | −0.0605 | 0.2331 | 0.2783 | −0.0812 | 0.2331 |
| −0.3105 | 0.0064 | 0.2331 | 0.3453 | −0.1477 | 0.2331 |
| −0.3795 | 0.0754 | 0.2331 | 0.4125 | −0.2140 | 0.2331 |
| −0.4469 | 0.1466 | 0.2331 | 0.4798 | −0.2801 | 0.2331 |
| −0.5124 | 0.2200 | 0.2331 | 0.5475 | −0.3460 | 0.2331 |
| −0.5738 | 0.2932 | 0.2331 | 0.6133 | −0.4093 | 0.2331 |
| −0.6311 | 0.3656 | 0.2331 | 0.6771 | −0.4699 | 0.2331 |
| −0.6842 | 0.4369 | 0.2331 | 0.7391 | −0.5281 | 0.2331 |
| −0.7333 | 0.5071 | 0.2331 | 0.7992 | −0.5836 | 0.2331 |
| −0.7784 | 0.5759 | 0.2331 | 0.8574 | −0.6365 | 0.2331 |
| −0.8198 | 0.6434 | 0.2331 | 0.9138 | −0.6867 | 0.2331 |
| −0.8575 | 0.7091 | 0.2331 | 0.9682 | −0.7345 | 0.2331 |
| −0.8912 | 0.7732 | 0.2331 | 1.0182 | −0.7777 | 0.2331 |
| −0.9202 | 0.8324 | 0.2331 | 1.0636 | −0.8165 | 0.2331 |
| −0.9446 | 0.8864 | 0.2331 | 1.1044 | −0.8511 | 0.2331 |
| −0.9647 | 0.9352 | 0.2331 | 1.1405 | −0.8816 | 0.2331 |
| −0.9815 | 0.9818 | 0.2331 | 1.1719 | −0.9078 | 0.2331 |
| −0.9938 | 1.0228 | 0.2331 | 1.1985 | −0.9300 | 0.2331 |
| −1.0005 | 1.0551 | 0.2331 | 1.2213 | −0.9489 | 0.2331 |
| −1.0031 | 1.0813 | 0.2331 | 1.2405 | −0.9646 | 0.2331 |
| −1.0021 | 1.1010 | 0.2331 | 1.2562 | −0.9776 | 0.2331 |
| −0.9983 | 1.1153 | 0.2331 | 1.2689 | −0.9881 | 0.2331 |
| −0.9942 | 1.1225 | 0.2331 | 1.2786 | −0.9960 | 0.2331 |
| −0.9906 | 1.1265 | 0.2331 | 1.2842 | −1.0035 | 0.2331 |
| −0.9886 | 1.1281 | 0.2331 | 1.2857 | −1.0111 | 0.2331 |
| −0.9874 | 1.1288 | 0.2331 | 1.2845 | −1.0172 | 0.2331 |
| 1.2655 | −1.0320 | 0.6548 | −0.9860 | 1.1540 | 0.6548 |
| 1.2622 | −1.0355 | 0.6548 | −0.9855 | 1.1543 | 0.6548 |
| 1.2567 | −1.0387 | 0.6548 | −0.9843 | 1.1549 | 0.6548 |
| 1.2487 | −1.0400 | 0.6548 | −0.9821 | 1.1560 | 0.6548 |
| 1.2396 | −1.0370 | 0.6548 | −0.9771 | 1.1573 | 0.6548 |
| 1.2282 | −1.0306 | 0.6548 | −0.9691 | 1.1576 | 0.6548 |
| 1.2135 | −1.0223 | 0.6548 | −0.9551 | 1.1546 | 0.6548 |
| 1.1951 | −1.0120 | 0.6548 | −0.9376 | 1.1469 | 0.6548 |
| 1.1728 | −0.9993 | 0.6548 | −0.9161 | 1.1336 | 0.6548 |
| 1.1463 | −0.9841 | 0.6548 | −0.8909 | 1.1145 | 0.6548 |
| 1.1152 | −0.9663 | 0.6548 | −0.8600 | 1.0875 | 0.6548 |
| 1.0787 | −0.9451 | 0.6548 | −0.8255 | 1.0551 | 0.6548 |
| 1.0367 | −0.9205 | 0.6548 | −0.7895 | 1.0196 | 0.6548 |
| 0.9890 | −0.8925 | 0.6548 | −0.7492 | 0.9794 | 0.6548 |
| 0.9360 | −0.8609 | 0.6548 | −0.7047 | 0.9346 | 0.6548 |
| 0.8776 | −0.8256 | 0.6548 | −0.6558 | 0.8852 | 0.6548 |

TABLE 5-continued

| SUCTION SIDE | | | PRESSURE SIDE | | |
|---|---|---|---|---|---|
| X | Y | Z | X | Y | Z |
| 0.8138 | −0.7866 | 0.6548 | −0.6048 | 0.8335 | 0.6548 |
| 0.7475 | −0.7457 | 0.6548 | −0.5516 | 0.7795 | 0.6548 |
| 0.6786 | −0.7027 | 0.6548 | −0.4961 | 0.7232 | 0.6548 |
| 0.6074 | −0.6574 | 0.6548 | −0.4383 | 0.6649 | 0.6548 |
| 0.5339 | −0.6099 | 0.6548 | −0.3782 | 0.6043 | 0.6548 |
| 0.4583 | −0.5598 | 0.6548 | −0.3158 | 0.5417 | 0.6548 |
| 0.3807 | −0.5071 | 0.6548 | −0.2510 | 0.4770 | 0.6548 |
| 0.3012 | −0.4515 | 0.6548 | −0.1838 | 0.4102 | 0.6548 |
| 0.2226 | −0.3948 | 0.6548 | −0.1166 | 0.3434 | 0.6548 |
| 0.1450 | −0.3369 | 0.6548 | −0.0493 | 0.2765 | 0.6548 |
| 0.0684 | −0.2777 | 0.6548 | 0.0177 | 0.2096 | 0.6548 |
| −0.0071 | −0.2170 | 0.6548 | 0.0845 | 0.1424 | 0.6548 |
| −0.0811 | −0.1547 | 0.6548 | 0.1511 | 0.0750 | 0.6548 |
| −0.1539 | −0.0907 | 0.6548 | 0.2175 | 0.0074 | 0.6548 |
| −0.2252 | −0.0249 | 0.6548 | 0.2837 | −0.0605 | 0.6548 |
| −0.2951 | 0.0427 | 0.6548 | 0.3499 | −0.1283 | 0.6548 |
| −0.3636 | 0.1122 | 0.6548 | 0.4161 | −0.1961 | 0.6548 |
| −0.4304 | 0.1836 | 0.6548 | 0.4824 | −0.2637 | 0.6548 |
| −0.4957 | 0.2571 | 0.6548 | 0.5490 | −0.3312 | 0.6548 |
| −0.5568 | 0.3298 | 0.6548 | 0.6136 | −0.3961 | 0.6548 |
| −0.6140 | 0.4015 | 0.6548 | 0.6762 | −0.4587 | 0.6548 |
| −0.6674 | 0.4720 | 0.6548 | 0.7368 | −0.5187 | 0.6548 |
| −0.7170 | 0.5413 | 0.6548 | 0.7956 | −0.5760 | 0.6548 |
| −0.7630 | 0.6091 | 0.6548 | 0.8525 | −0.6308 | 0.6548 |
| −0.8053 | 0.6754 | 0.6548 | 0.9075 | −0.6830 | 0.6548 |
| −0.8442 | 0.7400 | 0.6548 | 0.9606 | −0.7326 | 0.6548 |
| −0.8793 | 0.8029 | 0.6548 | 1.0092 | −0.7777 | 0.6548 |
| −0.9097 | 0.8610 | 0.6548 | 1.0535 | −0.8182 | 0.6548 |
| −0.9356 | 0.9141 | 0.6548 | 1.0932 | −0.8544 | 0.6548 |
| −0.9571 | 0.9620 | 0.6548 | 1.1283 | −0.8863 | 0.6548 |
| −0.9752 | 1.0076 | 0.6548 | 1.1588 | −0.9138 | 0.6548 |
| −0.9888 | 1.0480 | 0.6548 | 1.1847 | −0.9370 | 0.6548 |
| −0.9967 | 1.0799 | 0.6548 | 1.2067 | −0.9568 | 0.6548 |
| −1.0002 | 1.1058 | 0.6548 | 1.2254 | −0.9735 | 0.6548 |
| −1.0000 | 1.1254 | 0.6548 | 1.2407 | −0.9872 | 0.6548 |
| −0.9968 | 1.1398 | 0.6548 | 1.2529 | −0.9981 | 0.6548 |
| −0.9930 | 1.1471 | 0.6548 | 1.2624 | −1.0065 | 0.6548 |
| −0.9897 | 1.1511 | 0.6548 | 1.2678 | −1.0140 | 0.6548 |
| −0.9876 | 1.1529 | 0.6548 | 1.2690 | −1.0218 | 0.6548 |
| −0.9866 | 1.1536 | 0.6548 | 1.2678 | −1.0278 | 0.6548 |
| 1.2402 | −1.0759 | 1.0765 | −0.9671 | 1.1743 | 1.0765 |
| 1.2368 | −1.0793 | 1.0765 | −0.9665 | 1.1746 | 1.0765 |
| 1.2311 | −1.0823 | 1.0765 | −0.9654 | 1.1752 | 1.0765 |
| 1.2230 | −1.0831 | 1.0765 | −0.9630 | 1.1763 | 1.0765 |
| 1.2141 | −1.0796 | 1.0765 | −0.9580 | 1.1775 | 1.0765 |
| 1.2031 | −1.0727 | 1.0765 | −0.9500 | 1.1776 | 1.0765 |
| 1.1887 | −1.0638 | 1.0765 | −0.9360 | 1.1743 | 1.0765 |
| 1.1707 | −1.0527 | 1.0765 | −0.9186 | 1.1663 | 1.0765 |
| 1.1489 | −1.0390 | 1.0765 | −0.8973 | 1.1526 | 1.0765 |
| 1.1231 | −1.0228 | 1.0765 | −0.8722 | 1.1331 | 1.0765 |
| 1.0928 | −1.0037 | 1.0765 | −0.8412 | 1.1057 | 1.0765 |
| 1.0571 | −0.9809 | 1.0765 | −0.8069 | 1.0728 | 1.0765 |
| 1.0162 | −0.9545 | 1.0765 | −0.7711 | 1.0369 | 1.0765 |
| 0.9697 | −0.9245 | 1.0765 | −0.7312 | 0.9960 | 1.0765 |
| 0.9180 | −0.8908 | 1.0765 | −0.6869 | 0.9505 | 1.0765 |
| 0.8610 | −0.8532 | 1.0765 | −0.6385 | 0.9001 | 1.0765 |
| 0.7987 | −0.8118 | 1.0765 | −0.5881 | 0.8474 | 1.0765 |
| 0.7339 | −0.7683 | 1.0765 | −0.5355 | 0.7924 | 1.0765 |
| 0.6667 | −0.7227 | 1.0765 | −0.4807 | 0.7349 | 1.0765 |
| 0.5970 | −0.6750 | 1.0765 | −0.4239 | 0.6752 | 1.0765 |
| 0.5252 | −0.6248 | 1.0765 | −0.3646 | 0.6134 | 1.0765 |
| 0.4512 | −0.5721 | 1.0765 | −0.3031 | 0.5492 | 1.0765 |
| 0.3753 | −0.5166 | 1.0765 | −0.2394 | 0.4829 | 1.0765 |
| 0.2976 | −0.4584 | 1.0765 | −0.1733 | 0.4144 | 1.0765 |
| 0.2207 | −0.3991 | 1.0765 | −0.1071 | 0.3459 | 1.0765 |
| 0.1448 | −0.3387 | 1.0765 | −0.0412 | 0.2773 | 1.0765 |
| 0.0699 | −0.2771 | 1.0765 | 0.0247 | 0.2086 | 1.0765 |
| −0.0040 | −0.2141 | 1.0765 | 0.0903 | 0.1397 | 1.0765 |
| −0.0765 | −0.1496 | 1.0765 | 0.1555 | 0.0704 | 1.0765 |
| −0.1476 | −0.0836 | 1.0765 | 0.2206 | 0.0008 | 1.0765 |
| −0.2173 | −0.0157 | 1.0765 | 0.2853 | −0.0689 | 1.0765 |
| −0.2856 | 0.0539 | 1.0765 | 0.3499 | −0.1387 | 1.0765 |
| −0.3524 | 0.1252 | 1.0765 | 0.4145 | −0.2086 | 1.0765 |
| −0.4177 | 0.1983 | 1.0765 | 0.4792 | −0.2785 | 1.0765 |
| −0.4814 | 0.2731 | 1.0765 | 0.5440 | −0.3482 | 1.0765 |
| −0.5412 | 0.3468 | 1.0765 | 0.6069 | −0.4154 | 1.0765 |

TABLE 5-continued

| SUCTION SIDE | | | PRESSURE SIDE | | |
|---|---|---|---|---|---|
| X | Y | Z | X | Y | Z |
| −0.5971 | 0.4194 | 1.0765 | 0.6678 | −0.4801 | 1.0765 |
| −0.6495 | 0.4907 | 1.0765 | 0.7268 | −0.5422 | 1.0765 |
| −0.6983 | 0.5605 | 1.0765 | 0.7840 | −0.6017 | 1.0765 |
| −0.7434 | 0.6288 | 1.0765 | 0.8394 | −0.6584 | 1.0765 |
| −0.7851 | 0.6955 | 1.0765 | 0.8928 | −0.7127 | 1.0765 |
| −0.8235 | 0.7603 | 1.0765 | 0.9443 | −0.7644 | 1.0765 |
| −0.8585 | 0.8233 | 1.0765 | 0.9917 | −0.8113 | 1.0765 |
| −0.8887 | 0.8815 | 1.0765 | 1.0345 | −0.8536 | 1.0765 |
| −0.9145 | 0.9345 | 1.0765 | 1.0731 | −0.8914 | 1.0765 |
| −0.9360 | 0.9823 | 1.0765 | 1.1072 | −0.9245 | 1.0765 |
| −0.9544 | 1.0279 | 1.0765 | 1.1369 | −0.9532 | 1.0765 |
| −0.9682 | 1.0682 | 1.0765 | 1.1620 | −0.9774 | 1.0765 |
| −0.9764 | 1.1000 | 1.0765 | 1.1835 | −0.9982 | 1.0765 |
| −0.9803 | 1.1258 | 1.0765 | 1.2015 | −1.0155 | 1.0765 |
| −0.9804 | 1.1454 | 1.0765 | 1.2164 | −1.0298 | 1.0765 |
| −0.9775 | 1.1599 | 1.0765 | 1.2283 | −1.0412 | 1.0765 |
| −0.9739 | 1.1673 | 1.0765 | 1.2375 | −1.0500 | 1.0765 |
| −0.9706 | 1.1714 | 1.0765 | 1.2429 | −1.0577 | 1.0765 |
| −0.9687 | 1.1732 | 1.0765 | 1.2441 | −1.0655 | 1.0765 |
| −0.9676 | 1.1739 | 1.0765 | 1.2427 | −1.0718 | 1.0765 |
| 1.2041 | −1.1343 | 1.4981 | −0.9374 | 1.1831 | 1.4981 |
| 1.2005 | −1.1376 | 1.4981 | −0.9368 | 1.1833 | 1.4981 |
| 1.1948 | −1.1403 | 1.4981 | −0.9357 | 1.1840 | 1.4981 |
| 1.1867 | −1.1408 | 1.4981 | −0.9333 | 1.1849 | 1.4981 |
| 1.1779 | −1.1368 | 1.4981 | −0.9282 | 1.1860 | 1.4981 |
| 1.1671 | −1.1296 | 1.4981 | −0.9202 | 1.1858 | 1.4981 |
| 1.1532 | −1.1201 | 1.4981 | −0.9063 | 1.1819 | 1.4981 |
| 1.1356 | −1.1083 | 1.4981 | −0.8892 | 1.1732 | 1.4981 |
| 1.1144 | −1.0938 | 1.4981 | −0.8682 | 1.1590 | 1.4981 |
| 1.0892 | −1.0767 | 1.4981 | −0.8435 | 1.1388 | 1.4981 |
| 1.0597 | −1.0565 | 1.4981 | −0.8133 | 1.1107 | 1.4981 |
| 1.0250 | −1.0324 | 1.4981 | −0.7796 | 1.0769 | 1.4981 |
| 0.9851 | −1.0045 | 1.4981 | −0.7447 | 1.0402 | 1.4981 |
| 0.9398 | −0.9728 | 1.4981 | −0.7057 | 0.9984 | 1.4981 |
| 0.8894 | −0.9373 | 1.4981 | −0.6626 | 0.9517 | 1.4981 |
| 0.8339 | −0.8977 | 1.4981 | −0.6154 | 0.9001 | 1.4981 |
| 0.7732 | −0.8541 | 1.4981 | −0.5663 | 0.8461 | 1.4981 |
| 0.7101 | −0.8083 | 1.4981 | −0.5151 | 0.7896 | 1.4981 |
| 0.6446 | −0.7603 | 1.4981 | −0.4618 | 0.7308 | 1.4981 |
| 0.5768 | −0.7101 | 1.4981 | −0.4064 | 0.6696 | 1.4981 |
| 0.5068 | −0.6575 | 1.4981 | −0.3488 | 0.6060 | 1.4981 |
| 0.4348 | −0.6023 | 1.4981 | −0.2891 | 0.5402 | 1.4981 |
| 0.3609 | −0.5444 | 1.4981 | −0.2270 | 0.4720 | 1.4981 |
| 0.2852 | −0.4836 | 1.4981 | −0.1629 | 0.4016 | 1.4981 |
| 0.2105 | −0.4218 | 1.4981 | −0.0987 | 0.3313 | 1.4981 |
| 0.1367 | −0.3589 | 1.4981 | −0.0344 | 0.2609 | 1.4981 |
| 0.0639 | −0.2948 | 1.4981 | 0.0296 | 0.1903 | 1.4981 |
| −0.0075 | −0.2293 | 1.4981 | 0.0934 | 0.1196 | 1.4981 |
| −0.0778 | −0.1624 | 1.4981 | 0.1569 | 0.0485 | 1.4981 |
| −0.1467 | −0.0939 | 1.4981 | 0.2199 | −0.0230 | 1.4981 |
| −0.2140 | −0.0238 | 1.4981 | 0.2826 | −0.0947 | 1.4981 |
| −0.2799 | 0.0480 | 1.4981 | 0.3450 | −0.1667 | 1.4981 |
| −0.3444 | 0.1214 | 1.4981 | 0.4076 | −0.2385 | 1.4981 |
| −0.4074 | 0.1965 | 1.4981 | 0.4700 | −0.3105 | 1.4981 |
| −0.4687 | 0.2731 | 1.4981 | 0.5326 | −0.3823 | 1.4981 |
| −0.5262 | 0.3483 | 1.4981 | 0.5934 | −0.4515 | 1.4981 |
| −0.5802 | 0.4222 | 1.4981 | 0.6521 | −0.5182 | 1.4981 |
| −0.6306 | 0.4947 | 1.4981 | 0.7091 | −0.5823 | 1.4981 |
| −0.6776 | 0.5655 | 1.4981 | 0.7642 | −0.6437 | 1.4981 |
| −0.7211 | 0.6348 | 1.4981 | 0.8176 | −0.7026 | 1.4981 |
| −0.7613 | 0.7022 | 1.4981 | 0.8692 | −0.7587 | 1.4981 |
| −0.7982 | 0.7677 | 1.4981 | 0.9190 | −0.8122 | 1.4981 |
| −0.8321 | 0.8311 | 1.4981 | 0.9645 | −0.8608 | 1.4981 |
| −0.8613 | 0.8897 | 1.4981 | 1.0060 | −0.9047 | 1.4981 |
| −0.8863 | 0.9430 | 1.4981 | 1.0432 | −0.9438 | 1.4981 |
| −0.9073 | 0.9910 | 1.4981 | 1.0762 | −0.9782 | 1.4981 |
| −0.9250 | 1.0368 | 1.4981 | 1.1048 | −1.0079 | 1.4981 |
| −0.9384 | 1.0771 | 1.4981 | 1.1291 | −1.0331 | 1.4981 |
| −0.9463 | 1.1088 | 1.4981 | 1.1498 | −1.0546 | 1.4981 |
| −0.9502 | 1.1347 | 1.4981 | 1.1672 | −1.0726 | 1.4981 |
| −0.9504 | 1.1543 | 1.4981 | 1.1816 | −1.0874 | 1.4981 |
| −0.9477 | 1.1687 | 1.4981 | 1.1931 | −1.0992 | 1.4981 |
| −0.9442 | 1.1761 | 1.4981 | 1.2020 | −1.1084 | 1.4981 |
| −0.9410 | 1.1802 | 1.4981 | 1.2073 | −1.1162 | 1.4981 |
| −0.9390 | 1.1819 | 1.4981 | 1.2082 | −1.1241 | 1.4981 |
| −0.9379 | 1.1827 | 1.4981 | 1.2066 | −1.1302 | 1.4981 |

TABLE 5-continued

| SUCTION SIDE | | | PRESSURE SIDE | | |
|---|---|---|---|---|---|
| X | Y | Z | X | Y | Z |
| 1.1614 | −1.1975 | 1.9198 | −0.9022 | 1.1765 | 1.9198 |
| 1.1578 | −1.2006 | 1.9198 | −0.9016 | 1.1768 | 1.9198 |
| 1.1518 | −1.2031 | 1.9198 | −0.9005 | 1.1774 | 1.9198 |
| 1.1438 | −1.2032 | 1.9198 | −0.8981 | 1.1782 | 1.9198 |
| 1.1352 | −1.1990 | 1.9198 | −0.8930 | 1.1792 | 1.9198 |
| 1.1248 | −1.1915 | 1.9198 | −0.8850 | 1.1785 | 1.9198 |
| 1.1112 | −1.1815 | 1.9198 | −0.8713 | 1.1741 | 1.9198 |
| 1.0941 | −1.1692 | 1.9198 | −0.8546 | 1.1649 | 1.9198 |
| 1.0735 | −1.1542 | 1.9198 | −0.8342 | 1.1499 | 1.9198 |
| 1.0488 | −1.1363 | 1.9198 | −0.8102 | 1.1291 | 1.9198 |
| 1.0202 | −1.1152 | 1.9198 | −0.7808 | 1.1002 | 1.9198 |
| 0.9863 | −1.0902 | 1.9198 | −0.7482 | 1.0657 | 1.9198 |
| 0.9474 | −1.0614 | 1.9198 | −0.7143 | 1.0281 | 1.9198 |
| 0.9033 | −1.0284 | 1.9198 | −0.6767 | 0.9854 | 1.9198 |
| 0.8543 | −0.9914 | 1.9198 | −0.6351 | 0.9376 | 1.9198 |
| 0.8001 | −0.9503 | 1.9198 | −0.5895 | 0.8850 | 1.9198 |
| 0.7411 | −0.9050 | 1.9198 | −0.5421 | 0.8297 | 1.9198 |
| 0.6797 | −0.8575 | 1.9198 | −0.4925 | 0.7721 | 1.9198 |
| 0.6160 | −0.8078 | 1.9198 | −0.4411 | 0.7119 | 1.9198 |
| 0.5500 | −0.7557 | 1.9198 | −0.3877 | 0.6493 | 1.9198 |
| 0.4820 | −0.7012 | 1.9198 | −0.3321 | 0.5843 | 1.9198 |
| 0.4120 | −0.6439 | 1.9198 | −0.2745 | 0.5170 | 1.9198 |
| 0.3402 | −0.5840 | 1.9198 | −0.2147 | 0.4474 | 1.9198 |
| 0.2668 | −0.5211 | 1.9198 | −0.1527 | 0.3753 | 1.9198 |
| 0.1944 | −0.4572 | 1.9198 | −0.0907 | 0.3034 | 1.9198 |
| 0.1230 | −0.3921 | 1.9198 | −0.0287 | 0.2315 | 1.9198 |
| 0.0527 | −0.3259 | 1.9198 | 0.0332 | 0.1594 | 1.9198 |
| −0.0162 | −0.2582 | 1.9198 | 0.0948 | 0.0871 | 1.9198 |
| −0.0838 | −0.1891 | 1.9198 | 0.1559 | 0.0144 | 1.9198 |
| −0.1500 | −0.1186 | 1.9198 | 0.2167 | −0.0586 | 1.9198 |
| −0.2146 | −0.0463 | 1.9198 | 0.2771 | −0.1319 | 1.9198 |
| −0.2777 | 0.0274 | 1.9198 | 0.3373 | −0.2053 | 1.9198 |
| −0.3394 | 0.1027 | 1.9198 | 0.3973 | −0.2789 | 1.9198 |
| −0.3995 | 0.1796 | 1.9198 | 0.4575 | −0.3524 | 1.9198 |
| −0.4581 | 0.2578 | 1.9198 | 0.5175 | −0.4259 | 1.9198 |
| −0.5130 | 0.3345 | 1.9198 | 0.5758 | −0.4968 | 1.9198 |
| −0.5644 | 0.4097 | 1.9198 | 0.6323 | −0.5652 | 1.9198 |
| −0.6124 | 0.4834 | 1.9198 | 0.6870 | −0.6309 | 1.9198 |
| −0.6570 | 0.5554 | 1.9198 | 0.7398 | −0.6939 | 1.9198 |
| −0.6983 | 0.6254 | 1.9198 | 0.7911 | −0.7543 | 1.9198 |
| −0.7365 | 0.6936 | 1.9198 | 0.8406 | −0.8119 | 1.9198 |
| −0.7716 | 0.7598 | 1.9198 | 0.8883 | −0.8669 | 1.9198 |
| −0.8037 | 0.8239 | 1.9198 | 0.9321 | −0.9169 | 1.9198 |
| −0.8314 | 0.8827 | 1.9198 | 0.9719 | −0.9620 | 1.9198 |
| −0.8551 | 0.9364 | 1.9198 | 1.0076 | −1.0022 | 1.9198 |
| −0.8749 | 0.9846 | 1.9198 | 1.0392 | −1.0377 | 1.9198 |
| −0.8917 | 1.0305 | 1.9198 | 1.0667 | −1.0684 | 1.9198 |
| −0.9042 | 1.0709 | 1.9198 | 1.0900 | −1.0942 | 1.9198 |
| −0.9116 | 1.1027 | 1.9198 | 1.1100 | −1.1164 | 1.9198 |
| −0.9152 | 1.1284 | 1.9198 | 1.1267 | −1.1349 | 1.9198 |
| −0.9153 | 1.1480 | 1.9198 | 1.1405 | −1.1501 | 1.9198 |
| −0.9125 | 1.1624 | 1.9198 | 1.1516 | −1.1623 | 1.9198 |
| −0.9092 | 1.1697 | 1.9198 | 1.1601 | −1.1717 | 1.9198 |
| −0.9058 | 1.1738 | 1.9198 | 1.1651 | −1.1797 | 1.9198 |
| −0.9039 | 1.1754 | 1.9198 | 1.1659 | −1.1875 | 1.9198 |
| −0.9027 | 1.1762 | 1.9198 | 1.1640 | −1.1935 | 1.9198 |
| 1.1229 | −1.2617 | 2.3415 | −0.8707 | 1.1616 | 2.3415 |
| 1.1192 | −1.2648 | 2.3415 | −0.8701 | 1.1618 | 2.3415 |
| 1.1133 | −1.2672 | 2.3415 | −0.8690 | 1.1624 | 2.3415 |
| 1.1052 | −1.2669 | 2.3415 | −0.8665 | 1.1632 | 2.3415 |
| 1.0968 | −1.2624 | 2.3415 | −0.8614 | 1.1638 | 2.3415 |
| 1.0867 | −1.2546 | 2.3415 | −0.8535 | 1.1629 | 2.3415 |
| 1.0733 | −1.2444 | 2.3415 | −0.8401 | 1.1578 | 2.3415 |
| 1.0567 | −1.2316 | 2.3415 | −0.8239 | 1.1479 | 2.3415 |
| 1.0365 | −1.2161 | 2.3415 | −0.8040 | 1.1322 | 2.3415 |
| 1.0124 | −1.1976 | 2.3415 | −0.7808 | 1.1107 | 2.3415 |
| 0.9843 | −1.1758 | 2.3415 | −0.7523 | 1.0811 | 2.3415 |
| 0.9512 | −1.1501 | 2.3415 | −0.7208 | 1.0458 | 2.3415 |
| 0.9130 | −1.1204 | 2.3415 | −0.6881 | 1.0073 | 2.3415 |
| 0.8700 | −1.0865 | 2.3415 | −0.6517 | 0.9637 | 2.3415 |
| 0.8221 | −1.0483 | 2.3415 | −0.6116 | 0.9149 | 2.3415 |
| 0.7693 | −1.0058 | 2.3415 | −0.5676 | 0.8610 | 2.3415 |
| 0.7116 | −0.9592 | 2.3415 | −0.5219 | 0.8047 | 2.3415 |
| 0.6517 | −0.9103 | 2.3415 | −0.4741 | 0.7458 | 2.3415 |
| 0.5894 | −0.8590 | 2.3415 | −0.4246 | 0.6844 | 2.3415 |
| 0.5252 | −0.8053 | 2.3415 | −0.3730 | 0.6205 | 2.3415 |

TABLE 5-continued

| SUCTION SIDE | | | PRESSURE SIDE | | |
|---|---|---|---|---|---|
| X | Y | Z | X | Y | Z |
| 0.4589 | −0.7491 | 2.3415 | −0.3195 | 0.5542 | 2.3415 |
| 0.3908 | −0.6901 | 2.3415 | −0.2638 | 0.4855 | 2.3415 |
| 0.3210 | −0.6283 | 2.3415 | −0.2060 | 0.4144 | 2.3415 |
| 0.2497 | −0.5635 | 2.3415 | −0.1462 | 0.3410 | 2.3415 |
| 0.1794 | −0.4976 | 2.3415 | −0.0862 | 0.2677 | 2.3415 |
| 0.1103 | −0.4307 | 2.3415 | −0.0262 | 0.1943 | 2.3415 |
| 0.0423 | −0.3625 | 2.3415 | 0.0337 | 0.1210 | 2.3415 |
| −0.0242 | −0.2930 | 2.3415 | 0.0934 | 0.0474 | 2.3415 |
| −0.0894 | −0.2219 | 2.3415 | 0.1526 | −0.0264 | 2.3415 |
| −0.1530 | −0.1495 | 2.3415 | 0.2115 | −0.1006 | 2.3415 |
| −0.2150 | −0.0755 | 2.3415 | 0.2699 | −0.1752 | 2.3415 |
| −0.2757 | 0.0001 | 2.3415 | 0.3281 | −0.2499 | 2.3415 |
| −0.3348 | 0.0770 | 2.3415 | 0.3861 | −0.3248 | 2.3415 |
| −0.3925 | 0.1553 | 2.3415 | 0.4442 | −0.3996 | 2.3415 |
| −0.4485 | 0.2350 | 2.3415 | 0.5023 | −0.4744 | 2.3415 |
| −0.5010 | 0.3130 | 2.3415 | 0.5586 | −0.5467 | 2.3415 |
| −0.5502 | 0.3894 | 2.3415 | 0.6130 | −0.6164 | 2.3415 |
| −0.5959 | 0.4641 | 2.3415 | 0.6657 | −0.6833 | 2.3415 |
| −0.6385 | 0.5370 | 2.3415 | 0.7167 | −0.7477 | 2.3415 |
| −0.6778 | 0.6079 | 2.3415 | 0.7661 | −0.8093 | 2.3415 |
| −0.7141 | 0.6767 | 2.3415 | 0.8138 | −0.8681 | 2.3415 |
| −0.7474 | 0.7435 | 2.3415 | 0.8598 | −0.9243 | 2.3415 |
| −0.7780 | 0.8081 | 2.3415 | 0.9022 | −0.9754 | 2.3415 |
| −0.8043 | 0.8674 | 2.3415 | 0.9407 | −1.0214 | 2.3415 |
| −0.8268 | 0.9213 | 2.3415 | 0.9751 | −1.0625 | 2.3415 |
| −0.8456 | 0.9697 | 2.3415 | 1.0055 | −1.0988 | 2.3415 |
| −0.8615 | 1.0157 | 2.3415 | 1.0320 | −1.1302 | 2.3415 |
| −0.8733 | 1.0563 | 2.3415 | 1.0544 | −1.1567 | 2.3415 |
| −0.8803 | 1.0880 | 2.3415 | 1.0736 | −1.1794 | 2.3415 |
| −0.8837 | 1.1137 | 2.3415 | 1.0899 | −1.1983 | 2.3415 |
| −0.8837 | 1.1331 | 2.3415 | 1.1033 | −1.2139 | 2.3415 |
| −0.8810 | 1.1475 | 2.3415 | 1.1139 | −1.2263 | 2.3415 |
| −0.8776 | 1.1548 | 2.3415 | 1.1221 | −1.2360 | 2.3415 |
| −0.8743 | 1.1588 | 2.3415 | 1.1270 | −1.2440 | 2.3415 |
| −0.8724 | 1.1605 | 2.3415 | 1.1276 | −1.2518 | 2.3415 |
| −0.8712 | 1.1613 | 2.3415 | 1.1257 | −1.2579 | 2.3415 |
| 1.0882 | −1.3247 | 2.7632 | −0.8436 | 1.1387 | 2.7632 |
| 1.0844 | −1.3276 | 2.7632 | −0.8430 | 1.1390 | 2.7632 |
| 1.0785 | −1.3298 | 2.7632 | −0.8418 | 1.1395 | 2.7632 |
| 1.0705 | −1.3293 | 2.7632 | −0.8394 | 1.1402 | 2.7632 |
| 1.0622 | −1.3244 | 2.7632 | −0.8343 | 1.1406 | 2.7632 |
| 1.0522 | −1.3164 | 2.7632 | −0.8264 | 1.1393 | 2.7632 |
| 1.0392 | −1.3060 | 2.7632 | −0.8133 | 1.1336 | 2.7632 |
| 1.0229 | −1.2928 | 2.7632 | −0.7975 | 1.1232 | 2.7632 |
| 1.0032 | −1.2769 | 2.7632 | −0.7781 | 1.1069 | 2.7632 |
| 0.9797 | −1.2579 | 2.7632 | −0.7557 | 1.0848 | 2.7632 |
| 0.9523 | −1.2356 | 2.7632 | −0.7282 | 1.0545 | 2.7632 |
| 0.9197 | −1.2093 | 2.7632 | −0.6976 | 1.0185 | 2.7632 |
| 0.8825 | −1.1787 | 2.7632 | −0.6659 | 0.9793 | 2.7632 |
| 0.8404 | −1.1438 | 2.7632 | −0.6307 | 0.9348 | 2.7632 |
| 0.7936 | −1.1046 | 2.7632 | −0.5920 | 0.8853 | 2.7632 |
| 0.7420 | −1.0610 | 2.7632 | −0.5495 | 0.8305 | 2.7632 |
| 0.6856 | −1.0131 | 2.7632 | −0.5053 | 0.7731 | 2.7632 |
| 0.6271 | −0.9628 | 2.7632 | −0.4591 | 0.7132 | 2.7632 |
| 0.5664 | −0.9103 | 2.7632 | −0.4111 | 0.6508 | 2.7632 |
| 0.5038 | −0.8551 | 2.7632 | −0.3612 | 0.5859 | 2.7632 |
| 0.4392 | −0.7974 | 2.7632 | −0.3095 | 0.5186 | 2.7632 |
| 0.3728 | −0.7368 | 2.7632 | −0.2555 | 0.4487 | 2.7632 |
| 0.3050 | −0.6734 | 2.7632 | −0.1996 | 0.3765 | 2.7632 |
| 0.2358 | −0.6069 | 2.7632 | −0.1416 | 0.3020 | 2.7632 |
| 0.1675 | −0.5394 | 2.7632 | −0.0835 | 0.2275 | 2.7632 |
| 0.1005 | −0.4708 | 2.7632 | −0.0253 | 0.1531 | 2.7632 |
| 0.0346 | −0.4010 | 2.7632 | 0.0329 | 0.0787 | 2.7632 |
| −0.0297 | −0.3298 | 2.7632 | 0.0909 | 0.0041 | 2.7632 |
| −0.0926 | −0.2573 | 2.7632 | 0.1486 | −0.0707 | 2.7632 |
| −0.1540 | −0.1833 | 2.7632 | 0.2058 | −0.1459 | 2.7632 |
| −0.2138 | −0.1078 | 2.7632 | 0.2626 | −0.2214 | 2.7632 |
| −0.2722 | −0.0309 | 2.7632 | 0.3191 | −0.2971 | 2.7632 |
| −0.3292 | 0.0473 | 2.7632 | 0.3754 | −0.3730 | 2.7632 |
| −0.3846 | 0.1268 | 2.7632 | 0.4317 | −0.4489 | 2.7632 |
| −0.4385 | 0.2074 | 2.7632 | 0.4879 | −0.5248 | 2.7632 |
| −0.4890 | 0.2864 | 2.7632 | 0.5424 | −0.5981 | 2.7632 |
| −0.5361 | 0.3635 | 2.7632 | 0.5952 | −0.6687 | 2.7632 |
| −0.5801 | 0.4390 | 2.7632 | 0.6462 | −0.7368 | 2.7632 |
| −0.6208 | 0.5124 | 2.7632 | 0.6955 | −0.8021 | 2.7632 |
| −0.6585 | 0.5839 | 2.7632 | 0.7432 | −0.8647 | 2.7632 |

TABLE 5-continued

| SUCTION SIDE | | | PRESSURE SIDE | | |
|---|---|---|---|---|---|
| X | Y | Z | X | Y | Z |
| −0.6933 | 0.6533 | 2.7632 | 0.7894 | −0.9246 | 2.7632 |
| −0.7253 | 0.7204 | 2.7632 | 0.8340 | −0.9818 | 2.7632 |
| −0.7547 | 0.7852 | 2.7632 | 0.8749 | −1.0337 | 2.7632 |
| −0.7799 | 0.8447 | 2.7632 | 0.9122 | −1.0805 | 2.7632 |
| −0.8016 | 0.8987 | 2.7632 | 0.9456 | −1.1223 | 2.7632 |
| −0.8196 | 0.9472 | 2.7632 | 0.9750 | −1.1593 | 2.7632 |
| −0.8349 | 0.9932 | 2.7632 | 1.0005 | −1.1913 | 2.7632 |
| −0.8463 | 1.0337 | 2.7632 | 1.0222 | −1.2182 | 2.7632 |
| −0.8530 | 1.0653 | 2.7632 | 1.0409 | −1.2413 | 2.7632 |
| −0.8562 | 1.0910 | 2.7632 | 1.0566 | −1.2606 | 2.7632 |
| −0.8563 | 1.1103 | 2.7632 | 1.0695 | −1.2764 | 2.7632 |
| −0.8538 | 1.1247 | 2.7632 | 1.0799 | −1.2892 | 2.7632 |
| −0.8505 | 1.1320 | 2.7632 | 1.0878 | −1.2989 | 2.7632 |
| −0.8473 | 1.1361 | 2.7632 | 1.0926 | −1.3070 | 2.7632 |
| −0.8453 | 1.1377 | 2.7632 | 1.0931 | −1.3148 | 2.7632 |
| −0.8442 | 1.1384 | 2.7632 | 1.0910 | −1.3209 | 2.7632 |
| 1.0594 | −1.3855 | 3.1848 | −0.8203 | 1.1093 | 3.1848 |
| 1.0555 | −1.3884 | 3.1848 | −0.8197 | 1.1096 | 3.1848 |
| 1.0495 | −1.3904 | 3.1848 | −0.8186 | 1.1101 | 3.1848 |
| 1.0417 | −1.3896 | 3.1848 | −0.8161 | 1.1107 | 3.1848 |
| 1.0337 | −1.3845 | 3.1848 | −0.8110 | 1.1109 | 3.1848 |
| 1.0237 | 1.3763 | 3.1848 | −0.8032 | 1.1092 | 3.1848 |
| 1.0110 | −1.3657 | 3.1848 | −0.7904 | 1.1030 | 3.1848 |
| 0.9951 | −1.3522 | 3.1848 | −0.7750 | 1.0920 | 3.1848 |
| 0.9757 | −1.3359 | 3.1848 | −0.7562 | 1.0753 | 3.1848 |
| 0.9527 | −1.3164 | 3.1848 | −0.7343 | 1.0527 | 3.1848 |
| 0.9259 | −1.2936 | 3.1848 | −0.7075 | 1.0219 | 3.1848 |
| 0.8942 | −1.2666 | 3.1848 | −0.6779 | 0.9853 | 3.1848 |
| 0.8577 | −1.2353 | 3.1848 | −0.6470 | 0.9456 | 3.1848 |
| 0.8166 | −1.1996 | 3.1848 | −0.6129 | 0.9006 | 3.1848 |
| 0.7709 | −1.1594 | 3.1848 | −0.5751 | 0.8504 | 3.1848 |
| 0.7205 | 1.1148 | 3.1848 | −0.5339 | 0.7949 | 3.1848 |
| 0.6655 | −1.0657 | 3.1848 | −0.4907 | 0.7369 | 3.1848 |
| 0.6084 | −1.0143 | 3.1848 | −0.4459 | 0.6763 | 3.1848 |
| 0.5491 | −0.9605 | 3.1848 | −0.3993 | 0.6131 | 3.1848 |
| 0.4879 | −0.9042 | 3.1848 | −0.3508 | 0.5474 | 3.1848 |
| 0.4249 | −0.8451 | 3.1848 | −0.3003 | 0.4792 | 3.1848 |
| 0.3603 | −0.7832 | 3.1848 | −0.2480 | 0.4085 | 3.1848 |
| 0.2942 | −0.7184 | 3.1848 | −0.1935 | 0.3355 | 3.1848 |
| 0.2267 | −0.6504 | 3.1848 | −0.1371 | 0.2600 | 3.1848 |
| 0.1603 | −0.5816 | 3.1848 | −0.0805 | 0.1847 | 3.1848 |
| 0.0952 | −0.5117 | 3.1848 | −0.0239 | 0.1093 | 3.1848 |
| 0.0312 | −0.4406 | 3.1848 | 0.0328 | 0.0340 | 3.1848 |
| −0.0314 | −0.3682 | 3.1848 | 0.0893 | −0.0414 | 3.1848 |
| −0.0923 | −0.2945 | 3.1848 | 0.1456 | −0.1170 | 3.1848 |
| −0.1518 | −0.2192 | 3.1848 | 0.2015 | −0.1929 | 3.1848 |
| −0.2097 | −0.1426 | 3.1848 | 0.2568 | −0.2691 | 3.1848 |
| −0.2662 | −0.0647 | 3.1848 | 0.3119 | −0.3456 | 3.1848 |
| −0.3213 | 0.0143 | 3.1848 | 0.3667 | −0.4223 | 3.1848 |
| −0.3750 | 0.0947 | 3.1848 | 0.4214 | −0.4990 | 3.1848 |
| −0.4271 | 0.1760 | 3.1848 | 0.4761 | −0.5757 | 3.1848 |
| −0.4759 | 0.2555 | 3.1848 | 0.5291 | −0.6499 | 3.1848 |
| −0.5216 | 0.3332 | 3.1848 | 0.5804 | −0.7214 | 3.1848 |
| −0.5641 | 0.4091 | 3.1848 | 0.6300 | −0.7902 | 3.1848 |
| −0.6036 | 0.4829 | 3.1848 | 0.6779 | −0.8563 | 3.1848 |
| −0.6401 | 0.5546 | 3.1848 | 0.7242 | −0.9198 | 3.1848 |
| −0.6739 | 0.6241 | 3.1848 | 0.7690 | −0.9805 | 3.1848 |
| −0.7049 | 0.6914 | 3.1848 | 0.8123 | −1.0383 | 3.1848 |
| −0.7333 | 0.7563 | 3.1848 | 0.8521 | −1.0909 | 3.1848 |
| −0.7580 | 0.8158 | 3.1848 | 0.8883 | −1.1383 | 3.1848 |
| −0.7790 | 0.8697 | 3.1848 | 0.9208 | −1.1807 | 3.1848 |
| −0.7965 | 0.9182 | 3.1848 | 0.9494 | −1.2181 | 3.1848 |
| −0.8115 | 0.9641 | 3.1848 | 0.9742 | −1.2506 | 3.1848 |
| −0.8227 | 1.0045 | 3.1848 | 0.9955 | −1.2779 | 3.1848 |
| −0.8293 | 1.0360 | 3.1848 | 1.0136 | −1.3012 | 3.1848 |
| −0.8325 | 1.0616 | 3.1848 | 1.0288 | −1.3208 | 3.1848 |
| −0.8327 | 1.0809 | 3.1848 | 1.0414 | −1.3369 | 3.1848 |
| −0.8304 | 1.0951 | 3.1848 | 1.0515 | −1.3497 | 3.1848 |
| −0.8272 | 1.1026 | 3.1848 | 1.0592 | −1.3596 | 3.1848 |
| −0.8240 | 1.1067 | 3.1848 | 1.0639 | −1.3677 | 3.1848 |
| −0.8220 | 1.1083 | 3.1848 | 1.0644 | −1.3757 | 3.1848 |
| −0.8209 | 1.1089 | 3.1848 | 1.0623 | −1.3817 | 3.1848 |
| 1.0443 | −1.4461 | 3.6065 | −0.8049 | 1.0815 | 3.6065 |
| 1.0404 | −1.4489 | 3.6065 | −0.8044 | 1.0818 | 3.6065 |
| 1.0343 | −1.4508 | 3.6065 | −0.8031 | 1.0822 | 3.6065 |
| 1.0265 | −1.4498 | 3.6065 | −0.8007 | 1.0828 | 3.6065 |

TABLE 5-continued

| SUCTION SIDE | | | PRESSURE SIDE | | |
|---|---|---|---|---|---|
| X | Y | Z | X | Y | Z |
| 1.0186 | −1.4444 | 3.6065 | −0.7956 | 1.0828 | 3.6065 |
| 1.0088 | −1.4360 | 3.6065 | −0.7879 | 1.0808 | 3.6065 |
| 0.9963 | −1.4251 | 3.6065 | −0.7752 | 1.0741 | 3.6065 |
| 0.9806 | −1.4114 | 3.6065 | −0.7602 | 1.0626 | 3.6065 |
| 0.9615 | −1.3946 | 3.6065 | −0.7418 | 1.0453 | 3.6065 |
| 0.9389 | −1.3747 | 3.6065 | −0.7204 | 1.0221 | 3.6065 |
| 0.9125 | −1.3513 | 3.6065 | −0.6943 | 0.9906 | 3.6065 |
| 0.8812 | −1.3237 | 3.6065 | −0.6652 | 0.9534 | 3.6065 |
| 0.8453 | −1.2916 | 3.6065 | −0.6352 | 0.9131 | 3.6065 |
| 0.8049 | −1.2550 | 3.6065 | −0.6017 | 0.8674 | 3.6065 |
| 0.7598 | −1.2140 | 3.6065 | −0.5647 | 0.8163 | 3.6065 |
| 0.7103 | −1.1683 | 3.6065 | −0.5241 | 0.7601 | 3.6065 |
| 0.6562 | −1.1183 | 3.6065 | −0.4819 | 0.7014 | 3.6065 |
| 0.5999 | −1.0657 | 3.6065 | −0.4379 | 0.6399 | 3.6065 |
| 0.5416 | −1.0107 | 3.6065 | −0.3922 | 0.5758 | 3.6065 |
| 0.4814 | −0.9531 | 3.6065 | −0.3446 | 0.5092 | 3.6065 |
| 0.4194 | −0.8928 | 3.6065 | −0.2950 | 0.4401 | 3.6065 |
| 0.3560 | −0.8296 | 3.6065 | −0.2436 | 0.3685 | 3.6065 |
| 0.2910 | −0.7635 | 3.6065 | −0.1901 | 0.2945 | 3.6065 |
| 0.2248 | −0.6943 | 3.6065 | −0.1347 | 0.2180 | 3.6065 |
| 0.1596 | −0.6241 | 3.6065 | −0.0791 | 0.1416 | 3.6065 |
| 0.0955 | −0.5529 | 3.6065 | −0.0234 | 0.0653 | 3.6065 |
| 0.0328 | −0.4806 | 3.6065 | 0.0324 | −0.0109 | 3.6065 |
| −0.0285 | −0.4069 | 3.6065 | 0.0881 | −0.0872 | 3.6065 |
| −0.0882 | −0.3319 | 3.6065 | 0.1436 | −0.1637 | 3.6065 |
| −0.1464 | −0.2555 | 3.6065 | 0.1985 | −0.2405 | 3.6065 |
| −0.2030 | −0.1779 | 3.6065 | 0.2532 | −0.3176 | 3.6065 |
| −0.2583 | −0.0989 | 3.6065 | 0.3075 | −0.3948 | 3.6065 |
| −0.3123 | −0.0189 | 3.6065 | 0.3615 | −0.4724 | 3.6065 |
| −0.3649 | 0.0622 | 3.6065 | 0.4155 | −0.5500 | 3.6065 |
| −0.4160 | 0.1442 | 3.6065 | 0.4693 | −0.6275 | 3.6065 |
| −0.4639 | 0.2244 | 3.6065 | 0.5215 | −0.7025 | 3.6065 |
| −0.5087 | 0.3028 | 3.6065 | 0.5721 | −0.7747 | 3.6065 |
| −0.5505 | 0.3791 | 3.6065 | 0.6208 | −0.8444 | 3.6065 |
| −0.5892 | 0.4533 | 3.6065 | 0.6681 | −0.9113 | 3.6065 |
| −0.6252 | 0.5254 | 3.6065 | 0.7137 | −0.9754 | 3.6065 |
| −0.6584 | 0.5952 | 3.6065 | 0.7579 | −1.0368 | 3.6065 |
| −0.6891 | 0.6627 | 3.6065 | 0.8005 | −1.0953 | 3.6065 |
| −0.7172 | 0.7278 | 3.6065 | 0.8397 | −1.1485 | 3.6065 |
| −0.7415 | 0.7875 | 3.6065 | 0.8755 | −1.1965 | 3.6065 |
| −0.7625 | 0.8415 | 3.6065 | 0.9075 | −1.2394 | 3.6065 |
| −0.7799 | 0.8901 | 3.6065 | 0.9358 | −1.2773 | 3.6065 |
| −0.7948 | 0.9360 | 3.6065 | 0.9604 | −1.3100 | 3.6065 |
| −0.8061 | 0.9764 | 3.6065 | 0.9812 | −1.3376 | 3.6065 |
| −0.8128 | 1.0080 | 3.6065 | 0.9991 | −1.3612 | 3.6065 |
| −0.8162 | 1.0336 | 3.6065 | 1.0142 | −1.3810 | 3.6065 |
| −0.8167 | 1.0529 | 3.6065 | 1.0266 | −1.3974 | 3.6065 |
| −0.8146 | 1.0672 | 3.6065 | 1.0366 | −1.4104 | 3.6065 |
| −0.8117 | 1.0747 | 3.6065 | 1.0442 | −1.4204 | 3.6065 |
| −0.8086 | 1.0788 | 3.6065 | 1.0489 | −1.4285 | 3.6065 |
| −0.8066 | 1.0805 | 3.6065 | 1.0495 | −1.4364 | 3.6065 |
| −0.8055 | 1.0812 | 3.6065 | 1.0473 | −1.4423 | 3.6065 |
| 1.0475 | −1.5118 | 4.0282 | −0.8012 | 1.0636 | 4.0282 |
| 1.0436 | −1.5146 | 4.0282 | −0.8006 | 1.0638 | 4.0282 |
| 1.0373 | −1.5163 | 4.0282 | −0.7994 | 1.0643 | 4.0282 |
| 1.0294 | −1.5150 | 4.0282 | −0.7968 | 1.0649 | 4.0282 |
| 1.0216 | −1.5093 | 4.0282 | −0.7917 | 1.0647 | 4.0282 |
| 1.0120 | −1.5006 | 4.0282 | −0.7840 | 1.0622 | 4.0282 |
| 0.9993 | −1.4894 | 4.0282 | −0.7715 | 1.0549 | 4.0282 |
| 0.9837 | −1.4753 | 4.0282 | −0.7567 | 1.0428 | 4.0282 |
| 0.9647 | −1.4581 | 4.0282 | −0.7385 | 1.0248 | 4.0282 |
| 0.9421 | −1.4376 | 4.0282 | −0.7175 | 1.0008 | 4.0282 |
| 0.9158 | −1.4137 | 4.0282 | −0.6916 | 0.9686 | 4.0282 |
| 0.8846 | −1.3852 | 4.0282 | −0.6629 | 0.9304 | 4.0282 |
| 0.8489 | −1.3523 | 4.0282 | −0.6331 | 0.8892 | 4.0282 |
| 0.8085 | −1.3147 | 4.0282 | −0.5998 | 0.8424 | 4.0282 |
| 0.7636 | −1.2726 | 4.0282 | −0.5631 | 0.7903 | 4.0282 |
| 0.7142 | −1.2258 | 4.0282 | −0.5228 | 0.7329 | 4.0282 |
| 0.6602 | −1.1743 | 4.0282 | −0.4808 | 0.6729 | 4.0282 |
| 0.6041 | −1.1204 | 4.0282 | −0.4371 | 0.6102 | 4.0282 |
| 0.5460 | −1.0640 | 4.0282 | −0.3915 | 0.5448 | 4.0282 |
| 0.4861 | −1.0049 | 4.0282 | −0.3441 | 0.4769 | 4.0282 |
| 0.4244 | −0.9430 | 4.0282 | −0.2948 | 0.4063 | 4.0282 |
| 0.3612 | −0.8783 | 4.0282 | −0.2436 | 0.3333 | 4.0282 |
| 0.2964 | −0.8105 | 4.0282 | −0.1903 | 0.2578 | 4.0282 |
| 0.2305 | −0.7396 | 4.0282 | −0.1351 | 0.1799 | 4.0282 |

TABLE 5-continued

| SUCTION SIDE | | | PRESSURE SIDE | | |
|---|---|---|---|---|---|
| X | Y | Z | X | Y | Z |
| 0.1656 | −0.6677 | 4.0282 | −0.0795 | 0.1020 | 4.0282 |
| 0.1019 | −0.5948 | 4.0282 | −0.0240 | 0.0242 | 4.0282 |
| 0.0394 | −0.5207 | 4.0282 | 0.0318 | −0.0534 | 4.0282 |
| −0.0215 | −0.4455 | 4.0282 | 0.0875 | −0.1311 | 4.0282 |
| −0.0809 | −0.3688 | 4.0282 | 0.1431 | −0.2089 | 4.0282 |
| −0.1387 | −0.2908 | 4.0282 | 0.1983 | −0.2869 | 4.0282 |
| −0.1951 | −0.2116 | 4.0282 | 0.2531 | −0.3653 | 4.0282 |
| −0.2502 | −0.1312 | 4.0282 | 0.3075 | −0.4439 | 4.0282 |
| −0.3040 | −0.0497 | 4.0282 | 0.3616 | −0.5226 | 4.0282 |
| −0.3564 | 0.0326 | 4.0282 | 0.4157 | −0.6015 | 4.0282 |
| −0.4074 | 0.1158 | 4.0282 | 0.4697 | −0.6803 | 4.0282 |
| −0.4552 | 0.1972 | 4.0282 | 0.5221 | −0.7565 | 4.0282 |
| −0.5000 | 0.2765 | 4.0282 | 0.5727 | −0.8299 | 4.0282 |
| −0.5418 | 0.3539 | 4.0282 | 0.6218 | −0.9007 | 4.0282 |
| −0.5806 | 0.4291 | 4.0282 | 0.6691 | −0.9687 | 4.0282 |
| −0.6169 | 0.5019 | 4.0282 | 0.7149 | −1.0337 | 4.0282 |
| −0.6503 | 0.5725 | 4.0282 | 0.7593 | −1.0961 | 4.0282 |
| −0.6812 | 0.6407 | 4.0282 | 0.8021 | −1.1556 | 4.0282 |
| −0.7096 | 0.7065 | 4.0282 | 0.8415 | −1.2097 | 4.0282 |
| −0.7343 | 0.7667 | 4.0282 | 0.8774 | −1.2585 | 4.0282 |
| −0.7554 | 0.8213 | 4.0282 | 0.9095 | −1.3020 | 4.0282 |
| −0.7732 | 0.8703 | 4.0282 | 0.9380 | −1.3405 | 4.0282 |
| −0.7885 | 0.9166 | 4.0282 | 0.9627 | −1.3737 | 4.0282 |
| −0.8002 | 0.9573 | 4.0282 | 0.9838 | −1.4018 | 4.0282 |
| −0.8074 | 0.9891 | 4.0282 | 1.0018 | −1.4257 | 4.0282 |
| −0.8112 | 1.0149 | 4.0282 | 1.0169 | −1.4458 | 4.0282 |
| −0.8121 | 1.0343 | 4.0282 | 1.0293 | −1.4623 | 4.0282 |
| −0.8105 | 1.0488 | 4.0282 | 1.0393 | −1.4756 | 4.0282 |
| −0.8079 | 1.0566 | 4.0282 | 1.0470 | −1.4857 | 4.0282 |
| −0.8048 | 1.0608 | 4.0282 | 1.0520 | −1.4939 | 4.0282 |
| −0.8029 | 1.0625 | 4.0282 | 1.0527 | −1.5019 | 4.0282 |
| −0.8018 | 1.0633 | 4.0282 | 1.0505 | −1.5080 | 4.0282 |
| 1.0633 | −1.5713 | 4.4498 | −0.8093 | 1.0589 | 4.4498 |
| 1.0592 | −1.5740 | 4.4498 | −0.8086 | 1.0592 | 4.4498 |
| 1.0529 | 1.5756 | 4.4498 | −0.8074 | 1.0597 | 4.4498 |
| 1.0449 | −1.5740 | 4.4498 | −0.8048 | 1.0602 | 4.4498 |
| 1.0371 | −1.5680 | 4.4498 | −0.7996 | 1.0597 | 4.4498 |
| 1.0273 | −1.5591 | 4.4498 | −0.7919 | 1.0569 | 4.4498 |
| 1.0147 | −1.5475 | 4.4498 | −0.7795 | 1.0490 | 4.4498 |
| 0.9988 | −1.5331 | 4.4498 | −0.7647 | 1.0363 | 4.4498 |
| 0.9797 | −1.5154 | 4.4498 | −0.7466 | 1.0175 | 4.4498 |
| 0.9570 | −1.4944 | 4.4498 | −0.7256 | 0.9928 | 4.4498 |
| 0.9304 | −1.4697 | 4.4498 | −0.6998 | 0.9596 | 4.4498 |
| 0.8991 | −1.4405 | 4.4498 | −0.6710 | 0.9204 | 4.4498 |
| 0.8630 | −1.4067 | 4.4498 | −0.6409 | 0.8780 | 4.4498 |
| 0.8223 | −1.3681 | 4.4498 | −0.6075 | 0.8301 | 4.4498 |
| 0.7770 | −1.3249 | 4.4498 | −0.5705 | 0.7768 | 4.4498 |
| 0.7271 | −1.2769 | 4.4498 | −0.5300 | 0.7181 | 4.4498 |
| 0.6728 | −1.2241 | 4.4498 | −0.4877 | 0.6566 | 4.4498 |
| 0.6163 | −1.1687 | 4.4498 | −0.4436 | 0.5923 | 4.4498 |
| 0.5577 | −1.1108 | 4.4498 | −0.3977 | 0.5255 | 4.4498 |
| 0.4973 | −1.0502 | 4.4498 | −0.3498 | 0.4559 | 4.4498 |
| 0.4353 | −0.9867 | 4.4498 | −0.3001 | 0.3839 | 4.4498 |
| 0.3716 | −0.9202 | 4.4498 | −0.2484 | 0.3092 | 4.4498 |
| 0.3064 | −0.8506 | 4.4498 | −0.1947 | 0.2319 | 4.4498 |
| 0.2400 | −0.7779 | 4.4498 | −0.1388 | 0.1521 | 4.4498 |
| 0.1747 | −0.7041 | 4.4498 | −0.0828 | 0.0725 | 4.4498 |
| 0.1105 | −0.6294 | 4.4498 | −0.0266 | −0.0069 | 4.4498 |
| 0.0477 | −0.5535 | 4.4498 | 0.0299 | −0.0862 | 4.4498 |
| −0.0136 | −0.4762 | 4.4498 | 0.0864 | −0.1654 | 4.4498 |
| −0.0734 | −0.3977 | 4.4498 | 0.1427 | −0.2449 | 4.4498 |
| −0.1317 | −0.3179 | 4.4498 | 0.1987 | −0.3245 | 4.4498 |
| −0.1885 | −0.2368 | 4.4498 | 0.2544 | −0.4043 | 4.4498 |
| −0.2442 | −0.1548 | 4.4498 | 0.3097 | −0.4845 | 4.4498 |
| −0.2985 | −0.0718 | 4.4498 | 0.3646 | −0.5648 | 4.4498 |
| −0.3515 | 0.0122 | 4.4498 | 0.4196 | −0.6451 | 4.4498 |
| −0.4030 | 0.0969 | 4.4498 | 0.4746 | −0.7254 | 4.4498 |
| −0.4515 | 0.1797 | 4.4498 | 0.5279 | −0.8030 | 4.4498 |
| −0.4970 | 0.2603 | 4.4498 | 0.5794 | −0.8778 | 4.4498 |
| −0.5394 | 0.3389 | 4.4498 | 0.6293 | −0.9499 | 4.4498 |
| −0.5791 | 0.4152 | 4.4498 | 0.6775 | −1.0190 | 4.4498 |
| −0.6160 | 0.4892 | 4.4498 | 0.7242 | −1.0854 | 4.4498 |
| −0.6502 | 0.5608 | 4.4498 | 0.7694 | −1.1489 | 4.4498 |
| −0.6818 | 0.6301 | 4.4498 | 0.8129 | −1.2095 | 4.4498 |
| −0.7111 | 0.6967 | 4.4498 | 0.8530 | −1.2645 | 4.4498 |
| −0.7365 | 0.7578 | 4.4498 | 0.8895 | −1.3143 | 4.4498 |

TABLE 5-continued

| SUCTION SIDE | | | PRESSURE SIDE | | |
|---|---|---|---|---|---|
| X | Y | Z | X | Y | Z |
| −0.7585 | 0.8131 | 4.4498 | 0.9224 | −1.3586 | 4.4498 |
| −0.7770 | 0.8627 | 4.4498 | 0.9514 | −1.3976 | 4.4498 |
| −0.7930 | 0.9096 | 4.4498 | 0.9767 | −1.4314 | 4.4498 |
| −0.8054 | 0.9508 | 4.4498 | 0.9981 | −1.4600 | 4.4498 |
| −0.8132 | 0.9830 | 4.4498 | 1.0164 | −1.4843 | 4.4498 |
| −0.8178 | 1.0091 | 4.4498 | 1.0319 | −1.5048 | 4.4498 |
| −0.8192 | 1.0288 | 4.4498 | 1.0446 | −1.5216 | 4.4498 |
| −0.8180 | 1.0437 | 4.4498 | 1.0548 | −1.5351 | 4.4498 |
| −0.8157 | 1.0517 | 4.4498 | 1.0627 | −1.5454 | 4.4498 |
| −0.8129 | 1.0561 | 4.4498 | 1.0678 | −1.5535 | 4.4498 |
| −0.8110 | 1.0579 | 4.4498 | 1.0685 | −1.5615 | 4.4498 |
| −0.8098 | 1.0586 | 4.4498 | 1.0663 | −1.5675 | 4.4498 |
| 1.0815 | −1.6093 | 4.8715 | −0.8228 | 1.0625 | 4.8715 |
| 1.0773 | −1.6120 | 4.8715 | −0.8221 | 1.0628 | 4.8715 |
| 1.0708 | −1.6135 | 4.8715 | −0.8209 | 1.0633 | 4.8715 |
| 1.0628 | −1.6116 | 4.8715 | −0.8182 | 1.0636 | 4.8715 |
| 1.0551 | −1.6053 | 4.8715 | −0.8129 | 1.0630 | 4.8715 |
| 1.0453 | −1.5962 | 4.8715 | −0.8052 | 1.0599 | 4.8715 |
| 1.0325 | −1.5844 | 4.8715 | −0.7929 | 1.0515 | 4.8715 |
| 1.0166 | −1.5696 | 4.8715 | −0.7781 | 1.0383 | 4.8715 |
| 0.9972 | −1.5516 | 4.8715 | −0.7600 | 1.0189 | 4.8715 |
| 0.9743 | −1.5301 | 4.8715 | −0.7390 | 0.9937 | 4.8715 |
| 0.9475 | −1.5049 | 4.8715 | −0.7130 | 0.9597 | 4.8715 |
| 0.9159 | −1.4750 | 4.8715 | −0.6838 | 0.9197 | 4.8715 |
| 0.8796 | −1.4405 | 4.8715 | −0.6534 | 0.8766 | 4.8715 |
| 0.8386 | −1.4011 | 4.8715 | −0.6197 | 0.8278 | 4.8715 |
| 0.7929 | −1.3570 | 4.8715 | −0.5822 | 0.7735 | 4.8715 |
| 0.7426 | −1.3079 | 4.8715 | −0.5412 | 0.7138 | 4.8715 |
| 0.6877 | −1.2541 | 4.8715 | −0.4984 | 0.6512 | 4.8715 |
| 0.6307 | −1.1976 | 4.8715 | −0.4537 | 0.5859 | 4.8715 |
| 0.5718 | −1.1384 | 4.8715 | −0.4072 | 0.5179 | 4.8715 |
| 0.5109 | −1.0765 | 4.8715 | −0.3586 | 0.4473 | 4.8715 |
| 0.4483 | −1.0116 | 4.8715 | −0.3081 | 0.3740 | 4.8715 |
| 0.3842 | −0.9438 | 4.8715 | −0.2557 | 0.2981 | 4.8715 |
| 0.3184 | −0.8728 | 4.8715 | −0.2012 | 0.2195 | 4.8715 |
| 0.2515 | −0.7986 | 4.8715 | −0.1445 | 0.1385 | 4.8715 |
| 0.1855 | −0.7234 | 4.8715 | −0.0876 | 0.0575 | 4.8715 |
| 0.1207 | −0.6472 | 4.8715 | −0.0306 | −0.0232 | 4.8715 |
| 0.0573 | −0.5699 | 4.8715 | 0.0268 | −0.1038 | 4.8715 |
| −0.0045 | −0.4912 | 4.8715 | 0.0842 | −0.1843 | 4.8715 |
| −0.0650 | −0.4113 | 4.8715 | 0.1417 | −0.2648 | 4.8715 |
| −0.1239 | −0.3301 | 4.8715 | 0.1987 | −0.3456 | 4.8715 |
| −0.1816 | −0.2478 | 4.8715 | 0.2554 | −0.4266 | 4.8715 |
| −0.2381 | −0.1645 | 4.8715 | 0.3117 | −0.5078 | 4.8715 |
| −0.2931 | −0.0804 | 4.8715 | 0.3679 | −0.5892 | 4.8715 |
| −0.3470 | 0.0046 | 4.8715 | 0.4240 | −0.6707 | 4.8715 |
| −0.3995 | 0.0905 | 4.8715 | 0.4801 | −0.7521 | 4.8715 |
| −0.4490 | 0.1742 | 4.8715 | 0.5344 | −0.8308 | 4.8715 |
| −0.4956 | 0.2558 | 4.8715 | 0.5870 | −0.9066 | 4.8715 |
| −0.5391 | 0.3351 | 4.8715 | 0.6379 | −0.9796 | 4.8715 |
| −0.5799 | 0.4122 | 4.8715 | 0.6871 | −1.0498 | 4.8715 |
| −0.6179 | 0.4870 | 4.8715 | 0.7348 | −1.1170 | 4.8715 |
| −0.6533 | 0.5593 | 4.8715 | 0.7809 | −1.1813 | 4.8715 |
| −0.6860 | 0.6291 | 4.8715 | 0.8254 | −1.2427 | 4.8715 |
| −0.7163 | 0.6965 | 4.8715 | 0.8663 | −1.2985 | 4.8715 |
| −0.7429 | 0.7580 | 4.8715 | 0.9035 | −1.3489 | 4.8715 |
| −0.7659 | 0.8139 | 4.8715 | 0.9370 | −1.3939 | 4.8715 |
| −0.7853 | 0.8640 | 4.8715 | 0.9666 | −1.4334 | 4.8715 |
| −0.8023 | 0.9113 | 4.8715 | 0.9923 | −1.4676 | 4.8715 |
| −0.8156 | 0.9528 | 4.8715 | 1.0142 | −1.4966 | 4.8715 |
| −0.8242 | 0.9853 | 4.8715 | 1.0330 | −1.5213 | 4.8715 |
| −0.8294 | 1.0116 | 4.8715 | 1.0488 | −1.5419 | 4.8715 |
| −0.8315 | 1.0317 | 4.8715 | 1.0619 | −1.5589 | 4.8715 |
| −0.8310 | 1.0467 | 4.8715 | 1.0723 | −1.5725 | 4.8715 |
| −0.8290 | 1.0549 | 4.8715 | 1.0804 | −1.5830 | 4.8715 |
| −0.8263 | 1.0595 | 4.8715 | 1.0858 | −1.5911 | 4.8715 |
| −0.8245 | 1.0614 | 4.8715 | 1.0868 | −1.5992 | 4.8715 |
| −0.8233 | 1.0621 | 4.8715 | 1.0847 | −1.6055 | 4.8715 |
| 1.0962 | −1.6267 | 5.2932 | −0.8358 | 1.0752 | 5.2932 |
| 1.0919 | −1.6295 | 5.2932 | −0.8351 | 1.0755 | 5.2932 |
| 1.0854 | −1.6309 | 5.2932 | −0.8339 | 1.0759 | 5.2932 |
| 1.0773 | −1.6287 | 5.2932 | −0.8311 | 1.0763 | 5.2932 |
| 1.0697 | −1.6221 | 5.2932 | −0.8259 | 1.0755 | 5.2932 |
| 1.0598 | −1.6129 | 5.2932 | −0.8181 | 1.0720 | 5.2932 |
| 1.0470 | −1.6008 | 5.2932 | −0.8059 | 1.0633 | 5.2932 |
| 1.0310 | −1.5858 | 5.2932 | −0.7912 | 1.0496 | 5.2932 |

TABLE 5-continued

| SUCTION SIDE | | | PRESSURE SIDE | | |
|---|---|---|---|---|---|
| X | Y | Z | X | Y | Z |
| 1.0116 | −1.5675 | 5.2932 | −0.7731 | 1.0299 | 5.2932 |
| 0.9885 | −1.5456 | 5.2932 | −0.7520 | 1.0041 | 5.2932 |
| 0.9616 | −1.5200 | 5.2932 | −0.7258 | 0.9696 | 5.2932 |
| 0.9299 | −1.4896 | 5.2932 | −0.6965 | 0.9291 | 5.2932 |
| 0.8934 | −1.4544 | 5.2932 | −0.6658 | 0.8854 | 5.2932 |
| 0.8521 | −1.4144 | 5.2932 | −0.6317 | 0.8361 | 5.2932 |
| 0.8062 | −1.3695 | 5.2932 | −0.5938 | 0.7811 | 5.2932 |
| 0.7556 | −1.3197 | 5.2932 | −0.5523 | 0.7205 | 5.2932 |
| 0.7005 | −1.2649 | 5.2932 | −0.5090 | 0.6572 | 5.2932 |
| 0.6433 | −1.2075 | 5.2932 | −0.4638 | 0.5911 | 5.2932 |
| 0.5840 | −1.1473 | 5.2932 | −0.4166 | 0.5223 | 5.2932 |
| 0.5229 | −1.0844 | 5.2932 | −0.3676 | 0.4508 | 5.2932 |
| 0.4600 | −1.0185 | 5.2932 | −0.3164 | 0.3767 | 5.2932 |
| 0.3955 | −0.9495 | 5.2932 | −0.2632 | 0.2999 | 5.2932 |
| 0.3295 | −0.8775 | 5.2932 | −0.2080 | 0.2205 | 5.2932 |
| 0.2620 | −0.8020 | 5.2932 | −0.1506 | 0.1386 | 5.2932 |
| 0.1957 | −0.7257 | 5.2932 | −0.0930 | 0.0567 | 5.2932 |
| 0.1305 | −0.6484 | 5.2932 | −0.0351 | −0.0249 | 5.2932 |
| 0.0668 | −0.5699 | 5.2932 | 0.0230 | −0.1064 | 5.2932 |
| 0.0043 | −0.4901 | 5.2932 | 0.0813 | −0.1878 | 5.2932 |
| −0.0566 | −0.4091 | 5.2932 | 0.1396 | −0.2692 | 5.2932 |
| −0.1161 | −0.3268 | 5.2932 | 0.1976 | −0.3507 | 5.2932 |
| −0.1744 | −0.2436 | 5.2932 | 0.2552 | −0.4326 | 5.2932 |
| −0.2316 | −0.1595 | 5.2932 | 0.3126 | −0.5145 | 5.2932 |
| −0.2875 | −0.0746 | 5.2932 | 0.3697 | −0.5968 | 5.2932 |
| −0.3421 | 0.0110 | 5.2932 | 0.4268 | −0.6790 | 5.2932 |
| −0.3956 | 0.0974 | 5.2932 | 0.4839 | −0.7612 | 5.2932 |
| −0.4460 | 0.1818 | 5.2932 | 0.5390 | −0.8406 | 5.2932 |
| −0.4936 | 0.2639 | 5.2932 | 0.5926 | −0.9172 | 5.2932 |
| −0.5383 | 0.3438 | 5.2932 | 0.6444 | −0.9909 | 5.2932 |
| −0.5801 | 0.4213 | 5.2932 | 0.6945 | −1.0617 | 5.2932 |
| −0.6192 | 0.4964 | 5.2932 | 0.7430 | −1.1296 | 5.2932 |
| −0.6557 | 0.5691 | 5.2932 | 0.7898 | −1.1945 | 5.2932 |
| −0.6896 | 0.6394 | 5.2932 | 0.8350 | −1.2564 | 5.2932 |
| −0.7210 | 0.7070 | 5.2932 | 0.8766 | −1.3128 | 5.2932 |
| −0.7486 | 0.7689 | 5.2932 | 0.9144 | −1.3637 | 5.2932 |
| −0.7726 | 0.8250 | 5.2932 | 0.9485 | −1.4091 | 5.2932 |
| −0.7930 | 0.8752 | 5.2932 | 0.9786 | −1.4490 | 5.2932 |
| −0.8110 | 0.9227 | 5.2932 | 1.0048 | −1.4836 | 5.2932 |
| −0.8252 | 0.9645 | 5.2932 | 1.0271 | −1.5128 | 5.2932 |
| −0.8346 | 0.9971 | 5.2932 | 1.0461 | −1.5377 | 5.2932 |
| −0.8406 | 1.0236 | 5.2932 | 1.0622 | −1.5585 | 5.2932 |
| −0.8432 | 1.0437 | 5.2932 | 1.0755 | −1.5757 | 5.2932 |
| −0.8433 | 1.0509 | 5.2932 | 1.0862 | −1.5894 | 5.2932 |
| −0.8417 | 1.0672 | 5.2932 | 1.0944 | −1.6000 | 5.2932 |
| −0.8393 | 1.0720 | 5.2932 | 1.1001 | −1.6081 | 5.2932 |
| −0.8375 | 1.0741 | 5.2932 | 1.1015 | −1.6164 | 5.2932 |
| −0.8363 | 1.0749 | 5.2932 | 1.0994 | −1.6228 | 5.2932 |
| 1.0975 | −1.6250 | 5.5040 | −0.8394 | 1.0865 | 5.5040 |
| 1.0933 | −1.6278 | 5.5040 | −0.8387 | 1.0868 | 5.5040 |
| 1.0867 | −1.6292 | 5.5040 | −0.8374 | 1.0871 | 5.5040 |
| 1.0786 | −1.6269 | 5.5040 | −0.8347 | 1.0875 | 5.5040 |
| 1.0710 | −1.6202 | 5.5040 | −0.8294 | 1.0866 | 5.5040 |
| 1.0612 | −1.6109 | 5.5040 | −0.8217 | 1.0830 | 5.5040 |
| 1.0484 | −1.5988 | 5.5040 | −0.8095 | 1.0740 | 5.5040 |
| 1.0323 | −1.5837 | 5.5040 | −0.7949 | 1.0602 | 5.5040 |
| 1.0129 | −1.5652 | 5.5040 | −0.7769 | 1.0403 | 5.5040 |
| 0.9899 | −1.5433 | 5.5040 | −0.7559 | 1.0144 | 5.5040 |
| 0.9630 | −1.5175 | 5.5040 | −0.7298 | 0.9797 | 5.5040 |
| 0.9312 | −1.4870 | 5.5040 | −0.7004 | 0.9390 | 5.5040 |
| 0.8948 | −1.4516 | 5.5040 | −0.6698 | 0.8950 | 5.5040 |
| 0.8535 | −1.4113 | 5.5040 | −0.6356 | 0.8455 | 5.5040 |
| 0.8076 | −1.3662 | 5.5040 | −0.5978 | 0.7902 | 5.5040 |
| 0.7571 | −1.3161 | 5.5040 | −0.5562 | 0.7295 | 5.5040 |
| 0.7020 | −1.2610 | 5.5040 | −0.5128 | 0.6659 | 5.5040 |
| 0.6449 | −1.2031 | 5.5040 | −0.4675 | 0.5996 | 5.5040 |
| 0.5857 | −1.1426 | 5.5040 | −0.4204 | 0.5305 | 5.5040 |
| 0.5247 | −1.0793 | 5.5040 | −0.3711 | 0.4588 | 5.5040 |
| 0.4619 | −1.0130 | 5.5040 | −0.3199 | 0.3843 | 5.5040 |
| 0.3975 | −0.9436 | 5.5040 | −0.2666 | 0.3072 | 5.5040 |
| 0.3315 | −0.8710 | 5.5040 | −0.2114 | 0.2275 | 5.5040 |
| 0.2642 | −0.7952 | 5.5040 | −0.1538 | 0.1453 | 5.5040 |
| 0.1980 | −0.7183 | 5.5040 | −0.0960 | 0.0631 | 5.5040 |
| 0.1330 | −0.6406 | 5.5040 | −0.0380 | −0.0188 | 5.5040 |
| 0.0692 | −0.5617 | 5.5040 | 0.0202 | −0.1005 | 5.5040 |
| 0.0069 | −0.4815 | 5.5040 | 0.0787 | −0.1822 | 5.5040 |

TABLE 5-continued

| SUCTION SIDE | | | PRESSURE SIDE | | |
|---|---|---|---|---|---|
| X | Y | Z | X | Y | Z |
| −0.0540 | −0.4000 | 5.5040 | 0.1371 | −0.2638 | 5.5040 |
| −0.1136 | −0.3175 | 5.5040 | 0.1954 | −0.3456 | 5.5040 |
| −0.1719 | −0.2339 | 5.5040 | 0.2532 | −0.4276 | 5.5040 |
| −0.2291 | −0.1496 | 5.5040 | 0.3109 | −0.5099 | 5.5040 |
| −0.2851 | −0.0646 | 5.5040 | 0.3682 | −0.5922 | 5.5040 |
| −0.3400 | 0.0213 | 5.5040 | 0.4254 | −0.6748 | 5.5040 |
| −0.3937 | 0.1079 | 5.5040 | 0.4826 | −0.7572 | 5.5040 |
| −0.4443 | 0.1924 | 5.5040 | 0.5381 | −0.8369 | 5.5040 |
| −0.4921 | 0.2746 | 5.5040 | 0.5919 | −0.9137 | 5.5040 |
| −0.5371 | 0.3545 | 5.5040 | 0.6438 | −0.9876 | 5.5040 |
| −0.5792 | 0.4322 | 5.5040 | 0.6941 | −1.0586 | 5.5040 |
| −0.6186 | 0.5073 | 5.5040 | 0.7427 | −1.1267 | 5.5040 |
| −0.6554 | 0.5801 | 5.5040 | 0.7897 | −1.1917 | 5.5040 |
| −0.6897 | 0.6503 | 5.5040 | 0.8352 | −1.2539 | 5.5040 |
| −0.7215 | 0.7180 | 5.5040 | 0.8769 | −1.3105 | 5.5040 |
| −0.7495 | 0.7799 | 5.5040 | 0.9149 | −1.3615 | 5.5040 |
| −0.7738 | 0.8361 | 5.5040 | 0.9490 | −1.4070 | 5.5040 |
| −0.7946 | 0.8862 | 5.5040 | 0.9792 | −1.4471 | 5.5040 |
| −0.8128 | 0.9338 | 5.5040 | 1.0056 | −1.4817 | 5.5040 |
| −0.8274 | 0.9756 | 5.5040 | 1.0279 | −1.5109 | 5.5040 |
| −0.8371 | 1.0081 | 5.5040 | 1.0470 | −1.5359 | 5.5040 |
| −0.8433 | 1.0346 | 5.5040 | 1.0633 | −1.5568 | 5.5040 |
| −0.8462 | 1.0547 | 5.5040 | 1.0766 | −1.5740 | 5.5040 |
| −0.8466 | 1.0700 | 5.5040 | 1.0873 | −1.5877 | 5.5040 |
| −0.8451 | 1.0784 | 5.5040 | 1.0956 | −1.5983 | 5.5040 |
| −0.8428 | 1.0833 | 5.5040 | 1.1015 | −1.6064 | 5.5040 |
| −0.8411 | 1.0852 | 5.5040 | 1.1028 | −1.6147 | 5.5040 |
| −0.8399 | 1.0861 | 5.5040 | 1.1007 | −1.6211 | 5.5040 |
| 1.0881 | −1.6142 | 5.7149 | −0.8376 | 1.1023 | 5.7149 |
| 1.0839 | −1.6169 | 5.7149 | −0.8369 | 1.1026 | 5.7149 |
| 1.0773 | −1.6182 | 5.7149 | −0.8357 | 1.1031 | 5.7149 |
| 1.0693 | −1.6159 | 5.7149 | −0.8329 | 1.1034 | 5.7149 |
| 1.0618 | −1.6091 | 5.7149 | −0.8277 | 1.1023 | 5.7149 |
| 1.0520 | −1.5999 | 5.7149 | −0.8201 | 1.0985 | 5.7149 |
| 1.0392 | −1.5877 | 5.7149 | −0.8080 | 1.0895 | 5.7149 |
| 1.0233 | −1.5725 | 5.7149 | −0.7935 | 1.0755 | 5.7149 |
| 1.0039 | −1.5540 | 5.7149 | −0.7757 | 1.0556 | 5.7149 |
| 0.9810 | −1.5319 | 5.7149 | −0.7548 | 1.0296 | 5.7149 |
| 0.9542 | −1.5061 | 5.7149 | −0.7289 | 0.9947 | 5.7149 |
| 0.9227 | −1.4754 | 5.7149 | −0.6999 | 0.9539 | 5.7149 |
| 0.8864 | −1.4399 | 5.7149 | −0.6694 | 0.9098 | 5.7149 |
| 0.8455 | −1.3995 | 5.7149 | −0.6354 | 0.8601 | 5.7149 |
| 0.7998 | −1.3542 | 5.7149 | −0.5979 | 0.8048 | 5.7149 |
| 0.7497 | −1.3038 | 5.7149 | −0.5567 | 0.7439 | 5.7149 |
| 0.6951 | −1.2484 | 5.7149 | −0.5136 | 0.6802 | 5.7149 |
| 0.6385 | −1.1903 | 5.7149 | −0.4686 | 0.6137 | 5.7149 |
| 0.5798 | −1.1294 | 5.7149 | −0.4216 | 0.5446 | 5.7149 |
| 0.5192 | −1.0657 | 5.7149 | −0.3728 | 0.4726 | 5.7149 |
| 0.4570 | −0.9990 | 5.7149 | −0.3219 | 0.3981 | 5.7149 |
| 0.3932 | −0.9292 | 5.7149 | −0.2690 | 0.3209 | 5.7149 |
| 0.3279 | −0.8562 | 5.7149 | −0.2139 | 0.2411 | 5.7149 |
| 0.2613 | −0.7799 | 5.7149 | −0.1568 | 0.1586 | 5.7149 |
| 0.1957 | −0.7027 | 5.7149 | −0.0993 | 0.0764 | 5.7149 |
| 0.1313 | −0.6245 | 5.7149 | −0.0417 | −0.0058 | 5.7149 |
| 0.0682 | −0.5452 | 5.7149 | 0.0162 | −0.0876 | 5.7149 |
| 0.0064 | −0.4647 | 5.7149 | 0.0743 | −0.1694 | 5.7149 |
| −0.0539 | −0.3829 | 5.7149 | 0.1326 | −0.2511 | 5.7149 |
| −0.1130 | −0.3001 | 5.7149 | 0.1906 | −0.3329 | 5.7149 |
| −0.1709 | −0.2165 | 5.7149 | 0.2483 | −0.4149 | 5.7149 |
| −0.2277 | −0.1321 | 5.7149 | 0.3056 | −0.4973 | 5.7149 |
| −0.2834 | −0.0471 | 5.7149 | 0.3627 | −0.5798 | 5.7149 |
| −0.3379 | 0.0388 | 5.7149 | 0.4196 | −0.6624 | 5.7149 |
| −0.3913 | 0.1254 | 5.7149 | 0.4765 | −0.7450 | 5.7149 |
| −0.4419 | 0.2099 | 5.7149 | 0.5316 | −0.8248 | 5.7149 |
| −0.4894 | 0.2920 | 5.7149 | 0.5850 | −0.9018 | 5.7149 |
| −0.5342 | 0.3719 | 5.7149 | 0.6366 | −0.9758 | 5.7149 |
| −0.5763 | 0.4493 | 5.7149 | 0.6866 | −1.0470 | 5.7149 |
| −0.6156 | 0.5245 | 5.7149 | 0.7349 | −1.1151 | 5.7149 |
| −0.6524 | 0.5970 | 5.7149 | 0.7816 | −1.1804 | 5.7149 |
| −0.6866 | 0.6672 | 5.7149 | 0.8268 | −1.2427 | 5.7149 |
| −0.7184 | 0.7348 | 5.7149 | 0.8683 | −1.2994 | 5.7149 |
| −0.7464 | 0.7965 | 5.7149 | 0.9061 | −1.3504 | 5.7149 |
| −0.7709 | 0.8525 | 5.7149 | 0.9401 | −1.3960 | 5.7149 |
| −0.7917 | 0.9025 | 5.7149 | 0.9702 | −1.4361 | 5.7149 |
| −0.8101 | 0.9500 | 5.7149 | 0.9964 | −1.4707 | 5.7149 |
| −0.8248 | 0.9916 | 5.7149 | 1.0187 | −1.5001 | 5.7149 |

TABLE 5-continued

| SUCTION SIDE | | | PRESSURE SIDE | | |
|---|---|---|---|---|---|
| X | Y | Z | X | Y | Z |
| −0.8346 | 1.0240 | 5.7149 | 1.0377 | −1.5251 | 5.7149 |
| −0.8410 | 1.0504 | 5.7149 | 1.0538 | −1.5460 | 5.7149 |
| −0.8442 | 1.0705 | 5.7149 | 1.0671 | −1.5632 | 5.7149 |
| −0.8445 | 1.0858 | 5.7149 | 1.0778 | −1.5769 | 5.7149 |
| −0.8432 | 1.0942 | 5.7149 | 1.0860 | −1.5875 | 5.7149 |
| −0.8411 | 1.0991 | 5.7149 | 1.0918 | −1.5956 | 5.7149 |
| −0.8393 | 1.1012 | 5.7149 | 1.0933 | −1.6038 | 5.7149 |
| −0.8381 | 1.1020 | 5.7149 | 1.0913 | −1.6102 | 5.7149 |
| 1.0664 | −1.5955 | 5.9257 | −0.8239 | 1.1314 | 5.9257 |
| 1.0621 | −1.5983 | 5.9257 | −0.8232 | 1.1317 | 5.9257 |
| 1.0556 | −1.5997 | 5.9257 | −0.8220 | 1.1321 | 5.9257 |
| 1.0476 | −1.5972 | 5.9257 | −0.8193 | 1.1323 | 5.9257 |
| 1.0402 | −1.5904 | 5.9257 | −0.8140 | 1.1312 | 5.9257 |
| 1.0304 | −1.5811 | 5.9257 | −0.8065 | 1.1273 | 5.9257 |
| 1.0177 | −1.5690 | 5.9257 | −0.7947 | 1.1181 | 5.9257 |
| 1.0020 | −1.5538 | 5.9257 | −0.7805 | 1.1038 | 5.9257 |
| 0.9827 | −1.5352 | 5.9257 | −0.7631 | 1.0836 | 5.9257 |
| 0.9600 | −1.5132 | 5.9257 | −0.7428 | 1.0574 | 5.9257 |
| 0.9335 | −1.4873 | 5.9257 | −0.7174 | 1.0222 | 5.9257 |
| 0.9022 | −1.4566 | 5.9257 | −0.6890 | 0.9811 | 5.9257 |
| 0.8662 | −1.4210 | 5.9257 | −0.6593 | 0.9369 | 5.9257 |
| 0.8257 | −1.3805 | 5.9257 | −0.6262 | 0.8869 | 5.9257 |
| 0.7806 | −1.3350 | 5.9257 | −0.5895 | 0.8312 | 5.9257 |
| 0.7310 | −1.2844 | 5.9257 | −0.5492 | 0.7700 | 5.9257 |
| 0.6771 | −1.2286 | 5.9257 | −0.5071 | 0.7061 | 5.9257 |
| 0.6212 | −1.1702 | 5.9257 | −0.4631 | 0.6392 | 5.9257 |
| 0.5634 | −1.1089 | 5.9257 | −0.4173 | 0.5697 | 5.9257 |
| 0.5039 | −1.0447 | 5.9257 | −0.3695 | 0.4974 | 5.9257 |
| 0.4427 | −0.9774 | 5.9257 | −0.3197 | 0.4226 | 5.9257 |
| 0.3801 | −0.9071 | 5.9257 | −0.2680 | 0.3449 | 5.9257 |
| 0.3161 | −0.8335 | 5.9257 | −0.2141 | 0.2648 | 5.9257 |
| 0.2508 | −0.7564 | 5.9257 | −0.1582 | 0.1818 | 5.9257 |
| 0.1867 | −0.6785 | 5.9257 | −0.1020 | 0.0992 | 5.9257 |
| 0.1237 | −0.5997 | 5.9257 | −0.0456 | 0.0168 | 5.9257 |
| 0.0621 | −0.5196 | 5.9257 | 0.0112 | −0.0656 | 5.9257 |
| 0.0018 | −0.4384 | 5.9257 | 0.0682 | −0.1477 | 5.9257 |
| −0.0572 | −0.3561 | 5.9257 | 0.1253 | −0.2297 | 5.9257 |
| −0.1148 | −0.2728 | 5.9257 | 0.1823 | −0.3118 | 5.9257 |
| −0.1715 | −0.1887 | 5.9257 | 0.2390 | −0.3941 | 5.9257 |
| −0.2270 | −0.1040 | 5.9257 | 0.2953 | −0.4767 | 5.9257 |
| −0.2815 | −0.0186 | 5.9257 | 0.3514 | −0.5594 | 5.9257 |
| −0.3349 | 0.0675 | 5.9257 | 0.4073 | −0.6423 | 5.9257 |
| −0.3873 | 0.1544 | 5.9257 | 0.4631 | −0.7252 | 5.9257 |
| −0.4367 | 0.2390 | 5.9257 | 0.5173 | −0.8052 | 5.9257 |
| −0.4833 | 0.3213 | 5.9257 | 0.5697 | −0.8825 | 5.9257 |
| −0.5272 | 0.4012 | 5.9257 | 0.6204 | −0.9567 | 5.9257 |
| −0.5684 | 0.4789 | 5.9257 | 0.6696 | −1.0280 | 5.9257 |
| −0.6069 | 0.5540 | 5.9257 | 0.7172 | −1.0964 | 5.9257 |
| −0.6430 | 0.6267 | 5.9257 | 0.7632 | −1.1618 | 5.9257 |
| −0.6765 | 0.6967 | 5.9257 | 0.8078 | −1.2242 | 5.9257 |
| −0.7076 | 0.7643 | 5.9257 | 0.8487 | −1.2809 | 5.9257 |
| −0.7350 | 0.8261 | 5.9257 | 0.8860 | −1.3320 | 5.9257 |
| −0.7589 | 0.8820 | 5.9257 | 0.9196 | −1.3776 | 5.9257 |
| −0.7793 | 0.9321 | 5.9257 | 0.9494 | −1.4177 | 5.9257 |
| −0.7973 | 0.9794 | 5.9257 | 0.9754 | −1.4524 | 5.9257 |
| −0.8116 | 1.0210 | 5.9257 | 0.9974 | −1.4817 | 5.9257 |
| −0.8212 | 1.0534 | 5.9257 | 1.0164 | −1.5067 | 5.9257 |
| −0.8274 | 1.0797 | 5.9257 | 1.0323 | −1.5276 | 5.9257 |
| −0.8304 | 1.0998 | 5.9257 | 1.0454 | −1.5449 | 5.9257 |
| −0.8309 | 1.1150 | 5.9257 | 1.0560 | −1.5585 | 5.9257 |
| −0.8295 | 1.1233 | 5.9257 | 1.6041 | −1.5692 | 5.9257 |
| −0.8274 | 1.1283 | 5.9257 | 1.0700 | −1.5773 | 5.9257 |
| −0.8256 | 1.1302 | 5.9257 | 1.0714 | −1.5853 | 5.9257 |
| −0.8245 | 1.1311 | 5.9257 | 1.6094 | −1.5917 | 5.9257 |
| 1.0385 | −1.5739 | 6.1366 | −0.7931 | 1.1806 | 6.1366 |
| 1.0343 | −1.5767 | 6.1366 | −0.7926 | 1.1808 | 6.1366 |
| 1.0277 | −1.5781 | 6.1366 | −0.7913 | 1.1812 | 6.1366 |
| 1.0198 | −1.5755 | 6.1366 | −0.7885 | 1.1814 | 6.1366 |
| 1.0123 | −1.5687 | 6.1366 | −0.7833 | 1.1799 | 6.1366 |
| 1.0026 | −1.5594 | 6.1366 | −0.7762 | 1.1757 | 6.1366 |
| 0.9900 | −1.5473 | 6.1366 | −0.7647 | 1.1659 | 6.1366 |
| 0.9742 | −1.5321 | 6.1366 | −0.7512 | 1.1513 | 6.1366 |
| 0.9552 | −1.5136 | 6.1366 | −0.7347 | 1.1304 | 6.1366 |
| 0.9325 | −1.4916 | 6.1366 | −0.7153 | 1.1035 | 6.1366 |
| 0.9061 | −1.4656 | 6.1366 | −0.6914 | 1.0676 | 6.1366 |
| 0.8750 | −1.4348 | 6.1366 | −0.6645 | 1.0256 | 6.1366 |

TABLE 5-continued

| SUCTION SIDE | | | PRESSURE SIDE | | |
|---|---|---|---|---|---|
| X | Y | Z | X | Y | Z |
| 0.8394 | −1.3991 | 6.1366 | −0.6363 | 0.9806 | 6.1366 |
| 0.7991 | −1.3585 | 6.1366 | −0.6049 | 0.9297 | 6.1366 |
| 0.7544 | −1.3127 | 6.1366 | −0.5701 | 0.8731 | 6.1366 |
| 0.7054 | −1.2618 | 6.1366 | −0.5318 | 0.8109 | 6.1366 |
| 0.6521 | −1.2057 | 6.1366 | −0.4918 | 0.7459 | 6.1366 |
| 0.5970 | −1.1468 | 6.1366 | −0.4499 | 0.6781 | 6.1366 |
| 0.5401 | −1.0850 | 6.1366 | −0.4061 | 0.6074 | 6.1366 |
| 0.4816 | −1.0202 | 6.1366 | −0.3605 | 0.5341 | 6.1366 |
| 0.4216 | −0.9523 | 6.1366 | −0.3130 | 0.4581 | 6.1366 |
| 0.3602 | −0.8810 | 6.1366 | −0.2634 | 0.3794 | 6.1366 |
| 0.2977 | −0.8065 | 6.1366 | −0.2118 | 0.2981 | 6.1366 |
| 0.2341 | −0.7285 | 6.1366 | −0.1582 | 0.2142 | 6.1366 |
| 0.1718 | −0.6495 | 6.1366 | −0.1042 | 0.1304 | 6.1366 |
| 0.1107 | −0.5693 | 6.1366 | −0.0500 | 0.0469 | 6.1366 |
| 0.0512 | −0.4880 | 6.1366 | 0.0046 | −0.0364 | 6.1366 |
| −0.0069 | −0.4055 | 6.1366 | 0.0596 | −0.1195 | 6.1366 |
| −0.0636 | −0.3218 | 6.1366 | 0.1148 | −0.2024 | 6.1366 |
| −0.1191 | −0.2373 | 6.1366 | 0.1702 | −0.2853 | 6.1366 |
| −0.1735 | −0.1521 | 6.1366 | 0.2253 | −0.3682 | 6.1366 |
| −0.2270 | −0.0663 | 6.1366 | 0.2803 | −0.4513 | 6.1366 |
| −0.2793 | 0.0203 | 6.1366 | 0.3350 | −0.5346 | 6.1366 |
| −0.3304 | 0.1075 | 6.1366 | 0.3895 | −0.6180 | 6.1366 |
| −0.3805 | 0.1954 | 6.1366 | 0.4442 | −0.7013 | 6.1366 |
| −0.4277 | 0.2810 | 6.1366 | 0.4972 | −0.7817 | 6.1366 |
| −0.4722 | 0.3643 | 6.1366 | 0.5485 | −0.8592 | 6.1366 |
| −0.5140 | 0.4451 | 6.1366 | 0.5983 | −0.9338 | 6.1366 |
| −0.5533 | 0.5235 | 6.1366 | 0.6465 | −1.0054 | 6.1366 |
| −0.5900 | 0.5993 | 6.1366 | 0.6933 | −1.0740 | 6.1366 |
| −0.6242 | 0.6727 | 6.1366 | 0.7384 | −1.1396 | 6.1366 |
| −0.6560 | 0.7434 | 6.1366 | 0.7823 | −1.2022 | 6.1366 |
| −0.6854 | 0.8115 | 6.1366 | 0.8228 | −1.2590 | 6.1366 |
| −0.7114 | 0.8738 | 6.1366 | 0.8595 | −1.3102 | 6.1366 |
| −0.7338 | 0.9301 | 6.1366 | 0.8927 | −1.3559 | 6.1366 |
| −0.7529 | 0.9806 | 6.1366 | 0.9222 | −1.3961 | 6.1366 |
| −0.7697 | 1.0283 | 6.1366 | 0.9479 | −1.4307 | 6.1366 |
| −0.7830 | 1.0701 | 6.1366 | 0.9698 | −1.4600 | 6.1366 |
| −0.7918 | 1.1026 | 6.1366 | 0.9886 | −1.4850 | 6.1366 |
| −0.7975 | 1.1290 | 6.1366 | 1.0044 | −1.5059 | 6.1366 |
| −0.8001 | 1.1491 | 6.1366 | 1.0174 | −1.5231 | 6.1366 |
| −0.8002 | 1.1642 | 6.1366 | 1.0279 | −1.5368 | 6.1366 |
| −0.7988 | 1.1725 | 6.1366 | 1.0360 | −1.5473 | 6.1366 |
| −0.7966 | 1.1774 | 6.1366 | 1.0419 | −1.5554 | 6.1366 |
| −0.7948 | 1.1795 | 6.1366 | 1.0435 | −1.5635 | 6.1366 |
| −0.7938 | 1.1802 | 6.1366 | 1.0416 | −1.5700 | 6.1366 |
| 1.0095 | −1.5518 | 6.3475 | −0.7479 | 1.2458 | 6.3475 |
| 1.0053 | −1.5546 | 6.3475 | −0.7472 | 1.2460 | 6.3475 |
| 0.9988 | −1.5559 | 6.3475 | −0.7459 | 1.2463 | 6.3475 |
| 0.9908 | −1.5534 | 6.3475 | −0.7432 | 1.2462 | 6.3475 |
| 0.9834 | −1.5466 | 6.3475 | −0.7381 | 1.2443 | 6.3475 |
| 0.9737 | −1.5372 | 6.3475 | −0.7314 | 1.2395 | 6.3475 |
| 0.9610 | −1.5251 | 6.3475 | −0.7208 | 1.2289 | 6.3475 |
| 0.9453 | −1.5099 | 6.3475 | −0.7083 | 1.2133 | 6.3475 |
| 0.9262 | −1.4913 | 6.3475 | −0.6933 | 1.1915 | 6.3475 |
| 0.9036 | −1.4692 | 6.3475 | −0.6757 | 1.1634 | 6.3475 |
| 0.8773 | −1.4431 | 6.3475 | −0.6539 | 1.1263 | 6.3475 |
| 0.8462 | −1.4123 | 6.3475 | −0.6295 | 1.0829 | 6.3475 |
| 0.8107 | −1.3764 | 6.3475 | −0.6037 | 1.0365 | 6.3475 |
| 0.7706 | −1.3355 | 6.3475 | −0.5751 | 0.9841 | 6.3475 |
| 0.7263 | −1.2894 | 6.3475 | −0.5432 | 0.9259 | 6.3475 |
| 0.6777 | −1.2380 | 6.3475 | −0.5080 | 0.8620 | 6.3475 |
| 0.6249 | −1.1815 | 6.3475 | −0.4710 | 0.7953 | 6.3475 |
| 0.5703 | −1.1219 | 6.3475 | −0.4322 | 0.7258 | 6.3475 |
| 0.5140 | −1.0595 | 6.3475 | −0.3915 | 0.6535 | 6.3475 |
| 0.4564 | −0.9939 | 6.3475 | −0.3489 | 0.5785 | 6.3475 |
| 0.3974 | −0.9251 | 6.3475 | −0.3044 | 0.5008 | 6.3475 |
| 0.3372 | −0.8529 | 6.3475 | −0.2579 | 0.4205 | 6.3475 |
| 0.2760 | −0.7774 | 6.3475 | −0.2093 | 0.3374 | 6.3475 |
| 0.2139 | −0.6982 | 6.3475 | −0.1586 | 0.2517 | 6.3475 |
| 0.1534 | −0.6177 | 6.3475 | −0.1074 | 0.1664 | 6.3475 |
| 0.0944 | −0.5360 | 6.3475 | −0.0558 | 0.0814 | 6.3475 |
| 0.0372 | −0.4530 | 6.3475 | −0.0037 | −0.0034 | 6.3475 |
| −0.0185 | −0.3688 | 6.3475 | 0.0490 | −0.0878 | 6.3475 |
| −0.0727 | −0.2834 | 6.3475 | 0.1021 | −0.1720 | 6.3475 |
| −0.1257 | −0.1971 | 6.3475 | 0.1555 | −0.2559 | 6.3475 |
| −0.1775 | −0.1103 | 6.3475 | 0.2091 | −0.3397 | 6.3475 |
| −0.2282 | −0.0226 | 6.3475 | 0.2626 | −0.4236 | 6.3475 |

TABLE 5-continued

| SUCTION SIDE | | | PRESSURE SIDE | | |
|---|---|---|---|---|---|
| X | Y | Z | X | Y | Z |
| −0.2775 | 0.0656 | 6.3475 | 0.3160 | −0.5075 | 6.3475 |
| −0.3257 | 0.1547 | 6.3475 | 0.3694 | −0.5915 | 6.3475 |
| −0.3726 | 0.2444 | 6.3475 | 0.4228 | −0.6754 | 6.3475 |
| −0.4166 | 0.3317 | 6.3475 | 0.4748 | −0.7564 | 6.3475 |
| −0.4581 | 0.4166 | 6.3475 | 0.5252 | −0.8344 | 6.3475 |
| −0.4969 | 0.4990 | 6.3475 | 0.5740 | −0.9094 | 6.3475 |
| −0.5331 | 0.5789 | 6.3475 | 0.6215 | −0.9814 | 6.3475 |
| −0.5669 | 0.6563 | 6.3475 | 0.6674 | −1.0504 | 6.3475 |
| −0.5982 | 0.7310 | 6.3475 | 0.7120 | −1.1164 | 6.3475 |
| −0.6272 | 0.8029 | 6.3475 | 0.7552 | −1.1793 | 6.3475 |
| −0.6539 | 0.8722 | 6.3475 | 0.7952 | −1.2363 | 6.3475 |
| −0.6774 | 0.9355 | 6.3475 | 0.8316 | −1.2878 | 6.3475 |
| −0.6976 | 0.9928 | 6.3475 | 0.8644 | −1.3336 | 6.3475 |
| −0.7146 | 1.0440 | 6.3475 | 0.8937 | −1.3738 | 6.3475 |
| −0.7294 | 1.0924 | 6.3475 | 0.9192 | −1.4086 | 6.3475 |
| −0.7411 | 1.1348 | 6.3475 | 0.9409 | −1.4379 | 6.3475 |
| −0.7487 | 1.1676 | 6.3475 | 0.9596 | −1.4628 | 6.3475 |
| −0.7534 | 1.1942 | 6.3475 | 0.9754 | −1.4837 | 6.3475 |
| −0.7554 | 1.2144 | 6.3475 | 0.9885 | −1.5009 | 6.3475 |
| −0.7551 | 1.2296 | 6.3475 | 0.9988 | −1.5147 | 6.3475 |
| −0.7536 | 1.2379 | 6.3475 | 1.0070 | −1.5252 | 6.3475 |
| −0.7514 | 1.2427 | 6.3475 | 1.0128 | −1.5333 | 6.3475 |
| −0.7496 | 1.2447 | 6.3475 | 1.0145 | −1.5414 | 6.3475 |
| −0.7484 | 1.2455 | 6.3475 | 1.0126 | −1.5478 | 6.3475 |
| 0.9805 | −1.5298 | 6.5583 | −0.6994 | 1.3145 | 6.5583 |
| 0.9763 | −1.5326 | 6.5583 | −0.6987 | 1.3147 | 6.5583 |
| 0.9697 | −1.5339 | 6.5583 | −0.6974 | 1.3149 | 6.5583 |
| 0.9618 | −1.5314 | 6.5583 | −0.6948 | 1.3145 | 6.5583 |
| 0.9544 | −1.5245 | 6.5583 | −0.6900 | 1.3121 | 6.5583 |
| 0.9446 | −1.5151 | 6.5583 | −0.6837 | 1.3065 | 6.5583 |
| 0.9321 | −1.5029 | 6.5583 | −0.6741 | 1.2951 | 6.5583 |
| 0.9163 | −1.4876 | 6.5583 | −0.6630 | 1.2786 | 6.5583 |
| 0.8973 | −1.4689 | 6.5583 | −0.6495 | 1.2558 | 6.5583 |
| 0.8746 | −1.4467 | 6.5583 | −0.6339 | 1.2264 | 6.5583 |
| 0.8483 | −1.4205 | 6.5583 | −0.6146 | 1.1879 | 6.5583 |
| 0.8174 | −1.3894 | 6.5583 | −0.5929 | 1.1431 | 6.5583 |
| 0.7819 | −1.3533 | 6.5583 | −0.5700 | 1.0952 | 6.5583 |
| 0.7420 | −1.3121 | 6.5583 | −0.5441 | 1.0413 | 6.5583 |
| 0.6979 | −1.2656 | 6.5583 | −0.5155 | 0.9815 | 6.5583 |
| 0.6495 | −1.2138 | 6.5583 | −0.4837 | 0.9158 | 6.5583 |
| 0.5970 | −1.1566 | 6.5583 | −0.4500 | 0.8473 | 6.5583 |
| 0.5430 | −1.0966 | 6.5583 | −0.4145 | 0.7760 | 6.5583 |
| 0.4874 | −1.0333 | 6.5583 | −0.3771 | 0.7019 | 6.5583 |
| 0.4305 | −0.9669 | 6.5583 | −0.3379 | 0.6252 | 6.5583 |
| 0.3725 | −0.8972 | 6.5583 | −0.2965 | 0.5457 | 6.5583 |
| 0.3133 | −0.8240 | 6.5583 | −0.2532 | 0.4636 | 6.5583 |
| 0.2534 | −0.7472 | 6.5583 | −0.2077 | 0.3789 | 6.5583 |
| 0.1930 | −0.6666 | 6.5583 | −0.1600 | 0.2916 | 6.5583 |
| 0.1341 | −0.5847 | 6.5583 | −0.1117 | 0.2047 | 6.5583 |
| 0.0772 | −0.5015 | 6.5583 | −0.0627 | 0.1181 | 6.5583 |
| 0.0221 | −0.4168 | 6.5583 | −0.0131 | 0.0319 | 6.5583 |
| −0.0312 | −0.3308 | 6.5583 | 0.0373 | −0.0539 | 6.5583 |
| −0.0830 | −0.2436 | 6.5583 | 0.0883 | −0.1393 | 6.5583 |
| −0.1335 | −0.1555 | 6.5583 | 0.1399 | −0.2244 | 6.5583 |
| −0.1825 | −0.0668 | 6.5583 | 0.1918 | −0.3093 | 6.5583 |
| −0.2302 | 0.0227 | 6.5583 | 0.2439 | −0.3942 | 6.5583 |
| −0.2765 | 0.1130 | 6.5583 | 0.2959 | −0.4790 | 6.5583 |
| −0.3214 | 0.2039 | 6.5583 | 0.3480 | −0.5638 | 6.5583 |
| −0.3650 | 0.2956 | 6.5583 | 0.4004 | −0.6485 | 6.5583 |
| −0.4058 | 0.3847 | 6.5583 | 0.4513 | −0.7301 | 6.5583 |
| −0.4439 | 0.4715 | 6.5583 | 0.5008 | −0.8087 | 6.5583 |
| −0.4793 | 0.5556 | 6.5583 | 0.5489 | −0.8843 | 6.5583 |
| −0.5123 | 0.6371 | 6.5583 | 0.5956 | −0.9568 | 6.5583 |
| −0.5429 | 0.7160 | 6.5583 | 0.6410 | −1.0262 | 6.5583 |
| −0.5711 | 0.7921 | 6.5583 | 0.6850 | −1.0926 | 6.5583 |
| −0.5970 | 0.8655 | 6.5583 | 0.7279 | −1.1558 | 6.5583 |
| −0.6207 | 0.9360 | 6.5583 | 0.7675 | −1.2131 | 6.5583 |
| −0.6415 | 1.0005 | 6.5583 | 0.8036 | −1.2647 | 6.5583 |
| −0.6591 | 1.0587 | 6.5583 | 0.8362 | −1.3108 | 6.5583 |
| −0.6738 | 1.1108 | 6.5583 | 0.8653 | −1.3511 | 6.5583 |
| −0.6865 | 1.1599 | 6.5583 | 0.8907 | −1.3860 | 6.5583 |
| −0.6964 | 1.2029 | 6.5583 | 0.9123 | −1.4155 | 6.5583 |
| −0.7026 | 1.2361 | 6.5583 | 0.9309 | −1.4405 | 6.5583 |
| −0.7063 | 1.2629 | 6.5583 | 0.9466 | −1.4615 | 6.5583 |
| −0.7076 | 1.2831 | 6.5583 | 0.9596 | −1.4787 | 6.5583 |
| −0.7069 | 1.2984 | 6.5583 | 0.9700 | −1.4925 | 6.5583 |

TABLE 5-continued

| SUCTION SIDE | | | PRESSURE SIDE | | |
|---|---|---|---|---|---|
| X | Y | Z | X | Y | Z |
| −0.7053 | 1.3066 | 6.5583 | 0.9780 | −1.5031 | 6.5583 |
| −0.7030 | 1.3115 | 6.5583 | 0.9839 | −1.5111 | 6.5583 |
| −0.7012 | 1.3136 | 6.5583 | 0.9855 | −1.5193 | 6.5583 |
| −0.7000 | 1.3143 | 6.5583 | 0.9836 | −1.5257 | 6.5583 |

TABLE 6

| SUCTION SIDE | | | PRESSURE SIDE | | |
|---|---|---|---|---|---|
| X | Y | Z | X | Y | Z |
| 1.4114 | −1.0048 | −0.2388 | −0.9041 | 1.1141 | −0.2388 |
| 1.4089 | −1.0091 | −0.2388 | −0.9035 | 1.1144 | −0.2388 |
| 1.4042 | −1.0138 | −0.2388 | −0.9024 | 1.1148 | −0.2388 |
| 1.3966 | −1.0174 | −0.2388 | −0.8999 | 1.1155 | −0.2388 |
| 1.3865 | −1.0176 | −0.2388 | −0.8947 | 1.1162 | −0.2388 |
| 1.3735 | −1.0138 | −0.2388 | −0.8868 | 1.1155 | −0.2388 |
| 1.3567 | −1.0086 | −0.2388 | −0.8732 | 1.1108 | −0.2388 |
| 1.3357 | −1.0020 | −0.2388 | −0.8567 | 1.1011 | −0.2388 |
| 1.3103 | −0.9940 | −0.2388 | −0.8371 | 1.0851 | −0.2388 |
| 1.2801 | −0.9842 | −0.2388 | −0.8146 | 1.0629 | −0.2388 |
| 1.2447 | −0.9726 | −0.2388 | −0.7870 | 1.0320 | −0.2388 |
| 1.2031 | −0.9585 | −0.2388 | −0.7563 | 0.9957 | −0.2388 |
| 1.1552 | −0.9418 | −0.2388 | −0.7240 | 0.9566 | −0.2388 |
| 1.1011 | −0.9223 | −0.2388 | −0.6882 | 0.9121 | −0.2388 |
| 1.0409 | −0.8999 | −0.2388 | −0.6485 | 0.8625 | −0.2388 |
| 0.9748 | −0.8743 | −0.2388 | −0.6045 | 0.8084 | −0.2388 |
| 0.9027 | −0.8453 | −0.2388 | −0.5574 | 0.7527 | −0.2388 |
| 0.8278 | −0.8141 | −0.2388 | −0.5077 | 0.6951 | −0.2388 |
| 0.7502 | −0.7804 | −0.2388 | −0.4556 | 0.6355 | −0.2388 |
| 0.6702 | −0.7444 | −0.2388 | −0.4003 | 0.5746 | −0.2388 |
| 0.5879 | −0.7055 | −0.2388 | −0.3421 | 0.5121 | −0.2388 |
| 0.5033 | −0.6639 | −0.2388 | −0.2809 | 0.4481 | −0.2388 |
| 0.4166 | −0.6193 | −0.2388 | −0.2168 | 0.3825 | −0.2388 |
| 0.3279 | −0.5714 | −0.2388 | −0.1497 | 0.3154 | −0.2388 |
| 0.2402 | −0.5217 | −0.2388 | −0.0819 | 0.2490 | −0.2388 |
| 0.1538 | −0.4700 | −0.2388 | −0.0133 | 0.1834 | −0.2388 |
| 0.0685 | −0.4161 | −0.2388 | 0.0559 | 0.1184 | −0.2388 |
| −0.0152 | −0.3595 | −0.2388 | 0.1248 | 0.0532 | −0.2388 |
| −0.0970 | −0.2998 | −0.2388 | 0.1934 | −0.0125 | −0.2388 |
| −0.1767 | −0.2362 | −0.2388 | 0.2618 | −0.0782 | −0.2388 |
| −0.2531 | −0.1690 | −0.2388 | 0.3304 | −0.1437 | −0.2388 |
| −0.3261 | −0.0987 | −0.2388 | 0.3996 | −0.2087 | −0.2388 |
| −0.3960 | −0.0259 | −0.2388 | 0.4696 | −0.2728 | −0.2388 |
| −0.4627 | 0.0497 | −0.2388 | 0.5404 | −0.3359 | −0.2388 |
| −0.5260 | 0.1284 | −0.2388 | 0.6120 | −0.3981 | −0.2388 |
| −0.5837 | 0.2074 | −0.2388 | 0.6821 | −0.4571 | −0.2388 |
| −0.6361 | 0.2865 | −0.2388 | 0.7505 | −0.5132 | −0.2388 |
| −0.6838 | 0.3652 | −0.2388 | 0.8173 | −0.5664 | −0.2388 |
| −0.7265 | 0.4426 | −0.2388 | 0.8823 | −0.6170 | −0.2388 |
| −0.7644 | 0.5188 | −0.2388 | 0.9453 | −0.6648 | −0.2388 |
| −0.7983 | 0.5933 | −0.2388 | 1.0064 | −0.7098 | −0.2388 |
| −0.8282 | 0.6657 | −0.2388 | 1.0654 | −0.7524 | −0.2388 |
| −0.8541 | 0.7360 | −0.2388 | 1.1197 | −0.7907 | −0.2388 |
| −0.8763 | 0.8004 | −0.2388 | 1.1692 | −0.8248 | −0.2388 |
| −0.8939 | 0.8592 | −0.2388 | 1.2138 | −0.8550 | −0.2388 |
| −0.9073 | 0.9121 | −0.2388 | 1.2533 | −0.8813 | −0.2388 |
| −0.9178 | 0.9621 | −0.2388 | 1.2877 | −0.9039 | −0.2388 |
| −0.9248 | 1.0058 | −0.2388 | 1.3169 | −0.9227 | −0.2388 |
| −0.9277 | 1.0398 | −0.2388 | 1.3420 | −0.9388 | −0.2388 |
| −0.9270 | 1.0670 | −0.2388 | 1.3632 | −0.9521 | −0.2388 |
| −0.9234 | 1.0872 | −0.2388 | 1.3806 | −0.9630 | −0.2388 |
| −0.9176 | 1.1013 | −0.2388 | 1.3946 | −0.9716 | −0.2388 |
| −0.9125 | 1.1082 | −0.2388 | 1.4052 | −0.9784 | −0.2388 |
| −0.9084 | 1.1118 | −0.2388 | 1.4111 | −0.9860 | −0.2388 |
| −0.9060 | 1.1132 | −0.2388 | 1.4132 | −0.9937 | −0.2388 |
| −0.9048 | 1.1139 | −0.2388 | 1.4129 | −1.0001 | −0.2388 |
| 1.4164 | −0.9958 | 0.0000 | −0.8956 | 1.1417 | 0.0000 |
| 1.4138 | −1.0000 | 0.0000 | −0.8951 | 1.1421 | 0.0000 |
| 1.4088 | −1.0045 | 0.0000 | −0.8939 | 1.1425 | 0.0000 |
| 1.4011 | −1.0077 | 0.0000 | −0.8914 | 1.1433 | 0.0000 |
| 1.3911 | −1.0075 | 0.0000 | −0.8863 | 1.1442 | 0.0000 |
| 1.3784 | −1.0032 | 0.0000 | −0.8784 | 1.1439 | 0.0000 |

TABLE 6-continued

| SUCTION SIDE | | | PRESSURE SIDE | | |
|---|---|---|---|---|---|
| X | Y | Z | X | Y | Z |
| 1.3618 | −0.9974 | 0.0000 | −0.8645 | 1.1397 | 0.0000 |
| 1.3412 | −0.9901 | 0.0000 | −0.8478 | 1.1306 | 0.0000 |
| 1.3161 | −0.9811 | 0.0000 | −0.8275 | 1.1153 | 0.0000 |
| 1.2864 | −0.9704 | 0.0000 | −0.8040 | 1.0939 | 0.0000 |
| 1.2517 | −0.9576 | 0.0000 | −0.7754 | 1.0641 | 0.0000 |
| 1.2107 | −0.9422 | 0.0000 | −0.7434 | 1.0289 | 0.0000 |
| 1.1635 | −0.9240 | 0.0000 | −0.7097 | 0.9907 | 0.0000 |
| 1.1103 | −0.9030 | 0.0000 | −0.6722 | 0.9475 | 0.0000 |
| 1.0510 | −0.8789 | 0.0000 | −0.6310 | 0.8994 | 0.0000 |
| 0.9859 | −0.8516 | 0.0000 | −0.5852 | 0.8465 | 0.0000 |
| 0.9148 | −0.8208 | 0.0000 | −0.5369 | 0.7918 | 0.0000 |
| 0.8411 | −0.7879 | 0.0000 | −0.4861 | 0.7350 | 0.0000 |
| 0.7648 | −0.7526 | 0.0000 | −0.4327 | 0.6763 | 0.0000 |
| 0.6859 | −0.7148 | 0.0000 | −0.3766 | 0.6159 | 0.0000 |
| 0.6048 | −0.6745 | 0.0000 | −0.3178 | 0.5537 | 0.0000 |
| 0.5213 | −0.6314 | 0.0000 | −0.2561 | 0.4898 | 0.0000 |
| 0.4358 | −0.5852 | 0.0000 | −0.1917 | 0.4242 | 0.0000 |
| 0.3483 | −0.5360 | 0.0000 | −0.1244 | 0.3569 | 0.0000 |
| 0.2618 | −0.4850 | 0.0000 | −0.0566 | 0.2903 | 0.0000 |
| 0.1766 | −0.4322 | 0.0000 | 0.0118 | 0.2241 | 0.0000 |
| 0.0925 | −0.3772 | 0.0000 | 0.0807 | 0.1584 | 0.0000 |
| 0.0099 | −0.3198 | 0.0000 | 0.1492 | 0.0924 | 0.0000 |
| −0.0709 | −0.2596 | 0.0000 | 0.2172 | 0.0259 | 0.0000 |
| −0.1495 | −0.1958 | 0.0000 | 0.2851 | −0.0408 | 0.0000 |
| −0.2255 | −0.1282 | 0.0000 | 0.3532 | −0.1072 | 0.0000 |
| −0.2981 | −0.0579 | 0.0000 | 0.4218 | −0.1732 | 0.0000 |
| −0.3678 | 0.0150 | 0.0000 | 0.4908 | −0.2386 | 0.0000 |
| −0.4344 | 0.0902 | 0.0000 | 0.5607 | −0.3030 | 0.0000 |
| −0.4980 | 0.1681 | 0.0000 | 0.6314 | −0.3665 | 0.0000 |
| −0.5562 | 0.2460 | 0.0000 | 0.7006 | −0.4272 | 0.0000 |
| −0.6094 | 0.3238 | 0.0000 | 0.7680 | −0.4848 | 0.0000 |
| −0.6580 | 0.4009 | 0.0000 | 0.8338 | −0.5396 | 0.0000 |
| −0.7021 | 0.4773 | 0.0000 | 0.8977 | −0.5917 | 0.0000 |
| −0.7415 | 0.5524 | 0.0000 | 0.9598 | −0.6410 | 0.0000 |
| −0.7770 | 0.6257 | 0.0000 | 1.0198 | −0.6878 | 0.0000 |
| −0.8088 | 0.6970 | 0.0000 | 1.0779 | −0.7320 | 0.0000 |
| −0.8361 | 0.7663 | 0.0000 | 1.1312 | −0.7719 | 0.0000 |
| −0.8594 | 0.8300 | 0.0000 | 1.1798 | −0.8075 | 0.0000 |
| −0.8782 | 0.8881 | 0.0000 | 1.2235 | −0.8391 | 0.0000 |
| −0.8928 | 0.9405 | 0.0000 | 1.2622 | −0.8668 | 0.0000 |
| −0.9047 | 0.9900 | 0.0000 | 1.2960 | −0.8904 | 0.0000 |
| −0.9129 | 1.0333 | 0.0000 | 1.3246 | −0.9103 | 0.0000 |
| −0.9167 | 1.0671 | 0.0000 | 1.3493 | −0.9272 | 0.0000 |
| −0.9168 | 1.0941 | 0.0000 | 1.3699 | −0.9413 | 0.0000 |
| −0.9139 | 1.1143 | 0.0000 | 1.3871 | −0.9529 | 0.0000 |
| −0.9086 | 1.1285 | 0.0000 | 1.4007 | −0.9621 | 0.0000 |
| −0.9037 | 1.1356 | 0.0000 | 1.4111 | −0.9693 | 0.0000 |
| −0.8997 | 1.1393 | 0.0000 | 1.4168 | −0.9770 | 0.0000 |
| −0.8975 | 1.1408 | 0.0000 | 1.4187 | −0.9848 | 0.0000 |
| −0.8962 | 1.1414 | 0.0000 | 1.4181 | −0.9913 | 0.0000 |
| 1.4202 | −0.9890 | 0.2048 | −0.8880 | 1.1656 | 0.2048 |
| 1.4174 | −0.9932 | 0.2048 | −0.8874 | 1.1659 | 0.2048 |
| 1.4123 | −0.9974 | 0.2048 | −0.8862 | 1.1665 | 0.2048 |
| 1.4045 | −1.0003 | 0.2048 | −0.8838 | 1.1673 | 0.2048 |
| 1.3946 | −0.9998 | 0.2048 | −0.8787 | 1.1684 | 0.2048 |
| 1.3820 | −0.9951 | 0.2048 | −0.8707 | 1.1683 | 0.2048 |
| 1.3657 | −0.9887 | 0.2048 | −0.8567 | 1.1646 | 0.2048 |
| 1.3454 | −0.9808 | 0.2048 | −0.8396 | 1.1558 | 0.2048 |
| 1.3208 | −0.9710 | 0.2048 | −0.8189 | 1.1412 | 0.2048 |
| 1.2916 | −0.9594 | 0.2048 | −0.7949 | 1.1204 | 0.2048 |
| 1.2574 | −0.9455 | 0.2048 | −0.7653 | 1.0915 | 0.2048 |
| 1.2170 | −0.9290 | 0.2048 | −0.7321 | 1.0572 | 0.2048 |
| 1.1707 | −0.9095 | 0.2048 | −0.6973 | 1.0201 | 0.2048 |
| 1.1182 | −0.8871 | 0.2048 | −0.6584 | 0.9781 | 0.2048 |
| 1.0598 | −0.8617 | 0.2048 | −0.6155 | 0.9311 | 0.2048 |
| 0.9956 | −0.8330 | 0.2048 | −0.5683 | 0.8794 | 0.2048 |
| 0.9255 | −0.8008 | 0.2048 | −0.5189 | 0.8255 | 0.2048 |
| 0.8528 | −0.7664 | 0.2048 | −0.4672 | 0.7694 | 0.2048 |
| 0.7774 | −0.7296 | 0.2048 | −0.4129 | 0.7113 | 0.2048 |
| 0.6997 | −0.6905 | 0.2048 | −0.3561 | 0.6512 | 0.2048 |
| 0.6196 | −0.6488 | 0.2048 | −0.2967 | 0.5892 | 0.2048 |
| 0.5372 | −0.6046 | 0.2048 | −0.2347 | 0.5254 | 0.2048 |
| 0.4527 | −0.5573 | 0.2048 | −0.1700 | 0.4597 | 0.2048 |
| 0.3663 | −0.5069 | 0.2048 | −0.1026 | 0.3922 | 0.2048 |
| 0.2809 | −0.4549 | 0.2048 | −0.0348 | 0.3251 | 0.2048 |
| 0.1966 | −0.4011 | 0.2048 | 0.0334 | 0.2585 | 0.2048 |

TABLE 6-continued

| SUCTION SIDE | | | PRESSURE SIDE | | |
|---|---|---|---|---|---|
| X | Y | Z | X | Y | Z |
| 0.1137 | −0.3453 | 0.2048 | 0.1018 | 0.1921 | 0.2048 |
| 0.0322 | −0.2872 | 0.2048 | 0.1700 | 0.1253 | 0.2048 |
| −0.0476 | −0.2264 | 0.2048 | 0.2376 | 0.0581 | 0.2048 |
| −0.1255 | −0.1625 | 0.2048 | 0.3051 | −0.0093 | 0.2048 |
| −0.2009 | −0.0948 | 0.2048 | 0.3727 | −0.0766 | 0.2048 |
| −0.2732 | −0.0242 | 0.2048 | 0.4407 | −0.1434 | 0.2048 |
| −0.3428 | 0.0486 | 0.2048 | 0.5091 | −0.2097 | 0.2048 |
| −0.4094 | 0.1238 | 0.2048 | 0.5783 | −0.2754 | 0.2048 |
| −0.4732 | 0.2013 | 0.2048 | 0.6482 | −0.3401 | 0.2048 |
| −0.5320 | 0.2785 | 0.2048 | 0.7165 | −0.4020 | 0.2048 |
| −0.5860 | 0.3551 | 0.2048 | 0.7830 | −0.4610 | 0.2048 |
| −0.6355 | 0.4312 | 0.2048 | 0.8480 | −0.5171 | 0.2048 |
| −0.6807 | 0.5064 | 0.2048 | 0.9110 | −0.5706 | 0.2048 |
| −0.7216 | 0.5806 | 0.2048 | 0.9722 | −0.6214 | 0.2048 |
| −0.7584 | 0.6530 | 0.2048 | 1.0313 | −0.6695 | 0.2048 |
| −0.7918 | 0.7234 | 0.2048 | 1.0884 | −0.7152 | 0.2048 |
| −0.8205 | 0.7921 | 0.2048 | 1.1409 | −0.7565 | 0.2048 |
| −0.8448 | 0.8553 | 0.2048 | 1.1887 | −0.7935 | 0.2048 |
| −0.8645 | 0.9129 | 0.2048 | 1.2317 | −0.8262 | 0.2048 |
| −0.8803 | 0.9648 | 0.2048 | 1.2697 | −0.8549 | 0.2048 |
| −0.8933 | 1.0140 | 0.2048 | 1.3029 | −0.8796 | 0.2048 |
| −0.9025 | 1.0571 | 0.2048 | 1.3311 | −0.9005 | 0.2048 |
| −0.9071 | 1.0905 | 0.2048 | 1.3552 | −0.9181 | 0.2048 |
| −0.9078 | 1.1176 | 0.2048 | 1.3754 | −0.9330 | 0.2048 |
| −0.9054 | 1.1377 | 0.2048 | 1.3921 | −0.9451 | 0.2048 |
| −0.9005 | 1.1522 | 0.2048 | 1.4055 | −0.9547 | 0.2048 |
| −0.8959 | 1.1593 | 0.2048 | 1.4158 | −0.9623 | 0.2048 |
| −0.8920 | 1.1631 | 0.2048 | 1.4212 | −0.9703 | 0.2048 |
| −0.8898 | 1.1647 | 0.2048 | 1.4229 | −0.9782 | 0.2048 |
| −0.8885 | 1.1653 | 0.2048 | 1.4220 | −0.9845 | 0.2048 |
| 1.4192 | −0.9900 | 0.4054 | −0.8770 | 1.1892 | 0.4054 |
| 1.4162 | −0.9939 | 0.4054 | −0.8764 | 1.1895 | 0.4054 |
| 1.4110 | −0.9980 | 0.4054 | −0.8752 | 1.1900 | 0.4054 |
| 1.4032 | −1.0006 | 0.4054 | −0.8729 | 1.1910 | 0.4054 |
| 1.3933 | −0.9997 | 0.4054 | −0.8678 | 1.1921 | 0.4054 |
| 1.3810 | −0.9944 | 0.4054 | −0.8598 | 1.1922 | 0.4054 |
| 1.3651 | −0.9876 | 0.4054 | −0.8458 | 1.1888 | 0.4054 |
| 1.3452 | −0.9789 | 0.4054 | −0.8283 | 1.1806 | 0.4054 |
| 1.3211 | −0.9684 | 0.4054 | −0.8072 | 1.1665 | 0.4054 |
| 1.2923 | −0.9557 | 0.4054 | −0.7826 | 1.1464 | 0.4054 |
| 1.2588 | −0.9407 | 0.4054 | −0.7522 | 1.1182 | 0.4054 |
| 1.2193 | −0.9228 | 0.4054 | −0.7182 | 1.0846 | 0.4054 |
| 1.1737 | −0.9020 | 0.4054 | −0.6823 | 1.0484 | 0.4054 |
| 1.1222 | −0.8783 | 0.4054 | −0.6424 | 1.0072 | 0.4054 |
| 1.0649 | −0.8512 | 0.4054 | −0.5982 | 0.9613 | 0.4054 |
| 1.0016 | −0.8208 | 0.4054 | −0.5500 | 0.9104 | 0.4054 |
| 0.9328 | −0.7870 | 0.4054 | −0.4997 | 0.8570 | 0.4054 |
| 0.8612 | −0.7510 | 0.4054 | −0.4471 | 0.8016 | 0.4054 |
| 0.7870 | −0.7127 | 0.4054 | −0.3922 | 0.7438 | 0.4054 |
| 0.7106 | −0.6720 | 0.4054 | −0.3350 | 0.6840 | 0.4054 |
| 0.6316 | −0.6290 | 0.4054 | −0.2752 | 0.6221 | 0.4054 |
| 0.5505 | −0.5832 | 0.4054 | −0.2130 | 0.5581 | 0.4054 |
| 0.4673 | −0.5345 | 0.4054 | −0.1484 | 0.4921 | 0.4054 |
| 0.3821 | −0.4829 | 0.4054 | −0.0811 | 0.4242 | 0.4054 |
| 0.2979 | −0.4298 | 0.4054 | −0.0134 | 0.3566 | 0.4054 |
| 0.2149 | −0.3749 | 0.4054 | 0.0544 | 0.2892 | 0.4054 |
| 0.1332 | −0.3181 | 0.4054 | 0.1224 | 0.2221 | 0.4054 |
| 0.0528 | −0.2591 | 0.4054 | 0.1900 | 0.1545 | 0.4054 |
| −0.0259 | −0.1978 | 0.4054 | 0.2570 | 0.0864 | 0.4054 |
| −0.1025 | −0.1334 | 0.4054 | 0.3239 | 0.0181 | 0.4054 |
| −0.1770 | −0.0656 | 0.4054 | 0.3908 | −0.0503 | 0.4054 |
| −0.2489 | 0.0054 | 0.4054 | 0.4581 | −0.1182 | 0.4054 |
| −0.3183 | 0.0786 | 0.4054 | 0.5258 | −0.1856 | 0.4054 |
| −0.3850 | 0.1541 | 0.4054 | 0.5941 | −0.2526 | 0.4054 |
| −0.4492 | 0.2319 | 0.4054 | 0.6630 | −0.3189 | 0.4054 |
| −0.5088 | 0.3094 | 0.4054 | 0.7303 | −0.3823 | 0.4054 |
| −0.5635 | 0.3862 | 0.4054 | 0.7958 | −0.4428 | 0.4054 |
| −0.6139 | 0.4618 | 0.4054 | 0.8597 | −0.5004 | 0.4054 |
| −0.6599 | 0.5363 | 0.4054 | 0.9217 | −0.5555 | 0.4054 |
| −0.7015 | 0.6096 | 0.4054 | 0.9818 | −0.6077 | 0.4054 |
| −0.7392 | 0.6811 | 0.4054 | 1.0397 | −0.6576 | 0.4054 |
| −0.7735 | 0.7506 | 0.4054 | 1.0957 | −0.7049 | 0.4054 |
| −0.8033 | 0.8186 | 0.4054 | 1.1472 | −0.7478 | 0.4054 |
| −0.8284 | 0.8810 | 0.4054 | 1.1940 | −0.7862 | 0.4054 |
| −0.8489 | 0.9382 | 0.4054 | 1.2360 | −0.8203 | 0.4054 |
| −0.8655 | 0.9895 | 0.4054 | 1.2733 | −0.8503 | 0.4054 |

TABLE 6-continued

| SUCTION SIDE | | | PRESSURE SIDE | | |
|---|---|---|---|---|---|
| X | Y | Z | X | Y | Z |
| −0.8793 | 1.0382 | 0.4054 | 1.3057 | −0.8762 | 0.4054 |
| −0.8894 | 1.0808 | 0.4054 | 1.3332 | −0.8979 | 0.4054 |
| −0.8946 | 1.1142 | 0.4054 | 1.3566 | −0.9165 | 0.4054 |
| −0.8959 | 1.1410 | 0.4054 | 1.3764 | −0.9321 | 0.4054 |
| −0.8938 | 1.1612 | 0.4054 | 1.3928 | −0.9449 | 0.4054 |
| −0.8892 | 1.1755 | 0.4054 | 1.4057 | −0.9552 | 0.4054 |
| −0.8847 | 1.1827 | 0.4054 | 1.4157 | −0.9631 | 0.4054 |
| −0.8809 | 1.1865 | 0.4054 | 1.4210 | −0.9712 | 0.4054 |
| −0.8787 | 1.1881 | 0.4054 | 1.4222 | −0.9791 | 0.4054 |
| −0.8776 | 1.1888 | 0.4054 | 1.4212 | −0.9856 | 0.4054 |
| 1.4119 | −1.0012 | 0.5744 | −0.8644 | 1.2082 | 0.5744 |
| 1.4088 | −1.0050 | 0.5744 | −0.8639 | 1.2085 | 0.5744 |
| 1.4034 | −1.0089 | 0.5744 | −0.8628 | 1.2091 | 0.5744 |
| 1.3956 | −1.0112 | 0.5744 | −0.8603 | 1.2101 | 0.5744 |
| 1.3858 | −1.0100 | 0.5744 | −0.8554 | 1.2112 | 0.5744 |
| 1.3738 | −1.0044 | 0.5744 | −0.8472 | 1.2114 | 0.5744 |
| 1.3580 | −0.9970 | 0.5744 | −0.8332 | 1.2083 | 0.5744 |
| 1.3385 | −0.9877 | 0.5744 | −0.8155 | 1.2004 | 0.5744 |
| 1.3147 | −0.9764 | 0.5744 | −0.7941 | 1.1865 | 0.5744 |
| 1.2865 | −0.9628 | 0.5744 | −0.7691 | 1.1668 | 0.5744 |
| 1.2536 | −0.9468 | 0.5744 | −0.7381 | 1.1391 | 0.5744 |
| 1.2147 | −0.9278 | 0.5744 | −0.7035 | 1.1059 | 0.5744 |
| 1.1699 | −0.9056 | 0.5744 | −0.6671 | 1.0703 | 0.5744 |
| 1.1194 | −0.8803 | 0.5744 | −0.6265 | 1.0295 | 0.5744 |
| 1.0630 | −0.8517 | 0.5744 | −0.5819 | 0.9839 | 0.5744 |
| 1.0008 | −0.8196 | 0.5744 | −0.5330 | 0.9334 | 0.5744 |
| 0.9330 | −0.7840 | 0.5744 | −0.4821 | 0.8804 | 0.5744 |
| 0.8625 | −0.7463 | 0.5744 | −0.4291 | 0.8251 | 0.5744 |
| 0.7896 | −0.7063 | 0.5744 | −0.3739 | 0.7674 | 0.5744 |
| 0.7142 | −0.6638 | 0.5744 | −0.3165 | 0.7074 | 0.5744 |
| 0.6365 | −0.6190 | 0.5744 | −0.2566 | 0.6453 | 0.5744 |
| 0.5565 | −0.5717 | 0.5744 | −0.1944 | 0.5811 | 0.5744 |
| 0.4745 | −0.5216 | 0.5744 | −0.1299 | 0.5147 | 0.5744 |
| 0.3904 | −0.4684 | 0.5744 | −0.0628 | 0.4463 | 0.5744 |
| 0.3074 | −0.4138 | 0.5744 | 0.0043 | 0.3779 | 0.5744 |
| 0.2256 | −0.3577 | 0.5744 | 0.0716 | 0.3098 | 0.5744 |
| 0.1450 | −0.2997 | 0.5744 | 0.1391 | 0.2417 | 0.5744 |
| 0.0658 | −0.2397 | 0.5744 | 0.2060 | 0.1733 | 0.5744 |
| −0.0117 | −0.1774 | 0.5744 | 0.2724 | 0.1041 | 0.5744 |
| −0.0873 | −0.1124 | 0.5744 | 0.3386 | 0.0348 | 0.5744 |
| −0.1606 | −0.0440 | 0.5744 | 0.4047 | −0.0344 | 0.5744 |
| −0.2318 | 0.0274 | 0.5744 | 0.4711 | −0.1036 | 0.5744 |
| −0.3005 | 0.1010 | 0.5744 | 0.5378 | −0.1723 | 0.5744 |
| −0.3669 | 0.1768 | 0.5744 | 0.6050 | −0.2406 | 0.5744 |
| −0.4305 | 0.2547 | 0.5744 | 0.6728 | −0.3084 | 0.5744 |
| −0.4898 | 0.3321 | 0.5744 | 0.7389 | −0.3732 | 0.5744 |
| −0.5445 | 0.4087 | 0.5744 | 0.8032 | −0.4353 | 0.5744 |
| −0.5947 | 0.4842 | 0.5744 | 0.8657 | −0.4946 | 0.5744 |
| −0.6410 | 0.5583 | 0.5744 | 0.9265 | −0.5511 | 0.5744 |
| −0.6830 | 0.6312 | 0.5744 | 0.9854 | −0.6052 | 0.5744 |
| −0.7211 | 0.7022 | 0.5744 | 1.0421 | −0.6566 | 0.5744 |
| −0.7559 | 0.7714 | 0.5744 | 1.0969 | −0.7056 | 0.5744 |
| −0.7862 | 0.8390 | 0.5744 | 1.1472 | −0.7499 | 0.5744 |
| −0.8121 | 0.9011 | 0.5744 | 1.1930 | −0.7898 | 0.5744 |
| −0.8333 | 0.9579 | 0.5744 | 1.2340 | −0.8253 | 0.5744 |
| −0.8504 | 1.0089 | 0.5744 | 1.2704 | −0.8564 | 0.5744 |
| −0.8649 | 1.0574 | 0.5744 | 1.3020 | −0.8833 | 0.5744 |
| −0.8754 | 1.0998 | 0.5744 | 1.3288 | −0.9062 | 0.5744 |
| −0.8810 | 1.1330 | 0.5744 | 1.3517 | −0.9255 | 0.5744 |
| −0.8826 | 1.1598 | 0.5744 | 1.3710 | −0.9417 | 0.5744 |
| −0.8809 | 1.1799 | 0.5744 | 1.3868 | −0.9552 | 0.5744 |
| −0.8764 | 1.1943 | 0.5744 | 1.3996 | −0.9658 | 0.5744 |
| −0.8722 | 1.2015 | 0.5744 | 1.4092 | −0.9742 | 0.5744 |
| −0.8683 | 1.2054 | 0.5744 | 1.4142 | −0.9824 | 0.5744 |
| −0.8662 | 1.2071 | 0.5744 | 1.4154 | −0.9904 | 0.5744 |
| −0.8651 | 1.2079 | 0.5744 | 1.4141 | −0.9968 | 0.5744 |
| 1.3913 | −1.0337 | 0.8384 | −0.8459 | 1.2306 | 0.8384 |
| 1.3880 | −1.0374 | 0.8384 | −0.8452 | 1.2309 | 0.8384 |
| 1.3824 | −1.0411 | 0.8384 | −0.8441 | 1.2315 | 0.8384 |
| 1.3745 | −1.0430 | 0.8384 | −0.8417 | 1.2326 | 0.8384 |
| 1.3648 | −1.0413 | 0.8384 | −0.8367 | 1.2338 | 0.8384 |
| 1.3531 | −1.0351 | 0.8384 | −0.8285 | 1.2340 | 0.8384 |
| 1.3377 | −1.0270 | 0.8384 | −0.8143 | 1.2310 | 0.8384 |
| 1.3187 | −1.0168 | 0.8384 | −0.7965 | 1.2231 | 0.8384 |
| 1.2956 | −1.0044 | 0.8384 | −0.7748 | 1.2095 | 0.8384 |
| 1.2682 | −0.9896 | 0.8384 | −0.7493 | 1.1902 | 0.8384 |

TABLE 6-continued

| SUCTION SIDE | | | PRESSURE SIDE | | |
|---|---|---|---|---|---|
| X | Y | Z | X | Y | Z |
| 1.2360 | −0.9720 | 0.8384 | −0.7179 | 1.1630 | 0.8384 |
| 1.1981 | −0.9514 | 0.8384 | −0.6826 | 1.1302 | 0.8384 |
| 1.1545 | −0.9272 | 0.8384 | −0.6456 | 1.0946 | 0.8384 |
| 1.1052 | −0.8996 | 0.8384 | −0.6046 | 1.0542 | 0.8384 |
| 1.0502 | −0.8686 | 0.8384 | −0.5594 | 1.0088 | 0.8384 |
| 0.9897 | −0.8339 | 0.8384 | −0.5098 | 0.9585 | 0.8384 |
| 0.9236 | −0.7956 | 0.8384 | −0.4585 | 0.9056 | 0.8384 |
| 0.8548 | −0.7550 | 0.8384 | −0.4053 | 0.8501 | 0.8384 |
| 0.7837 | −0.7123 | 0.8384 | −0.3500 | 0.7921 | 0.8384 |
| 0.7102 | −0.6671 | 0.8384 | −0.2925 | 0.7317 | 0.8384 |
| 0.6343 | −0.6196 | 0.8384 | −0.2328 | 0.6691 | 0.8384 |
| 0.5562 | −0.5694 | 0.8384 | −0.1710 | 0.6040 | 0.8384 |
| 0.4760 | −0.5166 | 0.8384 | −0.1069 | 0.5367 | 0.8384 |
| 0.3941 | −0.4608 | 0.8384 | −0.0406 | 0.4671 | 0.8384 |
| 0.3130 | −0.4038 | 0.8384 | 0.0259 | 0.3975 | 0.8384 |
| 0.2331 | −0.3453 | 0.8384 | 0.0921 | 0.3278 | 0.8384 |
| 0.1543 | −0.2853 | 0.8384 | 0.1584 | 0.2581 | 0.8384 |
| 0.0771 | −0.2233 | 0.8384 | 0.2241 | 0.1880 | 0.8384 |
| 0.0014 | −0.1592 | 0.8384 | 0.2891 | 0.1171 | 0.8384 |
| −0.0723 | −0.0927 | 0.8384 | 0.3540 | 0.0460 | 0.8384 |
| −0.1438 | −0.0232 | 0.8384 | 0.4186 | −0.0251 | 0.8384 |
| −0.2132 | 0.0490 | 0.8384 | 0.4834 | −0.0962 | 0.8384 |
| −0.2807 | 0.1236 | 0.8384 | 0.5485 | −0.1671 | 0.8384 |
| −0.3458 | 0.2002 | 0.8384 | 0.6139 | −0.2376 | 0.8384 |
| −0.4086 | 0.2788 | 0.8384 | 0.6796 | −0.3077 | 0.8384 |
| −0.4670 | 0.3565 | 0.8384 | 0.7436 | −0.3751 | 0.8384 |
| −0.5209 | 0.4334 | 0.8384 | 0.8059 | −0.4397 | 0.8384 |
| −0.5708 | 0.5090 | 0.8384 | 0.8663 | −0.5016 | 0.8384 |
| −0.6167 | 0.5831 | 0.8384 | 0.9251 | −0.5608 | 0.8384 |
| −0.6587 | 0.6558 | 0.8384 | 0.9818 | −0.6174 | 0.8384 |
| −0.6970 | 0.7267 | 0.8384 | 1.0366 | −0.6714 | 0.8384 |
| −0.7317 | 0.7957 | 0.8384 | 1.0894 | −0.7229 | 0.8384 |
| −0.7625 | 0.8629 | 0.8384 | 1.1378 | −0.7696 | 0.8384 |
| −0.7889 | 0.9246 | 0.8384 | 1.1820 | −0.8116 | 0.8384 |
| −0.8108 | 0.9810 | 0.8384 | 1.2215 | −0.8491 | 0.8384 |
| −0.8286 | 1.0317 | 0.8384 | 1.2565 | −0.8822 | 0.8384 |
| −0.8437 | 1.0798 | 0.8384 | 1.2869 | −0.9107 | 0.8384 |
| −0.8547 | 1.1221 | 0.8384 | 1.3127 | −0.9348 | 0.8384 |
| −0.8607 | 1.1552 | 0.8384 | 1.3347 | −0.9553 | 0.8384 |
| −0.8629 | 1.1819 | 0.8384 | 1.3533 | −0.9726 | 0.8384 |
| −0.8615 | 1.2019 | 0.8384 | 1.3685 | −0.9867 | 0.8384 |
| −0.8575 | 1.2165 | 0.8384 | 1.3807 | −0.9980 | 0.8384 |
| −0.8532 | 1.2238 | 0.8384 | 1.3900 | −1.0069 | 0.8384 |
| −0.8497 | 1.2278 | 0.8384 | 1.3946 | −1.0153 | 0.8384 |
| −0.8475 | 1.2295 | 0.8384 | 1.3952 | −1.0233 | 0.8384 |
| −0.8464 | 1.2302 | 0.8384 | 1.3936 | −1.0295 | 0.8384 |
| 1.3648 | −1.0812 | 1.1024 | −0.8295 | 1.2405 | 1.1024 |
| 1.3613 | −1.0847 | 1.1024 | −0.8290 | 1.2408 | 1.1024 |
| 1.3557 | −1.0881 | 1.1024 | −0.8278 | 1.2414 | 1.1024 |
| 1.3476 | −1.0897 | 1.1024 | −0.8254 | 1.2425 | 1.1024 |
| 1.3381 | −1.0876 | 1.1024 | −0.8203 | 1.2437 | 1.1024 |
| 1.3265 | −1.0809 | 1.1024 | −0.8122 | 1.2439 | 1.1024 |
| 1.3117 | −1.0722 | 1.1024 | −0.7979 | 1.2407 | 1.1024 |
| 1.2931 | −1.0612 | 1.1024 | −0.7802 | 1.2327 | 1.1024 |
| 1.2705 | −1.0478 | 1.1024 | −0.7583 | 1.2192 | 1.1024 |
| 1.2437 | −1.0318 | 1.1024 | −0.7327 | 1.1997 | 1.1024 |
| 1.2122 | −1.0131 | 1.1024 | −0.7009 | 1.1725 | 1.1024 |
| 1.1752 | −0.9908 | 1.1024 | −0.6655 | 1.1397 | 1.1024 |
| 1.1327 | −0.9650 | 1.1024 | −0.6283 | 1.1040 | 1.1024 |
| 1.0845 | −0.9355 | 1.1024 | −0.5871 | 1.0634 | 1.1024 |
| 1.0308 | −0.9024 | 1.1024 | −0.5417 | 1.0178 | 1.1024 |
| 0.9716 | −0.8654 | 1.1024 | −0.4922 | 0.9672 | 1.1024 |
| 0.9071 | −0.8245 | 1.1024 | −0.4409 | 0.9139 | 1.1024 |
| 0.8399 | −0.7814 | 1.1024 | −0.3877 | 0.8578 | 1.1024 |
| 0.7704 | −0.7361 | 1.1024 | −0.3325 | 0.7992 | 1.1024 |
| 0.6984 | −0.6885 | 1.1024 | −0.2754 | 0.7381 | 1.1024 |
| 0.6244 | −0.6382 | 1.1024 | −0.2162 | 0.6746 | 1.1024 |
| 0.5481 | −0.5856 | 1.1024 | −0.1548 | 0.6086 | 1.1024 |
| 0.4697 | −0.5302 | 1.1024 | −0.0914 | 0.5400 | 1.1024 |
| 0.3896 | −0.4718 | 1.1024 | −0.0261 | 0.4691 | 1.1024 |
| 0.3104 | −0.4124 | 1.1024 | 0.0393 | 0.3980 | 1.1024 |
| 0.2321 | −0.3516 | 1.1024 | 0.1045 | 0.3268 | 1.1024 |
| 0.1552 | −0.2893 | 1.1024 | 0.1696 | 0.2556 | 1.1024 |
| 0.0798 | −0.2252 | 1.1024 | 0.2340 | 0.1837 | 1.1024 |
| 0.0060 | −0.1592 | 1.1024 | 0.2977 | 0.1111 | 1.1024 |
| −0.0659 | −0.0911 | 1.1024 | 0.3610 | 0.0382 | 1.1024 |

TABLE 6-continued

| SUCTION SIDE | | | PRESSURE SIDE | | |
|---|---|---|---|---|---|
| X | Y | Z | X | Y | Z |
| −0.1357 | −0.0203 | 1.1024 | 0.4243 | −0.0347 | 1.1024 |
| −0.2033 | 0.0531 | 1.1024 | 0.4874 | −0.1077 | 1.1024 |
| −0.2691 | 0.1287 | 1.1024 | 0.5508 | −0.1806 | 1.1024 |
| −0.3330 | 0.2064 | 1.1024 | 0.6145 | −0.2531 | 1.1024 |
| −0.3946 | 0.2860 | 1.1024 | 0.6785 | −0.3255 | 1.1024 |
| −0.4519 | 0.3645 | 1.1024 | 0.7405 | −0.3952 | 1.1024 |
| −0.5050 | 0.4420 | 1.1024 | 0.8008 | −0.4622 | 1.1024 |
| −0.5540 | 0.5183 | 1.1024 | 0.8593 | −0.5264 | 1.1024 |
| −0.5993 | 0.5928 | 1.1024 | 0.9159 | −0.5881 | 1.1024 |
| −0.6407 | 0.6658 | 1.1024 | 0.9707 | −0.6470 | 1.1024 |
| −0.6786 | 0.7369 | 1.1024 | 1.0236 | −0.7033 | 1.1024 |
| −0.7131 | 0.8059 | 1.1024 | 1.0746 | −0.7569 | 1.1024 |
| −0.7438 | 0.8731 | 1.1024 | 1.1214 | −0.8057 | 1.1024 |
| −0.7702 | 0.9349 | 1.1024 | 1.1638 | −0.8497 | 1.1024 |
| −0.7923 | 0.9912 | 1.1024 | 1.2020 | −0.8889 | 1.1024 |
| −0.8105 | 1.0417 | 1.1024 | 1.2357 | −0.9235 | 1.1024 |
| −0.8259 | 1.0897 | 1.1024 | 1.2651 | −0.9533 | 1.1024 |
| −0.8371 | 1.1318 | 1.1024 | 1.2899 | −0.9785 | 1.1024 |
| −0.8434 | 1.1649 | 1.1024 | 1.3111 | −1.0001 | 1.1024 |
| −0.8458 | 1.1916 | 1.1024 | 1.3290 | −1.0182 | 1.1024 |
| −0.8447 | 1.2117 | 1.1024 | 1.3438 | −1.0331 | 1.1024 |
| −0.8409 | 1.2262 | 1.1024 | 1.3555 | −1.0449 | 1.1024 |
| −0.8369 | 1.2336 | 1.1024 | 1.3645 | −1.0541 | 1.1024 |
| −0.8333 | 1.2376 | 1.1024 | 1.3687 | −1.0628 | 1.1024 |
| −0.8313 | 1.2394 | 1.1024 | 1.3691 | −1.0708 | 1.1024 |
| −0.8301 | 1.2402 | 1.1024 | 1.3673 | −1.0770 | 1.1024 |
| 1.3370 | −1.1367 | 1.3664 | −0.8145 | 1.2403 | 1.3664 |
| 1.3335 | −1.1402 | 1.3664 | −0.8139 | 1.2406 | 1.3664 |
| 1.3277 | −1.1433 | 1.3664 | −0.8127 | 1.2412 | 1.3664 |
| 1.3196 | −1.1446 | 1.3664 | −0.8103 | 1.2422 | 1.3664 |
| 1.3101 | −1.1420 | 1.3664 | −0.8052 | 1.2434 | 1.3664 |
| 1.2989 | −1.1349 | 1.3664 | −0.7970 | 1.2435 | 1.3664 |
| 1.2843 | −1.1256 | 1.3664 | −0.7827 | 1.2401 | 1.3664 |
| 1.2660 | −1.1140 | 1.3664 | −0.7650 | 1.2318 | 1.3664 |
| 1.2439 | −1.0998 | 1.3664 | −0.7432 | 1.2180 | 1.3664 |
| 1.2176 | −1.0829 | 1.3664 | −0.7177 | 1.1983 | 1.3664 |
| 1.1868 | −1.0632 | 1.3664 | −0.6860 | 1.1707 | 1.3664 |
| 1.1506 | −1.0395 | 1.3664 | −0.6506 | 1.1375 | 1.3664 |
| 1.1089 | −1.0122 | 1.3664 | −0.6136 | 1.1015 | 1.3664 |
| 1.0617 | −0.9810 | 1.3664 | −0.5725 | 1.0604 | 1.3664 |
| 1.0091 | −0.9461 | 1.3664 | −0.5273 | 1.0143 | 1.3664 |
| 0.9511 | −0.9071 | 1.3664 | −0.4779 | 0.9631 | 1.3664 |
| 0.8880 | −0.8641 | 1.3664 | −0.4269 | 0.9090 | 1.3664 |
| 0.8223 | −0.8187 | 1.3664 | −0.3740 | 0.8523 | 1.3664 |
| 0.7541 | −0.7713 | 1.3664 | −0.3193 | 0.7928 | 1.3664 |
| 0.6835 | −0.7214 | 1.3664 | −0.2627 | 0.7309 | 1.3664 |
| 0.6110 | −0.6689 | 1.3664 | −0.2041 | 0.6663 | 1.3664 |
| 0.5362 | −0.6139 | 1.3664 | −0.1434 | 0.5993 | 1.3664 |
| 0.4595 | −0.5561 | 1.3664 | −0.0809 | 0.5296 | 1.3664 |
| 0.3809 | −0.4954 | 1.3664 | −0.0165 | 0.4572 | 1.3664 |
| 0.3034 | −0.4336 | 1.3664 | 0.0479 | 0.3848 | 1.3664 |
| 0.2268 | −0.3707 | 1.3664 | 0.1121 | 0.3123 | 1.3664 |
| 0.1516 | −0.3062 | 1.3664 | 0.1760 | 0.2395 | 1.3664 |
| 0.0779 | −0.2401 | 1.3664 | 0.2393 | 0.1660 | 1.3664 |
| 0.0058 | −0.1722 | 1.3664 | 0.3017 | 0.0919 | 1.3664 |
| −0.0645 | −0.1024 | 1.3664 | 0.3637 | 0.0174 | 1.3664 |
| −0.1327 | −0.0301 | 1.3664 | 0.4256 | −0.0572 | 1.3664 |
| −0.1986 | 0.0446 | 1.3664 | 0.4873 | −0.1319 | 1.3664 |
| −0.2628 | 0.1213 | 1.3664 | 0.5491 | −0.2067 | 1.3664 |
| −0.3252 | 0.2001 | 1.3664 | 0.6111 | −0.2811 | 1.3664 |
| −0.3857 | 0.2808 | 1.3664 | 0.6733 | −0.3554 | 1.3664 |
| −0.4418 | 0.3603 | 1.3664 | 0.7335 | −0.4273 | 1.3664 |
| −0.4938 | 0.4386 | 1.3664 | 0.7920 | −0.4962 | 1.3664 |
| −0.5419 | 0.5154 | 1.3664 | 0.8487 | −0.5625 | 1.3664 |
| −0.5864 | 0.5906 | 1.3664 | 0.9035 | −0.6262 | 1.3664 |
| −0.6272 | 0.6640 | 1.3664 | 0.9564 | −0.6872 | 1.3664 |
| −0.6644 | 0.7355 | 1.3664 | 1.0077 | −0.7454 | 1.3664 |
| −0.6983 | 0.8050 | 1.3664 | 1.0571 | −0.8010 | 1.3664 |
| −0.7287 | 0.8724 | 1.3664 | 1.1023 | −0.8516 | 1.3664 |
| −0.7547 | 0.9342 | 1.3664 | 1.1433 | −0.8972 | 1.3664 |
| −0.7767 | 0.9906 | 1.3664 | 1.1803 | −0.9378 | 1.3664 |
| −0.7946 | 1.0413 | 1.3664 | 1.2129 | −0.9737 | 1.3664 |
| −0.8101 | 1.0894 | 1.3664 | 1.2413 | −1.0047 | 1.3664 |
| −0.8214 | 1.1315 | 1.3664 | 1.2653 | −1.0309 | 1.3664 |
| −0.8278 | 1.1645 | 1.3664 | 1.2859 | −1.0533 | 1.3664 |
| −0.8303 | 1.1913 | 1.3664 | 1.3031 | −1.0721 | 1.3664 |

TABLE 6-continued

| SUCTION SIDE | | | PRESSURE SIDE | | |
|---|---|---|---|---|---|
| X | Y | Z | X | Y | Z |
| −0.8294 | 1.2113 | 1.3664 | 1.3174 | −1.0875 | 1.3664 |
| −0.8258 | 1.2260 | 1.3664 | 1.3288 | −1.0998 | 1.3664 |
| −0.8218 | 1.2334 | 1.3664 | 1.3374 | −1.1094 | 1.3664 |
| −0.8183 | 1.2374 | 1.3664 | 1.3415 | −1.1182 | 1.3664 |
| −0.8162 | 1.2392 | 1.3664 | 1.3418 | −1.1263 | 1.3664 |
| −0.8150 | 1.2400 | 1.3664 | 1.3397 | −1.1326 | 1.3664 |
| 1.2977 | −1.2234 | 1.7888 | −0.7924 | 1.2316 | 1.7888 |
| 1.2940 | −1.2266 | 1.7888 | −0.7919 | 1.2319 | 1.7888 |
| 1.2881 | −1.2295 | 1.7888 | −0.7907 | 1.2326 | 1.7888 |
| 1.2799 | −1.2305 | 1.7888 | −0.7883 | 1.2335 | 1.7888 |
| 1.2706 | −1.2273 | 1.7888 | −0.7831 | 1.2347 | 1.7888 |
| 1.2596 | −1.2196 | 1.7888 | −0.7749 | 1.2347 | 1.7888 |
| 1.2453 | −1.2096 | 1.7888 | −0.7606 | 1.2310 | 1.7888 |
| 1.2276 | −1.1973 | 1.7888 | −0.7430 | 1.2224 | 1.7888 |
| 1.2060 | −1.1821 | 1.7888 | −0.7214 | 1.2081 | 1.7888 |
| 1.1803 | −1.1641 | 1.7888 | −0.6959 | 1.1877 | 1.7888 |
| 1.1503 | −1.1429 | 1.7888 | −0.6646 | 1.1592 | 1.7888 |
| 1.1149 | −1.1178 | 1.7888 | −0.6298 | 1.1252 | 1.7888 |
| 1.0743 | −1.0885 | 1.7888 | −0.5932 | 1.0882 | 1.7888 |
| 1.0282 | −1.0554 | 1.7888 | −0.5525 | 1.0462 | 1.7888 |
| 0.9770 | −1.0181 | 1.7888 | −0.5078 | 0.9990 | 1.7888 |
| 0.9205 | −0.9766 | 1.7888 | −0.4590 | 0.9466 | 1.7888 |
| 0.8590 | −0.9308 | 1.7888 | −0.4087 | 0.8914 | 1.7888 |
| 0.7949 | −0.8825 | 1.7888 | −0.3566 | 0.8333 | 1.7888 |
| 0.7284 | −0.8321 | 1.7888 | −0.3026 | 0.7726 | 1.7888 |
| 0.6598 | −0.7792 | 1.7888 | −0.2469 | 0.7091 | 1.7888 |
| 0.5890 | −0.7237 | 1.7888 | −0.1892 | 0.6431 | 1.7888 |
| 0.5164 | −0.6655 | 1.7888 | −0.1297 | 0.5743 | 1.7888 |
| 0.4418 | −0.6046 | 1.7888 | −0.0682 | 0.5029 | 1.7888 |
| 0.3656 | −0.5406 | 1.7888 | −0.0051 | 0.4286 | 1.7888 |
| 0.2903 | −0.4756 | 1.7888 | 0.0580 | 0.3543 | 1.7888 |
| 0.2162 | −0.4096 | 1.7888 | 0.1207 | 0.2797 | 1.7888 |
| 0.1434 | −0.3422 | 1.7888 | 0.1831 | 0.2049 | 1.7888 |
| 0.0722 | −0.2735 | 1.7888 | 0.2447 | 0.1293 | 1.7888 |
| 0.0025 | −0.2031 | 1.7888 | 0.3053 | 0.0529 | 1.7888 |
| −0.0654 | −0.1310 | 1.7888 | 0.3656 | −0.0238 | 1.7888 |
| −0.1310 | −0.0567 | 1.7888 | 0.4256 | −0.1006 | 1.7888 |
| −0.1945 | 0.0197 | 1.7888 | 0.4853 | −0.1778 | 1.7888 |
| −0.2562 | 0.0979 | 1.7888 | 0.5449 | −0.2550 | 1.7888 |
| −0.3161 | 0.1778 | 1.7888 | 0.6043 | −0.3323 | 1.7888 |
| −0.3742 | 0.2595 | 1.7888 | 0.6640 | −0.4095 | 1.7888 |
| −0.4286 | 0.3401 | 1.7888 | 0.7219 | −0.4840 | 1.7888 |
| −0.4792 | 0.4199 | 1.7888 | 0.7780 | −0.5557 | 1.7888 |
| −0.5262 | 0.4982 | 1.7888 | 0.8322 | −0.6247 | 1.7888 |
| −0.5696 | 0.5747 | 1.7888 | 0.8846 | −0.6910 | 1.7888 |
| −0.6094 | 0.6492 | 1.7888 | 0.9352 | −0.7546 | 1.7888 |
| −0.6458 | 0.7219 | 1.7888 | 0.9842 | −0.8154 | 1.7888 |
| −0.6789 | 0.7922 | 1.7888 | 1.0313 | −0.8734 | 1.7888 |
| −0.7087 | 0.8604 | 1.7888 | 1.0745 | −0.9263 | 1.7888 |
| −0.7341 | 0.9232 | 1.7888 | 1.1138 | −0.9741 | 1.7888 |
| −0.7556 | 0.9802 | 1.7888 | 1.1489 | −1.0166 | 1.7888 |
| −0.7732 | 1.0314 | 1.7888 | 1.1802 | −1.0541 | 1.7888 |
| −0.7885 | 1.0798 | 1.7888 | 1.2072 | −1.0866 | 1.7888 |
| −0.7998 | 1.1223 | 1.7888 | 1.2302 | −1.1140 | 1.7888 |
| −0.8063 | 1.1555 | 1.7888 | 1.2498 | −1.1374 | 1.7888 |
| −0.8087 | 1.1824 | 1.7888 | 1.2664 | −1.1572 | 1.7888 |
| −0.8077 | 1.2027 | 1.7888 | 1.2800 | −1.1733 | 1.7888 |
| −0.8039 | 1.2174 | 1.7888 | 1.2909 | −1.1862 | 1.7888 |
| −0.7999 | 1.2247 | 1.7888 | 1.2992 | −1.1961 | 1.7888 |
| −0.7963 | 1.2289 | 1.7888 | 1.3030 | −1.2051 | 1.7888 |
| −0.7942 | 1.2306 | 1.7888 | 1.3029 | −1.2132 | 1.7888 |
| −0.7931 | 1.2313 | 1.7888 | 1.3007 | −1.2194 | 1.7888 |
| 1.2690 | −1.3065 | 2.2112 | −0.7742 | 1.2129 | 2.2112 |
| 1.2652 | −1.3097 | 2.2112 | −0.7735 | 1.2132 | 2.2112 |
| 1.2591 | −1.3124 | 2.2112 | −0.7724 | 1.2138 | 2.2112 |
| 1.2508 | −1.3129 | 2.2112 | −0.7699 | 1.2147 | 2.2112 |
| 1.2416 | −1.3093 | 2.2112 | −0.7646 | 1.2158 | 2.2112 |
| 1.2309 | −1.3013 | 2.2112 | −0.7564 | 1.2155 | 2.2112 |
| 1.2168 | −1.2910 | 2.2112 | −0.7422 | 1.2113 | 2.2112 |
| 1.1993 | −1.2780 | 2.2112 | −0.7246 | 1.2023 | 2.2112 |
| 1.1781 | −1.2621 | 2.2112 | −0.7033 | 1.1873 | 2.2112 |
| 1.1528 | −1.2432 | 2.2112 | −0.6783 | 1.1661 | 2.2112 |
| 1.1233 | −1.2212 | 2.2112 | −0.6474 | 1.1368 | 2.2112 |
| 1.0885 | −1.1949 | 2.2112 | −0.6132 | 1.1016 | 2.2112 |
| 1.0485 | −1.1643 | 2.2112 | −0.5772 | 1.0637 | 2.2112 |
| 1.0032 | −1.1297 | 2.2112 | −0.5372 | 1.0206 | 2.2112 |

TABLE 6-continued

| SUCTION SIDE | | | PRESSURE SIDE | | |
|---|---|---|---|---|---|
| X | Y | Z | X | Y | Z |
| 0.9528 | −1.0908 | 2.2112 | −0.4932 | 0.9723 | 2.2112 |
| 0.8973 | −1.0476 | 2.2112 | −0.4452 | 0.9186 | 2.2112 |
| 0.8368 | −0.9998 | 2.2112 | −0.3958 | 0.8619 | 2.2112 |
| 0.7738 | −0.9496 | 2.2112 | −0.3446 | 0.8025 | 2.2112 |
| 0.7087 | −0.8970 | 2.2112 | −0.2915 | 0.7404 | 2.2112 |
| 0.6413 | −0.8417 | 2.2112 | −0.2365 | 0.6755 | 2.2112 |
| 0.5719 | −0.7840 | 2.2112 | −0.1798 | 0.6078 | 2.2112 |
| 0.5006 | −0.7234 | 2.2112 | −0.1213 | 0.5375 | 2.2112 |
| 0.4277 | −0.6598 | 2.2112 | −0.0609 | 0.4644 | 2.2112 |
| 0.3530 | −0.5933 | 2.2112 | 0.0012 | 0.3886 | 2.2112 |
| 0.2794 | −0.5258 | 2.2112 | 0.0630 | 0.3126 | 2.2112 |
| 0.2071 | −0.4571 | 2.2112 | 0.1246 | 0.2363 | 2.2112 |
| 0.1360 | −0.3872 | 2.2112 | 0.1860 | 0.1598 | 2.2112 |
| 0.0664 | −0.3160 | 2.2112 | 0.2464 | 0.0826 | 2.2112 |
| −0.0015 | −0.2432 | 2.2112 | 0.3058 | 0.0045 | 2.2112 |
| −0.0677 | −0.1687 | 2.2112 | 0.3648 | −0.0739 | 2.2112 |
| −0.1316 | −0.0922 | 2.2112 | 0.4235 | −0.1526 | 2.2112 |
| −0.1932 | −0.0136 | 2.2112 | 0.4816 | −0.2316 | 2.2112 |
| −0.2533 | 0.0665 | 2.2112 | 0.5396 | −0.3108 | 2.2112 |
| −0.3117 | 0.1483 | 2.2112 | 0.5974 | −0.3901 | 2.2112 |
| −0.3682 | 0.2316 | 2.2112 | 0.6552 | −0.4694 | 2.2112 |
| −0.4211 | 0.3139 | 2.2112 | 0.7113 | −0.5458 | 2.2112 |
| −0.4706 | 0.3949 | 2.2112 | 0.7657 | −0.6194 | 2.2112 |
| −0.5163 | 0.4741 | 2.2112 | 0.8183 | −0.6905 | 2.2112 |
| −0.5583 | 0.5515 | 2.2112 | 0.8690 | −0.7587 | 2.2112 |
| −0.5970 | 0.6269 | 2.2112 | 0.9181 | −0.8241 | 2.2112 |
| −0.6324 | 0.7002 | 2.2112 | 0.9655 | −0.8866 | 2.2112 |
| −0.6646 | 0.7712 | 2.2112 | 1.0112 | −0.9464 | 2.2112 |
| −0.6936 | 0.8400 | 2.2112 | 1.0530 | −1.0009 | 2.2112 |
| −0.7183 | 0.9032 | 2.2112 | 1.0910 | −1.0501 | 2.2112 |
| −0.7390 | 0.9605 | 2.2112 | 1.1251 | −1.0940 | 2.2112 |
| −0.7562 | 1.0121 | 2.2112 | 1.1553 | −1.1327 | 2.2112 |
| −0.7711 | 1.0606 | 2.2112 | 1.1816 | −1.1661 | 2.2112 |
| −0.7822 | 1.1033 | 2.2112 | 1.2037 | −1.1944 | 2.2112 |
| −0.7883 | 1.1367 | 2.2112 | 1.2228 | −1.2185 | 2.2112 |
| −0.7906 | 1.1637 | 2.2112 | 1.2388 | −1.2388 | 2.2112 |
| −0.7896 | 1.1840 | 2.2112 | 1.2520 | −1.2555 | 2.2112 |
| −0.7858 | 1.1988 | 2.2112 | 1.2627 | −1.2688 | 2.2112 |
| −0.7818 | 1.2061 | 2.2112 | 1.2708 | −1.2790 | 2.2112 |
| −0.7781 | 1.2102 | 2.2112 | 1.2746 | −1.2881 | 2.2112 |
| −0.7759 | 1.2119 | 2.2112 | 1.2744 | −1.2963 | 2.2112 |
| −0.7748 | 1.2126 | 2.2112 | 1.2720 | −1.3025 | 2.2112 |
| 1.2490 | −1.3929 | 2.6864 | −0.7586 | 1.1828 | 2.6864 |
| 1.2450 | −1.3960 | 2.6864 | −0.7580 | 1.1831 | 2.6864 |
| 1.2389 | −1.3986 | 2.6864 | −0.7568 | 1.1837 | 2.6864 |
| 1.2306 | −1.3988 | 2.6864 | −0.7543 | 1.1845 | 2.6864 |
| 1.2215 | −1.3948 | 2.6864 | −0.7490 | 1.1853 | 2.6864 |
| 1.2108 | −1.3864 | 2.6864 | −0.7407 | 1.1845 | 2.6864 |
| 1.1969 | −1.3758 | 2.6864 | −0.7266 | 1.1796 | 2.6864 |
| 1.1796 | −1.3623 | 2.6864 | −0.7094 | 1.1695 | 2.6864 |
| 1.1585 | −1.3460 | 2.6864 | −0.6885 | 1.1537 | 2.6864 |
| 1.1335 | −1.3265 | 2.6864 | −0.6640 | 1.1317 | 2.6864 |
| 1.1044 | −1.3036 | 2.6864 | −0.6338 | 1.1014 | 2.6864 |
| 1.0699 | −1.2764 | 2.6864 | −0.6001 | 1.0653 | 2.6864 |
| 1.0303 | −1.2449 | 2.6864 | −0.5650 | 1.0262 | 2.6864 |
| 0.9856 | −1.2092 | 2.6864 | −0.5258 | 0.9819 | 2.6864 |
| 0.9355 | −1.1692 | 2.6864 | −0.4828 | 0.9320 | 2.6864 |
| 0.8806 | −1.1245 | 2.6864 | −0.4360 | 0.8767 | 2.6864 |
| 0.8208 | −1.0751 | 2.6864 | −0.3877 | 0.8186 | 2.6864 |
| 0.7587 | −1.0233 | 2.6864 | −0.3375 | 0.7576 | 2.6864 |
| 0.6943 | −0.9690 | 2.6864 | −0.2855 | 0.6939 | 2.6864 |
| 0.6278 | −0.9121 | 2.6864 | −0.2317 | 0.6275 | 2.6864 |
| 0.5594 | −0.8523 | 2.6864 | −0.1761 | 0.5581 | 2.6864 |
| 0.4892 | −0.7897 | 2.6864 | −0.1188 | 0.4861 | 2.6864 |
| 0.4173 | −0.7242 | 2.6864 | −0.0595 | 0.4114 | 2.6864 |
| 0.3438 | −0.6556 | 2.6864 | 0.0016 | 0.3339 | 2.6864 |
| 0.2714 | −0.5860 | 2.6864 | 0.0624 | 0.2562 | 2.6864 |
| 0.2004 | −0.5151 | 2.6864 | 0.1231 | 0.1784 | 2.6864 |
| 0.1307 | −0.4431 | 2.6864 | 0.1836 | 0.1004 | 2.6864 |
| 0.0627 | −0.3696 | 2.6864 | 0.2433 | 0.0219 | 2.6864 |
| −0.0037 | −0.2946 | 2.6864 | 0.3020 | −0.0574 | 2.6864 |
| −0.0682 | −0.2180 | 2.6864 | 0.3603 | −0.1373 | 2.6864 |
| −0.1306 | −0.1394 | 2.6864 | 0.4181 | −0.2173 | 2.6864 |
| −0.1908 | −0.0588 | 2.6864 | 0.4754 | −0.2977 | 2.6864 |
| −0.2494 | 0.0231 | 2.6864 | 0.5324 | −0.3783 | 2.6864 |
| −0.3066 | 0.1066 | 2.6864 | 0.5892 | −0.4589 | 2.6864 |

TABLE 6-continued

| SUCTION SIDE | | | PRESSURE SIDE | | |
|---|---|---|---|---|---|
| X | Y | Z | X | Y | Z |
| −0.3618 | 0.1915 | 2.6864 | 0.6461 | −0.5397 | 2.6864 |
| −0.4134 | 0.2753 | 2.6864 | 0.7012 | −0.6177 | 2.6864 |
| −0.4617 | 0.3575 | 2.6864 | 0.7546 | −0.6927 | 2.6864 |
| −0.5064 | 0.4377 | 2.6864 | 0.8063 | −0.7651 | 2.6864 |
| −0.5474 | 0.5161 | 2.6864 | 0.8561 | −0.8346 | 2.6864 |
| −0.5850 | 0.5923 | 2.6864 | 0.9043 | −0.9013 | 2.6864 |
| −0.6197 | 0.6663 | 2.6864 | 0.9508 | −0.9650 | 2.6864 |
| −0.6512 | 0.7380 | 2.6864 | 0.9958 | −1.0260 | 2.6864 |
| −0.6796 | 0.8073 | 2.6864 | 1.0369 | −1.0816 | 2.6864 |
| −0.7038 | 0.8710 | 2.6864 | 1.0741 | −1.1318 | 2.6864 |
| −0.7242 | 0.9288 | 2.6864 | 1.1075 | −1.1766 | 2.6864 |
| −0.7410 | 0.9806 | 2.6864 | 1.1372 | −1.2160 | 2.6864 |
| −0.7555 | 1.0296 | 2.6864 | 1.1631 | −1.2501 | 2.6864 |
| −0.7660 | 1.0725 | 2.6864 | 1.1849 | −1.2789 | 2.6864 |
| −0.7721 | 1.1061 | 2.6864 | 1.2036 | −1.3036 | 2.6864 |
| −0.7745 | 1.1331 | 2.6864 | 1.2195 | −1.3243 | 2.6864 |
| −0.7736 | 1.1536 | 2.6864 | 1.2324 | −1.3413 | 2.6864 |
| −0.7701 | 1.1685 | 2.6864 | 1.2428 | −1.3548 | 2.6864 |
| −0.7662 | 1.1760 | 2.6864 | 1.2508 | −1.3653 | 2.6864 |
| −0.7625 | 1.1801 | 2.6864 | 1.2547 | −1.3744 | 2.6864 |
| −0.7604 | 1.1817 | 2.6864 | 1.2545 | −1.3827 | 2.6864 |
| −0.7593 | 1.1824 | 2.6864 | 1.2521 | −1.3889 | 2.6864 |
| 1.2368 | −1.4653 | 3.1616 | −0.7476 | 1.1564 | 3.1616 |
| 1.2329 | −1.4685 | 3.1616 | −0.7471 | 1.1567 | 3.1616 |
| 1.2265 | −1.4708 | 3.1616 | −0.7459 | 1.1573 | 3.1616 |
| 1.2182 | −1.4708 | 3.1616 | −0.7433 | 1.1580 | 3.1616 |
| 1.2091 | −1.4664 | 3.1616 | −0.7379 | 1.1586 | 3.1616 |
| 1.1986 | −1.4579 | 3.1616 | −0.7296 | 1.1575 | 3.1616 |
| 1.1848 | −1.4469 | 3.1616 | −0.7157 | 1.1518 | 3.1616 |
| 1.1676 | −1.4331 | 3.1616 | −0.6988 | 1.1411 | 3.1616 |
| 1.1467 | −1.4163 | 3.1616 | −0.6783 | 1.1245 | 3.1616 |
| 1.1219 | −1.3963 | 3.1616 | −0.6542 | 1.1017 | 3.1616 |
| 1.0930 | −1.3728 | 3.1616 | −0.6246 | 1.0704 | 3.1616 |
| 1.0589 | −1.3449 | 3.1616 | −0.5917 | 1.0332 | 3.1616 |
| 1.0195 | −1.3126 | 3.1616 | −0.5574 | 0.9929 | 3.1616 |
| 0.9749 | −1.2762 | 3.1616 | −0.5192 | 0.9470 | 3.1616 |
| 0.9253 | −1.2351 | 3.1616 | −0.4773 | 0.8957 | 3.1616 |
| 0.8708 | −1.1893 | 3.1616 | −0.4317 | 0.8389 | 3.1616 |
| 0.8113 | −1.1387 | 3.1616 | −0.3844 | 0.7792 | 3.1616 |
| 0.7498 | −1.0856 | 3.1616 | −0.3354 | 0.7166 | 3.1616 |
| 0.6859 | −1.0298 | 3.1616 | −0.2846 | 0.6513 | 3.1616 |
| 0.6200 | −0.9714 | 3.1616 | −0.2318 | 0.5832 | 3.1616 |
| 0.5522 | −0.9103 | 3.1616 | −0.1774 | 0.5123 | 3.1616 |
| 0.4827 | −0.8461 | 3.1616 | −0.1211 | 0.4387 | 3.1616 |
| 0.4116 | −0.7789 | 3.1616 | −0.0628 | 0.3623 | 3.1616 |
| 0.3390 | −0.7086 | 3.1616 | −0.0026 | 0.2833 | 3.1616 |
| 0.2675 | −0.6372 | 3.1616 | 0.0573 | 0.2041 | 3.1616 |
| 0.1975 | −0.5645 | 3.1616 | 0.1173 | 0.1249 | 3.1616 |
| 0.1289 | −0.4907 | 3.1616 | 0.1773 | 0.0457 | 3.1616 |
| 0.0620 | −0.4153 | 3.1616 | 0.2366 | −0.0340 | 3.1616 |
| −0.0031 | −0.3384 | 3.1616 | 0.2950 | −0.1143 | 3.1616 |
| −0.0664 | −0.2600 | 3.1616 | 0.3530 | −0.1950 | 3.1616 |
| −0.1275 | −0.1795 | 3.1616 | 0.4104 | −0.2760 | 3.1616 |
| −0.1865 | −0.0973 | 3.1616 | 0.4674 | −0.3574 | 3.1616 |
| −0.2441 | −0.0137 | 3.1616 | 0.5242 | −0.4389 | 3.1616 |
| −0.3001 | 0.0712 | 3.1616 | 0.5808 | −0.5205 | 3.1616 |
| −0.3544 | 0.1576 | 3.1616 | 0.6373 | −0.6022 | 3.1616 |
| −0.4052 | 0.2425 | 3.1616 | 0.6921 | −0.6811 | 3.1616 |
| −0.4527 | 0.3256 | 3.1616 | 0.7451 | −0.7572 | 3.1616 |
| −0.4967 | 0.4066 | 3.1616 | 0.7964 | −0.8303 | 3.1616 |
| −0.5372 | 0.4857 | 3.1616 | 0.8460 | −0.9008 | 3.1616 |
| −0.5745 | 0.5625 | 3.1616 | 0.8939 | −0.9682 | 3.1616 |
| −0.6088 | 0.6371 | 3.1616 | 0.9403 | −1.0328 | 3.1616 |
| −0.6398 | 0.7093 | 3.1616 | 0.9849 | −1.0944 | 3.1616 |
| −0.6680 | 0.7790 | 3.1616 | 1.0258 | −1.1507 | 3.1616 |
| −0.6922 | 0.8430 | 3.1616 | 1.0629 | −1.2015 | 3.1616 |
| −0.7126 | 0.9011 | 3.1616 | 1.0960 | −1.2470 | 3.1616 |
| −0.7294 | 0.9531 | 3.1616 | 1.1257 | −1.2869 | 3.1616 |
| −0.7437 | 1.0024 | 3.1616 | 1.1514 | −1.3214 | 3.1616 |
| −0.7543 | 1.0455 | 3.1616 | 1.1732 | −1.3506 | 3.1616 |
| −0.7603 | 1.0791 | 3.1616 | 1.1918 | −1.3755 | 3.1616 |
| −0.7629 | 1.1064 | 3.1616 | 1.2075 | −1.3965 | 3.1616 |
| −0.7622 | 1.1269 | 3.1616 | 1.2204 | −1.4137 | 3.1616 |
| −0.7589 | 1.1419 | 3.1616 | 1.2308 | −1.4274 | 3.1616 |
| −0.7551 | 1.1496 | 3.1616 | 1.2388 | −1.4380 | 3.1616 |
| −0.7517 | 1.1537 | 3.1616 | 1.2427 | −1.4470 | 3.1616 |

TABLE 6-continued

| SUCTION SIDE | | | PRESSURE SIDE | | |
|---|---|---|---|---|---|
| X | Y | Z | X | Y | Z |
| −0.7494 | 1.1554 | 3.1616 | 1.2425 | −1.4553 | 3.1616 |
| −0.7483 | 1.1561 | 3.1616 | 1.2400 | −1.4614 | 3.1616 |
| 1.2279 | −1.5371 | 3.6896 | −0.7400 | 1.1310 | 3.6896 |
| 1.2238 | −1.5401 | 3.6896 | −0.7394 | 1.1313 | 3.6896 |
| 1.2175 | −1.5424 | 3.6896 | −0.7381 | 1.1318 | 3.6896 |
| 1.2090 | −1.5421 | 3.6896 | −0.7355 | 1.1326 | 3.6896 |
| 1.2001 | −1.5372 | 3.6896 | −0.7301 | 1.1329 | 3.6896 |
| 1.1896 | −1.5286 | 3.6896 | −0.7219 | 1.1313 | 3.6896 |
| 1.1760 | −1.5172 | 3.6896 | −0.7080 | 1.1250 | 3.6896 |
| 1.1590 | −1.5030 | 3.6896 | −0.6916 | 1.1136 | 3.6896 |
| 1.1382 | −1.4857 | 3.6896 | −0.6714 | 1.0960 | 3.6896 |
| 1.1136 | −1.4651 | 3.6896 | −0.6480 | 1.0722 | 3.6896 |
| 1.0848 | −1.4410 | 3.6896 | −0.6191 | 1.0396 | 3.6896 |
| 1.0510 | −1.4123 | 3.6896 | −0.5872 | 1.0011 | 3.6896 |
| 1.0120 | −1.3792 | 3.6896 | −0.5540 | 0.9595 | 3.6896 |
| 0.9676 | −1.3418 | 3.6896 | −0.5170 | 0.9122 | 3.6896 |
| 0.9184 | −1.2995 | 3.6896 | −0.4764 | 0.8592 | 3.6896 |
| 0.8644 | −1.2524 | 3.6896 | −0.4320 | 0.8007 | 3.6896 |
| 0.8056 | −1.2005 | 3.6896 | −0.3860 | 0.7393 | 3.6896 |
| 0.7445 | −1.1460 | 3.6896 | −0.3381 | 0.6751 | 3.6896 |
| 0.6812 | −1.0887 | 3.6896 | −0.2885 | 0.6080 | 3.6896 |
| 0.6161 | −1.0289 | 3.6896 | −0.2370 | 0.5382 | 3.6896 |
| 0.5490 | −0.9660 | 3.6896 | −0.1836 | 0.4657 | 3.6896 |
| 0.4803 | −0.9001 | 3.6896 | −0.1284 | 0.3903 | 3.6896 |
| 0.4100 | −0.8312 | 3.6896 | −0.0713 | 0.3123 | 3.6896 |
| 0.3383 | −0.7591 | 3.6896 | −0.0119 | 0.2316 | 3.6896 |
| 0.2679 | −0.6858 | 3.6896 | 0.0473 | 0.1509 | 3.6896 |
| 0.1988 | −0.6112 | 3.6896 | 0.1066 | 0.0702 | 3.6896 |
| 0.1314 | −0.5355 | 3.6896 | 0.1658 | −0.0105 | 3.6896 |
| 0.0655 | −0.4582 | 3.6896 | 0.2248 | −0.0912 | 3.6896 |
| 0.0016 | −0.3794 | 3.6896 | 0.2833 | −0.1724 | 3.6896 |
| −0.0604 | −0.2988 | 3.6896 | 0.3412 | −0.2541 | 3.6896 |
| −0.1205 | −0.2167 | 3.6896 | 0.3986 | −0.3361 | 3.6896 |
| −0.1787 | −0.1330 | 3.6896 | 0.4557 | −0.4184 | 3.6896 |
| −0.2355 | −0.0479 | 3.6896 | 0.5125 | −0.5008 | 3.6896 |
| −0.2908 | 0.0383 | 3.6896 | 0.5692 | −0.5832 | 3.6896 |
| −0.3444 | 0.1261 | 3.6896 | 0.6259 | −0.6658 | 3.6896 |
| −0.3947 | 0.2120 | 3.6896 | 0.6808 | −0.7454 | 3.6896 |
| −0.4416 | 0.2959 | 3.6896 | 0.7339 | −0.8223 | 3.6896 |
| −0.4852 | 0.3776 | 3.6896 | 0.7853 | −0.8962 | 3.6896 |
| −0.5256 | 0.4574 | 3.6896 | 0.8352 | −0.9673 | 3.6896 |
| −0.5627 | 0.5347 | 3.6896 | 0.8832 | −1.0354 | 3.6896 |
| −0.5971 | 0.6096 | 3.6896 | 0.9297 | −1.1007 | 3.6896 |
| −0.6283 | 0.6822 | 3.6896 | 0.9745 | −1.1630 | 3.6896 |
| −0.6568 | 0.7522 | 3.6896 | 1.0157 | −1.2197 | 3.6896 |
| −0.6813 | 0.8163 | 3.6896 | 1.0528 | −1.2710 | 3.6896 |
| −0.7021 | 0.8746 | 3.6896 | 1.0862 | −1.3169 | 3.6896 |
| −0.7192 | 0.9267 | 3.6896 | 1.1159 | −1.3572 | 3.6896 |
| −0.7340 | 0.9761 | 3.6896 | 1.1417 | −1.3920 | 3.6896 |
| −0.7450 | 1.0194 | 3.6896 | 1.1636 | −1.4215 | 3.6896 |
| −0.7513 | 1.0531 | 3.6896 | 1.1823 | −1.4467 | 3.6896 |
| −0.7542 | 1.0805 | 3.6896 | 1.1981 | −1.4678 | 3.6896 |
| −0.7540 | 1.1010 | 3.6896 | 1.2111 | −1.4852 | 3.6896 |
| −0.7510 | 1.1162 | 3.6896 | 1.2216 | −1.4990 | 3.6896 |
| −0.7475 | 1.1240 | 3.6896 | 1.2296 | −1.5097 | 3.6896 |
| −0.7440 | 1.1282 | 3.6896 | 1.2337 | −1.5187 | 3.6896 |
| −0.7418 | 1.1299 | 3.6896 | 1.2335 | −1.5270 | 3.6896 |
| −0.7407 | 1.1307 | 3.6896 | 1.2310 | −1.5332 | 3.6896 |
| 1.2237 | −1.6063 | 4.2176 | −0.7367 | 1.1027 | 4.2176 |
| 1.2196 | −1.6093 | 4.2176 | −0.7361 | 1.1030 | 4.2176 |
| 1.2131 | −1.6115 | 4.2176 | −0.7348 | 1.1034 | 4.2176 |
| 1.2047 | −1.6108 | 4.2176 | −0.7321 | 1.1040 | 4.2176 |
| 1.1959 | −1.6056 | 4.2176 | −0.7267 | 1.1042 | 4.2176 |
| 1.1855 | −1.5967 | 4.2176 | −0.7184 | 1.1021 | 4.2176 |
| 1.1719 | −1.5850 | 4.2176 | −0.7049 | 1.0952 | 4.2176 |
| 1.1551 | −1.5704 | 4.2176 | −0.6887 | 1.0830 | 4.2176 |
| 1.1346 | −1.5526 | 4.2176 | −0.6690 | 1.0646 | 4.2176 |
| 1.1103 | −1.5314 | 4.2176 | −0.6462 | 1.0398 | 4.2176 |
| 1.0818 | −1.5066 | 4.2176 | −0.6182 | 1.0062 | 4.2176 |
| 1.0483 | −1.4771 | 4.2176 | −0.5873 | 0.9663 | 4.2176 |
| 1.0095 | −1.4431 | 4.2176 | −0.5550 | 0.9234 | 4.2176 |
| 0.9657 | −1.4046 | 4.2176 | −0.5191 | 0.8746 | 4.2176 |
| 0.9170 | −1.3612 | 4.2176 | −0.4796 | 0.8201 | 4.2176 |
| 0.8636 | −1.3127 | 4.2176 | −0.4366 | 0.7600 | 4.2176 |
| 0.8052 | −1.2595 | 4.2176 | −0.3916 | 0.6971 | 4.2176 |
| 0.7447 | −1.2036 | 4.2176 | −0.3448 | 0.6314 | 4.2176 |

TABLE 6-continued

| SUCTION SIDE | | | PRESSURE SIDE | | |
|---|---|---|---|---|---|
| X | Y | Z | X | Y | Z |
| 0.6822 | −1.1449 | 4.2176 | −0.2961 | 0.5627 | 4.2176 |
| 0.6178 | −1.0834 | 4.2176 | −0.2455 | 0.4915 | 4.2176 |
| 0.5515 | −1.0189 | 4.2176 | −0.1931 | 0.4173 | 4.2176 |
| 0.4835 | −0.9515 | 4.2176 | −0.1388 | 0.3403 | 4.2176 |
| 0.4142 | −0.8808 | 4.2176 | −0.0824 | 0.2608 | 4.2176 |
| 0.3435 | −0.8067 | 4.2176 | −0.0240 | 0.1786 | 4.2176 |
| 0.2740 | −0.7315 | 4.2176 | 0.0346 | 0.0964 | 4.2176 |
| 0.2059 | −0.6554 | 4.2176 | 0.0932 | 0.0144 | 4.2176 |
| 0.1393 | −0.5777 | 4.2176 | 0.1521 | −0.0676 | 4.2176 |
| 0.0743 | −0.4987 | 4.2176 | 0.2110 | −0.1495 | 4.2176 |
| 0.0113 | −0.4182 | 4.2176 | 0.2696 | −0.2316 | 4.2176 |
| −0.0497 | −0.3360 | 4.2176 | 0.3278 | −0.3141 | 4.2176 |
| −0.1092 | −0.2524 | 4.2176 | 0.3854 | −0.3968 | 4.2176 |
| −0.1671 | −0.1675 | 4.2176 | 0.4428 | −0.4798 | 4.2176 |
| −0.2237 | −0.0814 | 4.2176 | 0.4999 | −0.5631 | 4.2176 |
| −0.2787 | 0.0059 | 4.2176 | 0.5570 | −0.6462 | 4.2176 |
| −0.3321 | 0.0945 | 4.2176 | 0.6142 | −0.7294 | 4.2176 |
| −0.3823 | 0.1810 | 4.2176 | 0.6695 | −0.8096 | 4.2176 |
| −0.4292 | 0.2654 | 4.2176 | 0.7231 | −0.8870 | 4.2176 |
| −0.4729 | 0.3476 | 4.2176 | 0.7751 | −0.9615 | 4.2176 |
| −0.5133 | 0.4277 | 4.2176 | 0.8255 | −1.0330 | 4.2176 |
| −0.5509 | 0.5053 | 4.2176 | 0.8742 | −1.1016 | 4.2176 |
| −0.5856 | 0.5805 | 4.2176 | 0.9210 | −1.1673 | 4.2176 |
| −0.6174 | 0.6531 | 4.2176 | 0.9663 | −1.2300 | 4.2176 |
| −0.6467 | 0.7231 | 4.2176 | 1.0081 | −1.2869 | 4.2176 |
| −0.6720 | 0.7874 | 4.2176 | 1.0458 | −1.3386 | 4.2176 |
| −0.6936 | 0.8456 | 4.2176 | 1.0795 | −1.3847 | 4.2176 |
| −0.7116 | 0.8978 | 4.2176 | 1.1095 | −1.4253 | 4.2176 |
| −0.7274 | 0.9471 | 4.2176 | 1.1357 | −1.4602 | 4.2176 |
| −0.7391 | 0.9904 | 4.2176 | 1.1579 | −1.4898 | 4.2176 |
| −0.7461 | 1.0242 | 4.2176 | 1.1769 | −1.5151 | 4.2176 |
| −0.7495 | 1.0516 | 4.2176 | 1.1930 | −1.5364 | 4.2176 |
| −0.7498 | 1.0723 | 4.2176 | 1.2061 | −1.5538 | 4.2176 |
| −0.7473 | 1.0876 | 4.2176 | 1.2166 | −1.5677 | 4.2176 |
| −0.7441 | 1.0955 | 4.2176 | 1.2247 | −1.5785 | 4.2176 |
| −0.7407 | 1.0998 | 4.2176 | 1.2293 | −1.5874 | 4.2176 |
| −0.7386 | 1.1016 | 4.2176 | 1.2294 | −1.5959 | 4.2176 |
| −0.7373 | 1.1024 | 4.2176 | 1.2270 | −1.6023 | 4.2176 |
| 1.2240 | −1.6564 | 4.6400 | −0.7380 | 1.0770 | 4.6400 |
| 1.2199 | −1.6594 | 4.6400 | −0.7375 | 1.0773 | 4.6400 |
| 1.2133 | −1.6614 | 4.6400 | −0.7361 | 1.0778 | 4.6400 |
| 1.2048 | −1.6607 | 4.6400 | −0.7335 | 1.0784 | 4.6400 |
| 1.1962 | −1.6551 | 4.6400 | −0.7280 | 1.0783 | 4.6400 |
| 1.1859 | −1.6459 | 4.6400 | −0.7198 | 1.0759 | 4.6400 |
| 1.1725 | −1.6339 | 4.6400 | −0.7065 | 1.0684 | 4.6400 |
| 1.1558 | −1.6191 | 4.6400 | −0.6905 | 1.0557 | 4.6400 |
| 1.1354 | −1.6009 | 4.6400 | −0.6711 | 1.0366 | 4.6400 |
| 1.1113 | −1.5794 | 4.6400 | −0.6487 | 1.0112 | 4.6400 |
| 1.0831 | −1.5540 | 4.6400 | −0.6214 | 0.9768 | 4.6400 |
| 1.0499 | −1.5239 | 4.6400 | −0.5910 | 0.9361 | 4.6400 |
| 1.0115 | −1.4893 | 4.6400 | −0.5595 | 0.8922 | 4.6400 |
| 0.9681 | −1.4499 | 4.6400 | −0.5243 | 0.8425 | 4.6400 |
| 0.9199 | −1.4055 | 4.6400 | −0.4855 | 0.7869 | 4.6400 |
| 0.8670 | −1.3561 | 4.6400 | −0.4431 | 0.7258 | 4.6400 |
| 0.8091 | −1.3018 | 4.6400 | −0.3989 | 0.6618 | 4.6400 |
| 0.7490 | −1.2450 | 4.6400 | −0.3527 | 0.5950 | 4.6400 |
| 0.6871 | −1.1851 | 4.6400 | −0.3047 | 0.5254 | 4.6400 |
| 0.6234 | −1.1225 | 4.6400 | −0.2547 | 0.4529 | 4.6400 |
| 0.5577 | −1.0570 | 4.6400 | −0.2028 | 0.3778 | 4.6400 |
| 0.4904 | −0.9883 | 4.6400 | −0.1488 | 0.2999 | 4.6400 |
| 0.4217 | −0.9163 | 4.6400 | −0.0928 | 0.2193 | 4.6400 |
| 0.3516 | −0.8409 | 4.6400 | −0.0347 | 0.1361 | 4.6400 |
| 0.2828 | −0.7645 | 4.6400 | 0.0234 | 0.0530 | 4.6400 |
| 0.2153 | −0.6871 | 4.6400 | 0.0819 | −0.0300 | 4.6400 |
| 0.1492 | −0.6085 | 4.6400 | 0.1406 | −0.1128 | 4.6400 |
| 0.0849 | −0.5284 | 4.6400 | 0.1996 | −0.1955 | 4.6400 |
| 0.0223 | −0.4468 | 4.6400 | 0.2585 | −0.2780 | 4.6400 |
| −0.0384 | −0.3637 | 4.6400 | 0.3171 | −0.3609 | 4.6400 |
| −0.0977 | −0.2793 | 4.6400 | 0.3753 | −0.4442 | 4.6400 |
| −0.1557 | −0.1939 | 4.6400 | 0.4332 | −0.5276 | 4.6400 |
| −0.2123 | −0.1073 | 4.6400 | 0.4908 | −0.6111 | 4.6400 |
| −0.2675 | −0.0195 | 4.6400 | 0.5485 | −0.6946 | 4.6400 |
| −0.3212 | 0.0692 | 4.6400 | 0.6062 | −0.7781 | 4.6400 |
| −0.3716 | 0.1559 | 4.6400 | 0.6623 | −0.8586 | 4.6400 |
| −0.4189 | 0.2405 | 4.6400 | 0.7165 | −0.9364 | 4.6400 |
| −0.4630 | 0.3228 | 4.6400 | 0.7691 | −1.0110 | 4.6400 |

TABLE 6-continued

| SUCTION SIDE | | | PRESSURE SIDE | | |
|---|---|---|---|---|---|
| X | Y | Z | X | Y | Z |
| −0.5040 | 0.4028 | 4.6400 | 0.8202 | −1.0826 | 4.6400 |
| −0.5423 | 0.4804 | 4.6400 | 0.8694 | −1.1514 | 4.6400 |
| −0.5776 | 0.5555 | 4.6400 | 0.9169 | −1.2173 | 4.6400 |
| −0.6103 | 0.6280 | 4.6400 | 0.9628 | −1.2802 | 4.6400 |
| −0.6405 | 0.6979 | 4.6400 | 1.0051 | −1.3372 | 4.6400 |
| −0.6668 | 0.7619 | 4.6400 | 1.0433 | −1.3889 | 4.6400 |
| −0.6894 | 0.8200 | 4.6400 | 1.0776 | −1.4350 | 4.6400 |
| −0.7084 | 0.8719 | 4.6400 | 1.1082 | −1.4757 | 4.6400 |
| −0.7249 | 0.9211 | 4.6400 | 1.1347 | −1.5107 | 4.6400 |
| −0.7375 | 0.9643 | 4.6400 | 1.1572 | −1.5404 | 4.6400 |
| −0.7452 | 0.9980 | 4.6400 | 1.1765 | −1.5656 | 4.6400 |
| −0.7493 | 1.0254 | 4.6400 | 1.1928 | −1.5869 | 4.6400 |
| −0.7501 | 1.0462 | 4.6400 | 1.2062 | −1.6043 | 4.6400 |
| −0.7482 | 1.0616 | 4.6400 | 1.2168 | −1.6182 | 4.6400 |
| −0.7452 | 1.0696 | 4.6400 | 1.2252 | −1.6290 | 4.6400 |
| −0.7419 | 1.0742 | 4.6400 | 1.2297 | −1.6379 | 4.6400 |
| −0.7398 | 1.0760 | 4.6400 | 1.2297 | −1.6463 | 4.6400 |
| −0.7387 | 1.0767 | 4.6400 | 1.2273 | −1.6525 | 4.6400 |
| 1.2252 | −1.6936 | 5.0096 | −0.7425 | 1.0564 | 5.0096 |
| 1.2209 | −1.6966 | 5.0096 | −0.7418 | 1.0566 | 5.0096 |
| 1.2144 | −1.6985 | 5.0096 | −0.7406 | 1.0572 | 5.0096 |
| 1.2058 | −1.6975 | 5.0096 | −0.7378 | 1.0577 | 5.0096 |
| 1.1974 | −1.6917 | 5.0096 | −0.7323 | 1.0574 | 5.0096 |
| 1.1872 | −1.6823 | 5.0096 | −0.7242 | 1.0546 | 5.0096 |
| 1.1738 | −1.6703 | 5.0096 | −0.7111 | 1.0466 | 5.0096 |
| 1.1573 | −1.6551 | 5.0096 | −0.6955 | 1.0334 | 5.0096 |
| 1.1372 | −1.6366 | 5.0096 | −0.6764 | 1.0139 | 5.0096 |
| 1.1132 | −1.6146 | 5.0096 | −0.6543 | 0.9880 | 5.0096 |
| 1.0854 | −1.5889 | 5.0096 | −0.6273 | 0.9531 | 5.0096 |
| 1.0524 | −1.5582 | 5.0096 | −0.5974 | 0.9119 | 5.0096 |
| 1.0144 | −1.5230 | 5.0096 | −0.5662 | 0.8673 | 5.0096 |
| 0.9715 | −1.4827 | 5.0096 | −0.5316 | 0.8168 | 5.0096 |
| 0.9238 | −1.4376 | 5.0096 | −0.4933 | 0.7606 | 5.0096 |
| 0.8714 | −1.3875 | 5.0096 | −0.4513 | 0.6988 | 5.0096 |
| 0.8141 | −1.3324 | 5.0096 | −0.4074 | 0.6340 | 5.0096 |
| 0.7546 | −1.2745 | 5.0096 | −0.3618 | 0.5664 | 5.0096 |
| 0.6933 | −1.2138 | 5.0096 | −0.3142 | 0.4960 | 5.0096 |
| 0.6301 | −1.1501 | 5.0096 | −0.2645 | 0.4228 | 5.0096 |
| 0.5650 | −1.0836 | 5.0096 | −0.2129 | 0.3469 | 5.0096 |
| 0.4983 | −1.0140 | 5.0096 | −0.1592 | 0.2683 | 5.0096 |
| 0.4302 | −0.9410 | 5.0096 | −0.1034 | 0.1871 | 5.0096 |
| 0.3607 | −0.8647 | 5.0096 | −0.0454 | 0.1032 | 5.0096 |
| 0.2924 | −0.7874 | 5.0096 | 0.0128 | 0.0194 | 5.0096 |
| 0.2254 | −0.7091 | 5.0096 | 0.0713 | −0.0642 | 5.0096 |
| 0.1597 | −0.6296 | 5.0096 | 0.1300 | −0.1475 | 5.0096 |
| 0.0958 | −0.5487 | 5.0096 | 0.1891 | −0.2306 | 5.0096 |
| 0.0335 | −0.4663 | 5.0096 | 0.2484 | −0.3136 | 5.0096 |
| −0.0272 | −0.3827 | 5.0096 | 0.3075 | −0.3967 | 5.0096 |
| −0.0866 | −0.2980 | 5.0096 | 0.3662 | −0.4802 | 5.0096 |
| −0.1448 | −0.2123 | 5.0096 | 0.4246 | −0.5638 | 5.0096 |
| −0.2017 | −0.1256 | 5.0096 | 0.4828 | −0.6475 | 5.0096 |
| −0.2573 | −0.0377 | 5.0096 | 0.5411 | −0.7313 | 5.0096 |
| −0.3114 | 0.0511 | 5.0096 | 0.5995 | −0.8148 | 5.0096 |
| −0.3623 | 0.1377 | 5.0096 | 0.6562 | −0.8955 | 5.0096 |
| −0.4102 | 0.2221 | 5.0096 | 0.7111 | −0.9732 | 5.0096 |
| −0.4549 | 0.3042 | 5.0096 | 0.7643 | −1.0480 | 5.0096 |
| −0.4968 | 0.3841 | 5.0096 | 0.8160 | −1.1198 | 5.0096 |
| −0.5359 | 0.4614 | 5.0096 | 0.8659 | −1.1885 | 5.0096 |
| −0.5722 | 0.5362 | 5.0096 | 0.9139 | −1.2545 | 5.0096 |
| −0.6058 | 0.6085 | 5.0096 | 0.9602 | −1.3175 | 5.0096 |
| −0.6370 | 0.6782 | 5.0096 | 1.0030 | −1.3747 | 5.0096 |
| −0.6642 | 0.7418 | 5.0096 | 1.0418 | −1.4263 | 5.0096 |
| −0.6879 | 0.7996 | 5.0096 | 1.0767 | −1.4724 | 5.0096 |
| −0.7078 | 0.8513 | 5.0096 | 1.1075 | −1.5129 | 5.0096 |
| −0.7254 | 0.9002 | 5.0096 | 1.1344 | −1.5481 | 5.0096 |
| −0.7387 | 0.9433 | 5.0096 | 1.1572 | −1.5778 | 5.0096 |
| −0.7471 | 0.9769 | 5.0096 | 1.1767 | −1.6030 | 5.0096 |
| −0.7519 | 1.0043 | 5.0096 | 1.1932 | −1.6242 | 5.0096 |
| −0.7534 | 1.0251 | 5.0096 | 1.2068 | −1.6417 | 5.0096 |
| −0.7520 | 1.0405 | 5.0096 | 1.2178 | −1.6555 | 5.0096 |
| −0.7494 | 1.0488 | 5.0096 | 1.2262 | −1.6662 | 5.0096 |
| −0.7464 | 1.0535 | 5.0096 | 1.2309 | −1.6751 | 5.0096 |
| −0.7443 | 1.0553 | 5.0096 | 1.2310 | −1.6835 | 5.0096 |
| −0.7431 | 1.0560 | 5.0096 | 1.2284 | −1.6897 | 5.0096 |
| 1.2247 | −1.7202 | 5.3264 | −0.7449 | 1.0440 | 5.3264 |
| 1.2205 | −1.7232 | 5.3264 | −0.7443 | 1.0443 | 5.3264 |

TABLE 6-continued

| SUCTION SIDE | | | PRESSURE SIDE | | |
|---|---|---|---|---|---|
| X | Y | Z | X | Y | Z |
| 1.2139 | −1.7251 | 5.3264 | −0.7430 | 1.0447 | 5.3264 |
| 1.2053 | −1.7239 | 5.3264 | −0.7403 | 1.0452 | 5.3264 |
| 1.1970 | −1.7179 | 5.3264 | −0.7347 | 1.0447 | 5.3264 |
| 1.1868 | −1.7085 | 5.3264 | −0.7266 | 1.0416 | 5.3264 |
| 1.1736 | −1.6963 | 5.3264 | −0.7138 | 1.0332 | 5.3264 |
| 1.1572 | −1.6808 | 5.3264 | −0.6982 | 1.0196 | 5.3264 |
| 1.1372 | −1.6620 | 5.3264 | −0.6794 | 0.9997 | 5.3264 |
| 1.1136 | −1.6398 | 5.3264 | −0.6577 | 0.9735 | 5.3264 |
| 1.0859 | −1.6136 | 5.3264 | −0.6311 | 0.9382 | 5.3264 |
| 1.0531 | −1.5826 | 5.3264 | −0.6017 | 0.8963 | 5.3264 |
| 1.0154 | −1.5468 | 5.3264 | −0.5710 | 0.8511 | 5.3264 |
| 0.9730 | −1.5061 | 5.3264 | −0.5368 | 0.8001 | 5.3264 |
| 0.9258 | −1.4602 | 5.3264 | −0.4990 | 0.7433 | 5.3264 |
| 0.8738 | −1.4093 | 5.3264 | −0.4575 | 0.6808 | 5.3264 |
| 0.8170 | −1.3535 | 5.3264 | −0.4142 | 0.6154 | 5.3264 |
| 0.7581 | −1.2949 | 5.3264 | −0.3690 | 0.5471 | 5.3264 |
| 0.6974 | −1.2333 | 5.3264 | −0.3219 | 0.4760 | 5.3264 |
| 0.6348 | −1.1688 | 5.3264 | −0.2727 | 0.4023 | 5.3264 |
| 0.5702 | −1.1014 | 5.3264 | −0.2214 | 0.3258 | 5.3264 |
| 0.5041 | −1.0309 | 5.3264 | −0.1680 | 0.2466 | 5.3264 |
| 0.4366 | −0.9571 | 5.3264 | −0.1125 | 0.1647 | 5.3264 |
| 0.3677 | −0.8799 | 5.3264 | −0.0546 | 0.0803 | 5.3264 |
| 0.2999 | −0.8018 | 5.3264 | 0.0035 | −0.0040 | 5.3264 |
| 0.2333 | −0.7227 | 5.3264 | 0.0618 | −0.0881 | 5.3264 |
| 0.1681 | −0.6425 | 5.3264 | 0.1205 | −0.1718 | 5.3264 |
| 0.1046 | −0.5608 | 5.3264 | 0.1796 | −0.2553 | 5.3264 |
| 0.0427 | −0.4778 | 5.3264 | 0.2390 | −0.3388 | 5.3264 |
| −0.0178 | −0.3938 | 5.3264 | 0.2983 | −0.4222 | 5.3264 |
| −0.0771 | −0.3087 | 5.3264 | 0.3575 | −0.5057 | 5.3264 |
| −0.1354 | −0.2227 | 5.3264 | 0.4162 | −0.5895 | 5.3264 |
| −0.1925 | −0.1357 | 5.3264 | 0.4748 | −0.6734 | 5.3264 |
| −0.2483 | −0.0478 | 5.3264 | 0.5334 | −0.7573 | 5.3264 |
| −0.3028 | 0.0409 | 5.3264 | 0.5923 | −0.8410 | 5.3264 |
| −0.3540 | 0.1275 | 5.3264 | 0.6494 | −0.9218 | 5.3264 |
| −0.4023 | 0.2117 | 5.3264 | 0.7048 | −0.9996 | 5.3264 |
| −0.4476 | 0.2938 | 5.3264 | 0.7585 | −1.0744 | 5.3264 |
| −0.4901 | 0.3734 | 5.3264 | 0.8106 | −1.1462 | 5.3264 |
| −0.5299 | 0.4505 | 5.3264 | 0.8610 | −1.2150 | 5.3264 |
| −0.5670 | 0.5250 | 5.3264 | 0.9094 | −1.2810 | 5.3264 |
| −0.6013 | 0.5972 | 5.3264 | 0.9562 | −1.3440 | 5.3264 |
| −0.6332 | 0.6665 | 5.3264 | 0.9994 | −1.4011 | 5.3264 |
| −0.6613 | 0.7300 | 5.3264 | 1.0387 | −1.4526 | 5.3264 |
| −0.6857 | 0.7876 | 5.3264 | 1.0740 | −1.4987 | 5.3264 |
| −0.7064 | 0.8390 | 5.3264 | 1.1051 | −1.5393 | 5.3264 |
| −0.7245 | 0.8878 | 5.3264 | 1.1322 | −1.5744 | 5.3264 |
| −0.7386 | 0.9308 | 5.3264 | 1.1553 | −1.6041 | 5.3264 |
| −0.7475 | 0.9642 | 5.3264 | 1.1750 | −1.6293 | 5.3264 |
| −0.7528 | 0.9915 | 5.3264 | 1.1917 | −1.6504 | 5.3264 |
| −0.7547 | 1.0123 | 5.3264 | 1.2055 | −1.6677 | 5.3264 |
| −0.7539 | 1.0278 | 5.3264 | 1.2166 | −1.6817 | 5.3264 |
| −0.7516 | 1.0361 | 5.3264 | 1.2251 | −1.6923 | 5.3264 |
| −0.7487 | 1.0409 | 5.3264 | 1.2302 | −1.7011 | 5.3264 |
| −0.7467 | 1.0428 | 5.3264 | 1.2306 | −1.7098 | 5.3264 |
| −0.7455 | 1.0436 | 5.3264 | 1.2281 | −1.7162 | 5.3264 |
| 1.2223 | −1.7360 | 5.5904 | −0.7438 | 1.0402 | 5.5904 |
| 1.2180 | −1.7389 | 5.5904 | −0.7432 | 1.0405 | 5.5904 |
| 1.2113 | −1.7408 | 5.5904 | −0.7418 | 1.0409 | 5.5904 |
| 1.2029 | −1.7395 | 5.5904 | −0.7391 | 1.0413 | 5.5904 |
| 1.1945 | −1.7334 | 5.5904 | −0.7336 | 1.0407 | 5.5904 |
| 1.1844 | −1.7238 | 5.5904 | −0.7256 | 1.0374 | 5.5904 |
| 1.1713 | −1.7115 | 5.5904 | −0.7128 | 1.0288 | 5.5904 |
| 1.1551 | −1.6959 | 5.5904 | −0.6976 | 1.0148 | 5.5904 |
| 1.1352 | −1.6770 | 5.5904 | −0.6791 | 0.9946 | 5.5904 |
| 1.1117 | −1.6545 | 5.5904 | −0.6577 | 0.9680 | 5.5904 |
| 1.0841 | −1.6281 | 5.5904 | −0.6315 | 0.9322 | 5.5904 |
| 1.0516 | −1.5969 | 5.5904 | −0.6027 | 0.8898 | 5.5904 |
| 1.0142 | −1.5607 | 5.5904 | −0.5725 | 0.8442 | 5.5904 |
| 0.9720 | −1.5195 | 5.5904 | −0.5389 | 0.7926 | 5.5904 |
| 0.9252 | −1.4732 | 5.5904 | −0.5016 | 0.7353 | 5.5904 |
| 0.8735 | −1.4219 | 5.5904 | −0.4608 | 0.6720 | 5.5904 |
| 0.8171 | −1.3654 | 5.5904 | −0.4182 | 0.6060 | 5.5904 |
| 0.7587 | −1.3062 | 5.5904 | −0.3736 | 0.5371 | 5.5904 |
| 0.6985 | −1.2440 | 5.5904 | −0.3269 | 0.4655 | 5.5904 |
| 0.6365 | −1.1789 | 5.5904 | −0.2783 | 0.3910 | 5.5904 |
| 0.5725 | −1.1108 | 5.5904 | −0.2276 | 0.3139 | 5.5904 |
| 0.5069 | −1.0396 | 5.5904 | −0.1746 | 0.2341 | 5.5904 |

TABLE 6-continued

| SUCTION SIDE | | | PRESSURE SIDE | | |
|---|---|---|---|---|---|
| X | Y | Z | X | Y | Z |
| 0.4397 | −0.9652 | 5.5904 | −0.1194 | 0.1519 | 5.5904 |
| 0.3714 | −0.8873 | 5.5904 | −0.0619 | 0.0668 | 5.5904 |
| 0.3041 | −0.8086 | 5.5904 | −0.0041 | −0.0178 | 5.5904 |
| 0.2379 | −0.7289 | 5.5904 | 0.0540 | −0.1023 | 5.5904 |
| 0.1734 | −0.6480 | 5.5904 | 0.1126 | −0.1866 | 5.5904 |
| 0.1104 | −0.5656 | 5.5904 | 0.1715 | −0.2704 | 5.5904 |
| 0.0489 | −0.4822 | 5.5904 | 0.2307 | −0.3542 | 5.5904 |
| −0.0113 | −0.3976 | 5.5904 | 0.2901 | −0.4378 | 5.5904 |
| −0.0703 | −0.3120 | 5.5904 | 0.3493 | −0.5216 | 5.5904 |
| −0.1284 | −0.2258 | 5.5904 | 0.4082 | −0.6055 | 5.5904 |
| −0.1854 | −0.1385 | 5.5904 | 0.4670 | −0.6896 | 5.5904 |
| −0.2412 | −0.0506 | 5.5904 | 0.5259 | −0.7735 | 5.5904 |
| −0.2957 | 0.0382 | 5.5904 | 0.5850 | −0.8573 | 5.5904 |
| −0.3471 | 0.1248 | 5.5904 | 0.6424 | −0.9382 | 5.5904 |
| −0.3956 | 0.2091 | 5.5904 | 0.6981 | −1.0160 | 5.5904 |
| −0.4412 | 0.2910 | 5.5904 | 0.7521 | −1.0908 | 5.5904 |
| −0.4840 | 0.3707 | 5.5904 | 0.8046 | −1.1626 | 5.5904 |
| −0.5240 | 0.4477 | 5.5904 | 0.8553 | −1.2314 | 5.5904 |
| −0.5614 | 0.5222 | 5.5904 | 0.9043 | −1.2973 | 5.5904 |
| −0.5961 | 0.5941 | 5.5904 | 0.9515 | −1.3601 | 5.5904 |
| −0.6285 | 0.6634 | 5.5904 | 0.9949 | −1.4173 | 5.5904 |
| −0.6570 | 0.7267 | 5.5904 | 1.0345 | −1.4688 | 5.5904 |
| −0.6818 | 0.7841 | 5.5904 | 1.0700 | −1.5147 | 5.5904 |
| −0.7030 | 0.8355 | 5.5904 | 1.1015 | −1.5553 | 5.5904 |
| −0.7217 | 0.8841 | 5.5904 | 1.1289 | −1.5902 | 5.5904 |
| −0.7361 | 0.9269 | 5.5904 | 1.1521 | −1.6198 | 5.5904 |
| −0.7454 | 0.9603 | 5.5904 | 1.1719 | −1.6450 | 5.5904 |
| −0.7509 | 0.9876 | 5.5904 | 1.1887 | −1.6663 | 5.5904 |
| −0.7531 | 1.0083 | 5.5904 | 1.2027 | −1.6836 | 5.5904 |
| −0.7525 | 1.0239 | 5.5904 | 1.2138 | −1.6974 | 5.5904 |
| −0.7503 | 1.0323 | 5.5904 | 1.2223 | −1.7081 | 5.5904 |
| −0.7475 | 1.0371 | 5.5904 | 1.2276 | −1.7168 | 5.5904 |
| −0.7455 | 1.0390 | 5.5904 | 1.2280 | −1.7255 | 5.5904 |
| −0.7445 | 1.0398 | 5.5904 | 1.2256 | −1.7319 | 5.5904 |
| 1.2026 | −1.7474 | 5.8860 | −0.7367 | 1.0495 | 5.8860 |
| 1.1983 | −1.7503 | 5.8860 | −0.7360 | 1.0498 | 5.8860 |
| 1.1917 | −1.7521 | 5.8860 | −0.7347 | 1.0502 | 5.8860 |
| 1.1831 | −1.7506 | 5.8860 | −0.7319 | 1.0506 | 5.8860 |
| 1.1750 | −1.7444 | 5.8860 | −0.7264 | 1.0498 | 5.8860 |
| 1.1650 | −1.7347 | 5.8860 | −0.7185 | 1.0464 | 5.8860 |
| 1.1520 | −1.7222 | 5.8860 | −0.7058 | 1.0374 | 5.8860 |
| 1.1358 | −1.7065 | 5.8860 | −0.6909 | 1.0232 | 5.8860 |
| 1.1163 | −1.6874 | 5.8860 | −0.6729 | 1.0026 | 5.8860 |
| 1.0930 | −1.6647 | 5.8860 | −0.6521 | 0.9755 | 5.8860 |
| 1.0658 | −1.6379 | 5.8860 | −0.6268 | 0.9390 | 5.8860 |
| 1.0338 | −1.6062 | 5.8860 | −0.5990 | 0.8959 | 5.8860 |
| 0.9970 | −1.5695 | 5.8860 | −0.5699 | 0.8496 | 5.8860 |
| 0.9554 | −1.5277 | 5.8860 | −0.5373 | 0.7973 | 5.8860 |
| 0.9091 | −1.4809 | 5.8860 | −0.5011 | 0.7392 | 5.8860 |
| 0.8583 | −1.4289 | 5.8860 | −0.4615 | 0.6752 | 5.8860 |
| 0.8030 | −1.3714 | 5.8860 | −0.4200 | 0.6084 | 5.8860 |
| 0.7456 | −1.3112 | 5.8860 | −0.3765 | 0.5387 | 5.8860 |
| 0.6865 | −1.2480 | 5.8860 | −0.3308 | 0.4663 | 5.8860 |
| 0.6256 | −1.1819 | 5.8860 | −0.2833 | 0.3911 | 5.8860 |
| 0.5630 | −1.1126 | 5.8860 | −0.2337 | 0.3132 | 5.8860 |
| 0.4986 | −1.0403 | 5.8860 | −0.1818 | 0.2327 | 5.8860 |
| 0.4330 | −0.9647 | 5.8860 | −0.1277 | 0.1496 | 5.8860 |
| 0.3660 | −0.8857 | 5.8860 | −0.0713 | 0.0639 | 5.8860 |
| 0.3001 | −0.8057 | 5.8860 | −0.0145 | −0.0215 | 5.8860 |
| 0.2355 | −0.7248 | 5.8860 | 0.0428 | −0.1068 | 5.8860 |
| 0.1722 | −0.6428 | 5.8860 | 0.1004 | −0.1917 | 5.8860 |
| 0.1106 | −0.5596 | 5.8860 | 0.1585 | −0.2762 | 5.8860 |
| 0.0502 | −0.4753 | 5.8860 | 0.2169 | −0.3606 | 5.8860 |
| −0.0091 | −0.3901 | 5.8860 | 0.2756 | −0.4449 | 5.8860 |
| −0.0673 | −0.3040 | 5.8860 | 0.3342 | −0.5291 | 5.8860 |
| −0.1245 | −0.2171 | 5.8860 | 0.3926 | −0.6134 | 5.8860 |
| −0.1807 | −0.1296 | 5.8860 | 0.4510 | −0.6979 | 5.8860 |
| −0.2358 | −0.0412 | 5.8860 | 0.5094 | −0.7822 | 5.8860 |
| −0.2897 | 0.0478 | 5.8860 | 0.5681 | −0.8663 | 5.8860 |
| −0.3405 | 0.1346 | 5.8860 | 0.6252 | −0.9475 | 5.8860 |
| −0.3885 | 0.2191 | 5.8860 | 0.6805 | −1.0258 | 5.8860 |
| −0.4338 | 0.3011 | 5.8860 | 0.7342 | −1.1009 | 5.8860 |
| −0.4763 | 0.3807 | 5.8860 | 0.7863 | −1.1730 | 5.8860 |
| −0.5161 | 0.4578 | 5.8860 | 0.8368 | −1.2421 | 5.8860 |
| −0.5532 | 0.5322 | 5.8860 | 0.8856 | −1.3081 | 5.8860 |
| −0.5880 | 0.6041 | 5.8860 | 0.9327 | −1.3712 | 5.8860 |

TABLE 6-continued

| SUCTION SIDE | | | PRESSURE SIDE | | |
|---|---|---|---|---|---|
| X | Y | Z | X | Y | Z |
| −0.6203 | 0.6733 | 5.8860 | 0.9758 | −1.4286 | 5.8860 |
| −0.6488 | 0.7366 | 5.8860 | 1.0152 | −1.4802 | 5.8860 |
| −0.6736 | 0.7939 | 5.8860 | 1.0507 | −1.5263 | 5.8860 |
| −0.6950 | 0.8451 | 5.8860 | 1.0822 | −1.5669 | 5.8860 |
| −0.7139 | 0.8936 | 5.8860 | 1.1095 | −1.6020 | 5.8860 |
| −0.7285 | 0.9362 | 5.8860 | 1.1328 | −1.6316 | 5.8860 |
| −0.7380 | 0.9697 | 5.8860 | 1.1526 | −1.6569 | 5.8860 |
| −0.7436 | 0.9969 | 5.8860 | 1.1694 | −1.6781 | 5.8860 |
| −0.7457 | 1.0176 | 5.8860 | 1.1832 | −1.6954 | 5.8860 |
| −0.7452 | 1.0332 | 5.8860 | 1.1944 | −1.7093 | 5.8860 |
| −0.7431 | 1.0416 | 5.8860 | 1.2030 | −1.7200 | 5.8860 |
| −0.7404 | 1.0464 | 5.8860 | 1.2081 | −1.7288 | 5.8860 |
| −0.7384 | 1.0484 | 5.8860 | 1.2083 | −1.7371 | 5.8860 |
| −0.7372 | 1.0491 | 5.8860 | 1.2058 | −1.7435 | 5.8860 |
| 1.1635 | −1.7541 | 6.1500 | −0.7102 | 1.0886 | 6.1500 |
| 1.1592 | −1.7571 | 6.1500 | −0.7095 | 1.0888 | 6.1500 |
| 1.1525 | −1.7589 | 6.1500 | −0.7082 | 1.0893 | 6.1500 |
| 1.1440 | −1.7574 | 6.1500 | −0.7054 | 1.0896 | 6.1500 |
| 1.1359 | −1.7510 | 6.1500 | −0.6999 | 1.0884 | 6.1500 |
| 1.1260 | −1.7412 | 6.1500 | −0.6922 | 1.0844 | 6.1500 |
| 1.1131 | −1.7286 | 6.1500 | −0.6802 | 1.0748 | 6.1500 |
| 1.0970 | −1.7128 | 6.1500 | −0.6660 | 1.0598 | 6.1500 |
| 1.0775 | −1.6935 | 6.1500 | −0.6490 | 1.0385 | 6.1500 |
| 1.0544 | −1.6705 | 6.1500 | −0.6295 | 1.0104 | 6.1500 |
| 1.0274 | −1.6436 | 6.1500 | −0.6058 | 0.9728 | 6.1500 |
| 0.9957 | −1.6115 | 6.1500 | −0.5798 | 0.9285 | 6.1500 |
| 0.9592 | −1.5744 | 6.1500 | −0.5528 | 0.8809 | 6.1500 |
| 0.9181 | −1.5322 | 6.1500 | −0.5224 | 0.8274 | 6.1500 |
| 0.8724 | −1.4846 | 6.1500 | −0.4885 | 0.7679 | 6.1500 |
| 0.8223 | −1.4317 | 6.1500 | −0.4513 | 0.7025 | 6.1500 |
| 0.7679 | −1.3733 | 6.1500 | −0.4123 | 0.6341 | 6.1500 |
| 0.7118 | −1.3119 | 6.1500 | −0.3713 | 0.5630 | 6.1500 |
| 0.6540 | −1.2475 | 6.1500 | −0.3283 | 0.4890 | 6.1500 |
| 0.5946 | −1.1799 | 6.1500 | −0.2833 | 0.4123 | 6.1500 |
| 0.5338 | −1.1090 | 6.1500 | −0.2362 | 0.3327 | 6.1500 |
| 0.4716 | −1.0348 | 6.1500 | −0.1871 | 0.2505 | 6.1500 |
| 0.4082 | −0.9572 | 6.1500 | −0.1357 | 0.1657 | 6.1500 |
| 0.3439 | −0.8760 | 6.1500 | −0.0821 | 0.0781 | 6.1500 |
| 0.2807 | −0.7939 | 6.1500 | −0.0279 | −0.0090 | 6.1500 |
| 0.2188 | −0.7109 | 6.1500 | 0.0268 | −0.0958 | 6.1500 |
| 0.1583 | −0.6267 | 6.1500 | 0.0821 | −0.1824 | 6.1500 |
| 0.0992 | −0.5415 | 6.1500 | 0.1377 | −0.2686 | 6.1500 |
| 0.0413 | −0.4553 | 6.1500 | 0.1939 | −0.3545 | 6.1500 |
| −0.0155 | −0.3684 | 6.1500 | 0.2506 | −0.4401 | 6.1500 |
| −0.0713 | −0.2808 | 6.1500 | 0.3074 | −0.5256 | 6.1500 |
| −0.1262 | −0.1923 | 6.1500 | 0.3643 | −0.6110 | 6.1500 |
| −0.1799 | −0.1032 | 6.1500 | 0.4213 | −0.6964 | 6.1500 |
| −0.2326 | −0.0134 | 6.1500 | 0.4786 | −0.7817 | 6.1500 |
| −0.2841 | 0.0770 | 6.1500 | 0.5361 | −0.8667 | 6.1500 |
| −0.3327 | 0.1651 | 6.1500 | 0.5922 | −0.9485 | 6.1500 |
| −0.3787 | 0.2507 | 6.1500 | 0.6466 | −1.0274 | 6.1500 |
| −0.4219 | 0.3339 | 6.1500 | 0.6995 | −1.1032 | 6.1500 |
| −0.4624 | 0.4145 | 6.1500 | 0.7508 | −1.1759 | 6.1500 |
| −0.5005 | 0.4924 | 6.1500 | 0.8006 | −1.2454 | 6.1500 |
| −0.5361 | 0.5677 | 6.1500 | 0.8487 | −1.3120 | 6.1500 |
| −0.5692 | 0.6404 | 6.1500 | 0.8952 | −1.3754 | 6.1500 |
| −0.6001 | 0.7102 | 6.1500 | 0.9380 | −1.4332 | 6.1500 |
| −0.6273 | 0.7739 | 6.1500 | 0.9770 | −1.4853 | 6.1500 |
| −0.6510 | 0.8318 | 6.1500 | 1.0121 | −1.5316 | 6.1500 |
| −0.6714 | 0.8833 | 6.1500 | 1.0433 | −1.5724 | 6.1500 |
| −0.6895 | 0.9322 | 6.1500 | 1.0704 | −1.6077 | 6.1500 |
| −0.7034 | 0.9751 | 6.1500 | 1.0934 | −1.6374 | 6.1500 |
| −0.7122 | 1.0087 | 6.1500 | 1.1132 | −1.6629 | 6.1500 |
| −0.7174 | 1.0360 | 6.1500 | 1.1299 | −1.6841 | 6.1500 |
| −0.7193 | 1.0567 | 6.1500 | 1.1436 | −1.7016 | 6.1500 |
| −0.7187 | 1.0724 | 6.1500 | 1.1546 | −1.7156 | 6.1500 |
| −0.7166 | 1.0807 | 6.1500 | 1.1632 | −1.7263 | 6.1500 |
| −0.7140 | 1.0856 | 6.1500 | 1.1686 | −1.7350 | 6.1500 |
| −0.7120 | 1.0876 | 6.1500 | 1.1691 | −1.7436 | 6.1500 |
| −0.7108 | 1.0883 | 6.1500 | 1.1668 | −1.7501 | 6.1500 |
| 1.1126 | −1.7602 | 6.4352 | −0.6522 | 1.1718 | 6.4352 |
| 1.1084 | −1.7633 | 6.4352 | −0.6516 | 1.1721 | 6.4352 |
| 1.1016 | −1.7651 | 6.4352 | −0.6502 | 1.1723 | 6.4352 |
| 1.0931 | −1.7634 | 6.4352 | −0.6474 | 1.1722 | 6.4352 |
| 1.0850 | −1.7567 | 6.4352 | −0.6422 | 1.1703 | 6.4352 |
| 1.0751 | −1.7469 | 6.4352 | −0.6351 | 1.1652 | 6.4352 |

TABLE 6-continued

| SUCTION SIDE | | | PRESSURE SIDE | | |
|---|---|---|---|---|---|
| X | Y | Z | X | Y | Z |
| 1.0621 | −1.7342 | 6.4352 | −0.6243 | 1.1540 | 6.4352 |
| 1.0461 | −1.7182 | 6.4352 | −0.6118 | 1.1375 | 6.4352 |
| 1.0264 | −1.6987 | 6.4352 | −0.5970 | 1.1144 | 6.4352 |
| 1.0033 | −1.6754 | 6.4352 | −0.5801 | 1.0845 | 6.4352 |
| 0.9763 | −1.6482 | 6.4352 | −0.5598 | 1.0446 | 6.4352 |
| 0.9445 | −1.6157 | 6.4352 | −0.5376 | 0.9979 | 6.4352 |
| 0.9081 | −1.5781 | 6.4352 | −0.5145 | 0.9480 | 6.4352 |
| 0.8671 | −1.5351 | 6.4352 | −0.4884 | 0.8918 | 6.4352 |
| 0.8217 | −1.4867 | 6.4352 | −0.4594 | 0.8294 | 6.4352 |
| 0.7720 | −1.4328 | 6.4352 | −0.4269 | 0.7610 | 6.4352 |
| 0.7184 | −1.3731 | 6.4352 | −0.3927 | 0.6896 | 6.4352 |
| 0.6632 | −1.3103 | 6.4352 | −0.3567 | 0.6152 | 6.4352 |
| 0.6066 | −1.2442 | 6.4352 | −0.3187 | 0.5380 | 6.4352 |
| 0.5486 | −1.1746 | 6.4352 | −0.2786 | 0.4581 | 6.4352 |
| 0.4895 | −1.1016 | 6.4352 | −0.2364 | 0.3753 | 6.4352 |
| 0.4293 | −1.0250 | 6.4352 | −0.1921 | 0.2898 | 6.4352 |
| 0.3682 | −0.9447 | 6.4352 | −0.1455 | 0.2016 | 6.4352 |
| 0.3065 | −0.8604 | 6.4352 | −0.0965 | 0.1107 | 6.4352 |
| 0.2462 | −0.7751 | 6.4352 | −0.0468 | 0.0203 | 6.4352 |
| 0.1874 | −0.6886 | 6.4352 | 0.0038 | −0.0698 | 6.4352 |
| 0.1301 | −0.6010 | 6.4352 | 0.0552 | −0.1594 | 6.4352 |
| 0.0742 | −0.5123 | 6.4352 | 0.1073 | −0.2484 | 6.4352 |
| 0.0197 | −0.4227 | 6.4352 | 0.1603 | −0.3370 | 6.4352 |
| −0.0335 | −0.3325 | 6.4352 | 0.2141 | −0.4250 | 6.4352 |
| −0.0853 | −0.2415 | 6.4352 | 0.2685 | −0.5128 | 6.4352 |
| −0.1360 | −0.1498 | 6.4352 | 0.3235 | −0.6001 | 6.4352 |
| −0.1853 | −0.0573 | 6.4352 | 0.3789 | −0.6872 | 6.4352 |
| −0.2333 | 0.0359 | 6.4352 | 0.4348 | −0.7740 | 6.4352 |
| −0.2799 | 0.1297 | 6.4352 | 0.4913 | −0.8605 | 6.4352 |
| −0.3238 | 0.2210 | 6.4352 | 0.5463 | −0.9437 | 6.4352 |
| −0.3650 | 0.3098 | 6.4352 | 0.5999 | −1.0238 | 6.4352 |
| −0.4035 | 0.3959 | 6.4352 | 0.6521 | −1.1007 | 6.4352 |
| −0.4395 | 0.4793 | 6.4352 | 0.7028 | −1.1744 | 6.4352 |
| −0.4732 | 0.5599 | 6.4352 | 0.7520 | −1.2449 | 6.4352 |
| −0.5046 | 0.6377 | 6.4352 | 0.7996 | −1.3124 | 6.4352 |
| −0.5335 | 0.7127 | 6.4352 | 0.8456 | −1.3768 | 6.4352 |
| −0.5605 | 0.7847 | 6.4352 | 0.8880 | −1.4353 | 6.4352 |
| −0.5842 | 0.8504 | 6.4352 | 0.9267 | −1.4880 | 6.4352 |
| −0.6048 | 0.9098 | 6.4352 | 0.9616 | −1.5350 | 6.4352 |
| −0.6224 | 0.9630 | 6.4352 | 0.9925 | −1.5764 | 6.4352 |
| −0.6378 | 1.0130 | 6.4352 | 1.0195 | −1.6121 | 6.4352 |
| −0.6494 | 1.0570 | 6.4352 | 1.0424 | −1.6423 | 6.4352 |
| −0.6566 | 1.0912 | 6.4352 | 1.0620 | −1.6680 | 6.4352 |
| −0.6606 | 1.1188 | 6.4352 | 1.0786 | −1.6895 | 6.4352 |
| −0.6618 | 1.1397 | 6.4352 | 1.0922 | −1.7072 | 6.4352 |
| −0.6608 | 1.1555 | 6.4352 | 1.1032 | −1.7214 | 6.4352 |
| −0.6587 | 1.1639 | 6.4352 | 1.1115 | −1.7323 | 6.4352 |
| −0.6561 | 1.1688 | 6.4352 | 1.1171 | −1.7409 | 6.4352 |
| −0.6541 | 1.1708 | 6.4352 | 1.1181 | −1.7496 | 6.4352 |
| −0.6529 | 1.1715 | 6.4352 | 1.1159 | −1.7561 | 6.4352 |
| 1.0690 | −1.7655 | 6.6780 | −0.5941 | 1.2546 | 6.6780 |
| 1.0647 | −1.7686 | 6.6780 | −0.5935 | 1.2548 | 6.6780 |
| 1.0579 | −1.7705 | 6.6780 | −0.5920 | 1.2550 | 6.6780 |
| 1.0492 | −1.7685 | 6.6780 | −0.5892 | 1.2543 | 6.6780 |
| 1.0412 | −1.7615 | 6.6780 | −0.5844 | 1.2515 | 6.6780 |
| 1.0312 | −1.7515 | 6.6780 | −0.5782 | 1.2454 | 6.6780 |
| 1.0182 | −1.7386 | 6.6780 | −0.5689 | 1.2328 | 6.6780 |
| 1.0018 | −1.7223 | 6.6780 | −0.5582 | 1.2148 | 6.6780 |
| 0.9821 | −1.7026 | 6.6780 | −0.5457 | 1.1901 | 6.6780 |
| 0.9587 | −1.6789 | 6.6780 | −0.5316 | 1.1583 | 6.6780 |
| 0.9315 | −1.6512 | 6.6780 | −0.5148 | 1.1164 | 6.6780 |
| 0.8995 | −1.6181 | 6.6780 | −0.4965 | 1.0676 | 6.6780 |
| 0.8629 | −1.5797 | 6.6780 | −0.4775 | 1.0154 | 6.6780 |
| 0.8218 | −1.5358 | 6.6780 | −0.4559 | 0.9567 | 6.6780 |
| 0.7763 | −1.4863 | 6.6780 | −0.4315 | 0.8917 | 6.6780 |
| 0.7266 | −1.4311 | 6.6780 | −0.4040 | 0.8204 | 6.6780 |
| 0.6731 | −1.3698 | 6.6780 | −0.3749 | 0.7461 | 6.6780 |
| 0.6182 | −1.3052 | 6.6780 | −0.3437 | 0.6689 | 6.6780 |
| 0.5621 | −1.2372 | 6.6780 | −0.3105 | 0.5887 | 6.6780 |
| 0.5051 | −1.1656 | 6.6780 | −0.2753 | 0.5057 | 6.6780 |
| 0.4472 | −1.0904 | 6.6780 | −0.2379 | 0.4200 | 6.6780 |
| 0.3886 | −1.0115 | 6.6780 | −0.1982 | 0.3315 | 6.6780 |
| 0.3295 | −0.9289 | 6.6780 | −0.1561 | 0.2402 | 6.6780 |
| 0.2700 | −0.8422 | 6.6780 | −0.1116 | 0.1463 | 6.6780 |
| 0.2124 | −0.7542 | 6.6780 | −0.0660 | 0.0529 | 6.6780 |
| 0.1565 | −0.6651 | 6.6780 | −0.0193 | −0.0400 | 6.6780 |

TABLE 6-continued

| SUCTION SIDE | | | PRESSURE SIDE | | |
|---|---|---|---|---|---|
| X | Y | Z | X | Y | Z |
| 0.1023 | −0.5749 | 6.6780 | 0.0286 | −0.1323 | 6.6780 |
| 0.0497 | −0.4838 | 6.6780 | 0.0776 | −0.2242 | 6.6780 |
| −0.0015 | −0.3917 | 6.6780 | 0.1278 | −0.3154 | 6.6780 |
| −0.0513 | −0.2986 | 6.6780 | 0.1792 | −0.4060 | 6.6780 |
| −0.0997 | −0.2047 | 6.6780 | 0.2317 | −0.4961 | 6.6780 |
| −0.1466 | −0.1097 | 6.6780 | 0.2850 | −0.5856 | 6.6780 |
| −0.1918 | −0.0138 | 6.6780 | 0.3393 | −0.6746 | 6.6780 |
| −0.2355 | 0.0828 | 6.6780 | 0.3942 | −0.7631 | 6.6780 |
| −0.2775 | 0.1800 | 6.6780 | 0.4498 | −0.8512 | 6.6780 |
| −0.3167 | 0.2747 | 6.6780 | 0.5041 | −0.9359 | 6.6780 |
| −0.3532 | 0.3666 | 6.6780 | 0.5574 | −1.0175 | 6.6780 |
| −0.3871 | 0.4559 | 6.6780 | 0.6091 | −1.0956 | 6.6780 |
| −0.4185 | 0.5422 | 6.6780 | 0.6596 | −1.1706 | 6.6780 |
| −0.4476 | 0.6256 | 6.6780 | 0.7085 | −1.2423 | 6.6780 |
| −0.4745 | 0.7060 | 6.6780 | 0.7559 | −1.3109 | 6.6780 |
| −0.4992 | 0.7836 | 6.6780 | 0.8018 | −1.3763 | 6.6780 |
| −0.5219 | 0.8579 | 6.6780 | 0.8441 | −1.4357 | 6.6780 |
| −0.5418 | 0.9257 | 6.6780 | 0.8827 | −1.4893 | 6.6780 |
| −0.5590 | 0.9869 | 6.6780 | 0.9176 | −1.5370 | 6.6780 |
| −0.5736 | 1.0415 | 6.6780 | 0.9484 | −1.5789 | 6.6780 |
| −0.5862 | 1.0931 | 6.6780 | 0.9753 | −1.6153 | 6.6780 |
| −0.5955 | 1.1381 | 6.6780 | 0.9982 | −1.6458 | 6.6780 |
| −0.6009 | 1.1730 | 6.6780 | 1.0180 | −1.6719 | 6.6780 |
| −0.6036 | 1.2011 | 6.6780 | 1.0346 | −1.6937 | 6.6780 |
| −0.6041 | 1.2223 | 6.6780 | 1.0482 | −1.7118 | 6.6780 |
| −0.6028 | 1.2382 | 6.6780 | 1.0591 | −1.7261 | 6.6780 |
| −0.6007 | 1.2467 | 6.6780 | 1.0675 | −1.7372 | 6.6780 |
| −0.5981 | 1.2518 | 6.6780 | 1.0732 | −1.7459 | 6.6780 |
| −0.5961 | 1.2538 | 6.6780 | 1.0744 | −1.7545 | 6.6780 |
| −0.5948 | 1.2544 | 6.6780 | 1.0723 | −1.7613 | 6.6780 |

TABLE 7

| SUCTION SIDE | | | PRESSURE SIDE | | |
|---|---|---|---|---|---|
| X | Y | Z | X | Y | Z |
| 1.2074 | −0.9452 | −0.1892 | −0.8397 | 1.0366 | −0.1892 |
| 1.2049 | −0.9489 | −0.1892 | −0.8391 | 1.0368 | −0.1892 |
| 1.2010 | −0.9536 | −0.1892 | −0.8380 | 1.0372 | −0.1892 |
| 1.1953 | −0.9586 | −0.1892 | −0.8357 | 1.0376 | −0.1892 |
| 1.1875 | −0.9633 | −0.1892 | −0.8312 | 1.0381 | −0.1892 |
| 1.1762 | −0.9673 | −0.1892 | −0.8239 | 1.0374 | −0.1892 |
| 1.1605 | −0.9678 | −0.1892 | −0.8117 | 1.0330 | −0.1892 |
| 1.1419 | −0.9616 | −0.1892 | −0.7973 | 1.0233 | −0.1892 |
| 1.1203 | −0.9510 | −0.1892 | −0.7811 | 1.0070 | −0.1892 |
| 1.0946 | −0.9382 | −0.1892 | −0.7639 | 0.9838 | −0.1892 |
| 1.0645 | −0.9234 | −0.1892 | −0.7435 | 0.9522 | −0.1892 |
| 1.0290 | −0.9058 | −0.1892 | −0.7195 | 0.9162 | −0.1892 |
| 0.9881 | −0.8854 | −0.1892 | −0.6932 | 0.8783 | −0.1892 |
| 0.9418 | −0.8620 | −0.1892 | −0.6626 | 0.8362 | −0.1892 |
| 0.8903 | −0.8357 | −0.1892 | −0.6278 | 0.7900 | −0.1892 |
| 0.8333 | −0.8064 | −0.1892 | −0.5889 | 0.7399 | −0.1892 |
| 0.7712 | −0.7740 | −0.1892 | −0.5473 | 0.6882 | −0.1892 |
| 0.7065 | −0.7399 | −0.1892 | −0.5033 | 0.6348 | −0.1892 |
| 0.6395 | −0.7039 | −0.1892 | −0.4566 | 0.5799 | −0.1892 |
| 0.5699 | −0.6659 | −0.1892 | −0.4072 | 0.5237 | −0.1892 |
| 0.4982 | −0.6258 | −0.1892 | −0.3549 | 0.4660 | −0.1892 |
| 0.4243 | −0.5835 | −0.1892 | −0.2998 | 0.4070 | −0.1892 |
| 0.3484 | −0.5384 | −0.1892 | −0.2419 | 0.3466 | −0.1892 |
| 0.2707 | −0.4906 | −0.1892 | −0.1810 | 0.2851 | −0.1892 |
| 0.1938 | −0.4411 | −0.1892 | −0.1194 | 0.2242 | −0.1892 |
| 0.1180 | −0.3900 | −0.1892 | −0.0568 | 0.1644 | −0.1892 |
| 0.0434 | −0.3368 | −0.1892 | 0.0064 | 0.1054 | −0.1892 |
| −0.0295 | −0.2816 | −0.1892 | 0.0703 | 0.0468 | −0.1892 |
| −0.1003 | −0.2242 | −0.1892 | 0.1343 | −0.0113 | −0.1892 |
| −0.1685 | −0.1646 | −0.1892 | 0.1985 | −0.0695 | −0.1892 |
| −0.2347 | −0.1029 | −0.1892 | 0.2628 | −0.1274 | −0.1892 |
| −0.2986 | −0.0393 | −0.1892 | 0.3275 | −0.1850 | −0.1892 |
| −0.3604 | 0.0263 | −0.1892 | 0.3925 | −0.2422 | −0.1892 |
| −0.4199 | 0.0941 | −0.1892 | 0.4579 | −0.2989 | −0.1892 |
| −0.4771 | 0.1641 | −0.1892 | 0.5238 | −0.3551 | −0.1892 |
| −0.5299 | 0.2340 | −0.1892 | 0.5878 | −0.4089 | −0.1892 |

TABLE 7-continued

| SUCTION SIDE | | | PRESSURE SIDE | | |
|---|---|---|---|---|---|
| X | Y | Z | X | Y | Z |
| −0.5786 | 0.3037 | −0.1892 | 0.6501 | −0.4602 | −0.1892 |
| −0.6234 | 0.3728 | −0.1892 | 0.7107 | −0.5094 | −0.1892 |
| −0.6641 | 0.4413 | −0.1892 | 0.7691 | −0.5563 | −0.1892 |
| −0.7006 | 0.5087 | −0.1892 | 0.8257 | −0.6012 | −0.1892 |
| −0.7333 | 0.5746 | −0.1892 | 0.8802 | −0.6439 | −0.1892 |
| −0.7623 | 0.6387 | −0.1892 | 0.9327 | −0.6847 | −0.1892 |
| −0.7869 | 0.7013 | −0.1892 | 0.9807 | −0.7216 | −0.1892 |
| −0.8076 | 0.7589 | −0.1892 | 1.0243 | −0.7548 | −0.1892 |
| −0.8245 | 0.8114 | −0.1892 | 1.0634 | −0.7845 | −0.1892 |
| −0.8383 | 0.8584 | −0.1892 | 1.0980 | −0.8106 | −0.1892 |
| −0.8500 | 0.9029 | −0.1892 | 1.1280 | −0.8331 | −0.1892 |
| −0.8593 | 0.9416 | −0.1892 | 1.1534 | −0.8521 | −0.1892 |
| −0.8638 | 0.9719 | −0.1892 | 1.1751 | −0.8683 | −0.1892 |
| −0.8635 | 0.9962 | −0.1892 | 1.1934 | −0.8820 | −0.1892 |
| −0.8594 | 1.0142 | −0.1892 | 1.2064 | −0.8953 | −0.1892 |
| −0.8529 | 1.0263 | −0.1892 | 1.2124 | −0.9089 | −0.1892 |
| −0.8476 | 1.0320 | −0.1892 | 1.2141 | −0.9204 | −0.1892 |
| −0.8437 | 1.0348 | −0.1892 | 1.2135 | −0.9290 | −0.1892 |
| −0.8414 | 1.0359 | −0.1892 | 1.2117 | −0.9360 | −0.1892 |
| −0.8402 | 1.0364 | −0.1892 | 1.2095 | −0.9414 | −0.1892 |
| 1.1951 | −0.9151 | 0.0000 | −0.8374 | 1.0698 | 0.0000 |
| 1.1925 | −0.9187 | 0.0000 | −0.8369 | 1.0701 | 0.0000 |
| 1.1885 | −0.9232 | 0.0000 | −0.8358 | 1.0705 | 0.0000 |
| 1.1826 | −0.9279 | 0.0000 | −0.8335 | 1.0710 | 0.0000 |
| 1.1749 | −0.9324 | 0.0000 | −0.8290 | 1.0718 | 0.0000 |
| 1.1633 | −0.9359 | 0.0000 | −0.8218 | 1.0714 | 0.0000 |
| 1.1478 | −0.9359 | 0.0000 | −0.8093 | 1.0675 | 0.0000 |
| 1.1295 | −0.9290 | 0.0000 | −0.7947 | 1.0584 | 0.0000 |
| 1.1082 | −0.9181 | 0.0000 | −0.7779 | 1.0426 | 0.0000 |
| 1.0829 | −0.9050 | 0.0000 | −0.7601 | 1.0200 | 0.0000 |
| 1.0533 | −0.8898 | 0.0000 | −0.7390 | 0.9891 | 0.0000 |
| 1.0183 | −0.8717 | 0.0000 | −0.7145 | 0.9536 | 0.0000 |
| 0.9781 | −0.8507 | 0.0000 | −0.6875 | 0.9162 | 0.0000 |
| 0.9325 | −0.8269 | 0.0000 | −0.6565 | 0.8747 | 0.0000 |
| 0.8816 | −0.8001 | 0.0000 | −0.6212 | 0.8292 | 0.0000 |
| 0.8256 | −0.7702 | 0.0000 | −0.5820 | 0.7795 | 0.0000 |
| 0.7643 | −0.7371 | 0.0000 | −0.5402 | 0.7283 | 0.0000 |
| 0.7006 | −0.7022 | 0.0000 | −0.4961 | 0.6752 | 0.0000 |
| 0.6346 | −0.6654 | 0.0000 | −0.4494 | 0.6206 | 0.0000 |
| 0.5662 | −0.6266 | 0.0000 | −0.3999 | 0.5645 | 0.0000 |
| 0.4955 | −0.5858 | 0.0000 | −0.3478 | 0.5071 | 0.0000 |
| 0.4227 | −0.5427 | 0.0000 | −0.2928 | 0.4482 | 0.0000 |
| 0.3479 | −0.4971 | 0.0000 | −0.2351 | 0.3879 | 0.0000 |
| 0.2712 | −0.4487 | 0.0000 | −0.1745 | 0.3264 | 0.0000 |
| 0.1954 | −0.3989 | 0.0000 | −0.1130 | 0.2658 | 0.0000 |
| 0.1205 | −0.3475 | 0.0000 | −0.0508 | 0.2061 | 0.0000 |
| 0.0469 | −0.2941 | 0.0000 | 0.0121 | 0.1471 | 0.0000 |
| −0.0252 | −0.2386 | 0.0000 | 0.0755 | 0.0886 | 0.0000 |
| −0.0949 | −0.1811 | 0.0000 | 0.1391 | 0.0303 | 0.0000 |
| −0.1623 | −0.1214 | 0.0000 | 0.2026 | −0.0280 | 0.0000 |
| −0.2276 | −0.0598 | 0.0000 | 0.2662 | −0.0863 | 0.0000 |
| −0.2907 | 0.0038 | 0.0000 | 0.3301 | −0.1443 | 0.0000 |
| −0.3519 | 0.0692 | 0.0000 | 0.3941 | −0.2021 | 0.0000 |
| −0.4109 | 0.1367 | 0.0000 | 0.4586 | −0.2594 | 0.0000 |
| −0.4674 | 0.2063 | 0.0000 | 0.5235 | −0.3164 | 0.0000 |
| −0.5198 | 0.2757 | 0.0000 | 0.5866 | −0.3708 | 0.0000 |
| −0.5682 | 0.3447 | 0.0000 | 0.6480 | −0.4230 | 0.0000 |
| −0.6128 | 0.4132 | 0.0000 | 0.7075 | −0.4729 | 0.0000 |
| −0.6535 | 0.4809 | 0.0000 | 0.7651 | −0.5206 | 0.0000 |
| −0.6902 | 0.5475 | 0.0000 | 0.8208 | −0.5661 | 0.0000 |
| −0.7232 | 0.6126 | 0.0000 | 0.8744 | −0.6095 | 0.0000 |
| −0.7528 | 0.6760 | 0.0000 | 0.9260 | −0.6509 | 0.0000 |
| −0.7781 | 0.7377 | 0.0000 | 0.9733 | −0.6884 | 0.0000 |
| −0.7995 | 0.7946 | 0.0000 | 1.0162 | −0.7223 | 0.0000 |
| −0.8173 | 0.8463 | 0.0000 | 1.0547 | −0.7525 | 0.0000 |
| −0.8317 | 0.8927 | 0.0000 | 1.0887 | −0.7791 | 0.0000 |
| −0.8443 | 0.9366 | 0.0000 | 1.1182 | −0.8020 | 0.0000 |
| −0.8543 | 0.9748 | 0.0000 | 1.1432 | −0.8214 | 0.0000 |
| −0.8595 | 1.0047 | 0.0000 | 1.1646 | −0.8380 | 0.0000 |
| −0.8598 | 1.0289 | 0.0000 | 1.1824 | −0.8519 | 0.0000 |
| −0.8562 | 1.0468 | 0.0000 | 1.1951 | −0.8654 | 0.0000 |
| −0.8502 | 1.0591 | 0.0000 | 1.2010 | −0.8790 | 0.0000 |
| −0.8452 | 1.0649 | 0.0000 | 1.2023 | −0.8905 | 0.0000 |
| −0.8413 | 1.0678 | 0.0000 | 1.2014 | −0.8991 | 0.0000 |
| −0.8391 | 1.0690 | 0.0000 | 1.1996 | −0.9060 | 0.0000 |
| −0.8380 | 1.0696 | 0.0000 | 1.1972 | −0.9113 | 0.0000 |

TABLE 7-continued

| SUCTION SIDE | | | PRESSURE SIDE | | |
|---|---|---|---|---|---|
| X | Y | Z | X | Y | Z |
| 1.1700 | −0.8678 | 0.3657 | −0.8281 | 1.1305 | 0.3657 |
| 1.1672 | −0.8714 | 0.3657 | −0.8276 | 1.1308 | 0.3657 |
| 1.1631 | −0.8756 | 0.3657 | −0.8265 | 1.1312 | 0.3657 |
| 1.1572 | −0.8801 | 0.3657 | −0.8244 | 1.1319 | 0.3657 |
| 1.1492 | −0.8840 | 0.3657 | −0.8198 | 1.1329 | 0.3657 |
| 1.1378 | −0.8868 | 0.3657 | −0.8126 | 1.1328 | 0.3657 |
| 1.1225 | −0.8856 | 0.3657 | −0.8001 | 1.1295 | 0.3657 |
| 1.1049 | −0.8776 | 0.3657 | −0.7851 | 1.1212 | 0.3657 |
| 1.0843 | −0.8661 | 0.3657 | −0.7676 | 1.1065 | 0.3657 |
| 1.0597 | −0.8524 | 0.3657 | −0.7485 | 1.0852 | 0.3657 |
| 1.0310 | −0.8364 | 0.3657 | −0.7258 | 1.0558 | 0.3657 |
| 0.9972 | −0.8174 | 0.3657 | −0.6996 | 1.0218 | 0.3657 |
| 0.9581 | −0.7953 | 0.3657 | −0.6714 | 0.9858 | 0.3657 |
| 0.9138 | −0.7704 | 0.3657 | −0.6394 | 0.9455 | 0.3657 |
| 0.8646 | −0.7422 | 0.3657 | −0.6036 | 0.9010 | 0.3657 |
| 0.8102 | −0.7110 | 0.3657 | −0.5640 | 0.8522 | 0.3657 |
| 0.7508 | −0.6764 | 0.3657 | −0.5224 | 0.8013 | 0.3657 |
| 0.6889 | −0.6401 | 0.3657 | −0.4785 | 0.7486 | 0.3657 |
| 0.6248 | −0.6018 | 0.3657 | −0.4321 | 0.6943 | 0.3657 |
| 0.5584 | −0.5616 | 0.3657 | −0.3831 | 0.6384 | 0.3657 |
| 0.4898 | −0.5193 | 0.3657 | −0.3316 | 0.5811 | 0.3657 |
| 0.4191 | −0.4749 | 0.3657 | −0.2774 | 0.5223 | 0.3657 |
| 0.3463 | −0.4280 | 0.3657 | −0.2203 | 0.4620 | 0.3657 |
| 0.2716 | −0.3785 | 0.3657 | −0.1604 | 0.4006 | 0.3657 |
| 0.1979 | −0.3277 | 0.3657 | −0.0997 | 0.3400 | 0.3657 |
| 0.1249 | −0.2754 | 0.3657 | −0.0382 | 0.2802 | 0.3657 |
| 0.0533 | −0.2213 | 0.3657 | 0.0239 | 0.2211 | 0.3657 |
| −0.0163 | −0.1652 | 0.3657 | 0.0863 | 0.1623 | 0.3657 |
| −0.0836 | −0.1070 | 0.3657 | 0.1487 | 0.1035 | 0.3657 |
| −0.1489 | −0.0467 | 0.3657 | 0.2109 | 0.0444 | 0.3657 |
| −0.2120 | 0.0155 | 0.3657 | 0.2729 | −0.0149 | 0.3657 |
| −0.2732 | 0.0794 | 0.3657 | 0.3347 | −0.0743 | 0.3657 |
| −0.3327 | 0.1451 | 0.3657 | 0.3968 | −0.1335 | 0.3657 |
| −0.3902 | 0.2126 | 0.3657 | 0.4591 | −0.1925 | 0.3657 |
| −0.4457 | 0.2821 | 0.3657 | 0.5217 | −0.2510 | 0.3657 |
| −0.4972 | 0.3512 | 0.3657 | 0.5826 | −0.3073 | 0.3657 |
| −0.5451 | 0.4197 | 0.3657 | 0.6418 | −0.3612 | 0.3657 |
| −0.5892 | 0.4875 | 0.3657 | 0.6992 | −0.4127 | 0.3657 |
| −0.6297 | 0.5539 | 0.3657 | 0.7548 | −0.4621 | 0.3657 |
| −0.6664 | 0.6190 | 0.3657 | 0.8086 | −0.5092 | 0.3657 |
| −0.6997 | 0.6828 | 0.3657 | 0.8605 | −0.5541 | 0.3657 |
| −0.7299 | 0.7446 | 0.3657 | 0.9103 | −0.5969 | 0.3657 |
| −0.7565 | 0.8049 | 0.3657 | 0.9561 | −0.6359 | 0.3657 |
| −0.7792 | 0.8604 | 0.3657 | 0.9975 | −0.6710 | 0.3657 |
| −0.7983 | 0.9107 | 0.3657 | 1.0347 | −0.7023 | 0.3657 |
| −0.8143 | 0.9559 | 0.3657 | 1.0676 | −0.7298 | 0.3657 |
| −0.8285 | 0.9986 | 0.3657 | 1.0961 | −0.7537 | 0.3657 |
| −0.8400 | 1.0358 | 0.3657 | 1.1202 | −0.7739 | 0.3657 |
| −0.8462 | 1.0651 | 0.3657 | 1.1408 | −0.7911 | 0.3657 |
| −0.8476 | 1.0888 | 0.3657 | 1.1581 | −0.8055 | 0.3657 |
| −0.8451 | 1.1067 | 0.3657 | 1.1709 | −0.8189 | 0.3657 |
| −0.8400 | 1.1192 | 0.3657 | 1.1766 | −0.8325 | 0.3657 |
| −0.8354 | 1.1251 | 0.3657 | 1.1778 | −0.8437 | 0.3657 |
| −0.8318 | 1.1283 | 0.3657 | 1.1768 | −0.8523 | 0.3657 |
| −0.8298 | 1.1297 | 0.3657 | 1.1747 | −0.8590 | 0.3657 |
| −0.8287 | 1.1302 | 0.3657 | 1.1722 | −0.8642 | 0.3657 |
| 1.1561 | −0.8679 | 0.5200 | −0.8160 | 1.1480 | 0.5200 |
| 1.1534 | −0.8714 | 0.5200 | −0.8155 | 1.1483 | 0.5200 |
| 1.1491 | −0.8754 | 0.5200 | −0.8144 | 1.1488 | 0.5200 |
| 1.1431 | −0.8797 | 0.5200 | −0.8123 | 1.1495 | 0.5200 |
| 1.1351 | −0.8832 | 0.5200 | −0.8078 | 1.1505 | 0.5200 |
| 1.1234 | −0.8851 | 0.5200 | −0.8006 | 1.1505 | 0.5200 |
| 1.1084 | −0.8825 | 0.5200 | −0.7881 | 1.1472 | 0.5200 |
| 1.0914 | −0.8734 | 0.5200 | −0.7730 | 1.1390 | 0.5200 |
| 1.0711 | −0.8616 | 0.5200 | −0.7554 | 1.1247 | 0.5200 |
| 1.0469 | −0.8476 | 0.5200 | −0.7359 | 1.1038 | 0.5200 |
| 1.0186 | −0.8313 | 0.5200 | −0.7127 | 1.0750 | 0.5200 |
| 0.9852 | −0.8119 | 0.5200 | −0.6861 | 1.0414 | 0.5200 |
| 0.9467 | −0.7895 | 0.5200 | −0.6576 | 1.0059 | 0.5200 |
| 0.9032 | −0.7639 | 0.5200 | −0.6254 | 0.9659 | 0.5200 |
| 0.8545 | −0.7353 | 0.5200 | −0.5893 | 0.9218 | 0.5200 |
| 0.8009 | −0.7035 | 0.5200 | −0.5497 | 0.8733 | 0.5200 |
| 0.7424 | −0.6684 | 0.5200 | −0.5080 | 0.8226 | 0.5200 |
| 0.6814 | −0.6314 | 0.5200 | −0.4642 | 0.7701 | 0.5200 |
| 0.6182 | −0.5925 | 0.5200 | −0.4180 | 0.7159 | 0.5200 |
| 0.5527 | −0.5517 | 0.5200 | −0.3694 | 0.6600 | 0.5200 |

TABLE 7-continued

| SUCTION SIDE | | | PRESSURE SIDE | | |
|---|---|---|---|---|---|
| X | Y | Z | X | Y | Z |
| 0.4852 | −0.5086 | 0.5200 | −0.3184 | 0.6025 | 0.5200 |
| 0.4156 | −0.4632 | 0.5200 | −0.2646 | 0.5436 | 0.5200 |
| 0.3441 | −0.4153 | 0.5200 | −0.2082 | 0.4831 | 0.5200 |
| 0.2708 | −0.3647 | 0.5200 | −0.1490 | 0.4214 | 0.5200 |
| 0.1983 | −0.3128 | 0.5200 | −0.0890 | 0.3603 | 0.5200 |
| 0.1269 | −0.2593 | 0.5200 | −0.0285 | 0.2999 | 0.5200 |
| 0.0570 | −0.2043 | 0.5200 | 0.0327 | 0.2400 | 0.5200 |
| −0.0108 | −0.1473 | 0.5200 | 0.0941 | 0.1805 | 0.5200 |
| −0.0765 | −0.0881 | 0.5200 | 0.1555 | 0.1209 | 0.5200 |
| −0.1404 | −0.0270 | 0.5200 | 0.2166 | 0.0611 | 0.5200 |
| −0.2022 | 0.0360 | 0.5200 | 0.2774 | 0.0009 | 0.5200 |
| −0.2624 | 0.1007 | 0.5200 | 0.3379 | −0.0595 | 0.5200 |
| −0.3209 | 0.1670 | 0.5200 | 0.3985 | −0.1199 | 0.5200 |
| −0.3777 | 0.2352 | 0.5200 | 0.4593 | −0.1800 | 0.5200 |
| −0.4325 | 0.3052 | 0.5200 | 0.5205 | −0.2399 | 0.5200 |
| −0.4836 | 0.3746 | 0.5200 | 0.5800 | −0.2973 | 0.5200 |
| −0.5308 | 0.4431 | 0.5200 | 0.6378 | −0.3523 | 0.5200 |
| −0.5744 | 0.5104 | 0.5200 | 0.6939 | −0.4050 | 0.5200 |
| −0.6144 | 0.5766 | 0.5200 | 0.7483 | −0.4553 | 0.5200 |
| −0.6509 | 0.6413 | 0.5200 | 0.8010 | −0.5034 | 0.5200 |
| −0.6841 | 0.7044 | 0.5200 | 0.8517 | −0.5493 | 0.5200 |
| −0.7143 | 0.7658 | 0.5200 | 0.9006 | −0.5931 | 0.5200 |
| −0.7410 | 0.8254 | 0.5200 | 0.9453 | −0.6328 | 0.5200 |
| −0.7640 | 0.8803 | 0.5200 | 0.9859 | −0.6688 | 0.5200 |
| −0.7835 | 0.9300 | 0.5200 | 1.0222 | −0.7008 | 0.5200 |
| −0.8000 | 0.9747 | 0.5200 | 1.0544 | −0.7290 | 0.5200 |
| −0.8145 | 1.0169 | 0.5200 | 1.0822 | −0.7535 | 0.5200 |
| −0.8262 | 1.0537 | 0.5200 | 1.1057 | −0.7742 | 0.5200 |
| −0.8327 | 1.0827 | 0.5200 | 1.1259 | −0.7919 | 0.5200 |
| −0.8345 | 1.1064 | 0.5200 | 1.1428 | −0.8068 | 0.5200 |
| −0.8323 | 1.1241 | 0.5200 | 1.1561 | −0.8195 | 0.5200 |
| −0.8275 | 1.1366 | 0.5200 | 1.1625 | −0.8328 | 0.5200 |
| −0.8231 | 1.1426 | 0.5200 | 1.1640 | −0.8439 | 0.5200 |
| −0.8196 | 1.1458 | 0.5200 | 1.1631 | −0.8524 | 0.5200 |
| −0.8176 | 1.1472 | 0.5200 | 1.1610 | −0.8592 | 0.5200 |
| −0.8165 | 1.1477 | 0.5200 | 1.1585 | −0.8643 | 0.5200 |
| 1.1368 | −0.8934 | 0.6972 | −0.7957 | 1.1583 | 0.6972 |
| 1.1338 | −0.8968 | 0.6972 | −0.7951 | 1.1586 | 0.6972 |
| 1.1295 | −0.9007 | 0.6972 | −0.7941 | 1.1591 | 0.6972 |
| 1.1231 | −0.9045 | 0.6972 | −0.7919 | 1.1598 | 0.6972 |
| 1.1148 | −0.9072 | 0.6972 | −0.7875 | 1.1608 | 0.6972 |
| 1.1031 | −0.9076 | 0.6972 | −0.7803 | 1.1608 | 0.6972 |
| 1.0888 | −0.9025 | 0.6972 | −0.7678 | 1.1575 | 0.6972 |
| 1.0723 | −0.8926 | 0.6972 | −0.7527 | 1.1494 | 0.6972 |
| 1.0524 | −0.8804 | 0.6972 | −0.7349 | 1.1352 | 0.6972 |
| 1.0286 | −0.8660 | 0.6972 | −0.7151 | 1.1147 | 0.6972 |
| 1.0008 | −0.8491 | 0.6972 | −0.6916 | 1.0862 | 0.6972 |
| 0.9679 | −0.8291 | 0.6972 | −0.6648 | 1.0530 | 0.6972 |
| 0.9301 | −0.8060 | 0.6972 | −0.6361 | 1.0177 | 0.6972 |
| 0.8872 | −0.7796 | 0.6972 | −0.6036 | 0.9780 | 0.6972 |
| 0.8394 | −0.7501 | 0.6972 | −0.5676 | 0.9340 | 0.6972 |
| 0.7867 | −0.7172 | 0.6972 | −0.5279 | 0.8856 | 0.6972 |
| 0.7291 | −0.6810 | 0.6972 | −0.4862 | 0.8351 | 0.6972 |
| 0.6693 | −0.6428 | 0.6972 | −0.4425 | 0.7826 | 0.6972 |
| 0.6074 | −0.6025 | 0.6972 | −0.3967 | 0.7283 | 0.6972 |
| 0.5434 | −0.5600 | 0.6972 | −0.3485 | 0.6722 | 0.6972 |
| 0.4773 | −0.5152 | 0.6972 | −0.2979 | 0.6144 | 0.6972 |
| 0.4092 | −0.4680 | 0.6972 | −0.2450 | 0.5549 | 0.6972 |
| 0.3395 | −0.4180 | 0.6972 | −0.1893 | 0.4939 | 0.6972 |
| 0.2681 | −0.3653 | 0.6972 | −0.1313 | 0.4313 | 0.6972 |
| 0.1978 | −0.3114 | 0.6972 | −0.0725 | 0.3692 | 0.6972 |
| 0.1287 | −0.2561 | 0.6972 | −0.0133 | 0.3078 | 0.6972 |
| 0.0612 | −0.1994 | 0.6972 | 0.0463 | 0.2467 | 0.6972 |
| −0.0042 | −0.1407 | 0.6972 | 0.1062 | 0.1858 | 0.6972 |
| −0.0675 | −0.0802 | 0.6972 | 0.1660 | 0.1248 | 0.6972 |
| −0.1291 | −0.0179 | 0.6972 | 0.2256 | 0.0637 | 0.6972 |
| −0.1890 | 0.0461 | 0.6972 | 0.2846 | 0.0019 | 0.6972 |
| −0.2473 | 0.1115 | 0.6972 | 0.3430 | −0.0603 | 0.6972 |
| −0.3040 | 0.1785 | 0.6972 | 0.4015 | −0.1227 | 0.6972 |
| −0.3591 | 0.2469 | 0.6972 | 0.4601 | −0.1847 | 0.6972 |
| −0.4125 | 0.3170 | 0.6972 | 0.5190 | −0.2466 | 0.6972 |
| −0.4623 | 0.3865 | 0.6972 | 0.5763 | −0.3060 | 0.6972 |
| −0.5087 | 0.4550 | 0.6972 | 0.6320 | −0.3630 | 0.6972 |
| −0.5518 | 0.5226 | 0.6972 | 0.6862 | −0.4175 | 0.6972 |
| −0.5914 | 0.5886 | 0.6972 | 0.7387 | −0.4697 | 0.6972 |
| −0.6277 | 0.6532 | 0.6972 | 0.7895 | −0.5195 | 0.6972 |

TABLE 7-continued

| SUCTION SIDE | | | PRESSURE SIDE | | |
|---|---|---|---|---|---|
| X | Y | Z | X | Y | Z |
| −0.6608 | 0.7162 | 0.6972 | 0.8385 | −0.5670 | 0.6972 |
| −0.6911 | 0.7773 | 0.6972 | 0.8857 | −0.6124 | 0.6972 |
| −0.7181 | 0.8367 | 0.6972 | 0.9290 | −0.6536 | 0.6972 |
| −0.7413 | 0.8912 | 0.6972 | 0.9683 | −0.6908 | 0.6972 |
| −0.7610 | 0.9409 | 0.6972 | 1.0035 | −0.7240 | 0.6972 |
| −0.7776 | 0.9853 | 0.6972 | 1.0346 | −0.7532 | 0.6972 |
| −0.7924 | 1.0273 | 0.6972 | 1.0616 | −0.7786 | 0.6972 |
| −0.8043 | 1.0639 | 0.6972 | 1.0845 | −0.8000 | 0.6972 |
| −0.8110 | 1.0928 | 0.6972 | 1.1039 | −0.8183 | 0.6972 |
| −0.8131 | 1.1163 | 0.6972 | 1.1204 | −0.8336 | 0.6972 |
| −0.8113 | 1.1341 | 0.6972 | 1.1339 | −0.8463 | 0.6972 |
| −0.8069 | 1.1466 | 0.6972 | 1.1419 | −0.8586 | 0.6972 |
| −0.8027 | 1.1527 | 0.6972 | 1.1441 | −0.8696 | 0.6972 |
| −0.7992 | 1.1561 | 0.6972 | 1.1436 | −0.8781 | 0.6972 |
| −0.7972 | 1.1575 | 0.6972 | 1.1416 | −0.8849 | 0.6972 |
| −0.7962 | 1.1580 | 0.6972 | 1.1391 | −0.8899 | 0.6972 |
| 1.1151 | −0.9387 | 0.8745 | −0.7722 | 1.1583 | 0.8745 |
| 1.1121 | −0.9419 | 0.8745 | −0.7716 | 1.1586 | 0.8745 |
| 1.1074 | −0.9455 | 0.8745 | −0.7705 | 1.1591 | 0.8745 |
| 1.1009 | −0.9487 | 0.8745 | −0.7685 | 1.1598 | 0.8745 |
| 1.0923 | −0.9504 | 0.8745 | −0.7639 | 1.1608 | 0.8745 |
| 1.0808 | −0.9487 | 0.8745 | −0.7567 | 1.1607 | 0.8745 |
| 1.0674 | −0.9413 | 0.8745 | −0.7443 | 1.1574 | 0.8745 |
| 1.0514 | −0.9310 | 0.8745 | −0.7292 | 1.1492 | 0.8745 |
| 1.0317 | −0.9184 | 0.8745 | −0.7113 | 1.1351 | 0.8745 |
| 1.0084 | −0.9033 | 0.8745 | −0.6915 | 1.1147 | 0.8745 |
| 0.9812 | −0.8858 | 0.8745 | −0.6676 | 1.0863 | 0.8745 |
| 0.9490 | −0.8649 | 0.8745 | −0.6407 | 1.0532 | 0.8745 |
| 0.9119 | −0.8408 | 0.8745 | −0.6119 | 1.0180 | 0.8745 |
| 0.8699 | −0.8134 | 0.8745 | −0.5795 | 0.9783 | 0.8745 |
| 0.8232 | −0.7826 | 0.8745 | −0.5434 | 0.9344 | 0.8745 |
| 0.7718 | −0.7482 | 0.8745 | −0.5037 | 0.8859 | 0.8745 |
| 0.7156 | −0.7104 | 0.8745 | −0.4622 | 0.8353 | 0.8745 |
| 0.6572 | −0.6705 | 0.8745 | −0.4187 | 0.7826 | 0.8745 |
| 0.5967 | −0.6284 | 0.8745 | −0.3732 | 0.7280 | 0.8745 |
| 0.5343 | −0.5840 | 0.8745 | −0.3255 | 0.6714 | 0.8745 |
| 0.4699 | −0.5372 | 0.8745 | −0.2757 | 0.6130 | 0.8745 |
| 0.4037 | −0.4879 | 0.8745 | −0.2235 | 0.5528 | 0.8745 |
| 0.3359 | −0.4360 | 0.8745 | −0.1690 | 0.4908 | 0.8745 |
| 0.2666 | −0.3813 | 0.8745 | −0.1121 | 0.4271 | 0.8745 |
| 0.1985 | −0.3255 | 0.8745 | −0.0548 | 0.3638 | 0.8745 |
| 0.1318 | −0.2685 | 0.8745 | 0.0029 | 0.3010 | 0.8745 |
| 0.0667 | −0.2100 | 0.8745 | 0.0610 | 0.2383 | 0.8745 |
| 0.0034 | −0.1495 | 0.8745 | 0.1193 | 0.1759 | 0.8745 |
| −0.0578 | −0.0873 | 0.8745 | 0.1774 | 0.1134 | 0.8745 |
| −0.1174 | −0.0236 | 0.8745 | 0.2353 | 0.0506 | 0.8745 |
| −0.1754 | 0.0417 | 0.8745 | 0.2923 | −0.0129 | 0.8745 |
| −0.2320 | 0.1083 | 0.8745 | 0.3488 | −0.0770 | 0.8745 |
| −0.2871 | 0.1763 | 0.8745 | 0.4051 | −0.1412 | 0.8745 |
| −0.3407 | 0.2458 | 0.8745 | 0.4614 | −0.2054 | 0.8745 |
| −0.3928 | 0.3167 | 0.8745 | 0.5179 | −0.2695 | 0.8745 |
| −0.4415 | 0.3867 | 0.8745 | 0.5729 | −0.3310 | 0.8745 |
| −0.4870 | 0.4558 | 0.8745 | 0.6263 | −0.3901 | 0.8745 |
| −0.5293 | 0.5234 | 0.8745 | 0.6782 | −0.4468 | 0.8745 |
| −0.5682 | 0.5896 | 0.8745 | 0.7285 | −0.5011 | 0.8745 |
| −0.6041 | 0.6542 | 0.8745 | 0.7774 | −0.5529 | 0.8745 |
| −0.6369 | 0.7171 | 0.8745 | 0.8245 | −0.6024 | 0.8745 |
| −0.6670 | 0.7781 | 0.8745 | 0.8698 | −0.6497 | 0.8745 |
| −0.6938 | 0.8374 | 0.8745 | 0.9114 | −0.6926 | 0.8745 |
| −0.7169 | 0.8918 | 0.8745 | 0.9491 | −0.7313 | 0.8745 |
| −0.7365 | 0.9414 | 0.8745 | 0.9830 | −0.7659 | 0.8745 |
| −0.7530 | 0.9856 | 0.8745 | 1.0129 | −0.7963 | 0.8745 |
| −0.7679 | 1.0274 | 0.8745 | 1.0389 | −0.8227 | 0.8745 |
| −0.7798 | 1.0640 | 0.8745 | 1.0609 | −0.8449 | 0.8745 |
| −0.7865 | 1.0928 | 0.8745 | 1.0798 | −0.8639 | 0.8745 |
| −0.7888 | 1.1162 | 0.8745 | 1.0956 | −0.8799 | 0.8745 |
| −0.7873 | 1.1339 | 0.8745 | 1.1087 | −0.8929 | 0.8745 |
| −0.7831 | 1.1465 | 0.8745 | 1.1182 | −0.9042 | 0.8745 |
| −0.7791 | 1.1527 | 0.8745 | 1.1217 | −0.9148 | 0.8745 |
| −0.7757 | 1.1561 | 0.8745 | 1.1217 | −0.9233 | 0.8745 |
| −0.7737 | 1.1575 | 0.8745 | 1.1199 | −0.9301 | 0.8745 |
| −0.7727 | 1.1580 | 0.8745 | 1.1175 | −0.9352 | 0.8745 |
| 1.0718 | −1.0355 | 1.2291 | −0.7333 | 1.1442 | 1.2291 |
| 1.0686 | −1.0384 | 1.2291 | −0.7328 | 1.1445 | 1.2291 |
| 1.0636 | −1.0414 | 1.2291 | −0.7318 | 1.1450 | 1.2291 |
| 1.0566 | −1.0434 | 1.2291 | −0.7296 | 1.1457 | 1.2291 |

TABLE 7-continued

| SUCTION SIDE | | | PRESSURE SIDE | | |
|---|---|---|---|---|---|
| X | Y | Z | X | Y | Z |
| 1.0479 | −1.0431 | 1.2291 | −0.7251 | 1.1466 | 1.2291 |
| 1.0374 | −1.0379 | 1.2291 | −0.7179 | 1.1463 | 1.2291 |
| 1.0252 | −1.0290 | 1.2291 | −0.7055 | 1.1425 | 1.2291 |
| 1.0096 | −1.0178 | 1.2291 | −0.6905 | 1.1340 | 1.2291 |
| 0.9909 | −1.0042 | 1.2291 | −0.6728 | 1.1198 | 1.2291 |
| 0.9686 | −0.9879 | 1.2291 | −0.6528 | 1.0995 | 1.2291 |
| 0.9425 | −0.9689 | 1.2291 | −0.6287 | 1.0713 | 1.2291 |
| 0.9117 | −0.9463 | 1.2291 | −0.6014 | 1.0383 | 1.2291 |
| 0.8763 | −0.9201 | 1.2291 | −0.5725 | 1.0031 | 1.2291 |
| 0.8362 | −0.8903 | 1.2291 | −0.5400 | 0.9634 | 1.2291 |
| 0.7915 | −0.8568 | 1.2291 | −0.5039 | 0.9191 | 1.2291 |
| 0.7424 | −0.8196 | 1.2291 | −0.4646 | 0.8703 | 1.2291 |
| 0.6887 | −0.7786 | 1.2291 | −0.4237 | 0.8191 | 1.2291 |
| 0.6329 | −0.7355 | 1.2291 | −0.3811 | 0.7655 | 1.2291 |
| 0.5752 | −0.6901 | 1.2291 | −0.3366 | 0.7097 | 1.2291 |
| 0.5156 | −0.6424 | 1.2291 | −0.2903 | 0.6519 | 1.2291 |
| 0.4541 | −0.5924 | 1.2291 | −0.2419 | 0.5920 | 1.2291 |
| 0.3909 | −0.5399 | 1.2291 | −0.1916 | 0.5299 | 1.2291 |
| 0.3263 | −0.4848 | 1.2291 | −0.1392 | 0.4659 | 1.2291 |
| 0.2604 | −0.4271 | 1.2291 | −0.0847 | 0.4000 | 1.2291 |
| 0.1955 | −0.3684 | 1.2291 | −0.0299 | 0.3343 | 1.2291 |
| 0.1319 | −0.3085 | 1.2291 | 0.0251 | 0.2688 | 1.2291 |
| 0.0700 | −0.2471 | 1.2291 | 0.0803 | 0.2034 | 1.2291 |
| 0.0101 | −0.1840 | 1.2291 | 0.1356 | 0.1382 | 1.2291 |
| −0.0478 | −0.1190 | 1.2291 | 0.1909 | 0.0728 | 1.2291 |
| −0.1041 | −0.0527 | 1.2291 | 0.2458 | 0.0073 | 1.2291 |
| −0.1590 | 0.0150 | 1.2291 | 0.3000 | −0.0590 | 1.2291 |
| −0.2125 | 0.0839 | 1.2291 | 0.3534 | −0.1259 | 1.2291 |
| −0.2648 | 0.1539 | 1.2291 | 0.4062 | −0.1931 | 1.2291 |
| −0.3156 | 0.2252 | 1.2291 | 0.4591 | −0.2605 | 1.2291 |
| −0.3651 | 0.2977 | 1.2291 | 0.5120 | −0.3278 | 1.2291 |
| −0.4115 | 0.3691 | 1.2291 | 0.5633 | −0.3927 | 1.2291 |
| −0.4550 | 0.4391 | 1.2291 | 0.6132 | −0.4551 | 1.2291 |
| −0.4956 | 0.5077 | 1.2291 | 0.6615 | −0.5151 | 1.2291 |
| −0.5331 | 0.5745 | 1.2291 | 0.7083 | −0.5726 | 1.2291 |
| −0.5679 | 0.6395 | 1.2291 | 0.7537 | −0.6276 | 1.2291 |
| −0.5997 | 0.7027 | 1.2291 | 0.7974 | −0.6803 | 1.2291 |
| −0.6290 | 0.7639 | 1.2291 | 0.8396 | −0.7306 | 1.2291 |
| −0.6553 | 0.8232 | 1.2291 | 0.8782 | −0.7764 | 1.2291 |
| −0.6779 | 0.8777 | 1.2291 | 0.9133 | −0.8177 | 1.2291 |
| −0.6972 | 0.9272 | 1.2291 | 0.9448 | −0.8546 | 1.2291 |
| −0.7136 | 0.9714 | 1.2291 | 0.9726 | −0.8871 | 1.2291 |
| −0.7282 | 1.0132 | 1.2291 | 0.9968 | −0.9152 | 1.2291 |
| −0.7398 | 1.0497 | 1.2291 | 1.0173 | −0.9389 | 1.2291 |
| −0.7464 | 1.0785 | 1.2291 | 1.0349 | −0.9592 | 1.2291 |
| −0.7489 | 1.1019 | 1.2291 | 1.0496 | −0.9763 | 1.2291 |
| −0.7477 | 1.1195 | 1.2291 | 1.0618 | −0.9903 | 1.2291 |
| −0.7440 | 1.1322 | 1.2291 | 1.0715 | −1.0014 | 1.2291 |
| −0.7401 | 1.1386 | 1.2291 | 1.0773 | −1.0112 | 1.2291 |
| −0.7368 | 1.1420 | 1.2291 | 1.0783 | −1.0198 | 1.2291 |
| −0.7349 | 1.1434 | 1.2291 | 1.0770 | −1.0268 | 1.2291 |
| −0.7338 | 1.1439 | 1.2291 | 1.0744 | −1.0320 | 1.2291 |
| 1.0279 | −1.1304 | 1.5836 | −0.7017 | 1.1247 | 1.5836 |
| 1.0245 | −1.1332 | 1.5836 | −0.7011 | 1.1249 | 1.5836 |
| 1.0193 | −1.1357 | 1.5836 | −0.7001 | 1.1254 | 1.5836 |
| 1.0121 | −1.1369 | 1.5836 | −0.6979 | 1.1262 | 1.5836 |
| 1.0036 | −1.1350 | 1.5836 | −0.6933 | 1.1268 | 1.5836 |
| 0.9940 | −1.1282 | 1.5836 | −0.6861 | 1.1262 | 1.5836 |
| 0.9822 | −1.1185 | 1.5836 | −0.6739 | 1.1218 | 1.5836 |
| 0.9675 | −1.1064 | 1.5836 | −0.6591 | 1.1128 | 1.5836 |
| 0.9494 | −1.0917 | 1.5836 | −0.6415 | 1.0983 | 1.5836 |
| 0.9280 | −1.0742 | 1.5836 | −0.6215 | 1.0777 | 1.5836 |
| 0.9030 | −1.0537 | 1.5836 | −0.5973 | 1.0495 | 1.5836 |
| 0.8736 | −1.0295 | 1.5836 | −0.5701 | 1.0163 | 1.5836 |
| 0.8396 | −1.0014 | 1.5836 | −0.5413 | 0.9806 | 1.5836 |
| 0.8012 | −0.9694 | 1.5836 | −0.5091 | 0.9403 | 1.5836 |
| 0.7583 | −0.9337 | 1.5836 | −0.4738 | 0.8954 | 1.5836 |
| 0.7111 | −0.8940 | 1.5836 | −0.4353 | 0.8455 | 1.5836 |
| 0.6597 | −0.8502 | 1.5836 | −0.3952 | 0.7931 | 1.5836 |
| 0.6063 | −0.8042 | 1.5836 | −0.3536 | 0.7385 | 1.5836 |
| 0.5508 | −0.7560 | 1.5836 | −0.3103 | 0.6815 | 1.5836 |
| 0.4936 | −0.7054 | 1.5836 | −0.2653 | 0.6222 | 1.5836 |
| 0.4347 | −0.6525 | 1.5836 | −0.2185 | 0.5608 | 1.5836 |
| 0.3743 | −0.5971 | 1.5836 | −0.1698 | 0.4970 | 1.5836 |
| 0.3124 | −0.5390 | 1.5836 | −0.1194 | 0.4311 | 1.5836 |
| 0.2493 | −0.4783 | 1.5836 | −0.0670 | 0.3631 | 1.5836 |

TABLE 7-continued

| SUCTION SIDE | | | PRESSURE SIDE | | |
|---|---|---|---|---|---|
| X | Y | Z | X | Y | Z |
| 0.1873 | −0.4166 | 1.5836 | −0.0143 | 0.2952 | 1.5836 |
| 0.1265 | −0.3539 | 1.5836 | 0.0384 | 0.2275 | 1.5836 |
| 0.0673 | −0.2899 | 1.5836 | 0.0913 | 0.1597 | 1.5836 |
| 0.0101 | −0.2242 | 1.5836 | 0.1441 | 0.0920 | 1.5836 |
| −0.0450 | −0.1570 | 1.5836 | 0.1968 | 0.0242 | 1.5836 |
| −0.0987 | −0.0884 | 1.5836 | 0.2492 | −0.0439 | 1.5836 |
| −0.1511 | −0.0188 | 1.5836 | 0.3006 | −0.1126 | 1.5836 |
| −0.2022 | 0.0518 | 1.5836 | 0.3511 | −0.1823 | 1.5836 |
| −0.2521 | 0.1236 | 1.5836 | 0.4011 | −0.2521 | 1.5836 |
| −0.3006 | 0.1963 | 1.5836 | 0.4510 | −0.3220 | 1.5836 |
| −0.3479 | 0.2701 | 1.5836 | 0.5008 | −0.3920 | 1.5836 |
| −0.3923 | 0.3426 | 1.5836 | 0.5491 | −0.4596 | 1.5836 |
| −0.4339 | 0.4135 | 1.5836 | 0.5960 | −0.5246 | 1.5836 |
| −0.4729 | 0.4829 | 1.5836 | 0.6415 | −0.5872 | 1.5836 |
| −0.5091 | 0.5506 | 1.5836 | 0.6856 | −0.6471 | 1.5836 |
| −0.5425 | 0.6164 | 1.5836 | 0.7283 | −0.7047 | 1.5836 |
| −0.5733 | 0.6801 | 1.5836 | 0.7693 | −0.7598 | 1.5836 |
| −0.6016 | 0.7419 | 1.5836 | 0.8089 | −0.8124 | 1.5836 |
| −0.6273 | 0.8016 | 1.5836 | 0.8453 | −0.8604 | 1.5836 |
| −0.6491 | 0.8564 | 1.5836 | 0.8782 | −0.9037 | 1.5836 |
| −0.6676 | 0.9062 | 1.5836 | 0.9077 | −0.9424 | 1.5836 |
| −0.6832 | 0.9508 | 1.5836 | 0.9339 | −0.9765 | 1.5836 |
| −0.6971 | 0.9929 | 1.5836 | 0.9566 | −1.0060 | 1.5836 |
| −0.7078 | 1.0298 | 1.5836 | 0.9758 | −1.0310 | 1.5836 |
| −0.7141 | 1.0586 | 1.5836 | 0.9922 | −1.0523 | 1.5836 |
| −0.7164 | 1.0820 | 1.5836 | 1.0060 | −1.0702 | 1.5836 |
| −0.7155 | 1.0997 | 1.5836 | 1.0174 | −1.0849 | 1.5836 |
| −0.7121 | 1.1125 | 1.5836 | 1.0266 | −1.0967 | 1.5836 |
| −0.7084 | 1.1190 | 1.5836 | 1.0329 | −1.1062 | 1.5836 |
| −0.7051 | 1.1224 | 1.5836 | 1.0346 | −1.1147 | 1.5836 |
| −0.7032 | 1.1238 | 1.5836 | 1.0334 | −1.1219 | 1.5836 |
| −0.7022 | 1.1244 | 1.5836 | 1.0307 | −1.1271 | 1.5836 |
| 0.9918 | −1.2114 | 1.9382 | −0.6787 | 1.1058 | 1.9382 |
| 0.9883 | −1.2140 | 1.9382 | −0.6782 | 1.1060 | 1.9382 |
| 0.9828 | −1.2163 | 1.9382 | −0.6771 | 1.1065 | 1.9382 |
| 0.9755 | −1.2168 | 1.9382 | −0.6749 | 1.1072 | 1.9382 |
| 0.9673 | −1.2141 | 1.9382 | −0.6703 | 1.1076 | 1.9382 |
| 0.9582 | −1.2066 | 1.9382 | −0.6630 | 1.1066 | 1.9382 |
| 0.9467 | −1.1964 | 1.9382 | −0.6510 | 1.1016 | 1.9382 |
| 0.9323 | −1.1838 | 1.9382 | −0.6366 | 1.0919 | 1.9382 |
| 0.9149 | −1.1683 | 1.9382 | −0.6194 | 1.0767 | 1.9382 |
| 0.8942 | −1.1499 | 1.9382 | −0.5996 | 1.0557 | 1.9382 |
| 0.8699 | −1.1284 | 1.9382 | −0.5757 | 1.0270 | 1.9382 |
| 0.8413 | −1.1029 | 1.9382 | −0.5488 | 0.9933 | 1.9382 |
| 0.8084 | −1.0734 | 1.9382 | −0.5204 | 0.9571 | 1.9382 |
| 0.7711 | −1.0399 | 1.9382 | −0.4890 | 0.9158 | 1.9382 |
| 0.7296 | −1.0024 | 1.9382 | −0.4546 | 0.8697 | 1.9382 |
| 0.6838 | −0.9606 | 1.9382 | −0.4173 | 0.8186 | 1.9382 |
| 0.6339 | −0.9148 | 1.9382 | −0.3784 | 0.7651 | 1.9382 |
| 0.5820 | −0.8666 | 1.9382 | −0.3379 | 0.7091 | 1.9382 |
| 0.5284 | −0.8162 | 1.9382 | −0.2959 | 0.6507 | 1.9382 |
| 0.4730 | −0.7634 | 1.9382 | −0.2523 | 0.5900 | 1.9382 |
| 0.4160 | −0.7080 | 1.9382 | −0.2070 | 0.5268 | 1.9382 |
| 0.3575 | −0.6502 | 1.9382 | −0.1600 | 0.4614 | 1.9382 |
| 0.2977 | −0.5898 | 1.9382 | −0.1113 | 0.3936 | 1.9382 |
| 0.2369 | −0.5264 | 1.9382 | −0.0608 | 0.3237 | 1.9382 |
| 0.1771 | −0.4623 | 1.9382 | −0.0102 | 0.2538 | 1.9382 |
| 0.1184 | −0.3972 | 1.9382 | 0.0406 | 0.1840 | 1.9382 |
| 0.0613 | −0.3311 | 1.9382 | 0.0915 | 0.1143 | 1.9382 |
| 0.0061 | −0.2634 | 1.9382 | 0.1423 | 0.0445 | 1.9382 |
| −0.0470 | −0.1943 | 1.9382 | 0.1929 | −0.0254 | 1.9382 |
| −0.0988 | −0.1240 | 1.9382 | 0.2433 | −0.0955 | 1.9382 |
| −0.1492 | −0.0527 | 1.9382 | 0.2926 | −0.1664 | 1.9382 |
| −0.1984 | 0.0196 | 1.9382 | 0.3412 | −0.2378 | 1.9382 |
| −0.2463 | 0.0928 | 1.9382 | 0.3893 | −0.3095 | 1.9382 |
| −0.2931 | 0.1668 | 1.9382 | 0.4373 | −0.3812 | 1.9382 |
| −0.3387 | 0.2418 | 1.9382 | 0.4854 | −0.4529 | 1.9382 |
| −0.3814 | 0.3152 | 1.9382 | 0.5319 | −0.5222 | 1.9382 |
| −0.4215 | 0.3871 | 1.9382 | 0.5770 | −0.5890 | 1.9382 |
| −0.4590 | 0.4574 | 1.9382 | 0.6207 | −0.6533 | 1.9382 |
| −0.4938 | 0.5259 | 1.9382 | 0.6631 | −0.7149 | 1.9382 |
| −0.5261 | 0.5925 | 1.9382 | 0.7040 | −0.7741 | 1.9382 |
| −0.5558 | 0.6571 | 1.9382 | 0.7435 | −0.8308 | 1.9382 |
| −0.5832 | 0.7196 | 1.9382 | 0.7814 | −0.8850 | 1.9382 |
| −0.6080 | 0.7798 | 1.9382 | 0.8163 | −0.9345 | 1.9382 |
| −0.6292 | 0.8351 | 1.9382 | 0.8479 | −0.9790 | 1.9382 |

TABLE 7-continued

| SUCTION SIDE | | | PRESSURE SIDE | | |
|---|---|---|---|---|---|
| X | Y | Z | X | Y | Z |
| −0.6471 | 0.8854 | 1.9382 | 0.8763 | −1.0189 | 1.9382 |
| −0.6618 | 0.9305 | 1.9382 | 0.9014 | −1.0540 | 1.9382 |
| −0.6746 | 0.9730 | 1.9382 | 0.9232 | −1.0845 | 1.9382 |
| −0.6848 | 1.0102 | 1.9382 | 0.9416 | −1.1101 | 1.9382 |
| −0.6905 | 1.0392 | 1.9382 | 0.9574 | −1.1321 | 1.9382 |
| −0.6928 | 1.0628 | 1.9382 | 0.9708 | −1.1506 | 1.9382 |
| −0.6921 | 1.0806 | 1.9382 | 0.9816 | −1.1657 | 1.9382 |
| −0.6889 | 1.0935 | 1.9382 | 0.9904 | −1.1779 | 1.9382 |
| −0.6854 | 1.1000 | 1.9382 | 0.9968 | −1.1875 | 1.9382 |
| −0.6822 | 1.1035 | 1.9382 | 0.9986 | −1.1959 | 1.9382 |
| −0.6803 | 1.1049 | 1.9382 | 0.9973 | −1.2031 | 1.9382 |
| −0.6793 | 1.1055 | 1.9382 | 0.9947 | −1.2082 | 1.9382 |
| 0.9677 | −1.2736 | 2.2928 | −0.6633 | 1.0847 | 2.2928 |
| 0.9641 | −1.2762 | 2.2928 | −0.6627 | 1.0849 | 2.2928 |
| 0.9587 | −1.2782 | 2.2928 | −0.6617 | 1.0854 | 2.2928 |
| 0.9513 | −1.2784 | 2.2928 | −0.6594 | 1.0860 | 2.2928 |
| 0.9432 | −1.2752 | 2.2928 | −0.6547 | 1.0863 | 2.2928 |
| 0.9343 | −1.2674 | 2.2928 | −0.6476 | 1.0849 | 2.2928 |
| 0.9230 | −1.2570 | 2.2928 | −0.6357 | 1.0794 | 2.2928 |
| 0.9088 | −1.2440 | 2.2928 | −0.6216 | 1.0693 | 2.2928 |
| 0.8917 | −1.2281 | 2.2928 | −0.6046 | 1.0536 | 2.2928 |
| 0.8713 | −1.2093 | 2.2928 | −0.5852 | 1.0322 | 2.2928 |
| 0.8474 | −1.1872 | 2.2928 | −0.5615 | 1.0030 | 2.2928 |
| 0.8193 | −1.1610 | 2.2928 | −0.5351 | 0.9688 | 2.2928 |
| 0.7870 | −1.1307 | 2.2928 | −0.5073 | 0.9319 | 2.2928 |
| 0.7504 | −1.0963 | 2.2928 | −0.4767 | 0.8899 | 2.2928 |
| 0.7095 | −1.0577 | 2.2928 | −0.4433 | 0.8428 | 2.2928 |
| 0.6646 | −1.0148 | 2.2928 | −0.4068 | 0.7908 | 2.2928 |
| 0.6157 | −0.9677 | 2.2928 | −0.3690 | 0.7362 | 2.2928 |
| 0.5648 | −0.9183 | 2.2928 | −0.3296 | 0.6792 | 2.2928 |
| 0.5122 | −0.8664 | 2.2928 | −0.2888 | 0.6197 | 2.2928 |
| 0.4579 | −0.8122 | 2.2928 | −0.2463 | 0.5577 | 2.2928 |
| 0.4021 | −0.7554 | 2.2928 | −0.2023 | 0.4934 | 2.2928 |
| 0.3447 | −0.6960 | 2.2928 | −0.1566 | 0.4267 | 2.2928 |
| 0.2863 | −0.6340 | 2.2928 | −0.1093 | 0.3576 | 2.2928 |
| 0.2269 | −0.5690 | 2.2928 | −0.0603 | 0.2861 | 2.2928 |
| 0.1684 | −0.5034 | 2.2928 | −0.0112 | 0.2148 | 2.2928 |
| 0.1111 | −0.4368 | 2.2928 | 0.0382 | 0.1437 | 2.2928 |
| 0.0554 | −0.3691 | 2.2928 | 0.0877 | 0.0725 | 2.2928 |
| 0.0015 | −0.3001 | 2.2928 | 0.1371 | 0.0014 | 2.2928 |
| −0.0505 | −0.2297 | 2.2928 | 0.1864 | −0.0698 | 2.2928 |
| −0.1010 | −0.1582 | 2.2928 | 0.2353 | −0.1413 | 2.2928 |
| −0.1502 | −0.0858 | 2.2928 | 0.2835 | −0.2133 | 2.2928 |
| −0.1981 | −0.0123 | 2.2928 | 0.3308 | −0.2858 | 2.2928 |
| −0.2447 | 0.0619 | 2.2928 | 0.3778 | −0.3586 | 2.2928 |
| −0.2902 | 0.1371 | 2.2928 | 0.4249 | −0.4314 | 2.2928 |
| −0.3345 | 0.2131 | 2.2928 | 0.4720 | −0.5042 | 2.2928 |
| −0.3761 | 0.2875 | 2.2928 | 0.5174 | −0.5745 | 2.2928 |
| −0.4150 | 0.3603 | 2.2928 | 0.5615 | −0.6423 | 2.2928 |
| −0.4514 | 0.4312 | 2.2928 | 0.6043 | −0.7076 | 2.2928 |
| −0.4852 | 0.5004 | 2.2928 | 0.6456 | −0.7702 | 2.2928 |
| −0.5166 | 0.5678 | 2.2928 | 0.6856 | −0.8303 | 2.2928 |
| −0.5454 | 0.6329 | 2.2928 | 0.7242 | −0.8879 | 2.2928 |
| −0.5718 | 0.6960 | 2.2928 | 0.7614 | −0.9430 | 2.2928 |
| −0.5959 | 0.7567 | 2.2928 | 0.7955 | −0.9931 | 2.2928 |
| −0.6166 | 0.8124 | 2.2928 | 0.8264 | −1.0384 | 2.2928 |
| −0.6340 | 0.8630 | 2.2978 | 0.8542 | −1.0789 | 2.2978 |
| −0.6480 | 0.9084 | 2.2928 | 0.8788 | −1.1145 | 2.2928 |
| −0.6603 | 0.9513 | 2.2928 | 0.9003 | −1.1454 | 2.2928 |
| −0.6697 | 0.9887 | 2.2928 | 0.9184 | −1.1715 | 2.2928 |
| −0.6751 | 1.0180 | 2.2928 | 0.9339 | −1.1938 | 2.2928 |
| −0.6773 | 1.0416 | 2.2928 | 0.9469 | −1.2124 | 2.2928 |
| −0.6765 | 1.0594 | 2.2928 | 0.9577 | −1.2278 | 2.2928 |
| −0.6734 | 1.0723 | 2.2928 | 0.9663 | −1.2401 | 2.2928 |
| −0.6700 | 1.0790 | 2.2928 | 0.9727 | −1.2498 | 2.2928 |
| −0.6668 | 1.0825 | 2.2928 | 0.9746 | −1.2582 | 2.2928 |
| −0.6649 | 1.0839 | 2.2928 | 0.9733 | −1.2653 | 2.2928 |
| −0.6639 | 1.0845 | 2.2928 | 0.9707 | −1.2704 | 2.2928 |
| 0.9557 | −1.3206 | 2.6474 | −0.6530 | 1.0568 | 2.6474 |
| 0.9520 | −1.3231 | 2.6474 | −0.6524 | 1.0570 | 2.6474 |
| 0.9466 | −1.3251 | 2.6474 | −0.6514 | 1.0575 | 2.6474 |
| 0.9392 | −1.3251 | 2.6474 | −0.6491 | 1.0581 | 2.6474 |
| 0.9311 | −1.3214 | 2.6474 | −0.6444 | 1.0584 | 2.6474 |
| 0.9224 | −1.3134 | 2.6474 | −0.6372 | 1.0568 | 2.6474 |
| 0.9112 | −1.3029 | 2.6474 | −0.6254 | 1.0513 | 2.6474 |
| 0.8972 | −1.2898 | 2.6474 | −0.6113 | 1.0411 | 2.6474 |

TABLE 7-continued

| SUCTION SIDE | | | PRESSURE SIDE | | |
|---|---|---|---|---|---|
| X | Y | Z | X | Y | Z |
| 0.8802 | −1.2738 | 2.6474 | −0.5943 | 1.0252 | 2.6474 |
| 0.8599 | −1.2548 | 2.6474 | −0.5750 | 1.0037 | 2.6474 |
| 0.8363 | −1.2324 | 2.6474 | −0.5516 | 0.9744 | 2.6474 |
| 0.8084 | −1.2060 | 2.6474 | −0.5256 | 0.9397 | 2.6474 |
| 0.7762 | −1.1753 | 2.6474 | −0.4982 | 0.9024 | 2.6474 |
| 0.7399 | −1.1406 | 2.6474 | −0.4682 | 0.8600 | 2.6474 |
| 0.6995 | −1.1016 | 2.6474 | −0.4352 | 0.8124 | 2.6474 |
| 0.6551 | −1.0583 | 2.6474 | −0.3993 | 0.7600 | 2.6474 |
| 0.6065 | −1.0107 | 2.6474 | −0.3621 | 0.7049 | 2.6474 |
| 0.5562 | −0.9606 | 2.6474 | −0.3234 | 0.6473 | 2.6474 |
| 0.5041 | −0.9082 | 2.6474 | −0.2832 | 0.5872 | 2.6474 |
| 0.4504 | −0.8533 | 2.6474 | −0.2416 | 0.5247 | 2.6474 |
| 0.3952 | −0.7959 | 2.6474 | −0.1983 | 0.4598 | 2.6474 |
| 0.3386 | −0.7359 | 2.6474 | −0.1535 | 0.3923 | 2.6474 |
| 0.2807 | −0.6731 | 2.6474 | −0.1071 | 0.3226 | 2.6474 |
| 0.2219 | −0.6076 | 2.6474 | −0.0589 | 0.2504 | 2.6474 |
| 0.1641 | −0.5413 | 2.6474 | −0.0106 | 0.1785 | 2.6474 |
| 0.1075 | −0.4740 | 2.6474 | 0.0379 | 0.1066 | 2.6474 |
| 0.0525 | −0.4057 | 2.6474 | 0.0865 | 0.0348 | 2.6474 |
| −0.0007 | −0.3359 | 2.6474 | 0.1352 | −0.0371 | 2.6474 |
| −0.0520 | −0.2649 | 2.6474 | 0.1836 | −0.1090 | 2.6474 |
| −0.1019 | −0.1928 | 2.6474 | 0.2317 | −0.1811 | 2.6474 |
| −0.1504 | −0.1196 | 2.6474 | 0.2791 | −0.2538 | 2.6474 |
| −0.1976 | −0.0456 | 2.6474 | 0.3258 | −0.3268 | 2.6474 |
| −0.2435 | 0.0293 | 2.6474 | 0.3721 | −0.4002 | 2.6474 |
| −0.2884 | 0.1051 | 2.6474 | 0.4183 | −0.4736 | 2.6474 |
| −0.3320 | 0.1817 | 2.6474 | 0.4646 | −0.5470 | 2.6474 |
| −0.3730 | 0.2566 | 2.6474 | 0.5094 | −0.6178 | 2.6474 |
| −0.4113 | 0.3299 | 2.6474 | 0.5529 | −0.6860 | 2.6474 |
| −0.4471 | 0.4014 | 2.6474 | 0.5951 | −0.7517 | 2.6474 |
| −0.4804 | 0.4711 | 2.6474 | 0.6360 | −0.8148 | 2.6474 |
| −0.5111 | 0.5386 | 2.6474 | 0.6756 | −0.8752 | 2.6474 |
| −0.5394 | 0.6041 | 2.6474 | 0.7137 | −0.9332 | 2.6474 |
| −0.5652 | 0.6674 | 2.6474 | 0.7506 | −0.9886 | 2.6474 |
| −0.5888 | 0.7284 | 2.6474 | 0.7844 | −1.0390 | 2.6474 |
| −0.6089 | 0.7843 | 2.6474 | 0.8151 | −1.0845 | 2.6474 |
| −0.6258 | 0.8350 | 2.6474 | 0.8426 | −1.1252 | 2.6474 |
| −0.6396 | 0.8804 | 2.6474 | 0.8670 | −1.1611 | 2.6474 |
| −0.6517 | 0.9233 | 2.6474 | 0.8883 | −1.1921 | 2.6474 |
| −0.6606 | 0.9609 | 2.6474 | 0.9063 | −1.2183 | 2.6474 |
| −0.6657 | 0.9902 | 2.6474 | 0.9217 | −1.2407 | 2.6474 |
| −0.6675 | 1.0139 | 2.6474 | 0.9346 | −1.2595 | 2.6474 |
| −0.6665 | 1.0316 | 2.6474 | 0.9453 | −1.2749 | 2.6474 |
| −0.6633 | 1.0446 | 2.6474 | 0.9538 | −1.2873 | 2.6474 |
| −0.6598 | 1.0511 | 2.6474 | 0.9603 | −1.2970 | 2.6474 |
| −0.6565 | 1.0546 | 2.6474 | 0.9624 | −1.3053 | 2.6474 |
| −0.6546 | 1.0560 | 2.6474 | 0.9613 | −1.3123 | 2.6474 |
| −0.6535 | 1.0566 | 2.6474 | 0.9587 | −1.3174 | 2.6474 |
| 0.9554 | −1.3953 | 3.3565 | −0.6502 | 0.9928 | 3.3565 |
| 0.9519 | −1.3979 | 3.3565 | −0.6497 | 0.9930 | 3.3565 |
| 0.9462 | −1.3997 | 3.3565 | −0.6485 | 0.9935 | 3.3565 |
| 0.9389 | −1.3993 | 3.3565 | −0.6463 | 0.9939 | 3.3565 |
| 0.9311 | −1.3951 | 3.3565 | −0.6415 | 0.9941 | 3.3565 |
| 0.9224 | −1.3871 | 3.3565 | −0.6344 | 0.9925 | 3.3565 |
| 0.9112 | −1.3766 | 3.3565 | −0.6226 | 0.9866 | 3.3565 |
| 0.8972 | −1.3635 | 3.3565 | −0.6087 | 0.9761 | 3.3565 |
| 0.8802 | −1.3475 | 3.3565 | −0.5920 | 0.9600 | 3.3565 |
| 0.8599 | −1.3284 | 3.3565 | −0.5728 | 0.9382 | 3.3565 |
| 0.8363 | −1.3061 | 3.3565 | −0.5496 | 0.9085 | 3.3565 |
| 0.8084 | −1.2796 | 3.3565 | −0.5240 | 0.8735 | 3.3565 |
| 0.7763 | −1.2489 | 3.3565 | −0.4973 | 0.8357 | 3.3565 |
| 0.7403 | −1.2138 | 3.3565 | −0.4677 | 0.7927 | 3.3565 |
| 0.7002 | −1.1745 | 3.3565 | −0.4354 | 0.7446 | 3.3565 |
| 0.6559 | −1.1309 | 3.3565 | −0.4001 | 0.6916 | 3.3565 |
| 0.6078 | −1.0828 | 3.3565 | −0.3635 | 0.6360 | 3.3565 |
| 0.5578 | −1.0324 | 3.3565 | −0.3254 | 0.5778 | 3.3565 |
| 0.5061 | −0.9797 | 3.3565 | −0.2858 | 0.5172 | 3.3565 |
| 0.4528 | −0.9243 | 3.3565 | −0.2448 | 0.4540 | 3.3565 |
| 0.3979 | −0.8666 | 3.3565 | −0.2021 | 0.3884 | 3.3565 |
| 0.3415 | −0.8062 | 3.3565 | −0.1579 | 0.3205 | 3.3565 |
| 0.2840 | −0.7431 | 3.3565 | −0.1119 | 0.2502 | 3.3565 |
| 0.2255 | −0.6772 | 3.3565 | −0.0642 | 0.1775 | 3.3565 |
| 0.1678 | −0.6106 | 3.3565 | −0.0163 | 0.1051 | 3.3565 |
| 0.1114 | −0.5430 | 3.3565 | 0.0319 | 0.0327 | 3.3565 |
| 0.0572 | −0.4738 | 3.3565 | 0.0801 | −0.0395 | 3.3565 |
| 0.0047 | −0.4033 | 3.3565 | 0.1285 | −0.1117 | 3.3565 |

TABLE 7-continued

| SUCTION SIDE | | | PRESSURE SIDE | | |
|---|---|---|---|---|---|
| X | Y | Z | X | Y | Z |
| −0.0462 | −0.3316 | 3.3565 | 0.1770 | −0.1839 | 3.3565 |
| −0.0957 | −0.2590 | 3.3565 | 0.2252 | −0.2561 | 3.3565 |
| −0.1440 | −0.1854 | 3.3565 | 0.2731 | −0.3286 | 3.3565 |
| −0.1910 | −0.1108 | 3.3565 | 0.3203 | −0.4016 | 3.3565 |
| −0.2369 | −0.0356 | 3.3565 | 0.3666 | −0.4751 | 3.3565 |
| −0.2817 | 0.0407 | 3.3565 | 0.4127 | −0.5488 | 3.3565 |
| −0.3252 | 0.1178 | 3.3565 | 0.4592 | −0.6221 | 3.3565 |
| −0.3661 | 0.1931 | 3.3565 | 0.5042 | −0.6931 | 3.3565 |
| −0.4045 | 0.2667 | 3.3565 | 0.5479 | −0.7614 | 3.3565 |
| −0.4404 | 0.3385 | 3.3565 | 0.5904 | −0.8271 | 3.3565 |
| −0.4737 | 0.4081 | 3.3565 | 0.6316 | −0.8902 | 3.3565 |
| −0.5045 | 0.4755 | 3.3565 | 0.6714 | −0.9506 | 3.3565 |
| −0.5330 | 0.5409 | 3.3565 | 0.7100 | −1.0084 | 3.3565 |
| −0.5591 | 0.6040 | 3.3565 | 0.7472 | −1.0637 | 3.3565 |
| −0.5829 | 0.6648 | 3.3565 | 0.7813 | −1.1141 | 3.3565 |
| −0.6034 | 0.7205 | 3.3565 | 0.8124 | −1.1595 | 3.3565 |
| −0.6207 | 0.7711 | 3.3565 | 0.8404 | −1.2000 | 3.3565 |
| −0.6351 | 0.8164 | 3.3565 | 0.8649 | −1.2358 | 3.3565 |
| −0.6474 | 0.8592 | 3.3565 | 0.8863 | −1.2669 | 3.3565 |
| −0.6566 | 0.8966 | 3.3565 | 0.9044 | −1.2931 | 3.3565 |
| −0.6618 | 0.9258 | 3.3565 | 0.9199 | −1.3155 | 3.3565 |
| −0.6638 | 0.9496 | 3.3565 | 0.9329 | −1.3342 | 3.3565 |
| −0.6631 | 0.9674 | 3.3565 | 0.9437 | −1.3498 | 3.3565 |
| −0.6602 | 0.9803 | 3.3565 | 0.9523 | −1.3620 | 3.3565 |
| −0.6569 | 0.9869 | 3.3565 | 0.9589 | −1.3716 | 3.3565 |
| −0.6537 | 0.9905 | 3.3565 | 0.9617 | −1.3797 | 3.3565 |
| −0.6518 | 0.9920 | 3.3565 | 0.9609 | −1.3869 | 3.3565 |
| −0.6507 | 0.9925 | 3.3565 | 0.9584 | −1.3921 | 3.3565 |
| 0.9597 | −1.4269 | 3.7110 | −0.6570 | 0.9709 | 3.7110 |
| 0.9560 | −1.4294 | 3.7110 | −0.6564 | 0.9711 | 3.7110 |
| 0.9504 | −1.4312 | 3.7110 | −0.6553 | 0.9715 | 3.7110 |
| 0.9431 | −1.4306 | 3.7110 | −0.6530 | 0.9720 | 3.7110 |
| 0.9354 | −1.4262 | 3.7110 | −0.6483 | 0.9720 | 3.7110 |
| 0.9268 | −1.4180 | 3.7110 | −0.6412 | 0.9701 | 3.7110 |
| 0.9155 | −1.4074 | 3.7110 | −0.6296 | 0.9638 | 3.7110 |
| 0.9015 | −1.3942 | 3.7110 | −0.6159 | 0.9528 | 3.7110 |
| 0.8845 | −1.3780 | 3.7110 | −0.5994 | 0.9362 | 3.7110 |
| 0.8644 | −1.3588 | 3.7110 | −0.5805 | 0.9141 | 3.7110 |
| 0.8407 | −1.3362 | 3.7110 | −0.5576 | 0.8840 | 3.7110 |
| 0.8129 | −1.3096 | 3.7110 | −0.5324 | 0.8485 | 3.7110 |
| 0.7809 | −1.2786 | 3.7110 | −0.5060 | 0.8102 | 3.7110 |
| 0.7448 | −1.2434 | 3.7110 | −0.4768 | 0.7667 | 3.7110 |
| 0.7047 | −1.2038 | 3.7110 | −0.4447 | 0.7181 | 3.7110 |
| 0.6605 | −1.1599 | 3.7110 | −0.4098 | 0.6645 | 3.7110 |
| 0.6124 | −1.1115 | 3.7110 | −0.3734 | 0.6084 | 3.7110 |
| 0.5626 | −1.0608 | 3.7110 | −0.3355 | 0.5498 | 3.7110 |
| 0.5109 | −1.0076 | 3.7110 | −0.2961 | 0.4886 | 3.7110 |
| 0.4577 | −0.9519 | 3.7110 | −0.2552 | 0.4250 | 3.7110 |
| 0.4029 | −0.8938 | 3.7110 | −0.2125 | 0.3590 | 3.7110 |
| 0.3467 | −0.8329 | 3.7110 | −0.1683 | 0.2906 | 3.7110 |
| 0.2893 | −0.7693 | 3.7110 | −0.1223 | 0.2200 | 3.7110 |
| 0.2310 | −0.7028 | 3.7110 | −0.0744 | 0.1470 | 3.7110 |
| 0.1736 | −0.6357 | 3.7110 | −0.0264 | 0.0742 | 3.7110 |
| 0.1175 | −0.5674 | 3.7110 | 0.0219 | 0.0015 | 3.7110 |
| 0.0635 | −0.4976 | 3.7110 | 0.0706 | −0.0710 | 3.7110 |
| 0.0112 | −0.4266 | 3.7110 | 0.1193 | −0.1435 | 3.7110 |
| −0.0398 | −0.3545 | 3.7110 | 0.1681 | −0.2158 | 3.7110 |
| −0.0895 | −0.2815 | 3.7110 | 0.2169 | −0.2882 | 3.7110 |
| −0.1379 | −0.2075 | 3.7110 | 0.2655 | −0.3606 | 3.7110 |
| −0.1852 | −0.1328 | 3.7110 | 0.3135 | −0.4335 | 3.7110 |
| −0.2314 | −0.0571 | 3.7110 | 0.3607 | −0.5069 | 3.7110 |
| −0.2766 | 0.0193 | 3.7110 | 0.4078 | −0.5804 | 3.7110 |
| −0.3205 | 0.0966 | 3.7110 | 0.4549 | −0.6538 | 3.7110 |
| −0.3620 | 0.1720 | 3.7110 | 0.5007 | −0.7247 | 3.7110 |
| −0.4008 | 0.2457 | 3.7110 | 0.5451 | −0.7930 | 3.7110 |
| −0.4371 | 0.3174 | 3.7110 | 0.5882 | −0.8587 | 3.7110 |
| −0.4709 | 0.3869 | 3.7110 | 0.6300 | −0.9218 | 3.7110 |
| −0.5024 | 0.4543 | 3.7110 | 0.6704 | −0.9822 | 3.7110 |
| −0.5314 | 0.5195 | 3.7110 | 0.7095 | −1.0400 | 3.7110 |
| −0.5582 | 0.5824 | 3.7110 | 0.7473 | −1.0953 | 3.7110 |
| −0.5828 | 0.6431 | 3.7110 | 0.7819 | −1.1456 | 3.7110 |
| −0.6042 | 0.6987 | 3.7110 | 0.8134 | −1.1910 | 3.7110 |
| −0.6223 | 0.7491 | 3.7110 | 0.8417 | −1.2316 | 3.7110 |
| −0.6374 | 0.7942 | 3.7110 | 0.8666 | −1.2674 | 3.7110 |
| −0.6505 | 0.8368 | 3.7110 | 0.8883 | −1.2984 | 3.7110 |
| −0.6605 | 0.8742 | 3.7110 | 0.9067 | −1.3246 | 3.7110 |

TABLE 7-continued

| SUCTION SIDE | | | PRESSURE SIDE | | |
|---|---|---|---|---|---|
| X | Y | Z | X | Y | Z |
| −0.6663 | 0.9034 | 3.7110 | 0.9225 | −1.3469 | 3.7110 |
| −0.6690 | 0.9271 | 3.7110 | 0.9359 | −1.3656 | 3.7110 |
| −0.6689 | 0.9449 | 3.7110 | 0.9467 | −1.3811 | 3.7110 |
| −0.6664 | 0.9581 | 3.7110 | 0.9555 | −1.3934 | 3.7110 |
| −0.6635 | 0.9648 | 3.7110 | 0.9623 | −1.4029 | 3.7110 |
| −0.6605 | 0.9685 | 3.7110 | 0.9656 | −1.4109 | 3.7110 |
| −0.6586 | 0.9700 | 3.7110 | 0.9651 | −1.4182 | 3.7110 |
| −0.6575 | 0.9706 | 3.7110 | 0.9626 | −1.4235 | 3.7110 |
| 0.9609 | −1.4536 | 4.0656 | −0.6655 | 0.9576 | 4.0656 |
| 0.9572 | −1.4562 | 4.0656 | −0.6650 | 0.9579 | 4.0656 |
| 0.9516 | −1.4579 | 4.0656 | −0.6639 | 0.9583 | 4.0656 |
| 0.9441 | −1.4571 | 4.0656 | −0.6615 | 0.9587 | 4.0656 |
| 0.9367 | −1.4522 | 4.0656 | −0.6568 | 0.9584 | 4.0656 |
| 0.9281 | −1.4440 | 4.0656 | −0.6498 | 0.9560 | 4.0656 |
| 0.9170 | −1.4333 | 4.0656 | −0.6385 | 0.9489 | 4.0656 |
| 0.9030 | −1.4197 | 4.0656 | −0.6253 | 0.9374 | 4.0656 |
| 0.8862 | −1.4034 | 4.0656 | −0.6093 | 0.9201 | 4.0656 |
| 0.8662 | −1.3839 | 4.0656 | −0.5910 | 0.8973 | 4.0656 |
| 0.8427 | −1.3610 | 4.0656 | −0.5689 | 0.8664 | 4.0656 |
| 0.8151 | −1.3340 | 4.0656 | −0.5444 | 0.8300 | 4.0656 |
| 0.7833 | −1.3027 | 4.0656 | −0.5187 | 0.7910 | 4.0656 |
| 0.7474 | −1.2670 | 4.0656 | −0.4901 | 0.7467 | 4.0656 |
| 0.7074 | −1.2271 | 4.0656 | −0.4587 | 0.6974 | 4.0656 |
| 0.6634 | −1.1826 | 4.0656 | −0.4243 | 0.6430 | 4.0656 |
| 0.6155 | −1.1337 | 4.0656 | −0.3883 | 0.5862 | 4.0656 |
| 0.5658 | −1.0825 | 4.0656 | −0.3509 | 0.5268 | 4.0656 |
| 0.5145 | −1.0287 | 4.0656 | −0.3118 | 0.4650 | 4.0656 |
| 0.4616 | −0.9724 | 4.0656 | −0.2711 | 0.4008 | 4.0656 |
| 0.4072 | −0.9135 | 4.0656 | −0.2288 | 0.3342 | 4.0656 |
| 0.3515 | −0.8520 | 4.0656 | −0.1847 | 0.2651 | 4.0656 |
| 0.2945 | −0.7876 | 4.0656 | −0.1388 | 0.1938 | 4.0656 |
| 0.2366 | −0.7203 | 4.0656 | −0.0910 | 0.1203 | 4.0656 |
| 0.1799 | −0.6521 | 4.0656 | −0.0429 | 0.0469 | 4.0656 |
| 0.1246 | −0.5828 | 4.0656 | 0.0056 | −0.0262 | 4.0656 |
| 0.0709 | −0.5123 | 4.0656 | 0.0542 | −0.0991 | 4.0656 |
| 0.0188 | −0.4406 | 4.0656 | 0.1032 | −0.1719 | 4.0656 |
| −0.0320 | −0.3681 | 4.0656 | 0.1524 | −0.2446 | 4.0656 |
| −0.0817 | −0.2946 | 4.0656 | 0.2016 | −0.3172 | 4.0656 |
| −0.1303 | −0.2203 | 4.0656 | 0.2509 | −0.3898 | 4.0656 |
| −0.1778 | −0.1452 | 4.0656 | 0.2999 | −0.4626 | 4.0656 |
| −0.2243 | −0.0693 | 4.0656 | 0.3483 | −0.5357 | 4.0656 |
| −0.2697 | 0.0074 | 4.0656 | 0.3966 | −0.6090 | 4.0656 |
| −0.3141 | 0.0848 | 4.0656 | 0.4448 | −0.6823 | 4.0656 |
| −0.3559 | 0.1605 | 4.0656 | 0.4915 | −0.7530 | 4.0656 |
| −0.3952 | 0.2341 | 4.0656 | 0.5368 | −0.8212 | 4.0656 |
| −0.4321 | 0.3057 | 4.0656 | 0.5808 | −0.8868 | 4.0656 |
| −0.4666 | 0.3751 | 4.0656 | 0.6235 | −0.9498 | 4.0656 |
| −0.4986 | 0.4424 | 4.0656 | 0.6647 | −1.0102 | 4.0656 |
| −0.5284 | 0.5074 | 4.0656 | 0.7045 | −1.0680 | 4.0656 |
| −0.5560 | 0.5702 | 4.0656 | 0.7429 | −1.1231 | 4.0656 |
| −0.5816 | 0.6307 | 4.0656 | 0.7783 | −1.1734 | 4.0656 |
| −0.6038 | 0.6860 | 4.0656 | 0.8104 | −1.2188 | 4.0656 |
| −0.6230 | 0.7361 | 4.0656 | 0.8392 | −1.2592 | 4.0656 |
| −0.6392 | 0.7809 | 4.0656 | 0.8647 | −1.2949 | 4.0656 |
| −0.6535 | 0.8233 | 4.0656 | 0.8871 | −1.3257 | 4.0656 |
| −0.6645 | 0.8605 | 4.0656 | 0.9059 | −1.3517 | 4.0656 |
| −0.6714 | 0.8895 | 4.0656 | 0.9221 | −1.3740 | 4.0656 |
| −0.6750 | 0.9132 | 4.0656 | 0.9358 | −1.3926 | 4.0656 |
| −0.6758 | 0.9310 | 4.0656 | 0.9469 | −1.4080 | 4.0656 |
| −0.6742 | 0.9443 | 4.0656 | 0.9559 | −1.4202 | 4.0656 |
| −0.6716 | 0.9513 | 4.0656 | 0.9629 | −1.4297 | 4.0656 |
| −0.6689 | 0.9552 | 4.0656 | 0.9665 | −1.4376 | 4.0656 |
| −0.6671 | 0.9568 | 4.0656 | 0.9662 | −1.4449 | 4.0656 |
| −0.6660 | 0.9573 | 4.0656 | 0.9639 | −1.4503 | 4.0656 |
| 0.9584 | −1.4747 | 4.4202 | −0.6733 | 0.9562 | 4.4202 |
| 0.9546 | −1.4772 | 4.4202 | −0.6727 | 0.9564 | 4.4202 |
| 0.9488 | −1.4788 | 4.4202 | −0.6716 | 0.9568 | 4.4202 |
| 0.9414 | −1.4777 | 4.4202 | −0.6692 | 0.9571 | 4.4202 |
| 0.9342 | −1.4725 | 4.4202 | −0.6645 | 0.9564 | 4.4202 |
| 0.9257 | −1.4642 | 4.4202 | −0.6577 | 0.9533 | 4.4202 |
| 0.9146 | −1.4532 | 4.4202 | −0.6470 | 0.9454 | 4.4202 |
| 0.9008 | −1.4396 | 4.4202 | −0.6343 | 0.9329 | 4.4202 |
| 0.8840 | −1.4230 | 4.4202 | −0.6191 | 0.9150 | 4.4202 |
| 0.8642 | −1.4031 | 4.4202 | −0.6016 | 0.8913 | 4.4202 |
| 0.8409 | −1.3799 | 4.4202 | −0.5804 | 0.8596 | 4.4202 |
| 0.8136 | −1.3523 | 4.4202 | −0.5567 | 0.8224 | 4.4202 |

TABLE 7-continued

| SUCTION SIDE | | | PRESSURE SIDE | | |
|---|---|---|---|---|---|
| X | Y | Z | X | Y | Z |
| 0.7820 | −1.3205 | 4.4202 | −0.5318 | 0.7825 | 4.4202 |
| 0.7463 | −1.2844 | 4.4202 | −0.5039 | 0.7373 | 4.4202 |
| 0.7066 | −1.2438 | 4.4202 | −0.4732 | 0.6872 | 4.4202 |
| 0.6629 | −1.1988 | 4.4202 | −0.4393 | 0.6320 | 4.4202 |
| 0.6154 | −1.1491 | 4.4202 | −0.4040 | 0.5743 | 4.4202 |
| 0.5662 | −1.0971 | 4.4202 | −0.3672 | 0.5140 | 4.4202 |
| 0.5153 | −1.0425 | 4.4202 | −0.3286 | 0.4514 | 4.4202 |
| 0.4629 | −0.9853 | 4.4202 | −0.2883 | 0.3864 | 4.4202 |
| 0.4091 | −0.9255 | 4.4202 | −0.2463 | 0.3189 | 4.4202 |
| 0.3540 | −0.8629 | 4.4202 | −0.2025 | 0.2491 | 4.4202 |
| 0.2979 | −0.7974 | 4.4202 | −0.1568 | 0.1771 | 4.4202 |
| 0.2408 | −0.7289 | 4.4202 | −0.1091 | 0.1028 | 4.4202 |
| 0.1850 | −0.6595 | 4.4202 | −0.0610 | 0.0288 | 4.4202 |
| 0.1305 | −0.5891 | 4.4202 | −0.0125 | −0.0449 | 4.4202 |
| 0.0775 | −0.5176 | 4.4202 | 0.0363 | −0.1184 | 4.4202 |
| 0.0257 | −0.4451 | 4.4202 | 0.0855 | −0.1917 | 4.4202 |
| −0.0250 | −0.3718 | 4.4202 | 0.1350 | −0.2647 | 4.4202 |
| −0.0745 | −0.2977 | 4.4202 | 0.1848 | −0.3377 | 4.4202 |
| −0.1231 | −0.2229 | 4.4202 | 0.2347 | −0.4105 | 4.4202 |
| −0.1708 | −0.1474 | 4.4202 | 0.2845 | −0.4833 | 4.4202 |
| −0.2174 | −0.0710 | 4.4202 | 0.3341 | −0.5564 | 4.4202 |
| −0.2630 | 0.0061 | 4.4202 | 0.3834 | −0.6295 | 4.4202 |
| −0.3077 | 0.0839 | 4.4202 | 0.4328 | −0.7027 | 4.4202 |
| −0.3498 | 0.1597 | 4.4202 | 0.4805 | −0.7735 | 4.4202 |
| −0.3895 | 0.2333 | 4.4202 | 0.5267 | −0.8417 | 4.4202 |
| −0.4267 | 0.3050 | 4.4202 | 0.5715 | −0.9073 | 4.4202 |
| −0.4616 | 0.3744 | 4.4202 | 0.6148 | −0.9704 | 4.4202 |
| −0.4944 | 0.4417 | 4.4202 | 0.6567 | −1.0308 | 4.4202 |
| −0.5248 | 0.5067 | 4.4202 | 0.6971 | −1.0887 | 4.4202 |
| −0.5532 | 0.5694 | 4.4202 | 0.7361 | −1.1440 | 4.4202 |
| −0.5794 | 0.6297 | 4.4202 | 0.7720 | −1.1944 | 4.4202 |
| −0.6026 | 0.6849 | 4.4202 | 0.8045 | −1.2398 | 4.4202 |
| −0.6226 | 0.7349 | 4.4202 | 0.8338 | −1.2804 | 4.4202 |
| −0.6398 | 0.7795 | 4.4202 | 0.8598 | −1.3161 | 4.4202 |
| −0.6552 | 0.8217 | 4.4202 | 0.8824 | −1.3469 | 4.4202 |
| −0.6674 | 0.8586 | 4.4202 | 0.9016 | −1.3729 | 4.4202 |
| −0.6751 | 0.8874 | 4.4202 | 0.9181 | −1.3951 | 4.4202 |
| −0.6797 | 0.9110 | 4.4202 | 0.9321 | −1.4138 | 4.4202 |
| −0.6814 | 0.9288 | 4.4202 | 0.9435 | −1.4291 | 4.4202 |
| −0.6809 | 0.9422 | 4.4202 | 0.9528 | −1.4413 | 4.4202 |
| −0.6790 | 0.9495 | 4.4202 | 0.9599 | −1.4507 | 4.4202 |
| −0.6765 | 0.9536 | 4.4202 | 0.9638 | −1.4585 | 4.4202 |
| −0.6748 | 0.9553 | 4.4202 | 0.9637 | −1.4659 | 4.4202 |
| −0.6738 | 0.9559 | 4.4202 | 0.9613 | −1.4714 | 4.4202 |
| 0.9529 | −1.4848 | 4.5974 | −0.6740 | 0.9611 | 4.5974 |
| 0.9492 | −1.4873 | 4.5974 | −0.6735 | 0.9613 | 4.5974 |
| 0.9434 | −1.4888 | 4.5974 | −0.6723 | 0.9617 | 4.5974 |
| 0.9362 | −1.4878 | 4.5974 | −0.6699 | 0.9620 | 4.5974 |
| 0.9291 | −1.4826 | 4.5974 | −0.6652 | 0.9609 | 4.5974 |
| 0.9205 | −1.4742 | 4.5974 | −0.6586 | 0.9576 | 4.5974 |
| 0.9096 | −1.4632 | 4.5974 | −0.6482 | 0.9493 | 4.5974 |
| 0.8958 | −1.4494 | 4.5974 | −0.6358 | 0.9365 | 4.5974 |
| 0.8791 | −1.4327 | 4.5974 | −0.6208 | 0.9182 | 4.5974 |
| 0.8593 | −1.4126 | 4.5974 | −0.6037 | 0.8943 | 4.5974 |
| 0.8361 | −1.3892 | 4.5974 | −0.5828 | 0.8621 | 4.5974 |
| 0.8088 | −1.3614 | 4.5974 | −0.5595 | 0.8245 | 4.5974 |
| 0.7774 | −1.3293 | 4.5974 | −0.5350 | 0.7841 | 4.5974 |
| 0.7417 | −1.2930 | 4.5974 | −0.5075 | 0.7386 | 4.5974 |
| 0.7020 | −1.2522 | 4.5974 | −0.4771 | 0.6880 | 4.5974 |
| 0.6586 | −1.2067 | 4.5974 | −0.4437 | 0.6324 | 4.5974 |
| 0.6113 | −1.1567 | 4.5974 | −0.4087 | 0.5741 | 4.5974 |
| 0.5622 | −1.1041 | 4.5974 | −0.3722 | 0.5134 | 4.5974 |
| 0.5117 | −1.0490 | 4.5974 | −0.3340 | 0.4502 | 4.5974 |
| 0.4597 | −0.9912 | 4.5974 | −0.2940 | 0.3847 | 4.5974 |
| 0.4063 | −0.9308 | 4.5974 | −0.2523 | 0.3167 | 4.5974 |
| 0.3517 | −0.8675 | 4.5974 | −0.2088 | 0.2466 | 4.5974 |
| 0.2961 | −0.8012 | 4.5974 | −0.1633 | 0.1740 | 4.5974 |
| 0.2398 | −0.7319 | 4.5974 | −0.1160 | 0.0993 | 4.5974 |
| 0.1845 | −0.6617 | 4.5974 | −0.0680 | 0.0248 | 4.5974 |
| 0.1307 | −0.5904 | 4.5974 | −0.0197 | −0.0494 | 4.5974 |
| 0.0782 | −0.5181 | 4.5974 | 0.0290 | −0.1233 | 4.5974 |
| 0.0269 | −0.4450 | 4.5974 | 0.0781 | −0.1970 | 4.5974 |
| −0.0234 | −0.3710 | 4.5974 | 0.1276 | −0.2705 | 4.5974 |
| −0.0726 | −0.2964 | 4.5974 | 0.1773 | −0.3438 | 4.5974 |
| −0.1210 | −0.2210 | 4.5974 | 0.2273 | −0.4169 | 4.5974 |
| −0.1684 | −0.1450 | 4.5974 | 0.2773 | −0.4900 | 4.5974 |

TABLE 7-continued

| SUCTION SIDE | | | PRESSURE SIDE | | |
|---|---|---|---|---|---|
| X | Y | Z | X | Y | Z |
| −0.2149 | −0.0683 | 4.5974 | 0.3271 | −0.5632 | 4.5974 |
| −0.2604 | 0.0092 | 4.5974 | 0.3767 | −0.6366 | 4.5974 |
| −0.3049 | 0.0873 | 4.5974 | 0.4262 | −0.7100 | 4.5974 |
| −0.3470 | 0.1633 | 4.5974 | 0.4741 | −0.7809 | 4.5974 |
| −0.3866 | 0.2373 | 4.5974 | 0.5205 | −0.8494 | 4.5974 |
| −0.4239 | 0.3091 | 4.5974 | 0.5653 | −0.9153 | 4.5974 |
| −0.4588 | 0.3787 | 4.5974 | 0.6088 | −0.9786 | 4.5974 |
| −0.4916 | 0.4460 | 4.5974 | 0.6507 | −1.0393 | 4.5974 |
| −0.5223 | 0.5111 | 4.5974 | 0.6912 | −1.0975 | 4.5974 |
| −0.5507 | 0.5739 | 4.5974 | 0.7303 | −1.1530 | 4.5974 |
| −0.5771 | 0.6343 | 4.5974 | 0.7662 | −1.2035 | 4.5974 |
| −0.6004 | 0.6896 | 4.5974 | 0.7986 | −1.2493 | 4.5974 |
| −0.6207 | 0.7395 | 4.5974 | 0.8279 | −1.2901 | 4.5974 |
| −0.6381 | 0.7843 | 4.5974 | 0.8540 | −1.3259 | 4.5974 |
| −0.6537 | 0.8263 | 4.5974 | 0.8767 | −1.3568 | 4.5974 |
| −0.6662 | 0.8633 | 4.5974 | 0.8960 | −1.3829 | 4.5974 |
| −0.6744 | 0.8922 | 4.5974 | 0.9125 | −1.4053 | 4.5974 |
| −0.6793 | 0.9156 | 4.5974 | 0.9264 | −1.4239 | 4.5974 |
| −0.6814 | 0.9335 | 4.5974 | 0.9379 | −1.4392 | 4.5974 |
| −0.6811 | 0.9469 | 4.5974 | 0.9472 | −1.4515 | 4.5974 |
| −0.6795 | 0.9542 | 4.5974 | 0.9544 | −1.4609 | 4.5974 |
| −0.6772 | 0.9585 | 4.5974 | 0.9583 | −1.4687 | 4.5974 |
| −0.6756 | 0.9602 | 4.5974 | 0.9582 | −1.4761 | 4.5974 |
| −0.6745 | 0.9608 | 4.5974 | 0.9558 | −1.4815 | 4.5974 |
| 0.9426 | −1.4957 | 4.7869 | −0.6690 | 0.9729 | 4.7869 |
| 0.9388 | −1.4981 | 4.7869 | −0.6684 | 0.9732 | 4.7869 |
| 0.9329 | −1.4997 | 4.7869 | −0.6673 | 0.9735 | 4.7869 |
| 0.9255 | −1.4983 | 4.7869 | −0.6649 | 0.9737 | 4.7869 |
| 0.9184 | −1.4929 | 4.7869 | −0.6602 | 0.9725 | 4.7869 |
| 0.9099 | −1.4844 | 4.7869 | −0.6536 | 0.9689 | 4.7869 |
| 0.8988 | −1.4734 | 4.7869 | −0.6434 | 0.9603 | 4.7869 |
| 0.8851 | −1.4596 | 4.7869 | −0.6313 | 0.9471 | 4.7869 |
| 0.8683 | −1.4427 | 4.7869 | −0.6169 | 0.9284 | 4.7869 |
| 0.8485 | −1.4226 | 4.7869 | −0.6001 | 0.9040 | 4.7869 |
| 0.8253 | −1.3990 | 4.7869 | −0.5798 | 0.8713 | 4.7869 |
| 0.7980 | −1.3711 | 4.7869 | −0.5571 | 0.8331 | 4.7869 |
| 0.7666 | −1.3387 | 4.7869 | −0.5331 | 0.7922 | 4.7869 |
| 0.7312 | −1.3019 | 4.7869 | −0.5061 | 0.7461 | 4.7869 |
| 0.6919 | −1.2606 | 4.7869 | −0.4763 | 0.6949 | 4.7869 |
| 0.6485 | −1.2147 | 4.7869 | −0.4435 | 0.6386 | 4.7869 |
| 0.6014 | −1.1641 | 4.7869 | −0.4092 | 0.5797 | 4.7869 |
| 0.5528 | −1.1108 | 4.7869 | −0.3733 | 0.5182 | 4.7869 |
| 0.5026 | −1.0550 | 4.7869 | −0.3359 | 0.4544 | 4.7869 |
| 0.4511 | −0.9966 | 4.7869 | −0.2966 | 0.3881 | 4.7869 |
| 0.3984 | −0.9353 | 4.7869 | −0.2556 | 0.3194 | 4.7869 |
| 0.3445 | −0.8711 | 4.7869 | −0.2126 | 0.2485 | 4.7869 |
| 0.2897 | −0.8038 | 4.7869 | −0.1678 | 0.1752 | 4.7869 |
| 0.2342 | −0.7335 | 4.7869 | −0.1210 | 0.0997 | 4.7869 |
| 0.1801 | −0.6621 | 4.7869 | −0.0737 | 0.0245 | 4.7869 |
| 0.1272 | −0.5897 | 4.7869 | −0.0260 | −0.0504 | 4.7869 |
| 0.0757 | −0.5165 | 4.7869 | 0.0221 | −0.1251 | 4.7869 |
| 0.0252 | −0.4424 | 4.7869 | 0.0707 | −0.1995 | 4.7869 |
| −0.0244 | −0.3676 | 4.7869 | 0.1196 | −0.2736 | 4.7869 |
| −0.0730 | −0.2923 | 4.7869 | 0.1689 | −0.3476 | 4.7869 |
| −0.1208 | −0.2161 | 4.7869 | 0.2186 | −0.4213 | 4.7869 |
| −0.1676 | −0.1394 | 4.7869 | 0.2683 | −0.4948 | 4.7869 |
| −0.2135 | −0.0619 | 4.7869 | 0.3181 | −0.5684 | 4.7869 |
| −0.2585 | 0.0162 | 4.7869 | 0.3676 | −0.6422 | 4.7869 |
| −0.3025 | 0.0948 | 4.7869 | 0.4171 | −0.7160 | 4.7869 |
| −0.3440 | 0.1714 | 4.7869 | 0.4649 | −0.7874 | 4.7869 |
| −0.3831 | 0.2458 | 4.7869 | 0.5111 | −0.8562 | 4.7869 |
| −0.4199 | 0.3181 | 4.7869 | 0.5558 | −0.9225 | 4.7869 |
| −0.4546 | 0.3882 | 4.7869 | 0.5991 | −0.9862 | 4.7869 |
| −0.4871 | 0.4559 | 4.7869 | 0.6409 | −1.0473 | 4.7869 |
| −0.5174 | 0.5212 | 4.7869 | 0.6813 | −1.1058 | 4.7869 |
| −0.5456 | 0.5843 | 4.7869 | 0.7201 | −1.1617 | 4.7869 |
| −0.5718 | 0.6450 | 4.7869 | 0.7559 | −1.2126 | 4.7869 |
| −0.5949 | 0.7005 | 4.7869 | 0.7885 | −1.2585 | 4.7869 |
| −0.6151 | 0.7507 | 4.7869 | 0.8178 | −1.2993 | 4.7869 |
| −0.6324 | 0.7955 | 4.7869 | 0.8438 | −1.3354 | 4.7869 |
| −0.6480 | 0.8378 | 4.7869 | 0.8664 | −1.3666 | 4.7869 |
| −0.6605 | 0.8749 | 4.7869 | 0.8856 | −1.3929 | 4.7869 |
| −0.6687 | 0.9037 | 4.7869 | 0.9021 | −1.4154 | 4.7869 |
| −0.6737 | 0.9273 | 4.7869 | 0.9160 | −1.4342 | 4.7869 |
| −0.6759 | 0.9451 | 4.7869 | 0.9275 | −1.4496 | 4.7869 |
| −0.6758 | 0.9587 | 4.7869 | 0.9367 | −1.4619 | 4.7869 |

TABLE 7-continued

| SUCTION SIDE | | | PRESSURE SIDE | | |
|---|---|---|---|---|---|
| X | Y | Z | X | Y | Z |
| −0.6743 | 0.9659 | 4.7869 | 0.9438 | −1.4714 | 4.7869 |
| −0.6722 | 0.9703 | 4.7869 | 0.9479 | −1.4792 | 4.7869 |
| −0.6705 | 0.9720 | 4.7869 | 0.9479 | −1.4867 | 4.7869 |
| −0.6695 | 0.9727 | 4.7869 | 0.9455 | −1.4923 | 4.7869 |
| 0.9360 | −1.5028 | 4.8901 | −0.6630 | 0.9836 | 4.8901 |
| 0.9322 | −1.5052 | 4.8901 | −0.6624 | 0.9838 | 4.8901 |
| 0.9263 | −1.5068 | 4.8901 | −0.6613 | 0.9842 | 4.8901 |
| 0.9189 | −1.5053 | 4.8901 | −0.6589 | 0.9843 | 4.8901 |
| 0.9118 | −1.4998 | 4.8901 | −0.6542 | 0.9830 | 4.8901 |
| 0.9033 | −1.4913 | 4.8901 | −0.6478 | 0.9792 | 4.8901 |
| 0.8923 | −1.4802 | 4.8901 | −0.6377 | 0.9703 | 4.8901 |
| 0.8785 | −1.4663 | 4.8901 | −0.6258 | 0.9570 | 4.8901 |
| 0.8616 | −1.4494 | 4.8901 | −0.6116 | 0.9379 | 4.8901 |
| 0.8418 | −1.4292 | 4.8901 | −0.5952 | 0.9133 | 4.8901 |
| 0.8186 | −1.4056 | 4.8901 | −0.5751 | 0.8803 | 4.8901 |
| 0.7913 | −1.3775 | 4.8901 | −0.5528 | 0.8417 | 4.8901 |
| 0.7599 | −1.3450 | 4.8901 | −0.5293 | 0.8003 | 4.8901 |
| 0.7246 | −1.3079 | 4.8901 | −0.5028 | 0.7539 | 4.8901 |
| 0.6852 | −1.2662 | 4.8901 | −0.4734 | 0.7023 | 4.8901 |
| 0.6420 | −1.2201 | 4.8901 | −0.4411 | 0.6453 | 4.8901 |
| 0.5950 | −1.1691 | 4.8901 | −0.4075 | 0.5859 | 4.8901 |
| 0.5466 | −1.1156 | 4.8901 | −0.3721 | 0.5240 | 4.8901 |
| 0.4966 | −1.0594 | 4.8901 | −0.3351 | 0.4596 | 4.8901 |
| 0.4453 | −1.0004 | 4.8901 | −0.2964 | 0.3927 | 4.8901 |
| 0.3929 | −0.9386 | 4.8901 | −0.2558 | 0.3235 | 4.8901 |
| 0.3394 | −0.8738 | 4.8901 | −0.2135 | 0.2520 | 4.8901 |
| 0.2851 | −0.8060 | 4.8901 | −0.1692 | 0.1781 | 4.8901 |
| 0.2301 | −0.7348 | 4.8901 | −0.1230 | 0.1020 | 4.8901 |
| 0.1766 | −0.6627 | 4.8901 | −0.0762 | 0.0261 | 4.8901 |
| 0.1244 | −0.5895 | 4.8901 | −0.0290 | −0.0494 | 4.8901 |
| 0.0733 | −0.5156 | 4.8901 | 0.0186 | −0.1247 | 4.8901 |
| 0.0234 | −0.4407 | 4.8901 | 0.0668 | −0.1996 | 4.8901 |
| −0.0257 | −0.3654 | 4.8901 | 0.1153 | −0.2743 | 4.8901 |
| −0.0739 | −0.2892 | 4.8901 | 0.1642 | −0.3487 | 4.8901 |
| −0.1212 | −0.2124 | 4.8901 | 0.2135 | −0.4230 | 4.8901 |
| −0.1675 | −0.1351 | 4.8901 | 0.2630 | −0.4970 | 4.8901 |
| −0.2130 | −0.0569 | 4.8901 | 0.3127 | −0.5710 | 4.8901 |
| −0.2574 | 0.0217 | 4.8901 | 0.3621 | −0.6450 | 4.8901 |
| −0.3010 | 0.1008 | 4.8901 | 0.4115 | −0.7193 | 4.8901 |
| −0.3420 | 0.1779 | 4.8901 | 0.4592 | −0.7910 | 4.8901 |
| −0.3807 | 0.2528 | 4.8901 | 0.5052 | −0.8602 | 4.8901 |
| −0.4171 | 0.3255 | 4.8901 | 0.5498 | −0.9269 | 4.8901 |
| −0.4513 | 0.3960 | 4.8901 | 0.5929 | −0.9909 | 4.8901 |
| −0.4834 | 0.4641 | 4.8901 | 0.6346 | −1.0523 | 4.8901 |
| −0.5134 | 0.5298 | 4.8901 | 0.6749 | −1.1111 | 4.8901 |
| −0.5413 | 0.5933 | 4.8901 | 0.7137 | −1.1673 | 4.8901 |
| −0.5672 | 0.6543 | 4.8901 | 0.7494 | −1.2185 | 4.8901 |
| −0.5900 | 0.7100 | 4.8901 | 0.7820 | −1.2645 | 4.8901 |
| −0.6099 | 0.7604 | 4.8901 | 0.8114 | −1.3056 | 4.8901 |
| −0.6270 | 0.8055 | 4.8901 | 0.8373 | −1.3418 | 4.8901 |
| −0.6424 | 0.8480 | 4.8901 | 0.8599 | −1.3731 | 4.8901 |
| −0.6547 | 0.8852 | 4.8901 | 0.8790 | −1.3996 | 4.8901 |
| −0.6628 | 0.9142 | 4.8901 | 0.8954 | −1.4222 | 4.8901 |
| −0.6677 | 0.9378 | 4.8901 | 0.9093 | −1.4411 | 4.8901 |
| −0.6699 | 0.9556 | 4.8901 | 0.9207 | −1.4566 | 4.8901 |
| −0.6698 | 0.9693 | 4.8901 | 0.9300 | −1.4690 | 4.8901 |
| −0.6684 | 0.9766 | 4.8901 | 0.9371 | −1.4786 | 4.8901 |
| −0.6662 | 0.9809 | 4.8901 | 0.9413 | −1.4864 | 4.8901 |
| −0.6646 | 0.9827 | 4.8901 | 0.9413 | −1.4939 | 4.8901 |
| −0.6636 | 0.9833 | 4.8901 | 0.9390 | −1.4994 | 4.8901 |
| 0.9199 | −1.5213 | 5.1293 | −0.6349 | 1.0190 | 5.1293 |
| 0.9160 | −1.5238 | 5.1293 | −0.6343 | 1.0192 | 5.1293 |
| 0.9100 | −1.5252 | 5.1293 | −0.6332 | 1.0195 | 5.1293 |
| 0.9027 | −1.5236 | 5.1293 | −0.6308 | 1.0195 | 5.1293 |
| 0.8957 | −1.5177 | 5.1293 | −0.6261 | 1.0179 | 5.1293 |
| 0.8872 | −1.5091 | 5.1293 | −0.6199 | 1.0137 | 5.1293 |
| 0.8760 | −1.4979 | 5.1293 | −0.6101 | 1.0043 | 5.1293 |
| 0.8622 | −1.4839 | 5.1293 | −0.5989 | 0.9903 | 5.1293 |
| 0.8454 | −1.4667 | 5.1293 | −0.5854 | 0.9705 | 5.1293 |
| 0.8254 | −1.4464 | 5.1293 | −0.5699 | 0.9449 | 5.1293 |
| 0.8021 | −1.4224 | 5.1293 | −0.5512 | 0.9108 | 5.1293 |
| 0.7747 | −1.3940 | 5.1293 | −0.5303 | 0.8711 | 5.1293 |
| 0.7433 | −1.3611 | 5.1293 | −0.5082 | 0.8286 | 5.1293 |
| 0.7078 | −1.3236 | 5.1293 | −0.4833 | 0.7808 | 5.1293 |
| 0.6685 | −1.2814 | 5.1293 | −0.4557 | 0.7277 | 5.1293 |
| 0.6254 | −1.2345 | 5.1293 | −0.4253 | 0.6692 | 5.1293 |

TABLE 7-continued

| SUCTION SIDE | | | PRESSURE SIDE | | |
|---|---|---|---|---|---|
| X | Y | Z | X | Y | Z |
| 0.5786 | −1.1827 | 5.1293 | −0.3936 | 0.6081 | 5.1293 |
| 0.5304 | −1.1283 | 5.1293 | −0.3603 | 0.5444 | 5.1293 |
| 0.4808 | −1.0711 | 5.1293 | −0.3254 | 0.4783 | 5.1293 |
| 0.4300 | −1.0111 | 5.1293 | −0.2887 | 0.4096 | 5.1293 |
| 0.3781 | −0.9480 | 5.1293 | −0.2502 | 0.3386 | 5.1293 |
| 0.3254 | −0.8818 | 5.1293 | −0.2099 | 0.2651 | 5.1293 |
| 0.2719 | −0.8123 | 5.1293 | −0.1677 | 0.1893 | 5.1293 |
| 0.2182 | −0.7394 | 5.1293 | −0.1235 | 0.1113 | 5.1293 |
| 0.1659 | −0.6653 | 5.1293 | −0.0787 | 0.0336 | 5.1293 |
| 0.1151 | −0.5901 | 5.1293 | −0.0334 | −0.0439 | 5.1293 |
| 0.0655 | −0.5139 | 5.1293 | 0.0125 | −0.1209 | 5.1293 |
| 0.0169 | −0.4371 | 5.1293 | 0.0590 | −0.1977 | 5.1293 |
| −0.0306 | −0.3594 | 5.1293 | 0.1060 | −0.2741 | 5.1293 |
| −0.0773 | −0.2812 | 5.1293 | 0.1537 | −0.3501 | 5.1293 |
| −0.1230 | −0.2024 | 5.1293 | 0.2019 | −0.4258 | 5.1293 |
| −0.1676 | −0.1230 | 5.1293 | 0.2506 | −0.5013 | 5.1293 |
| −0.2112 | −0.0430 | 5.1293 | 0.2995 | −0.5766 | 5.1293 |
| −0.2538 | 0.0375 | 5.1293 | 0.3485 | −0.6518 | 5.1293 |
| −0.2953 | 0.1185 | 5.1293 | 0.3974 | −0.7271 | 5.1293 |
| −0.3344 | 0.1974 | 5.1293 | 0.4445 | −0.8000 | 5.1293 |
| −0.3712 | 0.2741 | 5.1293 | 0.4902 | −0.8703 | 5.1293 |
| −0.4057 | 0.3484 | 5.1293 | 0.5344 | −0.9379 | 5.1293 |
| −0.4381 | 0.4205 | 5.1293 | 0.5772 | −1.0029 | 5.1293 |
| −0.4684 | 0.4901 | 5.1293 | 0.6186 | −1.0653 | 5.1293 |
| −0.4966 | 0.5573 | 5.1293 | 0.6587 | −1.1249 | 5.1293 |
| −0.5229 | 0.6220 | 5.1293 | 0.6974 | −1.1819 | 5.1293 |
| −0.5473 | 0.6842 | 5.1293 | 0.7330 | −1.2337 | 5.1293 |
| −0.5686 | 0.7410 | 5.1293 | 0.7654 | −1.2804 | 5.1293 |
| −0.5871 | 0.7925 | 5.1293 | 0.7947 | −1.3220 | 5.1293 |
| −0.6029 | 0.8385 | 5.1293 | 0.8206 | −1.3587 | 5.1293 |
| −0.6173 | 0.8817 | 5.1293 | 0.8431 | −1.3904 | 5.1293 |
| −0.6287 | 0.9195 | 5.1293 | 0.8623 | −1.4172 | 5.1293 |
| −0.6361 | 0.9489 | 5.1293 | 0.8787 | −1.4400 | 5.1293 |
| −0.6405 | 0.9728 | 5.1293 | 0.8926 | −1.4592 | 5.1293 |
| −0.6423 | 0.9909 | 5.1293 | 0.9040 | −1.4749 | 5.1293 |
| −0.6419 | 1.0046 | 5.1293 | 0.9132 | −1.4875 | 5.1293 |
| −0.6404 | 1.0120 | 5.1293 | 0.9203 | −1.4972 | 5.1293 |
| −0.6382 | 1.0164 | 5.1293 | 0.9247 | −1.5050 | 5.1293 |
| −0.6365 | 1.0181 | 5.1293 | 0.9250 | −1.5123 | 5.1293 |
| −0.6355 | 1.0187 | 5.1293 | 0.9228 | −1.5179 | 5.1293 |
| 0.9078 | −1.5355 | 5.3066 | −0.6027 | 1.0519 | 5.3066 |
| 0.9038 | −1.5381 | 5.3066 | −0.6021 | 1.0521 | 5.3066 |
| 0.8978 | −1.5394 | 5.3066 | −0.6009 | 1.0523 | 5.3066 |
| 0.8904 | −1.5375 | 5.3066 | −0.5984 | 1.0522 | 5.3066 |
| 0.8834 | −1.5313 | 5.3066 | −0.5940 | 1.0503 | 5.3066 |
| 0.8748 | −1.5226 | 5.3066 | −0.5878 | 1.0458 | 5.3066 |
| 0.8636 | −1.5112 | 5.3066 | −0.5785 | 1.0358 | 5.3066 |
| 0.8496 | −1.4970 | 5.3066 | −0.5679 | 1.0213 | 5.3066 |
| 0.8327 | −1.4796 | 5.3066 | −0.5552 | 1.0008 | 5.3066 |
| 0.8125 | −1.4589 | 5.3066 | −0.5407 | 0.9745 | 5.3066 |
| 0.7891 | −1.4346 | 5.3066 | −0.5233 | 0.9394 | 5.3066 |
| 0.7616 | −1.4056 | 5.3066 | −0.5039 | 0.8986 | 5.3066 |
| 0.7298 | −1.3723 | 5.3066 | −0.4833 | 0.8551 | 5.3066 |
| 0.6940 | −1.3342 | 5.3066 | −0.4601 | 0.8060 | 5.3066 |
| 0.6544 | −1.2914 | 5.3066 | −0.4345 | 0.7515 | 5.3066 |
| 0.6111 | −1.2436 | 5.3066 | −0.4063 | 0.6916 | 5.3066 |
| 0.5641 | −1.1909 | 5.3066 | −0.3767 | 0.6290 | 5.3066 |
| 0.5157 | −1.1353 | 5.3066 | −0.3456 | 0.5638 | 5.3066 |
| 0.4659 | −1.0770 | 5.3066 | −0.3129 | 0.4960 | 5.3066 |
| 0.4150 | −1.0156 | 5.3066 | −0.2784 | 0.4257 | 5.3066 |
| 0.3634 | −0.9513 | 5.3066 | −0.2421 | 0.3530 | 5.3066 |
| 0.3110 | −0.8839 | 5.3066 | −0.2041 | 0.2778 | 5.3066 |
| 0.2582 | −0.8130 | 5.3066 | −0.1640 | 0.2002 | 5.3066 |
| 0.2053 | −0.7387 | 5.3066 | −0.1218 | 0.1203 | 5.3066 |
| 0.1543 | −0.6632 | 5.3066 | −0.0790 | 0.0408 | 5.3066 |
| 0.1048 | −0.5868 | 5.3066 | −0.0354 | −0.0383 | 5.3066 |
| 0.0567 | −0.5095 | 5.3066 | 0.0089 | −0.1171 | 5.3066 |
| 0.0096 | −0.4316 | 5.3066 | 0.0539 | −0.1953 | 5.3066 |
| −0.0362 | −0.3529 | 5.3066 | 0.0996 | −0.2731 | 5.3066 |
| −0.0811 | −0.2735 | 5.3066 | 0.1462 | −0.3506 | 5.3066 |
| −0.1249 | −0.1936 | 5.3066 | 0.1934 | −0.4275 | 5.3066 |
| −0.1677 | −0.1129 | 5.3066 | 0.2414 | −0.5041 | 5.3066 |
| −0.2093 | −0.0316 | 5.3066 | 0.2896 | −0.5804 | 5.3066 |
| −0.2499 | 0.0504 | 5.3066 | 0.3381 | −0.6567 | 5.3066 |
| −0.2893 | 0.1331 | 5.3066 | 0.3865 | −0.7329 | 5.3066 |
| −0.3263 | 0.2138 | 5.3066 | 0.4333 | −0.8067 | 5.3066 |

TABLE 7-continued

| SUCTION SIDE | | | PRESSURE SIDE | | |
|---|---|---|---|---|---|
| X | Y | Z | X | Y | Z |
| −0.3610 | 0.2922 | 5.3066 | 0.4786 | −0.8779 | 5.3066 |
| −0.3935 | 0.3682 | 5.3066 | 0.5225 | −0.9463 | 5.3066 |
| −0.4237 | 0.4419 | 5.3066 | 0.5650 | −1.0120 | 5.3066 |
| −0.4520 | 0.5130 | 5.3066 | 0.6063 | −1.0750 | 5.3066 |
| −0.4783 | 0.5817 | 5.3066 | 0.6462 | −1.1352 | 5.3066 |
| −0.5026 | 0.6478 | 5.3066 | 0.6848 | −1.1927 | 5.3066 |
| −0.5251 | 0.7113 | 5.3066 | 0.7203 | −1.2451 | 5.3066 |
| −0.5447 | 0.7694 | 5.3066 | 0.7527 | −1.2922 | 5.3066 |
| −0.5615 | 0.8219 | 5.3066 | 0.7818 | −1.3343 | 5.3066 |
| −0.5760 | 0.8687 | 5.3066 | 0.8077 | −1.3713 | 5.3066 |
| −0.5889 | 0.9128 | 5.3066 | 0.8303 | −1.4033 | 5.3066 |
| −0.5992 | 0.9513 | 5.3066 | 0.8495 | −1.4303 | 5.3066 |
| −0.6057 | 0.9813 | 5.3066 | 0.8660 | −1.4533 | 5.3066 |
| −0.6094 | 1.0055 | 5.3066 | 0.8799 | −1.4726 | 5.3066 |
| −0.6107 | 1.0238 | 5.3066 | 0.8913 | −1.4885 | 5.3066 |
| −0.6099 | 1.0375 | 5.3066 | 0.9004 | −1.5013 | 5.3066 |
| −0.6082 | 1.0450 | 5.3066 | 0.9075 | −1.5110 | 5.3066 |
| −0.6060 | 1.0494 | 5.3066 | 0.9121 | −1.5187 | 5.3066 |
| −0.6043 | 1.0511 | 5.3066 | 0.9128 | −1.5262 | 5.3066 |
| −0.6032 | 1.0517 | 5.3066 | 0.9107 | −1.5320 | 5.3066 |
| 0.8958 | −1.5500 | 5.4838 | −0.5690 | 1.0857 | 5.4838 |
| 0.8918 | −1.5524 | 5.4838 | −0.5684 | 1.0859 | 5.4838 |
| 0.8856 | −1.5537 | 5.4838 | −0.5672 | 1.0860 | 5.4838 |
| 0.8782 | −1.5517 | 5.4838 | −0.5647 | 1.0857 | 5.4838 |
| 0.8713 | −1.5454 | 5.4838 | −0.5603 | 1.0836 | 5.4838 |
| 0.8627 | −1.5366 | 5.4838 | −0.5545 | 1.0787 | 5.4838 |
| 0.8514 | −1.5251 | 5.4838 | −0.5456 | 1.0682 | 5.4838 |
| 0.8374 | −1.5106 | 5.4838 | −0.5356 | 1.0531 | 5.4838 |
| 0.8205 | −1.4931 | 5.4838 | −0.5238 | 1.0319 | 5.4838 |
| 0.8003 | −1.4721 | 5.4838 | −0.5104 | 1.0047 | 5.4838 |
| 0.7769 | −1.4475 | 5.4838 | −0.4944 | 0.9687 | 5.4838 |
| 0.7493 | −1.4183 | 5.4838 | −0.4765 | 0.9268 | 5.4838 |
| 0.7175 | −1.3845 | 5.4838 | −0.4576 | 0.8821 | 5.4838 |
| 0.6817 | −1.3460 | 5.4838 | −0.4363 | 0.8318 | 5.4838 |
| 0.6421 | −1.3027 | 5.4838 | −0.4127 | 0.7759 | 5.4838 |
| 0.5987 | −1.2543 | 5.4838 | −0.3866 | 0.7146 | 5.4838 |
| 0.5517 | −1.2009 | 5.4838 | −0.3593 | 0.6503 | 5.4838 |
| 0.5034 | −1.1447 | 5.4838 | −0.3305 | 0.5836 | 5.4838 |
| 0.4538 | −1.0856 | 5.4838 | −0.3000 | 0.5141 | 5.4838 |
| 0.4033 | −1.0235 | 5.4838 | −0.2679 | 0.4423 | 5.4838 |
| 0.3519 | −0.9584 | 5.4838 | −0.2339 | 0.3678 | 5.4838 |
| 0.3000 | −0.8899 | 5.4838 | −0.1981 | 0.2909 | 5.4838 |
| 0.2477 | −0.8180 | 5.4838 | −0.1602 | 0.2118 | 5.4838 |
| 0.1955 | −0.7425 | 5.4838 | −0.1202 | 0.1302 | 5.4838 |
| 0.1453 | −0.6657 | 5.4838 | −0.0794 | 0.0491 | 5.4838 |
| 0.0967 | −0.5877 | 5.4838 | −0.0376 | −0.0316 | 5.4838 |
| 0.0496 | −0.5089 | 5.4838 | 0.0049 | −0.1118 | 5.4838 |
| 0.0037 | −0.4292 | 5.4838 | 0.0484 | −0.1915 | 5.4838 |
| −0.0409 | −0.3488 | 5.4838 | 0.0929 | −0.2708 | 5.4838 |
| −0.0844 | −0.2676 | 5.4838 | 0.1383 | −0.3497 | 5.4838 |
| −0.1266 | −0.1857 | 5.4838 | 0.1845 | −0.4280 | 5.4838 |
| −0.1678 | −0.1029 | 5.4838 | 0.2316 | −0.5059 | 5.4838 |
| −0.2077 | −0.0195 | 5.4838 | 0.2792 | −0.5836 | 5.4838 |
| −0.2464 | 0.0647 | 5.4838 | 0.3271 | −0.6610 | 5.4838 |
| −0.2837 | 0.1494 | 5.4838 | 0.3750 | −0.7384 | 5.4838 |
| −0.3185 | 0.2319 | 5.4838 | 0.4214 | −0.8133 | 5.4838 |
| −0.3510 | 0.3120 | 5.4838 | 0.4664 | −0.8854 | 5.4838 |
| −0.3813 | 0.3897 | 5.4838 | 0.5101 | −0.9547 | 5.4838 |
| −0.4093 | 0.4649 | 5.4838 | 0.5525 | −1.0212 | 5.4838 |
| −0.4354 | 0.5375 | 5.4838 | 0.5937 | −1.0849 | 5.4838 |
| −0.4597 | 0.6076 | 5.4838 | 0.6336 | −1.1459 | 5.4838 |
| −0.4819 | 0.6750 | 5.4838 | 0.6723 | −1.2041 | 5.4838 |
| −0.5023 | 0.7398 | 5.4838 | 0.7078 | −1.2570 | 5.4838 |
| −0.5200 | 0.7989 | 5.4838 | 0.7403 | −1.3046 | 5.4838 |
| −0.5351 | 0.8524 | 5.4838 | 0.7695 | −1.3472 | 5.4838 |
| −0.5480 | 0.9000 | 5.4838 | 0.7955 | −1.3846 | 5.4838 |
| −0.5595 | 0.9449 | 5.4838 | 0.8182 | −1.4168 | 5.4838 |
| −0.5685 | 0.9840 | 5.4838 | 0.8375 | −1.4440 | 5.4838 |
| −0.5740 | 1.0145 | 5.4838 | 0.8541 | −1.4673 | 5.4838 |
| −0.5770 | 1.0390 | 5.4838 | 0.8680 | −1.4869 | 5.4838 |
| −0.5778 | 1.0575 | 5.4838 | 0.8794 | −1.5029 | 5.4838 |
| −0.5767 | 1.0713 | 5.4838 | 0.8887 | −1.5157 | 5.4838 |
| −0.5749 | 1.0788 | 5.4838 | 0.8958 | −1.5256 | 5.4838 |
| −0.5725 | 1.0831 | 5.4838 | 0.9002 | −1.5334 | 5.4838 |

TABLE 7-continued

| SUCTION SIDE | | | PRESSURE SIDE | | |
|---|---|---|---|---|---|
| X | Y | Z | X | Y | Z |
| −0.5707 | 1.0848 | 5.4838 | 0.9007 | −1.5409 | 5.4838 |
| −0.5697 | 1.0855 | 5.4838 | 0.8986 | −1.5465 | 5.4838 |

TABLE 8

| SUCTION SIDE | | | PRESSURE SIDE | | |
|---|---|---|---|---|---|
| X | Y | Z | X | Y | Z |
| 0.7478 | −0.9242 | −0.1839 | −0.9290 | 0.9510 | −0.1839 |
| 0.7455 | −0.9274 | −0.1839 | −0.9285 | 0.9512 | −0.1839 |
| 0.7418 | −0.9313 | −0.1839 | −0.9275 | 0.9515 | −0.1839 |
| 0.7362 | −0.9350 | −0.1839 | −0.9255 | 0.9520 | −0.1839 |
| 0.7286 | −0.9376 | −0.1839 | −0.9214 | 0.9524 | −0.1839 |
| 0.7179 | −0.9378 | −0.1839 | −0.9151 | 0.9519 | −0.1839 |
| 0.7049 | −0.9327 | −0.1839 | −0.9043 | 0.9481 | −0.1839 |
| 0.6893 | −0.9247 | −0.1839 | −0.8915 | 0.9397 | −0.1839 |
| 0.6704 | −0.9149 | −0.1839 | −0.8772 | 0.9254 | −0.1839 |
| 0.6479 | −0.9033 | −0.1839 | −0.8618 | 0.9051 | −0.1839 |
| 0.6215 | −0.8897 | −0.1839 | −0.8432 | 0.8777 | −0.1839 |
| 0.5903 | −0.8735 | −0.1839 | −0.8221 | 0.8459 | −0.1839 |
| 0.5544 | −0.8548 | −0.1839 | −0.7997 | 0.8120 | −0.1839 |
| 0.5137 | −0.8335 | −0.1839 | −0.7744 | 0.7738 | −0.1839 |
| 0.4684 | −0.8097 | −0.1839 | −0.7462 | 0.7315 | −0.1839 |
| 0.4183 | −0.7833 | −0.1839 | −0.7150 | 0.6851 | −0.1839 |
| 0.3634 | −0.7544 | −0.1839 | −0.6818 | 0.6369 | −0.1839 |
| 0.3062 | −0.7241 | −0.1839 | −0.6467 | 0.5870 | −0.1839 |
| 0.2472 | −0.6914 | −0.1839 | −0.6096 | 0.5356 | −0.1839 |
| 0.1866 | −0.6563 | −0.1839 | −0.5701 | 0.4826 | −0.1839 |
| 0.1242 | −0.6186 | −0.1839 | −0.5284 | 0.4281 | −0.1839 |
| 0.0604 | −0.5780 | −0.1839 | −0.4844 | 0.3722 | −0.1839 |
| −0.0047 | −0.5343 | −0.1839 | −0.4382 | 0.3147 | −0.1839 |
| −0.0706 | −0.4875 | −0.1839 | −0.3898 | 0.2557 | −0.1839 |
| −0.1348 | −0.4391 | −0.1839 | −0.3411 | 0.1969 | −0.1839 |
| −0.1976 | −0.3890 | −0.1839 | −0.2921 | 0.1384 | −0.1839 |
| −0.2585 | −0.3370 | −0.1839 | −0.2429 | 0.0802 | −0.1839 |
| −0.3177 | −0.2832 | −0.1839 | −0.1933 | 0.0221 | −0.1839 |
| −0.3751 | −0.2274 | −0.1839 | −0.1434 | −0.0355 | −0.1839 |
| −0.4305 | −0.1697 | −0.1839 | −0.0928 | −0.0928 | −0.1839 |
| −0.4841 | −0.1100 | −0.1839 | −0.0421 | −0.1497 | −0.1839 |
| −0.5357 | −0.0481 | −0.1839 | 0.0092 | −0.2063 | −0.1839 |
| −0.5849 | 0.0161 | −0.1839 | 0.0608 | −0.2625 | −0.1839 |
| −0.6318 | 0.0826 | −0.1839 | 0.1129 | −0.3182 | −0.1839 |
| −0.6757 | 0.1507 | −0.1839 | 0.1655 | −0.3734 | −0.1839 |
| −0.7154 | 0.2179 | −0.1839 | 0.2169 | −0.4264 | −0.1839 |
| −0.7513 | 0.2840 | −0.1839 | 0.2671 | −0.4770 | −0.1839 |
| −0.7836 | 0.3488 | −0.1839 | 0.3158 | −0.5252 | −0.1839 |
| −0.8125 | 0.4123 | −0.1839 | 0.3634 | −0.5713 | −0.1839 |
| −0.8382 | 0.4743 | −0.1839 | 0.4094 | −0.6152 | −0.1839 |
| −0.8613 | 0.5347 | −0.1839 | 0.4539 | −0.6569 | −0.1839 |
| −0.8819 | 0.5932 | −0.1839 | 0.4975 | −0.6960 | −0.1839 |
| −0.8997 | 0.6501 | −0.1839 | 0.5379 | −0.7308 | −0.1839 |
| −0.9147 | 0.7023 | −0.1839 | 0.5752 | −0.7617 | −0.1839 |
| −0.9269 | 0.7497 | −0.1839 | 0.6089 | −0.7888 | −0.1839 |
| −0.9364 | 0.7921 | −0.1839 | 0.6391 | −0.8123 | −0.1839 |
| −0.9440 | 0.8321 | −0.1839 | 0.6655 | −0.8322 | −0.1839 |
| −0.9494 | 0.8671 | −0.1839 | 0.6880 | −0.8488 | −0.1839 |
| −0.9520 | 0.8941 | −0.1839 | 0.7073 | −0.8629 | −0.1839 |
| −0.9510 | 0.9156 | −0.1839 | 0.7237 | −0.8745 | −0.1839 |
| −0.9468 | 0.9314 | −0.1839 | 0.7374 | −0.8840 | −0.1839 |
| −0.9409 | 0.9420 | −0.1839 | 0.7469 | −0.8930 | −0.1839 |
| −0.9361 | 0.9470 | −0.1839 | 0.7511 | −0.9022 | −0.1839 |
| −0.9325 | 0.9494 | −0.1839 | 0.7520 | −0.9097 | −0.1839 |
| −0.9305 | 0.9504 | −0.1839 | 0.7512 | −0.9160 | −0.1839 |
| −0.9295 | 0.9508 | −0.1839 | 0.7496 | −0.9207 | −0.1839 |
| 0.7440 | −0.8843 | 0.0000 | −0.9390 | 0.9858 | 0.0000 |
| 0.7417 | −0.8876 | 0.0000 | −0.9385 | 0.9860 | 0.0000 |
| 0.7378 | −0.8912 | 0.0000 | −0.9376 | 0.9863 | 0.0000 |
| 0.7321 | −0.8947 | 0.0000 | −0.9355 | 0.9869 | 0.0000 |
| 0.7244 | −0.8969 | 0.0000 | −0.9315 | 0.9875 | 0.0000 |
| 0.7138 | −0.8965 | 0.0000 | −0.9251 | 0.9873 | 0.0000 |
| 0.7012 | −0.8906 | 0.0000 | −0.9141 | 0.9840 | 0.0000 |
| 0.6859 | −0.8822 | 0.0000 | −0.9009 | 0.9763 | 0.0000 |

TABLE 8-continued

| SUCTION SIDE | | | PRESSURE SIDE | | |
|---|---|---|---|---|---|
| X | Y | Z | X | Y | Z |
| 0.6674 | −0.8720 | 0.0000 | −0.8860 | 0.9626 | 0.0000 |
| 0.6453 | −0.8598 | 0.0000 | −0.8697 | 0.9431 | 0.0000 |
| 0.6195 | −0.8457 | 0.0000 | −0.8501 | 0.9165 | 0.0000 |
| 0.5890 | −0.8290 | 0.0000 | −0.8279 | 0.8855 | 0.0000 |
| 0.5537 | −0.8096 | 0.0000 | −0.8044 | 0.8523 | 0.0000 |
| 0.5138 | −0.7877 | 0.0000 | −0.7781 | 0.8149 | 0.0000 |
| 0.4692 | −0.7632 | 0.0000 | −0.7488 | 0.7733 | 0.0000 |
| 0.4198 | −0.7361 | 0.0000 | −0.7164 | 0.7278 | 0.0000 |
| 0.3657 | −0.7066 | 0.0000 | −0.6822 | 0.6804 | 0.0000 |
| 0.3094 | −0.6757 | 0.0000 | −0.6461 | 0.6313 | 0.0000 |
| 0.2513 | −0.6425 | 0.0000 | −0.6079 | 0.5805 | 0.0000 |
| 0.1914 | −0.6069 | 0.0000 | −0.5677 | 0.5282 | 0.0000 |
| 0.1299 | −0.5688 | 0.0000 | −0.5253 | 0.4742 | 0.0000 |
| 0.0669 | −0.5281 | 0.0000 | −0.4807 | 0.4187 | 0.0000 |
| 0.0026 | −0.4844 | 0.0000 | −0.4341 | 0.3618 | 0.0000 |
| −0.0626 | −0.4377 | 0.0000 | −0.3853 | 0.3032 | 0.0000 |
| −0.1263 | −0.3894 | 0.0000 | −0.3361 | 0.2448 | 0.0000 |
| −0.1884 | −0.3396 | 0.0000 | −0.2868 | 0.1866 | 0.0000 |
| −0.2489 | −0.2880 | 0.0000 | −0.2372 | 0.1287 | 0.0000 |
| −0.3076 | −0.2347 | 0.0000 | −0.1874 | 0.0709 | 0.0000 |
| −0.3647 | −0.1794 | 0.0000 | −0.1373 | 0.0136 | 0.0000 |
| −0.4199 | −0.1224 | 0.0000 | −0.0868 | −0.0436 | 0.0000 |
| −0.4734 | −0.0634 | 0.0000 | −0.0360 | −0.1006 | 0.0000 |
| −0.5248 | −0.0025 | 0.0000 | 0.0150 | −0.1573 | 0.0000 |
| −0.5742 | 0.0606 | 0.0000 | 0.0663 | −0.2137 | 0.0000 |
| −0.6215 | 0.1260 | 0.0000 | 0.1180 | −0.2697 | 0.0000 |
| −0.6663 | 0.1932 | 0.0000 | 0.1702 | −0.3253 | 0.0000 |
| −0.7073 | 0.2597 | 0.0000 | 0.2211 | −0.3787 | 0.0000 |
| −0.7447 | 0.3252 | 0.0000 | 0.2705 | −0.4298 | 0.0000 |
| −0.7785 | 0.3896 | 0.0000 | 0.3187 | −0.4786 | 0.0000 |
| −0.8092 | 0.4526 | 0.0000 | 0.3656 | −0.5254 | 0.0000 |
| −0.8365 | 0.5141 | 0.0000 | 0.4110 | −0.5699 | 0.0000 |
| −0.8612 | 0.5739 | 0.0000 | 0.4549 | −0.6122 | 0.0000 |
| −0.8833 | 0.6318 | 0.0000 | 0.4977 | −0.6519 | 0.0000 |
| −0.9026 | 0.6879 | 0.0000 | 0.5377 | −0.6874 | 0.0000 |
| −0.9188 | 0.7393 | 0.0000 | 0.5743 | −0.7189 | 0.0000 |
| −0.9321 | 0.7859 | 0.0000 | 0.6076 | −0.7465 | 0.0000 |
| −0.9426 | 0.8278 | 0.0000 | 0.6372 | −0.7705 | 0.0000 |
| −0.9512 | 0.8673 | 0.0000 | 0.6632 | −0.7910 | 0.0000 |
| −0.9574 | 0.9018 | 0.0000 | 0.6853 | −0.8081 | 0.0000 |
| −0.9606 | 0.9286 | 0.0000 | 0.7044 | −0.8226 | 0.0000 |
| −0.9600 | 0.9500 | 0.0000 | 0.7205 | −0.8346 | 0.0000 |
| −0.9562 | 0.9656 | 0.0000 | 0.7337 | −0.8444 | 0.0000 |
| −0.9505 | 0.9764 | 0.0000 | 0.7433 | −0.8533 | 0.0000 |
| −0.9459 | 0.9815 | 0.0000 | 0.7476 | −0.8625 | 0.0000 |
| −0.9424 | 0.9841 | 0.0000 | 0.7484 | −0.8701 | 0.0000 |
| −0.9405 | 0.9852 | 0.0000 | 0.7476 | −0.8763 | 0.0000 |
| −0.9395 | 0.9856 | 0.0000 | 0.7459 | −0.8811 | 0.0000 |
| 0.7417 | −0.8604 | 0.1116 | −0.9450 | 1.0068 | 0.1116 |
| 0.7392 | −0.8635 | 0.1116 | −0.9446 | 1.0070 | 0.1116 |
| 0.7352 | −0.8672 | 0.1116 | −0.9436 | 1.0073 | 0.1116 |
| 0.7295 | −0.8704 | 0.1116 | −0.9416 | 1.0080 | 0.1116 |
| 0.7218 | −0.8724 | 0.1116 | −0.9376 | 1.0087 | 0.1116 |
| 0.7112 | −0.8716 | 0.1116 | −0.9312 | 1.0086 | 0.1116 |
| 0.6988 | −0.8654 | 0.1116 | −0.9200 | 1.0057 | 0.1116 |
| 0.6838 | −0.8568 | 0.1116 | −0.9068 | 0.9982 | 0.1116 |
| 0.6655 | −0.8462 | 0.1116 | −0.8914 | 0.9850 | 0.1116 |
| 0.6436 | −0.8338 | 0.1116 | −0.8746 | 0.9660 | 0.1116 |
| 0.6181 | −0.8192 | 0.1116 | −0.8544 | 0.9398 | 0.1116 |
| 0.5879 | −0.8020 | 0.1116 | −0.8315 | 0.9093 | 0.1116 |
| 0.5531 | −0.7823 | 0.1116 | −0.8073 | 0.8766 | 0.1116 |
| 0.5136 | −0.7600 | 0.1116 | −0.7804 | 0.8397 | 0.1116 |
| 0.4693 | −0.7351 | 0.1116 | −0.7504 | 0.7986 | 0.1116 |
| 0.4205 | −0.7076 | 0.1116 | −0.7173 | 0.7535 | 0.1116 |
| 0.3668 | −0.6776 | 0.1116 | −0.6824 | 0.7066 | 0.1116 |
| 0.3109 | −0.6462 | 0.1116 | −0.6456 | 0.6581 | 0.1116 |
| 0.2532 | −0.6127 | 0.1116 | −0.6069 | 0.6076 | 0.1116 |
| 0.1937 | −0.5768 | 0.1116 | −0.5662 | 0.5556 | 0.1116 |
| 0.1326 | −0.5385 | 0.1116 | −0.5234 | 0.5020 | 0.1116 |
| 0.0700 | −0.4976 | 0.1116 | −0.4785 | 0.4469 | 0.1116 |
| 0.0060 | −0.4538 | 0.1116 | −0.4316 | 0.3901 | 0.1116 |
| −0.0588 | −0.4071 | 0.1116 | −0.3825 | 0.3318 | 0.1116 |
| −0.1221 | −0.3588 | 0.1116 | −0.3332 | 0.2737 | 0.1116 |
| −0.1839 | −0.3091 | 0.1116 | −0.2836 | 0.2158 | 0.1116 |
| −0.2442 | −0.2577 | 0.1116 | −0.2339 | 0.1580 | 0.1116 |
| −0.3027 | −0.2044 | 0.1116 | −0.1839 | 0.1004 | 0.1116 |

TABLE 8-continued

| SUCTION SIDE | | | PRESSURE SIDE | | |
|---|---|---|---|---|---|
| X | Y | Z | X | Y | Z |
| −0.3596 | −0.1494 | 0.1116 | −0.1337 | 0.0430 | 0.1116 |
| −0.4147 | −0.0927 | 0.1116 | −0.0832 | −0.0140 | 0.1116 |
| −0.4681 | −0.0341 | 0.1116 | −0.0325 | −0.0709 | 0.1116 |
| −0.5196 | 0.0266 | 0.1116 | 0.0184 | −0.1278 | 0.1116 |
| −0.5690 | 0.0892 | 0.1116 | 0.0696 | −0.1843 | 0.1116 |
| −0.6164 | 0.1541 | 0.1116 | 0.1211 | −0.2404 | 0.1116 |
| −0.6618 | 0.2207 | 0.1116 | 0.1730 | −0.2963 | 0.1116 |
| −0.7033 | 0.2865 | 0.1116 | 0.2235 | −0.3500 | 0.1116 |
| −0.7412 | 0.3514 | 0.1116 | 0.2727 | −0.4015 | 0.1116 |
| −0.7759 | 0.4151 | 0.1116 | 0.3205 | −0.4506 | 0.1116 |
| −0.8074 | 0.4774 | 0.1116 | 0.3669 | −0.4976 | 0.1116 |
| −0.8356 | 0.5383 | 0.1116 | 0.4118 | −0.5425 | 0.1116 |
| −0.8611 | 0.5975 | 0.1116 | 0.4554 | −0.5853 | 0.1116 |
| −0.8841 | 0.6549 | 0.1116 | 0.4979 | −0.6254 | 0.1116 |
| −0.9043 | 0.7104 | 0.1116 | 0.5374 | −0.6612 | 0.1116 |
| −0.9213 | 0.7615 | 0.1116 | 0.5738 | −0.6931 | 0.1116 |
| −0.9353 | 0.8078 | 0.1116 | 0.6067 | −0.7211 | 0.1116 |
| −0.9464 | 0.8493 | 0.1116 | 0.6361 | −0.7454 | 0.1116 |
| −0.9556 | 0.8885 | 0.1116 | 0.6618 | −0.7662 | 0.1116 |
| −0.9624 | 0.9228 | 0.1116 | 0.6837 | −0.7836 | 0.1116 |
| −0.9658 | 0.9494 | 0.1116 | 0.7025 | −0.7983 | 0.1116 |
| −0.9654 | 0.9709 | 0.1116 | 0.7183 | −0.8106 | 0.1116 |
| −0.9618 | 0.9866 | 0.1116 | 0.7315 | −0.8206 | 0.1116 |
| −0.9562 | 0.9973 | 0.1116 | 0.7411 | −0.8295 | 0.1116 |
| −0.9518 | 1.0024 | 0.1116 | 0.7454 | −0.8386 | 0.1116 |
| −0.9484 | 1.0050 | 0.1116 | 0.7462 | −0.8461 | 0.1116 |
| −0.9465 | 1.0061 | 0.1116 | 0.7453 | −0.8524 | 0.1116 |
| −0.9456 | 1.0065 | 0.1116 | 0.7435 | −0.8571 | 0.1116 |
| 0.7354 | −0.8265 | 0.3010 | −0.9544 | 1.0372 | 0.3010 |
| 0.7329 | −0.8296 | 0.3010 | −0.9540 | 1.0373 | 0.3010 |
| 0.7288 | −0.8330 | 0.3010 | −0.9530 | 1.0378 | 0.3010 |
| 0.7229 | −0.8360 | 0.3010 | −0.9511 | 1.0385 | 0.3010 |
| 0.7152 | −0.8376 | 0.3010 | −0.9471 | 1.0394 | 0.3010 |
| 0.7047 | −0.8360 | 0.3010 | −0.9407 | 1.0395 | 0.3010 |
| 0.6927 | −0.8291 | 0.3010 | −0.9295 | 1.0370 | 0.3010 |
| 0.6780 | −0.8200 | 0.3010 | −0.9158 | 1.0301 | 0.3010 |
| 0.6602 | −0.8090 | 0.3010 | −0.8999 | 1.0177 | 0.3010 |
| 0.6390 | −0.7959 | 0.3010 | −0.8823 | 0.9995 | 0.3010 |
| 0.6140 | −0.7806 | 0.3010 | −0.8610 | 0.9742 | 0.3010 |
| 0.5845 | −0.7627 | 0.3010 | −0.8370 | 0.9447 | 0.3010 |
| 0.5504 | −0.7422 | 0.3010 | −0.8117 | 0.9128 | 0.3010 |
| 0.5115 | −0.7190 | 0.3010 | −0.7836 | 0.8768 | 0.3010 |
| 0.4682 | −0.6932 | 0.3010 | −0.7524 | 0.8367 | 0.3010 |
| 0.4201 | −0.6648 | 0.3010 | −0.7180 | 0.7926 | 0.3010 |
| 0.3673 | −0.6340 | 0.3010 | −0.6820 | 0.7466 | 0.3010 |
| 0.3123 | −0.6017 | 0.3010 | −0.6442 | 0.6988 | 0.3010 |
| 0.2555 | −0.5674 | 0.3010 | −0.6046 | 0.6493 | 0.3010 |
| 0.1969 | −0.5309 | 0.3010 | −0.5630 | 0.5980 | 0.3010 |
| 0.1366 | −0.4920 | 0.3010 | −0.5196 | 0.5449 | 0.3010 |
| 0.0746 | −0.4506 | 0.3010 | −0.4741 | 0.4902 | 0.3010 |
| 0.0116 | −0.4066 | 0.3010 | −0.4266 | 0.4339 | 0.3010 |
| −0.0524 | −0.3597 | 0.3010 | −0.3772 | 0.3760 | 0.3010 |
| −0.1150 | −0.3113 | 0.3010 | −0.3275 | 0.3183 | 0.3010 |
| −0.1763 | −0.2616 | 0.3010 | −0.2776 | 0.2607 | 0.3010 |
| −0.2360 | −0.2104 | 0.3010 | −0.2277 | 0.2031 | 0.3010 |
| −0.2942 | −0.1574 | 0.3010 | −0.1776 | 0.1457 | 0.3010 |
| −0.3507 | −0.1028 | 0.3010 | −0.1272 | 0.0885 | 0.3010 |
| −0.4055 | −0.0465 | 0.3010 | −0.0768 | 0.0314 | 0.3010 |
| −0.4587 | 0.0116 | 0.3010 | −0.0263 | −0.0256 | 0.3010 |
| −0.5101 | 0.0715 | 0.3010 | 0.0242 | −0.0826 | 0.3010 |
| −0.5597 | 0.1333 | 0.3010 | 0.0750 | −0.1394 | 0.3010 |
| −0.6074 | 0.1971 | 0.3010 | 0.1260 | −0.1960 | 0.3010 |
| −0.6533 | 0.2627 | 0.3010 | 0.1773 | −0.2524 | 0.3010 |
| −0.6956 | 0.3274 | 0.3010 | 0.2271 | −0.3066 | 0.3010 |
| −0.7347 | 0.3912 | 0.3010 | 0.2756 | −0.3586 | 0.3010 |
| −0.7705 | 0.4537 | 0.3010 | 0.3227 | −0.4085 | 0.3010 |
| −0.8034 | 0.5150 | 0.3010 | 0.3683 | −0.4562 | 0.3010 |
| −0.8330 | 0.5748 | 0.3010 | 0.4125 | −0.5019 | 0.3010 |
| −0.8599 | 0.6330 | 0.3010 | 0.4552 | −0.5453 | 0.3010 |
| −0.8844 | 0.6893 | 0.3010 | 0.4968 | −0.5863 | 0.3010 |
| −0.9060 | 0.7440 | 0.3010 | 0.5357 | −0.6229 | 0.3010 |
| −0.9243 | 0.7940 | 0.3010 | 0.5713 | −0.6554 | 0.3010 |
| −0.9396 | 0.8396 | 0.3010 | 0.6035 | −0.6841 | 0.3010 |
| −0.9518 | 0.8806 | 0.3010 | 0.6323 | −0.7092 | 0.3010 |
| −0.9621 | 0.9193 | 0.3010 | 0.6574 | −0.7306 | 0.3010 |
| −0.9698 | 0.9532 | 0.3010 | 0.6788 | −0.7485 | 0.3010 |

TABLE 8-continued

| SUCTION SIDE | | | PRESSURE SIDE | | |
|---|---|---|---|---|---|
| X | Y | Z | X | Y | Z |
| −0.9737 | 0.9796 | 0.3010 | 0.6972 | −0.7638 | 0.3010 |
| −0.9737 | 1.0008 | 0.3010 | 0.7128 | −0.7764 | 0.3010 |
| −0.9706 | 1.0166 | 0.3010 | 0.7256 | −0.7868 | 0.3010 |
| −0.9654 | 1.0274 | 0.3010 | 0.7353 | −0.7958 | 0.3010 |
| −0.9610 | 1.0326 | 0.3010 | 0.7396 | −0.8048 | 0.3010 |
| −0.9577 | 1.0353 | 0.3010 | 0.7403 | −0.8124 | 0.3010 |
| −0.9559 | 1.0364 | 0.3010 | 0.7393 | −0.8186 | 0.3010 |
| −0.9550 | 1.0369 | 0.3010 | 0.7374 | −0.8232 | 0.3010 |
| 0.7294 | −0.8156 | 0.4071 | −0.9586 | 1.0489 | 0.4071 |
| 0.7268 | −0.8186 | 0.4071 | −0.9581 | 1.0490 | 0.4071 |
| 0.7227 | −0.8218 | 0.4071 | −0.9572 | 1.0495 | 0.4071 |
| 0.7168 | −0.8247 | 0.4071 | −0.9553 | 1.0502 | 0.4071 |
| 0.7089 | −0.8261 | 0.4071 | −0.9513 | 1.0512 | 0.4071 |
| 0.6986 | −0.8240 | 0.4071 | −0.9449 | 1.0514 | 0.4071 |
| 0.6869 | −0.8168 | 0.4071 | −0.9337 | 1.0491 | 0.4071 |
| 0.6725 | −0.8074 | 0.4071 | −0.9199 | 1.0426 | 0.4071 |
| 0.6549 | −0.7960 | 0.4071 | −0.9036 | 1.0306 | 0.4071 |
| 0.6340 | −0.7826 | 0.4071 | −0.8855 | 1.0128 | 0.4071 |
| 0.6094 | −0.7669 | 0.4071 | −0.8636 | 0.9881 | 0.4071 |
| 0.5804 | −0.7484 | 0.4071 | −0.8390 | 0.9590 | 0.4071 |
| 0.5467 | −0.7273 | 0.4071 | −0.8131 | 0.9277 | 0.4071 |
| 0.5086 | −0.7036 | 0.4071 | −0.7843 | 0.8922 | 0.4071 |
| 0.4657 | −0.6771 | 0.4071 | −0.7526 | 0.8526 | 0.4071 |
| 0.4183 | −0.6481 | 0.4071 | −0.7176 | 0.8092 | 0.4071 |
| 0.3662 | −0.6166 | 0.4071 | −0.6809 | 0.7637 | 0.4071 |
| 0.3118 | −0.5837 | 0.4071 | −0.6425 | 0.7163 | 0.4071 |
| 0.2556 | −0.5488 | 0.4071 | −0.6024 | 0.6672 | 0.4071 |
| 0.1976 | −0.5116 | 0.4071 | −0.5604 | 0.6163 | 0.4071 |
| 0.1379 | −0.4722 | 0.4071 | −0.5165 | 0.5636 | 0.4071 |
| 0.0766 | −0.4304 | 0.4071 | −0.4707 | 0.5093 | 0.4071 |
| 0.0142 | −0.3860 | 0.4071 | −0.4230 | 0.4533 | 0.4071 |
| −0.0492 | −0.3388 | 0.4071 | −0.3734 | 0.3955 | 0.4071 |
| −0.1113 | −0.2903 | 0.4071 | −0.3236 | 0.3379 | 0.4071 |
| −0.1720 | −0.2405 | 0.4071 | −0.2736 | 0.2804 | 0.4071 |
| −0.2314 | −0.1892 | 0.4071 | −0.2237 | 0.2229 | 0.4071 |
| −0.2893 | −0.1364 | 0.4071 | −0.1736 | 0.1655 | 0.4071 |
| −0.3454 | −0.0818 | 0.4071 | −0.1235 | 0.1082 | 0.4071 |
| −0.4000 | −0.0258 | 0.4071 | −0.0732 | 0.0510 | 0.4071 |
| −0.4530 | 0.0320 | 0.4071 | −0.0230 | −0.0062 | 0.4071 |
| −0.5043 | 0.0914 | 0.4071 | 0.0273 | −0.0634 | 0.4071 |
| −0.5539 | 0.1528 | 0.4071 | 0.0777 | −0.1205 | 0.4071 |
| −0.6017 | 0.2159 | 0.4071 | 0.1283 | −0.1774 | 0.4071 |
| −0.6477 | 0.2806 | 0.4071 | 0.1791 | −0.2342 | 0.4071 |
| −0.6905 | 0.3449 | 0.4071 | 0.2284 | −0.2888 | 0.4071 |
| −0.7300 | 0.4081 | 0.4071 | 0.2763 | −0.3414 | 0.4071 |
| −0.7665 | 0.4699 | 0.4071 | 0.3229 | −0.3917 | 0.4071 |
| −0.7999 | 0.5306 | 0.4071 | 0.3679 | −0.4399 | 0.4071 |
| −0.8303 | 0.5898 | 0.4071 | 0.4115 | −0.4860 | 0.4071 |
| −0.8580 | 0.6473 | 0.4071 | 0.4536 | −0.5300 | 0.4071 |
| −0.8833 | 0.7031 | 0.4071 | 0.4946 | −0.5716 | 0.4071 |
| −0.9056 | 0.7572 | 0.4071 | 0.5328 | −0.6088 | 0.4071 |
| −0.9247 | 0.8070 | 0.4071 | 0.5680 | −0.6419 | 0.4071 |
| −0.9406 | 0.8521 | 0.4071 | 0.5997 | −0.6711 | 0.4071 |
| −0.9536 | 0.8927 | 0.4071 | 0.6280 | −0.6966 | 0.4071 |
| −0.9644 | 0.9311 | 0.4071 | 0.6527 | −0.7184 | 0.4071 |
| −0.9726 | 0.9648 | 0.4071 | 0.6738 | −0.7368 | 0.4071 |
| −0.9769 | 0.9911 | 0.4071 | 0.6919 | −0.7523 | 0.4071 |
| −0.9772 | 1.0124 | 0.4071 | 0.7072 | −0.7653 | 0.4071 |
| −0.9742 | 1.0280 | 0.4071 | 0.7198 | −0.7760 | 0.4071 |
| −0.9693 | 1.0389 | 0.4071 | 0.7294 | −0.7850 | 0.4071 |
| −0.9651 | 1.0441 | 0.4071 | 0.7337 | −0.7940 | 0.4071 |
| −0.9618 | 1.0469 | 0.4071 | 0.7344 | −0.8015 | 0.4071 |
| −0.9601 | 1.0481 | 0.4071 | 0.7334 | −0.8078 | 0.4071 |
| −0.9591 | 1.0486 | 0.4071 | 0.7315 | −0.8123 | 0.4071 |
| 0.7171 | −0.8159 | 0.5548 | −0.9607 | 1.0576 | 0.5548 |
| 0.7144 | −0.8188 | 0.5548 | −0.9603 | 1.0578 | 0.5548 |
| 0.7102 | −0.8220 | 0.5548 | −0.9593 | 1.0582 | 0.5548 |
| 0.7042 | −0.8246 | 0.5548 | −0.9574 | 1.0590 | 0.5548 |
| 0.6964 | −0.8255 | 0.5548 | −0.9534 | 1.0600 | 0.5548 |
| 0.6863 | −0.8230 | 0.5548 | −0.9470 | 1.0604 | 0.5548 |
| 0.6749 | −0.8153 | 0.5548 | −0.9357 | 1.0583 | 0.5548 |
| 0.6608 | −0.8056 | 0.5548 | −0.9217 | 1.0520 | 0.5548 |
| 0.6436 | −0.7938 | 0.5548 | −0.9052 | 1.0404 | 0.5548 |
| 0.6231 | −0.7799 | 0.5548 | −0.8866 | 1.0232 | 0.5548 |
| 0.5992 | −0.7636 | 0.5548 | −0.8642 | 0.9990 | 0.5548 |
| 0.5708 | −0.7445 | 0.5548 | −0.8390 | 0.9705 | 0.5548 |

TABLE 8-continued

| SUCTION SIDE | | | PRESSURE SIDE | | |
|---|---|---|---|---|---|
| X | Y | Z | X | Y | Z |
| 0.5379 | −0.7226 | 0.5548 | −0.8125 | 0.9397 | 0.5548 |
| 0.5005 | −0.6979 | 0.5548 | −0.7831 | 0.9047 | 0.5548 |
| 0.4586 | −0.6705 | 0.5548 | −0.7507 | 0.8657 | 0.5548 |
| 0.4121 | −0.6405 | 0.5548 | −0.7151 | 0.8227 | 0.5548 |
| 0.3610 | −0.6079 | 0.5548 | −0.6779 | 0.7777 | 0.5548 |
| 0.3076 | −0.5738 | 0.5548 | −0.6391 | 0.7308 | 0.5548 |
| 0.2525 | −0.5379 | 0.5548 | −0.5984 | 0.6821 | 0.5548 |
| 0.1955 | −0.4998 | 0.5548 | −0.5561 | 0.6316 | 0.5548 |
| 0.1369 | −0.4594 | 0.5548 | −0.5119 | 0.5792 | 0.5548 |
| 0.0767 | −0.4168 | 0.5548 | −0.4659 | 0.5250 | 0.5548 |
| 0.0154 | −0.3716 | 0.5548 | −0.4181 | 0.4691 | 0.5548 |
| −0.0471 | −0.3238 | 0.5548 | −0.3685 | 0.4114 | 0.5548 |
| −0.1082 | −0.2746 | 0.5548 | −0.3187 | 0.3538 | 0.5548 |
| −0.1683 | −0.2243 | 0.5548 | −0.2690 | 0.2961 | 0.5548 |
| −0.2269 | −0.1726 | 0.5548 | −0.2193 | 0.2385 | 0.5548 |
| −0.2841 | −0.1193 | 0.5548 | −0.1696 | 0.1808 | 0.5548 |
| −0.3397 | −0.0646 | 0.5548 | −0.1198 | 0.1232 | 0.5548 |
| −0.3939 | −0.0083 | 0.5548 | −0.0700 | 0.0656 | 0.5548 |
| −0.4466 | 0.0496 | 0.5548 | −0.0203 | 0.0079 | 0.5548 |
| −0.4977 | 0.1090 | 0.5548 | 0.0292 | −0.0498 | 0.5548 |
| −0.5472 | 0.1702 | 0.5548 | 0.0789 | −0.1074 | 0.5548 |
| −0.5951 | 0.2330 | 0.5548 | 0.1287 | −0.1650 | 0.5548 |
| −0.6413 | 0.2975 | 0.5548 | 0.1787 | −0.2225 | 0.5548 |
| −0.6842 | 0.3612 | 0.5548 | 0.2271 | −0.2779 | 0.5548 |
| −0.7240 | 0.4236 | 0.5548 | 0.2741 | −0.3311 | 0.5548 |
| −0.7608 | 0.4849 | 0.5548 | 0.3197 | −0.3824 | 0.5548 |
| −0.7946 | 0.5448 | 0.5548 | 0.3638 | −0.4314 | 0.5548 |
| −0.8256 | 0.6032 | 0.5548 | 0.4064 | −0.4784 | 0.5548 |
| −0.8540 | 0.6601 | 0.5548 | 0.4476 | −0.5232 | 0.5548 |
| −0.8799 | 0.7153 | 0.5548 | 0.4876 | −0.5657 | 0.5548 |
| −0.9031 | 0.7687 | 0.5548 | 0.5249 | −0.6038 | 0.5548 |
| −0.9229 | 0.8177 | 0.5548 | 0.5591 | −0.6377 | 0.5548 |
| −0.9396 | 0.8623 | 0.5548 | 0.5900 | −0.6678 | 0.5548 |
| −0.9531 | 0.9025 | 0.5548 | 0.6177 | −0.6941 | 0.5548 |
| −0.9646 | 0.9405 | 0.5548 | 0.6418 | −0.7166 | 0.5548 |
| −0.9734 | 0.9738 | 0.5548 | 0.6623 | −0.7355 | 0.5548 |
| −0.9779 | 0.9999 | 0.5548 | 0.6800 | −0.7515 | 0.5548 |
| −0.9786 | 1.0210 | 0.5548 | 0.6949 | −0.7649 | 0.5548 |
| −0.9759 | 1.0366 | 0.5548 | 0.7073 | −0.7759 | 0.5548 |
| −0.9711 | 1.0476 | 0.5548 | 0.7168 | −0.7849 | 0.5548 |
| −0.9670 | 1.0528 | 0.5548 | 0.7215 | −0.7939 | 0.5548 |
| −0.9639 | 1.0556 | 0.5548 | 0.7224 | −0.8016 | 0.5548 |
| −0.9621 | 1.0568 | 0.5548 | 0.7212 | −0.8079 | 0.5548 |
| −0.9611 | 1.0573 | 0.5548 | 0.7192 | −0.8127 | 0.5548 |
| 0.7004 | −0.8331 | 0.7026 | −0.9570 | 1.0590 | 0.7026 |
| 0.6977 | −0.8359 | 0.7026 | −0.9565 | 1.0593 | 0.7026 |
| 0.6934 | −0.8390 | 0.7026 | −0.9556 | 1.0597 | 0.7026 |
| 0.6873 | −0.8414 | 0.7026 | −0.9537 | 1.0604 | 0.7026 |
| 0.6794 | −0.8419 | 0.7026 | −0.9497 | 1.0615 | 0.7026 |
| 0.6695 | −0.8388 | 0.7026 | −0.9433 | 1.0618 | 0.7026 |
| 0.6584 | −0.8309 | 0.7026 | −0.9320 | 1.0598 | 0.7026 |
| 0.6446 | −0.8209 | 0.7026 | −0.9180 | 1.0536 | 0.7026 |
| 0.6277 | −0.8088 | 0.7026 | −0.9013 | 1.0422 | 0.7026 |
| 0.6076 | −0.7945 | 0.7026 | −0.8826 | 1.0251 | 0.7026 |
| 0.5841 | −0.7777 | 0.7026 | −0.8600 | 1.0011 | 0.7026 |
| 0.5562 | −0.7581 | 0.7026 | −0.8346 | 0.9727 | 0.7026 |
| 0.5239 | −0.7355 | 0.7026 | −0.8080 | 0.9420 | 0.7026 |
| 0.4872 | −0.7101 | 0.7026 | −0.7784 | 0.9072 | 0.7026 |
| 0.4462 | −0.6817 | 0.7026 | −0.7459 | 0.8683 | 0.7026 |
| 0.4006 | −0.6507 | 0.7026 | −0.7102 | 0.8254 | 0.7026 |
| 0.3505 | −0.6169 | 0.7026 | −0.6729 | 0.7804 | 0.7026 |
| 0.2983 | −0.5816 | 0.7026 | −0.6340 | 0.7336 | 0.7026 |
| 0.2441 | −0.5445 | 0.7026 | −0.5935 | 0.6847 | 0.7026 |
| 0.1882 | −0.5053 | 0.7026 | −0.5512 | 0.6340 | 0.7026 |
| 0.1307 | −0.4638 | 0.7026 | −0.5072 | 0.5815 | 0.7026 |
| 0.0717 | −0.4201 | 0.7026 | −0.4615 | 0.5271 | 0.7026 |
| 0.0114 | −0.3738 | 0.7026 | −0.4140 | 0.4710 | 0.7026 |
| −0.0499 | −0.3250 | 0.7026 | −0.3648 | 0.4129 | 0.7026 |
| −0.1100 | −0.2749 | 0.7026 | −0.3155 | 0.3548 | 0.7026 |
| −0.1690 | −0.2237 | 0.7026 | −0.2663 | 0.2967 | 0.7026 |
| −0.2267 | −0.1712 | 0.7026 | −0.2171 | 0.2387 | 0.7026 |
| −0.2830 | −0.1172 | 0.7026 | −0.1680 | 0.1805 | 0.7026 |
| −0.3379 | −0.0617 | 0.7026 | −0.1188 | 0.1223 | 0.7026 |
| −0.3913 | −0.0048 | 0.7026 | −0.0698 | 0.0641 | 0.7026 |
| −0.4433 | 0.0536 | 0.7026 | −0.0209 | 0.0057 | 0.7026 |
| −0.4939 | 0.1135 | 0.7026 | 0.0279 | −0.0527 | 0.7026 |

TABLE 8-continued

| SUCTION SIDE | | | PRESSURE SIDE | | |
|---|---|---|---|---|---|
| X | Y | Z | X | Y | Z |
| −0.5429 | 0.1749 | 0.7026 | 0.0767 | −0.1111 | 0.7026 |
| −0.5903 | 0.2380 | 0.7026 | 0.1256 | −0.1695 | 0.7026 |
| −0.6361 | 0.3025 | 0.7026 | 0.1745 | −0.2278 | 0.7026 |
| −0.6787 | 0.3660 | 0.7026 | 0.2219 | −0.2842 | 0.7026 |
| −0.7182 | 0.4283 | 0.7026 | 0.2679 | −0.3383 | 0.7026 |
| −0.7548 | 0.4894 | 0.7026 | 0.3124 | −0.3904 | 0.7026 |
| −0.7886 | 0.5490 | 0.7026 | 0.3555 | −0.4404 | 0.7026 |
| −0.8196 | 0.6071 | 0.7026 | 0.3971 | −0.4882 | 0.7026 |
| −0.8481 | 0.6637 | 0.7026 | 0.4374 | −0.5339 | 0.7026 |
| −0.8740 | 0.7184 | 0.7026 | 0.4766 | −0.5772 | 0.7026 |
| −0.8974 | 0.7716 | 0.7026 | 0.5130 | −0.6161 | 0.7026 |
| −0.9175 | 0.8203 | 0.7026 | 0.5464 | −0.6509 | 0.7026 |
| −0.9345 | 0.8647 | 0.7026 | 0.5766 | −0.6817 | 0.7026 |
| −0.9483 | 0.9046 | 0.7026 | 0.6034 | −0.7088 | 0.7026 |
| −0.9600 | 0.9424 | 0.7026 | 0.6270 | −0.7319 | 0.7026 |
| −0.9690 | 0.9755 | 0.7026 | 0.6470 | −0.7513 | 0.7026 |
| −0.9737 | 1.0014 | 0.7026 | 0.6642 | −0.7679 | 0.7026 |
| −0.9744 | 1.0224 | 0.7026 | 0.6787 | −0.7817 | 0.7026 |
| −0.9720 | 1.0380 | 0.7026 | 0.6907 | 0.7930 | 0.7026 |
| −0.9673 | 1.0490 | 0.7026 | 0.7002 | −0.8021 | 0.7026 |
| −0.9632 | 1.0542 | 0.7026 | 0.7050 | −0.8112 | 0.7026 |
| −0.9601 | 1.0571 | 0.7026 | 0.7058 | −0.8188 | 0.7026 |
| −0.9584 | 1.0582 | 0.7026 | 0.7047 | −0.8252 | 0.7026 |
| −0.9574 | 1.0587 | 0.7026 | 0.7026 | −0.8299 | 0.7026 |
| 0.6613 | −0.8836 | 0.9982 | −0.9407 | 1.0574 | 0.9982 |
| 0.6585 | −0.8863 | 0.9982 | −0.9402 | 1.0576 | 0.9982 |
| 0.6541 | −0.8891 | 0.9982 | −0.9393 | 1.0580 | 0.9982 |
| 0.6479 | −0.8910 | 0.9982 | −0.9374 | 1.0588 | 0.9982 |
| 0.6400 | −0.8908 | 0.9982 | −0.9334 | 1.0597 | 0.9982 |
| 0.6306 | −0.8865 | 0.9982 | −0.9270 | 1.0600 | 0.9982 |
| 0.6198 | −0.8782 | 0.9982 | −0.9157 | 1.0576 | 0.9982 |
| 0.6061 | −0.8679 | 0.9982 | −0.9018 | 1.0511 | 0.9982 |
| 0.5897 | −0.8554 | 0.9982 | −0.8854 | 1.0394 | 0.9982 |
| 0.5701 | −0.8406 | 0.9982 | −0.8668 | 1.0220 | 0.9982 |
| 0.5471 | −0.8232 | 0.9982 | −0.8445 | 0.9977 | 0.9982 |
| 0.5199 | −0.8026 | 0.9982 | −0.8195 | 0.9690 | 0.9982 |
| 0.4885 | −0.7790 | 0.9982 | −0.7933 | 0.9379 | 0.9982 |
| 0.4529 | −0.7521 | 0.9982 | −0.7644 | 0.9026 | 0.9982 |
| 0.4132 | −0.7222 | 0.9982 | −0.7323 | 0.8631 | 0.9982 |
| 0.3692 | −0.6890 | 0.9982 | −0.6974 | 0.8195 | 0.9982 |
| 0.3212 | −0.6527 | 0.9982 | −0.6609 | 0.7740 | 0.9982 |
| 0.2711 | −0.6147 | 0.9982 | −0.6229 | 0.7264 | 0.9982 |
| 0.2189 | −0.5752 | 0.9982 | −0.5832 | 0.6768 | 0.9982 |
| 0.1648 | −0.5337 | 0.9982 | −0.5420 | 0.6252 | 0.9982 |
| 0.1093 | −0.4899 | 0.9982 | −0.4990 | 0.5717 | 0.9982 |
| 0.0524 | −0.4438 | 0.9982 | −0.4545 | 0.5163 | 0.9982 |
| −0.0056 | −0.3953 | 0.9982 | −0.4083 | 0.4590 | 0.9982 |
| −0.0647 | −0.3442 | 0.9982 | −0.3605 | 0.3997 | 0.9982 |
| −0.1226 | −0.2920 | 0.9982 | −0.3127 | 0.3404 | 0.9982 |
| −0.1793 | −0.2387 | 0.9982 | −0.2649 | 0.2811 | 0.9982 |
| −0.2348 | −0.1842 | 0.9982 | −0.2173 | 0.2216 | 0.9982 |
| −0.2888 | −0.1285 | 0.9982 | −0.1697 | 0.1621 | 0.9982 |
| −0.3414 | −0.0715 | 0.9982 | −0.1221 | 0.1026 | 0.9982 |
| −0.3927 | −0.0131 | 0.9982 | −0.0748 | 0.0429 | 0.9982 |
| −0.4425 | 0.0466 | 0.9982 | −0.0277 | −0.0170 | 0.9982 |
| −0.4910 | 0.1074 | 0.9982 | 0.0193 | −0.0770 | 0.9982 |
| −0.5379 | 0.1697 | 0.9982 | 0.0661 | −0.1370 | 0.9982 |
| −0.5834 | 0.2333 | 0.9982 | 0.1130 | −0.1971 | 0.9982 |
| −0.6274 | 0.2983 | 0.9982 | 0.1599 | −0.2571 | 0.9982 |
| −0.6685 | 0.3623 | 0.9982 | 0.2052 | −0.3151 | 0.9982 |
| −0.7069 | 0.4253 | 0.9982 | 0.2492 | −0.3710 | 0.9982 |
| −0.7425 | 0.4867 | 0.9982 | 0.2917 | −0.4248 | 0.9982 |
| −0.7753 | 0.5467 | 0.9982 | 0.3327 | −0.4765 | 0.9982 |
| −0.8056 | 0.6052 | 0.9982 | 0.3727 | −0.5259 | 0.9982 |
| −0.8334 | 0.6619 | 0.9982 | 0.4116 | −0.5728 | 0.9982 |
| −0.8588 | 0.7168 | 0.9982 | 0.4494 | −0.6173 | 0.9982 |
| −0.8818 | 0.7701 | 0.9982 | 0.4842 | −0.6577 | 0.9982 |
| −0.9015 | 0.8188 | 0.9982 | 0.5159 | −0.6941 | 0.9982 |
| −0.9182 | 0.8632 | 0.9982 | 0.5446 | −0.7264 | 0.9982 |
| −0.9318 | 0.9031 | 0.9982 | 0.5702 | −0.7547 | 0.9982 |
| −0.9435 | 0.9408 | 0.9982 | 0.5924 | −0.7791 | 0.9982 |
| −0.9523 | 0.9738 | 0.9982 | 0.6112 | −0.7997 | 0.9982 |
| −0.9570 | 0.9997 | 0.9982 | 0.6275 | −0.8172 | 0.9982 |
| −0.9578 | 1.0207 | 0.9982 | 0.6412 | −0.8319 | 0.9982 |
| −0.9554 | 1.0364 | 0.9982 | 0.6525 | −0.8438 | 0.9982 |
| −0.9509 | 1.0473 | 0.9982 | 0.6615 | −0.8535 | 0.9982 |

TABLE 8-continued

| SUCTION SIDE | | | PRESSURE SIDE | | |
|---|---|---|---|---|---|
| X | Y | Z | X | Y | Z |
| −0.9471 | 1.0526 | 0.9982 | 0.6662 | −0.8623 | 0.9982 |
| −0.9439 | 1.0554 | 0.9982 | 0.6670 | −0.8699 | 0.9982 |
| −0.9421 | 1.0566 | 0.9982 | 0.6658 | −0.8760 | 0.9982 |
| −0.9412 | 1.0571 | 0.9982 | 0.6636 | −0.8805 | 0.9982 |
| 0.6286 | −0.9507 | 1.2910 | −0.9189 | 1.0372 | 1.2910 |
| 0.6256 | −0.9532 | 1.2910 | −0.9185 | 1.0373 | 1.2910 |
| 0.6210 | −0.9557 | 1.2910 | −0.9175 | 1.0378 | 1.2910 |
| 0.6146 | −0.9571 | 1.2910 | −0.9156 | 1.0385 | 1.2910 |
| 0.6068 | −0.9560 | 1.2910 | −0.9115 | 1.0392 | 1.2910 |
| 0.5981 | −0.9504 | 1.2910 | −0.9051 | 1.0391 | 1.2910 |
| 0.5877 | −0.9417 | 1.2910 | −0.8940 | 1.0362 | 1.2910 |
| 0.5746 | −0.9308 | 1.2910 | −0.8804 | 1.0291 | 1.2910 |
| 0.5586 | −0.9177 | 1.2910 | −0.8643 | 1.0167 | 1.2910 |
| 0.5396 | −0.9020 | 1.2910 | −0.8464 | 0.9988 | 1.2910 |
| 0.5174 | −0.8838 | 1.2910 | −0.8247 | 0.9738 | 1.2910 |
| 0.4910 | −0.8623 | 1.2910 | −0.8006 | 0.9443 | 1.2910 |
| 0.4604 | −0.8376 | 1.2910 | −0.7755 | 0.9125 | 1.2910 |
| 0.4257 | −0.8098 | 1.2910 | −0.7474 | 0.8763 | 1.2910 |
| 0.3868 | −0.7789 | 1.2910 | −0.7166 | 0.8359 | 1.2910 |
| 0.3436 | −0.7449 | 1.2910 | −0.6828 | 0.7915 | 1.2910 |
| 0.2964 | −0.7074 | 1.2910 | −0.6475 | 0.7448 | 1.2910 |
| 0.2475 | −0.6681 | 1.2910 | −0.6107 | 0.6963 | 1.2910 |
| 0.1967 | −0.6268 | 1.2910 | −0.5724 | 0.6456 | 1.2910 |
| 0.1442 | −0.5834 | 1.2910 | −0.5326 | 0.5929 | 1.2910 |
| 0.0905 | −0.5379 | 1.2910 | −0.4911 | 0.5383 | 1.2910 |
| 0.0354 | −0.4898 | 1.2910 | −0.4480 | 0.4817 | 1.2910 |
| −0.0208 | −0.4394 | 1.2910 | −0.4033 | 0.4232 | 1.2910 |
| −0.0778 | −0.3862 | 1.2910 | −0.3571 | 0.3626 | 1.2910 |
| −0.1337 | −0.3322 | 1.2910 | −0.3107 | 0.3021 | 1.2910 |
| −0.1884 | −0.2770 | 1.2910 | −0.2645 | 0.2416 | 1.2910 |
| −0.2418 | −0.2208 | 1.2910 | −0.2183 | 0.1809 | 1.2910 |
| −0.2938 | −0.1633 | 1.2910 | −0.1722 | 0.1202 | 1.2910 |
| −0.3443 | −0.1046 | 1.2910 | −0.1263 | 0.0594 | 1.2910 |
| −0.3935 | −0.0448 | 1.2910 | −0.0804 | −0.0014 | 1.2910 |
| −0.4413 | 0.0163 | 1.2910 | −0.0348 | −0.0626 | 1.2910 |
| −0.4878 | 0.0786 | 1.2910 | 0.0105 | −0.1237 | 1.2910 |
| −0.5328 | 0.1420 | 1.2910 | 0.0557 | −0.1851 | 1.2910 |
| −0.5763 | 0.2068 | 1.2910 | 0.1009 | −0.2464 | 1.2910 |
| −0.6186 | 0.2727 | 1.2910 | 0.1462 | −0.3077 | 1.2910 |
| −0.6580 | 0.3377 | 1.2910 | 0.1899 | −0.3670 | 1.2910 |
| −0.6948 | 0.4014 | 1.2910 | 0.2322 | −0.4242 | 1.2910 |
| −0.7289 | 0.4636 | 1.2910 | 0.2732 | −0.4792 | 1.2910 |
| −0.7605 | 0.5242 | 1.2910 | 0.3127 | −0.5321 | 1.2910 |
| −0.7895 | 0.5832 | 1.2910 | 0.3509 | −0.5828 | 1.2910 |
| −0.8162 | 0.6404 | 1.2910 | 0.3880 | −0.6312 | 1.2910 |
| −0.8406 | 0.6957 | 1.2910 | 0.4237 | −0.6774 | 1.2910 |
| −0.8627 | 0.7491 | 1.2910 | 0.4567 | −0.7194 | 1.2910 |
| −0.8817 | 0.7982 | 1.2910 | 0.4869 | −0.7570 | 1.2910 |
| −0.8977 | 0.8428 | 1.2910 | 0.5144 | −0.7903 | 1.2910 |
| −0.9109 | 0.8827 | 1.2910 | 0.5389 | −0.8195 | 1.2910 |
| −0.9222 | 0.9206 | 1.2910 | 0.5604 | −0.8446 | 1.2910 |
| −0.9307 | 0.9537 | 1.2910 | 0.5787 | −0.8657 | 1.2910 |
| −0.9351 | 0.9795 | 1.2910 | 0.5944 | −0.8836 | 1.2910 |
| −0.9358 | 1.0005 | 1.2910 | 0.6077 | −0.8987 | 1.2910 |
| −0.9335 | 1.0161 | 1.2910 | 0.6187 | −0.9110 | 1.2910 |
| −0.9292 | 1.0271 | 1.2910 | 0.6276 | −0.9207 | 1.2910 |
| −0.9252 | 1.0324 | 1.2910 | 0.6331 | −0.9293 | 1.2910 |
| −0.9221 | 1.0352 | 1.2910 | 0.6342 | −0.9368 | 1.2910 |
| −0.9203 | 1.0364 | 1.2910 | 0.6332 | −0.9430 | 1.2910 |
| −0.9193 | 1.0369 | 1.2910 | 0.6309 | −0.9476 | 1.2910 |
| 0.5982 | −1.0166 | 1.5892 | −0.9004 | 1.0083 | 1.5892 |
| 0.5952 | −1.0190 | 1.5892 | −0.8999 | 1.0086 | 1.5892 |
| 0.5905 | −1.0213 | 1.5892 | −0.8989 | 1.0089 | 1.5892 |
| 0.5841 | −1.0223 | 1.5892 | −0.8970 | 1.0095 | 1.5892 |
| 0.5765 | −1.0206 | 1.5892 | −0.8929 | 1.0102 | 1.5892 |
| 0.5681 | −1.0144 | 1.5892 | −0.8865 | 1.0098 | 1.5892 |
| 0.5579 | −1.0053 | 1.5892 | −0.8756 | 1.0063 | 1.5892 |
| 0.5452 | −0.9940 | 1.5892 | −0.8624 | 0.9985 | 1.5892 |
| 0.5298 | −0.9804 | 1.5892 | −0.8468 | 0.9856 | 1.5892 |
| 0.5113 | −0.9642 | 1.5892 | −0.8294 | 0.9671 | 1.5892 |
| 0.4896 | −0.9454 | 1.5892 | −0.8085 | 0.9415 | 1.5892 |
| 0.4638 | −0.9232 | 1.5892 | −0.7854 | 0.9113 | 1.5892 |
| 0.4341 | −0.8977 | 1.5892 | −0.7611 | 0.8788 | 1.5892 |
| 0.4002 | −0.8690 | 1.5892 | −0.7341 | 0.8419 | 1.5892 |
| 0.3621 | −0.8372 | 1.5892 | −0.7044 | 0.8007 | 1.5892 |
| 0.3198 | −0.8022 | 1.5892 | −0.6719 | 0.7553 | 1.5892 |

TABLE 8-continued

| SUCTION SIDE | | | PRESSURE SIDE | | |
|---|---|---|---|---|---|
| X | Y | Z | X | Y | Z |
| 0.2737 | −0.7638 | 1.5892 | −0.6379 | 0.7078 | 1.5892 |
| 0.2258 | −0.7233 | 1.5892 | −0.6024 | 0.6582 | 1.5892 |
| 0.1763 | −0.6806 | 1.5892 | −0.5655 | 0.6067 | 1.5892 |
| 0.1253 | −0.6357 | 1.5892 | −0.5269 | 0.5531 | 1.5892 |
| 0.0730 | −0.5886 | 1.5892 | −0.4869 | 0.4975 | 1.5892 |
| 0.0195 | −0.5391 | 1.5892 | −0.4453 | 0.4398 | 1.5892 |
| −0.0350 | −0.4872 | 1.5892 | −0.4021 | 0.3802 | 1.5892 |
| −0.0903 | −0.4325 | 1.5892 | −0.3573 | 0.3186 | 1.5892 |
| −0.1445 | −0.3769 | 1.5892 | −0.3124 | 0.2570 | 1.5892 |
| −0.1975 | −0.3203 | 1.5892 | −0.2675 | 0.1955 | 1.5892 |
| −0.2490 | −0.2626 | 1.5892 | −0.2226 | 0.1339 | 1.5892 |
| −0.2993 | −0.2038 | 1.5892 | −0.1778 | 0.0723 | 1.5892 |
| −0.3480 | −0.1437 | 1.5892 | −0.1331 | 0.0106 | 1.5892 |
| −0.3953 | −0.0825 | 1.5892 | −0.0886 | −0.0511 | 1.5892 |
| −0.4413 | −0.0203 | 1.5892 | −0.0444 | −0.1131 | 1.5892 |
| −0.4859 | 0.0431 | 1.5892 | −0.0003 | −0.1752 | 1.5892 |
| −0.5291 | 0.1076 | 1.5892 | 0.0436 | −0.2374 | 1.5892 |
| −0.5710 | 0.1733 | 1.5892 | 0.0875 | −0.2997 | 1.5892 |
| −0.6115 | 0.2401 | 1.5892 | 0.1313 | −0.3620 | 1.5892 |
| −0.6494 | 0.3056 | 1.5892 | 0.1737 | −0.4222 | 1.5892 |
| −0.6847 | 0.3700 | 1.5892 | 0.2146 | −0.4803 | 1.5892 |
| −0.7176 | 0.4328 | 1.5892 | 0.2543 | −0.5362 | 1.5892 |
| −0.7479 | 0.4939 | 1.5892 | 0.2926 | −0.5900 | 1.5892 |
| −0.7758 | 0.5533 | 1.5892 | 0.3296 | −0.6415 | 1.5892 |
| −0.8014 | 0.6108 | 1.5892 | 0.3653 | −0.6910 | 1.5892 |
| −0.8249 | 0.6664 | 1.5892 | 0.3996 | −0.7381 | 1.5892 |
| −0.8462 | 0.7201 | 1.5892 | 0.4313 | −0.7811 | 1.5892 |
| −0.8645 | 0.7693 | 1.5892 | 0.4604 | −0.8195 | 1.5892 |
| −0.8800 | 0.8139 | 1.5892 | 0.4869 | −0.8535 | 1.5892 |
| −0.8928 | 0.8540 | 1.5892 | 0.5107 | −0.8833 | 1.5892 |
| −0.9037 | 0.8918 | 1.5892 | 0.5314 | −0.9090 | 1.5892 |
| −0.9119 | 0.9249 | 1.5892 | 0.5492 | −0.9305 | 1.5892 |
| −0.9162 | 0.9508 | 1.5892 | 0.5645 | −0.9488 | 1.5892 |
| −0.9169 | 0.9717 | 1.5892 | 0.5775 | −0.9642 | 1.5892 |
| −0.9148 | 0.9873 | 1.5892 | 0.5881 | −0.9767 | 1.5892 |
| −0.9105 | 0.9983 | 1.5892 | 0.5967 | −0.9867 | 1.5892 |
| −0.9068 | 1.0036 | 1.5892 | 0.6025 | −0.9950 | 1.5892 |
| −0.9036 | 1.0065 | 1.5892 | 0.6040 | −1.0026 | 1.5892 |
| −0.9018 | 1.0076 | 1.5892 | 0.6030 | −1.0089 | 1.5892 |
| −0.9009 | 1.0081 | 1.5892 | 0.6007 | −1.0136 | 1.5892 |
| 0.5716 | −1.0729 | 1.8847 | −0.8875 | 0.9809 | 1.8847 |
| 0.5686 | −1.0753 | 1.8847 | −0.8870 | 0.9811 | 1.8847 |
| 0.5638 | −1.0774 | 1.8847 | −0.8860 | 0.9815 | 1.8847 |
| 0.5574 | −1.0782 | 1.8847 | −0.8840 | 0.9821 | 1.8847 |
| 0.5498 | −1.0761 | 1.8847 | −0.8799 | 0.9825 | 1.8847 |
| 0.5417 | −1.0696 | 1.8847 | −0.8736 | 0.9819 | 1.8847 |
| 0.5318 | −1.0604 | 1.8847 | −0.8628 | 0.9779 | 1.8847 |
| 0.5192 | −1.0490 | 1.8847 | −0.8499 | 0.9696 | 1.8847 |
| 0.5041 | −1.0351 | 1.8847 | −0.8349 | 0.9561 | 1.8847 |
| 0.4858 | −1.0185 | 1.8847 | −0.8179 | 0.9371 | 1.8847 |
| 0.4646 | −0.9992 | 1.8847 | −0.7977 | 0.9110 | 1.8847 |
| 0.4394 | −0.9765 | 1.8847 | −0.7754 | 0.8803 | 1.8847 |
| 0.4103 | −0.9505 | 1.8847 | −0.7519 | 0.8471 | 1.8847 |
| 0.3771 | −0.9210 | 1.8847 | −0.7258 | 0.8096 | 1.8847 |
| 0.3399 | −0.8883 | 1.8847 | −0.6971 | 0.7677 | 1.8847 |
| 0.2986 | −0.8522 | 1.8847 | −0.6656 | 0.7216 | 1.8847 |
| 0.2535 | −0.8125 | 1.8847 | −0.6328 | 0.6734 | 1.8847 |
| 0.2068 | −0.7708 | 1.8847 | −0.5985 | 0.6230 | 1.8847 |
| 0.1585 | −0.7271 | 1.8847 | −0.5627 | 0.5707 | 1.8847 |
| 0.1087 | −0.6810 | 1.8847 | −0.5254 | 0.5162 | 1.8847 |
| 0.0576 | −0.6326 | 1.8847 | −0.4866 | 0.4597 | 1.8847 |
| 0.0055 | −0.5819 | 1.8847 | −0.4462 | 0.4013 | 1.8847 |
| −0.0476 | −0.5287 | 1.8847 | −0.4043 | 0.3407 | 1.8847 |
| −0.1015 | −0.4728 | 1.8847 | −0.3608 | 0.2783 | 1.8847 |
| −0.1541 | −0.4160 | 1.8847 | −0.3172 | 0.2159 | 1.8847 |
| −0.2056 | −0.3582 | 1.8847 | −0.2733 | 0.1536 | 1.8847 |
| −0.2556 | −0.2993 | 1.8847 | −0.2296 | 0.0913 | 1.8847 |
| −0.3043 | −0.2394 | 1.8847 | −0.1859 | 0.0290 | 1.8847 |
| −0.3515 | −0.1782 | 1.8847 | −0.1422 | −0.0334 | 1.8847 |
| −0.3973 | −0.1161 | 1.8847 | −0.0986 | −0.0959 | 1.8847 |
| −0.4418 | −0.0528 | 1.8847 | −0.0554 | −0.1586 | 1.8847 |
| −0.4850 | 0.0114 | 1.8847 | −0.0123 | −0.2214 | 1.8847 |
| −0.5268 | 0.0768 | 1.8847 | 0.0305 | −0.2843 | 1.8847 |
| −0.5672 | 0.1432 | 1.8847 | 0.0733 | −0.3472 | 1.8847 |
| −0.6064 | 0.2106 | 1.8847 | 0.1161 | −0.4103 | 1.8847 |
| −0.6430 | 0.2767 | 1.8847 | 0.1574 | −0.4712 | 1.8847 |

TABLE 8-continued

| SUCTION SIDE | | | PRESSURE SIDE | | |
|---|---|---|---|---|---|
| X | Y | Z | X | Y | Z |
| −0.6772 | 0.3414 | 1.8847 | 0.1975 | −0.5299 | 1.8847 |
| −0.7089 | 0.4045 | 1.8847 | 0.2361 | −0.5865 | 1.8847 |
| −0.7383 | 0.4660 | 1.8847 | 0.2735 | −0.6409 | 1.8847 |
| −0.7654 | 0.5255 | 1.8847 | 0.3096 | −0.6931 | 1.8847 |
| −0.7903 | 0.5833 | 1.8847 | 0.3444 | −0.7430 | 1.8847 |
| −0.8131 | 0.6390 | 1.8847 | 0.3780 | −0.7908 | 1.8847 |
| −0.8339 | 0.6927 | 1.8847 | 0.4091 | −0.8341 | 1.8847 |
| −0.8518 | 0.7420 | 1.8847 | 0.4375 | −0.8730 | 1.8847 |
| −0.8669 | 0.7866 | 1.8847 | 0.4635 | −0.9075 | 1.8847 |
| −0.8794 | 0.8266 | 1.8847 | 0.4866 | −0.9377 | 1.8847 |
| −0.8901 | 0.8644 | 1.8847 | 0.5069 | −0.9639 | 1.8847 |
| −0.8983 | 0.8975 | 1.8847 | 0.5241 | −0.9858 | 1.8847 |
| −0.9025 | 0.9233 | 1.8847 | 0.5390 | −1.0044 | 1.8847 |
| −0.9034 | 0.9442 | 1.8847 | 0.5516 | −1.0200 | 1.8847 |
| −0.9015 | 0.9598 | 1.8847 | 0.5620 | −1.0329 | 1.8847 |
| −0.8975 | 0.9708 | 1.8847 | 0.5703 | −1.0431 | 1.8847 |
| −0.8937 | 0.9763 | 1.8847 | 0.5760 | −1.0513 | 1.8847 |
| −0.8906 | 0.9791 | 1.8847 | 0.5776 | −1.0589 | 1.8847 |
| −0.8889 | 0.9802 | 1.8847 | 0.5765 | −1.0653 | 1.8847 |
| −0.8879 | 0.9807 | 1.8847 | 0.5742 | −1.0699 | 1.8847 |
| 0.5511 | −1.1205 | 2.1802 | −0.8769 | 0.9556 | 2.1802 |
| 0.5480 | −1.1229 | 2.1802 | −0.8764 | 0.9558 | 2.1802 |
| 0.5432 | −1.1249 | 2.1802 | −0.8754 | 0.9561 | 2.1802 |
| 0.5367 | −1.1254 | 2.1802 | −0.8735 | 0.9566 | 2.1802 |
| 0.5293 | −1.1231 | 2.1802 | −0.8694 | 0.9569 | 2.1802 |
| 0.5214 | −1.1163 | 2.1802 | −0.8630 | 0.9559 | 2.1802 |
| 0.5115 | −1.1070 | 2.1802 | −0.8525 | 0.9514 | 2.1802 |
| 0.4992 | −1.0953 | 2.1802 | −0.8400 | 0.9426 | 2.1802 |
| 0.4843 | −1.0813 | 2.1802 | −0.8254 | 0.9286 | 2.1802 |
| 0.4664 | −1.0644 | 2.1802 | −0.8090 | 0.9090 | 2.1802 |
| 0.4455 | −1.0449 | 2.1802 | −0.7895 | 0.8824 | 2.1802 |
| 0.4206 | −1.0218 | 2.1802 | −0.7680 | 0.8510 | 2.1802 |
| 0.3920 | −0.9953 | 2.1802 | −0.7454 | 0.8173 | 2.1802 |
| 0.3593 | −0.9653 | 2.1802 | −0.7202 | 0.7792 | 2.1802 |
| 0.3227 | −0.9319 | 2.1802 | −0.6925 | 0.7367 | 2.1802 |
| 0.2821 | −0.8952 | 2.1802 | −0.6620 | 0.6899 | 2.1802 |
| 0.2379 | −0.8547 | 2.1802 | −0.6303 | 0.6410 | 2.1802 |
| 0.1919 | −0.8122 | 2.1802 | −0.5971 | 0.5900 | 2.1802 |
| 0.1445 | −0.7675 | 2.1802 | −0.5623 | 0.5368 | 2.1802 |
| 0.0957 | −0.7206 | 2.1802 | −0.5262 | 0.4816 | 2.1802 |
| 0.0457 | −0.6714 | 2.1802 | −0.4885 | 0.4244 | 2.1802 |
| −0.0054 | −0.6198 | 2.1802 | −0.4492 | 0.3652 | 2.1802 |
| −0.0573 | −0.5655 | 2.1802 | −0.4084 | 0.3040 | 2.1802 |
| −0.1099 | −0.5086 | 2.1802 | −0.3660 | 0.2408 | 2.1802 |
| −0.1613 | −0.4508 | 2.1802 | −0.3234 | 0.1778 | 2.1802 |
| −0.2115 | −0.3920 | 2.1802 | −0.2806 | 0.1148 | 2.1802 |
| −0.2603 | −0.3322 | 2.1802 | −0.2378 | 0.0518 | 2.1802 |
| −0.3076 | −0.2713 | 2.1802 | −0.1948 | −0.0111 | 2.1802 |
| −0.3535 | −0.2094 | 2.1802 | −0.1520 | −0.0740 | 2.1802 |
| −0.3981 | −0.1463 | 2.1802 | −0.1092 | −0.1369 | 2.1802 |
| −0.4413 | −0.0823 | 2.1802 | −0.0666 | −0.2000 | 2.1802 |
| −0.4832 | −0.0173 | 2.1802 | −0.0243 | −0.2633 | 2.1802 |
| −0.5238 | 0.0487 | 2.1802 | 0.0179 | −0.3267 | 2.1802 |
| −0.5632 | 0.1155 | 2.1802 | 0.0600 | −0.3901 | 2.1802 |
| −0.6012 | 0.1835 | 2.1802 | 0.1021 | −0.4536 | 2.1802 |
| −0.6369 | 0.2499 | 2.1802 | 0.1427 | −0.5149 | 2.1802 |
| −0.6701 | 0.3150 | 2.1802 | 0.1822 | −0.5740 | 2.1802 |
| −0.7011 | 0.3785 | 2.1802 | 0.2203 | −0.6310 | 2.1802 |
| −0.7297 | 0.4401 | 2.1802 | 0.2570 | −0.6857 | 2.1802 |
| −0.7561 | 0.4999 | 2.1802 | 0.2926 | −0.7382 | 2.1802 |
| −0.7805 | 0.5577 | 2.1802 | 0.3269 | −0.7886 | 2.1802 |
| −0.8027 | 0.6136 | 2.1802 | 0.3601 | −0.8366 | 2.1802 |
| −0.8231 | 0.6674 | 2.1802 | 0.3906 | −0.8803 | 2.1802 |
| −0.8407 | 0.7167 | 2.1802 | 0.4187 | −0.9195 | 2.1802 |
| −0.8555 | 0.7613 | 2.1802 | 0.4442 | −0.9543 | 2.1802 |
| −0.8679 | 0.8012 | 2.1802 | 0.4670 | −0.9847 | 2.1802 |
| −0.8786 | 0.8390 | 2.1802 | 0.4870 | −1.0110 | 2.1802 |
| −0.8867 | 0.8720 | 2.1802 | 0.5041 | −1.0331 | 2.1802 |
| −0.8910 | 0.8978 | 2.1802 | 0.5188 | −1.0519 | 2.1802 |
| −0.8921 | 0.9186 | 2.1802 | 0.5312 | −1.0676 | 2.1802 |
| −0.8904 | 0.9343 | 2.1802 | 0.5414 | −1.0806 | 2.1802 |
| −0.8867 | 0.9454 | 2.1802 | 0.5496 | −1.0908 | 2.1802 |
| −0.8831 | 0.9508 | 2.1802 | 0.5555 | −1.0991 | 2.1802 |
| −0.8801 | 0.9537 | 2.1802 | 0.5570 | −1.1067 | 2.1802 |
| −0.8783 | 0.9549 | 2.1802 | 0.5560 | −1.1130 | 2.1802 |
| −0.8774 | 0.9553 | 2.1802 | 0.5537 | −1.1176 | 2.1802 |

TABLE 8-continued

| SUCTION SIDE | | | PRESSURE SIDE | | |
|---|---|---|---|---|---|
| X | Y | Z | X | Y | Z |
| 0.5351 | −1.1712 | 2.5777 | −0.8720 | 0.9214 | 2.5777 |
| 0.5320 | −1.1735 | 2.5777 | −0.8715 | 0.9217 | 2.5777 |
| 0.5271 | −1.1754 | 2.5777 | −0.8705 | 0.9220 | 2.5777 |
| 0.5206 | −1.1758 | 2.5777 | −0.8685 | 0.9224 | 2.5777 |
| 0.5133 | −1.1730 | 2.5777 | −0.8644 | 0.9226 | 2.5777 |
| 0.5056 | −1.1660 | 2.5777 | −0.8581 | 0.9211 | 2.5777 |
| 0.4960 | −1.1566 | 2.5777 | −0.8479 | 0.9158 | 2.5777 |
| 0.4839 | −1.1448 | 2.5777 | −0.8359 | 0.9063 | 2.5777 |
| 0.4692 | −1.1304 | 2.5777 | −0.8219 | 0.8916 | 2.5777 |
| 0.4516 | −1.1135 | 2.5777 | −0.8063 | 0.8716 | 2.5777 |
| 0.4309 | −1.0938 | 2.5777 | −0.7876 | 0.8444 | 2.5777 |
| 0.4064 | −1.0704 | 2.5777 | −0.7670 | 0.8124 | 2.5777 |
| 0.3780 | −1.0438 | 2.5777 | −0.7453 | 0.7781 | 2.5777 |
| 0.3456 | −1.0138 | 2.5777 | −0.7211 | 0.7393 | 2.5777 |
| 0.3093 | −0.9801 | 2.5777 | −0.6944 | 0.6961 | 2.5777 |
| 0.2694 | −0.9429 | 2.5777 | −0.6651 | 0.6486 | 2.5777 |
| 0.2259 | −0.9019 | 2.5777 | −0.6344 | 0.5989 | 2.5777 |
| 0.1808 | −0.8588 | 2.5777 | −0.6023 | 0.5471 | 2.5777 |
| 0.1342 | −0.8136 | 2.5777 | −0.5687 | 0.4933 | 2.5777 |
| 0.0864 | −0.7660 | 2.5777 | −0.5336 | 0.4374 | 2.5777 |
| 0.0374 | −0.7162 | 2.5777 | −0.4970 | 0.3795 | 2.5777 |
| −0.0126 | −0.6639 | 2.5777 | −0.4589 | 0.3195 | 2.5777 |
| −0.0634 | −0.6090 | 2.5777 | −0.4191 | 0.2576 | 2.5777 |
| −0.1148 | −0.5512 | 2.5777 | −0.3776 | 0.1937 | 2.5777 |
| −0.1652 | −0.4926 | 2.5777 | −0.3359 | 0.1300 | 2.5777 |
| −0.2143 | −0.4330 | 2.5777 | −0.2939 | 0.0664 | 2.5777 |
| −0.2620 | −0.3724 | 2.5777 | −0.2518 | 0.0030 | 2.5777 |
| −0.3083 | −0.3107 | 2.5777 | −0.2094 | −0.0603 | 2.5777 |
| −0.3532 | −0.2479 | 2.5777 | −0.1670 | −0.1236 | 2.5777 |
| −0.3968 | −0.1841 | 2.5777 | −0.1247 | −0.1868 | 2.5777 |
| −0.4391 | −0.1193 | 2.5777 | −0.0824 | −0.2501 | 2.5777 |
| −0.4802 | −0.0535 | 2.5777 | −0.0402 | −0.3135 | 2.5777 |
| −0.5202 | 0.0132 | 2.5777 | 0.0018 | −0.3771 | 2.5777 |
| −0.5589 | 0.0808 | 2.5777 | 0.0437 | −0.4406 | 2.5777 |
| −0.5965 | 0.1494 | 2.5777 | 0.0857 | −0.5042 | 2.5777 |
| −0.6315 | 0.2164 | 2.5777 | 0.1264 | −0.5655 | 2.5777 |
| −0.6641 | 0.2817 | 2.5777 | 0.1657 | −0.6247 | 2.5777 |
| −0.6945 | 0.3451 | 2.5777 | 0.2038 | −0.6817 | 2.5777 |
| −0.7227 | 0.4068 | 2.5777 | 0.2406 | −0.7365 | 2.5777 |
| −0.7488 | 0.4666 | 2.5777 | 0.2761 | −0.7890 | 2.5777 |
| −0.7728 | 0.5244 | 2.5777 | 0.3106 | −0.8393 | 2.5777 |
| −0.7949 | 0.5802 | 2.5777 | 0.3437 | −0.8874 | 2.5777 |
| −0.8151 | 0.6339 | 2.5777 | 0.3743 | −0.9310 | 2.5777 |
| −0.8327 | 0.6830 | 2.5777 | 0.4022 | −0.9704 | 2.5777 |
| −0.8477 | 0.7275 | 2.5777 | 0.4274 | −1.0054 | 2.5777 |
| −0.8603 | 0.7673 | 2.5777 | 0.4501 | −1.0359 | 2.5777 |
| −0.8712 | 0.8048 | 2.5777 | 0.4701 | −1.0622 | 2.5777 |
| −0.8796 | 0.8378 | 2.5777 | 0.4872 | −1.0843 | 2.5777 |
| −0.8841 | 0.8634 | 2.5777 | 0.5019 | −1.1031 | 2.5777 |
| −0.8856 | 0.8841 | 2.5777 | 0.5144 | −1.1188 | 2.5777 |
| −0.8846 | 0.8997 | 2.5777 | 0.5247 | −1.1317 | 2.5777 |
| −0.8814 | 0.9111 | 2.5777 | 0.5330 | −1.1419 | 2.5777 |
| −0.8781 | 0.9167 | 2.5777 | 0.5390 | −1.1501 | 2.5777 |
| −0.8752 | 0.9196 | 2.5777 | 0.5408 | −1.1575 | 2.5777 |
| −0.8734 | 0.9208 | 2.5777 | 0.5399 | −1.1637 | 2.5777 |
| −0.8724 | 0.9213 | 2.5777 | 0.5376 | −1.1683 | 2.5777 |
| 0.5287 | −1.2199 | 3.0667 | −0.8841 | 0.8741 | 3.0667 |
| 0.5256 | −1.2222 | 3.0667 | −0.8837 | 0.8743 | 3.0667 |
| 0.5207 | −1.2241 | 3.0667 | −0.8827 | 0.8746 | 3.0667 |
| 0.5143 | −1.2243 | 3.0667 | −0.8807 | 0.8750 | 3.0667 |
| 0.5071 | −1.2213 | 3.0667 | −0.8766 | 0.8749 | 3.0667 |
| 0.4996 | −1.2142 | 3.0667 | −0.8704 | 0.8730 | 3.0667 |
| 0.4899 | −1.2047 | 3.0667 | −0.8605 | 0.8670 | 3.0667 |
| 0.4779 | −1.1929 | 3.0667 | −0.8490 | 0.8569 | 3.0667 |
| 0.4633 | −1.1786 | 3.0667 | −0.8354 | 0.8416 | 3.0667 |
| 0.4459 | −1.1615 | 3.0667 | −0.8202 | 0.8212 | 3.0667 |
| 0.4256 | −1.1415 | 3.0667 | −0.8020 | 0.7937 | 3.0667 |
| 0.4015 | −1.1180 | 3.0667 | −0.7819 | 0.7613 | 3.0667 |
| 0.3736 | −1.0909 | 3.0667 | −0.7607 | 0.7266 | 3.0667 |
| 0.3420 | −1.0602 | 3.0667 | −0.7369 | 0.6875 | 3.0667 |
| 0.3065 | −1.0260 | 3.0667 | −0.7107 | 0.6440 | 3.0667 |
| 0.2673 | −0.9882 | 3.0667 | −0.6818 | 0.5961 | 3.0667 |
| 0.2246 | −0.9467 | 3.0667 | −0.6516 | 0.5460 | 3.0667 |
| 0.1804 | −0.9030 | 3.0667 | −0.6198 | 0.4939 | 3.0667 |
| 0.1347 | −0.8571 | 3.0667 | −0.5866 | 0.4398 | 3.0667 |
| 0.0877 | −0.8090 | 3.0667 | −0.5518 | 0.3836 | 3.0667 |

TABLE 8-continued

| SUCTION SIDE | | | PRESSURE SIDE | | |
|---|---|---|---|---|---|
| X | Y | Z | X | Y | Z |
| 0.0396 | −0.7586 | 3.0667 | −0.5156 | 0.3253 | 3.0667 |
| −0.0095 | −0.7057 | 3.0667 | −0.4777 | 0.2651 | 3.0667 |
| −0.0596 | −0.6501 | 3.0667 | −0.4381 | 0.2028 | 3.0667 |
| −0.1104 | −0.5920 | 3.0667 | −0.3968 | 0.1388 | 3.0667 |
| −0.1602 | −0.5329 | 3.0667 | −0.3552 | 0.0749 | 3.0667 |
| −0.2086 | −0.4730 | 3.0667 | −0.3133 | 0.0112 | 3.0667 |
| −0.2560 | −0.4120 | 3.0667 | −0.2710 | −0.0523 | 3.0667 |
| −0.3020 | −0.3501 | 3.0667 | −0.2285 | −0.1156 | 3.0667 |
| −0.3468 | −0.2871 | 3.0667 | −0.1859 | −0.1788 | 3.0667 |
| −0.3904 | −0.2232 | 3.0667 | −0.1432 | −0.2420 | 3.0667 |
| −0.4328 | −0.1584 | 3.0667 | −0.1005 | −0.3051 | 3.0667 |
| −0.4741 | −0.0927 | 3.0667 | −0.0578 | −0.3684 | 3.0667 |
| −0.5144 | −0.0261 | 3.0667 | −0.0152 | −0.4316 | 3.0667 |
| −0.5535 | 0.0413 | 3.0667 | 0.0275 | −0.4947 | 3.0667 |
| −0.5915 | 0.1094 | 3.0667 | 0.0701 | −0.5579 | 3.0667 |
| −0.6271 | 0.1757 | 3.0667 | 0.1116 | −0.6189 | 3.0667 |
| −0.6604 | 0.2404 | 3.0667 | 0.1517 | −0.6777 | 3.0667 |
| −0.6915 | 0.3033 | 3.0667 | 0.1905 | −0.7342 | 3.0667 |
| −0.7205 | 0.3644 | 3.0667 | 0.2281 | −0.7886 | 3.0667 |
| −0.7475 | 0.4235 | 3.0667 | 0.2645 | −0.8407 | 3.0667 |
| −0.7725 | 0.4807 | 3.0667 | 0.2996 | −0.8906 | 3.0667 |
| −0.7956 | 0.5357 | 3.0667 | 0.3334 | −0.9382 | 3.0667 |
| −0.8169 | 0.5888 | 3.0667 | 0.3647 | −0.9816 | 3.0667 |
| −0.8356 | 0.6373 | 3.0667 | 0.3933 | −1.0204 | 3.0667 |
| −0.8517 | 0.6812 | 3.0667 | 0.4192 | −1.0549 | 3.0667 |
| −0.8653 | 0.7205 | 3.0667 | 0.4425 | −1.0852 | 3.0667 |
| −0.8774 | 0.7576 | 3.0667 | 0.4627 | −1.1114 | 3.0667 |
| −0.8868 | 0.7901 | 3.0667 | 0.4800 | −1.1333 | 3.0667 |
| −0.8924 | 0.8154 | 3.0667 | 0.4948 | −1.1520 | 3.0667 |
| −0.8950 | 0.8361 | 3.0667 | 0.5074 | −1.1677 | 3.0667 |
| −0.8949 | 0.8517 | 3.0667 | 0.5178 | −1.1805 | 3.0667 |
| −0.8927 | 0.8631 | 3.0667 | 0.5261 | −1.1908 | 3.0667 |
| −0.8899 | 0.8690 | 3.0667 | 0.5322 | −1.1989 | 3.0667 |
| −0.8872 | 0.8722 | 3.0667 | 0.5342 | −1.2062 | 3.0667 |
| −0.8855 | 0.8734 | 3.0667 | 0.5335 | −1.2125 | 3.0667 |
| −0.8847 | 0.8739 | 3.0667 | 0.5313 | −1.2170 | 3.0667 |
| 0.5225 | −1.2437 | 3.3622 | −0.8937 | 0.8490 | 3.3622 |
| 0.5194 | −1.2460 | 3.3622 | −0.8933 | 0.8492 | 3.3622 |
| 0.5145 | −1.2478 | 3.3622 | −0.8923 | 0.8496 | 3.3622 |
| 0.5080 | −1.2478 | 3.3622 | −0.8902 | 0.8499 | 3.3622 |
| 0.5010 | −1.2447 | 3.3622 | −0.8862 | 0.8496 | 3.3622 |
| 0.4935 | −1.2375 | 3.3622 | −0.8801 | 0.8474 | 3.3622 |
| 0.4840 | −1.2280 | 3.3622 | −0.8704 | 0.8409 | 3.3622 |
| 0.4721 | −1.2161 | 3.3622 | −0.8592 | 0.8305 | 3.3622 |
| 0.4576 | −1.2016 | 3.3622 | −0.8459 | 0.8150 | 3.3622 |
| 0.4404 | −1.1845 | 3.3622 | −0.8311 | 0.7944 | 3.3622 |
| 0.4202 | −1.1644 | 3.3622 | −0.8132 | 0.7666 | 3.3622 |
| 0.3964 | −1.1407 | 3.3622 | −0.7933 | 0.7340 | 3.3622 |
| 0.3688 | −1.1135 | 3.3622 | −0.7724 | 0.6992 | 3.3622 |
| 0.3376 | −1.0825 | 3.3622 | −0.7489 | 0.6599 | 3.3622 |
| 0.3026 | −1.0480 | 3.3622 | −0.7229 | 0.6162 | 3.3622 |
| 0.2640 | −1.0099 | 3.3622 | −0.6943 | 0.5681 | 3.3622 |
| 0.2218 | −0.9679 | 3.3622 | −0.6642 | 0.5179 | 3.3622 |
| 0.1782 | −0.9237 | 3.3622 | −0.6327 | 0.4656 | 3.3622 |
| 0.1332 | −0.8774 | 3.3622 | −0.5998 | 0.4113 | 3.3622 |
| 0.0869 | −0.8290 | 3.3622 | −0.5652 | 0.3549 | 3.3622 |
| 0.0394 | −0.7780 | 3.3622 | −0.5291 | 0.2965 | 3.3622 |
| −0.0091 | −0.7247 | 3.3622 | −0.4914 | 0.2362 | 3.3622 |
| −0.0585 | −0.6688 | 3.3622 | −0.4520 | 0.1739 | 3.3622 |
| −0.1088 | −0.6103 | 3.3622 | −0.4108 | 0.1096 | 3.3622 |
| −0.1580 | −0.5510 | 3.3622 | −0.3692 | 0.0457 | 3.3622 |
| −0.2060 | −0.4908 | 3.3622 | −0.3274 | −0.0180 | 3.3622 |
| −0.2530 | −0.4296 | 3.3622 | −0.2851 | −0.0816 | 3.3622 |
| −0.2987 | −0.3676 | 3.3622 | −0.2426 | −0.1448 | 3.3622 |
| −0.3432 | −0.3046 | 3.3622 | −0.1998 | −0.2079 | 3.3622 |
| −0.3867 | −0.2407 | 3.3622 | −0.1569 | −0.2710 | 3.3622 |
| −0.4291 | −0.1760 | 3.3622 | −0.1139 | −0.3340 | 3.3622 |
| −0.4705 | −0.1105 | 3.3622 | −0.0709 | −0.3970 | 3.3622 |
| −0.5109 | −0.0443 | 3.3622 | −0.0279 | −0.4600 | 3.3622 |
| −0.5504 | 0.0227 | 3.3622 | 0.0151 | −0.5230 | 3.3622 |
| −0.5887 | 0.0903 | 3.3622 | 0.0583 | −0.5858 | 3.3622 |
| −0.6247 | 0.1562 | 3.3622 | 0.1001 | −0.6465 | 3.3622 |
| −0.6585 | 0.2204 | 3.3622 | 0.1407 | −0.7050 | 3.3622 |
| −0.6901 | 0.2828 | 3.3622 | 0.1800 | −0.7612 | 3.3622 |
| −0.7197 | 0.3434 | 3.3622 | 0.2182 | −0.8152 | 3.3622 |
| −0.7474 | 0.4019 | 3.3622 | 0.2550 | −0.8671 | 3.3622 |

TABLE 8-continued

| SUCTION SIDE | | | PRESSURE SIDE | | |
|---|---|---|---|---|---|
| X | Y | Z | X | Y | Z |
| −0.7731 | 0.4586 | 3.3622 | 0.2906 | −0.9166 | 3.3622 |
| −0.7970 | 0.5131 | 3.3622 | 0.3249 | −0.9640 | 3.3622 |
| −0.8191 | 0.5657 | 3.3622 | 0.3566 | −1.0070 | 3.3622 |
| −0.8386 | 0.6137 | 3.3622 | 0.3855 | −1.0456 | 3.3622 |
| −0.8554 | 0.6572 | 3.3622 | 0.4118 | −1.0799 | 3.3622 |
| −0.8699 | 0.6961 | 3.3622 | 0.4352 | −1.1100 | 3.3622 |
| −0.8828 | 0.7328 | 3.3622 | 0.4557 | −1.1360 | 3.3622 |
| −0.8929 | 0.7649 | 3.3622 | 0.4731 | −1.1579 | 3.3622 |
| −0.8993 | 0.7901 | 3.3622 | 0.4881 | −1.1765 | 3.3622 |
| −0.9024 | 0.8105 | 3.3622 | 0.5008 | −1.1920 | 3.3622 |
| −0.9031 | 0.8261 | 3.3622 | 0.5114 | −1.2048 | 3.3622 |
| −0.9016 | 0.8376 | 3.3622 | 0.5198 | −1.2149 | 3.3622 |
| −0.8993 | 0.8437 | 3.3622 | 0.5261 | −1.2228 | 3.3622 |
| −0.8967 | 0.8470 | 3.3622 | 0.5281 | −1.2302 | 3.3622 |
| −0.8951 | 0.8483 | 3.3622 | 0.5273 | −1.2363 | 3.3622 |
| −0.8943 | 0.8488 | 3.3622 | 0.5250 | −1.2408 | 3.3622 |
| 0.5163 | −1.2657 | 3.6578 | −0.9033 | 0.8291 | 3.6578 |
| 0.5130 | −1.2680 | 3.6578 | −0.9029 | 0.8293 | 3.6578 |
| 0.5081 | −1.2698 | 3.6578 | −0.9019 | 0.8296 | 3.6578 |
| 0.5016 | −1.2696 | 3.6578 | −0.8998 | 0.8299 | 3.6578 |
| 0.4946 | −1.2661 | 3.6578 | −0.8958 | 0.8293 | 3.6578 |
| 0.4873 | −1.2588 | 3.6578 | −0.8899 | 0.8268 | 3.6578 |
| 0.4779 | −1.2491 | 3.6578 | −0.8805 | 0.8199 | 3.6578 |
| 0.4660 | −1.2371 | 3.6578 | −0.8697 | 0.8091 | 3.6578 |
| 0.4517 | −1.2225 | 3.6578 | −0.8568 | 0.7932 | 3.6578 |
| 0.4345 | −1.2051 | 3.6578 | −0.8422 | 0.7724 | 3.6578 |
| 0.4145 | −1.1847 | 3.6578 | −0.8247 | 0.7444 | 3.6578 |
| 0.3908 | −1.1607 | 3.6578 | −0.8052 | 0.7116 | 3.6578 |
| 0.3635 | −1.1331 | 3.6578 | −0.7846 | 0.6765 | 3.6578 |
| 0.3325 | −1.1017 | 3.6578 | −0.7615 | 0.6369 | 3.6578 |
| 0.2979 | −1.0666 | 3.6578 | −0.7358 | 0.5929 | 3.6578 |
| 0.2596 | −1.0278 | 3.6578 | −0.7075 | 0.5446 | 3.6578 |
| 0.2179 | −0.9851 | 3.6578 | −0.6778 | 0.4942 | 3.6578 |
| 0.1747 | −0.9402 | 3.6578 | −0.6466 | 0.4417 | 3.6578 |
| 0.1302 | −0.8930 | 3.6578 | −0.6139 | 0.3870 | 3.6578 |
| 0.0842 | −0.8437 | 3.6578 | −0.5797 | 0.3304 | 3.6578 |
| 0.0370 | −0.7918 | 3.6578 | −0.5438 | 0.2718 | 3.6578 |
| −0.0111 | −0.7376 | 3.6578 | −0.5062 | 0.2112 | 3.6578 |
| −0.0602 | −0.6809 | 3.6578 | −0.4669 | 0.1487 | 3.6578 |
| −0.1100 | −0.6217 | 3.6578 | −0.4259 | 0.0844 | 3.6578 |
| −0.1588 | −0.5618 | 3.6578 | −0.3845 | 0.0202 | 3.6578 |
| −0.2064 | −0.5012 | 3.6578 | −0.3426 | 0.0436 | 3.6578 |
| −0.2528 | −0.4398 | 3.6578 | −0.3003 | −0.1072 | 3.6578 |
| −0.2981 | −0.3776 | 3.6578 | −0.2578 | −0.1705 | 3.6578 |
| −0.3423 | −0.3148 | 3.6578 | −0.2149 | −0.2336 | 3.6578 |
| −0.3854 | −0.2512 | 3.6578 | −0.1717 | −0.2966 | 3.6578 |
| −0.4276 | −0.1870 | 3.6578 | −0.1284 | −0.3595 | 3.6578 |
| −0.4688 | −0.1221 | 3.6578 | −0.0851 | −0.4223 | 3.6578 |
| −0.5090 | −0.0567 | 3.6578 | −0.0416 | −0.4851 | 3.6578 |
| −0.5483 | 0.0094 | 3.6578 | 0.0018 | −0.5479 | 3.6578 |
| −0.5866 | 0.0761 | 3.6578 | 0.0456 | −0.6105 | 3.6578 |
| −0.6228 | 0.1412 | 3.6578 | 0.0879 | −0.6709 | 3.6578 |
| −0.6568 | 0.2045 | 3.6578 | 0.1291 | −0.7291 | 3.6578 |
| −0.6889 | 0.2662 | 3.6578 | 0.1690 | −0.7850 | 3.6578 |
| −0.7189 | 0.3260 | 3.6578 | 0.2076 | −0.8388 | 3.6578 |
| −0.7471 | 0.3840 | 3.6578 | 0.2449 | −0.8903 | 3.6578 |
| −0.7735 | 0.4401 | 3.6578 | 0.2811 | −0.9396 | 3.6578 |
| −0.7982 | 0.4944 | 3.6578 | 0.3158 | −0.9867 | 3.6578 |
| −0.8211 | 0.5466 | 3.6578 | 0.3479 | −1.0294 | 3.6578 |
| −0.8415 | 0.5944 | 3.6578 | 0.3773 | −1.0679 | 3.6578 |
| −0.8591 | 0.6376 | 3.6578 | 0.4037 | −1.1020 | 3.6578 |
| −0.8744 | 0.6763 | 3.6578 | 0.4274 | −1.1320 | 3.6578 |
| −0.8881 | 0.7127 | 3.6578 | 0.4480 | −1.1579 | 3.6578 |
| −0.8990 | 0.7447 | 3.6578 | 0.4656 | −1.1797 | 3.6578 |
| −0.9060 | 0.7696 | 3.6578 | 0.4807 | −1.1983 | 3.6578 |
| −0.9099 | 0.7901 | 3.6578 | 0.4935 | −1.2138 | 3.6578 |
| −0.9112 | 0.8056 | 3.6578 | 0.5041 | −1.2265 | 3.6578 |
| −0.9104 | 0.8173 | 3.6578 | 0.5126 | −1.2366 | 3.6578 |
| −0.9085 | 0.8234 | 3.6578 | 0.5191 | −1.2444 | 3.6578 |
| −0.9063 | 0.8269 | 3.6578 | 0.5216 | −1.2517 | 3.6578 |
| −0.9047 | 0.8283 | 3.6578 | 0.5210 | −1.2581 | 3.6578 |
| −0.9038 | 0.8289 | 3.6578 | 0.5188 | −1.2628 | 3.6578 |
| 0.5065 | −1.2793 | 3.8056 | −0.9073 | 0.8204 | 3.8056 |
| 0.5034 | −1.2815 | 3.8056 | −0.9068 | 0.8207 | 3.8056 |
| 0.4984 | −1.2833 | 3.8056 | −0.9058 | 0.8210 | 3.8056 |
| 0.4919 | −1.2830 | 3.8056 | −0.9038 | 0.8212 | 3.8056 |

TABLE 8-continued

| SUCTION SIDE | | | PRESSURE SIDE | | |
|---|---|---|---|---|---|
| X | Y | Z | X | Y | Z |
| 0.4851 | −1.2793 | 3.8056 | −0.8996 | 0.8205 | 3.8056 |
| 0.4778 | −1.2720 | 3.8056 | −0.8938 | 0.8178 | 3.8056 |
| 0.4684 | −1.2623 | 3.8056 | −0.8847 | 0.8107 | 3.8056 |
| 0.4567 | −1.2502 | 3.8056 | −0.8740 | 0.7997 | 3.8056 |
| 0.4425 | −1.2355 | 3.8056 | −0.8613 | 0.7838 | 3.8056 |
| 0.4256 | −1.2181 | 3.8056 | −0.8469 | 0.7629 | 3.8056 |
| 0.4057 | −1.1976 | 3.8056 | −0.8296 | 0.7347 | 3.8056 |
| 0.3823 | −1.1735 | 3.8056 | −0.8103 | 0.7018 | 3.8056 |
| 0.3552 | −1.1456 | 3.8056 | −0.7898 | 0.6665 | 3.8056 |
| 0.3245 | −1.1140 | 3.8056 | −0.7669 | 0.6268 | 3.8056 |
| 0.2903 | −1.0786 | 3.8056 | −0.7415 | 0.5827 | 3.8056 |
| 0.2525 | −1.0395 | 3.8056 | −0.7134 | 0.5342 | 3.8056 |
| 0.2114 | −0.9965 | 3.8056 | −0.6838 | 0.4836 | 3.8056 |
| 0.1687 | −0.9513 | 3.8056 | −0.6530 | 0.4310 | 3.8056 |
| 0.1247 | −0.9038 | 3.8056 | −0.6204 | 0.3763 | 3.8056 |
| 0.0794 | −0.8540 | 3.8056 | −0.5863 | 0.3195 | 3.8056 |
| 0.0329 | −0.8020 | 3.8056 | −0.5507 | 0.2607 | 3.8056 |
| −0.0145 | −0.7476 | 3.8056 | −0.5133 | 0.2001 | 3.8056 |
| −0.0629 | −0.6906 | 3.8056 | −0.4742 | 0.1375 | 3.8056 |
| −0.1121 | −0.6310 | 3.8056 | −0.4334 | 0.0730 | 3.8056 |
| −0.1602 | −0.5709 | 3.8056 | −0.3921 | 0.0087 | 3.8056 |
| −0.2074 | −0.5100 | 3.8056 | −0.3505 | −0.0553 | 3.8056 |
| −0.2534 | −0.4484 | 3.8056 | −0.3084 | −0.1190 | 3.8056 |
| −0.2983 | −0.3860 | 3.8056 | −0.2659 | −0.1824 | 3.8056 |
| −0.3422 | −0.3230 | 3.8056 | −0.2231 | −0.2457 | 3.8056 |
| −0.3851 | −0.2592 | 3.8056 | −0.1800 | −0.3088 | 3.8056 |
| −0.4271 | −0.1948 | 3.8056 | −0.1368 | −0.3717 | 3.8056 |
| −0.4682 | −0.1299 | 3.8056 | −0.0935 | −0.4346 | 3.8056 |
| −0.5085 | −0.0643 | 3.8056 | −0.0501 | −0.4975 | 3.8056 |
| −0.5478 | 0.0018 | 3.8056 | −0.0066 | −0.5603 | 3.8056 |
| −0.5862 | 0.0686 | 3.8056 | 0.0370 | −0.6230 | 3.8056 |
| −0.6224 | 0.1337 | 3.8056 | 0.0794 | −0.6835 | 3.8056 |
| −0.6567 | 0.1971 | 3.8056 | 0.1205 | −0.7418 | 3.8056 |
| −0.6890 | 0.2588 | 3.8056 | 0.1603 | −0.7978 | 3.8056 |
| −0.7192 | 0.3186 | 3.8056 | 0.1989 | −0.8516 | 3.8056 |
| −0.7477 | 0.3766 | 3.8056 | 0.2361 | −0.9031 | 3.8056 |
| −0.7744 | 0.4328 | 3.8056 | 0.2722 | −0.9525 | 3.8056 |
| −0.7993 | 0.4870 | 3.8056 | 0.3069 | −0.9997 | 3.8056 |
| −0.8225 | 0.5390 | 3.8056 | 0.3388 | −1.0425 | 3.8056 |
| −0.8430 | 0.5866 | 3.8056 | 0.3681 | −1.0811 | 3.8056 |
| −0.8610 | 0.6296 | 3.8056 | 0.3945 | −1.1154 | 3.8056 |
| −0.8764 | 0.6681 | 3.8056 | 0.4181 | −1.1454 | 3.8056 |
| −0.8904 | 0.7044 | 3.8056 | 0.4386 | −1.1714 | 3.8056 |
| −0.9016 | 0.7361 | 3.8056 | 0.4561 | −1.1933 | 3.8056 |
| −0.9088 | 0.7610 | 3.8056 | 0.4712 | −1.2119 | 3.8056 |
| −0.9130 | 0.7814 | 3.8056 | 0.4839 | −1.2274 | 3.8056 |
| −0.9146 | 0.7968 | 3.8056 | 0.4945 | −1.2402 | 3.8056 |
| −0.9140 | 0.8085 | 3.8056 | 0.5029 | −1.2504 | 3.8056 |
| −0.9123 | 0.8147 | 3.8056 | 0.5093 | −1.2583 | 3.8056 |
| −0.9102 | 0.8182 | 3.8056 | 0.5118 | −1.2654 | 3.8056 |
| −0.9086 | 0.8196 | 3.8056 | 0.5112 | −1.2718 | 3.8056 |
| −0.9077 | 0.8202 | 3.8056 | 0.5090 | −1.2764 | 3.8056 |
| 0.4870 | −1.2928 | 3.9533 | −0.9049 | 0.8165 | 3.9533 |
| 0.4838 | −1.2951 | 3.9533 | −0.9045 | 0.8166 | 3.9533 |
| 0.4790 | −1.2969 | 3.9533 | −0.9035 | 0.8170 | 3.9533 |
| 0.4725 | −1.2965 | 3.9533 | −0.9014 | 0.8172 | 3.9533 |
| 0.4657 | −1.2927 | 3.9533 | −0.8973 | 0.8164 | 3.9533 |
| 0.4586 | −1.2853 | 3.9533 | −0.8916 | 0.8135 | 3.9533 |
| 0.4492 | −1.2756 | 3.9533 | −0.8826 | 0.8063 | 3.9533 |
| 0.4376 | −1.2636 | 3.9533 | −0.8721 | 0.7952 | 3.9533 |
| 0.4235 | −1.2489 | 3.9533 | −0.8597 | 0.7791 | 3.9533 |
| 0.4067 | −1.2314 | 3.9533 | −0.8456 | 0.7579 | 3.9533 |
| 0.3870 | −1.2110 | 3.9533 | −0.8287 | 0.7296 | 3.9533 |
| 0.3639 | −1.1867 | 3.9533 | −0.8099 | 0.6965 | 3.9533 |
| 0.3371 | −1.1587 | 3.9533 | −0.7899 | 0.6611 | 3.9533 |
| 0.3069 | −1.1270 | 3.9533 | −0.7674 | 0.6212 | 3.9533 |
| 0.2731 | −1.0915 | 3.9533 | −0.7425 | 0.5768 | 3.9533 |
| 0.2358 | −1.0521 | 3.9533 | −0.7151 | 0.5281 | 3.9533 |
| 0.1953 | −1.0088 | 3.9533 | −0.6862 | 0.4773 | 3.9533 |
| 0.1534 | −0.9632 | 3.9533 | −0.6559 | 0.4243 | 3.9533 |
| 0.1102 | −0.9154 | 3.9533 | −0.6240 | 0.3693 | 3.9533 |
| 0.0657 | −0.8652 | 3.9533 | −0.5907 | 0.3123 | 3.9533 |
| 0.0202 | −0.8128 | 3.9533 | −0.5556 | 0.2533 | 3.9533 |
| −0.0261 | −0.7578 | 3.9533 | −0.5190 | 0.1923 | 3.9533 |
| −0.0735 | −0.7003 | 3.9533 | −0.4807 | 0.1294 | 3.9533 |
| −0.1215 | −0.6403 | 3.9533 | −0.4406 | 0.0645 | 3.9533 |

TABLE 8-continued

| SUCTION SIDE | | | PRESSURE SIDE | | |
|---|---|---|---|---|---|
| X | Y | Z | X | Y | Z |
| −0.1687 | −0.5796 | 3.9533 | −0.4000 | 0.0000 | 3.9533 |
| −0.2148 | −0.5181 | 3.9533 | −0.3591 | −0.0643 | 3.9533 |
| −0.2598 | −0.4558 | 3.9533 | −0.3178 | −0.1284 | 3.9533 |
| −0.3039 | −0.3930 | 3.9533 | −0.2761 | −0.1922 | 3.9533 |
| −0.3469 | −0.3294 | 3.9533 | −0.2339 | −0.2558 | 3.9533 |
| −0.3890 | −0.2652 | 3.9533 | −0.1915 | −0.3192 | 3.9533 |
| −0.4304 | −0.2004 | 3.9533 | −0.1489 | −0.3824 | 3.9533 |
| −0.4709 | −0.1350 | 3.9533 | −0.1062 | −0.4456 | 3.9533 |
| −0.5106 | −0.0691 | 3.9533 | −0.0634 | −0.5087 | 3.9533 |
| −0.5494 | −0.0025 | 3.9533 | −0.0206 | −0.5718 | 3.9533 |
| −0.5873 | 0.0647 | 3.9533 | 0.0224 | −0.6347 | 3.9533 |
| −0.6232 | 0.1302 | 3.9533 | 0.0642 | −0.6956 | 3.9533 |
| −0.6570 | 0.1940 | 3.9533 | 0.1047 | −0.7541 | 3.9533 |
| −0.6890 | 0.2559 | 3.9533 | 0.1441 | −0.8103 | 3.9533 |
| −0.7189 | 0.3159 | 3.9533 | 0.1821 | −0.8643 | 3.9533 |
| −0.7469 | 0.3740 | 3.9533 | 0.2189 | −0.9161 | 3.9533 |
| −0.7733 | 0.4300 | 3.9533 | 0.2546 | −0.9656 | 3.9533 |
| −0.7979 | 0.4840 | 3.9533 | 0.2889 | −1.0130 | 3.9533 |
| −0.8208 | 0.5360 | 3.9533 | 0.3206 | −1.0559 | 3.9533 |
| −0.8411 | 0.5834 | 3.9533 | 0.3495 | −1.0946 | 3.9533 |
| −0.8589 | 0.6263 | 3.9533 | 0.3758 | −1.1290 | 3.9533 |
| −0.8742 | 0.6647 | 3.9533 | 0.3992 | −1.1590 | 3.9533 |
| −0.8880 | 0.7008 | 3.9533 | 0.4195 | −1.1851 | 3.9533 |
| −0.8991 | 0.7325 | 3.9533 | 0.4369 | −1.2070 | 3.9533 |
| −0.9062 | 0.7572 | 3.9533 | 0.4519 | −1.2256 | 3.9533 |
| −0.9104 | 0.7775 | 3.9533 | 0.4645 | −1.2412 | 3.9533 |
| −0.9120 | 0.7929 | 3.9533 | 0.4749 | −1.2540 | 3.9533 |
| −0.9115 | 0.8045 | 3.9533 | 0.4833 | −1.2642 | 3.9533 |
| −0.9098 | 0.8107 | 3.9533 | 0.4897 | −1.2721 | 3.9533 |
| −0.9078 | 0.8143 | 3.9533 | 0.4921 | −1.2792 | 3.9533 |
| −0.9063 | 0.8157 | 3.9533 | 0.4916 | −1.2854 | 3.9533 |
| −0.9054 | 0.8162 | 3.9533 | 0.4895 | −1.2900 | 3.9533 |
| 0.4778 | −1.2981 | 4.0137 | −0.9002 | 0.8188 | 4.0137 |
| 0.4747 | −1.3004 | 4.0137 | −0.8998 | 0.8190 | 4.0137 |
| 0.4698 | −1.3020 | 4.0137 | −0.8987 | 0.8193 | 4.0137 |
| 0.4633 | −1.3017 | 4.0137 | −0.8967 | 0.8195 | 4.0137 |
| 0.4566 | −1.2979 | 4.0137 | −0.8927 | 0.8187 | 4.0137 |
| 0.4494 | −1.2905 | 4.0137 | −0.8870 | 0.8157 | 4.0137 |
| 0.4401 | −1.2808 | 4.0137 | −0.8781 | 0.8085 | 4.0137 |
| 0.4285 | −1.2688 | 4.0137 | −0.8677 | 0.7971 | 4.0137 |
| 0.4144 | −1.2541 | 4.0137 | −0.8554 | 0.7809 | 4.0137 |
| 0.3976 | −1.2366 | 4.0137 | −0.8416 | 0.7597 | 4.0137 |
| 0.3780 | −1.2161 | 4.0137 | −0.8250 | 0.7313 | 4.0137 |
| 0.3548 | −1.1919 | 4.0137 | −0.8064 | 0.6979 | 4.0137 |
| 0.3281 | −1.1639 | 4.0137 | −0.7868 | 0.6624 | 4.0137 |
| 0.2979 | −1.1321 | 4.0137 | −0.7648 | 0.6222 | 4.0137 |
| 0.2642 | −1.0966 | 4.0137 | −0.7403 | 0.5777 | 4.0137 |
| 0.2270 | −1.0571 | 4.0137 | −0.7133 | 0.5288 | 4.0137 |
| 0.1866 | −1.0137 | 4.0137 | −0.6850 | 0.4778 | 4.0137 |
| 0.1449 | −0.9679 | 4.0137 | −0.6552 | 0.4246 | 4.0137 |
| 0.1020 | −0.9199 | 4.0137 | −0.6238 | 0.3693 | 4.0137 |
| 0.0579 | −0.8695 | 4.0137 | −0.5910 | 0.3120 | 4.0137 |
| 0.0128 | −0.8167 | 4.0137 | −0.5566 | 0.2527 | 4.0137 |
| −0.0333 | −0.7616 | 4.0137 | −0.5205 | 0.1915 | 4.0137 |
| −0.0802 | −0.7037 | 4.0137 | −0.4828 | 0.1282 | 4.0137 |
| −0.1278 | −0.6433 | 4.0137 | −0.4433 | 0.0631 | 4.0137 |
| −0.1743 | −0.5822 | 4.0137 | −0.4034 | −0.0018 | 4.0137 |
| −0.2198 | −0.5203 | 4.0137 | −0.3630 | −0.0664 | 4.0137 |
| −0.2643 | −0.4578 | 4.0137 | −0.3223 | −0.1308 | 4.0137 |
| −0.3077 | −0.3945 | 4.0137 | −0.2811 | −0.1949 | 4.0137 |
| −0.3502 | −0.3306 | 4.0137 | −0.2394 | −0.2588 | 4.0137 |
| −0.3919 | −0.2660 | 4.0137 | −0.1976 | −0.3224 | 4.0137 |
| −0.4326 | −0.2009 | 4.0137 | −0.1554 | −0.3859 | 4.0137 |
| −0.4726 | −0.1352 | 4.0137 | −0.1132 | −0.4493 | 4.0137 |
| −0.5117 | −0.0689 | 4.0137 | −0.0708 | −0.5126 | 4.0137 |
| −0.5500 | −0.0020 | 4.0137 | −0.0282 | −0.5759 | 4.0137 |
| −0.5874 | 0.0654 | 4.0137 | 0.0144 | −0.6390 | 4.0137 |
| −0.6228 | 0.1312 | 4.0137 | 0.0560 | −0.6999 | 4.0137 |
| −0.6562 | 0.1952 | 4.0137 | 0.0962 | −0.7585 | 4.0137 |
| −0.6876 | 0.2573 | 4.0137 | 0.1353 | −0.8149 | 4.0137 |
| −0.7171 | 0.3175 | 4.0137 | 0.1732 | −0.8689 | 4.0137 |
| −0.7448 | 0.3757 | 4.0137 | 0.2099 | −0.9208 | 4.0137 |
| −0.7709 | 0.4318 | 4.0137 | 0.2453 | −0.9704 | 4.0137 |
| −0.7950 | 0.4860 | 4.0137 | 0.2796 | −1.0177 | 4.0137 |
| −0.8176 | 0.5380 | 4.0137 | 0.3112 | −1.0608 | 4.0137 |
| −0.8377 | 0.5856 | 4.0137 | 0.3400 | −1.0994 | 4.0137 |

TABLE 8-continued

| SUCTION SIDE | | | PRESSURE SIDE | | |
|---|---|---|---|---|---|
| X | Y | Z | X | Y | Z |
| −0.8551 | 0.6286 | 4.0137 | 0.3663 | −1.1337 | 4.0137 |
| −0.8702 | 0.6670 | 4.0137 | 0.3896 | −1.1638 | 4.0137 |
| −0.8839 | 0.7031 | 4.0137 | 0.4099 | −1.1898 | 4.0137 |
| −0.8948 | 0.7349 | 4.0137 | 0.4273 | −1.2117 | 4.0137 |
| −0.9017 | 0.7597 | 4.0137 | 0.4422 | −1.2303 | 4.0137 |
| −0.9059 | 0.7799 | 4.0137 | 0.4549 | −1.2460 | 4.0137 |
| −0.9074 | 0.7953 | 4.0137 | 0.4653 | −1.2588 | 4.0137 |
| −0.9068 | 0.8069 | 4.0137 | 0.4736 | −1.2690 | 4.0137 |
| −0.9052 | 0.8131 | 4.0137 | 0.4800 | −1.2769 | 4.0137 |
| −0.9031 | 0.8166 | 4.0137 | 0.4829 | −1.2839 | 4.0137 |
| −0.9016 | 0.8180 | 4.0137 | 0.4824 | −1.2903 | 4.0137 |
| −0.9007 | 0.8186 | 4.0137 | 0.4804 | −1.2951 | 4.0137 |
| 0.4448 | −1.3167 | 4.2488 | −0.8664 | 0.8462 | 4.2488 |
| 0.4416 | −1.3189 | 4.2488 | −0.8659 | 0.8464 | 4.2488 |
| 0.4367 | −1.3206 | 4.2488 | −0.8650 | 0.8466 | 4.2488 |
| 0.4301 | −1.3202 | 4.2488 | −0.8628 | 0.8466 | 4.2488 |
| 0.4235 | −1.3161 | 4.2488 | −0.8589 | 0.8453 | 4.2488 |
| 0.4163 | −1.3087 | 4.2488 | −0.8535 | 0.8419 | 4.2488 |
| 0.4070 | −1.2991 | 4.2488 | −0.8452 | 0.8339 | 4.2488 |
| 0.3953 | −1.2869 | 4.2488 | −0.8356 | 0.8219 | 4.2488 |
| 0.3810 | −1.2721 | 4.2488 | −0.8246 | 0.8048 | 4.2488 |
| 0.3642 | −1.2545 | 4.2488 | −0.8122 | 0.7828 | 4.2488 |
| 0.3445 | −1.2339 | 4.2488 | −0.7974 | 0.7532 | 4.2488 |
| 0.3213 | −1.2096 | 4.2488 | −0.7810 | 0.7187 | 4.2488 |
| 0.2945 | −1.1813 | 4.2488 | −0.7636 | 0.6818 | 4.2488 |
| 0.2644 | −1.1493 | 4.2488 | −0.7440 | 0.6404 | 4.2488 |
| 0.2306 | −1.1134 | 4.2488 | −0.7222 | 0.5944 | 4.2488 |
| 0.1937 | −1.0734 | 4.2488 | −0.6980 | 0.5438 | 4.2488 |
| 0.1536 | −1.0294 | 4.2488 | −0.6726 | 0.4911 | 4.2488 |
| 0.1122 | −0.9829 | 4.2488 | −0.6457 | 0.4362 | 4.2488 |
| 0.0697 | −0.9340 | 4.2488 | −0.6175 | 0.3792 | 4.2488 |
| 0.0263 | −0.8827 | 4.2488 | −0.5878 | 0.3201 | 4.2488 |
| −0.0179 | −0.8289 | 4.2488 | −0.5564 | 0.2590 | 4.2488 |
| −0.0627 | −0.7725 | 4.2488 | −0.5235 | 0.1958 | 4.2488 |
| −0.1082 | −0.7134 | 4.2488 | −0.4888 | 0.1306 | 4.2488 |
| −0.1542 | −0.6515 | 4.2488 | −0.4524 | 0.0635 | 4.2488 |
| −0.1988 | −0.5888 | 4.2488 | −0.4154 | −0.0033 | 4.2488 |
| −0.2423 | −0.5253 | 4.2488 | −0.3777 | −0.0697 | 4.2488 |
| −0.2845 | −0.4610 | 4.2488 | −0.3394 | −0.1358 | 4.2488 |
| −0.3256 | −0.3960 | 4.2488 | −0.3006 | −0.2015 | 4.2488 |
| −0.3656 | −0.3304 | 4.2488 | −0.2612 | −0.2669 | 4.2488 |
| −0.4047 | −0.2641 | 4.2488 | −0.2212 | −0.3319 | 4.2488 |
| −0.4429 | −0.1972 | 4.2488 | −0.1808 | −0.3967 | 4.2488 |
| −0.4801 | −0.1296 | 4.2488 | −0.1399 | −0.4612 | 4.2488 |
| −0.5164 | −0.0615 | 4.2488 | −0.0987 | −0.5255 | 4.2488 |
| −0.5518 | 0.0071 | 4.2488 | −0.0573 | −0.5897 | 4.2488 |
| −0.5863 | 0.0765 | 4.2488 | −0.0156 | −0.6536 | 4.2488 |
| −0.6186 | 0.1441 | 4.2488 | 0.0252 | −0.7152 | 4.2488 |
| −0.6492 | 0.2097 | 4.2488 | 0.0648 | −0.7745 | 4.2488 |
| −0.6778 | 0.2735 | 4.2488 | 0.1033 | −0.8313 | 4.2488 |
| −0.7045 | 0.3352 | 4.2488 | 0.1407 | −0.8859 | 4.2488 |
| −0.7296 | 0.3948 | 4.2488 | 0.1771 | −0.9382 | 4.2488 |
| −0.7530 | 0.4523 | 4.2488 | 0.2123 | −0.9881 | 4.2488 |
| −0.7748 | 0.5077 | 4.2488 | 0.2464 | −1.0357 | 4.2488 |
| −0.7951 | 0.5609 | 4.2488 | 0.2779 | −1.0789 | 4.2488 |
| −0.8129 | 0.6095 | 4.2488 | 0.3067 | −1.1177 | 4.2488 |
| −0.8285 | 0.6533 | 4.2488 | 0.3328 | −1.1522 | 4.2488 |
| −0.8420 | 0.6925 | 4.2488 | 0.3562 | −1.1825 | 4.2488 |
| −0.8541 | 0.7293 | 4.2488 | 0.3766 | −1.2085 | 4.2488 |
| −0.8637 | 0.7616 | 4.2488 | 0.3940 | −1.2305 | 4.2488 |
| −0.8697 | 0.7868 | 4.2488 | 0.4089 | −1.2492 | 4.2488 |
| −0.8730 | 0.8072 | 4.2488 | 0.4216 | −1.2647 | 4.2488 |
| −0.8740 | 0.8227 | 4.2488 | 0.4320 | −1.2776 | 4.2488 |
| −0.8732 | 0.8343 | 4.2488 | 0.4404 | −1.2879 | 4.2488 |
| −0.8715 | 0.8405 | 4.2488 | 0.4469 | −1.2957 | 4.2488 |
| −0.8694 | 0.8441 | 4.2488 | 0.4497 | −1.3028 | 4.2488 |
| −0.8678 | 0.8454 | 4.2488 | 0.4493 | −1.3091 | 4.2488 |
| −0.8669 | 0.8459 | 4.2488 | 0.4473 | −1.3137 | 4.2488 |
| 0.4050 | −1.3390 | 4.5443 | −0.8201 | 0.8850 | 4.5443 |
| 0.4018 | −1.3413 | 4.5443 | −0.8195 | 0.8851 | 4.5443 |
| 0.3968 | −1.3429 | 4.5443 | −0.8186 | 0.8852 | 4.5443 |
| 0.3902 | −1.3423 | 4.5443 | −0.8165 | 0.8849 | 4.5443 |
| 0.3837 | −1.3380 | 4.5443 | −0.8127 | 0.8833 | 4.5443 |
| 0.3765 | −1.3305 | 4.5443 | −0.8078 | 0.8790 | 4.5443 |
| 0.3670 | −1.3207 | 4.5443 | −0.8004 | 0.8701 | 4.5443 |
| 0.3553 | −1.3085 | 4.5443 | −0.7921 | 0.8572 | 4.5443 |

TABLE 8-continued

| SUCTION SIDE | | | PRESSURE SIDE | | |
|---|---|---|---|---|---|
| X | Y | Z | X | Y | Z |
| 0.3410 | −1.2936 | 4.5443 | −0.7827 | 0.8391 | 4.5443 |
| 0.3240 | −1.2758 | 4.5443 | −0.7723 | 0.8158 | 4.5443 |
| 0.3043 | −1.2550 | 4.5443 | −0.7601 | 0.7848 | 4.5443 |
| 0.2810 | −1.2303 | 4.5443 | −0.7467 | 0.7488 | 4.5443 |
| 0.2542 | −1.2017 | 4.5443 | −0.7323 | 0.7103 | 4.5443 |
| 0.2241 | −1.1692 | 4.5443 | −0.7161 | 0.6672 | 4.5443 |
| 0.1906 | −1.1326 | 4.5443 | −0.6978 | 0.6193 | 4.5443 |
| 0.1537 | −1.0920 | 4.5443 | −0.6775 | 0.5668 | 4.5443 |
| 0.1140 | −1.0470 | 4.5443 | −0.6560 | 0.5120 | 4.5443 |
| 0.0731 | −0.9995 | 4.5443 | −0.6331 | 0.4550 | 4.5443 |
| 0.0314 | −0.9494 | 4.5443 | −0.6088 | 0.3959 | 4.5443 |
| −0.0111 | −0.8969 | 4.5443 | −0.5830 | 0.3346 | 4.5443 |
| −0.0542 | −0.8416 | 4.5443 | −0.5556 | 0.2712 | 4.5443 |
| −0.0978 | −0.7836 | 4.5443 | −0.5266 | 0.2059 | 4.5443 |
| −0.1416 | −0.7228 | 4.5443 | −0.4959 | 0.1385 | 4.5443 |
| −0.1855 | −0.6590 | 4.5443 | −0.4632 | 0.0693 | 4.5443 |
| −0.2280 | −0.5944 | 4.5443 | −0.4298 | 0.0004 | 4.5443 |
| −0.2691 | −0.5288 | 4.5443 | −0.3955 | −0.0682 | 4.5443 |
| −0.3088 | −0.4624 | 4.5443 | −0.3604 | −0.1363 | 4.5443 |
| −0.3472 | −0.3954 | 4.5443 | −0.3244 | −0.2040 | 4.5443 |
| −0.3846 | −0.3275 | 4.5443 | −0.2876 | −0.2712 | 4.5443 |
| −0.4208 | −0.2591 | 4.5443 | −0.2500 | −0.3381 | 4.5443 |
| −0.4559 | −0.1899 | 4.5443 | −0.2116 | −0.4046 | 4.5443 |
| −0.4899 | −0.1200 | 4.5443 | −0.1725 | −0.4707 | 4.5443 |
| −0.5228 | −0.0495 | 4.5443 | −0.1327 | −0.5365 | 4.5443 |
| −0.5547 | 0.0216 | 4.5443 | −0.0926 | −0.6020 | 4.5443 |
| −0.5854 | 0.0935 | 4.5443 | −0.0519 | −0.6672 | 4.5443 |
| −0.6140 | 0.1633 | 4.5443 | −0.0122 | −0.7300 | 4.5443 |
| −0.6406 | 0.2313 | 4.5443 | 0.0266 | −0.7903 | 4.5443 |
| −0.6655 | 0.2971 | 4.5443 | 0.0645 | −0.8481 | 4.5443 |
| −0.6884 | 0.3608 | 4.5443 | 0.1015 | −0.9036 | 4.5443 |
| −0.7098 | 0.4223 | 4.5443 | 0.1375 | −0.9566 | 4.5443 |
| −0.7296 | 0.4816 | 4.5443 | 0.1724 | −1.0072 | 4.5443 |
| −0.7479 | 0.5386 | 4.5443 | 0.2062 | −1.0554 | 4.5443 |
| −0.7648 | 0.5935 | 4.5443 | 0.2375 | −1.0991 | 4.5443 |
| −0.7797 | 0.6435 | 4.5443 | 0.2663 | −1.1385 | 4.5443 |
| −0.7925 | 0.6885 | 4.5443 | 0.2923 | −1.1733 | 4.5443 |
| −0.8035 | 0.7287 | 4.5443 | 0.3157 | −1.2038 | 4.5443 |
| −0.8135 | 0.7666 | 4.5443 | 0.3362 | −1.2302 | 4.5443 |
| −0.8212 | 0.7996 | 4.5443 | 0.3535 | −1.2523 | 4.5443 |
| −0.8258 | 0.8252 | 4.5443 | 0.3685 | −1.2712 | 4.5443 |
| −0.8281 | 0.8459 | 4.5443 | 0.3812 | −1.2869 | 4.5443 |
| −0.8283 | 0.8615 | 4.5443 | 0.3918 | −1.2998 | 4.5443 |
| −0.8271 | 0.8731 | 4.5443 | 0.4002 | −1.3101 | 4.5443 |
| −0.8253 | 0.8794 | 4.5443 | 0.4067 | −1.3181 | 4.5443 |
| −0.8231 | 0.8830 | 4.5443 | 0.4097 | −1.3250 | 4.5443 |
| −0.8215 | 0.8843 | 4.5443 | 0.4095 | −1.3314 | 4.5443 |
| −0.8206 | 0.8848 | 4.5443 | 0.4074 | −1.3361 | 4.5443 |

TABLE 9

| SUCTION SIDE | | | PRESSURE SIDE | | |
|---|---|---|---|---|---|
| X | Y | Z | X | Y | Z |
| 1.3231 | −1.0089 | −0.2137 | −0.7735 | 1.1225 | −0.2137 |
| 1.3207 | −1.0131 | −0.2137 | −0.7729 | 1.1227 | −0.2137 |
| 1.3165 | −1.0178 | −0.2137 | −0.7718 | 1.1230 | −0.2137 |
| 1.3101 | −1.0228 | −0.2137 | −0.7693 | 1.1236 | −0.2137 |
| 1.3014 | −1.0267 | −0.2137 | −0.7644 | 1.1241 | −0.2137 |
| 1.2886 | −1.0279 | −0.2137 | −0.7569 | 1.1234 | −0.2137 |
| 1.2728 | −1.0227 | −0.2137 | −0.7438 | 1.1189 | −0.2137 |
| 1.2533 | −1.0149 | −0.2137 | −0.7282 | 1.1093 | −0.2137 |
| 1.2296 | −1.0052 | −0.2137 | −0.7100 | 1.0933 | −0.2137 |
| 1.2016 | −0.9935 | −0.2137 | −0.6899 | 1.0708 | −0.2137 |
| 1.1688 | −0.9798 | −0.2137 | −0.6661 | 1.0392 | −0.2137 |
| 1.1301 | −0.9634 | −0.2137 | −0.6399 | 1.0020 | −0.2137 |
| 1.0855 | −0.9444 | −0.2137 | −0.6124 | 0.9619 | −0.2137 |
| 1.0351 | −0.9224 | −0.2137 | −0.5816 | 0.9169 | −0.2137 |
| 0.9790 | −0.8975 | −0.2137 | −0.5473 | 0.8667 | −0.2137 |
| 0.9172 | −0.8694 | −0.2137 | −0.5095 | 0.8116 | −0.2137 |
| 0.8499 | −0.8380 | −0.2137 | −0.4698 | 0.7543 | −0.2137 |
| 0.7802 | −0.8043 | −0.2137 | −0.4278 | 0.6947 | −0.2137 |

TABLE 9-continued

| SUCTION SIDE | | | PRESSURE SIDE | | |
|---|---|---|---|---|---|
| X | Y | Z | X | Y | Z |
| 0.7080 | −0.7684 | −0.2137 | −0.3838 | 0.6331 | −0.2137 |
| 0.6334 | −0.7298 | −0.2137 | −0.3372 | 0.5696 | −0.2137 |
| 0.5567 | −0.6885 | −0.2137 | −0.2880 | 0.5042 | −0.2137 |
| 0.4778 | −0.6441 | −0.2137 | −0.2363 | 0.4371 | −0.2137 |
| 0.3970 | −0.5965 | −0.2137 | −0.1818 | 0.3683 | −0.2137 |
| 0.3148 | −0.5455 | −0.2137 | −0.1245 | 0.2979 | −0.2137 |
| 0.2339 | −0.4928 | −0.2137 | −0.0663 | 0.2283 | −0.2137 |
| 0.1547 | −0.4381 | −0.2137 | −0.0072 | 0.1594 | −0.2137 |
| 0.0771 | −0.3812 | −0.2137 | 0.0525 | 0.0910 | −0.2137 |
| 0.0013 | −0.3221 | −0.2137 | 0.1133 | 0.0234 | −0.2137 |
| −0.0726 | −0.2605 | −0.2137 | 0.1751 | −0.0432 | −0.2137 |
| −0.1444 | −0.1962 | −0.2137 | 0.2379 | −0.1090 | −0.2137 |
| −0.2139 | −0.1292 | −0.2137 | 0.3020 | −0.1738 | −0.2137 |
| −0.2809 | −0.0588 | −0.2137 | 0.3672 | −0.2375 | −0.2137 |
| −0.3448 | 0.0148 | −0.2137 | 0.4336 | −0.2997 | −0.2137 |
| −0.4050 | 0.0907 | −0.2137 | 0.5011 | −0.3608 | −0.2137 |
| −0.4617 | 0.1690 | −0.2137 | 0.5697 | −0.4205 | −0.2137 |
| −0.5128 | 0.2467 | −0.2137 | 0.6371 | −0.4770 | −0.2137 |
| −0.5589 | 0.3239 | −0.2137 | 0.7031 | −0.5305 | −0.2137 |
| −0.6004 | 0.4003 | −0.2137 | 0.7676 | −0.5811 | −0.2137 |
| −0.6376 | 0.4755 | −0.2137 | 0.8303 | −0.6290 | −0.2137 |
| −0.6703 | 0.5496 | −0.2137 | 0.8913 | −0.6743 | −0.2137 |
| −0.6995 | 0.6222 | −0.2137 | 0.9503 | −0.7171 | −0.2137 |
| −0.7251 | 0.6925 | −0.2137 | 1.0073 | −0.7577 | −0.2137 |
| −0.7465 | 0.7609 | −0.2137 | 1.0596 | −0.7942 | −0.2137 |
| −0.7643 | 0.8236 | −0.2137 | 1.1072 | −0.8269 | −0.2137 |
| −0.7783 | 0.8806 | −0.2137 | 1.1499 | −0.8560 | −0.2137 |
| −0.7889 | 0.9316 | −0.2137 | 1.1877 | −0.8814 | −0.2137 |
| −0.7972 | 0.9798 | −0.2137 | 1.2206 | −0.9033 | −0.2137 |
| −0.8023 | 1.0218 | −0.2137 | 1.2484 | −0.9218 | −0.2137 |
| −0.8032 | 1.0544 | −0.2137 | 1.2722 | −0.9376 | −0.2137 |
| −0.8004 | 1.0802 | −0.2137 | 1.2922 | −0.9508 | −0.2137 |
| −0.7949 | 1.0990 | −0.2137 | 1.3087 | −0.9616 | −0.2137 |
| −0.7876 | 1.1118 | −0.2137 | 1.3207 | −0.9717 | −0.2137 |
| −0.7820 | 1.1176 | −0.2137 | 1.3260 | −0.9825 | −0.2137 |
| −0.7777 | 1.1206 | −0.2137 | 1.3274 | −0.9915 | −0.2137 |
| −0.7753 | 1.1218 | −0.2137 | 1.3266 | −0.9990 | −0.2137 |
| −0.7741 | 1.1223 | −0.2137 | 1.3250 | −1.0047 | −0.2137 |
| 1.2904 | −0.9979 | 0.0000 | −0.7737 | 1.1592 | 0.0000 |
| 1.2877 | −1.0019 | 0.0000 | −0.7730 | 1.1596 | 0.0000 |
| 1.2832 | −1.0063 | 0.0000 | −0.7720 | 1.1599 | 0.0000 |
| 1.2766 | −1.0106 | 0.0000 | −0.7695 | 1.1606 | 0.0000 |
| 1.2675 | −1.0136 | 0.0000 | −0.7647 | 1.1613 | 0.0000 |
| 1.2549 | −1.0134 | 0.0000 | −0.7571 | 1.1610 | 0.0000 |
| 1.2395 | −1.0071 | 0.0000 | −0.7440 | 1.1570 | 0.0000 |
| 1.2208 | −0.9981 | 0.0000 | −0.7281 | 1.1480 | 0.0000 |
| 1.1980 | −0.9874 | 0.0000 | −0.7095 | 1.1326 | 0.0000 |
| 1.1709 | −0.9744 | 0.0000 | −0.6888 | 1.1107 | 0.0000 |
| 1.1391 | −0.9593 | 0.0000 | −0.6644 | 1.0798 | 0.0000 |
| 1.1016 | −0.9412 | 0.0000 | −0.6375 | 1.0434 | 0.0000 |
| 1.0585 | −0.9203 | 0.0000 | −0.6091 | 1.0042 | 0.0000 |
| 1.0096 | −0.8963 | 0.0000 | −0.5774 | 0.9599 | 0.0000 |
| 0.9553 | −0.8694 | 0.0000 | −0.5423 | 0.9106 | 0.0000 |
| 0.8954 | −0.8392 | 0.0000 | −0.5038 | 0.8564 | 0.0000 |
| 0.8301 | −0.8054 | 0.0000 | −0.4632 | 0.7999 | 0.0000 |
| 0.7624 | −0.7695 | 0.0000 | −0.4205 | 0.7412 | 0.0000 |
| 0.6923 | −0.7313 | 0.0000 | −0.3757 | 0.6804 | 0.0000 |
| 0.6199 | −0.6904 | 0.0000 | −0.3285 | 0.6176 | 0.0000 |
| 0.5455 | −0.6469 | 0.0000 | −0.2789 | 0.5528 | 0.0000 |
| 0.4692 | −0.6002 | 0.0000 | −0.2268 | 0.4862 | 0.0000 |
| 0.3909 | −0.5504 | 0.0000 | −0.1723 | 0.4177 | 0.0000 |
| 0.3112 | −0.4973 | 0.0000 | −0.1150 | 0.3474 | 0.0000 |
| 0.2330 | −0.4425 | 0.0000 | −0.0572 | 0.2777 | 0.0000 |
| 0.1561 | −0.3862 | 0.0000 | 0.0013 | 0.2085 | 0.0000 |
| 0.0807 | −0.3280 | 0.0000 | 0.0603 | 0.1397 | 0.0000 |
| 0.0070 | −0.2678 | 0.0000 | 0.1200 | 0.0713 | 0.0000 |
| −0.0648 | −0.2055 | 0.0000 | 0.1805 | 0.0037 | 0.0000 |
| −0.1349 | −0.1409 | 0.0000 | 0.2418 | −0.0630 | 0.0000 |
| −0.2027 | −0.0738 | 0.0000 | 0.3040 | −0.1289 | 0.0000 |
| −0.2683 | −0.0038 | 0.0000 | 0.3672 | −0.1939 | 0.0000 |
| −0.3313 | 0.0691 | 0.0000 | 0.4315 | −0.2578 | 0.0000 |
| −0.3911 | 0.1445 | 0.0000 | 0.4967 | −0.3206 | 0.0000 |
| −0.4474 | 0.2219 | 0.0000 | 0.5632 | −0.3823 | 0.0000 |
| −0.4985 | 0.2988 | 0.0000 | 0.6284 | −0.4407 | 0.0000 |
| −0.5449 | 0.3749 | 0.0000 | 0.6923 | −0.4963 | 0.0000 |
| −0.5866 | 0.4499 | 0.0000 | 0.7547 | −0.5490 | 0.0000 |

TABLE 9-continued

| SUCTION SIDE | | | PRESSURE SIDE | | |
|---|---|---|---|---|---|
| X | Y | Z | X | Y | Z |
| −0.6243 | 0.5237 | 0.0000 | 0.8155 | −0.5990 | 0.0000 |
| −0.6577 | 0.5963 | 0.0000 | 0.8745 | −0.6463 | 0.0000 |
| −0.6878 | 0.6673 | 0.0000 | 0.9316 | −0.6913 | 0.0000 |
| −0.7145 | 0.7362 | 0.0000 | 0.9866 | −0.7339 | 0.0000 |
| −0.7372 | 0.8031 | 0.0000 | 1.0371 | −0.7724 | 0.0000 |
| −0.7561 | 0.8644 | 0.0000 | 1.0830 | −0.8070 | 0.0000 |
| −0.7713 | 0.9203 | 0.0000 | 1.1242 | −0.8378 | 0.0000 |
| −0.7832 | 0.9704 | 0.0000 | 1.1607 | −0.8649 | 0.0000 |
| −0.7927 | 1.0176 | 0.0000 | 1.1923 | −0.8883 | 0.0000 |
| −0.7990 | 1.0589 | 0.0000 | 1.2191 | −0.9081 | 0.0000 |
| −0.8008 | 1.0910 | 0.0000 | 1.2420 | −0.9250 | 0.0000 |
| −0.7988 | 1.1167 | 0.0000 | 1.2613 | −0.9392 | 0.0000 |
| −0.7939 | 1.1353 | 0.0000 | 1.2771 | −0.9508 | 0.0000 |
| −0.7872 | 1.1482 | 0.0000 | 1.2887 | −0.9611 | 0.0000 |
| −0.7818 | 1.1541 | 0.0000 | 1.2939 | −0.9718 | 0.0000 |
| −0.7777 | 1.1572 | 0.0000 | 1.2952 | −0.9808 | 0.0000 |
| −0.7754 | 1.1585 | 0.0000 | 1.2944 | −0.9882 | 0.0000 |
| −0.7742 | 1.1590 | 0.0000 | 1.2926 | −0.9939 | 0.0000 |
| 1.2745 | −0.9925 | 0.1038 | −0.7741 | 1.1778 | 0.1038 |
| 1.2716 | −0.9963 | 0.1038 | −0.7735 | 1.1781 | 0.1038 |
| 1.2670 | −1.0007 | 0.1038 | −0.7723 | 1.1785 | 0.1038 |
| 1.2603 | −1.0047 | 0.1038 | −0.7700 | 1.1792 | 0.1038 |
| 1.2512 | −1.0073 | 0.1038 | −0.7652 | 1.1798 | 0.1038 |
| 1.2387 | −1.0066 | 0.1038 | −0.7576 | 1.1794 | 0.1038 |
| 1.2237 | −0.9997 | 0.1038 | −0.7445 | 1.1753 | 0.1038 |
| 1.2052 | −0.9905 | 0.1038 | −0.7286 | 1.1663 | 0.1038 |
| 1.1829 | −0.9791 | 0.1038 | −0.7099 | 1.1510 | 0.1038 |
| 1.1563 | −0.9657 | 0.1038 | −0.6887 | 1.1296 | 0.1038 |
| 1.1252 | −0.9498 | 0.1038 | −0.6634 | 1.0996 | 0.1038 |
| 1.0883 | −0.9311 | 0.1038 | −0.6358 | 1.0637 | 0.1038 |
| 1.0460 | −0.9092 | 0.1038 | −0.6070 | 1.0249 | 0.1038 |
| 0.9981 | −0.8844 | 0.1038 | −0.5750 | 0.9810 | 0.1038 |
| 0.9447 | −0.8564 | 0.1038 | −0.5394 | 0.9322 | 0.1038 |
| 0.8859 | −0.8250 | 0.1038 | −0.5003 | 0.8786 | 0.1038 |
| 0.8217 | −0.7902 | 0.1038 | −0.4594 | 0.8225 | 0.1038 |
| 0.7553 | −0.7531 | 0.1038 | −0.4164 | 0.7642 | 0.1038 |
| 0.6864 | −0.7137 | 0.1038 | −0.3714 | 0.7036 | 0.1038 |
| 0.6152 | −0.6719 | 0.1038 | −0.3240 | 0.6411 | 0.1038 |
| 0.5421 | −0.6273 | 0.1038 | −0.2744 | 0.5766 | 0.1038 |
| 0.4669 | −0.5798 | 0.1038 | −0.2224 | 0.5100 | 0.1038 |
| 0.3900 | −0.5292 | 0.1038 | −0.1680 | 0.4416 | 0.1038 |
| 0.3117 | −0.4754 | 0.1038 | −0.1111 | 0.3713 | 0.1038 |
| 0.2347 | −0.4201 | 0.1038 | −0.0535 | 0.3016 | 0.1038 |
| 0.1590 | −0.3632 | 0.1038 | 0.0046 | 0.2322 | 0.1038 |
| 0.0849 | −0.3045 | 0.1038 | 0.0631 | 0.1632 | 0.1038 |
| 0.0122 | −0.2442 | 0.1038 | 0.1222 | 0.0948 | 0.1038 |
| −0.0587 | −0.1817 | 0.1038 | 0.1822 | 0.0268 | 0.1038 |
| −0.1277 | −0.1170 | 0.1038 | 0.2429 | −0.0404 | 0.1038 |
| −0.1948 | −0.0499 | 0.1038 | 0.3044 | −0.1068 | 0.1038 |
| −0.2595 | 0.0197 | 0.1038 | 0.3669 | −0.1724 | 0.1038 |
| −0.3218 | 0.0922 | 0.1038 | 0.4304 | −0.2369 | 0.1038 |
| −0.3813 | 0.1673 | 0.1038 | 0.4948 | −0.3005 | 0.1038 |
| −0.4378 | 0.2445 | 0.1038 | 0.5602 | −0.3631 | 0.1038 |
| −0.4894 | 0.3213 | 0.1038 | 0.6244 | −0.4225 | 0.1038 |
| −0.5362 | 0.3974 | 0.1038 | 0.6873 | −0.4791 | 0.1038 |
| −0.5788 | 0.4725 | 0.1038 | 0.7487 | −0.5328 | 0.1038 |
| −0.6172 | 0.5460 | 0.1038 | 0.8083 | −0.5838 | 0.1038 |
| −0.6513 | 0.6183 | 0.1038 | 0.8662 | −0.6324 | 0.1038 |
| −0.6820 | 0.6886 | 0.1038 | 0.9222 | −0.6784 | 0.1038 |
| −0.7094 | 0.7569 | 0.1038 | 0.9763 | −0.7220 | 0.1038 |
| −0.7328 | 0.8232 | 0.1038 | 1.0258 | −0.7617 | 0.1038 |
| −0.7524 | 0.8841 | 0.1038 | 1.0709 | −0.7972 | 0.1038 |
| −0.7684 | 0.9395 | 0.1038 | 1.1113 | −0.8288 | 0.1038 |
| −0.7810 | 0.9891 | 0.1038 | 1.1470 | −0.8567 | 0.1038 |
| −0.7909 | 1.0361 | 0.1038 | 1.1781 | −0.8808 | 0.1038 |
| −0.7972 | 1.0772 | 0.1038 | 1.2043 | −0.9012 | 0.1038 |
| −0.7992 | 1.1091 | 0.1038 | 1.2268 | −0.9186 | 0.1038 |
| −0.7976 | 1.1345 | 0.1038 | 1.2456 | −0.9332 | 0.1038 |
| −0.7934 | 1.1533 | 0.1038 | 1.2611 | −0.9452 | 0.1038 |
| −0.7872 | 1.1663 | 0.1038 | 1.2729 | −0.9557 | 0.1038 |
| −0.7821 | 1.1725 | 0.1038 | 1.2782 | −0.9663 | 0.1038 |
| −0.7780 | 1.1756 | 0.1038 | 1.2795 | −0.9753 | 0.1038 |
| −0.7758 | 1.1769 | 0.1038 | 1.2785 | −0.9828 | 0.1038 |
| −0.7746 | 1.1776 | 0.1038 | 1.2766 | −0.9886 | 0.1038 |
| 1.2570 | −0.9887 | 0.2130 | −0.7741 | 1.1957 | 0.2130 |
| 1.2541 | −0.9923 | 0.2130 | −0.7735 | 1.1959 | 0.2130 |

TABLE 9-continued

| SUCTION SIDE | | | PRESSURE SIDE | | |
|---|---|---|---|---|---|
| X | Y | Z | X | Y | Z |
| 1.2494 | −0.9965 | 0.2130 | −0.7724 | 1.1963 | 0.2130 |
| 1.2426 | −1.0004 | 0.2130 | −0.7701 | 1.1970 | 0.2130 |
| 1.2335 | −1.0025 | 0.2130 | −0.7652 | 1.1977 | 0.2130 |
| 1.2211 | −1.0011 | 0.2130 | −0.7576 | 1.1972 | 0.2130 |
| 1.2064 | −0.9937 | 0.2130 | −0.7445 | 1.1930 | 0.2130 |
| 1.1884 | −0.9840 | 0.2130 | −0.7287 | 1.1840 | 0.2130 |
| 1.1664 | −0.9721 | 0.2130 | −0.7098 | 1.1690 | 0.2130 |
| 1.1403 | −0.9579 | 0.2130 | −0.6882 | 1.1481 | 0.2130 |
| 1.1097 | −0.9414 | 0.2130 | −0.6621 | 1.1187 | 0.2130 |
| 1.0737 | −0.9217 | 0.2130 | −0.6337 | 1.0835 | 0.2130 |
| 1.0321 | −0.8990 | 0.2130 | −0.6046 | 1.0451 | 0.2130 |
| 0.9852 | −0.8730 | 0.2130 | −0.5721 | 1.0016 | 0.2130 |
| 0.9328 | −0.8439 | 0.2130 | −0.5360 | 0.9533 | 0.2130 |
| 0.8749 | −0.8113 | 0.2130 | −0.4963 | 0.9002 | 0.2130 |
| 0.8120 | −0.7751 | 0.2130 | −0.4550 | 0.8445 | 0.2130 |
| 0.7466 | −0.7367 | 0.2130 | −0.4117 | 0.7866 | 0.2130 |
| 0.6790 | −0.6962 | 0.2130 | −0.3664 | 0.7264 | 0.2130 |
| 0.6091 | −0.6530 | 0.2130 | −0.3189 | 0.6641 | 0.2130 |
| 0.5372 | −0.6074 | 0.2130 | −0.2692 | 0.5997 | 0.2130 |
| 0.4632 | −0.5587 | 0.2130 | −0.2172 | 0.5333 | 0.2130 |
| 0.3876 | −0.5072 | 0.2130 | −0.1629 | 0.4649 | 0.2130 |
| 0.3106 | −0.4525 | 0.2130 | −0.1063 | 0.3946 | 0.2130 |
| 0.2348 | −0.3965 | 0.2130 | −0.0490 | 0.3248 | 0.2130 |
| 0.1603 | −0.3389 | 0.2130 | 0.0087 | 0.2552 | 0.2130 |
| 0.0872 | −0.2797 | 0.2130 | 0.0669 | 0.1861 | 0.2130 |
| 0.0158 | −0.2188 | 0.2130 | 0.1254 | 0.1173 | 0.2130 |
| −0.0542 | −0.1560 | 0.2130 | 0.1847 | 0.0491 | 0.2130 |
| −0.1222 | −0.0911 | 0.2130 | 0.2447 | −0.0185 | 0.2130 |
| −0.1883 | −0.0241 | 0.2130 | 0.3056 | −0.0855 | 0.2130 |
| −0.2521 | 0.0455 | 0.2130 | 0.3672 | −0.1516 | 0.2130 |
| −0.3138 | 0.1178 | 0.2130 | 0.4299 | −0.2170 | 0.2130 |
| −0.3729 | 0.1925 | 0.2130 | 0.4933 | −0.2813 | 0.2130 |
| −0.4292 | 0.2694 | 0.2130 | 0.5576 | −0.3448 | 0.2130 |
| −0.4808 | 0.3457 | 0.2130 | 0.6208 | −0.4053 | 0.2130 |
| −0.5278 | 0.4211 | 0.2130 | 0.6824 | −0.4629 | 0.2130 |
| −0.5708 | 0.4956 | 0.2130 | 0.7427 | −0.5176 | 0.2130 |
| −0.6096 | 0.5685 | 0.2130 | 0.8012 | −0.5698 | 0.2130 |
| −0.6443 | 0.6401 | 0.2130 | 0.8579 | −0.6195 | 0.2130 |
| −0.6756 | 0.7097 | 0.2130 | 0.9129 | −0.6667 | 0.2130 |
| −0.7037 | 0.7773 | 0.2130 | 0.9658 | −0.7115 | 0.2130 |
| −0.7278 | 0.8430 | 0.2130 | 1.0143 | −0.7522 | 0.2130 |
| −0.7481 | 0.9034 | 0.2130 | 1.0584 | −0.7888 | 0.2130 |
| −0.7648 | 0.9581 | 0.2130 | 1.0980 | −0.8215 | 0.2130 |
| −0.7784 | 1.0072 | 0.2130 | 1.1329 | −0.8501 | 0.2130 |
| −0.7887 | 1.0538 | 0.2130 | 1.1632 | −0.8751 | 0.2130 |
| −0.7951 | 1.0947 | 0.2130 | 1.1888 | −0.8961 | 0.2130 |
| −0.7972 | 1.1266 | 0.2130 | 1.2108 | −0.9140 | 0.2130 |
| −0.7960 | 1.1519 | 0.2130 | 1.2293 | −0.9291 | 0.2130 |
| −0.7923 | 1.1706 | 0.2130 | 1.2444 | −0.9416 | 0.2130 |
| −0.7868 | 1.1837 | 0.2130 | 1.2560 | −0.9520 | 0.2130 |
| −0.7819 | 1.1901 | 0.2130 | 1.2613 | −0.9628 | 0.2130 |
| −0.7780 | 1.1934 | 0.2130 | 1.2624 | −0.9717 | 0.2130 |
| −0.7758 | 1.1948 | 0.2130 | 1.2614 | −0.9791 | 0.2130 |
| −0.7746 | 1.1953 | 0.2130 | 1.2592 | −0.9847 | 0.2130 |
| 1.2337 | −0.9904 | 0.3478 | −0.7727 | 1.2123 | 0.3478 |
| 1.2306 | −0.9940 | 0.3478 | −0.7721 | 1.2126 | 0.3478 |
| 1.2258 | −0.9979 | 0.3478 | −0.7710 | 1.2130 | 0.3478 |
| 1.2189 | −1.0013 | 0.3478 | −0.7687 | 1.2138 | 0.3478 |
| 1.2097 | −1.0030 | 0.3478 | −0.7638 | 1.2145 | 0.3478 |
| 1.1975 | −1.0007 | 0.3478 | −0.7562 | 1.2141 | 0.3478 |
| 1.1833 | −0.9926 | 0.3478 | −0.7432 | 1.2100 | 0.3478 |
| 1.1657 | −0.9823 | 0.3478 | −0.7273 | 1.2012 | 0.3478 |
| 1.1443 | −0.9696 | 0.3478 | −0.7081 | 1.1866 | 0.3478 |
| 1.1190 | −0.9546 | 0.3478 | −0.6861 | 1.1662 | 0.3478 |
| 1.0893 | −0.9370 | 0.3478 | −0.6593 | 1.1375 | 0.3478 |
| 1.0542 | −0.9163 | 0.3478 | −0.6303 | 1.1029 | 0.3478 |
| 1.0137 | −0.8922 | 0.3478 | −0.6007 | 1.0650 | 0.3478 |
| 0.9679 | −0.8647 | 0.3478 | −0.5676 | 1.0221 | 0.3478 |
| 0.9169 | −0.8340 | 0.3478 | −0.5308 | 0.9745 | 0.3478 |
| 0.8606 | −0.7997 | 0.3478 | −0.4906 | 0.9220 | 0.3478 |
| 0.7992 | −0.7618 | 0.3478 | −0.4487 | 0.8669 | 0.3478 |
| 0.7355 | −0.7217 | 0.3478 | −0.4050 | 0.8095 | 0.3478 |
| 0.6693 | −0.6794 | 0.3478 | −0.3594 | 0.7497 | 0.3478 |
| 0.6012 | −0.6347 | 0.3478 | −0.3117 | 0.6878 | 0.3478 |
| 0.5308 | −0.5875 | 0.3478 | −0.2618 | 0.6237 | 0.3478 |
| 0.4586 | −0.5374 | 0.3478 | −0.2099 | 0.5574 | 0.3478 |

TABLE 9-continued

| SUCTION SIDE | | | PRESSURE SIDE | | |
|---|---|---|---|---|---|
| X | Y | Z | X | Y | Z |
| 0.3847 | −0.4846 | 0.3478 | −0.1558 | 0.4891 | 0.3478 |
| 0.3093 | −0.4288 | 0.3478 | −0.0992 | 0.4188 | 0.3478 |
| 0.2351 | −0.3717 | 0.3478 | −0.0424 | 0.3487 | 0.3478 |
| 0.1623 | −0.3133 | 0.3478 | 0.0149 | 0.2791 | 0.3478 |
| 0.0907 | −0.2534 | 0.3478 | 0.0724 | 0.2096 | 0.3478 |
| 0.0207 | −0.1920 | 0.3478 | 0.1303 | 0.1404 | 0.3478 |
| −0.0478 | −0.1288 | 0.3478 | 0.1887 | 0.0717 | 0.3478 |
| −0.1146 | −0.0639 | 0.3478 | 0.2478 | 0.0035 | 0.3478 |
| −0.1794 | 0.0031 | 0.3478 | 0.3075 | −0.0642 | 0.3478 |
| −0.2422 | 0.0723 | 0.3478 | 0.3681 | −0.1312 | 0.3478 |
| −0.3027 | 0.1439 | 0.3478 | 0.4294 | −0.1974 | 0.3478 |
| −0.3610 | 0.2179 | 0.3478 | 0.4915 | −0.2628 | 0.3478 |
| −0.4171 | 0.2942 | 0.3478 | 0.5545 | −0.3274 | 0.3478 |
| −0.4688 | 0.3700 | 0.3478 | 0.6161 | −0.3892 | 0.3478 |
| −0.5162 | 0.4449 | 0.3478 | 0.6764 | −0.4482 | 0.3478 |
| −0.5596 | 0.5186 | 0.3478 | 0.7349 | −0.5044 | 0.3478 |
| −0.5991 | 0.5908 | 0.3478 | 0.7919 | −0.5581 | 0.3478 |
| −0.6345 | 0.6616 | 0.3478 | 0.8472 | −0.6092 | 0.3478 |
| −0.6666 | 0.7305 | 0.3478 | 0.9005 | −0.6578 | 0.3478 |
| −0.6955 | 0.7973 | 0.3478 | 0.9518 | −0.7043 | 0.3478 |
| −0.7206 | 0.8623 | 0.3478 | 0.9990 | −0.7464 | 0.3478 |
| −0.7416 | 0.9219 | 0.3478 | 1.0417 | −0.7844 | 0.3478 |
| −0.7593 | 0.9761 | 0.3478 | 1.0800 | −0.8183 | 0.3478 |
| −0.7737 | 1.0247 | 0.3478 | 1.1139 | −0.8482 | 0.3478 |
| −0.7847 | 1.0709 | 0.3478 | 1.1433 | −0.8741 | 0.3478 |
| −0.7915 | 1.1114 | 0.3478 | 1.1681 | −0.8959 | 0.3478 |
| −0.7940 | 1.1430 | 0.3478 | 1.1893 | −0.9147 | 0.3478 |
| −0.7934 | 1.1683 | 0.3478 | 1.2072 | −0.9304 | 0.3478 |
| −0.7902 | 1.1870 | 0.3478 | 1.2219 | −0.9433 | 0.3478 |
| −0.7850 | 1.2002 | 0.3478 | 1.2331 | −0.9541 | 0.3478 |
| −0.7803 | 1.2066 | 0.3478 | 1.2384 | −0.9647 | 0.3478 |
| −0.7766 | 1.2100 | 0.3478 | 1.2394 | −0.9737 | 0.3478 |
| −0.7744 | 1.2114 | 0.3478 | 1.2383 | −0.9810 | 0.3478 |
| −0.7733 | 1.2121 | 0.3478 | 1.2360 | −0.9865 | 0.3478 |
| 1.1497 | −1.0355 | 0.7389 | −0.7569 | 1.2397 | 0.7389 |
| 1.1464 | −1.0387 | 0.7389 | −0.7563 | 1.2401 | 0.7389 |
| 1.1411 | −1.0420 | 0.7389 | −0.7553 | 1.2405 | 0.7389 |
| 1.1339 | −1.0444 | 0.7389 | −0.7529 | 1.2413 | 0.7389 |
| 1.1247 | −1.0445 | 0.7389 | −0.7481 | 1.2422 | 0.7389 |
| 1.1135 | −1.0398 | 0.7389 | −0.7406 | 1.2420 | 0.7389 |
| 1.1006 | −1.0302 | 0.7389 | −0.7275 | 1.2383 | 0.7389 |
| 1.0845 | −1.0183 | 0.7389 | −0.7114 | 1.2298 | 0.7389 |
| 1.0650 | −1.0037 | 0.7389 | −0.6920 | 1.2159 | 0.7389 |
| 1.0418 | −0.9863 | 0.7389 | −0.6695 | 1.1960 | 0.7389 |
| 1.0146 | −0.9660 | 0.7389 | −0.6423 | 1.1681 | 0.7389 |
| 0.9826 | −0.9420 | 0.7389 | −0.6125 | 1.1344 | 0.7389 |
| 0.9456 | −0.9142 | 0.7389 | −0.5819 | 1.0977 | 0.7389 |
| 0.9038 | −0.8827 | 0.7389 | −0.5478 | 1.0560 | 0.7389 |
| 0.8572 | −0.8474 | 0.7389 | −0.5099 | 1.0095 | 0.7389 |
| 0.8056 | −0.8081 | 0.7389 | −0.4688 | 0.9581 | 0.7389 |
| 0.7494 | −0.7650 | 0.7389 | −0.4262 | 0.9040 | 0.7389 |
| 0.6909 | −0.7196 | 0.7389 | −0.3819 | 0.8475 | 0.7389 |
| 0.6304 | −0.6721 | 0.7389 | −0.3358 | 0.7884 | 0.7389 |
| 0.5676 | −0.6222 | 0.7389 | −0.2881 | 0.7269 | 0.7389 |
| 0.5029 | −0.5698 | 0.7389 | −0.2386 | 0.6631 | 0.7389 |
| 0.4364 | −0.5150 | 0.7389 | −0.1872 | 0.5968 | 0.7389 |
| 0.3681 | −0.4575 | 0.7389 | −0.1340 | 0.5282 | 0.7389 |
| 0.2983 | −0.3974 | 0.7389 | −0.0788 | 0.4573 | 0.7389 |
| 0.2294 | −0.3365 | 0.7389 | −0.0236 | 0.3864 | 0.7389 |
| 0.1613 | −0.2745 | 0.7389 | 0.0315 | 0.3155 | 0.7389 |
| 0.0943 | −0.2116 | 0.7389 | 0.0866 | 0.2446 | 0.7389 |
| 0.0286 | −0.1475 | 0.7389 | 0.1416 | 0.1736 | 0.7389 |
| −0.0359 | −0.0822 | 0.7389 | 0.1969 | 0.1028 | 0.7389 |
| −0.0989 | −0.0155 | 0.7389 | 0.2524 | 0.0322 | 0.7389 |
| −0.1604 | 0.0526 | 0.7389 | 0.3083 | −0.0382 | 0.7389 |
| −0.2201 | 0.1225 | 0.7389 | 0.3646 | −0.1082 | 0.7389 |
| −0.2779 | 0.1941 | 0.7389 | 0.4213 | −0.1778 | 0.7389 |
| −0.3337 | 0.2676 | 0.7389 | 0.4785 | −0.2469 | 0.7389 |
| −0.3878 | 0.3429 | 0.7389 | 0.5363 | −0.3157 | 0.7389 |
| −0.4382 | 0.4174 | 0.7389 | 0.5927 | −0.3817 | 0.7389 |
| −0.4848 | 0.4910 | 0.7389 | 0.6475 | −0.4452 | 0.7389 |
| −0.5278 | 0.5630 | 0.7389 | 0.7007 | −0.5060 | 0.7389 |
| −0.5673 | 0.6334 | 0.7389 | 0.7524 | −0.5642 | 0.7389 |
| −0.6034 | 0.7023 | 0.7389 | 0.8023 | −0.6200 | 0.7389 |
| −0.6362 | 0.7694 | 0.7389 | 0.8505 | −0.6734 | 0.7389 |
| −0.6661 | 0.8345 | 0.7389 | 0.8968 | −0.7244 | 0.7389 |

TABLE 9-continued

| SUCTION SIDE | | | PRESSURE SIDE | | |
|---|---|---|---|---|---|
| X | Y | Z | X | Y | Z |
| −0.6925 | 0.8976 | 0.7389 | 0.9392 | −0.7708 | 0.7389 |
| −0.7148 | 0.9557 | 0.7389 | 0.9777 | −0.8127 | 0.7389 |
| −0.7338 | 1.0084 | 0.7389 | 1.0122 | −0.8501 | 0.7389 |
| −0.7494 | 1.0556 | 0.7389 | 1.0427 | −0.8831 | 0.7389 |
| −0.7622 | 1.1006 | 0.7389 | 1.0691 | −0.9117 | 0.7389 |
| −0.7708 | 1.1401 | 0.7389 | 1.0914 | −0.9359 | 0.7389 |
| −0.7749 | 1.1709 | 0.7389 | 1.1105 | −0.9565 | 0.7389 |
| −0.7754 | 1.1958 | 0.7389 | 1.1266 | −0.9739 | 0.7389 |
| −0.7730 | 1.2142 | 0.7389 | 1.1398 | −0.9881 | 0.7389 |
| −0.7685 | 1.2275 | 0.7389 | 1.1503 | −0.9996 | 0.7389 |
| −0.7642 | 1.2339 | 0.7389 | 1.1558 | −1.0103 | 0.7389 |
| −0.7606 | 1.2374 | 0.7389 | 1.1566 | −1.0192 | 0.7389 |
| −0.7586 | 1.2388 | 0.7389 | 1.1551 | −1.0266 | 0.7389 |
| −0.7574 | 1.2394 | 0.7389 | 1.1524 | −1.0320 | 0.7389 |
| 1.0867 | −1.0880 | 1.0563 | −0.7302 | 1.2449 | 1.0563 |
| 1.0832 | −1.0909 | 1.0563 | −0.7296 | 1.2452 | 1.0563 |
| 1.0778 | −1.0937 | 1.0563 | −0.7285 | 1.2456 | 1.0563 |
| 1.0703 | −1.0953 | 1.0563 | −0.7263 | 1.2465 | 1.0563 |
| 1.0613 | −1.0941 | 1.0563 | −0.7216 | 1.2475 | 1.0563 |
| 1.0510 | −1.0879 | 1.0563 | −0.7141 | 1.2477 | 1.0563 |
| 1.0388 | −1.0775 | 1.0563 | −0.7009 | 1.2446 | 1.0563 |
| 1.0237 | −1.0646 | 1.0563 | −0.6846 | 1.2369 | 1.0563 |
| 1.0053 | −1.0488 | 1.0563 | −0.6651 | 1.2231 | 1.0563 |
| 0.9834 | −1.0301 | 1.0563 | −0.6431 | 1.2030 | 1.0563 |
| 0.9578 | −1.0083 | 1.0563 | −0.6169 | 1.1744 | 1.0563 |
| 0.9277 | −0.9823 | 1.0563 | −0.5882 | 1.1400 | 1.0563 |
| 0.8928 | −0.9523 | 1.0563 | −0.5578 | 1.1031 | 1.0563 |
| 0.8533 | −0.9183 | 1.0563 | −0.5240 | 1.0615 | 1.0563 |
| 0.8094 | −0.8802 | 1.0563 | −0.4867 | 1.0149 | 1.0563 |
| 0.7609 | −0.8380 | 1.0563 | −0.4463 | 0.9631 | 1.0563 |
| 0.7079 | −0.7916 | 1.0563 | −0.4044 | 0.9087 | 1.0563 |
| 0.6528 | −0.7429 | 1.0563 | −0.3610 | 0.8517 | 1.0563 |
| 0.5956 | −0.6919 | 1.0563 | −0.3159 | 0.7922 | 1.0563 |
| 0.5364 | −0.6387 | 1.0563 | −0.2694 | 0.7302 | 1.0563 |
| 0.4753 | −0.5829 | 1.0563 | −0.2212 | 0.6657 | 1.0563 |
| 0.4124 | −0.5247 | 1.0563 | −0.1712 | 0.5987 | 1.0563 |
| 0.3477 | −0.4639 | 1.0563 | −0.1196 | 0.5292 | 1.0563 |
| 0.2813 | −0.4004 | 1.0563 | −0.0662 | 0.4573 | 1.0563 |
| 0.2157 | −0.3362 | 1.0563 | −0.0130 | 0.3854 | 1.0563 |
| 0.1508 | −0.2712 | 1.0563 | 0.0401 | 0.3134 | 1.0563 |
| 0.0869 | −0.2053 | 1.0563 | 0.0929 | 0.2410 | 1.0563 |
| 0.0239 | −0.1384 | 1.0563 | 0.1453 | 0.1685 | 1.0563 |
| −0.0380 | −0.0704 | 1.0563 | 0.1977 | 0.0958 | 1.0563 |
| −0.0984 | −0.0014 | 1.0563 | 0.2502 | 0.0233 | 1.0563 |
| −0.1570 | 0.0687 | 1.0563 | 0.3029 | −0.0490 | 1.0563 |
| −0.2137 | 0.1400 | 1.0563 | 0.3559 | −0.1212 | 1.0563 |
| −0.2682 | 0.2127 | 1.0563 | 0.4091 | −0.1932 | 1.0563 |
| −0.3210 | 0.2865 | 1.0563 | 0.4628 | −0.2648 | 1.0563 |
| −0.3719 | 0.3615 | 1.0563 | 0.5167 | −0.3363 | 1.0563 |
| −0.4193 | 0.4352 | 1.0563 | 0.5693 | −0.4049 | 1.0563 |
| −0.4634 | 0.5074 | 1.0563 | 0.6205 | −0.4711 | 1.0563 |
| −0.5043 | 0.5780 | 1.0563 | 0.6701 | −0.5346 | 1.0563 |
| −0.5420 | 0.6470 | 1.0563 | 0.7181 | −0.5955 | 1.0563 |
| −0.5767 | 0.7144 | 1.0563 | 0.7645 | −0.6540 | 1.0563 |
| −0.6084 | 0.7801 | 1.0563 | 0.8092 | −0.7099 | 1.0563 |
| −0.6376 | 0.8437 | 1.0563 | 0.8523 | −0.7635 | 1.0563 |
| −0.6637 | 0.9058 | 1.0563 | 0.8917 | −0.8122 | 1.0563 |
| −0.6859 | 0.9632 | 1.0563 | 0.9273 | −0.8562 | 1.0563 |
| −0.7049 | 1.0155 | 1.0563 | 0.9594 | −0.8956 | 1.0563 |
| −0.7208 | 1.0622 | 1.0563 | 0.9876 | −0.9303 | 1.0563 |
| −0.7339 | 1.1068 | 1.0563 | 1.0122 | −0.9603 | 1.0563 |
| −0.7428 | 1.1458 | 1.0563 | 1.0330 | −0.9858 | 1.0563 |
| −0.7472 | 1.1764 | 1.0563 | 1.0507 | −1.0075 | 1.0563 |
| −0.7480 | 1.2010 | 1.0563 | 1.0657 | −1.0257 | 1.0563 |
| −0.7459 | 1.2194 | 1.0563 | 1.0781 | −1.0406 | 1.0563 |
| −0.7415 | 1.2326 | 1.0563 | 1.0881 | −1.0526 | 1.0563 |
| −0.7374 | 1.2390 | 1.0563 | 1.0937 | −1.0630 | 1.0563 |
| −0.7339 | 1.2425 | 1.0563 | 1.0944 | −1.0719 | 1.0563 |
| −0.7318 | 1.2439 | 1.0563 | 1.0926 | −1.0793 | 1.0563 |
| −0.7308 | 1.2445 | 1.0563 | 1.0897 | −1.0845 | 1.0563 |
| 1.0325 | −1.1556 | 1.3738 | −0.6981 | 1.2259 | 1.3738 |
| 1.0288 | −1.1583 | 1.3738 | −0.6974 | 1.2262 | 1.3738 |
| 1.0233 | −1.1606 | 1.3738 | −0.6964 | 1.2266 | 1.3738 |
| 1.0158 | −1.1615 | 1.3738 | −0.6941 | 1.2275 | 1.3738 |
| 1.0071 | −1.1594 | 1.3738 | −0.6895 | 1.2285 | 1.3738 |
| 0.9976 | −1.1520 | 1.3738 | −0.6819 | 1.2286 | 1.3738 |

TABLE 9-continued

| SUCTION SIDE | | | PRESSURE SIDE | | |
|---|---|---|---|---|---|
| X | Y | Z | X | Y | Z |
| 0.9862 | −1.1411 | 1.3738 | −0.6688 | 1.2254 | 1.3738 |
| 0.9719 | −1.1276 | 1.3738 | −0.6527 | 1.2175 | 1.3738 |
| 0.9547 | −1.1111 | 1.3738 | −0.6334 | 1.2035 | 1.3738 |
| 0.9341 | −1.0914 | 1.3738 | −0.6118 | 1.1832 | 1.3738 |
| 0.9101 | −1.0684 | 1.3738 | −0.5861 | 1.1543 | 1.3738 |
| 0.8817 | −1.0412 | 1.3738 | −0.5582 | 1.1196 | 1.3738 |
| 0.8490 | −1.0097 | 1.3738 | −0.5287 | 1.0824 | 1.3738 |
| 0.8119 | −0.9741 | 1.3738 | −0.4957 | 1.0402 | 1.3738 |
| 0.7706 | −0.9340 | 1.3738 | −0.4596 | 0.9930 | 1.3738 |
| 0.7250 | −0.8899 | 1.3738 | −0.4204 | 0.9408 | 1.3738 |
| 0.6752 | −0.8412 | 1.3738 | −0.3800 | 0.8856 | 1.3738 |
| 0.6234 | −0.7903 | 1.3738 | −0.3381 | 0.8280 | 1.3738 |
| 0.5697 | −0.7371 | 1.3738 | −0.2946 | 0.7677 | 1.3738 |
| 0.5140 | −0.6815 | 1.3738 | −0.2498 | 0.7049 | 1.3738 |
| 0.4565 | −0.6234 | 1.3738 | −0.2033 | 0.6395 | 1.3738 |
| 0.3972 | −0.5631 | 1.3738 | −0.1552 | 0.5716 | 1.3738 |
| 0.3363 | −0.5001 | 1.3738 | −0.1056 | 0.5012 | 1.3738 |
| 0.2738 | −0.4345 | 1.3738 | −0.0543 | 0.4283 | 1.3738 |
| 0.2118 | −0.3685 | 1.3738 | −0.0031 | 0.3554 | 1.3738 |
| 0.1506 | −0.3021 | 1.3738 | 0.0480 | 0.2824 | 1.3738 |
| 0.0901 | −0.2349 | 1.3738 | 0.0984 | 0.2089 | 1.3738 |
| 0.0305 | −0.1671 | 1.3738 | 0.1482 | 0.1350 | 1.3738 |
| −0.0281 | −0.0984 | 1.3738 | 0.1977 | 0.0608 | 1.3738 |
| −0.0854 | −0.0287 | 1.3738 | 0.2471 | −0.0134 | 1.3738 |
| −0.1412 | 0.0423 | 1.3738 | 0.2967 | −0.0875 | 1.3738 |
| −0.1951 | 0.1147 | 1.3738 | 0.3464 | −0.1615 | 1.3738 |
| −0.2470 | 0.1886 | 1.3738 | 0.3964 | −0.2353 | 1.3738 |
| −0.2976 | 0.2636 | 1.3738 | 0.4468 | −0.3089 | 1.3738 |
| −0.3467 | 0.3399 | 1.3738 | 0.4975 | −0.3822 | 1.3738 |
| −0.3927 | 0.4147 | 1.3738 | 0.5469 | −0.4528 | 1.3738 |
| −0.4357 | 0.4881 | 1.3738 | 0.5949 | −0.5208 | 1.3738 |
| −0.4758 | 0.5600 | 1.3738 | 0.6414 | −0.5861 | 1.3738 |
| −0.5130 | 0.6303 | 1.3738 | 0.6865 | −0.6489 | 1.3738 |
| −0.5472 | 0.6985 | 1.3738 | 0.7300 | −0.7091 | 1.3738 |
| −0.5786 | 0.7647 | 1.3738 | 0.7720 | −0.7668 | 1.3738 |
| −0.6074 | 0.8288 | 1.3738 | 0.8123 | −0.8219 | 1.3738 |
| −0.6332 | 0.8909 | 1.3738 | 0.8493 | −0.8723 | 1.3738 |
| −0.6552 | 0.9480 | 1.3738 | 0.8827 | −0.9178 | 1.3738 |
| −0.6738 | 0.9997 | 1.3738 | 0.9127 | −0.9583 | 1.3738 |
| −0.6894 | 1.0462 | 1.3738 | 0.9393 | −0.9942 | 1.3738 |
| −0.7028 | 1.0899 | 1.3738 | 0.9623 | −1.0252 | 1.3738 |
| −0.7121 | 1.1286 | 1.3738 | 0.9817 | −1.0515 | 1.3738 |
| −0.7166 | 1.1587 | 1.3738 | 0.9985 | −1.0740 | 1.3738 |
| −0.7171 | 1.1831 | 1.3738 | 1.0125 | −1.0927 | 1.3738 |
| −0.7146 | 1.2013 | 1.3738 | 1.0241 | −1.1081 | 1.3738 |
| −0.7097 | 1.2141 | 1.3738 | 1.0335 | −1.1205 | 1.3738 |
| −0.7053 | 1.2204 | 1.3738 | 1.0395 | −1.1307 | 1.3738 |
| −0.7017 | 1.2237 | 1.3738 | 1.0404 | −1.1397 | 1.3738 |
| −0.6997 | 1.2251 | 1.3738 | 1.0386 | −1.1470 | 1.3738 |
| −0.6986 | 1.2257 | 1.3738 | 1.0356 | −1.1522 | 1.3738 |
| 0.9909 | −1.2194 | 1.6913 | −0.6779 | 1.1958 | 1.6913 |
| 0.9872 | −1.2220 | 1.6913 | −0.6772 | 1.1960 | 1.6913 |
| 0.9816 | −1.2241 | 1.6913 | −0.6761 | 1.1965 | 1.6913 |
| 0.9741 | −1.2244 | 1.6913 | −0.6739 | 1.1972 | 1.6913 |
| 0.9657 | −1.2215 | 1.6913 | −0.6691 | 1.1980 | 1.6913 |
| 0.9566 | −1.2136 | 1.6913 | −0.6617 | 1.1975 | 1.6913 |
| 0.9455 | −1.2024 | 1.6913 | −0.6489 | 1.1934 | 1.6913 |
| 0.9318 | −1.1885 | 1.6913 | −0.6333 | 1.1845 | 1.6913 |
| 0.9150 | −1.1716 | 1.6913 | −0.6148 | 1.1697 | 1.6913 |
| 0.8951 | −1.1515 | 1.6913 | −0.5938 | 1.1487 | 1.6913 |
| 0.8718 | −1.1279 | 1.6913 | −0.5688 | 1.1194 | 1.6913 |
| 0.8442 | −1.1000 | 1.6913 | −0.5417 | 1.0843 | 1.6913 |
| 0.8124 | −1.0679 | 1.6913 | −0.5132 | 1.0464 | 1.6913 |
| 0.7766 | −1.0313 | 1.6913 | −0.4815 | 1.0036 | 1.6913 |
| 0.7365 | −0.9904 | 1.6913 | −0.4467 | 0.9557 | 1.6913 |
| 0.6923 | −0.9450 | 1.6913 | −0.4089 | 0.9026 | 1.6913 |
| 0.6442 | −0.8952 | 1.6913 | −0.3699 | 0.8468 | 1.6913 |
| 0.5941 | −0.8429 | 1.6913 | −0.3293 | 0.7885 | 1.6913 |
| 0.5421 | −0.7884 | 1.6913 | −0.2875 | 0.7275 | 1.6913 |
| 0.4883 | −0.7314 | 1.6913 | −0.2441 | 0.6639 | 1.6913 |
| 0.4328 | −0.6720 | 1.6913 | −0.1991 | 0.5978 | 1.6913 |
| 0.3757 | −0.6100 | 1.6913 | −0.1527 | 0.5291 | 1.6913 |
| 0.3170 | −0.5456 | 1.6913 | −0.1047 | 0.4579 | 1.6913 |
| 0.2568 | −0.4784 | 1.6913 | −0.0552 | 0.3842 | 1.6913 |
| 0.1972 | −0.4109 | 1.6913 | −0.0055 | 0.3106 | 1.6913 |
| 0.1384 | −0.3429 | 1.6913 | 0.0440 | 0.2368 | 1.6913 |

TABLE 9-continued

| SUCTION SIDE | | | PRESSURE SIDE | | |
|---|---|---|---|---|---|
| X | Y | Z | X | Y | Z |
| 0.0804 | −0.2742 | 1.6913 | 0.0930 | 0.1627 | 1.6913 |
| 0.0233 | −0.2049 | 1.6913 | 0.1413 | 0.0882 | 1.6913 |
| −0.0327 | −0.1347 | 1.6913 | 0.1891 | 0.0133 | 1.6913 |
| −0.0873 | −0.0637 | 1.6913 | 0.2367 | −0.0617 | 1.6913 |
| −0.1404 | 0.0085 | 1.6913 | 0.2844 | −0.1366 | 1.6913 |
| −0.1917 | 0.0821 | 1.6913 | 0.3322 | −0.2115 | 1.6913 |
| −0.2412 | 0.1568 | 1.6913 | 0.3803 | −0.2861 | 1.6913 |
| −0.2892 | 0.2327 | 1.6913 | 0.4286 | −0.3606 | 1.6913 |
| −0.3361 | 0.3094 | 1.6913 | 0.4772 | −0.4350 | 1.6913 |
| −0.3799 | 0.3845 | 1.6913 | 0.5246 | −0.5066 | 1.6913 |
| −0.4210 | 0.4581 | 1.6913 | 0.5705 | −0.5756 | 1.6913 |
| −0.4594 | 0.5298 | 1.6913 | 0.6151 | −0.6420 | 1.6913 |
| −0.4950 | 0.5998 | 1.6913 | 0.6583 | −0.7057 | 1.6913 |
| −0.5281 | 0.6681 | 1.6913 | 0.7000 | −0.7669 | 1.6913 |
| −0.5586 | 0.7344 | 1.6913 | 0.7402 | −0.8255 | 1.6913 |
| −0.5866 | 0.7988 | 1.6913 | 0.7789 | −0.8815 | 1.6913 |
| −0.6119 | 0.8610 | 1.6913 | 0.8144 | −0.9327 | 1.6913 |
| −0.6337 | 0.9181 | 1.6913 | 0.8465 | −0.9788 | 1.6913 |
| −0.6519 | 0.9698 | 1.6913 | 0.8754 | −1.0201 | 1.6913 |
| −0.6673 | 1.0161 | 1.6913 | 0.9008 | −1.0565 | 1.6913 |
| −0.6809 | 1.0599 | 1.6913 | 0.9230 | −1.0879 | 1.6913 |
| −0.6906 | 1.0983 | 1.6913 | 0.9416 | −1.1146 | 1.6913 |
| −0.6955 | 1.1284 | 1.6913 | 0.9577 | −1.1373 | 1.6913 |
| −0.6964 | 1.1528 | 1.6913 | 0.9712 | −1.1565 | 1.6913 |
| −0.6940 | 1.1710 | 1.6913 | 0.9824 | −1.1721 | 1.6913 |
| −0.6894 | 1.1838 | 1.6913 | 0.9913 | −1.1847 | 1.6913 |
| −0.6851 | 1.1901 | 1.6913 | 0.9975 | −1.1947 | 1.6913 |
| −0.6815 | 1.1935 | 1.6913 | 0.9988 | −1.2035 | 1.6913 |
| −0.6794 | 1.1948 | 1.6913 | 0.9972 | −1.2109 | 1.6913 |
| −0.6784 | 1.1955 | 1.6913 | 0.9941 | −1.2161 | 1.6913 |
| 0.9639 | −1.2918 | 2.0089 | −0.6694 | 1.1536 | 2.0089 |
| 0.9600 | −1.2944 | 2.0089 | −0.6689 | 1.1538 | 2.0089 |
| 0.9544 | −1.2963 | 2.0089 | −0.6677 | 1.1542 | 2.0089 |
| 0.9468 | −1.2963 | 2.0089 | −0.6655 | 1.1549 | 2.0089 |
| 0.9386 | −1.2929 | 2.0089 | −0.6607 | 1.1553 | 2.0089 |
| 0.9299 | −1.2845 | 2.0089 | −0.6533 | 1.1542 | 2.0089 |
| 0.9189 | −1.2732 | 2.0089 | −0.6408 | 1.1491 | 2.0089 |
| 0.9053 | −1.2591 | 2.0089 | −0.6260 | 1.1391 | 2.0089 |
| 0.8887 | −1.2421 | 2.0089 | −0.6083 | 1.1233 | 2.0089 |
| 0.8690 | −1.2218 | 2.0089 | −0.5882 | 1.1013 | 2.0089 |
| 0.8460 | −1.1979 | 2.0089 | −0.5643 | 1.0711 | 2.0089 |
| 0.8187 | −1.1697 | 2.0089 | −0.5383 | 1.0351 | 2.0089 |
| 0.7874 | −1.1370 | 2.0089 | −0.5109 | 0.9963 | 2.0089 |
| 0.7520 | −1.1000 | 2.0089 | −0.4804 | 0.9527 | 2.0089 |
| 0.7125 | −1.0585 | 2.0089 | −0.4468 | 0.9038 | 2.0089 |
| 0.6689 | −1.0126 | 2.0089 | −0.4103 | 0.8498 | 2.0089 |
| 0.6213 | −0.9620 | 2.0089 | −0.3725 | 0.7932 | 2.0089 |
| 0.5720 | −0.9092 | 2.0089 | −0.3332 | 0.7339 | 2.0089 |
| 0.5208 | −0.8539 | 2.0089 | −0.2924 | 0.6720 | 2.0089 |
| 0.4679 | −0.7960 | 2.0089 | −0.2501 | 0.6076 | 2.0089 |
| 0.4132 | −0.7358 | 2.0089 | −0.2064 | 0.5406 | 2.0089 |
| 0.3571 | −0.6730 | 2.0089 | −1.1611 | 0.4711 | 2.0089 |
| 0.2995 | −0.6075 | 2.0089 | −0.1141 | 0.3991 | 2.0089 |
| 0.2406 | −0.5393 | 2.0089 | −0.0657 | 0.3246 | 2.0089 |
| 0.1825 | −0.4705 | 2.0089 | −0.0171 | 0.2501 | 2.0089 |
| 0.1251 | −0.4012 | 2.0089 | 0.0314 | 0.1757 | 2.0089 |
| 0.0688 | −0.3313 | 2.0089 | 0.0798 | 0.1010 | 2.0089 |
| 0.0135 | −0.2605 | 2.0089 | 0.1278 | 0.0262 | 2.0089 |
| −0.0405 | −0.1888 | 2.0089 | 0.1753 | −0.0489 | 2.0089 |
| −0.0932 | −0.1162 | 2.0089 | 0.2224 | −0.1243 | 2.0089 |
| −0.1442 | −0.0424 | 2.0089 | 0.2696 | −0.1995 | 2.0089 |
| −0.1936 | 0.0326 | 2.0089 | 0.3168 | −0.2749 | 2.0089 |
| −0.2416 | 0.1085 | 2.0089 | 0.3641 | −0.3502 | 2.0089 |
| −0.2882 | 0.1854 | 2.0089 | 0.4114 | −0.4254 | 2.0089 |
| −0.3337 | 0.2631 | 2.0089 | 0.4591 | −0.5003 | 2.0089 |
| −0.3763 | 0.3391 | 2.0089 | 0.5055 | −0.5728 | 2.0089 |
| −0.4162 | 0.4136 | 2.0089 | 0.5505 | −0.6424 | 2.0089 |
| −0.4534 | 0.4861 | 2.0089 | 0.5942 | −0.7095 | 2.0089 |
| −0.4881 | 0.5568 | 2.0089 | 0.6364 | −0.7738 | 2.0089 |
| −0.5203 | 0.6257 | 2.0089 | 0.6773 | −0.8357 | 2.0089 |
| −0.5499 | 0.6923 | 2.0089 | 0.7168 | −0.8948 | 2.0089 |
| −0.5769 | 0.7568 | 2.0089 | 0.7547 | −0.9514 | 2.0089 |
| −0.6016 | 0.8190 | 2.0089 | 0.7895 | −1.0029 | 2.0089 |
| −0.6229 | 0.8760 | 2.0089 | 0.8211 | −1.0496 | 2.0089 |
| −0.6409 | 0.9277 | 2.0089 | 0.8494 | −1.0912 | 2.0089 |
| −0.6561 | 0.9739 | 2.0089 | 0.8744 | −1.1279 | 2.0089 |

TABLE 9-continued

| SUCTION SIDE | | | PRESSURE SIDE | | |
|---|---|---|---|---|---|
| X | Y | Z | X | Y | Z |
| −0.6695 | 1.0175 | 2.0089 | 0.8962 | −1.1598 | 2.0089 |
| −0.6792 | 1.0559 | 2.0089 | 0.9147 | −1.1866 | 2.0089 |
| −0.6843 | 1.0858 | 2.0089 | 0.9304 | −1.2096 | 2.0089 |
| −0.6858 | 1.1101 | 2.0089 | 0.9437 | −1.2289 | 2.0089 |
| −0.6843 | 1.1283 | 2.0089 | 0.9547 | −1.2446 | 2.0089 |
| −0.6805 | 1.1414 | 2.0089 | 0.9635 | −1.2573 | 2.0089 |
| −0.6766 | 1.1479 | 2.0089 | 0.9699 | −1.2673 | 2.0089 |
| −0.6732 | 1.1513 | 2.0089 | 0.9715 | −1.2761 | 2.0089 |
| −0.6711 | 1.1526 | 2.0089 | 0.9699 | −1.2834 | 2.0089 |
| −0.6700 | 1.1533 | 2.0089 | 0.9669 | −1.2886 | 2.0089 |
| 0.9499 | −1.3809 | 2.3264 | −0.6634 | 1.0967 | 2.3264 |
| 0.9461 | −1.3834 | 2.3264 | −0.6627 | 1.0970 | 2.3264 |
| 0.9403 | −1.3853 | 2.3264 | −0.6617 | 1.0974 | 2.3264 |
| 0.9328 | −1.3850 | 2.3264 | −0.6593 | 1.0979 | 2.3264 |
| 0.9247 | −1.3810 | 2.3264 | −0.6544 | 1.0981 | 2.3264 |
| 0.9162 | −1.3724 | 2.3264 | −0.6471 | 1.0966 | 2.3264 |
| 0.9052 | −1.3610 | 2.3264 | −0.6348 | 1.0907 | 2.3264 |
| 0.8917 | −1.3469 | 2.3264 | −0.6206 | 1.0799 | 2.3264 |
| 0.8752 | −1.3295 | 2.3264 | −0.6034 | 1.0633 | 2.3264 |
| 0.8556 | −1.3089 | 2.3264 | −0.5840 | 1.0405 | 2.3264 |
| 0.8326 | −1.2847 | 2.3264 | −0.5610 | 1.0094 | 2.3264 |
| 0.8055 | −1.2561 | 2.3264 | −0.5360 | 0.9725 | 2.3264 |
| 0.7743 | −1.2231 | 2.3264 | −0.5096 | 0.9328 | 2.3264 |
| 0.7391 | −1.1855 | 2.3264 | −0.4802 | 0.8879 | 2.3264 |
| 0.6999 | −1.1435 | 2.3264 | −0.4477 | 0.8380 | 2.3264 |
| 0.6567 | −1.0969 | 2.3264 | −0.4125 | 0.7828 | 2.3264 |
| 0.6095 | −1.0456 | 2.3264 | −0.3758 | 0.7251 | 2.3264 |
| 0.5604 | −0.9920 | 2.3264 | −0.3375 | 0.6646 | 2.3264 |
| 0.5097 | −0.9359 | 2.3264 | −0.2979 | 0.6017 | 2.3264 |
| 0.4573 | −0.8772 | 2.3264 | −0.2567 | 0.5362 | 2.3264 |
| 0.4032 | −0.8160 | 2.3264 | −0.2139 | 0.4681 | 2.3264 |
| 0.3478 | −0.7521 | 2.3264 | −0.1695 | 0.3976 | 2.3264 |
| 0.2908 | −0.6855 | 2.3264 | −0.1235 | 0.3246 | 2.3264 |
| 0.2327 | −0.6162 | 2.3264 | −0.0758 | 0.2491 | 2.3264 |
| 0.1754 | −0.5463 | 2.3264 | −0.0280 | 0.1736 | 2.3264 |
| 0.1189 | −0.4758 | 2.3264 | 0.0200 | 0.0983 | 2.3264 |
| 0.0636 | −0.4045 | 2.3264 | 0.0680 | 0.0230 | 2.3264 |
| 0.0094 | −0.3324 | 2.3264 | 0.1159 | −0.0525 | 2.3264 |
| −0.0436 | −0.2594 | 2.3264 | 0.1632 | −0.1282 | 2.3264 |
| −0.0950 | −0.1853 | 2.3264 | 0.2103 | −0.2041 | 2.3264 |
| −0.1447 | −0.1100 | 2.3264 | 0.2571 | −0.2801 | 2.3264 |
| −0.1928 | −0.0338 | 2.3264 | 0.3041 | −0.3562 | 2.3264 |
| −0.2399 | 0.0434 | 2.3264 | 0.3511 | −0.4321 | 2.3264 |
| −0.2857 | 0.1214 | 2.3264 | 0.3982 | −0.5079 | 2.3264 |
| −0.3303 | 0.2003 | 2.3264 | 0.4456 | −0.5836 | 2.3264 |
| −0.3720 | 0.2774 | 2.3264 | 0.4917 | −0.6567 | 2.3264 |
| −0.4112 | 0.3527 | 2.3264 | 0.5364 | −0.7269 | 2.3264 |
| −0.4479 | 0.4261 | 2.3264 | 0.5800 | −0.7946 | 2.3264 |
| −0.4820 | 0.4976 | 2.3264 | 0.6221 | −0.8595 | 2.3264 |
| −0.5136 | 0.5669 | 2.3264 | 0.6628 | −0.9218 | 2.3264 |
| −0.5427 | 0.6340 | 2.3264 | 0.7021 | −0.9814 | 2.3264 |
| −0.5695 | 0.6987 | 2.3264 | 0.7400 | −1.0385 | 2.3264 |
| −0.5939 | 0.7612 | 2.3264 | 0.7747 | −1.0905 | 2.3264 |
| −0.6150 | 0.8184 | 2.3264 | 0.8063 | −1.1374 | 2.3264 |
| −0.6330 | 0.8702 | 2.3264 | 0.8346 | −1.1794 | 2.3264 |
| −0.6483 | 0.9165 | 2.3264 | 0.8597 | −1.2163 | 2.3264 |
| −0.6617 | 0.9602 | 2.3264 | 0.8814 | −1.2484 | 2.3264 |
| −0.6716 | 0.9986 | 2.3264 | 0.8999 | −1.2754 | 2.3264 |
| −0.6769 | 1.0286 | 2.3264 | 0.9156 | −1.2985 | 2.3264 |
| −0.6787 | 1.0529 | 2.3264 | 0.9290 | −1.3179 | 2.3264 |
| −0.6775 | 1.0711 | 2.3264 | 0.9400 | −1.3339 | 2.3264 |
| −0.6741 | 1.0844 | 2.3264 | 0.9488 | −1.3465 | 2.3264 |
| −0.6704 | 1.0910 | 2.3264 | 0.9553 | −1.3564 | 2.3264 |
| −0.6670 | 1.0945 | 2.3264 | 0.9574 | −1.3652 | 2.3264 |
| −0.6650 | 1.0959 | 2.3264 | 0.9560 | −1.3725 | 2.3264 |
| −0.6639 | 1.0965 | 2.3264 | 0.9530 | −1.3777 | 2.3264 |
| 0.9467 | −1.4566 | 2.6439 | −0.6632 | 1.0521 | 2.6439 |
| 0.9428 | −1.4591 | 2.6439 | −0.6625 | 1.0523 | 2.6439 |
| 0.9370 | −1.4609 | 2.6439 | −0.6613 | 1.0527 | 2.6439 |
| 0.9294 | −1.4605 | 2.6439 | −0.6590 | 1.0532 | 2.6439 |
| 0.9213 | −1.4562 | 2.6439 | −0.6541 | 1.0532 | 2.6439 |
| 0.9127 | −1.4475 | 2.6439 | −0.6468 | 1.0513 | 2.6439 |
| 0.9018 | −1.4361 | 2.6439 | −0.6348 | 1.0447 | 2.6439 |
| 0.8880 | −1.4217 | 2.6439 | −0.6209 | 1.0332 | 2.6439 |
| 0.8714 | −1.4044 | 2.6439 | −0.6042 | 1.0157 | 2.6439 |
| 0.8516 | −1.3836 | 2.6439 | −0.5855 | 0.9922 | 2.6439 |

TABLE 9-continued

| SUCTION SIDE | | | PRESSURE SIDE | | |
|---|---|---|---|---|---|
| X | Y | Z | X | Y | Z |
| 0.8284 | −1.3592 | 2.6439 | −0.5633 | 0.9601 | 2.6439 |
| 0.8012 | −1.3305 | 2.6439 | −0.5390 | 0.9222 | 2.6439 |
| 0.7697 | −1.2971 | 2.6439 | −0.5136 | 0.8815 | 2.6439 |
| 0.7343 | −1.2592 | 2.6439 | −0.4851 | 0.8357 | 2.6439 |
| 0.6948 | −1.2169 | 2.6439 | −0.4536 | 0.7847 | 2.6439 |
| 0.6512 | −1.1698 | 2.6439 | 0.4193 | 0.7282 | 2.6439 |
| 0.6038 | −1.1180 | 2.6439 | −0.3835 | 0.6692 | 2.6439 |
| 0.5547 | −1.0637 | 2.6439 | −0.3463 | 0.6077 | 2.6439 |
| 0.5038 | −1.0069 | 2.6439 | −0.3074 | 0.5435 | 2.6439 |
| 0.4513 | −0.9475 | 2.6439 | −0.2671 | 0.4767 | 2.6439 |
| 0.3972 | −0.8855 | 2.6439 | −0.2250 | 0.4075 | 2.6439 |
| 0.3417 | −0.8207 | 2.6439 | −0.1812 | 0.3358 | 2.6439 |
| 0.2849 | −0.7532 | 2.6439 | −0.1358 | 0.2616 | 2.6439 |
| 0.2270 | −0.6829 | 2.6439 | −0.0885 | 0.1851 | 2.6439 |
| 0.1699 | −0.6118 | 2.6439 | −0.0411 | 0.1086 | 2.6439 |
| 0.1139 | −0.5402 | 2.6439 | 0.0067 | 0.0323 | 2.6439 |
| 0.0590 | −0.4677 | 2.6439 | 0.0547 | −0.0439 | 2.6439 |
| 0.0053 | −0.3943 | 2.6439 | 0.1026 | −0.1200 | 2.6439 |
| −0.0469 | −0.3199 | 2.6439 | 0.1503 | −0.1963 | 2.6439 |
| −0.0974 | −0.2444 | 2.6439 | 0.1977 | −0.2728 | 2.6439 |
| −0.1464 | −0.1678 | 2.6439 | 0.2449 | −0.3495 | 2.6439 |
| −0.1940 | −0.0902 | 2.6439 | 0.2922 | −0.4261 | 2.6439 |
| −0.2405 | −0.0118 | 2.6439 | 0.3395 | −0.5027 | 2.6439 |
| −0.2858 | 0.0673 | 2.6439 | 0.3869 | −0.5791 | 2.6439 |
| −0.3299 | 0.1474 | 2.6439 | 0.4347 | −0.6554 | 2.6439 |
| −0.3713 | 0.2255 | 2.6439 | 0.4812 | −0.7290 | 2.6439 |
| −0.4101 | 0.3018 | 2.6439 | 0.5263 | −0.7998 | 2.6439 |
| −0.4464 | 0.3762 | 2.6439 | 0.5703 | −0.8678 | 2.6439 |
| −0.4802 | 0.4484 | 2.6439 | 0.6129 | −0.9332 | 2.6439 |
| −0.5115 | 0.5183 | 2.6439 | 0.6541 | −0.9958 | 2.6439 |
| −0.5406 | 0.5860 | 2.6439 | 0.6939 | −1.0559 | 2.6439 |
| −0.5672 | 0.6513 | 2.6439 | 0.7324 | −1.1131 | 2.6439 |
| −0.5916 | 0.7142 | 2.6439 | 0.7676 | −1.1653 | 2.6439 |
| −0.6128 | 0.7718 | 2.6439 | 0.7997 | −1.2125 | 2.6439 |
| −0.6309 | 0.8239 | 2.6439 | 0.8284 | −1.2545 | 2.6439 |
| −0.6463 | 0.8705 | 2.6439 | 0.8540 | −1.2917 | 2.6439 |
| −0.6600 | 0.9145 | 2.6439 | 0.8761 | −1.3238 | 2.6439 |
| −0.6700 | 0.9530 | 2.6439 | 0.8949 | −1.3509 | 2.6439 |
| −0.6755 | 0.9831 | 2.6439 | 0.9109 | −1.3740 | 2.6439 |
| −0.6776 | 1.0076 | 2.6439 | 0.9246 | −1.3935 | 2.6439 |
| −0.6768 | 1.0259 | 2.6439 | 0.9359 | −1.4094 | 2.6439 |
| −0.6736 | 1.0394 | 2.6439 | 0.9448 | −1.4221 | 2.6439 |
| −0.6701 | 1.0462 | 2.6439 | 0.9516 | −1.4319 | 2.6439 |
| −0.6668 | 1.0498 | 2.6439 | 0.9540 | −1.4407 | 2.6439 |
| −0.6648 | 1.0513 | 2.6439 | 0.9527 | −1.4481 | 2.6439 |
| −0.6637 | 1.0518 | 2.6439 | 0.9498 | −1.4533 | 2.6439 |
| 0.9580 | −1.5130 | 2.9614 | −0.6724 | 1.0244 | 2.9614 |
| 0.9542 | −1.5155 | 2.9614 | −0.6718 | 1.0247 | 2.9614 |
| 0.9483 | −1.5173 | 2.9614 | −0.6706 | 1.0251 | 2.9614 |
| 0.9405 | −1.5169 | 2.9614 | −0.6682 | 1.0255 | 2.9614 |
| 0.9324 | −1.5125 | 2.9614 | −0.6633 | 1.0252 | 2.9614 |
| 0.9237 | −1.5038 | 2.9614 | −0.6559 | 1.0228 | 2.9614 |
| 0.9124 | −1.4924 | 2.9614 | −0.6442 | 1.0155 | 2.9614 |
| 0.8983 | −1.4782 | 2.9614 | −0.6306 | 1.0034 | 2.9614 |
| 0.8810 | −1.4608 | 2.9614 | −0.6144 | 0.9850 | 2.9614 |
| 0.8607 | −1.4400 | 2.9614 | −0.5962 | 0.9608 | 2.9614 |
| 0.8368 | −1.4158 | 2.9614 | −0.5746 | 0.9279 | 2.9614 |
| 0.8088 | −1.3870 | 2.9614 | −0.5509 | 0.8890 | 2.9614 |
| 0.7766 | −1.3538 | 2.9614 | −0.5261 | 0.8473 | 2.9614 |
| 0.7401 | −1.3159 | 2.9614 | −0.4982 | 0.8003 | 2.9614 |
| 0.6996 | −1.2734 | 2.9614 | −0.4674 | 0.7480 | 2.9614 |
| 0.6551 | −1.2262 | 2.9614 | −0.4337 | 0.6904 | 2.9614 |
| 0.6066 | −1.1743 | 2.9614 | −0.3984 | 0.6301 | 2.9614 |
| 0.5564 | −1.1197 | 2.9614 | −0.3617 | 0.5673 | 2.9614 |
| 0.5044 | −1.0626 | 2.9614 | −0.3233 | 0.5018 | 2.9614 |
| 0.4508 | −1.0027 | 2.9614 | −0.2832 | 0.4339 | 2.9614 |
| 0.3959 | −0.9401 | 2.9614 | −0.2414 | 0.3635 | 2.9614 |
| 0.3396 | −0.8748 | 2.9614 | −0.1977 | 0.2906 | 2.9614 |
| 0.2821 | −0.8066 | 2.9614 | −0.1523 | 0.2152 | 2.9614 |
| 0.2235 | −0.7355 | 2.9614 | −0.1050 | 0.1375 | 2.9614 |
| 0.1659 | −0.6635 | 2.9614 | −0.0573 | 0.0599 | 2.9614 |
| 0.1096 | −0.5908 | 2.9614 | −0.0093 | −0.0174 | 2.9614 |
| 0.0544 | −0.5171 | 2.9614 | 0.0393 | −0.0944 | 2.9614 |
| 0.0006 | −0.4424 | 2.9614 | 0.0881 | −0.1713 | 2.9614 |
| −0.0514 | −0.3667 | 2.9614 | 0.1368 | −0.2481 | 2.9614 |
| −0.1018 | −0.2898 | 2.9614 | 0.1853 | −0.3252 | 2.9614 |

TABLE 9-continued

| SUCTION SIDE | | | PRESSURE SIDE | | |
|---|---|---|---|---|---|
| X | Y | Z | X | Y | Z |
| −0.1508 | −0.2119 | 2.9614 | 0.2336 | −0.4023 | 2.9614 |
| −0.1985 | −0.1331 | 2.9614 | 0.2820 | −0.4795 | 2.9614 |
| −0.2451 | −0.0535 | 2.9614 | 0.3303 | −0.5566 | 2.9614 |
| −0.2905 | 0.0269 | 2.9614 | 0.3790 | −0.6334 | 2.9614 |
| −0.3347 | 0.1082 | 2.9614 | 0.4279 | −0.7102 | 2.9614 |
| −0.3762 | 0.1876 | 2.9614 | 0.4756 | −0.7841 | 2.9614 |
| −0.4152 | 0.2650 | 2.9614 | 0.5221 | −0.8554 | 2.9614 |
| −0.4516 | 0.3404 | 2.9614 | 0.5672 | −0.9237 | 2.9614 |
| −0.4854 | 0.4136 | 2.9614 | 0.6111 | −0.9893 | 2.9614 |
| −0.5169 | 0.4845 | 2.9614 | 0.6536 | −1.0521 | 2.9614 |
| −0.5460 | 0.5530 | 2.9614 | 0.6947 | −1.1122 | 2.9614 |
| −0.5729 | 0.6191 | 2.9614 | 0.7343 | −1.1696 | 2.9614 |
| −0.5976 | 0.6826 | 2.9614 | 0.7708 | −1.2219 | 2.9614 |
| −0.6190 | 0.7409 | 2.9614 | 0.8040 | −1.2690 | 2.9614 |
| −0.6374 | 0.7936 | 2.9614 | 0.8338 | −1.3111 | 2.9614 |
| −0.6530 | 0.8407 | 2.9614 | 0.8604 | −1.3480 | 2.9614 |
| −0.6670 | 0.8851 | 2.9614 | 0.8834 | −1.3801 | 2.9614 |
| −0.6773 | 0.9239 | 2.9614 | 0.9028 | −1.4072 | 2.9614 |
| −0.6832 | 0.9544 | 2.9614 | 0.9197 | −1.4302 | 2.9614 |
| −0.6856 | 0.9791 | 2.9614 | 0.9337 | −1.4496 | 2.9614 |
| −0.6853 | 0.9977 | 2.9614 | 0.9454 | −1.4655 | 2.9614 |
| −0.6825 | 1.0113 | 2.9614 | 0.9548 | −1.4783 | 2.9614 |
| −0.6792 | 1.0184 | 2.9614 | 0.9620 | −1.4880 | 2.9614 |
| −0.6760 | 1.0221 | 2.9614 | 0.9648 | −1.4967 | 2.9614 |
| −0.6740 | 1.0236 | 2.9614 | 0.9639 | −1.5041 | 2.9614 |
| −0.6730 | 1.0242 | 2.9614 | 0.9611 | −1.5096 | 2.9614 |
| 0.9844 | −1.5482 | 3.2789 | −0.6916 | 1.0063 | 3.2789 |
| 0.9806 | −1.5510 | 3.2789 | −0.6909 | 1.0067 | 3.2789 |
| 0.9746 | −1.5529 | 3.2789 | −0.6898 | 1.0070 | 3.2789 |
| 0.9668 | −1.5526 | 3.2789 | −0.6873 | 1.0073 | 3.2789 |
| 0.9586 | −1.5480 | 3.2789 | −0.6823 | 1.0069 | 3.2789 |
| 0.9495 | −1.5395 | 3.2789 | −0.6751 | 1.0040 | 3.2789 |
| 0.9377 | −1.5282 | 3.2789 | −0.6635 | 0.9961 | 3.2789 |
| 0.9229 | −1.5141 | 3.2789 | −0.6502 | 0.9833 | 3.2789 |
| 0.9050 | −1.4971 | 3.2789 | −0.6342 | 0.9645 | 3.2789 |
| 0.8837 | −1.4768 | 3.2789 | −0.6163 | 0.9395 | 3.2789 |
| 0.8589 | −1.4528 | 3.2789 | −0.5950 | 0.9058 | 3.2789 |
| 0.8296 | −1.4244 | 3.2789 | −0.5716 | 0.8660 | 3.2789 |
| 0.7959 | −1.3916 | 3.2789 | −0.5471 | 0.8234 | 3.2789 |
| 0.7580 | −1.3541 | 3.2789 | −0.5195 | 0.7755 | 3.2789 |
| 0.7159 | −1.3120 | 3.2789 | −0.4888 | 0.7221 | 3.2789 |
| 0.6697 | −1.2653 | 3.2789 | −0.4553 | 0.6635 | 3.2789 |
| 0.6193 | −1.2137 | 3.2789 | −0.4202 | 0.6021 | 3.2789 |
| 0.5671 | −1.1595 | 3.2789 | −0.3833 | 0.5383 | 3.2789 |
| 0.5133 | −1.1025 | 3.2789 | −0.3448 | 0.4717 | 3.2789 |
| 0.4581 | −1.0429 | 3.2789 | −0.3045 | 0.4028 | 3.2789 |
| 0.4013 | −0.9804 | 3.2789 | −0.2624 | 0.3313 | 3.2789 |
| 0.3433 | −0.9150 | 3.2789 | −0.2183 | 0.2575 | 3.2789 |
| 0.2841 | −0.8466 | 3.2789 | −0.1722 | 0.1811 | 3.2789 |
| 0.2240 | −0.7752 | 3.2789 | −0.1242 | 0.1025 | 3.2789 |
| 0.1650 | −0.7028 | 3.2789 | −0.0756 | 0.0242 | 3.2789 |
| 0.1074 | −0.6295 | 3.2789 | −0.0265 | −0.0538 | 3.2789 |
| 0.0512 | −0.5551 | 3.2789 | 0.0230 | −0.1315 | 3.2789 |
| −0.0033 | −0.4796 | 3.2789 | 0.0732 | −0.2089 | 3.2789 |
| −0.0561 | −0.4028 | 3.2789 | 0.1236 | −0.2861 | 3.2789 |
| −0.1073 | −0.3249 | 3.2789 | 0.1740 | −0.3632 | 3.2789 |
| −0.1571 | −0.2460 | 3.2789 | 0.2242 | −0.4405 | 3.2789 |
| −0.2058 | −0.1662 | 3.2789 | 0.2745 | −0.5178 | 3.2789 |
| −0.2533 | −0.0856 | 3.2789 | 0.3249 | −0.5950 | 3.2789 |
| −0.2995 | −0.0042 | 3.2789 | 0.3754 | −0.6720 | 3.2789 |
| −0.3446 | 0.0783 | 3.2789 | 0.4265 | −0.7488 | 3.2789 |
| −0.3868 | 0.1589 | 3.2789 | 0.4762 | −0.8228 | 3.2789 |
| −0.4265 | 0.2373 | 3.2789 | 0.5246 | −0.8938 | 3.2789 |
| −0.4635 | 0.3137 | 3.2789 | 0.5718 | −0.9620 | 3.2789 |
| −0.4979 | 0.3878 | 3.2789 | 0.6177 | −1.0275 | 3.2789 |
| −0.5300 | 0.4595 | 3.2789 | 0.6622 | −1.0901 | 3.2789 |
| −0.5597 | 0.5289 | 3.2789 | 0.7052 | −1.1500 | 3.2789 |
| −0.5870 | 0.5958 | 3.2789 | 0.7470 | −1.2071 | 3.2789 |
| −0.6123 | 0.6601 | 3.2789 | 0.7853 | −1.2590 | 3.2789 |
| −0.6342 | 0.7191 | 3.2789 | 0.8202 | −1.3058 | 3.2789 |
| −0.6531 | 0.7723 | 3.2789 | 0.8516 | −1.3475 | 3.2789 |
| −0.6693 | 0.8199 | 3.2789 | 0.8795 | −1.3842 | 3.2789 |
| −0.6836 | 0.8648 | 3.2789 | 0.9038 | −1.4160 | 3.2789 |
| −0.6944 | 0.9042 | 3.2789 | 0.9245 | −1.4427 | 3.2789 |
| −0.7007 | 0.9350 | 3.2789 | 0.9421 | −1.4656 | 3.2789 |
| −0.7036 | 0.9600 | 3.2789 | 0.9570 | −1.4848 | 3.2789 |

TABLE 9-continued

| SUCTION SIDE | | | PRESSURE SIDE | | |
|---|---|---|---|---|---|
| X | Y | Z | X | Y | Z |
| −0.7036 | 0.9789 | 3.2789 | 0.9693 | −1.5005 | 3.2789 |
| −0.7014 | 0.9927 | 3.2789 | 0.9791 | −1.5131 | 3.2789 |
| −0.6983 | 1.0001 | 3.2789 | 0.9868 | −1.5228 | 3.2789 |
| −0.6952 | 1.0040 | 3.2789 | 0.9903 | −1.5313 | 3.2789 |
| −0.6932 | 1.0055 | 3.2789 | 0.9899 | −1.5390 | 3.2789 |
| −0.6921 | 1.0061 | 3.2789 | 0.9875 | −1.5447 | 3.2789 |
| 1.0162 | −1.5526 | 3.5965 | −0.7169 | 1.0083 | 3.5965 |
| 1.0124 | −1.5555 | 3.5965 | −0.7163 | 1.0085 | 3.5965 |
| 1.0064 | −1.5576 | 3.5964 | −0.7151 | 1.0088 | 3.5964 |
| 0.9986 | −1.5573 | 3.5964 | −0.7126 | 1.0091 | 3.5964 |
| 0.9903 | −1.5528 | 3.5964 | −0.7076 | 1.0085 | 3.5964 |
| 0.9808 | −1.5443 | 3.5964 | −0.7003 | 1.0054 | 3.5965 |
| 0.9684 | −1.5333 | 3.5964 | −0.6889 | 0.9971 | 3.5964 |
| 0.9530 | −1.5196 | 3.5964 | −0.6757 | 0.9838 | 3.5964 |
| 0.9343 | −1.5029 | 3.5964 | −0.6600 | 0.9644 | 3.5964 |
| 0.9121 | −1.4828 | 3.5964 | −0.6422 | 0.9389 | 3.5964 |
| 0.8862 | −1.4594 | 3.5964 | −0.6208 | 0.9047 | 3.5964 |
| 0.8558 | −1.4315 | 3.5965 | −0.5975 | 0.8643 | 3.5965 |
| 0.8207 | −1.3993 | 3.5964 | −0.5730 | 0.8211 | 3.5965 |
| 0.7812 | −1.3624 | 3.5965 | −0.5453 | 0.7723 | 3.5964 |
| 0.7374 | −1.3210 | 3.5964 | −0.5145 | 0.7183 | 3.5965 |
| 0.6891 | −1.2749 | 3.5964 | −0.4808 | 0.6588 | 3.5964 |
| 0.6369 | −1.2240 | 3.5964 | −0.4453 | 0.5967 | 3.5965 |
| 0.5827 | −1.1703 | 3.5964 | −0.4080 | 0.5320 | 3.5964 |
| 0.5269 | −1.1140 | 3.5965 | −0.3690 | 0.4648 | 3.5964 |
| 0.4695 | −1.0549 | 3.5964 | −0.3280 | 0.3950 | 3.5964 |
| 0.4107 | −0.9928 | 3.5964 | −0.2850 | 0.3230 | 3.5965 |
| 0.3506 | −0.9279 | 3.5965 | −0.2401 | 0.2484 | 3.5965 |
| 0.2895 | −0.8597 | 3.5964 | −0.1930 | 0.1715 | 3.5965 |
| 0.2274 | −0.7884 | 3.5965 | −0.1439 | 0.0923 | 3.5964 |
| 0.1667 | −0.7161 | 3.5964 | −0.0940 | 0.0135 | 3.5964 |
| 0.1075 | −0.6426 | 3.5964 | −0.0436 | −0.0648 | 3.5965 |
| 0.0498 | −0.5680 | 3.5965 | 0.0076 | −0.1429 | 3.5964 |
| −0.0060 | −0.4919 | 3.5964 | 0.0592 | −0.2205 | 3.5964 |
| −0.0601 | −0.4145 | 3.5964 | 0.1116 | −0.2978 | 3.5964 |
| −0.1127 | −0.3359 | 3.5964 | 0.1642 | −0.3749 | 3.5965 |
| −0.1640 | −0.2565 | 3.5964 | 0.2168 | −0.4520 | 3.5964 |
| −0.2140 | −0.1761 | 3.5965 | 0.2693 | −0.5291 | 3.5964 |
| −0.2629 | −0.0949 | 3.5964 | 0.3220 | −0.6062 | 3.5964 |
| −0.3105 | −0.0126 | 3.5964 | 0.3749 | −0.6830 | 3.5965 |
| −0.3568 | 0.0707 | 3.5964 | 0.4284 | −0.7595 | 3.5965 |
| −0.4004 | 0.1521 | 3.5964 | 0.4803 | −0.8332 | 3.5964 |
| −0.4410 | 0.2313 | 3.5964 | 0.5311 | −0.9040 | 3.5965 |
| −0.4791 | 0.3084 | 3.5965 | 0.5805 | −0.9719 | 3.5964 |
| −0.5144 | 0.3831 | 3.5964 | 0.6287 | −1.0370 | 3.5965 |
| −0.5474 | 0.4555 | 3.5965 | 0.6754 | −1.0992 | 3.5965 |
| −0.5780 | 0.5255 | 3.5965 | 0.7207 | −1.1585 | 3.5965 |
| −0.6061 | 0.5931 | 3.5964 | 0.7645 | −1.2150 | 3.5965 |
| −0.6322 | 0.6580 | 3.5964 | 0.8049 | −1.2665 | 3.5964 |
| −0.6549 | 0.7176 | 3.5965 | 0.8416 | −1.3128 | 3.5965 |
| −0.6744 | 0.7713 | 3.5964 | 0.8747 | −1.3540 | 3.5965 |
| −0.6913 | 0.8195 | 3.5964 | 0.9041 | −1.3903 | 3.5965 |
| −0.7062 | 0.8647 | 3.5965 | 0.9298 | −1.4216 | 3.5964 |
| −0.7176 | 0.9045 | 3.5965 | 0.9515 | −1.4480 | 3.5964 |
| −0.7243 | 0.9356 | 3.5965 | 0.9701 | −1.4706 | 3.5964 |
| −0.7277 | 0.9609 | 3.5964 | 0.9859 | −1.4894 | 3.5964 |
| −0.7282 | 0.9799 | 3.5965 | 0.9988 | −1.5050 | 3.5964 |
| −0.7263 | 0.9941 | 3.5965 | 1.0092 | −1.5173 | 3.5964 |
| −0.7235 | 1.0016 | 3.5965 | 1.0172 | −1.5269 | 3.5964 |
| −0.7206 | 1.0057 | 3.5964 | 1.0215 | −1.5351 | 3.5964 |
| −0.7186 | 1.0073 | 3.5965 | 1.0215 | −1.5430 | 3.5965 |
| −0.7175 | 1.0079 | 3.5964 | 1.0192 | −1.5489 | 3.5964 |
| 1.0425 | −1.5299 | 3.9139 | −0.7423 | 1.0380 | 3.9139 |
| 1.0387 | −1.5329 | 3.9139 | −0.7417 | 1.0382 | 3.9139 |
| 1.0327 | −1.5351 | 3.9139 | −0.7405 | 1.0386 | 3.9139 |
| 1.0248 | −1.5349 | 3.9319 | −0.7379 | 1.0388 | 3.9139 |
| 1.0164 | −1.5303 | 3.9139 | −0.7329 | 1.0380 | 3.9139 |
| 1.0066 | −1.5220 | 3.9139 | −0.7257 | 1.0346 | 3.9139 |
| 0.9938 | −1.5113 | 3.9139 | −0.7145 | 1.0259 | 3.9139 |
| 0.9778 | −1.4977 | 3.9139 | −0.7013 | 1.0122 | 3.9139 |
| 0.9584 | −1.4813 | 3.9139 | −0.6856 | 0.9925 | 3.9139 |
| 0.9354 | −1.4617 | 3.9139 | −0.6678 | 0.9665 | 3.9139 |
| 0.9087 | −1.4385 | 3.9139 | −0.6465 | 0.9317 | 3.9139 |
| 0.8772 | −1.4112 | 3.9139 | −0.6231 | 0.8908 | 3.9139 |
| 0.8409 | −1.3793 | 3.9139 | −0.5985 | 0.8469 | 3.9139 |
| 0.8001 | −1.3430 | 3.9139 | −0.5706 | 0.7975 | 3.9139 |

TABLE 9-continued

| SUCTION SIDE | | | PRESSURE SIDE | | |
|---|---|---|---|---|---|
| X | Y | Z | X | Y | Z |
| 0.7547 | −1.3021 | 3.9139 | −0.5396 | 0.7428 | 3.9139 |
| 0.7049 | −1.2566 | 3.9139 | −0.5056 | 0.6826 | 3.9139 |
| 0.6508 | −1.2061 | 3.9139 | −0.4697 | 0.6198 | 3.9139 |
| 0.5949 | −1.1530 | 3.9139 | −0.4319 | 0.5544 | 3.9139 |
| 0.5373 | −1.0971 | 3.9139 | −0.3923 | 0.4865 | 3.9139 |
| 0.4782 | −1.0384 | 3.9139 | −0.3506 | 0.4161 | 3.9139 |
| 0.4177 | −0.9766 | 3.9139 | −0.3070 | 0.3434 | 3.9139 |
| 0.3560 | −0.9119 | 3.9139 | −0.2611 | 0.2682 | 3.9139 |
| 0.2931 | −0.8440 | 3.9139 | −0.2131 | 0.1907 | 3.9139 |
| 0.2294 | −0.7726 | 3.9139 | −0.1627 | 0.1110 | 3.9139 |
| 0.1672 | −0.7002 | 3.9139 | −0.1116 | 0.0317 | 3.9139 |
| 0.1065 | −0.6264 | 3.9139 | −0.0598 | −0.0472 | 3.9139 |
| 0.0476 | −0.5514 | 3.9139 | −0.0073 | −0.1256 | 3.9139 |
| −0.0094 | −0.4748 | 3.9139 | 0.0458 | −0.2036 | 3.9139 |
| −0.0645 | −0.3967 | 3.9139 | 0.0998 | −0.2811 | 3.9139 |
| −0.1185 | −0.3177 | 3.9139 | 0.1543 | −0.3581 | 3.9139 |
| −0.1712 | −0.2378 | 3.9139 | 0.2090 | −0.4351 | 3.9139 |
| −0.2226 | −0.1568 | 3.9139 | 0.2636 | −0.5121 | 3.9139 |
| −0.2728 | −0.0749 | 3.9139 | 0.3184 | −0.5889 | 3.9139 |
| −0.3217 | 0.0081 | 3.9139 | 0.3734 | −0.6656 | 3.9139 |
| −0.3692 | 0.0921 | 3.9139 | 0.4288 | −0.7421 | 3.9139 |
| −0.4138 | 0.1741 | 3.9139 | 0.4829 | −0.8155 | 3.9139 |
| −0.4555 | 0.2540 | 3.9139 | 0.5357 | −0.8861 | 3.9139 |
| −0.4945 | 0.3316 | 3.9139 | 0.5870 | −0.9537 | 3.9139 |
| −0.5309 | 0.4070 | 3.9139 | 0.6371 | −1.0185 | 3.9139 |
| −0.5648 | 0.4800 | 3.9139 | 0.6857 | −1.0803 | 3.9139 |
| −0.5962 | 0.5506 | 3.9139 | 0.7329 | −1.1393 | 3.9139 |
| −0.6251 | 0.6186 | 3.9139 | 0.7786 | −1.1955 | 3.9139 |
| −0.6520 | 0.6842 | 3.9139 | 0.8206 | −1.2465 | 3.9139 |
| −0.6754 | 0.7442 | 3.9139 | 0.8590 | −1.2923 | 3.9139 |
| −0.6957 | 0.7985 | 3.9139 | 0.8936 | −1.3331 | 3.9139 |
| −0.7132 | 0.8469 | 3.9139 | 0.9242 | −1.3690 | 3.9139 |
| −0.7287 | 0.8927 | 3.9139 | 0.9510 | −1.4000 | 3.9139 |
| −0.7406 | 0.9329 | 3.9139 | 0.9737 | −1.4262 | 3.9139 |
| −0.7478 | 0.9642 | 3.9139 | 0.9931 | −1.4484 | 3.9139 |
| −0.7517 | 0.9896 | 3.9139 | 1.0095 | −1.4671 | 3.9139 |
| −0.7527 | 1.0090 | 3.9139 | 1.0232 | −1.4824 | 3.9139 |
| −0.7512 | 1.0234 | 3.9139 | 1.0340 | −1.4947 | 3.9139 |
| −0.7488 | 1.0310 | 3.9139 | 1.0423 | −1.5040 | 3.9139 |
| −0.7459 | 1.0353 | 3.9139 | 1.0471 | −1.5121 | 3.9139 |
| −0.7440 | 1.0370 | 3.9139 | 1.0476 | −1.5201 | 3.9139 |
| −0.7429 | 1.0376 | 3.9139 | 1.0454 | −1.5261 | 3.9139 |
| 1.0592 | −1.4962 | 4.2314 | −0.7606 | 1.0956 | 4.2314 |
| 1.0554 | −1.4992 | 4.2314 | −0.7601 | 1.0959 | 4.2314 |
| 1.0494 | −1.5016 | 4.2314 | −0.7588 | 1.0962 | 4.2314 |
| 1.0413 | −1.5014 | 4.2314 | −0.7562 | 1.0964 | 4.2314 |
| 1.0329 | −1.4966 | 4.2314 | −0.7511 | 1.0954 | 4.2314 |
| 1.0227 | −1.4884 | 4.2314 | −0.7440 | 1.0915 | 4.2314 |
| 1.0095 | −1.4776 | 4.2314 | −0.7329 | 1.0824 | 4.2314 |
| 0.9931 | −1.4642 | 4.2314 | −0.7199 | 1.0682 | 4.2314 |
| 0.9732 | −1.4479 | 4.2314 | −0.7045 | 1.0479 | 4.2314 |
| 0.9497 | −1.4284 | 4.2314 | −0.6870 | 1.0214 | 4.2314 |
| 0.9221 | −1.4054 | 4.2314 | −0.6658 | 0.9858 | 4.2314 |
| 0.8897 | −1.3782 | 4.2314 | −0.6425 | 0.9441 | 4.2314 |
| 0.8526 | −1.3464 | 4.2314 | −0.6180 | 0.8993 | 4.2314 |
| 0.8106 | −1.3102 | 4.2314 | −0.5903 | 0.8491 | 4.2314 |
| 0.7641 | −1.2695 | 4.2314 | −0.5593 | 0.7933 | 4.2314 |
| 0.7131 | −1.2240 | 4.2314 | −0.5253 | 0.7321 | 4.2314 |
| 0.6576 | −1.1736 | 4.2314 | −0.4893 | 0.6682 | 4.2314 |
| 0.6003 | −1.1204 | 4.2314 | −0.4515 | 0.6017 | 4.2314 |
| 0.5415 | −1.0645 | 4.2314 | −0.4117 | 0.5327 | 4.2314 |
| 0.4810 | −1.0056 | 4.2314 | −0.3698 | 0.4613 | 4.2314 |
| 0.4191 | −0.9436 | 4.2314 | −0.3257 | 0.3874 | 4.2314 |
| 0.3562 | −0.8786 | 4.2314 | −0.2795 | 0.3111 | 4.2314 |
| 0.2921 | −0.8101 | 4.2314 | −0.2310 | 0.2326 | 4.2314 |
| 0.2273 | −0.7382 | 4.2314 | −0.1800 | 0.1516 | 4.2314 |
| 0.1641 | −0.6650 | 4.2314 | −0.1281 | 0.0713 | 4.2314 |
| 0.1026 | −0.5903 | 4.2314 | −0.0756 | −0.0086 | 4.2314 |
| 0.0431 | −0.5142 | 4.2314 | −0.0221 | −0.0880 | 4.2314 |
| −0.0145 | −0.4365 | 4.2314 | 0.0319 | −0.1667 | 4.2314 |
| −0.0705 | −0.3573 | 4.2314 | 0.0869 | −0.2450 | 4.2314 |
| −0.1252 | −0.2774 | 4.2314 | 0.1427 | −0.3227 | 4.2314 |
| −0.1788 | −0.1963 | 4.2314 | 0.1988 | −0.4000 | 4.2314 |
| −0.2310 | −0.1143 | 4.2314 | 0.2551 | −0.4773 | 4.2314 |
| −0.2819 | −0.0312 | 4.2314 | 0.3115 | −0.5545 | 4.2314 |
| −0.3315 | 0.0530 | 4.2314 | 0.3681 | −0.6316 | 4.2314 |

TABLE 9-continued

| SUCTION SIDE | | | PRESSURE SIDE | | |
|---|---|---|---|---|---|
| X | Y | Z | X | Y | Z |
| −0.3797 | 0.1381 | 4.2314 | 0.4251 | −0.7084 | 4.2314 |
| −0.4249 | 0.2211 | 4.2314 | 0.4807 | −0.7822 | 4.2314 |
| −0.4671 | 0.3020 | 4.2314 | 0.5350 | −0.8531 | 4.2314 |
| −0.5066 | 0.3806 | 4.2314 | 0.5879 | −0.9209 | 4.2314 |
| −0.5436 | 0.4569 | 4.2314 | 0.6394 | −0.9858 | 4.2314 |
| −0.5779 | 0.5308 | 4.2314 | 0.6895 | −1.0478 | 4.2314 |
| −0.6098 | 0.6023 | 4.2314 | 0.7381 | −1.1068 | 4.2314 |
| −0.6392 | 0.6712 | 4.2314 | 0.7853 | −1.1630 | 4.2314 |
| −0.6666 | 0.7376 | 4.2314 | 0.8287 | −1.2139 | 4.2314 |
| −0.6904 | 0.7983 | 4.2314 | 0.8683 | −1.2597 | 4.2314 |
| −0.7112 | 0.8531 | 4.2314 | 0.9041 | −1.3004 | 4.2314 |
| −0.7290 | 0.9022 | 4.2314 | 0.9359 | −1.3361 | 4.2314 |
| −0.7449 | 0.9484 | 4.2314 | 0.9635 | −1.3670 | 4.2314 |
| −0.7571 | 0.9890 | 4.2314 | 0.9871 | −1.3931 | 4.2314 |
| −0.7647 | 1.0207 | 4.2314 | 1.0072 | −1.4152 | 4.2314 |
| −0.7689 | 1.0465 | 4.2314 | 1.0242 | −1.4338 | 4.2314 |
| −0.7703 | 1.0660 | 4.2314 | 1.0383 | −1.4490 | 4.2314 |
| −0.7691 | 1.0806 | 4.2314 | 1.0496 | −1.4611 | 4.2314 |
| −0.7670 | 1.0884 | 4.2314 | 1.0582 | −1.4705 | 4.2314 |
| −0.7642 | 1.0929 | 4.2314 | 1.0633 | −1.4785 | 4.2314 |
| −0.7623 | 1.0946 | 4.2314 | 1.0639 | −1.4864 | 4.2314 |
| −0.7612 | 1.0954 | 4.2314 | 1.0619 | −1.4923 | 4.2314 |
| 1.0700 | −1.4591 | 4.5489 | −0.7662 | 1.1775 | 4.5489 |
| 1.0662 | −1.4623 | 4.5489 | −0.7656 | 1.1777 | 4.5489 |
| 1.0601 | −1.4646 | 4.5489 | −0.7643 | 1.1780 | 4.5489 |
| 1.0518 | −1.4642 | 4.5489 | −0.7617 | 1.1781 | 4.5489 |
| 1.0434 | −1.4591 | 4.5489 | −0.7566 | 1.1767 | 4.5489 |
| 1.0331 | −1.4509 | 4.5489 | −0.7496 | 1.1725 | 4.5489 |
| 1.0195 | −1.4401 | 4.5489 | −0.7388 | 1.1627 | 4.5489 |
| 1.0028 | −1.4267 | 4.5489 | −0.7262 | 1.1479 | 4.5489 |
| 0.9824 | −1.4104 | 4.5489 | −0.7112 | 1.1268 | 4.5489 |
| 0.9583 | −1.3908 | 4.5489 | −0.6941 | 1.0993 | 4.5489 |
| 0.9301 | −1.3677 | 4.5489 | −0.6736 | 1.0627 | 4.5489 |
| 0.8970 | −1.3403 | 4.5489 | −0.6510 | 1.0198 | 4.5489 |
| 0.8590 | −1.3084 | 4.5489 | −0.6271 | 0.9738 | 4.5489 |
| 0.8162 | −1.2720 | 4.5489 | −0.6000 | 0.9222 | 4.5489 |
| 0.7687 | −1.2309 | 4.5489 | −0.5698 | 0.8650 | 4.5489 |
| 0.7165 | −1.1850 | 4.5489 | −0.5363 | 0.8022 | 4.5489 |
| 0.6600 | −1.1341 | 4.5489 | −0.5010 | 0.7366 | 4.5489 |
| 0.6016 | −1.0805 | 4.5489 | −0.4637 | 0.6686 | 4.5489 |
| 0.5417 | −1.0238 | 4.5489 | −0.4244 | 0.5979 | 4.5489 |
| 0.4802 | −0.9642 | 4.5489 | −0.3830 | 0.5246 | 4.5489 |
| 0.4175 | −0.9014 | 4.5489 | −0.3394 | 0.4490 | 4.5489 |
| 0.3536 | −0.8353 | 4.5489 | −0.2934 | 0.3711 | 4.5489 |
| 0.2888 | −0.7658 | 4.5489 | −0.2450 | 0.2907 | 4.5489 |
| 0.2233 | −0.6927 | 4.5489 | −0.1941 | 0.2082 | 4.5489 |
| 0.1595 | −0.6180 | 4.5489 | −0.1423 | 0.1261 | 4.5489 |
| 0.0976 | −0.5418 | 4.5489 | −0.0897 | 0.0446 | 4.5489 |
| 0.0380 | −0.4638 | 4.5489 | −0.0360 | −0.0363 | 4.5489 |
| −0.0198 | −0.3844 | 4.5489 | 0.0184 | −0.1167 | 4.5489 |
| −0.0763 | −0.3038 | 4.5489 | 0.0739 | −0.1963 | 4.5489 |
| −0.1315 | −0.2222 | 4.5489 | 0.1301 | −0.2754 | 4.5489 |
| −0.1853 | −0.1395 | 4.5489 | 0.1873 | −0.3538 | 4.5489 |
| −0.2378 | −0.0557 | 4.5489 | 0.2449 | −0.4319 | 4.5489 |
| −0.2889 | 0.0292 | 4.5489 | 0.3024 | −0.5100 | 4.5489 |
| −0.3386 | 0.1151 | 4.5489 | 0.3601 | −0.5880 | 4.5489 |
| −0.3867 | 0.2019 | 4.5489 | 0.4184 | −0.6657 | 4.5489 |
| −0.4319 | 0.2865 | 4.5489 | 0.4751 | −0.7404 | 4.5489 |
| −0.4740 | 0.3691 | 4.5489 | 0.5306 | −0.8119 | 4.5489 |
| −0.5134 | 0.4492 | 4.5489 | 0.5848 | −0.8805 | 4.5489 |
| −0.5501 | 0.5271 | 4.5489 | 0.6375 | −0.9460 | 4.5489 |
| −0.5843 | 0.6025 | 4.5489 | 0.6889 | −1.0085 | 4.5489 |
| −0.6159 | 0.6753 | 4.5489 | 0.7388 | −1.0679 | 4.5489 |
| −0.6452 | 0.7455 | 4.5489 | 0.7872 | −1.1244 | 4.5489 |
| −0.6722 | 0.8131 | 4.5489 | 0.8318 | −1.1756 | 4.5489 |
| −0.6958 | 0.8749 | 4.5489 | 0.8726 | −1.2218 | 4.5489 |
| −0.7165 | 0.9308 | 4.5489 | 0.9093 | −1.2626 | 4.5489 |
| −0.7342 | 0.9807 | 4.5489 | 0.9420 | −1.2985 | 4.5489 |
| −0.7499 | 1.0277 | 4.5489 | 0.9705 | −1.3295 | 4.5489 |
| −0.7621 | 1.0691 | 4.5489 | 0.9947 | −1.3556 | 4.5489 |
| −0.7696 | 1.1012 | 4.5489 | 1.0155 | −1.3777 | 4.5489 |
| −0.7740 | 1.1274 | 4.5489 | 1.0331 | −1.3964 | 4.5489 |
| −0.7754 | 1.1471 | 4.5489 | 1.0476 | −1.4116 | 4.5489 |
| −0.7745 | 1.1620 | 4.5489 | 1.0592 | −1.4239 | 4.5489 |
| −0.7724 | 1.1700 | 4.5489 | 1.0681 | −1.4331 | 4.5489 |
| −0.7699 | 1.1746 | 4.5489 | 1.0736 | −1.4410 | 4.5489 |

TABLE 9-continued

| SUCTION SIDE | | | PRESSURE SIDE | | |
|---|---|---|---|---|---|
| X | Y | Z | X | Y | Z |
| −0.7679 | 1.1764 | 4.5489 | 1.0746 | −1.4490 | 4.5489 |
| −0.7668 | 1.1771 | 4.5489 | 1.0728 | −1.4552 | 4.5489 |
| 1.0787 | −1.4212 | 4.8665 | −0.7655 | 1.2799 | 4.8665 |
| 1.0748 | −1.4245 | 4.8665 | −0.7648 | 1.2801 | 4.8665 |
| 1.0685 | −1.4268 | 4.8665 | −0.7635 | 1.2804 | 4.8665 |
| 1.0601 | −1.4262 | 4.8665 | −0.7608 | 1.2802 | 4.8665 |
| 1.0516 | −1.4209 | 4.8665 | −0.7558 | 1.2783 | 4.8665 |
| 1.0409 | −1.4126 | 4.8665 | −0.7491 | 1.2735 | 4.8665 |
| 1.0271 | −1.4018 | 4.8665 | −0.7388 | 1.2627 | 4.8665 |
| 1.0099 | −1.3883 | 4.8665 | −0.7267 | 1.2470 | 4.8665 |
| 0.9890 | −1.3718 | 4.8665 | −0.7125 | 1.2248 | 4.8665 |
| 0.9642 | −1.3520 | 4.8665 | −0.6962 | 1.1963 | 4.8665 |
| 0.9353 | −1.3288 | 4.8665 | −0.6765 | 1.1583 | 4.8665 |
| 0.9014 | −1.3010 | 4.8665 | −0.6547 | 1.1138 | 4.8665 |
| 0.8623 | −1.2688 | 4.8665 | −0.6319 | 1.0663 | 4.8665 |
| 0.8184 | −1.2320 | 4.8665 | −0.6060 | 1.0129 | 4.8665 |
| 0.7697 | −1.1903 | 4.8665 | −0.5769 | 0.9537 | 4.8665 |
| 0.7164 | −1.1437 | 4.8665 | −0.5448 | 0.8888 | 4.8665 |
| 0.6586 | −1.0921 | 4.8665 | −0.5106 | 0.8211 | 4.8665 |
| 0.5991 | −1.0374 | 4.8665 | −0.4745 | 0.7507 | 4.8665 |
| 0.5378 | −0.9797 | 4.8665 | −0.4362 | 0.6776 | 4.8665 |
| 0.4753 | −0.9190 | 4.8665 | −0.3958 | 0.6021 | 4.8665 |
| 0.4114 | −0.8549 | 4.8665 | −0.3531 | 0.5241 | 4.8665 |
| 0.3466 | −0.7874 | 4.8665 | −0.3079 | 0.4437 | 4.8665 |
| 0.2809 | −0.7163 | 4.8665 | −0.2602 | 0.3610 | 4.8665 |
| 0.2148 | −0.6412 | 4.8665 | −0.2099 | 0.2760 | 4.8665 |
| 0.1507 | −0.5646 | 4.8665 | −0.1584 | 0.1916 | 4.8665 |
| 0.0888 | −0.4861 | 4.8665 | −0.1059 | 0.1078 | 4.8665 |
| 0.0292 | −0.4057 | 4.8665 | −0.0524 | 0.0246 | 4.8665 |
| −0.0289 | −0.3240 | 4.8665 | 0.0021 | −0.0578 | 4.8665 |

TABLE 9-continued

| SUCTION SIDE | | | PRESSURE SIDE | | |
|---|---|---|---|---|---|
| X | Y | Z | X | Y | Z |
| −0.0855 | −0.2414 | 4.8665 | 0.0578 | −0.1395 | 4.8665 |
| −0.1408 | −0.1575 | 4.8665 | 0.1145 | −0.2204 | 4.8665 |
| −0.1946 | −0.0724 | 4.8665 | 0.1723 | −0.3006 | 4.8665 |
| −0.2470 | 0.0138 | 4.8665 | 0.2310 | −0.3801 | 4.8665 |
| −0.2979 | 0.1013 | 4.8665 | 0.2898 | −0.4596 | 4.8665 |
| −0.3472 | 0.1895 | 4.8665 | 0.3488 | −0.5388 | 4.8665 |
| −0.3949 | 0.2788 | 4.8665 | 0.4082 | −0.6178 | 4.8665 |
| −0.4394 | 0.3658 | 4.8665 | 0.4663 | −0.6937 | 4.8665 |
| −0.4811 | 0.4505 | 4.8665 | 0.5230 | −0.7664 | 4.8665 |
| −0.5197 | 0.5329 | 4.8665 | 0.5784 | −0.8361 | 4.8665 |
| −0.5557 | 0.6129 | 4.8665 | 0.6324 | −0.9024 | 4.8665 |
| −0.5892 | 0.6903 | 4.8665 | 0.6851 | −0.9658 | 4.8665 |
| −0.6201 | 0.7651 | 4.8665 | 0.7364 | −1.0260 | 4.8665 |
| −0.6486 | 0.8373 | 4.8665 | 0.7861 | −1.0832 | 4.8665 |
| −0.6750 | 0.9066 | 4.8665 | 0.8320 | −1.1351 | 4.8665 |
| −0.6980 | 0.9700 | 4.8665 | 0.8740 | −1.1815 | 4.8665 |
| −0.7179 | 1.0273 | 4.8665 | 0.9118 | −1.2228 | 4.8665 |
| −0.7349 | 1.0785 | 4.8665 | 0.9455 | −1.2590 | 4.8665 |
| −0.7499 | 1.1269 | 4.8665 | 0.9748 | −1.2902 | 4.8665 |
| −0.7615 | 1.1692 | 4.8665 | 0.9998 | −1.3165 | 4.8665 |
| −0.7688 | 1.2021 | 4.8665 | 1.0212 | −1.3388 | 4.8665 |
| −0.7729 | 1.2288 | 4.8665 | 1.0394 | −1.3575 | 4.8665 |
| −0.7743 | 1.2489 | 4.8665 | 1.0544 | −1.3730 | 4.8665 |
| −0.7736 | 1.2641 | 4.8665 | 1.0663 | −1.3852 | 4.8665 |
| −0.7717 | 1.2722 | 4.8665 | 1.0756 | −1.3946 | 4.8665 |
| −0.7691 | 1.2770 | 4.8665 | 1.0816 | −1.4023 | 4.8665 |
| −0.7672 | 1.2789 | 4.8665 | 1.0831 | −1.4105 | 4.8665 |
| −0.7660 | 1.2797 | 4.8665 | 1.0815 | −1.4169 | 4.8665 |

TABLE 10

| SUCTION SIDE | | | PRESSURE SIDE | | |
|---|---|---|---|---|---|
| X | Y | Z | X | Y | Z |
| 1.415113 | −1.33821 | −0.19083 | −1.01312 | 1.462653 | −0.19083 |
| 1.411274 | −1.34262 | −0.19083 | −1.01244 | 1.462992 | −0.19083 |
| 1.405515 | −1.34781 | −0.19083 | −1.01097 | 1.46333 | −0.19083 |
| 1.397385 | −1.35312 | −0.19083 | −1.00792 | 1.464008 | −0.19083 |
| 1.386658 | −1.35775 | −0.19083 | −1.00183 | 1.464459 | −0.19083 |
| 1.371413 | −1.36057 | −0.19083 | −0.99245 | 1.463104 | −0.19083 |
| 1.351314 | −1.3582 | −0.19083 | −0.97665 | 1.456668 | −0.19083 |
| 1.328955 | −1.34646 | −0.19083 | −0.95813 | 1.443682 | −0.19083 |
| 1.303774 | −1.3285 | −0.19083 | −0.93667 | 1.422792 | −0.19083 |
| 1.273851 | −1.30705 | −0.19083 | −0.91307 | 1.393433 | −0.19083 |
| 1.238732 | −1.28209 | −0.19083 | −0.88597 | 1.352782 | −0.19083 |
| 1.197404 | −1.2524 | −0.19083 | −0.85684 | 1.304452 | −0.19083 |
| 1.149639 | −1.21818 | −0.19083 | −0.8259 | 1.252847 | −0.19083 |
| 1.09555 | −1.17934 | −0.19083 | −0.79055 | 1.195032 | −0.19083 |
| 1.035251 | −1.13575 | −0.19083 | −0.75069 | 1.131345 | −0.19083 |
| 0.968628 | −1.08753 | −0.19083 | −0.70598 | 1.0619 | −0.19083 |
| 0.895794 | −1.03457 | −0.19083 | −0.65798 | 0.98997 | −0.19083 |
| 0.819912 | −0.97902 | −0.19083 | −0.60695 | 0.915668 | −0.19083 |
| 0.741094 | −0.92098 | −0.19083 | −0.55263 | 0.838996 | −0.19083 |
| 0.65934 | −0.86034 | −0.19083 | −0.49482 | 0.760177 | −0.19083 |
| 0.574763 | −0.79688 | −0.19083 | −0.4335 | 0.679327 | −0.19083 |
| 0.487476 | −0.73071 | −0.19083 | −0.36868 | 0.596556 | −0.19083 |
| 0.397365 | −0.66149 | −0.19083 | −0.30003 | 0.511979 | −0.19083 |
| 0.304884 | −0.5891 | −0.19083 | −0.22787 | 0.425595 | −0.19083 |
| 0.21308 | −0.51593 | −0.19083 | −0.15447 | 0.340341 | −0.19083 |
| 0.122067 | −0.44152 | −0.19083 | −0.07995 | 0.25599 | −0.19083 |
| 0.032182 | −0.36575 | −0.19083 | −0.00474 | 0.172316 | −0.19083 |
| −0.05635 | −0.28862 | −0.19083 | 0.07114 | 0.089094 | −0.19083 |
| −0.14284 | −0.20981 | −0.19083 | 0.147474 | 0.006436 | −0.19083 |
| −0.22697 | −0.12907 | −0.19083 | 0.224372 | −0.07577 | −0.19083 |
| −0.3085 | −0.04585 | −0.19083 | 0.301835 | −0.15764 | −0.19083 |
| −0.38698 | 0.039861 | −0.19083 | 0.37975 | −0.23894 | −0.19083 |
| −0.46229 | 0.128277 | −0.19083 | 0.458116 | −0.3199 | −0.19083 |
| −0.53445 | 0.219404 | −0.19083 | 0.536935 | −0.40041 | −0.19083 |
| −0.60322 | 0.313466 | −0.19083 | 0.616092 | −0.48047 | −0.19083 |
| −0.66645 | 0.40719 | −0.19083 | 0.692877 | −0.5576 | −0.19083 |
| −0.72416 | 0.500574 | −0.19083 | 0.767404 | −0.63179 | −0.19083 |

TABLE 10-continued

| SUCTION SIDE | | | PRESSURE SIDE | | |
|---|---|---|---|---|---|
| X | Y | Z | X | Y | Z |
| −0.77678 | 0.593169 | −0.19083 | 0.83956 | −0.70304 | −0.19083 |
| −0.82409 | 0.684182 | −0.19083 | 0.909119 | −0.77158 | −0.19083 |
| −0.86621 | 0.773276 | −0.19083 | 0.976306 | −0.83719 | −0.19083 |
| −0.90381 | 0.860225 | −0.19083 | 1.040897 | −0.89997 | −0.19083 |
| −0.93701 | 0.944802 | −0.19083 | 1.103003 | −0.96005 | −0.19083 |
| −0.96569 | 1.026782 | −0.19083 | 1.159688 | −1.0147 | −0.19083 |
| −0.98963 | 1.101986 | −0.19083 | 1.21118 | −1.06416 | −0.19083 |
| −1.00917 | 1.170303 | −0.19083 | 1.257251 | −1.10831 | −0.19083 |
| −1.02486 | 1.231506 | −0.19083 | 1.297902 | −1.14727 | −0.19083 |
| −1.03785 | 1.289321 | −0.19083 | 1.333246 | −1.18103 | −0.19083 |
| −1.04564 | 1.340022 | −0.19083 | 1.363057 | −1.2096 | −0.19083 |
| −1.04756 | 1.379318 | −0.19083 | 1.388577 | −1.23399 | −0.19083 |
| −1.04462 | 1.410822 | −0.19083 | 1.410032 | −1.25443 | −0.19083 |
| −1.03841 | 1.433745 | −0.19083 | 1.423808 | −1.27419 | −0.19083 |
| −1.03006 | 1.449441 | −0.19083 | 1.428777 | −1.29282 | −0.19083 |
| −1.02339 | 1.456668 | −0.19083 | 1.428438 | −1.30773 | −0.19083 |
| −1.0182 | 1.460394 | −0.19083 | 1.425841 | −1.31868 | −0.19083 |
| −1.01538 | 1.461862 | −0.19083 | 1.42234 | −1.32726 | −0.19083 |
| −1.01391 | 1.462427 | −0.19083 | 1.418501 | −1.3337 | −0.19083 |
| 1.42776 | −1.3381 | 0 | −1.00499 | 1.466379 | 0 |
| 1.423808 | −1.34239 | 0 | −1.0042 | 1.466718 | 0 |
| 1.417936 | −1.34736 | 0 | −1.00273 | 1.46717 | 0 |
| 1.409806 | −1.35256 | 0 | −0.99979 | 1.467847 | 0 |
| 1.399079 | −1.35696 | 0 | −0.99381 | 1.468412 | 0 |
| 1.383835 | −1.35956 | 0 | −0.98432 | 1.467395 | 0 |
| 1.363848 | −1.35696 | 0 | −0.9684 | 1.461298 | 0 |
| 1.341715 | −1.34499 | 0 | −0.94943 | 1.448877 | 0 |
| 1.31676 | −1.32692 | 0 | −0.92741 | 1.428438 | 0 |
| 1.287062 | −1.30524 | 0 | −0.90313 | 1.399756 | 0 |
| 1.252396 | −1.27995 | 0 | −0.8749 | 1.359896 | 0 |
| 1.211406 | −1.24991 | 0 | −0.84442 | 1.312356 | 0 |
| 1.164205 | −1.21525 | 0 | −0.81201 | 1.261655 | 0 |
| 1.110794 | −1.17584 | 0 | −0.7752 | 1.204856 | 0 |
| 1.051172 | −1.13168 | 0 | −0.73375 | 1.142073 | 0 |
| 0.985453 | −1.08268 | 0 | −0.68734 | 1.073643 | 0 |
| 0.913636 | −1.02893 | 0 | −0.63777 | 1.002843 | 0 |
| 0.83877 | −0.97247 | 0 | −0.58515 | 0.929557 | 0 |
| 0.760968 | −0.91352 | 0 | −0.52926 | 0.854014 | 0 |
| 0.680456 | −0.85187 | 0 | −0.47009 | 0.776212 | 0 |
| 0.597008 | −0.78739 | 0 | −0.40742 | 0.696265 | 0 |
| 0.51085 | −0.7202 | 0 | −0.34136 | 0.614398 | 0 |
| 0.422095 | −0.64997 | 0 | −0.27191 | 0.530498 | 0 |
| 0.330743 | −0.57668 | 0 | −0.19897 | 0.444566 | 0 |
| 0.240181 | −0.50249 | 0 | −0.12512 | 0.359424 | 0 |
| 0.150409 | −0.42729 | 0 | −0.05059 | 0.27496 | 0 |
| 0.061654 | −0.35073 | 0 | 0.024504 | 0.190948 | 0 |
| −0.02575 | −0.27281 | 0 | 0.099821 | 0.107161 | 0 |
| −0.11134 | −0.19343 | 0 | 0.175704 | 0.023826 | 0 |
| −0.1949 | −0.11224 | 0 | 0.251925 | −0.05928 | 0 |
| −0.27586 | −0.02891 | 0 | 0.328484 | −0.14194 | 0 |
| −0.35423 | 0.056686 | 0 | 0.405496 | −0.22426 | 0 |
| −0.42966 | 0.144763 | 0 | 0.482846 | −0.30624 | 0 |
| −0.50216 | 0.235325 | 0 | 0.560648 | −0.38788 | 0 |
| −0.57138 | 0.32871 | 0 | 0.638676 | −0.46918 | 0 |
| −0.63529 | 0.42153 | 0 | 0.714445 | −0.54755 | 0 |
| −0.69378 | 0.513786 | 0 | 0.787843 | −0.62287 | 0 |
| −0.74742 | 0.605251 | 0 | 0.858982 | −0.69525 | 0 |
| −0.79586 | 0.695248 | 0 | 0.927525 | −0.76481 | 0 |
| −0.83956 | 0.783213 | 0 | 0.993809 | −0.83143 | 0 |
| −0.87863 | 0.869145 | 0 | 1.057496 | −0.89523 | 0 |
| −0.91364 | 0.952593 | 0 | 1.118811 | −0.95621 | 0 |
| −0.94424 | 1.033557 | 0 | 1.174933 | −1.01176 | 0 |
| −0.9701 | 1.107858 | 0 | 1.225747 | −1.06179 | 0 |
| −0.99144 | 1.175384 | 0 | 1.271366 | −1.10662 | 0 |
| −1.00894 | 1.235796 | 0 | 1.311566 | −1.14603 | 0 |
| −1.02362 | 1.292934 | 0 | 1.346571 | −1.18013 | 0 |
| −1.03311 | 1.343183 | 0 | 1.376156 | −1.20903 | 0 |
| −1.03627 | 1.382254 | 0 | 1.40145 | −1.23376 | 0 |
| −1.03457 | 1.413758 | 0 | 1.422679 | −1.25443 | 0 |
| −1.02915 | 1.436681 | 0 | 1.436681 | −1.27408 | 0 |
| −1.02136 | 1.452603 | 0 | 1.441763 | −1.29282 | 0 |
| −1.01492 | 1.460169 | 0 | 1.441424 | −1.30773 | 0 |
| −1.00996 | 1.463895 | 0 | 1.438827 | −1.31868 | 0 |
| −1.00713 | 1.465476 | 0 | 1.4351 | −1.32715 | 0 |
| −1.00567 | 1.466153 | 0 | 1.431261 | −1.33359 | 0 |
| 1.435552 | −1.33833 | 0.123083 | −0.99968 | 1.469089 | 0.123083 |

TABLE 10-continued

| SUCTION SIDE | | | PRESSURE SIDE | | |
|---|---|---|---|---|---|
| X | Y | Z | X | Y | Z |
| 1.431487 | −1.34251 | 0.123083 | −0.99889 | 1.469428 | 0.123083 |
| 1.425615 | −1.34747 | 0.123083 | −0.99754 | 1.46988 | 0.123083 |
| 1.417372 | −1.35267 | 0.123083 | −0.9946 | 1.47067 | 0.123083 |
| 1.406644 | −1.35685 | 0.123083 | −0.9885 | 1.471235 | 0.123083 |
| 1.391287 | −1.35922 | 0.123083 | −0.97902 | 1.470218 | 0.123083 |
| 1.371526 | −1.3564 | 0.123083 | −0.96309 | 1.464347 | 0.123083 |
| 1.349507 | −1.3442 | 0.123083 | −0.94401 | 1.451925 | 0.123083 |
| 1.324777 | −1.32579 | 0.123083 | −0.92177 | 1.431826 | 0.123083 |
| 1.295418 | −1.304 | 0.123083 | −0.89704 | 1.403483 | 0.123083 |
| 1.260978 | −1.27837 | 0.123083 | −0.86813 | 1.364074 | 0.123083 |
| 1.220326 | −1.2481 | 0.123083 | −0.83662 | 1.317212 | 0.123083 |
| 1.173578 | −1.2131 | 0.123083 | −0.80331 | 1.267075 | 0.123083 |
| 1.120618 | −1.17324 | 0.123083 | −0.76548 | 1.210954 | 0.123083 |
| 1.061448 | −1.12875 | 0.123083 | −0.7228 | 1.148961 | 0.123083 |
| 0.99618 | −1.07929 | 0.123083 | −0.67515 | 1.081322 | 0.123083 |
| 0.924928 | −1.02497 | 0.123083 | −0.62445 | 1.011312 | 0.123083 |
| 0.850626 | −0.96806 | 0.123083 | −0.5707 | 0.938817 | 0.123083 |
| 0.773502 | −0.90855 | 0.123083 | −0.51367 | 0.864064 | 0.123083 |
| 0.693555 | −0.84645 | 0.123083 | −0.45349 | 0.786939 | 0.123083 |
| 0.610784 | −0.78141 | 0.123083 | −0.39014 | 0.70767 | 0.123083 |
| 0.525417 | −0.71365 | 0.123083 | −0.3234 | 0.626141 | 0.123083 |
| 0.437226 | −0.64297 | 0.123083 | −0.25339 | 0.542581 | 0.123083 |
| 0.346664 | −0.56912 | 0.123083 | −0.18022 | 0.456761 | 0.123083 |
| 0.256667 | −0.49448 | 0.123083 | −0.10637 | 0.37162 | 0.123083 |
| 0.167686 | −0.41871 | 0.123083 | −0.03196 | 0.286817 | 0.123083 |
| 0.079722 | −0.34158 | 0.123083 | 0.042797 | 0.202466 | 0.123083 |
| −0.00689 | −0.2631 | 0.123083 | 0.117888 | 0.118227 | 0.123083 |
| −0.09169 | −0.18304 | 0.123083 | 0.193206 | 0.034328 | 0.123083 |
| −0.17446 | −0.1014 | 0.123083 | 0.268863 | −0.04923 | 0.123083 |
| −0.25497 | −0.01773 | 0.123083 | 0.344971 | −0.13257 | 0.123083 |
| −0.333 | 0.067978 | 0.123083 | 0.42153 | −0.21545 | 0.123083 |
| −0.40843 | 0.156055 | 0.123083 | 0.498316 | −0.298 | 0.123083 |
| −0.48104 | 0.246504 | 0.123083 | 0.575553 | −0.38031 | 0.123083 |
| −0.55082 | 0.339325 | 0.123083 | 0.653016 | −0.46229 | 0.123083 |
| −0.6153 | 0.431693 | 0.123083 | 0.728221 | −0.54123 | 0.123083 |
| −0.6747 | 0.523271 | 0.123083 | 0.801054 | −0.61722 | 0.123083 |
| −0.72912 | 0.613946 | 0.123083 | 0.871517 | −0.69028 | 0.123083 |
| −0.7787 | 0.70304 | 0.123083 | 0.939607 | −0.7604 | 0.123083 |
| −0.8233 | 0.790214 | 0.123083 | 1.005327 | −0.8277 | 0.123083 |
| −0.8635 | 0.875356 | 0.123083 | 1.068562 | −0.89207 | 0.123083 |
| −0.89963 | 0.958013 | 0.123083 | 1.129426 | −0.9535 | 0.123083 |
| −0.93136 | 1.038186 | 0.123083 | 1.184982 | −1.0095 | 0.123083 |
| −0.95824 | 1.111923 | 0.123083 | 1.235458 | −1.06009 | 0.123083 |
| −0.98048 | 1.178998 | 0.123083 | 1.280626 | −1.10537 | 0.123083 |
| −0.99889 | 1.238958 | 0.123083 | 1.320599 | −1.14523 | 0.123083 |
| −1.01447 | 1.295757 | 0.123083 | 1.355266 | −1.17968 | 0.123083 |
| −1.02486 | 1.345668 | 0.123083 | 1.384512 | −1.20892 | 0.123083 |
| −1.02881 | 1.384512 | 0.123083 | 1.40958 | −1.23376 | 0.123083 |
| −1.0278 | 1.415904 | 0.123083 | 1.430696 | −1.25477 | 0.123083 |
| −1.02306 | 1.43894 | 0.123083 | 1.444698 | −1.27442 | 0.123083 |
| −1.01572 | 1.454974 | 0.123083 | 1.44978 | −1.29305 | 0.123083 |
| −1.0095 | 1.462653 | 0.123083 | 1.449328 | −1.30807 | 0.123083 |
| −1.00454 | 1.466605 | 0.123083 | 1.446618 | −1.31891 | 0.123083 |
| −1.00183 | 1.468073 | 0.123083 | 1.442892 | −1.32749 | 0.123083 |
| −1.00036 | 1.46875 | 0.123083 | 1.43894 | −1.33381 | 0.123083 |
| 1.441311 | −1.34262 | 0.280042 | −0.99358 | 1.471235 | 0.280042 |
| 1.437246 | −1.3468 | 0.280042 | −0.99279 | 1.471461 | 0.280042 |
| 1.431374 | −1.35165 | 0.280042 | −0.99144 | 1.472025 | 0.280042 |
| 1.423018 | −1.35662 | 0.280042 | −0.9885 | 1.472816 | 0.280042 |
| 1.412178 | −1.36069 | 0.280042 | −0.9824 | 1.473493 | 0.280042 |
| 1.396933 | −1.36272 | 0.280042 | −0.97292 | 1.47259 | 0.280042 |
| 1.377172 | −1.35933 | 0.280042 | −0.957 | 1.466718 | 0.280042 |
| 1.355605 | −1.34646 | 0.280042 | −0.9378 | 1.454635 | 0.280042 |
| 1.331214 | −1.32783 | 0.280042 | −0.91522 | 1.434762 | 0.280042 |
| 1.302193 | −1.30558 | 0.280042 | −0.88992 | 1.40687 | 0.280042 |
| 1.268205 | −1.27961 | 0.280042 | −0.86011 | 1.368026 | 0.280042 |
| 1.228118 | −1.24878 | 0.280042 | −0.82759 | 1.321954 | 0.280042 |
| 1.181821 | −1.21333 | 0.280042 | −0.79304 | 1.272495 | 0.280042 |
| 1.129426 | −1.1729 | 0.280042 | −0.75385 | 1.217278 | 0.280042 |
| 1.071046 | −1.12773 | 0.280042 | −0.70982 | 1.156188 | 0.280042 |
| 1.006456 | −1.07771 | 0.280042 | −0.66069 | 1.089565 | 0.280042 |
| 0.935881 | −1.02283 | 0.280042 | −0.60864 | 1.020458 | 0.280042 |
| 0.86237 | −0.96535 | 0.280042 | −0.55365 | 0.948867 | 0.280042 |
| 0.785923 | −0.90528 | 0.280042 | −0.49561 | 0.874791 | 0.280042 |
| 0.706766 | −0.84238 | 0.280042 | −0.4344 | 0.798457 | 0.280042 |
| 0.624899 | −0.77678 | 0.280042 | −0.37015 | 0.719639 | 0.280042 |

TABLE 10-continued

| SUCTION SIDE | | | PRESSURE SIDE | | |
|---|---|---|---|---|---|
| X | Y | Z | X | Y | Z |
| 0.540209 | −0.70835 | 0.280042 | −0.30285 | 0.638563 | 0.280042 |
| 0.452922 | −0.63698 | 0.280042 | −0.2325 | 0.555115 | 0.280042 |
| 0.363264 | −0.56245 | 0.280042 | −0.15922 | 0.469296 | 0.280042 |
| 0.274283 | −0.48702 | 0.280042 | −0.08537 | 0.383928 | 0.280042 |
| 0.186205 | −0.41058 | 0.280042 | −0.01107 | 0.298899 | 0.280042 |
| 0.099144 | −0.33278 | 0.280042 | 0.063235 | 0.213983 | 0.280042 |
| 0.013663 | −0.25351 | 0.280042 | 0.137875 | 0.12918 | 0.280042 |
| −0.07024 | −0.17288 | 0.280042 | 0.212628 | 0.044716 | 0.280042 |
| −0.1521 | −0.09056 | 0.280042 | 0.28772 | −0.03963 | 0.280042 |
| −0.23194 | −0.00644 | 0.280042 | 0.363151 | −0.12365 | 0.280042 |
| −0.30951 | 0.079609 | 0.280042 | 0.43892 | −0.20732 | 0.280042 |
| −0.38461 | 0.167799 | 0.280042 | 0.515028 | −0.29066 | 0.280042 |
| −0.45733 | 0.258135 | 0.280042 | 0.591588 | −0.37377 | 0.280042 |
| −0.52734 | 0.350842 | 0.280042 | 0.668261 | −0.45654 | 0.280042 |
| −0.59238 | 0.442646 | 0.280042 | 0.742675 | −0.53637 | 0.280042 |
| −0.65256 | 0.533547 | 0.280042 | 0.814831 | −0.61316 | 0.280042 |
| −0.7079 | 0.623431 | 0.280042 | 0.884615 | −0.68701 | 0.280042 |
| −0.75837 | 0.711509 | 0.280042 | 0.952029 | −0.75792 | 0.280042 |
| −0.80422 | 0.797667 | 0.280042 | 1.01707 | −0.8259 | 0.280042 |
| −0.84566 | 0.881792 | 0.280042 | 1.079741 | −0.89105 | 0.280042 |
| −0.88303 | 0.963546 | 0.280042 | 1.139814 | −0.95327 | 0.280042 |
| −0.91612 | 1.042929 | 0.280042 | 1.194807 | −1.01007 | 0.280042 |
| −0.94412 | 1.115988 | 0.280042 | 1.244604 | −1.06145 | 0.280042 |
| −0.96761 | 1.182272 | 0.280042 | 1.289095 | −1.10729 | 0.280042 |
| −0.98703 | 1.241781 | 0.280042 | 1.328504 | −1.14783 | 0.280042 |
| −1.00375 | 1.297902 | 0.280042 | 1.362606 | −1.18284 | 0.280042 |
| −1.01515 | 1.347474 | 0.280042 | 1.391513 | −1.21253 | 0.280042 |
| −1.02012 | 1.386093 | 0.280042 | 1.41613 | −1.23783 | 0.280042 |
| −1.02001 | 1.417372 | 0.280042 | 1.436907 | −1.25917 | 0.280042 |
| −1.01594 | 1.44052 | 0.280042 | 1.451022 | −1.27882 | 0.280042 |
| −1.00917 | 1.456781 | 0.280042 | 1.45599 | −1.29756 | 0.280042 |
| −1.00318 | 1.464572 | 0.280042 | 1.455539 | −1.31247 | 0.280042 |
| −0.99844 | 1.468525 | 0.280042 | 1.452716 | −1.32342 | 0.280042 |
| −0.99573 | 1.470218 | 0.280042 | 1.448877 | −1.33189 | 0.280042 |
| −0.99426 | 1.470896 | 0.280042 | 1.444924 | −1.33821 | 0.280042 |
| 1.440746 | −1.34804 | 0.35231 | −0.99121 | 1.471122 | 0.35231 |
| 1.436681 | −1.3521 | 0.35231 | −0.99053 | 1.471461 | 0.35231 |
| 1.430583 | −1.35696 | 0.35231 | −0.98907 | 1.471912 | 0.35231 |
| 1.422227 | −1.36182 | 0.35231 | −0.98613 | 1.472816 | 0.35231 |
| 1.411387 | −1.36577 | 0.35231 | −0.98015 | 1.473493 | 0.35231 |
| 1.39603 | −1.36746 | 0.35231 | −0.97066 | 1.47259 | 0.35231 |
| 1.376382 | −1.36373 | 0.35231 | −0.95463 | 1.466831 | 0.35231 |
| 1.35504 | −1.35041 | 0.35231 | −0.93532 | 1.454748 | 0.35231 |
| 1.330875 | −1.33155 | 0.35231 | −0.91273 | 1.4351 | 0.35231 |
| 1.301968 | −1.30908 | 0.35231 | −0.88721 | 1.407322 | 0.35231 |
| 1.268205 | −1.28277 | 0.35231 | −0.85695 | 1.368816 | 0.35231 |
| 1.228344 | −1.25161 | 0.35231 | −0.82398 | 1.322971 | 0.35231 |
| 1.182385 | −1.21581 | 0.35231 | −0.78897 | 1.273963 | 0.35231 |
| 1.130329 | −1.17505 | 0.35231 | −0.74922 | 1.219084 | 0.35231 |
| 1.072062 | −1.12954 | 0.35231 | −0.70462 | 1.158333 | 0.35231 |
| 1.007811 | −1.07906 | 0.35231 | −0.65494 | 1.092049 | 0.35231 |
| 0.937575 | −1.02385 | 0.35231 | −0.60243 | 1.023281 | 0.35231 |
| 0.86429 | −0.96592 | 0.35231 | −0.54687 | 0.951916 | 0.35231 |
| 0.788295 | −0.90539 | 0.35231 | −0.48849 | 0.878179 | 0.35231 |
| 0.709363 | −0.84216 | 0.35231 | −0.42695 | 0.801958 | 0.35231 |
| 0.627722 | −0.77621 | 0.35231 | −0.36259 | 0.723366 | 0.35231 |
| 0.543484 | −0.70733 | 0.35231 | −0.29517 | 0.642289 | 0.35231 |
| 0.456536 | −0.63551 | 0.35231 | −0.22471 | 0.558841 | 0.35231 |
| 0.367216 | −0.56042 | 0.35231 | −0.15143 | 0.472909 | 0.35231 |
| 0.278574 | −0.48454 | 0.35231 | −0.07769 | 0.387429 | 0.35231 |
| 0.190835 | −0.40764 | 0.35231 | −0.00361 | 0.302174 | 0.35231 |
| 0.104225 | −0.32939 | 0.35231 | 0.070575 | 0.217032 | 0.35231 |
| 0.019196 | −0.24989 | 0.35231 | 0.144876 | 0.132003 | 0.35231 |
| −0.06425 | −0.16904 | 0.35231 | 0.219404 | 0.047088 | 0.35231 |
| −0.14567 | −0.08661 | 0.35231 | 0.29427 | −0.03749 | 0.35231 |
| −0.22494 | −0.00248 | 0.35231 | 0.369361 | −0.12184 | 0.35231 |
| −0.30184 | 0.083561 | 0.35231 | 0.444792 | −0.20585 | 0.35231 |
| −0.37648 | 0.171525 | 0.35231 | 0.520561 | −0.28964 | 0.35231 |
| −0.44852 | 0.26141 | 0.35231 | 0.596669 | −0.37309 | 0.35231 |
| −0.51808 | 0.35344 | 0.35231 | 0.673003 | −0.45631 | 0.35231 |
| −0.58267 | 0.444453 | 0.35231 | 0.747079 | −0.5366 | 0.35231 |
| −0.64251 | 0.534337 | 0.35231 | 0.818783 | −0.61383 | 0.35231 |
| −0.69773 | 0.623093 | 0.35231 | 0.888229 | −0.68813 | 0.35231 |
| −0.74855 | 0.710493 | 0.35231 | 0.955303 | −0.75939 | 0.35231 |
| −0.79484 | 0.796425 | 0.35231 | 1.019893 | −0.82782 | 0.35231 |
| −0.83708 | 0.88055 | 0.35231 | 1.082112 | −0.89331 | 0.35231 |

TABLE 10-continued

| SUCTION SIDE | | | PRESSURE SIDE | | |
|---|---|---|---|---|---|
| X | Y | Z | X | Y | Z |
| −0.87524 | 0.962304 | 0.35231 | 1.141847 | −0.95609 | 0.35231 |
| −0.90912 | 1.0418 | 0.35231 | 1.196387 | −1.01323 | 0.35231 |
| −0.93791 | 1.114746 | 0.35231 | 1.245846 | −1.06506 | 0.35231 |
| −0.96197 | 1.181143 | 0.35231 | 1.289998 | −1.11136 | 0.35231 |
| −0.98207 | 1.240765 | 0.35231 | 1.328955 | −1.15212 | 0.35231 |
| −0.99934 | 1.296999 | 0.35231 | 1.362831 | −1.18758 | 0.35231 |
| −1.01131 | 1.346571 | 0.35231 | 1.3914 | −1.2175 | 0.35231 |
| −1.01662 | 1.385415 | 0.35231 | 1.415904 | −1.24314 | 0.35231 |
| −1.01696 | 1.416694 | 0.35231 | 1.436342 | −1.26459 | 0.35231 |
| −1.01323 | 1.439956 | 0.35231 | 1.45057 | −1.28435 | 0.35231 |
| −1.00668 | 1.456329 | 0.35231 | 1.455539 | −1.30298 | 0.35231 |
| −1.00092 | 1.464234 | 0.35231 | 1.454974 | −1.318 | 0.35231 |
| −0.99607 | 1.468412 | 0.35231 | 1.452151 | −1.32884 | 0.35231 |
| −0.99336 | 1.470105 | 0.35231 | 1.448312 | −1.33731 | 0.35231 |
| −0.992 | 1.470783 | 0.35231 | 1.444247 | −1.34364 | 0.35231 |
| 1.436568 | −1.35775 | 0.43813 | −0.98895 | 1.470105 | 0.43813 |
| 1.43239 | −1.36182 | 0.43813 | −0.98816 | 1.470444 | 0.43813 |
| 1.426405 | −1.36656 | 0.43813 | −0.98681 | 1.470896 | 0.43813 |
| 1.417936 | −1.3713 | 0.43813 | −0.98387 | 1.471799 | 0.43813 |
| 1.406983 | −1.37503 | 0.43813 | −0.97777 | 1.47259 | 0.43813 |
| 1.391626 | −1.37638 | 0.43813 | −0.9684 | 1.471686 | 0.43813 |
| 1.372091 | −1.37209 | 0.43813 | −0.95225 | 1.465927 | 0.43813 |
| 1.351088 | −1.3582 | 0.43813 | −0.93295 | 1.453958 | 0.43813 |
| 1.327149 | −1.33901 | 0.43813 | −0.91014 | 1.434423 | 0.43813 |
| 1.29858 | −1.3162 | 0.43813 | −0.88439 | 1.406983 | 0.43813 |
| 1.265156 | −1.28966 | 0.43813 | −0.85379 | 1.368703 | 0.43813 |
| 1.225634 | −1.25815 | 0.43813 | −0.82025 | 1.323197 | 0.43813 |
| 1.180014 | −1.22179 | 0.43813 | −0.78468 | 1.274528 | 0.43813 |
| 1.12841 | −1.18069 | 0.43813 | −0.74437 | 1.220101 | 0.43813 |
| 1.070595 | −1.13462 | 0.43813 | −0.69909 | 1.159801 | 0.43813 |
| 1.006795 | −1.08381 | 0.43813 | −0.64895 | 1.093856 | 0.43813 |
| 0.93701 | −1.02791 | 0.43813 | −0.59588 | 1.025427 | 0.43813 |
| 0.86429 | −0.96953 | 0.43813 | −0.53998 | 0.9544 | 0.43813 |
| 0.788633 | −0.90855 | 0.43813 | −0.48127 | 0.880776 | 0.43813 |
| 0.710267 | −0.84487 | 0.43813 | −0.41961 | 0.804668 | 0.43813 |
| 0.62919 | −0.77836 | 0.43813 | −0.35502 | 0.726076 | 0.43813 |
| 0.545404 | −0.70891 | 0.43813 | −0.28761 | 0.644999 | 0.43813 |
| 0.45902 | −0.63653 | 0.43813 | −0.21737 | 0.561325 | 0.43813 |
| 0.370265 | −0.56099 | 0.43813 | −0.1442 | 0.47528 | 0.43813 |
| 0.282187 | −0.48454 | 0.43813 | −0.07069 | 0.389461 | 0.43813 |
| 0.195013 | −0.40708 | 0.43813 | 0.003162 | 0.303981 | 0.43813 |
| 0.108968 | −0.32848 | 0.43813 | 0.077124 | 0.2185 | 0.43813 |
| 0.024391 | −0.24865 | 0.43813 | 0.151087 | 0.133133 | 0.43813 |
| −0.05849 | −0.16757 | 0.43813 | 0.225275 | 0.047991 | 0.43813 |
| −0.13946 | −0.0848 | 0.43813 | 0.29969 | −0.03715 | 0.43813 |
| −0.21827 | −0.00045 | 0.43813 | 0.37433 | −0.12195 | 0.43813 |
| −0.29472 | 0.085706 | 0.43813 | 0.449309 | −0.20642 | 0.43813 |
| −0.36891 | 0.173897 | 0.43813 | 0.524513 | −0.29077 | 0.43813 |
| −0.44061 | 0.263894 | 0.43813 | 0.600057 | −0.37478 | 0.43813 |
| −0.50995 | 0.355811 | 0.43813 | 0.675826 | −0.45857 | 0.43813 |
| −0.57431 | 0.446824 | 0.43813 | 0.749337 | −0.53931 | 0.43813 |
| −0.63416 | 0.536483 | 0.43813 | 0.82059 | −0.61711 | 0.43813 |
| −0.68938 | 0.624899 | 0.43813 | 0.889471 | −0.69197 | 0.43813 |
| −0.7403 | 0.711848 | 0.43813 | 0.955981 | −0.76379 | 0.43813 |
| −0.78705 | 0.797328 | 0.43813 | 1.020119 | −0.83279 | 0.43813 |
| −0.82962 | 0.881115 | 0.43813 | 1.081774 | −0.89884 | 0.43813 |
| −0.86824 | 0.96253 | 0.43813 | 1.140944 | −0.96219 | 0.43813 |
| −0.9028 | 1.041687 | 0.43813 | 1.194919 | −1.02001 | 0.43813 |
| −0.93204 | 1.114407 | 0.43813 | 1.243701 | −1.07229 | 0.43813 |
| −0.95677 | 1.180579 | 0.43813 | 1.287401 | −1.11915 | 0.43813 |
| −0.97732 | 1.239862 | 0.43813 | 1.325907 | −1.16048 | 0.43813 |
| −0.99505 | 1.29587 | 0.43813 | 1.359331 | −1.19627 | 0.43813 |
| −1.00747 | 1.345329 | 0.43813 | 1.387561 | −1.22665 | 0.43813 |
| −1.01323 | 1.38406 | 0.43813 | 1.411726 | −1.25251 | 0.43813 |
| −1.01391 | 1.415452 | 0.43813 | 1.431939 | −1.2743 | 0.43813 |
| −1.01041 | 1.438714 | 0.43813 | 1.446279 | −1.29384 | 0.43813 |
| −1.0042 | 1.4552 | 0.43813 | 1.451474 | −1.31258 | 0.43813 |
| −0.99844 | 1.463217 | 0.43813 | 1.451022 | −1.3276 | 0.43813 |
| −0.9937 | 1.467282 | 0.43813 | 1.448199 | −1.33855 | 0.43813 |
| −0.9911 | 1.468976 | 0.43813 | 1.444247 | −1.34702 | 0.43813 |
| −0.98963 | 1.469767 | 0.43813 | 1.440182 | −1.35335 | 0.43813 |
| 1.398966 | −1.41274 | 0.752047 | −0.98003 | 1.465024 | 0.752047 |
| 1.394675 | −1.41669 | 0.752047 | −0.97936 | 1.465363 | 0.752047 |
| 1.388464 | −1.4211 | 0.752047 | −0.97789 | 1.465927 | 0.752047 |
| 1.379769 | −1.42528 | 0.752047 | −0.97495 | 1.466831 | 0.752047 |
| 1.36859 | −1.42821 | 0.752047 | −0.96897 | 1.467621 | 0.752047 |

TABLE 10-continued

| SUCTION SIDE | | | PRESSURE SIDE | | |
|---|---|---|---|---|---|
| X | Y | Z | X | Y | Z |
| 1.353233 | −1.4281 | 0.752047 | −0.95948 | 1.466718 | 0.752047 |
| 1.334489 | −1.42132 | 0.752047 | −0.94333 | 1.460959 | 0.752047 |
| 1.31484 | −1.40552 | 0.752047 | −0.92402 | 1.449102 | 0.752047 |
| 1.291692 | −1.38553 | 0.752047 | −0.90099 | 1.429793 | 0.752047 |
| 1.264139 | −1.36182 | 0.752047 | −0.87468 | 1.402579 | 0.752047 |
| 1.231844 | −1.33404 | 0.752047 | −0.8434 | 1.364864 | 0.752047 |
| 1.193677 | −1.30118 | 0.752047 | −0.80885 | 1.319922 | 0.752047 |
| 1.149639 | −1.26335 | 0.752047 | −0.77237 | 1.271931 | 0.752047 |
| 1.099728 | −1.22055 | 0.752047 | −0.73093 | 1.217955 | 0.752047 |
| 1.043832 | −1.17267 | 0.752047 | −0.68486 | 1.15822 | 0.752047 |
| 0.982065 | −1.11983 | 0.752047 | −0.63393 | 1.092727 | 0.752047 |
| 0.914426 | −1.0619 | 0.752047 | −0.58052 | 1.024297 | 0.752047 |
| 0.843851 | −1.00137 | 0.752047 | −0.5244 | 0.953158 | 0.752047 |
| 0.770566 | −0.93825 | 0.752047 | −0.46568 | 0.879308 | 0.752047 |
| 0.694458 | −0.87231 | 0.752047 | −0.40425 | 0.802861 | 0.752047 |
| 0.615753 | −0.80354 | 0.752047 | −0.34023 | 0.723591 | 0.752047 |
| 0.53445 | −0.73195 | 0.752047 | −0.27361 | 0.641611 | 0.752047 |
| 0.450551 | −0.65719 | 0.752047 | −0.20427 | 0.556921 | 0.752047 |
| 0.364393 | −0.57939 | 0.752047 | −0.13223 | 0.469634 | 0.752047 |
| 0.278799 | −0.5008 | 0.752047 | −0.05973 | 0.382686 | 0.752047 |
| 0.193997 | −0.42142 | 0.752047 | 0.012873 | 0.29585 | 0.752047 |
| 0.110323 | −0.34124 | 0.752047 | 0.08548 | 0.209015 | 0.752047 |
| 0.027891 | −0.25994 | 0.752047 | 0.157975 | 0.122067 | 0.752047 |
| −0.05307 | −0.1774 | 0.752047 | 0.23047 | 0.035118 | 0.752047 |
| −0.13223 | −0.09338 | 0.752047 | 0.302964 | −0.05183 | 0.752047 |
| −0.20935 | −0.00779 | 0.752047 | 0.375459 | −0.13867 | 0.752047 |
| −0.28422 | 0.079722 | 0.752047 | 0.448179 | −0.2255 | 0.752047 |
| −0.35671 | 0.169154 | 0.752047 | 0.521013 | −0.31211 | 0.752047 |
| −0.42695 | 0.260394 | 0.752047 | 0.594072 | −0.39861 | 0.752047 |
| −0.49493 | 0.353553 | 0.752047 | 0.667244 | −0.48488 | 0.752047 |
| −0.55828 | 0.445469 | 0.752047 | 0.738271 | −0.56821 | 0.752047 |
| −0.61722 | 0.536031 | 0.752047 | 0.806926 | −0.64839 | 0.752047 |
| −0.6721 | 0.625012 | 0.752047 | 0.873323 | −0.72574 | 0.752047 |
| −0.72291 | 0.712412 | 0.752047 | 0.937349 | −0.80004 | 0.752047 |
| −0.76966 | 0.797893 | 0.752047 | 0.999003 | −0.8714 | 0.752047 |
| −0.81246 | 0.881002 | 0.752047 | 1.058286 | −0.93995 | 0.752047 |
| −0.85142 | 0.96174 | 0.752047 | 1.114972 | −1.00567 | 0.752047 |
| −0.88653 | 1.039993 | 0.752047 | 1.166689 | −1.06563 | 0.752047 |
| −0.91646 | 1.111923 | 0.752047 | 1.213438 | −1.12005 | 0.752047 |
| −0.94187 | 1.177417 | 0.752047 | 1.255219 | −1.16872 | 0.752047 |
| −0.96321 | 1.236022 | 0.752047 | 1.292031 | −1.21163 | 0.752047 |
| −0.98161 | 1.291466 | 0.752047 | 1.323987 | −1.2489 | 0.752047 |
| −0.99471 | 1.340473 | 0.752047 | 1.350862 | −1.28051 | 0.752047 |
| −1.00126 | 1.378753 | 0.752047 | 1.373898 | −1.3075 | 0.752047 |
| −1.00273 | 1.409919 | 0.752047 | 1.39332 | −1.33008 | 0.752047 |
| −1.00025 | 1.433181 | 0.752047 | 1.408112 | −1.34939 | 0.752047 |
| −0.9946 | 1.44978 | 0.752047 | 1.413871 | −1.36791 | 0.752047 |
| −0.98929 | 1.45791 | 0.752047 | 1.413758 | −1.38293 | 0.752047 |
| −0.98466 | 1.462201 | 0.752047 | 1.410935 | −1.39388 | 0.752047 |
| −0.98218 | 1.463895 | 0.752047 | 1.406983 | −1.40224 | 0.752047 |
| −0.98071 | 1.464685 | 0.752047 | 1.402692 | −1.40845 | 0.752047 |
| 1.348491 | −1.4832 | 1.067094 | −0.96806 | 1.456216 | 1.067094 |
| 1.344087 | −1.48682 | 1.067094 | −0.96727 | 1.456555 | 1.067094 |
| 1.337424 | −1.49077 | 1.067094 | −0.96592 | 1.45712 | 1.067094 |
| 1.328391 | −1.49382 | 1.067094 | −0.96298 | 1.45791 | 1.067094 |
| 1.316873 | −1.49461 | 1.067094 | −0.95688 | 1.458588 | 1.067094 |
| 1.302081 | −1.49088 | 1.067094 | −0.9474 | 1.457458 | 1.067094 |
| 1.286046 | −1.4788 | 1.067094 | −0.93148 | 1.451135 | 1.067094 |
| 1.267527 | −1.46198 | 1.067094 | −0.91239 | 1.438714 | 1.067094 |
| 1.245056 | −1.44142 | 1.067094 | −0.88958 | 1.418953 | 1.067094 |
| 1.218181 | −1.41703 | 1.067094 | −0.86361 | 1.3914 | 1.067094 |
| 1.186789 | −1.38846 | 1.067094 | −0.83256 | 1.353346 | 1.067094 |
| 1.149639 | −1.3547 | 1.067094 | −0.79846 | 1.308065 | 1.067094 |
| 1.106842 | −1.31574 | 1.067094 | −0.76232 | 1.259736 | 1.067094 |
| 1.058286 | −1.27159 | 1.067094 | −0.72145 | 1.205308 | 1.067094 |
| 1.004085 | −1.22236 | 1.067094 | −0.67594 | 1.145009 | 1.067094 |
| 0.944011 | −1.16782 | 1.067094 | −0.6258 | 1.078725 | 1.067094 |
| 0.878292 | −1.1082 | 1.067094 | −0.57318 | 1.009618 | 1.067094 |
| 0.809862 | −1.04587 | 1.067094 | −0.51808 | 0.937688 | 1.067094 |
| 0.73861 | −0.98082 | 1.067094 | −0.46049 | 0.862935 | 1.067094 |
| 0.664647 | −0.91296 | 1.067094 | −0.40019 | 0.785472 | 1.067094 |
| 0.5882 | −0.84227 | 1.067094 | −0.3374 | 0.705072 | 1.067094 |
| 0.509156 | −0.76865 | 1.067094 | −0.27202 | 0.622076 | 1.067094 |
| 0.427628 | −0.69186 | 1.067094 | −0.20393 | 0.536257 | 1.067094 |
| 0.343841 | −0.61214 | 1.067094 | −0.13313 | 0.447728 | 1.067094 |
| 0.260619 | −0.53185 | 1.067094 | −0.06211 | 0.359537 | 1.067094 |

TABLE 10-continued

| SUCTION SIDE | | | PRESSURE SIDE | | |
|---|---|---|---|---|---|
| X | Y | Z | X | Y | Z |
| 0.178188 | −0.45089 | 1.067094 | 0.009147 | 0.27146 | 1.067094 |
| 0.096772 | −0.36914 | 1.067094 | 0.080286 | 0.183269 | 1.067094 |
| 0.016373 | −0.28648 | 1.067094 | 0.151087 | 0.094853 | 1.067094 |
| −0.06244 | −0.20258 | 1.067094 | 0.221549 | 0.006211 | 1.067094 |
| −0.13957 | −0.1171 | 1.067094 | 0.291898 | −0.08266 | 1.067094 |
| −0.21466 | −0.02992 | 1.067094 | 0.362022 | −0.17164 | 1.067094 |
| −0.28738 | 0.05917 | 1.067094 | 0.432032 | −0.26073 | 1.067094 |
| −0.35796 | 0.150071 | 1.067094 | 0.502042 | −0.34983 | 1.067094 |
| −0.42639 | 0.242891 | 1.067094 | 0.572053 | −0.43892 | 1.067094 |
| −0.49256 | 0.337518 | 1.067094 | 0.642063 | −0.5279 | 1.067094 |
| −0.55432 | 0.430903 | 1.067094 | 0.709928 | −0.61395 | 1.067094 |
| −0.6118 | 0.52282 | 1.067094 | 0.775535 | −0.69683 | 1.067094 |
| −0.66532 | 0.613043 | 1.067094 | 0.838883 | −0.77666 | 1.067094 |
| −0.71478 | 0.701346 | 1.067094 | 0.899972 | −0.85356 | 1.067094 |
| −0.76029 | 0.787278 | 1.067094 | 0.958691 | −0.92752 | 1.067094 |
| −0.80196 | 0.870952 | 1.067094 | 1.015038 | −0.99855 | 1.067094 |
| −0.84001 | 0.952029 | 1.067094 | 1.069014 | −1.06653 | 1.067094 |
| −0.87423 | 1.030508 | 1.067094 | 1.118247 | −1.12875 | 1.067094 |
| −0.9037 | 1.102664 | 1.067094 | 1.162737 | −1.18498 | 1.067094 |
| −0.92854 | 1.168157 | 1.067094 | 1.202598 | −1.23534 | 1.067094 |
| −0.94943 | 1.226876 | 1.067094 | 1.237603 | −1.27984 | 1.067094 |
| −0.96761 | 1.282432 | 1.067094 | 1.268092 | −1.31845 | 1.067094 |
| −0.98071 | 1.331327 | 1.067094 | 1.293724 | −1.35109 | 1.067094 |
| −0.98749 | 1.369607 | 1.067094 | 1.315744 | −1.37898 | 1.067094 |
| −0.98941 | 1.40066 | 1.067094 | 1.33415 | −1.40235 | 1.067094 |
| −0.98737 | 1.423921 | 1.067094 | 1.349394 | −1.42166 | 1.067094 |
| −0.98218 | 1.440633 | 1.067094 | 1.359331 | −1.43826 | 1.067094 |
| −0.9771 | 1.448877 | 1.067094 | 1.361589 | −1.45305 | 1.067094 |
| −0.97269 | 1.45328 | 1.067094 | 1.360008 | −1.46412 | 1.067094 |
| −0.9701 | 1.455087 | 1.067094 | 1.356395 | −1.4727 | 1.067094 |
| −0.96874 | 1.455878 | 1.067094 | 1.35233 | −1.47891 | 1.067094 |
| 1.258268 | −1.6204 | 1.696058 | −0.92414 | 1.439617 | 1.696058 |
| 1.253525 | −1.62368 | 1.696058 | −0.92335 | 1.439956 | 1.696058 |
| 1.246411 | −1.62639 | 1.696058 | −0.92188 | 1.440408 | 1.696058 |
| 1.236813 | −1.62706 | 1.696058 | −0.91894 | 1.441085 | 1.696058 |
| 1.22586 | −1.62379 | 1.696058 | −0.91285 | 1.441311 | 1.696058 |
| 1.214116 | −1.61385 | 1.696058 | −0.90347 | 1.439165 | 1.696058 |
| 1.200001 | −1.59962 | 1.696058 | −0.88812 | 1.431487 | 1.696058 |
| 1.182385 | −1.5819 | 1.696058 | −0.87005 | 1.417711 | 1.696058 |
| 1.160818 | −1.56033 | 1.696058 | −0.84837 | 1.396369 | 1.696058 |
| 1.135298 | −1.5347 | 1.696058 | −0.82386 | 1.367461 | 1.696058 |
| 1.105487 | −1.50455 | 1.696058 | −0.79428 | 1.328052 | 1.696058 |
| 1.070143 | −1.46909 | 1.696058 | −0.76176 | 1.281529 | 1.696058 |
| 1.029379 | −1.4281 | 1.696058 | −0.72743 | 1.231731 | 1.696058 |
| 0.983194 | −1.38158 | 1.696058 | −0.68859 | 1.175723 | 1.696058 |
| 0.93159 | −1.32975 | 1.696058 | −0.64545 | 1.113504 | 1.696058 |
| 0.874565 | −1.27227 | 1.696058 | −0.5978 | 1.0453 | 1.696058 |
| 0.812121 | −1.20937 | 1.696058 | −0.54789 | 0.973935 | 1.696058 |
| 0.746966 | −1.14377 | 1.696058 | −0.49538 | 0.899859 | 1.696058 |
| 0.679214 | −1.07522 | 1.696058 | −0.4405 | 0.822848 | 1.696058 |
| 0.608978 | −1.00386 | 1.696058 | −0.38302 | 0.743014 | 1.696058 |
| 0.536257 | −0.92944 | 1.696058 | −0.32295 | 0.660243 | 1.696058 |
| 0.461278 | −0.85198 | 1.696058 | −0.26039 | 0.574763 | 1.696058 |
| 0.384041 | −0.77147 | 1.696058 | −0.19535 | 0.486346 | 1.696058 |
| 0.304658 | −0.6878 | 1.696058 | −0.12783 | 0.395107 | 1.696058 |
| 0.225953 | −0.60344 | 1.696058 | −0.06019 | 0.303981 | 1.696058 |
| 0.148038 | −0.51864 | 1.696058 | 0.007679 | 0.212854 | 1.696058 |
| 0.07114 | −0.43294 | 1.696058 | 0.075318 | 0.121728 | 1.696058 |
| −0.00452 | −0.34621 | 1.696058 | 0.142505 | 0.030263 | 1.696058 |
| −0.07859 | −0.25825 | 1.696058 | 0.208902 | −0.06188 | 1.696058 |
| −0.15075 | −0.16882 | 1.696058 | 0.274734 | −0.15436 | 1.696058 |
| −0.22076 | −0.07769 | 1.696058 | 0.340115 | −0.24718 | 1.696058 |
| −0.28862 | 0.015131 | 1.696058 | 0.405157 | −0.34023 | 1.696058 |
| −0.35457 | 0.109419 | 1.696058 | 0.469973 | −0.4335 | 1.696058 |
| −0.41859 | 0.205289 | 1.696058 | 0.534563 | −0.52688 | 1.696058 |
| −0.48059 | 0.302739 | 1.696058 | 0.599154 | −0.62027 | 1.696058 |
| −0.53852 | 0.398495 | 1.696058 | 0.661485 | −0.71061 | 1.696058 |
| −0.59238 | 0.49267 | 1.696058 | 0.721785 | −0.79778 | 1.696058 |
| −0.6424 | 0.584926 | 1.696058 | 0.779826 | −0.88179 | 1.696058 |
| −0.68859 | 0.675036 | 1.696058 | 0.835834 | −0.96276 | 1.696058 |
| −0.73104 | 0.762775 | 1.696058 | 0.889697 | −1.04056 | 1.696058 |
| −0.76966 | 0.848029 | 1.696058 | 0.941414 | −1.1152 | 1.696058 |
| −0.80478 | 0.930461 | 1.696058 | 0.990873 | −1.18679 | 1.696058 |
| −0.83651 | 1.010182 | 1.696058 | 1.036154 | −1.25217 | 1.696058 |
| −0.86373 | 1.083242 | 1.696058 | 1.077031 | −1.31134 | 1.696058 |
| −0.88676 | 1.149526 | 1.696058 | 1.113617 | −1.3643 | 1.696058 |

TABLE 10-continued

| SUCTION SIDE | | | PRESSURE SIDE | | |
|---|---|---|---|---|---|
| X | Y | Z | X | Y | Z |
| −0.90618 | 1.208809 | 1.696058 | 1.145912 | −1.41094 | 1.696058 |
| −0.92301 | 1.264817 | 1.696058 | 1.173916 | −1.45147 | 1.696058 |
| −0.9352 | 1.31405 | 1.696058 | 1.197517 | −1.48569 | 1.696058 |
| −0.94175 | 1.352443 | 1.696058 | 1.217842 | −1.51493 | 1.696058 |
| −0.9439 | 1.383609 | 1.696058 | 1.234893 | −1.53944 | 1.696058 |
| −0.94232 | 1.40687 | 1.696058 | 1.249008 | −1.55965 | 1.696058 |
| −0.9378 | 1.423808 | 1.696058 | 1.2603 | −1.5758 | 1.696058 |
| −0.93306 | 1.432277 | 1.696058 | 1.26764 | −1.5889 | 1.696058 |
| −0.92877 | 1.436794 | 1.696058 | 1.268769 | −1.60042 | 1.696058 |
| −0.92617 | 1.438488 | 1.696058 | 1.266285 | −1.60967 | 1.696058 |
| −0.92481 | 1.439278 | 1.696058 | 1.262333 | −1.61622 | 1.696058 |
| 1.219649 | −1.68398 | 2.009976 | −0.90144 | 1.427873 | 2.009976 |
| 1.214793 | −1.68714 | 2.009976 | −0.90065 | 1.428212 | 2.009976 |
| 1.207566 | −1.68962 | 2.009976 | −0.89929 | 1.428664 | 2.009976 |
| 1.198081 | −1.68973 | 2.009976 | −0.89625 | 1.429228 | 2.009976 |
| 1.187354 | −1.68556 | 2.009976 | −0.89004 | 1.429228 | 2.009976 |
| 1.176288 | −1.67506 | 2.009976 | −0.88078 | 1.426744 | 2.009976 |
| 1.162398 | −1.66049 | 2.009976 | −0.86576 | 1.418501 | 2.009976 |
| 1.145122 | −1.6422 | 2.009976 | −0.84803 | 1.404047 | 2.009976 |
| 1.124119 | −1.62006 | 2.009976 | −0.82691 | 1.382254 | 2.009976 |
| 1.099163 | −1.59375 | 2.009976 | −0.80286 | 1.352782 | 2.009976 |
| 1.069917 | −1.56293 | 2.009976 | −0.77395 | 1.312808 | 2.009976 |
| 1.035363 | −1.52645 | 2.009976 | −0.74222 | 1.26572 | 2.009976 |
| 0.995503 | −1.48445 | 2.009976 | −0.70846 | 1.215245 | 2.009976 |
| 0.950335 | −1.43679 | 2.009976 | −0.67052 | 1.158559 | 2.009976 |
| 0.899859 | −1.3835 | 2.009976 | −0.62829 | 1.09555 | 2.009976 |
| 0.84419 | −1.32455 | 2.009976 | −0.58165 | 1.026443 | 2.009976 |
| 0.7831 | −1.25996 | 2.009976 | −0.53287 | 0.954174 | 2.009976 |
| 0.719526 | −1.19244 | 2.009976 | −0.48172 | 0.878969 | 2.009976 |
| 0.653468 | −1.12209 | 2.009976 | −0.42808 | 0.800716 | 2.009976 |
| 0.585039 | −1.04858 | 2.009976 | −0.37207 | 0.719639 | 2.009976 |
| 0.514125 | −0.97213 | 2.009976 | −0.31358 | 0.635627 | 2.009976 |
| 0.441066 | −0.89252 | 2.009976 | −0.25271 | 0.548678 | 2.009976 |
| 0.365861 | −0.80986 | 2.009976 | −0.18937 | 0.458794 | 2.009976 |
| 0.288624 | −0.72393 | 2.009976 | −0.12353 | 0.366087 | 2.009976 |
| 0.212064 | −0.63743 | 2.009976 | −0.0577 | 0.273266 | 2.009976 |
| 0.136407 | −0.55037 | 2.009976 | 0.008243 | 0.180672 | 2.009976 |
| 0.061993 | −0.46241 | 2.009976 | 0.074188 | 0.087965 | 2.009976 |
| −0.01107 | −0.37365 | 2.009976 | 0.139682 | −0.00497 | 2.009976 |
| −0.08232 | −0.28354 | 2.009976 | 0.204272 | −0.09858 | 2.009976 |
| −0.15165 | −0.19219 | 2.009976 | 0.268185 | −0.19264 | 2.009976 |
| −0.21873 | −0.09926 | 2.009976 | 0.331646 | −0.28716 | 2.009976 |
| −0.28377 | −0.00497 | 2.009976 | 0.394542 | −0.3819 | 2.009976 |
| −0.34712 | 0.090562 | 2.009976 | 0.457213 | −0.47686 | 2.009976 |
| −0.40866 | 0.187221 | 2.009976 | 0.519771 | −0.57194 | 2.009976 |
| −0.46817 | 0.285236 | 2.009976 | 0.582103 | −0.66702 | 2.009976 |
| −0.52372 | 0.381444 | 2.009976 | 0.642289 | −0.75905 | 2.009976 |
| −0.57555 | 0.475506 | 2.009976 | 0.700443 | −0.84792 | 2.009976 |
| −0.62366 | 0.567536 | 2.009976 | 0.756564 | −0.93351 | 2.009976 |
| −0.66815 | 0.65742 | 2.009976 | 0.81054 | −1.01605 | 2.009976 |
| −0.70914 | 0.744933 | 2.009976 | 0.862596 | −1.09532 | 2.009976 |
| −0.74685 | 0.830188 | 2.009976 | 0.912507 | −1.17132 | 2.009976 |
| −0.78129 | 0.912958 | 2.009976 | 0.960385 | −1.24427 | 2.009976 |
| −0.81269 | 0.993357 | 2.009976 | 1.004085 | −1.31078 | 2.009976 |
| −0.83967 | 1.067207 | 2.009976 | 1.04372 | −1.37096 | 2.009976 |
| −0.86271 | 1.134394 | 2.009976 | 1.079064 | −1.42482 | 2.009976 |
| −0.88202 | 1.194355 | 2.009976 | 1.110342 | −1.47236 | 2.009976 |
| −0.89884 | 1.250928 | 2.009976 | 1.1317443 | −1.51358 | 2.009976 |
| −0.91115 | 1.300613 | 2.009976 | 1.160366 | −1.54836 | 2.009976 |
| −0.91793 | 1.339457 | 2.009976 | 1.180014 | −1.57817 | 2.009976 |
| −0.9203 | 1.370849 | 2.009976 | 1.196613 | −1.60313 | 2.009976 |
| −0.91917 | 1.394449 | 2.009976 | 1.210164 | −1.62368 | 2.009976 |
| −0.91499 | 1.411613 | 2.009976 | 1.221117 | −1.64005 | 2.009976 |
| −0.91047 | 1.420308 | 2.009976 | 1.228683 | −1.65315 | 2.009976 |
| −0.90618 | 1.424937 | 2.009976 | 1.230038 | −1.66433 | 2.009976 |
| −0.90359 | 1.426744 | 2.009976 | 1.227666 | −1.67347 | 2.009976 |
| −0.90212 | 1.427535 | 2.009976 | 1.223714 | −1.68002 | 2.009976 |
| 1.188031 | −1.74021 | 2.325023 | −0.88507 | 1.412516 | 2.325023 |
| 1.183176 | −1.74326 | 2.325023 | −0.88428 | 1.412855 | 2.325023 |
| 1.175836 | −1.74552 | 2.325023 | −0.88281 | 1.413307 | 2.325023 |
| 1.166351 | −1.74518 | 2.325023 | −0.87987 | 1.413871 | 2.325023 |
| 1.155962 | −1.74032 | 2.325023 | −0.87366 | 1.413758 | 2.325023 |
| 1.145235 | −1.72937 | 2.325023 | −0.8644 | 1.410935 | 2.325023 |
| 1.131684 | −1.71458 | 2.325023 | −0.84961 | 1.402241 | 2.325023 |
| 1.114633 | −1.69606 | 2.325023 | −0.83222 | 1.387448 | 2.325023 |
| 1.093969 | −1.67359 | 2.325023 | −0.81144 | 1.36509 | 2.325023 |

TABLE 10-continued

| SUCTION SIDE | | | PRESSURE SIDE | | |
|---|---|---|---|---|---|
| X | Y | Z | X | Y | Z |
| 1.069465 | −1.64694 | 2.325023 | −0.78784 | 1.335279 | 2.325023 |
| 1.040671 | −1.61555 | 2.325023 | −0.7595 | 1.294854 | 2.325023 |
| 1.006795 | −1.57862 | 2.325023 | −0.72822 | 1.247201 | 2.325023 |
| 0.967611 | −1.53582 | 2.325023 | −0.69514 | 1.196274 | 2.325023 |
| 0.923347 | −1.48738 | 2.325023 | −0.65787 | 1.138911 | 2.325023 |
| 0.873888 | −1.43318 | 2.325023 | −0.61654 | 1.075224 | 2.325023 |
| 0.819235 | −1.37322 | 2.325023 | −0.57092 | 1.005214 | 2.325023 |
| 0.7595 | −1.30739 | 2.325023 | −0.52327 | 0.932042 | 2.325023 |
| 0.697394 | −1.23873 | 2.325023 | −0.47325 | 0.855821 | 2.325023 |
| 0.632804 | −1.16692 | 2.325023 | −0.42097 | 0.776664 | 2.325023 |
| 0.565842 | −1.09216 | 2.325023 | −0.3662 | 0.694458 | 2.325023 |
| 0.496622 | −1.01413 | 2.325023 | −0.30917 | 0.609203 | 2.325023 |
| 0.425257 | −0.93306 | 2.325023 | −0.24978 | 0.521013 | 2.325023 |
| 0.351859 | −0.84871 | 2.325023 | −0.18812 | 0.429886 | 2.325023 |
| 0.276654 | −0.76108 | 2.325023 | −0.12399 | 0.335711 | 2.325023 |
| 0.202127 | −0.67278 | 2.325023 | −0.05973 | 0.241536 | 2.325023 |
| 0.128729 | −0.58391 | 2.325023 | 0.00463 | 0.147586 | 2.325023 |
| 0.05646 | −0.49414 | 2.325023 | 0.068994 | 0.053524 | 2.325023 |
| −0.01423 | −0.40335 | 2.325023 | 0.13302 | −0.04065 | 2.325023 |
| −0.08311 | −0.31132 | 2.325023 | 0.196368 | −0.13539 | 2.325023 |
| −0.14996 | −0.21794 | 2.325023 | 0.2587 | −0.2307 | 2.325023 |
| −0.21466 | −0.12308 | 2.325023 | 0.320354 | −0.32656 | 2.325023 |
| −0.27767 | −0.0271 | 2.325023 | 0.381557 | −0.42266 | 2.325023 |
| −0.3391 | 0.069897 | 2.325023 | 0.442421 | −0.51898 | 2.325023 |
| −0.39895 | 0.168138 | 2.325023 | 0.503172 | −0.61553 | 2.325023 |
| −0.45699 | 0.267507 | 2.325023 | 0.563697 | −0.71196 | 2.325023 |
| −0.5113 | 0.364732 | 2.325023 | 0.622302 | −0.80523 | 2.325023 |
| −0.562 | 0.45981 | 2.325023 | 0.678875 | −0.89534 | 2.325023 |
| −0.6092 | 0.552743 | 2.325023 | 0.733528 | −0.98207 | 2.325023 |
| −0.6529 | 0.643305 | 2.325023 | 0.786262 | −1.06563 | 2.325023 |
| −0.69333 | 0.731496 | 2.325023 | 0.837076 | −1.1458 | 2.325023 |
| −0.73059 | 0.817202 | 2.325023 | 0.885857 | −1.22281 | 2.325023 |
| −0.76469 | 0.900311 | 2.325023 | 0.932719 | −1.29655 | 2.325023 |
| −0.79575 | 0.980597 | 2.325023 | 0.975516 | −1.36385 | 2.325023 |
| −0.82251 | 1.054221 | 2.325023 | 1.01436 | −1.42471 | 2.325023 |
| −0.84521 | 1.120844 | 2.325023 | 1.04914 | −1.47914 | 2.325023 |
| −0.8644 | 1.180466 | 2.325023 | 1.079741 | −1.52713 | 2.325023 |
| −0.88123 | 1.2367 | 2.325023 | 1.10639 | −1.5688 | 2.325023 |
| −0.89354 | 1.286046 | 2.325023 | 1.128974 | −1.60392 | 2.325023 |
| −0.90042 | 1.324552 | 2.325023 | 1.148283 | −1.63395 | 2.325023 |
| −0.90302 | 1.355718 | 2.325023 | 1.164544 | −1.65925 | 2.325023 |
| −0.90212 | 1.379092 | 2.325023 | 1.177981 | −1.67991 | 2.325023 |
| −0.89828 | 1.396256 | 2.325023 | 1.188709 | −1.69651 | 2.325023 |
| −0.89387 | 1.404951 | 2.325023 | 1.1965 | −1.7095 | 2.325023 |
| −0.8897 | 1.409693 | 2.325023 | 1.198307 | −1.72067 | 2.325023 |
| −0.88721 | 1.4115 | 2.325023 | 1.196162 | −1.72982 | 2.325023 |
| −0.88574 | 1.41229 | 2.325023 | 1.192209 | −1.73626 | 2.325023 |
| 1.17832 | −1.80345 | 2.953987 | −0.88992 | 1.369833 | 2.953987 |
| 1.173465 | −1.80649 | 2.953987 | −0.88925 | 1.370171 | 2.953987 |
| 1.166012 | −1.80853 | 2.953987 | −0.88778 | 1.370623 | 2.953987 |
| 1.156414 | −1.80774 | 2.953987 | −0.88473 | 1.371188 | 2.953987 |
| 1.146364 | −1.80186 | 2.953987 | −0.87852 | 1.370736 | 2.953987 |
| 1.135749 | −1.79069 | 2.953987 | −0.86948 | 1.367461 | 2.953987 |
| 1.122086 | −1.77601 | 2.953987 | −0.85492 | 1.357976 | 2.953987 |
| 1.104809 | −1.7576 | 2.953987 | −0.83787 | 1.342619 | 2.953987 |
| 1.083919 | −1.73524 | 2.953987 | −0.81754 | 1.319809 | 2.953987 |
| 1.05919 | −1.70871 | 2.953987 | −0.79428 | 1.289546 | 2.953987 |
| 1.030169 | −1.67754 | 2.953987 | −0.76639 | 1.248669 | 2.953987 |
| 0.995954 | −1.64073 | 2.953987 | −0.73545 | 1.200565 | 2.953987 |
| 0.956432 | −1.59816 | 2.953987 | −0.70281 | 1.149074 | 2.953987 |
| 0.911829 | −1.54983 | 2.953987 | −0.66612 | 1.091146 | 2.953987 |
| 0.862144 | −1.49574 | 2.953987 | −0.62546 | 1.026782 | 2.953987 |
| 0.807265 | −1.43589 | 2.953987 | −0.58063 | 0.955868 | 2.953987 |
| 0.747305 | −1.37006 | 2.953987 | −0.53389 | 0.881792 | 2.953987 |
| 0.684973 | −1.30118 | 2.953987 | −0.48488 | 0.804555 | 2.953987 |
| 0.620382 | −1.22925 | 2.953987 | −0.43373 | 0.724269 | 2.953987 |
| 0.553534 | −1.15427 | 2.953987 | −0.3802 | 0.640934 | 2.953987 |
| 0.48454 | −1.0759 | 2.953987 | −0.32442 | 0.554437 | 2.953987 |
| 0.413626 | −0.99437 | 2.953987 | −0.26627 | 0.465005 | 2.953987 |
| 0.340905 | −0.90934 | 2.953987 | −0.20585 | 0.372523 | 2.953987 |
| 0.266491 | −0.8207 | 2.953987 | −0.14307 | 0.276993 | 2.953987 |
| 0.193206 | −0.73138 | 2.953987 | −0.07995 | 0.181688 | 2.953987 |
| 0.12105 | −0.64105 | 2.953987 | −0.01671 | 0.086497 | 2.953987 |
| 0.050362 | −0.54981 | 2.953987 | 0.046749 | −0.00858 | 2.953987 |
| −0.01863 | −0.45744 | 2.953987 | 0.110323 | −0.10355 | 2.953987 |
| −0.08559 | −0.36349 | 2.953987 | 0.173671 | −0.19874 | 2.953987 |

TABLE 10-continued

| SUCTION SIDE | | | PRESSURE SIDE | | |
|---|---|---|---|---|---|
| X | Y | Z | X | Y | Z |
| −0.15052 | −0.26807 | 2.953987 | 0.236003 | −0.2945 | 2.953987 |
| −0.21376 | −0.17141 | 2.953987 | 0.297657 | −0.39082 | 2.953987 |
| −0.27564 | −0.07396 | 2.953987 | 0.35886 | −0.48736 | 2.953987 |
| −0.33616 | 0.024617 | 2.953987 | 0.419724 | −0.58414 | 2.953987 |
| −0.39511 | 0.124325 | 2.953987 | 0.480475 | −0.68091 | 2.953987 |
| −0.45236 | 0.225162 | 2.953987 | 0.541226 | −0.77768 | 2.953987 |
| −0.50622 | 0.323855 | 2.953987 | 0.60017 | −0.87118 | 2.953987 |
| −0.5567 | 0.420175 | 2.953987 | 0.657194 | −0.9614 | 2.953987 |
| −0.60367 | 0.514012 | 2.953987 | 0.712412 | −1.04824 | 2.953987 |
| −0.64737 | 0.605251 | 2.953987 | 0.765711 | −1.13168 | 2.953987 |
| −0.68791 | 0.693668 | 2.953987 | 0.817202 | −1.21186 | 2.953987 |
| −0.7254 | 0.779148 | 2.953987 | 0.866774 | −1.28864 | 2.953987 |
| −0.75973 | 0.861693 | 2.953987 | 0.914426 | −1.36227 | 2.953987 |
| −0.79134 | 0.941301 | 2.953987 | 0.958126 | −1.42923 | 2.953987 |
| −0.81856 | 1.014135 | 2.953987 | 0.997761 | −1.48987 | 2.953987 |
| −0.84204 | 1.08008 | 2.953987 | 1.033218 | −1.54407 | 2.953987 |
| −0.86203 | 1.139137 | 2.953987 | 1.064723 | −1.59183 | 2.953987 |
| −0.87965 | 1.194694 | 2.953987 | 1.091936 | −1.63316 | 2.953987 |
| −0.89297 | 1.243475 | 2.953987 | 1.115085 | −1.66817 | 2.953987 |
| −0.90088 | 1.281529 | 2.953987 | 1.134846 | −1.69798 | 2.953987 |
| −0.9046 | 1.312469 | 2.953987 | 1.151558 | −1.72305 | 2.953987 |
| −0.90483 | 1.335731 | 2.953987 | 1.165334 | −1.7436 | 2.953987 |
| −0.902 | 1.353007 | 2.953987 | 1.176401 | −1.76008 | 2.953987 |
| −0.89828 | 1.362041 | 2.953987 | 1.184757 | −1.77273 | 2.953987 |
| −0.89444 | 1.366897 | 2.953987 | 1.187693 | −1.78368 | 2.953987 |
| −0.89196 | 1.368816 | 2.953987 | 1.186112 | −1.79294 | 2.953987 |
| −0.8906 | 1.369494 | 2.953987 | 1.182385 | −1.79949 | 2.953987 |
| 1.188144 | −1.81733 | 3.267905 | −0.90381 | 1.347926 | 3.267905 |
| 1.183176 | −1.82038 | 3.267905 | −0.90302 | 1.348265 | 3.267905 |
| 1.175723 | −1.82242 | 3.267905 | −0.90155 | 1.348716 | 3.267905 |
| 1.166125 | −1.82129 | 3.267905 | −0.8985 | 1.349168 | 3.267905 |
| 1.156414 | −1.81519 | 3.267905 | −0.89229 | 1.348491 | 3.267905 |
| 1.145573 | −1.80401 | 3.267905 | −0.88337 | 1.34499 | 3.267905 |
| 1.131571 | −1.78956 | 3.267905 | −0.86915 | 1.335166 | 3.267905 |
| 1.114069 | −1.77149 | 3.267905 | −0.85232 | 1.31947 | 3.267905 |
| 1.09284 | −1.74947 | 3.267905 | −0.83222 | 1.296322 | 3.267905 |
| 1.067546 | −1.72327 | 3.267905 | −0.8093 | 1.265833 | 3.267905 |
| 1.037961 | −1.69256 | 3.267905 | −0.78152 | 1.224843 | 3.267905 |
| 1.003068 | −1.6562 | 3.267905 | −0.75081 | 1.176626 | 3.267905 |
| 0.962982 | −1.61419 | 3.267905 | −0.71828 | 1.125022 | 3.267905 |
| 0.917588 | −1.56643 | 3.267905 | −0.68181 | 1.066868 | 3.267905 |
| 0.866887 | −1.51302 | 3.267905 | −0.64116 | 1.002278 | 3.267905 |
| 0.811104 | −1.45385 | 3.267905 | −0.59667 | 0.931138 | 3.267905 |
| 0.75024 | −1.38869 | 3.267905 | −0.55003 | 0.856837 | 3.267905 |
| 0.687005 | −1.3206 | 3.267905 | −0.50125 | 0.779374 | 3.267905 |
| 0.621399 | −1.24935 | 3.267905 | −0.45032 | 0.698749 | 3.267905 |
| 0.553647 | −1.17493 | 3.267905 | −0.39703 | 0.615188 | 3.267905 |
| 0.483749 | −1.09724 | 3.267905 | −0.34147 | 0.528466 | 3.267905 |
| 0.411932 | −1.01628 | 3.267905 | −0.28343 | 0.438807 | 3.267905 |
| 0.338421 | −0.93182 | 3.267905 | −0.22313 | 0.3461 | 3.267905 |
| 0.263329 | −0.84363 | 3.267905 | −0.16035 | 0.250457 | 3.267905 |
| 0.18948 | −0.75453 | 3.267905 | −0.09711 | 0.155039 | 3.267905 |
| 0.116985 | −0.66442 | 3.267905 | −0.03365 | 0.059848 | 3.267905 |
| 0.046184 | −0.57318 | 3.267905 | 0.030037 | −0.03523 | 3.267905 |
| −0.02292 | −0.48059 | 3.267905 | 0.094062 | −0.12997 | 3.267905 |
| −0.09 | −0.38653 | 3.267905 | 0.158201 | −0.22482 | 3.267905 |
| −0.15493 | −0.29088 | 3.267905 | 0.221662 | −0.32002 | 3.267905 |
| −0.21839 | −0.19411 | 3.267905 | 0.284445 | −0.41566 | 3.267905 |
| −0.28061 | −0.09643 | 3.267905 | 0.346777 | −0.51164 | 3.267905 |
| −0.34124 | 0.002371 | 3.267905 | 0.408996 | −0.60762 | 3.267905 |
| −0.4003 | 0.102418 | 3.267905 | 0.471102 | −0.70372 | 3.267905 |
| −0.45789 | 0.203482 | 3.267905 | 0.533208 | −0.79981 | 3.267905 |
| −0.51187 | 0.3024 | 3.267905 | 0.593395 | −0.89263 | 3.267905 |
| −0.56245 | 0.398946 | 3.267905 | 0.651774 | −0.98207 | 3.267905 |
| −0.60966 | 0.492896 | 3.267905 | 0.708121 | −1.06822 | 3.267905 |
| −0.65358 | 0.584022 | 3.267905 | 0.762775 | −1.15111 | 3.267905 |
| −0.69435 | 0.672326 | 3.267905 | 0.815395 | −1.2306 | 3.267905 |
| −0.73206 | 0.757806 | 3.267905 | 0.866209 | −1.30671 | 3.267905 |
| −0.76684 | 0.840238 | 3.267905 | 0.914991 | −1.37966 | 3.267905 |
| −0.7988 | 0.919733 | 3.267905 | 0.95982 | −1.44605 | 3.267905 |
| −0.82657 | 0.992454 | 3.267905 | 1.000358 | −1.50601 | 3.267905 |
| −0.85063 | 1.058286 | 3.267905 | 1.036831 | −1.55965 | 3.267905 |
| −0.87118 | 1.117005 | 3.267905 | 1.069127 | −1.60696 | 3.267905 |
| −0.88936 | 1.172448 | 3.267905 | 1.097131 | −1.64784 | 3.267905 |
| −0.90336 | 1.221117 | 3.267905 | 1.120844 | −1.68251 | 3.267905 |
| −0.91194 | 1.259058 | 3.267905 | 1.14117 | −1.71198 | 3.267905 |

TABLE 10-continued

| SUCTION SIDE | | | PRESSURE SIDE | | |
|---|---|---|---|---|---|
| X | Y | Z | X | Y | Z |
| −0.91635 | 1.289885 | 3.267905 | 1.158333 | −1.73682 | 3.267905 |
| −0.91725 | 1.31326 | 3.267905 | 1.172448 | −1.75715 | 3.267905 |
| −0.9151 | 1.330649 | 3.267905 | 1.183853 | −1.77341 | 3.267905 |
| −0.91183 | 1.339796 | 3.267905 | 1.192548 | −1.78594 | 3.267905 |
| −0.90822 | 1.344764 | 3.267905 | 1.196613 | −1.79656 | 3.267905 |
| −0.90584 | 1.346797 | 3.267905 | 1.195597 | −1.80616 | 3.267905 |
| −0.90449 | 1.347587 | 3.267905 | 1.192096 | −1.81304 | 3.267905 |
| 1.197855 | −1.81541 | 3.582952 | −0.91906 | 1.335166 | 3.582952 |
| 1.193 | −1.81858 | 3.582952 | −0.91838 | 1.335392 | 3.582952 |
| 1.185547 | −1.8205 | 3.582952 | −0.91691 | 1.335844 | 3.582952 |
| 1.175949 | −1.81937 | 3.582952 | −0.91386 | 1.336295 | 3.582952 |
| 1.166464 | −1.81282 | 3.582952 | −0.90765 | 1.335392 | 3.582952 |
| 1.155397 | −1.80186 | 3.582952 | −0.89884 | 1.331553 | 3.582952 |
| 1.14117 | −1.78764 | 3.582952 | −0.88484 | 1.321503 | 3.582952 |
| 1.123441 | −1.7698 | 3.582952 | −0.86835 | 1.305468 | 3.582952 |
| 1.10176 | −1.74811 | 3.582952 | −0.84848 | 1.282207 | 3.582952 |
| 1.076128 | −1.72226 | 3.582952 | −0.82578 | 1.251492 | 3.582952 |
| 1.046091 | −1.69199 | 3.582952 | −0.79834 | 1.210389 | 3.582952 |
| 1.010634 | −1.6562 | 3.582952 | −0.76786 | 1.161947 | 3.582952 |
| 0.96987 | −1.61476 | 3.582952 | −0.73556 | 1.110117 | 3.582952 |
| 0.923799 | −1.56767 | 3.582952 | −0.69931 | 1.051737 | 3.582952 |
| 0.87242 | −1.51493 | 3.582952 | −0.65911 | 0.986921 | 3.582952 |
| 0.815734 | −1.45656 | 3.582952 | −0.61496 | 0.915555 | 3.582952 |
| 0.753967 | −1.3923 | 3.582952 | −0.56855 | 0.841028 | 3.582952 |
| 0.689828 | −1.325 | 3.582952 | −0.52011 | 0.763452 | 3.582952 |
| 0.623318 | −1.25465 | 3.582952 | −0.4693 | 0.682714 | 3.582952 |
| 0.55455 | −1.18103 | 3.582952 | −0.41622 | 0.598928 | 3.582952 |
| 0.483749 | −1.10424 | 3.582952 | −0.36078 | 0.512092 | 3.582952 |
| 0.411142 | −1.02407 | 3.582952 | −0.30285 | 0.422321 | 3.582952 |
| 0.336727 | −0.94028 | 3.582952 | −0.24244 | 0.329613 | 3.582952 |
| 0.260732 | −0.85288 | 3.582952 | −0.17954 | 0.234083 | 3.582952 |
| 0.186205 | −0.76436 | 3.582952 | −0.11608 | 0.138779 | 3.582952 |
| 0.113146 | −0.6747 | 3.582952 | −0.05217 | 0.043926 | 3.582952 |
| 0.042006 | −0.58368 | 3.582952 | 0.012195 | −0.05081 | 3.582952 |
| −0.0271 | −0.49098 | 3.582952 | 0.077011 | −0.1451 | 3.582952 |
| −0.09395 | −0.39669 | 3.582952 | 0.142053 | −0.23928 | 3.582952 |
| −0.15922 | −0.30104 | 3.582952 | 0.206982 | −0.33357 | 3.582952 |
| −0.22302 | −0.20427 | 3.582952 | 0.271347 | −0.42819 | 3.582952 |
| −0.28546 | −0.1066 | 3.582952 | 0.335034 | −0.52327 | 3.582952 |
| −0.34655 | −0.00779 | 3.582952 | 0.398495 | −0.61846 | 3.582952 |
| −0.40606 | 0.092256 | 3.582952 | 0.461956 | −0.71377 | 3.582952 |
| −0.46399 | 0.193432 | 3.582952 | 0.525304 | −0.80907 | 3.582952 |
| −0.5183 | 0.29235 | 3.582952 | 0.586845 | −0.90099 | 3.582952 |
| −0.56912 | 0.388671 | 3.582952 | 0.646354 | −0.98963 | 3.582952 |
| −0.61666 | 0.482281 | 3.582952 | 0.704056 | −1.075 | 3.582952 |
| −0.66092 | 0.573295 | 3.582952 | 0.759952 | −1.15698 | 3.582952 |
| −0.70214 | 0.661372 | 3.582952 | 0.813814 | −1.23557 | 3.582952 |
| −0.7403 | 0.746514 | 3.582952 | 0.865871 | −1.311 | 3.582952 |
| −0.77553 | 0.82872 | 3.582952 | 0.915894 | −1.38304 | 3.582952 |
| −0.80817 | 0.90799 | 3.582952 | 0.961853 | −1.44865 | 3.582952 |
| −0.83651 | 0.980371 | 3.582952 | 1.00352 | −1.50793 | 3.582952 |
| −0.86113 | 1.045978 | 3.582952 | 1.040897 | −1.56089 | 3.582952 |
| −0.88213 | 1.104583 | 3.582952 | 1.073982 | −1.60764 | 3.582952 |
| −0.9011 | 1.159801 | 3.582952 | 1.102777 | −1.64807 | 3.582952 |
| −0.91578 | 1.208244 | 3.582952 | 1.127055 | −1.68217 | 3.582952 |
| −0.92493 | 1.245959 | 3.582952 | 1.147945 | −1.7113 | 3.582952 |
| −0.9299 | 1.276674 | 3.582952 | 1.165673 | −1.73581 | 3.582952 |
| −0.93136 | 1.300048 | 3.582952 | 1.180127 | −1.75591 | 3.582952 |
| −0.92978 | 1.317438 | 3.582952 | 1.191871 | −1.77194 | 3.582952 |
| −0.92685 | 1.326697 | 3.582952 | 1.200791 | −1.78425 | 3.582952 |
| −0.92346 | 1.331891 | 3.582952 | 1.205534 | −1.79464 | 3.582952 |
| −0.9212 | 1.333924 | 3.582952 | 1.205082 | −1.80424 | 3.582952 |
| −0.91985 | 1.334714 | 3.582952 | 1.201808 | −1.81112 | 3.582952 |
| 1.195823 | −1.7873 | 3.896869 | −0.93927 | 1.347926 | 3.896869 |
| 1.190967 | −1.79046 | 3.896869 | −0.93859 | 1.348265 | 3.896869 |
| 1.183515 | −1.79238 | 3.896869 | −0.93701 | 1.348716 | 3.896869 |
| 1.174029 | −1.79091 | 3.896869 | −0.93396 | 1.349055 | 3.896869 |
| 1.16477 | −1.78414 | 3.896869 | −0.92786 | 1.347926 | 3.896869 |
| 1.153704 | −1.7733 | 3.896869 | −0.91917 | 1.343748 | 3.896869 |
| 1.13925 | −1.75929 | 3.896869 | −0.90551 | 1.333246 | 3.896869 |
| 1.121183 | −1.74168 | 3.896869 | −0.88936 | 1.316873 | 3.896869 |
| 1.099276 | −1.72034 | 3.896869 | −0.87005 | 1.293273 | 3.896869 |
| 1.073305 | −1.69493 | 3.896869 | −0.8478 | 1.262446 | 3.896869 |
| 1.042929 | −1.66501 | 3.896869 | −0.82082 | 1.220891 | 3.896869 |
| 1.007133 | −1.62966 | 3.896869 | −0.79078 | 1.172223 | 3.896869 |
| 0.965805 | −1.5889 | 3.896869 | −0.75905 | 1.120166 | 3.896869 |

TABLE 10-continued

| SUCTION SIDE | | | PRESSURE SIDE | | |
|---|---|---|---|---|---|
| X | Y | Z | X | Y | Z |
| 0.919169 | −1.54249 | 3.896869 | −0.72325 | 1.061674 | 3.896869 |
| 0.867226 | −1.49043 | 3.896869 | −0.68339 | 0.996632 | 3.896869 |
| 0.809862 | −1.43273 | 3.896869 | −0.63969 | 0.925041 | 3.896869 |
| 0.747417 | −1.36938 | 3.896869 | −0.59385 | 0.850288 | 3.896869 |
| 0.682488 | −1.30287 | 3.896869 | −0.54574 | 0.772486 | 3.896869 |
| 0.615301 | −1.23331 | 3.896869 | −0.49538 | 0.691522 | 3.896869 |
| 0.545855 | −1.16059 | 3.896869 | −0.44276 | 0.607623 | 3.896869 |
| 0.47449 | −1.0846 | 3.896869 | −0.38754 | 0.520674 | 3.896869 |
| 0.401092 | −1.0051 | 3.896869 | −0.32995 | 0.43079 | 3.896869 |
| 0.326113 | −0.9221 | 3.896869 | −0.26965 | 0.338082 | 3.896869 |
| 0.249779 | −0.83527 | 3.896869 | −0.20676 | 0.242552 | 3.896869 |
| 0.174913 | −0.74719 | 3.896869 | −0.14341 | 0.147474 | 3.896869 |
| 0.101741 | −0.65787 | 3.896869 | −0.07927 | 0.052734 | 3.896869 |
| 0.030488 | −0.56697 | 3.896869 | −0.01468 | −0.04167 | 3.896869 |
| −0.03839 | −0.47415 | 3.896869 | 0.050362 | −0.13573 | 3.896869 |
| −0.10524 | −0.37964 | 3.896869 | 0.116082 | −0.22934 | 3.896869 |
| −0.17062 | −0.28411 | 3.896869 | 0.18214 | −0.32273 | 3.896869 |
| −0.23476 | −0.18756 | 3.896869 | 0.247746 | −0.41634 | 3.896869 |
| −0.29743 | −0.08977 | 3.896869 | 0.312788 | −0.51051 | 3.896869 |
| −0.35863 | 0.009034 | 3.896869 | 0.377492 | −0.6048 | 3.896869 |
| −0.41837 | 0.109081 | 3.896869 | 0.442195 | −0.69909 | 3.896869 |
| −0.47641 | 0.210144 | 3.896869 | 0.506898 | −0.79338 | 3.896869 |
| −0.53084 | 0.308723 | 3.896869 | 0.569681 | −0.88439 | 3.896869 |
| −0.58176 | 0.404705 | 3.896869 | 0.630545 | −0.97213 | 3.896869 |
| −0.62953 | 0.498203 | 3.896869 | 0.68949 | −1.05648 | 3.896869 |
| −0.67402 | 0.588878 | 3.896869 | 0.746514 | −1.13756 | 3.896869 |
| −0.71546 | 0.676617 | 3.896869 | 0.801619 | −1.21536 | 3.896869 |
| −0.75408 | 0.761532 | 3.896869 | 0.854917 | −1.28977 | 3.896869 |
| −0.78976 | 0.843399 | 3.896869 | 0.90607 | −1.36091 | 3.896869 |
| −0.82274 | 0.922218 | 3.896869 | 0.953045 | −1.42573 | 3.896869 |
| −0.85176 | 0.994374 | 3.896869 | 0.995729 | −1.48433 | 3.896869 |
| −0.87682 | 1.059641 | 3.896869 | 1.034008 | −1.53662 | 3.896869 |
| −0.89839 | 1.117908 | 3.896869 | 1.067884 | −1.58269 | 3.896869 |
| −0.91781 | 1.1729 | 3.896869 | 1.097357 | −1.62255 | 3.896869 |
| −0.93295 | 1.221117 | 3.896869 | 1.122199 | −1.65631 | 3.896869 |
| −0.94266 | 1.258719 | 3.896869 | 1.143654 | −1.68499 | 3.896869 |
| −0.94819 | 1.289208 | 3.896869 | 1.161608 | −1.70916 | 3.896869 |
| −0.95022 | 1.312469 | 3.896869 | 1.176513 | −1.72903 | 3.896869 |
| −0.94921 | 1.329859 | 3.896869 | 1.188483 | −1.74484 | 3.896869 |
| −0.94672 | 1.339231 | 3.896869 | 1.19763 | −1.75692 | 3.896869 |
| −0.94356 | 1.344651 | 3.896869 | 1.202711 | −1.76697 | 3.896869 |
| −0.9413 | 1.346797 | 3.896869 | 1.202598 | −1.77623 | 3.896869 |
| −0.93995 | 1.347587 | 3.896869 | 1.199549 | −1.78312 | 3.896869 |
| 1.162286 | −1.75308 | 4.211916 | −0.96276 | 1.392191 | 4.211916 |
| 1.15743 | −1.75624 | 4.211916 | −0.96197 | 1.392529 | 4.211916 |
| 1.149977 | −1.75805 | 4.211916 | −0.9605 | 1.392868 | 4.211916 |
| 1.140492 | −1.75624 | 4.211916 | −0.95734 | 1.393094 | 4.211916 |
| 1.131458 | −1.74902 | 4.211916 | −0.95135 | 1.391739 | 4.211916 |
| 1.120279 | −1.73829 | 4.211916 | −0.94288 | 1.387109 | 4.211916 |
| 1.105713 | −1.7244 | 4.211916 | −0.92967 | 1.376043 | 4.211916 |
| 1.087533 | −1.7069 | 4.211916 | −0.91409 | 1.359105 | 4.211916 |
| 1.065513 | −1.68578 | 4.211916 | −0.89546 | 1.33494 | 4.211916 |
| 1.039316 | −1.66049 | 4.211916 | −0.87411 | 1.303548 | 4.211916 |
| 1.008714 | −1.63079 | 4.211916 | −0.84792 | 1.261429 | 4.211916 |
| 0.972693 | −1.59567 | 4.211916 | −0.8189 | 1.212083 | 4.211916 |
| 0.931138 | −1.55502 | 4.211916 | −0.78807 | 1.159463 | 4.211916 |
| 0.884164 | −1.50884 | 4.211916 | −0.75329 | 1.10018 | 4.211916 |
| 0.831995 | −1.45701 | 4.211916 | −0.71467 | 1.03446 | 4.211916 |
| 0.774518 | −1.39942 | 4.211916 | −0.67199 | 0.962191 | 4.211916 |
| 0.711848 | −1.33607 | 4.211916 | −0.62727 | 0.886761 | 4.211916 |
| 0.646919 | −1.26967 | 4.211916 | −0.5803 | 0.808168 | 4.211916 |
| 0.579844 | −1.2 | 4.211916 | −0.53106 | 0.726527 | 4.211916 |
| 0.510624 | −1.12705 | 4.211916 | −0.47946 | 0.641724 | 4.211916 |
| 0.439485 | −1.05083 | 4.211916 | −0.42548 | 0.554098 | 4.211916 |
| 0.366538 | −0.971 | 4.211916 | −0.36891 | 0.463537 | 4.211916 |
| 0.292124 | −0.88744 | 4.211916 | −0.30974 | 0.370039 | 4.211916 |
| 0.216581 | −0.79981 | 4.211916 | −0.24775 | 0.273831 | 4.211916 |
| 0.142731 | −0.71094 | 4.211916 | −0.18519 | 0.178075 | 4.211916 |
| 0.070688 | −0.62061 | 4.211916 | −0.12195 | 0.08277 | 4.211916 |
| 0.000678 | −0.52847 | 4.211916 | −0.05804 | −0.0122 | 4.211916 |
| −0.06707 | −0.43474 | 4.211916 | 0.006436 | −0.1066 | 4.211916 |
| −0.13313 | −0.33955 | 4.211916 | 0.071591 | −0.20066 | 4.211916 |
| −0.19806 | −0.24334 | 4.211916 | 0.137311 | −0.29427 | 4.211916 |
| −0.26152 | −0.14612 | 4.211916 | 0.20303 | −0.38799 | 4.211916 |
| −0.32363 | −0.04777 | 4.211916 | 0.268411 | −0.48183 | 4.211916 |
| −0.38427 | 0.051604 | 4.211916 | 0.333453 | −0.576 | 4.211916 |

TABLE 10-continued

| SUCTION SIDE | | | PRESSURE SIDE | | |
|---|---|---|---|---|---|
| X | Y | Z | X | Y | Z |
| −0.44332 | 0.15199 | 4.211916 | 0.398382 | −0.67018 | 4.211916 |
| −0.50069 | 0.253392 | 4.211916 | 0.463311 | −0.76424 | 4.211916 |
| −0.55455 | 0.352197 | 4.211916 | 0.526433 | −0.85503 | 4.211916 |
| −0.60503 | 0.448518 | 4.211916 | 0.587749 | −0.94254 | 4.211916 |
| −0.65223 | 0.542129 | 4.211916 | 0.647145 | −1.02667 | 4.211916 |
| −0.69638 | 0.632917 | 4.211916 | 0.704621 | −1.10741 | 4.211916 |
| −0.73748 | 0.720881 | 4.211916 | 0.76029 | −1.18476 | 4.211916 |
| −0.77587 | 0.805797 | 4.211916 | 0.814153 | −1.25883 | 4.211916 |
| −0.81133 | 0.887777 | 4.211916 | 0.865983 | −1.32952 | 4.211916 |
| −0.8443 | 0.966595 | 4.211916 | 0.913523 | −1.394 | 4.211916 |
| −0.87321 | 1.038638 | 4.211916 | 0.956771 | −1.45204 | 4.211916 |
| −0.89828 | 1.103906 | 4.211916 | 0.995616 | −1.50398 | 4.211916 |
| −0.91985 | 1.162173 | 4.211916 | 1.030056 | −1.5496 | 4.211916 |
| −0.93938 | 1.217052 | 4.211916 | 1.05998 | −1.58912 | 4.211916 |
| −0.95463 | 1.265156 | 4.211916 | 1.085387 | −1.62255 | 4.211916 |
| −0.96456 | 1.302758 | 4.211916 | 1.107068 | −1.651 | 4.211916 |
| −0.97043 | 1.333246 | 4.211916 | 1.125474 | −1.67494 | 4.211916 |
| −0.97269 | 1.356508 | 4.211916 | 1.140605 | −1.69459 | 4.211916 |
| −0.97213 | 1.373898 | 4.211916 | 1.1528 | −1.71017 | 4.211916 |
| −0.96987 | 1.383383 | 4.211916 | 1.162173 | −1.72226 | 4.211916 |
| −0.96693 | 1.388803 | 4.211916 | 1.168157 | −1.73185 | 4.211916 |
| −0.96468 | 1.390949 | 4.211916 | 1.168835 | −1.74145 | 4.211916 |
| −0.96343 | 1.391852 | 4.211916 | 1.166125 | −1.74857 | 4.211916 |
| 1.1493 | −1.74608 | 4.278539 | −0.96603 | 1.407322 | 4.278539 |
| 1.144444 | −1.74924 | 4.278539 | −0.96535 | 1.407548 | 4.278539 |
| 1.136991 | −1.75105 | 4.278539 | −0.96377 | 1.407999 | 4.278539 |
| 1.127619 | −1.74913 | 4.278539 | −0.96072 | 1.408112 | 4.278539 |
| 1.118586 | −1.7419 | 4.278539 | −0.95474 | 1.406644 | 4.278539 |
| 1.107406 | −1.73118 | 4.278539 | −0.94627 | 1.401902 | 4.278539 |
| 1.09284 | −1.71729 | 4.278539 | −0.93328 | 1.39061 | 4.278539 |
| 1.074547 | −1.69978 | 4.278539 | −0.91781 | 1.373559 | 4.278539 |
| 1.052527 | −1.67867 | 4.278539 | −0.89941 | 1.349281 | 4.278539 |
| 1.026217 | −1.65337 | 4.278539 | −0.87829 | 1.317551 | 4.278539 |
| 0.995616 | −1.62379 | 4.278539 | −0.85255 | 1.275206 | 4.278539 |
| 0.959481 | −1.58867 | 4.278539 | −0.82386 | 1.225634 | 4.278539 |
| 0.917927 | −1.54802 | 4.278539 | −0.79349 | 1.172674 | 4.278539 |
| 0.870952 | −1.50184 | 4.278539 | −0.75916 | 1.113165 | 4.278539 |
| 0.81867 | −1.45001 | 4.278539 | −0.72099 | 1.047107 | 4.278539 |
| 0.761194 | −1.3923 | 4.278539 | −0.67888 | 0.9745 | 4.278539 |
| 0.698636 | −1.32896 | 4.278539 | −0.6345 | 0.898617 | 4.278539 |
| 0.633707 | −1.26233 | 4.278539 | −0.58809 | 0.819799 | 4.278539 |
| 0.566745 | −1.19255 | 4.278539 | −0.53931 | 0.737706 | 4.278539 |
| 0.497751 | −1.11938 | 4.278539 | −0.48815 | 0.652678 | 4.278539 |
| 0.426725 | −1.04282 | 4.278539 | −0.43463 | 0.5646 | 4.278539 |
| 0.35423 | −0.96276 | 4.278539 | −0.37851 | 0.473699 | 4.278539 |
| 0.280155 | −0.87874 | 4.278539 | −0.31979 | 0.379863 | 4.278539 |
| 0.205063 | −0.79078 | 4.278539 | −0.25836 | 0.283316 | 4.278539 |
| 0.131552 | −0.70157 | 4.278539 | −0.19625 | 0.187221 | 4.278539 |
| 0.059961 | −0.61067 | 4.278539 | −0.13347 | 0.091465 | 4.278539 |
| −0.00937 | −0.51808 | 4.278539 | −0.0699 | −0.00373 | 4.278539 |
| −0.07667 | −0.4239 | 4.278539 | −0.00576 | −0.09847 | 4.278539 |
| −0.14228 | −0.32826 | 4.278539 | 0.058944 | −0.19287 | 4.278539 |
| −0.20676 | −0.23171 | 4.278539 | 0.124438 | −0.28682 | 4.278539 |
| −0.26977 | −0.13415 | 4.278539 | 0.190044 | −0.38054 | 4.278539 |
| −0.33142 | −0.03534 | 4.278539 | 0.255425 | −0.47449 | 4.278539 |
| −0.39172 | 0.064364 | 4.278539 | 0.320354 | −0.56878 | 4.278539 |
| −0.45032 | 0.164976 | 4.278539 | 0.385057 | −0.66318 | 4.278539 |
| −0.50724 | 0.266604 | 4.278539 | 0.449873 | −0.75758 | 4.278539 |
| −0.56076 | 0.365748 | 4.278539 | 0.51277 | −0.84859 | 4.278539 |
| −0.6109 | 0.462182 | 4.278539 | 0.573859 | −0.93622 | 4.278539 |
| −0.65776 | 0.556018 | 4.278539 | 0.633255 | −1.02046 | 4.278539 |
| −0.70157 | 0.646919 | 4.278539 | 0.690732 | −1.1012 | 4.278539 |
| −0.74245 | 0.734996 | 4.278539 | 0.746401 | −1.17866 | 4.278539 |
| −0.7805 | 0.820138 | 4.278539 | 0.800151 | −1.25273 | 4.278539 |
| −0.81585 | 0.902231 | 4.278539 | 0.852094 | −1.32354 | 4.278539 |
| −0.84848 | 0.981162 | 4.278539 | 0.899859 | −1.3879 | 4.278539 |
| −0.87716 | 1.053431 | 4.278539 | 0.943221 | −1.44605 | 4.278539 |
| −0.90212 | 1.118698 | 4.278539 | 0.982178 | −1.49788 | 4.278539 |
| −0.92357 | 1.177078 | 4.278539 | 1.016732 | −1.5435 | 4.278539 |
| −0.94288 | 1.231957 | 4.278539 | 1.046768 | −1.58291 | 4.278539 |
| −0.95813 | 1.280174 | 4.278539 | 1.072175 | −1.61634 | 4.278539 |
| −0.96784 | 1.317776 | 4.278539 | 1.094082 | −1.64479 | 4.278539 |
| −0.97371 | 1.348265 | 4.278539 | 1.112488 | −1.66862 | 4.278539 |
| −0.97597 | 1.371526 | 4.278539 | 1.127732 | −1.68827 | 4.278539 |
| −0.97529 | 1.388916 | 4.278539 | 1.139927 | −1.70385 | 4.278539 |
| −0.97314 | 1.398401 | 4.278539 | 1.1493 | −1.71593 | 4.278539 |

TABLE 10-continued

| SUCTION SIDE | | | PRESSURE SIDE | | |
|---|---|---|---|---|---|
| X | Y | Z | X | Y | Z |
| −0.97021 | 1.403934 | 4.278539 | 1.155285 | −1.72553 | 4.278539 |
| −0.96806 | 1.40608 | 4.278539 | 1.155736 | −1.73479 | 4.278539 |
| −0.96671 | 1.406983 | 4.278539 | 1.153026 | −1.74179 | 4.278539 |
| 1.126942 | −1.73727 | 4.368875 | −0.97055 | 1.431035 | 4.368875 |
| 1.122086 | −1.74044 | 4.368875 | −0.96976 | 1.431261 | 4.368875 |
| 1.11452 | −1.74224 | 4.368875 | −0.96829 | 1.431713 | 4.368875 |
| 1.105148 | −1.74021 | 4.368875 | −0.96524 | 1.431826 | 4.368875 |
| 1.096227 | −1.73287 | 4.368875 | −0.95926 | 1.430132 | 4.368875 |
| 1.084935 | −1.72214 | 4.368875 | −0.9509 | 1.425163 | 4.368875 |
| 1.070369 | −1.70825 | 4.368875 | −0.93814 | 1.413645 | 4.368875 |
| 1.052076 | −1.69086 | 4.368875 | −0.92301 | 1.396256 | 4.368875 |
| 1.029943 | −1.66964 | 4.368875 | −0.90505 | 1.371639 | 4.368875 |
| 1.003633 | −1.64434 | 4.368875 | −0.88439 | 1.339683 | 4.368875 |
| 0.972919 | −1.61476 | 4.368875 | −0.85921 | 1.296886 | 4.368875 |
| 0.936784 | −1.57964 | 4.368875 | −0.8312 | 1.246863 | 4.368875 |
| 0.895117 | −1.53899 | 4.368875 | −0.80151 | 1.193451 | 4.368875 |
| 0.848029 | −1.4928 | 4.368875 | −0.76797 | 1.133491 | 4.368875 |
| 0.795747 | −1.44086 | 4.368875 | −0.73059 | 1.066868 | 4.368875 |
| 0.738271 | −1.38316 | 4.368875 | −0.68926 | 0.993696 | 4.368875 |
| 0.675826 | −1.31958 | 4.368875 | −0.6459 | 0.917362 | 4.368875 |
| 0.611123 | −1.25273 | 4.368875 | −0.60017 | 0.837866 | 4.368875 |
| 0.544274 | −1.18261 | 4.368875 | −0.55229 | 0.755322 | 4.368875 |
| 0.475506 | −1.1091 | 4.368875 | −0.50204 | 0.669729 | 4.368875 |
| 0.405044 | −1.03209 | 4.368875 | −0.44931 | 0.581086 | 4.368875 |
| 0.332888 | −0.95146 | 4.368875 | −0.39398 | 0.489508 | 4.368875 |
| 0.25949 | −0.867 | 4.368875 | −0.33605 | 0.395107 | 4.368875 |
| 0.184963 | −0.77836 | 4.368875 | −0.27552 | 0.297883 | 4.368875 |
| 0.11213 | −0.68836 | 4.368875 | −0.2141 | 0.201223 | 4.368875 |
| 0.041442 | −0.59678 | 4.368875 | −0.1521 | 0.104903 | 4.368875 |
| −0.02699 | −0.5034 | 4.368875 | −0.08943 | 0.009147 | 4.368875 |
| −0.09338 | −0.40832 | 4.368875 | −0.02597 | −0.08627 | 4.368875 |
| −0.15831 | −0.31211 | 4.368875 | 0.038167 | −0.18112 | 4.368875 |
| −0.22189 | −0.21489 | 4.368875 | 0.102983 | −0.27552 | 4.368875 |
| −0.28411 | −0.11653 | 4.368875 | 0.168364 | −0.36959 | 4.368875 |
| −0.34497 | −0.01716 | 4.368875 | 0.233519 | −0.46376 | 4.368875 |
| −0.40437 | 0.083222 | 4.368875 | 0.298222 | −0.55839 | 4.368875 |
| −0.46218 | 0.184398 | 4.368875 | 0.362586 | −0.65313 | 4.368875 |
| −0.51842 | 0.286478 | 4.368875 | 0.427063 | −0.74776 | 4.368875 |
| −0.57115 | 0.386073 | 4.368875 | 0.489621 | −0.83911 | 4.368875 |
| −0.62061 | 0.483072 | 4.368875 | 0.550485 | −0.92707 | 4.368875 |
| −0.66691 | 0.577247 | 4.368875 | 0.609542 | −1.01154 | 4.368875 |
| −0.71015 | 0.668486 | 4.368875 | 0.666906 | −1.0925 | 4.368875 |
| −0.75047 | 0.756903 | 4.368875 | 0.722575 | −1.17008 | 4.368875 |
| −0.78796 | 0.842383 | 4.368875 | 0.776325 | −1.24427 | 4.368875 |
| −0.82274 | 0.924702 | 4.368875 | 0.828268 | −1.31507 | 4.368875 |
| −0.85503 | 1.003859 | 4.368875 | 0.876146 | −1.37954 | 4.368875 |
| −0.88326 | 1.076353 | 4.368875 | 0.91962 | −1.43758 | 4.368875 |
| −0.90776 | 1.141847 | 4.368875 | 0.958691 | −1.48941 | 4.368875 |
| −0.92888 | 1.20034 | 4.368875 | 0.993357 | −1.53492 | 4.368875 |
| −0.94796 | 1.255445 | 4.368875 | 1.023507 | −1.57444 | 4.368875 |
| −0.96287 | 1.303774 | 4.368875 | 1.04914 | −1.60775 | 4.368875 |
| −0.97247 | 1.341377 | 4.368875 | 1.071046 | −1.6361 | 4.368875 |
| −0.97811 | 1.371978 | 4.368875 | 1.089565 | −1.65992 | 4.368875 |
| −0.98037 | 1.39524 | 4.368875 | 1.104809 | −1.67957 | 4.368875 |
| −0.97981 | 1.412629 | 4.368875 | 1.117118 | −1.69516 | 4.368875 |
| −0.97766 | 1.422114 | 4.368875 | 1.12649 | −1.70712 | 4.368875 |
| −0.97473 | 1.427648 | 4.368875 | 1.132588 | −1.71672 | 4.368875 |
| −0.97258 | 1.429793 | 4.368875 | 1.133265 | −1.72598 | 4.368875 |
| −0.97122 | 1.430696 | 4.368875 | 1.130555 | −1.73298 | 4.368875 |
| 1.075563 | −1.72395 | 4.525834 | −0.98229 | 1.47993 | 4.525834 |
| 1.070707 | −1.72722 | 4.525834 | −0.98161 | 1.480155 | 4.525834 |
| 1.063142 | −1.72892 | 4.525834 | −0.98003 | 1.480494 | 4.525834 |
| 1.053769 | −1.72655 | 4.525834 | −0.97698 | 1.480494 | 4.525834 |
| 1.044962 | −1.71898 | 4.525834 | −0.97111 | 1.478462 | 4.525834 |
| 1.03367 | −1.70837 | 4.525834 | −0.96309 | 1.473041 | 4.525834 |
| 1.018877 | −1.69448 | 4.525834 | −0.95067 | 1.460959 | 4.525834 |
| 1.000584 | −1.67709 | 4.525834 | −0.93633 | 1.443005 | 4.525834 |
| 0.978339 | −1.65586 | 4.525834 | −0.91917 | 1.417711 | 4.525834 |
| 0.951803 | −1.63056 | 4.525834 | −0.89952 | 1.384964 | 4.525834 |
| 0.920976 | −1.60087 | 4.525834 | −0.87569 | 1.341264 | 4.525834 |
| 0.884615 | −1.56575 | 4.525834 | −0.84927 | 1.290337 | 4.525834 |
| 0.842835 | −1.5251 | 4.525834 | −0.82104 | 1.236022 | 4.525834 |
| 0.795747 | −1.47869 | 4.525834 | −0.7892 | 1.174933 | 4.525834 |
| 0.743352 | −1.42652 | 4.525834 | −0.75363 | 1.107181 | 4.525834 |
| 0.685763 | −1.36848 | 4.525834 | −0.71422 | 1.032766 | 4.525834 |
| 0.623318 | −1.30434 | 4.525834 | −0.67266 | 0.95519 | 4.525834 |

TABLE 10-continued

| SUCTION SIDE | | | PRESSURE SIDE | | |
|---|---|---|---|---|---|
| X | Y | Z | X | Y | Z |
| 0.558841 | −1.23704 | 4.525834 | −0.62896 | 0.874452 | 4.525834 |
| 0.492444 | −1.16624 | 4.525834 | −0.58289 | 0.790553 | 4.525834 |
| 0.424128 | −1.09205 | 4.525834 | −0.53456 | 0.703605 | 4.525834 |
| 0.35423 | −1.01413 | 4.525834 | −0.48364 | 0.61372 | 4.525834 |
| 0.282978 | −0.93249 | 4.525834 | −0.43023 | 0.5209 | 4.525834 |
| 0.210483 | −0.84679 | 4.525834 | −0.37422 | 0.425144 | 4.525834 |
| 0.137198 | −0.75679 | 4.525834 | −0.31539 | 0.326565 | 4.525834 |
| 0.065719 | −0.66544 | 4.525834 | −0.25588 | 0.228437 | 4.525834 |
| −0.0035 | −0.57228 | 4.525834 | −0.19546 | 0.130874 | 4.525834 |
| −0.07024 | −0.4772 | 4.525834 | −0.13426 | 0.033763 | 4.525834 |
| −0.13505 | −0.38065 | 4.525834 | −0.07238 | −0.06278 | 4.525834 |
| −0.1984 | −0.28298 | 4.525834 | −0.0096 | −0.15888 | 4.525834 |
| −0.26039 | −0.18417 | 4.525834 | 0.054089 | −0.25441 | 4.525834 |
| −0.32103 | −0.08435 | 4.525834 | 0.118453 | −0.34949 | 4.525834 |
| −0.3802 | 0.016486 | 4.525834 | 0.183043 | −0.44434 | 4.525834 |
| −0.43779 | 0.118227 | 4.525834 | 0.247069 | −0.53964 | 4.525834 |
| −0.49369 | 0.220759 | 4.525834 | 0.310869 | −0.63506 | 4.525834 |
| −0.54811 | 0.324306 | 4.525834 | 0.374781 | −0.73048 | 4.525834 |
| −0.59904 | 0.425144 | 4.525834 | 0.436887 | −0.82251 | 4.525834 |
| −0.64681 | 0.523271 | 4.525834 | 0.4973 | −0.91104 | 4.525834 |
| −0.69141 | 0.618463 | 4.525834 | 0.556018 | −0.99595 | 4.525834 |
| −0.73308 | 0.710831 | 4.525834 | 0.613156 | −1.07748 | 4.525834 |
| −0.77192 | 0.800264 | 4.525834 | 0.668599 | −1.1554 | 4.525834 |
| −0.80794 | 0.886535 | 4.525834 | 0.722349 | −1.22992 | 4.525834 |
| −0.84137 | 0.969757 | 4.525834 | 0.774292 | −1.30095 | 4.525834 |
| −0.87231 | 1.049704 | 4.525834 | 0.822171 | −1.36554 | 4.525834 |
| −0.89929 | 1.122764 | 4.525834 | 0.865758 | −1.4237 | 4.525834 |
| −0.92278 | 1.188935 | 4.525834 | 0.905054 | −1.47553 | 4.525834 |
| −0.94311 | 1.247879 | 4.525834 | 0.939946 | −1.52115 | 4.525834 |
| −0.96129 | 1.303436 | 4.525834 | 0.970322 | −1.56055 | 4.525834 |
| −0.97552 | 1.352104 | 4.525834 | 0.995954 | −1.59387 | 4.525834 |
| −0.98466 | 1.389932 | 4.525834 | 1.018087 | −1.62232 | 4.525834 |
| −0.99008 | 1.420647 | 4.525834 | 1.036719 | −1.64615 | 4.525834 |
| −0.99212 | 1.444021 | 4.525834 | 1.052076 | −1.66568 | 4.525834 |
| −0.99144 | 1.461524 | 4.525834 | 1.064384 | −1.68138 | 4.525834 |
| −0.98941 | 1.471009 | 4.525834 | 1.073869 | −1.69335 | 4.525834 |
| −0.98658 | 1.476542 | 4.525834 | 1.080419 | −1.70272 | 4.525834 |
| −0.98432 | 1.478687 | 4.525834 | 1.081774 | −1.71221 | 4.525834 |
| −0.98308 | 1.479591 | 4.525834 | 1.079289 | −1.71955 | 4.525834 |
| 0.954626 | −1.70035 | 4.84088 | −1.01594 | 1.591607 | 4.84088 |
| 0.949657 | −1.70362 | 4.84088 | −1.01515 | 1.591833 | 4.84088 |
| 0.941866 | −1.7052 | 4.84088 | −1.01357 | 1.591946 | 4.84088 |
| 0.932606 | −1.70216 | 4.84088 | −1.01052 | 1.591382 | 4.84088 |
| 0.923799 | −1.69425 | 4.84088 | −1.00499 | 1.588559 | 4.84088 |
| 0.912394 | −1.68352 | 4.84088 | −0.99765 | 1.582122 | 4.84088 |
| 0.897488 | −1.66964 | 4.84088 | −0.98669 | 1.568572 | 4.84088 |
| 0.878856 | −1.65213 | 4.84088 | −0.97394 | 1.549262 | 4.84088 |
| 0.856272 | −1.6309 | 4.84088 | −0.95892 | 1.522275 | 4.84088 |
| 0.82951 | −1.60561 | 4.84088 | −0.94175 | 1.487834 | 4.84088 |
| 0.798231 | −1.5758 | 4.84088 | −0.92109 | 1.442101 | 4.84088 |
| 0.761532 | −1.54045 | 4.84088 | −0.89805 | 1.389029 | 4.84088 |
| 0.7193 | −1.49935 | 4.84088 | −0.87344 | 1.332343 | 4.84088 |
| 0.671874 | −1.4526 | 4.84088 | −0.84554 | 1.268769 | 4.84088 |
| 0.61914 | −1.39976 | 4.84088 | −0.81404 | 1.198307 | 4.84088 |
| 0.561551 | −1.34104 | 4.84088 | −0.77915 | 1.120844 | 4.84088 |
| 0.499219 | −1.276 | 4.84088 | −0.74211 | 1.040219 | 4.84088 |
| 0.434968 | −1.20734 | 4.84088 | −0.7027 | 0.956432 | 4.84088 |
| 0.369023 | −1.13518 | 4.84088 | −0.66115 | 0.869371 | 4.84088 |
| 0.301496 | −1.0593 | 4.84088 | −0.61699 | 0.779261 | 4.84088 |
| 0.232615 | −0.97936 | 4.84088 | −0.57047 | 0.685989 | 4.84088 |
| 0.162492 | −0.89546 | 4.84088 | −0.52124 | 0.589781 | 4.84088 |
| 0.091691 | −0.80715 | 4.84088 | −0.4693 | 0.49075 | 4.84088 |
| 0.020326 | −0.71411 | 4.84088 | −0.41453 | 0.388784 | 4.84088 |
| −0.04878 | −0.61925 | 4.84088 | −0.35875 | 0.287381 | 4.84088 |
| −0.1154 | −0.52248 | 4.84088 | −0.30184 | 0.186657 | 4.84088 |
| −0.17954 | −0.42345 | 4.84088 | −0.24391 | 0.086497 | 4.84088 |
| −0.24176 | −0.32329 | 4.84088 | −0.18496 | −0.01299 | 4.84088 |
| −0.30251 | −0.22211 | 4.84088 | −0.12489 | −0.11202 | 4.84088 |
| −0.36146 | −0.12003 | 4.84088 | −0.06391 | −0.21037 | 4.84088 |
| −0.41871 | −0.01694 | 4.84088 | −0.00181 | −0.30805 | 4.84088 |
| −0.47415 | 0.087174 | 4.84088 | 0.061203 | −0.40516 | 4.84088 |
| −0.5279 | 0.19219 | 4.84088 | 0.124099 | −0.50238 | 4.84088 |
| −0.57984 | 0.298222 | 4.84088 | 0.186996 | −0.59949 | 4.84088 |
| −0.62998 | 0.405044 | 4.84088 | 0.250118 | −0.69649 | 4.84088 |
| −0.67673 | 0.509043 | 4.84088 | 0.311546 | −0.7901 | 4.84088 |
| −0.72032 | 0.61022 | 4.84088 | 0.371394 | −0.87999 | 4.84088 |

TABLE 10-continued

| SUCTION SIDE | | | PRESSURE SIDE | | |
|---|---|---|---|---|---|
| X | Y | Z | X | Y | Z |
| −0.76074 | 0.708573 | 4.84088 | 0.429661 | −0.96637 | 4.84088 |
| −0.79834 | 0.803652 | 4.84088 | 0.486459 | −1.04903 | 4.84088 |
| −0.83312 | 0.895681 | 4.84088 | 0.54179 | −1.12796 | 4.84088 |
| −0.86519 | 0.984549 | 4.84088 | 0.59554 | −1.20339 | 4.84088 |
| −0.89478 | 1.07003 | 4.84088 | 0.647709 | −1.27521 | 4.84088 |
| −0.92199 | 1.152236 | 4.84088 | 0.695926 | −1.34036 | 4.84088 |
| −0.94582 | 1.227327 | 4.84088 | 0.739965 | −1.39897 | 4.84088 |
| −0.96637 | 1.295079 | 4.84088 | 0.779713 | −1.45113 | 4.84088 |
| −0.9841 | 1.355492 | 4.84088 | 0.815057 | −1.49698 | 4.84088 |
| −0.99991 | 1.412403 | 4.84088 | 0.845771 | −1.53662 | 4.84088 |
| −1.01221 | 1.462088 | 4.84088 | 0.871968 | −1.57004 | 4.84088 |
| −1.02001 | 1.500594 | 4.84088 | 0.894439 | −1.5985 | 4.84088 |
| −1.02441 | 1.53176 | 4.84088 | 0.91341 | −1.62243 | 4.84088 |
| −1.02588 | 1.55536 | 4.84088 | 0.928993 | −1.64208 | 4.84088 |
| −1.02509 | 1.572976 | 4.84088 | 0.941414 | −1.65778 | 4.84088 |
| −1.02294 | 1.582574 | 4.84088 | 0.951012 | −1.66986 | 4.84088 |
| −1.02023 | 1.58822 | 4.84088 | 0.958013 | −1.67901 | 4.84088 |
| −1.01797 | 1.590478 | 4.84088 | 0.960159 | −1.68838 | 4.84088 |
| −1.01662 | 1.591269 | 4.84088 | 0.958126 | −1.69572 | 4.84088 |

TABLE 11

| SUCTION SIDE | | | PRESSURE SIDE | | |
|---|---|---|---|---|---|
| X | Y | Z | X | Y | Z |
| 1.028944 | −1.29299 | −0.23775 | −1.00122 | 1.216466 | −0.23775 |
| 1.025745 | −1.29702 | −0.23775 | −1.00063 | 1.216584 | −0.23775 |
| 1.020414 | −1.3014 | −0.23775 | −0.99933 | 1.21694 | −0.23775 |
| 1.012596 | −1.30496 | −0.23775 | −0.99672 | 1.21765 | −0.23775 |
| 1.002409 | −1.30602 | −0.23775 | −0.99151 | 1.218361 | −0.23775 |
| 0.989259 | −1.30199 | −0.23775 | −0.98334 | 1.21848 | −0.23775 |
| 0.973504 | −1.29335 | −0.23775 | −0.96877 | 1.215518 | −0.23775 |
| 0.953721 | −1.28257 | −0.23775 | −0.95088 | 1.207344 | −0.23775 |
| 0.929793 | −1.26942 | −0.23775 | −0.92956 | 1.191826 | −0.23775 |
| 0.901362 | −1.25354 | −0.23775 | −0.90657 | 1.168726 | −0.23775 |
| 0.868193 | −1.23495 | −0.23775 | −0.88051 | 1.135321 | −0.23775 |
| 0.829102 | −1.21268 | −0.23775 | −0.85303 | 1.094689 | −0.23775 |
| 0.784087 | −1.18673 | −0.23775 | −0.82472 | 1.05074 | −0.23775 |
| 0.733386 | −1.157 | −0.23775 | −0.79356 | 1.00075 | −0.23775 |
| 0.676999 | −1.12324 | −0.23775 | −0.75933 | 0.945074 | −0.23775 |
| 0.614926 | −1.08545 | −0.23775 | −0.7219 | 0.883712 | −0.23775 |
| 0.547522 | −1.0434 | −0.23775 | −0.6828 | 0.819506 | −0.23775 |
| 0.477631 | −0.99862 | −0.23775 | −0.64182 | 0.752576 | −0.23775 |
| 0.405489 | −0.951 | −0.23775 | −0.5987 | 0.683159 | −0.23775 |
| 0.330977 | −0.90053 | −0.23775 | −0.55333 | 0.611372 | −0.23775 |
| 0.254571 | −0.84687 | −0.23775 | −0.50547 | 0.537335 | −0.23775 |
| 0.176268 | −0.79013 | −0.23775 | −0.45512 | 0.461165 | −0.23775 |
| 0.096426 | −0.72995 | −0.23775 | −0.40193 | 0.382981 | −0.23775 |
| 0.015163 | −0.66634 | −0.23775 | −0.34626 | 0.302547 | −0.23775 |
| −0.06468 | −0.60118 | −0.23775 | −0.28963 | 0.222823 | −0.23775 |
| −0.14298 | −0.53437 | −0.23775 | −0.2323 | 0.143574 | −0.23775 |
| −0.21962 | −0.4659 | −0.23775 | −0.17485 | 0.064442 | −0.23775 |
| −0.29449 | −0.3953 | −0.23775 | −0.11716 | −0.01457 | −0.23775 |
| −0.36723 | −0.32269 | −0.23775 | −0.05899 | −0.09323 | −0.23775 |
| −0.43771 | −0.24746 | −0.23775 | −0.00024 | −0.17141 | −0.23775 |
| −0.50535 | −0.16928 | −0.23775 | 0.059467 | −0.249 | −0.23775 |
| −0.57003 | −0.08778 | −0.23775 | 0.120118 | −0.32577 | −0.23775 |
| −0.63151 | −0.00308 | −0.23775 | 0.181836 | −0.40182 | −0.23775 |
| −0.68979 | 0.083988 | −0.23775 | 0.244857 | −0.47704 | −0.23775 |
| −0.74452 | 0.173189 | −0.23775 | 0.309062 | −0.55119 | −0.23775 |
| −0.79392 | 0.261441 | −0.23775 | 0.37232 | −0.6218 | −0.23775 |
| −0.83846 | 0.348628 | −0.23775 | 0.434393 | −0.68908 | −0.23775 |
| −0.87779 | 0.434393 | −0.23775 | 0.495163 | −0.75317 | −0.23775 |
| −0.91262 | 0.518263 | −0.23775 | 0.554511 | −0.81406 | −0.23775 |
| −0.94365 | 0.6 | −0.23775 | 0.612201 | −0.87187 | −0.23775 |
| −0.96983 | 0.679723 | −0.23775 | 0.668233 | −0.92695 | −0.23775 |
| −0.99246 | 0.756722 | −0.23775 | 0.722369 | −0.97907 | −0.23775 |
| −1.01189 | 0.831115 | −0.23775 | 0.772359 | −1.02634 | −0.23775 |
| −1.02669 | 0.899467 | −0.23775 | 0.817848 | −1.06863 | −0.23775 |
| −1.03783 | 0.961421 | −0.23775 | 0.858717 | −1.1063 | −0.23775 |
| −1.04541 | 1.016979 | −0.23775 | 0.895084 | −1.13923 | −0.23775 |
| −1.05003 | 1.06922 | −0.23775 | 0.926713 | −1.16766 | −0.23775 |

TABLE 11-continued

| SUCTION SIDE | | | PRESSURE SIDE | | |
|---|---|---|---|---|---|
| X | Y | Z | X | Y | Z |
| −1.05038 | 1.11459 | −0.23775 | 0.953603 | −1.19159 | −0.23775 |
| −1.04612 | 1.149299 | −0.23775 | 0.976703 | −1.21196 | −0.23775 |
| −1.03806 | 1.176189 | −0.23775 | 0.99613 | −1.22902 | −0.23775 |
| −1.02823 | 1.194788 | −0.23775 | 1.012122 | −1.243 | −0.23775 |
| −1.01793 | 1.206634 | −0.23775 | 1.024916 | −1.25425 | −0.23775 |
| −1.01082 | 1.211964 | −0.23775 | 1.032024 | −1.26492 | −0.23775 |
| −1.00584 | 1.21457 | −0.23775 | 1.034037 | −1.27439 | −0.23775 |
| −1.00324 | 1.215755 | −0.23775 | 1.033445 | −1.28257 | −0.23775 |
| −1.00193 | 1.216229 | −0.23775 | 1.031431 | −1.28861 | −0.23775 |
| 1.041737 | −1.25828 | 0 | −1.04683 | 1.262428 | 0 |
| 1.038302 | −1.26219 | 0 | −1.04624 | 1.262665 | 0 |
| 1.032853 | −1.26634 | 0 | −1.04494 | 1.263139 | 0 |
| 1.024797 | −1.26965 | 0 | −1.04245 | 1.26385 | 0 |
| 1.014491 | −1.27025 | 0 | −1.03712 | 1.264797 | 0 |
| 1.001579 | −1.26563 | 0 | −1.02883 | 1.265034 | 0 |
| 0.985943 | −1.25662 | 0 | −1.01414 | 1.261954 | 0 |
| 0.966397 | −1.24537 | 0 | −0.99601 | 1.253544 | 0 |
| 0.942705 | −1.23151 | 0 | −0.97433 | 1.238025 | 0 |
| 0.914511 | −1.21504 | 0 | −0.95064 | 1.215163 | 0 |
| 0.881579 | −1.19562 | 0 | −0.92316 | 1.182112 | 0 |
| 0.842843 | −1.17252 | 0 | −0.89378 | 1.142073 | 0 |
| 0.798302 | −1.14551 | 0 | −0.86345 | 1.098717 | 0 |
| 0.747956 | −1.11471 | 0 | −0.82993 | 1.049437 | 0 |
| 0.691925 | −1.07976 | 0 | −0.79321 | 0.994472 | 0 |
| 0.630326 | −1.04079 | 0 | −0.75293 | 0.93382 | 0 |
| 0.563396 | −0.99731 | 0 | −0.71088 | 0.870326 | 0 |
| 0.493978 | −0.95123 | 0 | −0.66693 | 0.804225 | 0 |
| 0.422191 | −0.90243 | 0 | −0.62085 | 0.735637 | 0 |
| 0.348272 | −0.85066 | 0 | −0.57252 | 0.664561 | 0 |
| 0.272271 | −0.79581 | 0 | −0.5217 | 0.591115 | 0 |
| 0.194393 | −0.73777 | 0 | −0.46851 | 0.515419 | 0 |
| 0.115025 | −0.67641 | 0 | −0.41271 | 0.437473 | 0 |
| 0.034116 | −0.61161 | 0 | −0.35443 | 0.357275 | 0 |
| −0.04549 | −0.54527 | 0 | −0.29544 | 0.277552 | 0 |
| −0.12355 | −0.47751 | 0 | −0.23597 | 0.198184 | 0 |
| −0.20008 | −0.40809 | 0 | −0.17627 | 0.119052 | 0 |
| −0.27483 | −0.33678 | 0 | −0.11633 | 0.040039 | 0 |
| −0.3478 | −0.26346 | 0 | −0.05615 | −0.03874 | 0 |
| −0.41852 | −0.188 | 0 | 0.004738 | −0.11704 | 0 |
| −0.48699 | −0.11005 | 0 | 0.066338 | −0.19487 | 0 |
| −0.55273 | −0.02914 | 0 | 0.128648 | −0.2721 | 0 |
| −0.61587 | 0.054373 | 0 | 0.191787 | −0.34863 | 0 |
| −0.67605 | 0.140375 | 0 | 0.255874 | −0.42444 | 0 |
| −0.73315 | 0.228272 | 0 | 0.320908 | −0.49931 | 0 |
| −0.78527 | 0.315104 | 0 | 0.384758 | −0.57086 | 0 |
| −0.83277 | 0.40075 | 0 | 0.447305 | −0.63921 | 0 |
| −0.87542 | 0.485094 | 0 | 0.508312 | −0.70436 | 0 |
| −0.91368 | 0.567542 | 0 | 0.567897 | −0.76644 | 0 |
| −0.94839 | 0.647858 | 0 | 0.625706 | −0.82567 | 0 |
| −0.9786 | 0.726278 | 0 | 0.681737 | −0.88182 | 0 |
| −1.00501 | 0.802211 | 0 | 0.735992 | −0.93536 | 0 |
| −1.02823 | 0.875538 | 0 | 0.785745 | −0.98369 | 0 |
| −1.04695 | 0.942942 | 0 | 0.831234 | −1.02729 | 0 |
| −1.06188 | 1.004304 | 0 | 0.871984 | −1.0659 | 0 |
| −1.07313 | 1.059151 | 0 | 0.908233 | −1.0999 | 0 |
| −1.08142 | 1.111036 | 0 | 0.939743 | −1.12916 | 0 |
| −1.08545 | 1.156288 | 0 | 0.966515 | −1.15392 | 0 |
| −1.08438 | 1.191234 | 0 | 0.989378 | −1.175 | 0 |
| −1.07929 | 1.218835 | 0 | 1.008687 | −1.19266 | 0 |
| −1.07159 | 1.238381 | 0 | 1.024561 | −1.20711 | 0 |
| −1.06259 | 1.251411 | 0 | 1.037236 | −1.21872 | 0 |
| −1.05607 | 1.257334 | 0 | 1.045054 | −1.22938 | 0 |
| −1.05133 | 1.260414 | 0 | 1.047305 | −1.23921 | 0 |
| −1.04884 | 1.261599 | 0 | 1.046594 | −1.24762 | 0 |
| −1.04754 | 1.262191 | 0 | 1.044343 | −1.25402 | 0 |
| 1.045883 | −1.24703 | 0.078302 | −1.06199 | 1.278065 | 0.078302 |
| 1.042448 | −1.25094 | 0.078302 | −1.06128 | 1.278302 | 0.078302 |
| 1.03688 | −1.25497 | 0.078302 | −1.0601 | 1.278776 | 0.078302 |
| 1.028825 | −1.25816 | 0.078302 | −1.05749 | 1.279605 | 0.078302 |
| 1.018519 | −1.25864 | 0.078302 | −1.05228 | 1.280553 | 0.078302 |
| 1.005607 | −1.2539 | 0.078302 | −1.04375 | 1.280671 | 0.078302 |
| 0.98997 | −1.24478 | 0.078302 | −1.02906 | 1.277473 | 0.078302 |
| 0.970543 | −1.23317 | 0.078302 | −1.01094 | 1.268944 | 0.078302 |
| 0.946851 | −1.21919 | 0.078302 | −0.98926 | 1.253307 | 0.078302 |
| 0.918776 | −1.20237 | 0.078302 | −0.96545 | 1.230444 | 0.078302 |
| 0.885962 | −1.1827 | 0.078302 | −0.93737 | 1.197512 | 0.078302 |

TABLE 11-continued

| SUCTION SIDE | | | PRESSURE SIDE | | |
|---|---|---|---|---|---|
| X | Y | Z | X | Y | Z |
| 0.847344 | −1.15925 | 0.078302 | −0.9074 | 1.15771 | 0.078302 |
| 0.802922 | −1.13189 | 0.078302 | −0.87637 | 1.11459 | 0.078302 |
| 0.752695 | −1.10073 | 0.078302 | −0.84201 | 1.065548 | 0.078302 |
| 0.696782 | −1.06543 | 0.078302 | −0.80434 | 1.010938 | 0.078302 |
| 0.635419 | −1.02586 | 0.078302 | −0.763 | 0.950523 | 0.078302 |
| 0.56849 | −0.98203 | 0.078302 | −0.72 | 0.887384 | 0.078302 |
| 0.499309 | −0.9356 | 0.078302 | −0.67499 | 0.82152 | 0.078302 |
| 0.427641 | −0.88632 | 0.078302 | −0.62796 | 0.753169 | 0.078302 |
| 0.35384 | −0.83408 | 0.078302 | −0.57856 | 0.68233 | 0.078302 |
| 0.277907 | −0.77876 | 0.078302 | −0.52691 | 0.609003 | 0.078302 |
| 0.200197 | −0.72036 | 0.078302 | −0.47277 | 0.533425 | 0.078302 |
| 0.120829 | −0.65864 | 0.078302 | −0.41627 | 0.455597 | 0.078302 |
| 0.039921 | −0.59337 | 0.078302 | −0.35716 | 0.3754 | 0.078302 |
| −0.03957 | −0.52679 | 0.078302 | −0.29757 | 0.295558 | 0.078302 |
| −0.11751 | −0.45856 | 0.078302 | −0.23751 | 0.21619 | 0.078302 |
| −0.19404 | −0.38879 | 0.078302 | −0.1771 | 0.13694 | 0.078302 |
| −0.2689 | −0.31724 | 0.078302 | −0.11645 | 0.057927 | 0.078302 |
| −0.34176 | −0.24367 | 0.078302 | −0.05544 | −0.02085 | 0.078302 |
| −0.41271 | −0.16798 | 0.078302 | 0.006041 | −0.09915 | 0.078302 |
| −0.4813 | −0.08979 | 0.078302 | 0.068233 | −0.17698 | 0.078302 |
| −0.54752 | −0.00912 | 0.078302 | 0.131135 | −0.25433 | 0.078302 |
| −0.61114 | 0.074274 | 0.078302 | 0.194867 | −0.33098 | 0.078302 |
| −0.67202 | 0.159803 | 0.078302 | 0.259427 | −0.40691 | 0.078302 |
| −0.72983 | 0.247344 | 0.078302 | 0.324817 | −0.48213 | 0.078302 |
| −0.7829 | 0.333702 | 0.078302 | 0.388904 | −0.55404 | 0.078302 |
| −0.83135 | 0.418875 | 0.078302 | 0.45157 | −0.62263 | 0.078302 |
| −0.87506 | 0.502744 | 0.078302 | 0.512813 | −0.68825 | 0.078302 |
| −0.91451 | 0.584719 | 0.078302 | 0.572399 | −0.7508 | 0.078302 |
| −0.9504 | 0.664561 | 0.078302 | 0.630207 | −0.81038 | 0.078302 |
| −0.9818 | 0.742507 | 0.078302 | 0.686357 | −0.86713 | 0.078302 |
| −1.0094 | 0.817966 | 0.078302 | 0.740493 | −0.92103 | 0.078302 |
| −1.03392 | 0.890938 | 0.078302 | 0.790365 | −0.96983 | 0.078302 |
| −1.05382 | 0.958104 | 0.078302 | 0.835735 | −1.01378 | 0.078302 |
| −1.06993 | 1.019111 | 0.078302 | 0.876604 | −1.05287 | 0.078302 |
| −1.08225 | 1.073721 | 0.078302 | 0.912734 | −1.08711 | 0.078302 |
| −1.09173 | 1.125488 | 0.078302 | 0.944245 | −1.11672 | 0.078302 |
| −1.09682 | 1.170622 | 0.078302 | 0.970898 | −1.14172 | 0.078302 |
| −1.09682 | 1.205686 | 0.078302 | 0.993761 | −1.16304 | 0.078302 |
| −1.09268 | 1.233406 | 0.078302 | 1.012951 | −1.18093 | 0.078302 |
| −1.0858 | 1.253188 | 0.078302 | 1.028825 | −1.19562 | 0.078302 |
| −1.07739 | 1.266574 | 0.078302 | 1.0415 | −1.20734 | 0.078302 |
| −1.071 | 1.272734 | 0.078302 | 1.049319 | −1.21801 | 0.078302 |
| −1.06638 | 1.275933 | 0.078302 | 1.051688 | −1.22796 | 0.078302 |
| −1.06389 | 1.277236 | 0.078302 | 1.050859 | −1.23637 | 0.078302 |
| −1.06259 | 1.277828 | 0.078302 | 1.048489 | −1.24265 | 0.078302 |
| 1.050148 | −1.22807 | 0.236328 | −1.09019 | 1.310286 | 0.236328 |
| 1.046594 | −1.23187 | 0.236328 | −1.08948 | 1.310641 | 0.236328 |
| 1.040908 | −1.23589 | 0.236328 | −1.08829 | 1.311115 | 0.236328 |
| 1.032734 | −1.23874 | 0.236328 | −1.08569 | 1.311945 | 0.236328 |
| 1.022428 | −1.23897 | 0.236328 | −1.08036 | 1.313011 | 0.236328 |
| 1.009635 | −1.23376 | 0.236328 | −1.07183 | 1.313011 | 0.236328 |
| 0.994116 | −1.22417 | 0.236328 | −1.05702 | 1.309575 | 0.236328 |
| 0.974926 | −1.2122 | 0.236328 | −1.03889 | 1.300691 | 0.236328 |
| 0.951471 | −1.19751 | 0.236328 | −1.0171 | 1.284936 | 0.236328 |
| 0.923633 | −1.1801 | 0.236328 | −0.99281 | 1.262073 | 0.236328 |
| 0.891175 | −1.15972 | 0.236328 | −0.96403 | 1.229378 | 0.236328 |
| 0.852794 | −1.13544 | 0.236328 | −0.93275 | 1.189931 | 0.236328 |
| 0.808608 | −1.10713 | 0.236328 | −0.90041 | 1.147167 | 0.236328 |
| 0.758736 | −1.07502 | 0.236328 | −0.86464 | 1.098717 | 0.236328 |
| 0.703297 | −1.03866 | 0.236328 | −0.82519 | 1.044462 | 0.236328 |
| 0.642172 | −0.99814 | 0.236328 | −0.78207 | 0.98464 | 0.236328 |
| 0.575716 | −0.95313 | 0.236328 | −0.73718 | 0.921974 | 0.236328 |
| 0.506653 | −0.90551 | 0.236328 | −0.69038 | 0.856584 | 0.236328 |
| 0.435341 | −0.85516 | 0.236328 | −0.64146 | 0.788588 | 0.236328 |
| 0.361777 | −0.80197 | 0.236328 | −0.5904 | 0.718105 | 0.236328 |
| 0.286199 | −0.74571 | 0.236328 | −0.53698 | 0.645015 | 0.236328 |
| 0.208727 | −0.68636 | 0.236328 | −0.4813 | 0.569437 | 0.236328 |
| 0.129714 | −0.62369 | 0.236328 | −0.42338 | 0.491609 | 0.236328 |
| 0.049279 | −0.55759 | 0.236328 | −0.36296 | 0.411293 | 0.236328 |
| −0.02973 | −0.49019 | 0.236328 | −0.30207 | 0.331214 | 0.236328 |
| −0.10732 | −0.42136 | 0.236328 | −0.24083 | 0.251609 | 0.236328 |
| −0.18338 | −0.35088 | 0.236328 | −0.17935 | 0.172122 | 0.236328 |
| −0.25765 | −0.27885 | 0.236328 | −0.11751 | 0.092873 | 0.236328 |
| −0.33027 | −0.20505 | 0.236328 | −0.0552 | 0.013978 | 0.236328 |
| −0.40087 | −0.12924 | 0.236328 | 0.007581 | −0.06456 | 0.236328 |
| −0.46934 | −0.05141 | 0.236328 | 0.070958 | −0.14263 | 0.236328 |

TABLE 11-continued

| SUCTION SIDE | | | PRESSURE SIDE | | |
|---|---|---|---|---|---|
| X | Y | Z | X | Y | Z |
| −0.53568 | 0.028549 | 0.236328 | 0.134926 | −0.22022 | 0.236328 |
| −0.59964 | 0.11076 | 0.236328 | 0.199487 | −0.29722 | 0.236328 |
| −0.66148 | 0.195104 | 0.236328 | 0.264758 | −0.37362 | 0.236328 |
| −0.72083 | 0.281935 | 0.236328 | 0.330859 | −0.44944 | 0.236328 |
| −0.77591 | 0.367937 | 0.236328 | 0.395301 | −0.52205 | 0.236328 |
| −0.8265 | 0.452517 | 0.236328 | 0.458322 | −0.59159 | 0.236328 |
| −0.87258 | 0.535558 | 0.236328 | 0.519684 | −0.65816 | 0.236328 |
| −0.91439 | 0.617058 | 0.236328 | 0.579388 | −0.72166 | 0.236328 |
| −0.95266 | 0.696308 | 0.236328 | 0.637315 | −0.78231 | 0.236328 |
| −0.98677 | 0.773662 | 0.236328 | 0.693228 | −0.84 | 0.236328 |
| −1.01698 | 0.848884 | 0.236328 | 0.747364 | −0.89508 | 0.236328 |
| −1.04411 | 0.9215 | 0.236328 | 0.796999 | −0.94496 | 0.236328 |
| −1.0665 | 0.988312 | 0.236328 | 0.842251 | −0.98973 | 0.236328 |
| −1.08486 | 1.049082 | 0.236328 | 0.882882 | −1.02977 | 0.236328 |
| −1.09931 | 1.103573 | 0.236328 | 0.918776 | −1.06496 | 0.236328 |
| −1.11104 | 1.155103 | 0.236328 | 0.950049 | −1.09528 | 0.236328 |
| −1.11826 | 1.200355 | 0.236328 | 0.976584 | −1.12099 | 0.236328 |
| −1.12016 | 1.235419 | 0.236328 | 0.99921 | −1.14278 | 0.236328 |
| −1.11779 | 1.263494 | 0.236328 | 1.018282 | −1.16126 | 0.236328 |
| −1.11234 | 1.283869 | 0.236328 | 1.034037 | −1.17631 | 0.236328 |
| −1.10488 | 1.297848 | 0.236328 | 1.046594 | −1.18839 | 0.236328 |
| −1.09907 | 1.304482 | 0.236328 | 1.054294 | −1.19929 | 0.236328 |
| −1.09457 | 1.307917 | 0.236328 | 1.056308 | −1.20912 | 0.236328 |
| −1.09208 | 1.309457 | 0.236328 | 1.05536 | −1.21753 | 0.236328 |
| −1.09078 | 1.310049 | 0.236328 | 1.052872 | −1.22381 | 0.236328 |
| 1.043277 | −1.2218 | 0.374334 | −1.1089 | 1.340375 | 0.374334 |
| 1.039605 | −1.22559 | 0.374334 | −1.10831 | 1.34073 | 0.374334 |
| 1.0338 | −1.22938 | 0.374334 | −1.10701 | 1.341204 | 0.374334 |
| 1.025508 | −1.2321 | 0.374334 | −1.10452 | 1.342152 | 0.374334 |
| 1.015202 | −1.23187 | 0.374334 | −1.09919 | 1.343218 | 0.374334 |
| 1.002527 | −1.22606 | 0.374334 | −1.09054 | 1.343336 | 0.374334 |
| 0.987364 | −1.21599 | 0.374334 | −1.07562 | 1.339783 | 0.374334 |
| 0.968411 | −1.20344 | 0.374334 | −1.05737 | 1.33078 | 0.374334 |
| 0.945311 | −1.18815 | 0.374334 | −1.03546 | 1.315024 | 0.374334 |
| 0.917828 | −1.16991 | 0.374334 | −1.01082 | 1.292043 | 0.374334 |
| 0.885725 | −1.14847 | 0.374334 | −0.98144 | 1.259348 | 0.374334 |
| 0.847937 | −1.12312 | 0.374334 | −0.94969 | 1.219901 | 0.374334 |
| 0.804343 | −1.09374 | 0.374334 | −0.91653 | 1.177255 | 0.374334 |
| 0.755064 | −1.06034 | 0.374334 | −0.8798 | 1.128805 | 0.374334 |
| 0.700099 | −1.02267 | 0.374334 | −0.83941 | 1.074788 | 0.374334 |
| 0.639684 | −0.98061 | 0.374334 | −0.79522 | 1.015084 | 0.374334 |
| 0.57382 | −0.93418 | 0.374334 | −0.74926 | 0.952537 | 0.374334 |
| 0.505469 | −0.88513 | 0.374334 | −0.70128 | 0.887147 | 0.374334 |
| 0.434867 | −0.83337 | 0.374334 | −0.65129 | 0.819151 | 0.374334 |
| 0.361895 | −0.77876 | 0.374334 | −0.59905 | 0.748549 | 0.374334 |
| 0.28691 | −0.72107 | 0.374334 | −0.5448 | 0.67534 | 0.374334 |
| 0.210148 | −0.66041 | 0.374334 | −0.48817 | 0.599645 | 0.374334 |
| 0.131728 | −0.59645 | 0.374334 | −0.4293 | 0.521461 | 0.374334 |
| 0.052004 | −0.52904 | 0.374334 | −0.36806 | 0.44079 | 0.374334 |
| −0.02642 | −0.46045 | 0.374334 | −0.30657 | 0.360355 | 0.374334 |
| −0.10342 | −0.39044 | 0.374334 | −0.24474 | 0.280158 | 0.374334 |
| −0.17887 | −0.31901 | 0.374334 | −0.18255 | 0.200197 | 0.374334 |
| −0.25268 | −0.24592 | 0.374334 | −0.12 | 0.120474 | 0.374334 |
| −0.32482 | −0.17129 | 0.374334 | −0.0571 | 0.041106 | 0.374334 |
| −0.39506 | −0.095 | 0.374334 | 0.006278 | −0.03791 | 0.374334 |
| −0.46342 | −0.01682 | 0.374334 | 0.070128 | −0.11656 | 0.374334 |
| −0.52975 | 0.063258 | 0.374334 | 0.134452 | −0.19475 | 0.374334 |
| −0.59396 | 0.14535 | 0.374334 | 0.199368 | −0.27258 | 0.374334 |
| −0.65615 | 0.229339 | 0.374334 | 0.264877 | −0.34981 | 0.374334 |
| −0.71609 | 0.315459 | 0.374334 | 0.330977 | −0.42657 | 0.374334 |
| −0.77189 | 0.40075 | 0.374334 | 0.395538 | −0.50026 | 0.374334 |
| −0.82365 | 0.484975 | 0.374334 | 0.458322 | −0.57086 | 0.374334 |
| −0.87115 | 0.56766 | 0.374334 | 0.519447 | −0.6385 | 0.374334 |
| −0.91451 | 0.648687 | 0.374334 | 0.578796 | −0.7033 | 0.374334 |
| −0.95443 | 0.727581 | 0.374334 | 0.636249 | −0.76513 | 0.374334 |
| −0.99009 | 0.804462 | 0.374334 | 0.691806 | −0.82413 | 0.374334 |
| −1.02207 | 0.879092 | 0.374334 | 0.74535 | −0.88039 | 0.374334 |
| −1.05086 | 0.951234 | 0.374334 | 0.794511 | −0.93157 | 0.374334 |
| −1.07491 | 1.01769 | 0.374334 | 0.839171 | −0.97765 | 0.374334 |
| −1.09481 | 1.078104 | 0.374334 | 0.87921 | −1.01876 | 0.374334 |
| −1.1108 | 1.132359 | 0.374334 | 0.914748 | −1.05489 | 0.374334 |
| −1.12407 | 1.183771 | 0.374334 | 0.945548 | −1.08616 | 0.374334 |
| −1.1326 | 1.228904 | 0.374334 | 0.971609 | −1.11269 | 0.374334 |
| −1.13568 | 1.263968 | 0.374334 | 0.993879 | −1.1352 | 0.374334 |
| −1.13449 | 1.29228 | 0.374334 | 1.012715 | −1.15416 | 0.374334 |
| −1.12999 | 1.313011 | 0.374334 | 1.028114 | −1.16979 | 0.374334 |

TABLE 11-continued

| SUCTION SIDE | | | PRESSURE SIDE | | |
|---|---|---|---|---|---|
| X | Y | Z | X | Y | Z |
| −1.12324 | 1.327344 | 0.374334 | 1.040553 | −1.18223 | 0.374334 |
| −1.11767 | 1.334215 | 0.374334 | 1.047897 | −1.19337 | 0.374334 |
| −1.11329 | 1.337887 | 0.374334 | 1.049793 | −1.2032 | 0.374334 |
| −1.11092 | 1.339427 | 0.374334 | 1.048726 | −1.21149 | 0.374334 |
| −1.10961 | 1.340138 | 0.374334 | 1.04612 | −1.21765 | 0.374334 |
| 1.023257 | −1.23317 | 0.552379 | −1.12193 | 1.379348 | 0.552379 |
| 1.019467 | −1.23684 | 0.552379 | −1.12134 | 1.379585 | 0.552379 |
| 1.013544 | −1.24039 | 0.552379 | −1.12004 | 1.380177 | 0.552379 |
| 1.005133 | −1.24276 | 0.552379 | −1.11743 | 1.381125 | 0.552379 |
| 0.994709 | −1.24193 | 0.552379 | −1.1121 | 1.382191 | 0.552379 |
| 0.982389 | −1.2353 | 0.552379 | −1.10345 | 1.382428 | 0.552379 |
| 0.967463 | −1.22464 | 0.552379 | −1.08841 | 1.378874 | 0.552379 |
| 0.948865 | −1.21125 | 0.552379 | −1.06981 | 1.369753 | 0.552379 |
| 0.926357 | −1.19491 | 0.552379 | −1.04778 | 1.353879 | 0.552379 |
| 0.899467 | −1.1756 | 0.552379 | −1.02278 | 1.330661 | 0.552379 |
| 0.868075 | −1.15285 | 0.552379 | −0.99317 | 1.297611 | 0.552379 |
| 0.830997 | −1.12584 | 0.552379 | −0.96118 | 1.257808 | 0.552379 |
| 0.788351 | −1.09469 | 0.552379 | −0.92754 | 1.214807 | 0.552379 |
| 0.740138 | −1.05915 | 0.552379 | −0.89035 | 1.166002 | 0.552379 |
| 0.686357 | −1.01923 | 0.552379 | −0.84936 | 1.11151 | 0.552379 |
| 0.627246 | −0.97493 | 0.552379 | −0.8047 | 1.051333 | 0.552379 |
| 0.562685 | −0.92588 | 0.552379 | −0.75803 | 0.988193 | 0.552379 |
| 0.495637 | −0.87435 | 0.552379 | −0.70958 | 0.92233 | 0.552379 |
| 0.426338 | −0.81998 | 0.552379 | −0.65899 | 0.853741 | 0.552379 |
| 0.354788 | −0.76276 | 0.552379 | −0.60628 | 0.782428 | 0.552379 |
| 0.281224 | −0.70259 | 0.552379 | −0.55143 | 0.708509 | 0.552379 |
| 0.205883 | −0.63945 | 0.552379 | −0.49445 | 0.631866 | 0.552379 |
| 0.128884 | −0.57311 | 0.552379 | −0.4351 | 0.552734 | 0.552379 |
| 0.050464 | −0.50334 | 0.552379 | −0.37362 | 0.470997 | 0.552379 |
| −0.02677 | −0.4325 | 0.552379 | −0.31179 | 0.389496 | 0.552379 |
| −0.10247 | −0.36047 | 0.552379 | −0.24971 | 0.308233 | 0.552379 |
| −0.17686 | −0.28715 | 0.552379 | −0.1874 | 0.227088 | 0.552379 |
| −0.2496 | −0.2124 | 0.552379 | −0.12486 | 0.14618 | 0.552379 |
| −0.32079 | −0.13635 | 0.552379 | −0.06195 | 0.065508 | 0.552379 |
| −0.39021 | −0.05864 | 0.552379 | 0.001303 | −0.01481 | 0.552379 |
| −0.45785 | 0.020494 | 0.552379 | 0.064916 | −0.09489 | 0.552379 |
| −0.52371 | 0.101283 | 0.552379 | 0.129003 | −0.17473 | 0.552379 |
| −0.58756 | 0.18385 | 0.552379 | 0.193445 | −0.2541 | 0.552379 |
| −0.64952 | 0.268075 | 0.552379 | 0.258361 | −0.33311 | 0.552379 |
| −0.70946 | 0.354077 | 0.552379 | 0.32387 | −0.41165 | 0.552379 |
| −0.76537 | 0.438894 | 0.552379 | 0.387601 | −0.48723 | 0.552379 |
| −0.81761 | 0.522409 | 0.552379 | 0.449674 | −0.55984 | 0.552379 |
| −0.86594 | 0.604738 | 0.552379 | 0.509852 | −0.6295 | 0.552379 |
| −0.91048 | 0.685646 | 0.552379 | 0.568253 | −0.69631 | 0.552379 |
| −0.95183 | 0.764541 | 0.552379 | 0.62464 | −0.76016 | 0.552379 |
| −0.98914 | 0.841421 | 0.552379 | 0.67925 | −0.82116 | 0.552379 |
| −1.02267 | 0.91617 | 0.552379 | 0.731727 | −0.87945 | 0.552379 |
| −1.05311 | 0.98843 | 0.552379 | 0.779822 | −0.93252 | 0.552379 |
| −1.07882 | 1.054886 | 0.552379 | 0.823534 | −0.98026 | 0.552379 |
| −1.10026 | 1.115301 | 0.552379 | 0.862744 | −1.02302 | 0.552379 |
| −1.11779 | 1.169556 | 0.552379 | 0.897453 | −1.06057 | 0.552379 |
| −1.13248 | 1.220967 | 0.552379 | 0.92766 | −1.09315 | 0.552379 |
| −1.14231 | 1.266219 | 0.552379 | 0.953129 | −1.12063 | 0.552379 |
| −1.14646 | 1.30152 | 0.552379 | 0.974926 | −1.14409 | 0.552379 |
| −1.14598 | 1.32995 | 0.552379 | 0.993406 | −1.16375 | 0.552379 |
| −1.14219 | 1.351036 | 0.552379 | 1.00845 | −1.17998 | 0.552379 |
| −1.13591 | 1.365725 | 0.552379 | 1.020651 | −1.19289 | 0.552379 |
| −1.13058 | 1.372951 | 0.552379 | 1.028351 | −1.20403 | 0.552379 |
| −1.12632 | 1.376742 | 0.552379 | 1.030247 | −1.2141 | 0.552379 |
| −1.12383 | 1.378282 | 0.552379 | 1.029062 | −1.22263 | 0.552379 |
| −1.12265 | 1.378993 | 0.552379 | 1.026337 | −1.2289 | 0.552379 |
| 1.006199 | −1.26041 | 0.710405 | −1.12241 | 1.409911 | 0.710405 |
| 1.00229 | −1.26397 | 0.710405 | −1.12182 | 1.410148 | 0.710405 |
| 0.99613 | −1.2674 | 0.710405 | −1.12051 | 1.41074 | 0.710405 |
| 0.987483 | −1.2693 | 0.710405 | −1.11791 | 1.411688 | 0.710405 |
| 0.977058 | −1.268 | 0.710405 | −1.11246 | 1.412754 | 0.710405 |
| 0.965094 | −1.26065 | 0.710405 | −1.10369 | 1.412754 | 0.710405 |
| 0.950523 | −1.2494 | 0.710405 | −1.08853 | 1.408963 | 0.710405 |
| 0.93228 | −1.2353 | 0.710405 | −1.06993 | 1.399605 | 0.710405 |
| 0.910247 | −1.21824 | 0.710405 | −1.04778 | 1.383257 | 0.710405 |
| 0.883949 | −1.19775 | 0.710405 | −1.02278 | 1.359447 | 0.710405 |
| 0.853149 | −1.17382 | 0.710405 | −0.99317 | 1.325804 | 0.710405 |
| 0.8169 | −1.14551 | 0.710405 | −0.96118 | 1.285291 | 0.710405 |
| 0.775202 | −1.11269 | 0.710405 | −0.92778 | 1.241461 | 0.710405 |
| 0.727937 | −1.07538 | 0.710405 | −0.8907 | 1.191945 | 0.710405 |
| 0.675222 | −1.03356 | 0.710405 | −0.84995 | 1.136387 | 0.710405 |

TABLE 11-continued

| SUCTION SIDE | | | PRESSURE SIDE | | |
|---|---|---|---|---|---|
| X | Y | Z | X | Y | Z |
| 0.617295 | −0.98701 | 0.710405 | −0.80529 | 1.075143 | 0.710405 |
| 0.554037 | −0.93572 | 0.710405 | −0.75885 | 1.011056 | 0.710405 |
| 0.488411 | −0.88182 | 0.710405 | −0.7104 | 0.944008 | 0.710405 |
| 0.420415 | −0.82507 | 0.710405 | −0.66006 | 0.874235 | 0.710405 |
| 0.350286 | −0.76549 | 0.710405 | −0.60746 | 0.801737 | 0.710405 |
| 0.278026 | −0.70306 | 0.710405 | −0.55285 | 0.726515 | 0.710405 |
| 0.203988 | −0.63755 | 0.710405 | −0.49599 | 0.648687 | 0.710405 |
| 0.128174 | −0.56884 | 0.710405 | −0.43688 | 0.568253 | 0.710405 |
| 0.050819 | −0.4967 | 0.710405 | −0.37552 | 0.485094 | 0.710405 |
| −0.02523 | −0.42361 | 0.710405 | −0.3138 | 0.40229 | 0.710405 |
| −0.10022 | −0.34934 | 0.710405 | −0.25196 | 0.319605 | 0.710405 |
| −0.17378 | −0.27388 | 0.710405 | −0.18989 | 0.23692 | 0.710405 |
| −0.2458 | −0.19712 | 0.710405 | −0.12758 | 0.154472 | 0.710405 |
| −0.31641 | −0.11893 | 0.710405 | −0.06515 | 0.072142 | 0.710405 |
| −0.38535 | −0.03933 | 0.710405 | −0.00249 | −0.00995 | 0.710405 |
| −0.45264 | 0.041816 | 0.710405 | 0.060533 | −0.09169 | 0.710405 |
| −0.51814 | 0.124501 | 0.710405 | 0.123909 | −0.17331 | 0.710405 |
| −0.58176 | 0.208963 | 0.710405 | 0.187759 | −0.25457 | 0.710405 |
| −0.64359 | 0.294965 | 0.710405 | 0.251964 | −0.33548 | 0.710405 |
| −0.70365 | 0.382744 | 0.710405 | 0.316525 | −0.41603 | 0.710405 |
| −0.75992 | 0.469102 | 0.710405 | 0.379546 | −0.49362 | 0.710405 |
| −0.81228 | 0.553919 | 0.710405 | 0.440671 | −0.56813 | 0.710405 |
| −0.86073 | 0.636959 | 0.710405 | 0.500138 | −0.63968 | 0.710405 |
| −0.90551 | 0.717986 | 0.710405 | 0.55771 | −0.70827 | 0.710405 |
| −0.94673 | 0.79688 | 0.710405 | 0.613386 | −0.7739 | 0.710405 |
| −0.9844 | 0.873524 | 0.710405 | 0.667048 | −0.83668 | 0.710405 |
| −1.0184 | 0.948035 | 0.710405 | 0.718815 | −0.89674 | 0.710405 |
| −1.04932 | 1.020059 | 0.710405 | 0.766318 | −0.95135 | 0.710405 |
| −1.07562 | 1.086278 | 0.710405 | 0.809319 | −1.00051 | 0.710405 |
| −1.09765 | 1.146456 | 0.710405 | 0.848055 | −1.04458 | 0.710405 |
| −1.11577 | 1.200474 | 0.710405 | 0.882172 | −1.08332 | 0.710405 |
| −1.13117 | 1.251648 | 0.710405 | 0.911905 | −1.11684 | 0.710405 |
| −1.14172 | 1.296663 | 0.710405 | 0.937019 | −1.14515 | 0.710405 |
| −1.14622 | 1.331964 | 0.710405 | 0.958578 | −1.16932 | 0.710405 |
| −1.1461 | 1.360395 | 0.710405 | 0.976703 | −1.18958 | 0.710405 |
| −1.14255 | 1.381481 | 0.710405 | 0.991629 | −1.20628 | 0.710405 |
| −1.13639 | 1.396288 | 0.710405 | 1.003475 | −1.21966 | 0.710405 |
| −1.13106 | 1.403396 | 0.710405 | 1.011411 | −1.2308 | 0.710405 |
| −1.12679 | 1.407186 | 0.710405 | 1.013544 | −1.24111 | 0.710405 |
| −1.1243 | 1.408845 | 0.710405 | 1.012241 | −1.24975 | 0.710405 |
| −1.12312 | 1.409556 | 0.710405 | 1.009398 | −1.25615 | 0.710405 |
| 0.974334 | −1.34499 | 1.026574 | −1.10938 | 1.455992 | 1.026574 |
| 0.970187 | −1.34843 | 1.026574 | −1.10867 | 1.456229 | 1.026574 |
| 0.963672 | −1.35151 | 1.026574 | −1.10736 | 1.456821 | 1.026574 |
| 0.954788 | −1.35269 | 1.026456 | −1.10464 | 1.45765 | 1.026574 |
| 0.944363 | −1.35021 | 1.026574 | −1.09895 | 1.458598 | 1.026456 |
| 0.932991 | −1.34156 | 1.026574 | −1.09007 | 1.458006 | 1.026456 |
| 0.918776 | −1.32924 | 1.026574 | −1.07491 | 1.45303 | 1.026456 |
| 0.901125 | −1.31372 | 1.026574 | −1.05654 | 1.442251 | 1.026574 |
| 0.879684 | −1.295 | 1.026574 | −1.03475 | 1.424363 | 1.026456 |
| 0.854215 | −1.27262 | 1.026456 | −1.01023 | 1.399013 | 1.026574 |
| 0.824482 | −1.24644 | 1.026574 | −0.98132 | 1.363593 | 1.026456 |
| 0.789299 | −1.2154 | 1.026456 | −0.95005 | 1.321066 | 1.026574 |
| 0.748786 | −1.17951 | 1.026456 | −0.91747 | 1.275103 | 1.026574 |
| 0.70306 | −1.13876 | 1.026574 | −0.88134 | 1.223218 | 1.026456 |
| 0.652004 | −1.09315 | 1.026574 | −0.84142 | 1.165173 | 1.026574 |
| 0.595735 | −1.04245 | 1.026574 | −0.79783 | 1.101204 | 1.026456 |
| 0.534492 | −0.98653 | 1.026574 | −0.75234 | 1.034274 | 1.026574 |
| 0.47076 | −0.92802 | 1.026574 | −0.70496 | 0.964383 | 1.026456 |
| 0.404896 | −0.86653 | 1.026574 | −0.65544 | 0.891648 | 1.026574 |
| 0.336782 | −0.80209 | 1.026456 | −0.60391 | 0.816071 | 1.026574 |
| 0.266772 | −0.73469 | 1.026574 | −0.55025 | 0.73765 | 1.026574 |
| 0.194985 | −0.66421 | 1.026574 | −0.49433 | 0.656505 | 1.026574 |
| 0.12154 | −0.59052 | 1.026456 | −0.43617 | 0.572754 | 1.026574 |
| 0.046555 | −0.51341 | 1.026456 | −0.37576 | 0.48616 | 1.026574 |
| −0.02725 | −0.43546 | 1.026574 | −0.31499 | 0.399803 | 1.026574 |
| −0.09974 | −0.35656 | 1.026574 | −0.25398 | 0.313682 | 1.026574 |
| −0.17094 | −0.27649 | 1.026456 | −0.19273 | 0.22768 | 1.026574 |
| −0.24071 | −0.19546 | 1.026456 | −0.13137 | 0.141797 | 1.026456 |
| −0.30894 | −0.11325 | 1.026456 | −0.06989 | 0.056032 | 1.026456 |
| −0.37564 | −0.02985 | 1.026574 | −0.00829 | −0.02973 | 1.026574 |
| −0.44055 | 0.054847 | 1.026456 | 0.053662 | −0.11526 | 1.026456 |
| −0.50381 | 0.140967 | 1.026456 | 0.115854 | −0.20055 | 1.026574 |
| −0.56529 | 0.228391 | 1.026456 | 0.178282 | −0.28561 | 1.026456 |
| −0.62523 | 0.316999 | 1.026574 | 0.241185 | −0.37042 | 1.026574 |
| −0.6834 | 0.40691 | 1.026574 | 0.304442 | −0.455 | 1.026574 |

TABLE 11-continued

| SUCTION SIDE | | | PRESSURE SIDE | | |
|---|---|---|---|---|---|
| X | Y | Z | X | Y | Z |
| −0.73801 | 0.495044 | 1.026574 | 0.365804 | −0.53639 | 1.026456 |
| −0.78918 | 0.581402 | 1.026574 | 0.425508 | −0.61481 | 1.026574 |
| −0.83692 | 0.665982 | 1.026574 | 0.483435 | −0.69015 | 1.026574 |
| −0.88122 | 0.748549 | 1.026456 | 0.539467 | −0.76253 | 1.026574 |
| −0.92257 | 0.828983 | 1.026456 | 0.593603 | −0.83183 | 1.026456 |
| −0.96059 | 0.907522 | 1.026574 | 0.645844 | −0.89816 | 1.026574 |
| −0.99542 | 0.98381 | 1.026456 | 0.696189 | −0.96166 | 1.026574 |
| −1.02717 | 1.057374 | 1.026574 | 0.74227 | −1.01935 | 1.026574 |
| −1.05453 | 1.125015 | 1.026574 | 0.784087 | −1.07159 | 1.026574 |
| −1.07763 | 1.186377 | 1.026574 | 0.821639 | −1.11814 | 1.026456 |
| −1.09694 | 1.241461 | 1.026574 | 0.854807 | −1.15925 | 1.026574 |
| −1.11352 | 1.293583 | 1.026574 | 0.883593 | −1.19479 | 1.026456 |
| −1.12501 | 1.339546 | 1.026574 | 0.907996 | −1.22488 | 1.026574 |
| −1.13058 | 1.375439 | 1.026574 | 0.928845 | −1.25046 | 1.026456 |
| −1.13141 | 1.40458 | 1.026574 | 0.946495 | −1.27202 | 1.026456 |
| −1.12869 | 1.426258 | 1.026574 | 0.960948 | −1.28979 | 1.026574 |
| −1.12312 | 1.441777 | 1.026574 | 0.972557 | −1.30389 | 1.026574 |
| −1.11803 | 1.44924 | 1.026456 | 0.980493 | −1.3155 | 1.026456 |
| −1.11376 | 1.453267 | 1.026574 | 0.982389 | −1.32592 | 1.026456 |
| −1.11127 | 1.454926 | 1.026574 | 0.980967 | −1.33457 | 1.026456 |
| −1.10997 | 1.455636 | 1.026574 | 0.977769 | −1.34085 | 1.026574 |
| 0.93844 | −1.46263 | 1.342626 | −1.09362 | 1.475301 | 1.342626 |
| 0.934057 | −1.46582 | 1.342626 | −1.09291 | 1.475656 | 1.342626 |
| 0.927186 | −1.46843 | 1.342626 | −1.09161 | 1.47613 | 1.342626 |
| 0.918065 | −1.4689 | 1.342626 | −1.08877 | 1.476959 | 1.342626 |
| 0.907877 | −1.46523 | 1.342626 | −1.08296 | 1.477552 | 1.342626 |
| 0.896979 | −1.4554 | 1.342626 | −1.07384 | 1.476249 | 1.342626 |
| 0.883356 | −1.44201 | 1.342626 | −1.0588 | 1.470089 | 1.342626 |
| 0.866298 | −1.42531 | 1.342626 | −1.04079 | 1.457887 | 1.342626 |
| 0.845567 | −1.40505 | 1.342626 | −1.01947 | 1.43846 | 1.342626 |
| 0.821046 | −1.38089 | 1.342626 | −0.99542 | 1.411332 | 1.342626 |
| 0.79226 | −1.35258 | 1.342626 | −0.96734 | 1.373899 | 1.342626 |
| 0.758381 | −1.31893 | 1.342626 | −0.93702 | 1.329358 | 1.342626 |
| 0.719289 | −1.2802 | 1.342626 | −0.90551 | 1.281145 | 1.342626 |
| 0.675104 | −1.23625 | 1.342626 | −0.87044 | 1.226653 | 1.342626 |
| 0.625824 | −1.18697 | 1.342626 | −0.83171 | 1.166002 | 1.342626 |
| 0.571451 | −1.13224 | 1.342626 | −0.7893 | 1.099072 | 1.342626 |
| 0.512221 | −1.07218 | 1.342626 | −0.74511 | 1.02918 | 1.342626 |
| 0.45074 | −1.00916 | 1.342626 | −0.69891 | 0.956209 | 1.342626 |
| 0.387127 | −0.94306 | 1.342626 | −0.6507 | 0.880158 | 1.342626 |
| 0.321382 | −0.87412 | 1.342626 | −0.60036 | 0.801263 | 1.342626 |
| 0.253623 | −0.80197 | 1.342626 | −0.548 | 0.719526 | 1.342626 |
| 0.184205 | −0.72652 | 1.342626 | −0.49339 | 0.634827 | 1.342626 |
| 0.113248 | −0.64786 | 1.342626 | −0.43641 | 0.547285 | 1.342626 |
| 0.04075 | −0.56576 | 1.342626 | −0.3773 | 0.457019 | 1.342626 |
| −0.03068 | −0.48272 | 1.342626 | −0.31771 | 0.366871 | 1.342626 |
| −0.10081 | −0.39897 | 1.342626 | −0.25789 | 0.277078 | 1.342626 |
| −0.16963 | −0.31416 | 1.342626 | −0.19771 | 0.187404 | 1.342626 |
| −0.23716 | −0.22839 | 1.342626 | −0.13741 | 0.097848 | 1.342626 |
| −0.30326 | −0.14156 | 1.342626 | −0.077 | 0.008292 | 1.342626 |
| −0.36782 | −0.05354 | 1.342626 | −0.01658 | −0.08115 | 1.342626 |
| −0.43084 | 0.035538 | 1.342626 | 0.044186 | −0.17046 | 1.342626 |
| −0.4922 | 0.125805 | 1.342626 | 0.105074 | −0.25966 | 1.342626 |
| −0.55202 | 0.217256 | 1.342626 | 0.166199 | −0.34863 | 1.342626 |
| −0.61042 | 0.309773 | 1.342626 | 0.227562 | −0.43747 | 1.342626 |
| −0.6674 | 0.403356 | 1.342626 | 0.289279 | −0.52608 | 1.342626 |
| −0.72095 | 0.494926 | 1.342626 | 0.349102 | −0.61161 | 1.342626 |
| −0.77117 | 0.584363 | 1.342626 | 0.407265 | −0.69394 | 1.342626 |
| −0.8182 | 0.67155 | 1.342626 | 0.463534 | −0.77319 | 1.342626 |
| −0.86203 | 0.756722 | 1.342626 | 0.517907 | −0.84924 | 1.342626 |
| −0.9029 | 0.839408 | 1.342626 | 0.570503 | −0.92233 | 1.342626 |
| −0.94069 | 0.919487 | 1.342626 | 0.621204 | −0.99234 | 1.342626 |
| −0.97528 | 0.996959 | 1.342626 | 0.669891 | −1.05927 | 1.342626 |
| −1.00703 | 1.071708 | 1.342626 | 0.714551 | −1.12028 | 1.342626 |
| −1.03463 | 1.140178 | 1.342626 | 0.754946 | −1.17536 | 1.342626 |
| −1.05808 | 1.202369 | 1.342626 | 0.791313 | −1.22464 | 1.342626 |
| −1.07787 | 1.258045 | 1.342626 | 0.823415 | −1.268 | 1.342626 |
| −1.09493 | 1.310641 | 1.342626 | 0.851254 | −1.30567 | 1.342626 |
| −1.10689 | 1.357078 | 1.342626 | 0.874827 | −1.33741 | 1.342626 |
| −1.11293 | 1.393445 | 1.342626 | 0.895084 | −1.36454 | 1.342626 |
| −1.11447 | 1.422942 | 1.342626 | 0.912142 | −1.38729 | 1.342626 |
| −1.11222 | 1.444857 | 1.342626 | 0.92612 | −1.406 | 1.342626 |
| −1.10725 | 1.46073 | 1.342626 | 0.937492 | −1.42093 | 1.342626 |
| −1.10239 | 1.468549 | 1.342626 | 0.945429 | −1.43289 | 1.342626 |
| −1.09812 | 1.472695 | 1.342626 | 0.947325 | −1.44344 | 1.342626 |
| −1.09564 | 1.474353 | 1.342626 | 0.945548 | −1.4522 | 1.342626 |

TABLE 11-continued

| SUCTION SIDE | | | PRESSURE SIDE | | |
|---|---|---|---|---|---|
| X | Y | Z | X | Y | Z |
| −1.09433 | 1.475064 | 1.342626 | 0.942112 | −1.4586 | 1.342626 |
| 0.905508 | −1.59708 | 1.658677 | −1.07609 | 1.461559 | 1.658677 |
| 0.90077 | −1.60016 | 1.658677 | −1.07538 | 1.461796 | 1.658677 |
| 0.893781 | −1.60241 | 1.658677 | −1.07396 | 1.462389 | 1.658677 |
| 0.884422 | −1.60229 | 1.658677 | −1.07112 | 1.462981 | 1.658677 |
| 0.874472 | −1.59755 | 1.658677 | −1.06507 | 1.463218 | 1.658677 |
| 0.864047 | −1.58677 | 1.658677 | −1.05595 | 1.461204 | 1.658677 |
| 0.85078 | −1.57267 | 1.658677 | −1.04103 | 1.453623 | 1.658677 |
| 0.834195 | −1.55502 | 1.658677 | −1.02361 | 1.440118 | 1.658677 |
| 0.814057 | −1.53346 | 1.658677 | −1.00288 | 1.419151 | 1.658677 |
| 0.790128 | −1.50776 | 1.658677 | −0.97966 | 1.390483 | 1.658677 |
| 0.762172 | −1.47779 | 1.658677 | −0.95254 | 1.351273 | 1.658677 |
| 0.72924 | −1.44225 | 1.658677 | −0.92351 | 1.3046 | 1.658677 |
| 0.691214 | −1.40114 | 1.658677 | −0.89331 | 1.254254 | 1.658677 |
| 0.648332 | −1.35447 | 1.658677 | −0.85955 | 1.197394 | 1.658677 |
| 0.600474 | −1.30223 | 1.658677 | −0.82235 | 1.134255 | 1.658677 |
| 0.547759 | −1.2443 | 1.658677 | −0.78148 | 1.0646 | 1.658677 |
| 0.490187 | −1.18069 | 1.658677 | −0.73872 | 0.991747 | 1.658677 |
| 0.430602 | −1.114 | 1.658677 | −0.69406 | 0.915933 | 1.658677 |
| 0.368884 | −1.04411 | 1.658677 | −0.64738 | 0.83692 | 1.658677 |
| 0.305153 | −0.97114 | 1.658677 | −0.5987 | 0.754946 | 1.658677 |
| 0.239645 | −0.89485 | 1.658677 | −0.54776 | 0.669891 | 1.658677 |
| 0.172478 | −0.81524 | 1.658677 | −0.49469 | 0.581994 | 1.658677 |
| 0.103653 | −0.7322 | 1.658677 | −0.43925 | 0.491135 | 1.658677 |
| 0.033524 | −0.64561 | 1.658677 | −0.38156 | 0.397315 | 1.658677 |
| −0.03554 | −0.5583 | 1.658677 | −0.32351 | 0.30385 | 1.658677 |
| −0.10342 | −0.47005 | 1.658677 | −0.265 | 0.210622 | 1.658677 |
| −0.16999 | −0.38109 | 1.658677 | −0.206 | 0.117631 | 1.658677 |
| −0.23538 | −0.29106 | 1.658677 | −0.14701 | 0.024758 | 1.658677 |
| −0.29923 | −0.2002 | 1.658677 | −0.08778 | −0.06811 | 1.658677 |
| −0.36166 | −0.10815 | 1.658677 | −0.02843 | −0.16087 | 1.658677 |
| −0.42267 | −0.01516 | 1.658677 | 0.031037 | −0.2535 | 1.658677 |
| −0.48213 | 0.078894 | 1.658677 | 0.090622 | −0.34602 | 1.658677 |
| −0.5403 | 0.173899 | 1.658677 | 0.150563 | −0.43842 | 1.658677 |
| −0.59704 | 0.269852 | 1.658677 | 0.210622 | −0.53058 | 1.658677 |
| −0.65248 | 0.366634 | 1.658677 | 0.270918 | −0.62274 | 1.658677 |
| −0.70484 | 0.461165 | 1.658677 | 0.329437 | −0.71159 | 1.658677 |
| −0.754 | 0.553445 | 1.658677 | 0.38618 | −0.79724 | 1.658677 |
| −0.80008 | 0.643238 | 1.658677 | 0.441145 | −0.87968 | 1.658677 |
| −0.8432 | 0.730543 | 1.658677 | 0.494334 | −0.95893 | 1.658677 |
| −0.88324 | 0.815005 | 1.658677 | 0.545627 | −1.03499 | 1.658677 |
| −0.92043 | 0.896742 | 1.658677 | 0.595143 | −1.10784 | 1.658677 |
| −0.95479 | 0.975637 | 1.658677 | 0.642646 | −1.17749 | 1.658677 |
| −0.98642 | 1.051688 | 1.658677 | 0.686239 | −1.24111 | 1.658677 |
| −1.0139 | 1.121342 | 1.658677 | 0.725804 | −1.29844 | 1.658677 |
| −1.03759 | 1.184363 | 1.658677 | 0.761342 | −1.34985 | 1.658677 |
| −1.05761 | 1.240869 | 1.658677 | 0.792734 | −1.39498 | 1.658677 |
| −1.07491 | 1.294176 | 1.658677 | 0.819862 | −1.4342 | 1.658677 |
| −1.08734 | 1.341323 | 1.658677 | 0.842961 | −1.46736 | 1.658677 |
| −1.09374 | 1.378164 | 1.658677 | 0.862744 | −1.49556 | 1.658677 |
| −1.09576 | 1.408016 | 1.658677 | 0.879329 | −1.51937 | 1.658677 |
| −1.0941 | 1.430286 | 1.658677 | 0.893188 | −1.5388 | 1.658677 |
| −1.08948 | 1.446515 | 1.658677 | 0.904205 | −1.55431 | 1.658677 |
| −1.08486 | 1.45457 | 1.658677 | 0.912379 | −1.56652 | 1.658677 |
| −1.08059 | 1.458835 | 1.658677 | 0.914748 | −1.57729 | 1.658677 |
| −1.0781 | 1.460493 | 1.658677 | 0.91309 | −1.58653 | 1.658677 |
| −1.0768 | 1.461204 | 1.658677 | 0.909417 | −1.59305 | 1.658677 |
| 0.870326 | −1.70535 | 1.974728 | −1.06069 | 1.414412 | 1.974728 |
| 0.865469 | −1.70831 | 1.974728 | −1.05998 | 1.414768 | 1.974728 |
| 0.858361 | −1.71033 | 1.974728 | −1.05856 | 1.415123 | 1.974728 |
| 0.84924 | −1.70973 | 1.974728 | −1.0556 | 1.415715 | 1.974728 |
| 0.839526 | −1.70452 | 1.974728 | −1.04956 | 1.415479 | 1.974728 |
| 0.829338 | −1.6935 | 1.974728 | −1.04055 | 1.412872 | 1.974728 |
| 0.816426 | −1.67893 | 1.974728 | −1.02598 | 1.404343 | 1.974728 |
| 0.800079 | −1.66081 | 1.974728 | −1.00916 | 1.389891 | 1.974728 |
| 0.780414 | −1.63866 | 1.974728 | −0.98926 | 1.367858 | 1.974728 |
| 0.756959 | −1.61236 | 1.974728 | −0.96699 | 1.338124 | 1.974728 |
| 0.729595 | −1.58156 | 1.974728 | −0.94105 | 1.297848 | 1.974728 |
| 0.697256 | −1.54507 | 1.974728 | −0.91321 | 1.24999 | 1.974728 |
| 0.660059 | −1.5029 | 1.974728 | −0.88454 | 1.198341 | 1.974728 |
| 0.618124 | −1.45493 | 1.974728 | −0.85232 | 1.140178 | 1.974728 |
| 0.571333 | −1.40126 | 1.974728 | −0.81678 | 1.07538 | 1.974728 |
| 0.519802 | −1.34168 | 1.974728 | −0.77769 | 1.004185 | 1.974728 |
| 0.463652 | −1.27629 | 1.974728 | −0.7367 | 0.929793 | 1.974728 |
| 0.405489 | −1.20758 | 1.974728 | −0.69382 | 0.852201 | 1.974728 |
| 0.345311 | −1.13579 | 1.974728 | −0.64892 | 0.77153 | 1.974728 |

TABLE 11-continued

| SUCTION SIDE | | | PRESSURE SIDE | | |
|---|---|---|---|---|---|
| X | Y | Z | X | Y | Z |
| 0.283356 | −1.06069 | 1.974728 | −0.60201 | 0.687897 | 1.974728 |
| 0.219625 | −0.98215 | 1.974728 | −0.55285 | 0.601066 | 1.974728 |
| 0.154353 | −0.9003 | 1.974728 | −0.50144 | 0.511273 | 1.974728 |
| 0.08766 | −0.81489 | 1.974728 | −0.4479 | 0.418638 | 1.974728 |
| 0.019664 | −0.72592 | 1.974728 | −0.39198 | 0.322922 | 1.974728 |
| −0.04727 | −0.63613 | 1.974728 | −0.33548 | 0.22768 | 1.974728 |
| −0.11289 | −0.54563 | 1.974728 | −0.27862 | 0.132557 | 1.974728 |
| −0.17733 | −0.45418 | 1.974728 | −0.22116 | 0.037907 | 1.974728 |
| −0.24036 | −0.3619 | 1.974728 | −0.16336 | −0.05662 | 1.974728 |
| −0.30207 | −0.26867 | 1.974728 | −0.10543 | −0.15104 | 1.974728 |
| −0.36237 | −0.17449 | 1.974728 | −0.04738 | −0.24533 | 1.974728 |
| −0.42113 | −0.07937 | 1.974728 | 0.010898 | −0.33962 | 1.974728 |
| −0.47858 | 0.016703 | 1.974728 | 0.069299 | −0.43368 | 1.974728 |
| −0.53497 | 0.113485 | 1.974728 | 0.127937 | −0.52762 | 1.974728 |
| −0.58993 | 0.211096 | 1.974728 | 0.186811 | −0.62156 | 1.974728 |
| −0.64383 | 0.309654 | 1.974728 | 0.246041 | −0.71526 | 1.974728 |
| −0.69453 | 0.405726 | 1.974728 | 0.303376 | −0.80565 | 1.974728 |
| −0.74227 | 0.49919 | 1.974728 | 0.359052 | −0.89271 | 1.974728 |
| −0.78717 | 0.590168 | 1.974728 | 0.41307 | −0.97658 | 1.974728 |
| −0.8291 | 0.67842 | 1.974728 | 0.465192 | −1.05714 | 1.974728 |
| −0.86831 | 0.763712 | 1.974728 | 0.515656 | −1.13449 | 1.974728 |
| −0.90468 | 0.846278 | 1.974728 | 0.564225 | −1.20865 | 1.974728 |
| −0.93844 | 0.925765 | 1.974728 | 0.611017 | −1.27949 | 1.974728 |
| −0.96948 | 1.002409 | 1.974728 | 0.653899 | −1.34417 | 1.974728 |
| −0.99672 | 1.072418 | 1.974728 | 0.692873 | −1.40245 | 1.974728 |
| −1.0203 | 1.135794 | 1.974728 | 0.727818 | −1.45469 | 1.974728 |
| −1.04032 | 1.192537 | 1.974728 | 0.758736 | −1.50065 | 1.974728 |
| −1.05761 | 1.246199 | 1.974728 | 0.785508 | −1.54045 | 1.974728 |
| −1.07005 | 1.293346 | 1.974728 | 0.808253 | −1.5741 | 1.974728 |
| −1.0768 | 1.330306 | 1.974728 | 0.827798 | −1.60276 | 1.974728 |
| −1.07905 | 1.360276 | 1.974728 | 0.844146 | −1.62693 | 1.974728 |
| −1.07787 | 1.382784 | 1.974728 | 0.857769 | −1.64671 | 1.974728 |
| −1.07384 | 1.399131 | 1.974728 | 0.868667 | −1.66259 | 1.974728 |
| −1.06934 | 1.407423 | 1.974728 | 0.876841 | −1.67479 | 1.974728 |
| −1.06519 | 1.411806 | 1.974728 | 0.879566 | −1.68557 | 1.974728 |
| −1.0627 | 1.413465 | 1.974728 | 0.878026 | −1.69481 | 1.974728 |
| −1.0614 | 1.414175 | 1.974728 | 0.874235 | −1.70132 | 1.974728 |
| 0.835972 | −1.77465 | 2.290779 | −1.046 | 1.336821 | 2.290779 |
| 0.831234 | −1.77749 | 2.290779 | −1.04529 | 1.337176 | 2.290779 |
| 0.824126 | −1.77939 | 2.290779 | −1.04387 | 1.337532 | 2.290779 |
| 0.815005 | −1.77868 | 2.290779 | −1.04091 | 1.337887 | 2.290779 |
| 0.805528 | −1.77323 | 2.290779 | −1.03499 | 1.337413 | 2.290779 |
| 0.795696 | −1.76209 | 2.290779 | −1.02622 | 1.334452 | 2.290779 |
| 0.782902 | −1.74764 | 2.290779 | −1.01212 | 1.325449 | 2.290779 |
| 0.76691 | −1.72952 | 2.290779 | −0.99589 | 1.310523 | 2.290779 |
| 0.747483 | −1.70748 | 2.290779 | −0.9767 | 1.288134 | 2.290779 |
| 0.724501 | −1.68118 | 2.290779 | −0.95538 | 1.258282 | 2.290779 |
| 0.697611 | −1.6505 | 2.290779 | −0.93038 | 1.217887 | 2.290779 |
| 0.665982 | −1.61402 | 2.290779 | −0.90373 | 1.169911 | 2.290779 |
| 0.629496 | −1.57196 | 2.290779 | −0.87637 | 1.118262 | 2.290779 |
| 0.588272 | −1.52411 | 2.290779 | −0.84569 | 1.05998 | 2.290779 |
| 0.54231 | −1.47056 | 2.290779 | −0.81169 | 0.995064 | 2.290779 |
| 0.491846 | −1.4111 | 2.290779 | −0.77437 | 0.923751 | 2.290779 |
| 0.43688 | −1.34571 | 2.290779 | −0.73504 | 0.849358 | 2.290779 |
| 0.38002 | −1.27712 | 2.290779 | −0.69394 | 0.771767 | 2.290779 |
| 0.321145 | −1.20533 | 2.290779 | −0.65082 | 0.691096 | 2.290779 |
| 0.260612 | −1.13023 | 2.290779 | −0.60557 | 0.607344 | 2.290779 |
| 0.198421 | −1.05181 | 2.290779 | −0.5583 | 0.520632 | 2.290779 |
| 0.134807 | −0.96995 | 2.290779 | −0.50879 | 0.430957 | 2.290779 |
| 0.069773 | −0.88454 | 2.290779 | −0.4569 | 0.338322 | 2.290779 |
| 0.003672 | −0.79546 | 2.290779 | −0.40276 | 0.242725 | 2.290779 |
| −0.06136 | −0.70567 | 2.290779 | −0.34804 | 0.147601 | 2.290779 |
| −0.12509 | −0.61504 | 2.290779 | −0.29283 | 0.052715 | 2.290779 |
| −0.18752 | −0.52347 | 2.290779 | −0.23692 | −0.0417 | 2.290779 |
| −0.24865 | −0.43119 | 2.290779 | −0.18053 | −0.13587 | 2.290779 |
| −0.30823 | −0.33785 | 2.290779 | −0.12379 | −0.22981 | 2.290779 |
| −0.3664 | −0.24355 | 2.290779 | −0.06693 | −0.32375 | 2.290779 |
| −0.42326 | −0.14843 | 2.290779 | −0.00995 | −0.41757 | 2.290779 |
| −0.47893 | −0.05248 | 2.290779 | 0.047266 | −0.51127 | 2.290779 |
| −0.53343 | 0.044186 | 2.290779 | 0.104719 | −0.60474 | 2.290779 |
| −0.58673 | 0.141678 | 2.290779 | 0.16229 | −0.6982 | 2.290779 |
| −0.63885 | 0.239882 | 2.290779 | 0.220217 | −0.79143 | 2.290779 |
| −0.68802 | 0.335716 | 2.290779 | 0.276604 | −0.88134 | 2.290779 |
| −0.73445 | 0.428825 | 2.290779 | 0.331214 | −0.96806 | 2.290779 |
| −0.77793 | 0.519329 | 2.290779 | 0.384166 | −1.05145 | 2.290779 |
| −0.81868 | 0.606989 | 2.290779 | 0.435459 | −1.13153 | 2.290779 |

TABLE 11-continued

| SUCTION SIDE | | | PRESSURE SIDE | | |
|---|---|---|---|---|---|
| X | Y | Z | X | Y | Z |
| −0.85682 | 0.691806 | 2.290779 | 0.485094 | −1.20841 | 2.290779 |
| −0.89224 | 0.773781 | 2.290779 | 0.532952 | −1.28209 | 2.290779 |
| −0.92517 | 0.852675 | 2.290779 | 0.579151 | −1.35246 | 2.290779 |
| −0.95562 | 0.928608 | 2.290779 | 0.621441 | −1.41654 | 2.290779 |
| −0.98239 | 0.998026 | 2.290779 | 0.659822 | −1.47447 | 2.290779 |
| −1.00549 | 1.060809 | 2.290779 | 0.694413 | −1.52624 | 2.290779 |
| −1.02527 | 1.116959 | 2.290779 | 0.724975 | −1.57185 | 2.290779 |
| −1.04221 | 1.170148 | 2.290779 | 0.75151 | −1.61129 | 2.290779 |
| −1.05441 | 1.21694 | 2.290779 | 0.774018 | −1.6447 | 2.290779 |
| −1.06105 | 1.253544 | 2.290779 | 0.793327 | −1.67313 | 2.290779 |
| −1.06353 | 1.283159 | 2.290779 | 0.809556 | −1.69706 | 2.290779 |
| −1.06259 | 1.305429 | 2.290779 | 0.82306 | −1.71672 | 2.290779 |
| −1.0588 | 1.321658 | 2.290779 | 0.83384 | −1.73236 | 2.290779 |
| −1.05453 | 1.32995 | 2.290779 | 0.842014 | −1.74444 | 2.290779 |
| −1.0505 | 1.334333 | 2.290779 | 0.844975 | −1.7551 | 2.290779 |
| −1.04802 | 1.335873 | 2.290779 | 0.843554 | −1.76422 | 2.290779 |
| −1.04671 | 1.336584 | 2.290779 | 0.839881 | −1.77062 | 2.290779 |
| 0.806713 | −1.80829 | 2.606831 | −1.02432 | 1.236249 | 2.606831 |
| 0.802093 | −1.81113 | 2.606831 | −1.02361 | 1.236485 | 2.606831 |
| 0.795222 | −1.81303 | 2.606831 | −1.02219 | 1.236841 | 2.606831 |
| 0.786337 | −1.8122 | 2.606831 | −1.01935 | 1.237196 | 2.606831 |
| 0.777098 | −1.80687 | 2.606831 | −1.01354 | 1.236604 | 2.606831 |
| 0.767265 | −1.79621 | 2.606831 | −1.00501 | 1.233406 | 2.606831 |
| 0.754709 | −1.78211 | 2.606831 | −0.99151 | 1.224403 | 2.606831 |
| 0.738953 | −1.76446 | 2.606831 | −0.97587 | 1.209595 | 2.606831 |
| 0.719881 | −1.74302 | 2.606831 | −0.95728 | 1.187562 | 2.606831 |
| 0.697256 | −1.71755 | 2.606831 | −0.93666 | 1.158183 | 2.606831 |
| 0.670839 | −1.68758 | 2.606831 | −0.9125 | 1.118499 | 2.606831 |
| 0.639684 | −1.65216 | 2.606831 | −0.88679 | 1.071471 | 2.606831 |
| 0.603791 | −1.61117 | 2.606831 | −0.86049 | 1.020651 | 2.606831 |
| 0.563277 | −1.56462 | 2.606831 | −0.83123 | 0.963317 | 2.606831 |
| 0.518263 | −1.51226 | 2.606831 | −0.79878 | 0.899585 | 2.606831 |
| 0.468628 | −1.45433 | 2.606831 | −0.76288 | 0.829575 | 2.606831 |
| 0.414728 | −1.39048 | 2.606831 | −0.72533 | 0.756367 | 2.606831 |
| 0.358934 | −1.32355 | 2.606831 | −0.68588 | 0.680197 | 2.606831 |
| 0.301362 | −1.25354 | 2.606831 | −0.64442 | 0.600829 | 2.606831 |
| 0.242014 | −1.1801 | 2.606831 | −0.60107 | 0.518618 | 2.606831 |
| 0.181244 | −1.10357 | 2.606831 | −0.55546 | 0.433445 | 2.606831 |
| 0.118934 | −1.02349 | 2.606831 | −0.50784 | 0.345429 | 2.606831 |
| 0.055439 | −0.93998 | 2.606831 | −0.45785 | 0.254571 | 2.606831 |
| −0.00912 | −0.85291 | 2.606831 | −0.40549 | 0.160869 | 2.606831 |
| −0.07238 | −0.76501 | 2.606831 | −0.35254 | 0.067641 | 2.606831 |
| −0.13433 | −0.67617 | 2.606831 | −0.29899 | −0.02535 | 2.606831 |
| −0.19499 | −0.58661 | 2.606831 | −0.24486 | −0.11787 | 2.606831 |
| −0.25398 | −0.49587 | 2.606831 | −0.19001 | −0.20991 | 2.606831 |
| −0.31155 | −0.4043 | 2.606831 | −0.13457 | −0.30172 | 2.606831 |
| −0.36758 | −0.31167 | 2.606831 | −0.07901 | −0.39341 | 2.606831 |
| −0.42243 | −0.21832 | 2.606831 | −0.02334 | −0.48509 | 2.606831 |
| −0.47621 | −0.12426 | 2.606831 | 0.03234 | −0.57666 | 2.606831 |
| −0.52881 | −0.0295 | 2.606831 | 0.088371 | −0.66811 | 2.606831 |
| −0.58034 | 0.065982 | 2.606831 | 0.144521 | −0.75945 | 2.606831 |
| −0.63068 | 0.16229 | 2.606831 | 0.201145 | −0.85054 | 2.606831 |
| −0.67807 | 0.256111 | 2.606831 | 0.256111 | −0.93844 | 2.606831 |
| −0.72284 | 0.347443 | 2.606831 | 0.309536 | −1.02314 | 2.606831 |
| −0.7649 | 0.436051 | 2.606831 | 0.361421 | −1.10452 | 2.606831 |
| −0.80434 | 0.521935 | 2.606831 | 0.411767 | −1.1827 | 2.606831 |
| −0.84118 | 0.605094 | 2.606831 | 0.460454 | −1.25757 | 2.606831 |
| −0.87542 | 0.685291 | 2.606831 | 0.507483 | −1.32936 | 2.606831 |
| −0.9074 | 0.762527 | 2.606831 | 0.552971 | −1.39795 | 2.606831 |
| −0.9369 | 0.836801 | 2.606831 | 0.594669 | −1.46037 | 2.606831 |
| −0.96284 | 0.904679 | 2.606831 | 0.632576 | −1.51676 | 2.606831 |
| −0.98535 | 0.96616 | 2.606831 | 0.666693 | −1.56711 | 2.606831 |
| −1.00454 | 1.021125 | 2.606831 | 0.696782 | −1.61141 | 2.606831 |
| −1.02089 | 1.073129 | 2.606831 | 0.72308 | −1.64979 | 2.606831 |
| −1.0325 | 1.118855 | 2.606831 | 0.74535 | −1.68213 | 2.606831 |
| −1.03889 | 1.15463 | 2.606831 | 0.764422 | −1.70985 | 2.606831 |
| −1.04126 | 1.183652 | 2.606831 | 0.780533 | −1.73307 | 2.606831 |
| −1.04032 | 1.205449 | 2.606831 | 0.7938 | −1.75214 | 2.606831 |
| −1.03676 | 1.221323 | 2.606831 | 0.804462 | −1.7673 | 2.606831 |
| −1.03273 | 1.229378 | 2.606831 | 0.812636 | −1.77915 | 2.606831 |
| −1.02871 | 1.233761 | 2.606831 | 0.815479 | −1.78946 | 2.606831 |
| −1.02634 | 1.235301 | 2.606831 | 0.814057 | −1.79822 | 2.606831 |
| −1.02503 | 1.236012 | 2.606831 | 0.810622 | −1.8045 | 2.606831 |
| 0.771648 | −1.78732 | 2.922882 | −1.00762 | 1.149773 | 2.922882 |
| 0.767265 | −1.79017 | 2.922882 | −1.00691 | 1.15001 | 2.922882 |
| 0.760513 | −1.79218 | 2.922882 | −1.00561 | 1.150365 | 2.922882 |

TABLE 11-continued

| SUCTION SIDE | | | PRESSURE SIDE | | |
|---|---|---|---|---|---|
| X | Y | Z | X | Y | Z |
| 0.751747 | −1.79159 | 2.922882 | −1.00276 | 1.15072 | 2.922882 |
| 0.742626 | −1.78661 | 2.922882 | −0.9972 | 1.150128 | 2.922882 |
| 0.73303 | −1.77631 | 2.922882 | −0.98902 | 1.14693 | 2.922882 |
| 0.720474 | −1.76304 | 2.922882 | −0.97599 | 1.138045 | 2.922882 |
| 0.704955 | −1.74622 | 2.922882 | −0.96107 | 1.123593 | 2.922882 |
| 0.68612 | −1.72584 | 2.922882 | −0.9433 | 1.102152 | 2.922882 |
| 0.663731 | −1.70156 | 2.922882 | −0.92351 | 1.07384 | 2.922882 |
| 0.637552 | −1.67313 | 2.922882 | −0.90018 | 1.035577 | 2.922882 |
| 0.606752 | −1.63937 | 2.922882 | −0.8753 | 0.990089 | 2.922882 |
| 0.571333 | −1.60039 | 2.922882 | −0.85007 | 0.940928 | 2.922882 |
| 0.531412 | −1.55597 | 2.922882 | −0.82188 | 0.885489 | 2.922882 |
| 0.486989 | −1.5061 | 2.922882 | −0.7906 | 0.823771 | 2.922882 |
| 0.438302 | −1.45066 | 2.922882 | −0.75625 | 0.756012 | 2.922882 |
| 0.385232 | −1.38965 | 2.922882 | −0.72 | 0.685173 | 2.922882 |
| 0.330503 | −1.32545 | 2.922882 | −0.68197 | 0.611372 | 2.922882 |
| 0.273998 | −1.25828 | 2.922882 | −0.64217 | 0.534728 | 2.922882 |
| 0.216071 | −1.1878 | 2.922882 | −0.60024 | 0.455242 | 2.922882 |
| 0.156723 | −1.11412 | 2.922882 | −0.55629 | 0.372912 | 2.922882 |
| 0.096071 | −1.03712 | 2.922882 | −0.51021 | 0.287858 | 2.922882 |
| 0.034235 | −0.95668 | 2.922882 | −0.46199 | 0.200079 | 2.922882 |
| −0.02843 | −0.87269 | 2.922882 | −0.41141 | 0.109576 | 2.922882 |
| −0.08967 | −0.78776 | 2.922882 | −0.36012 | 0.019427 | 2.922882 |
| −0.14973 | −0.70199 | 2.922882 | −0.30823 | −0.07037 | 2.922882 |
| −0.20837 | −0.61528 | 2.922882 | −0.25564 | −0.1598 | 2.922882 |
| −0.26535 | −0.52762 | 2.922882 | −0.20233 | −0.24865 | 2.922882 |
| −0.32079 | −0.43889 | 2.922882 | −0.14843 | −0.33726 | 2.922882 |
| −0.37493 | −0.34934 | 2.922882 | −0.09418 | −0.42563 | 2.922882 |
| −0.428 | −0.25895 | 2.922882 | −0.03968 | −0.51388 | 2.922882 |
| −0.47988 | −0.16798 | 2.922882 | 0.014808 | −0.60201 | 2.922882 |
| −0.5307 | −0.07617 | 2.922882 | 0.069536 | −0.69003 | 2.922882 |
| −0.58034 | 0.016347 | 2.922882 | 0.12462 | −0.77793 | 2.922882 |
| −0.62879 | 0.109576 | 2.922882 | 0.179941 | −0.86559 | 2.922882 |
| −0.67451 | 0.200553 | 2.922882 | 0.23384 | −0.95017 | 2.922882 |
| −0.71751 | 0.289042 | 2.922882 | 0.286081 | −1.03155 | 2.922882 |
| −0.75791 | 0.374926 | 2.922882 | 0.336782 | −1.10985 | 2.922882 |
| −0.79581 | 0.458085 | 2.922882 | 0.386061 | −1.18507 | 2.922882 |
| −0.83112 | 0.538519 | 2.922882 | 0.433564 | −1.25722 | 2.922882 |
| −0.86417 | 0.616229 | 2.922882 | 0.479526 | −1.32628 | 2.922882 |
| −0.89485 | 0.690977 | 2.922882 | 0.52383 | −1.39226 | 2.922882 |
| −0.92328 | 0.762882 | 2.922882 | 0.56458 | −1.45232 | 2.922882 |
| −0.94827 | 0.828628 | 2.922882 | 0.60154 | −1.50657 | 2.922882 |
| −0.96995 | 0.888095 | 2.922882 | 0.634827 | −1.55502 | 2.922882 |
| −0.98831 | 0.941283 | 2.922882 | 0.664324 | −1.59779 | 2.922882 |
| −1.00395 | 0.991629 | 2.922882 | 0.689911 | −1.63463 | 2.922882 |
| −1.01497 | 1.035933 | 2.922882 | 0.711589 | −1.6659 | 2.922882 |
| −1.02113 | 1.070641 | 2.922882 | 0.730187 | −1.69256 | 2.922882 |
| −1.02338 | 1.098598 | 2.922882 | 0.745943 | −1.71483 | 2.922882 |
| −1.02267 | 1.119684 | 2.922882 | 0.758973 | −1.73319 | 2.922882 |
| −1.01935 | 1.135084 | 2.922882 | 0.769398 | −1.74776 | 2.922882 |
| −1.01556 | 1.143021 | 2.922882 | 0.777335 | −1.75901 | 2.922882 |
| −1.01189 | 1.147285 | 2.922882 | 0.780178 | −1.76896 | 2.922882 |
| −1.00952 | 1.148825 | 2.922882 | 0.778756 | −1.77761 | 2.922882 |
| −1.00821 | 1.149536 | 2.922882 | 0.775321 | −1.78365 | 2.922882 |
| 0.743455 | −1.74113 | 3.238933 | −1.00442 | 1.10073 | 3.238933 |
| 0.73919 | −1.74397 | 3.238933 | −1.00383 | 1.100967 | 3.238933 |
| 0.732675 | −1.74598 | 3.238933 | −1.00253 | 1.101323 | 3.238933 |
| 0.724264 | −1.74563 | 3.238933 | −0.9998 | 1.101678 | 3.238933 |
| 0.715261 | −1.74113 | 3.238933 | −0.99435 | 1.101086 | 3.238933 |
| 0.705548 | −1.73141 | 3.238933 | −0.98653 | 1.097769 | 3.238933 |
| 0.693228 | −1.71862 | 3.238933 | −0.9741 | 1.088884 | 3.238933 |
| 0.67771 | −1.70263 | 3.238933 | −0.95964 | 1.074788 | 3.238933 |
| 0.658875 | −1.6832 | 3.238933 | −0.94259 | 1.05382 | 3.238933 |
| 0.636486 | −1.65998 | 3.238933 | −0.9234 | 1.026219 | 3.238933 |
| 0.610424 | −1.63285 | 3.238933 | −0.90077 | 0.989023 | 3.238933 |
| 0.579743 | −1.60063 | 3.238933 | −0.87649 | 0.944955 | 3.238933 |
| 0.544442 | −1.5632 | 3.238933 | −0.85173 | 0.897335 | 3.238933 |
| 0.504758 | −1.52079 | 3.238933 | −0.82424 | 0.843435 | 3.238933 |
| 0.460572 | −1.47293 | 3.238933 | −0.79356 | 0.783613 | 3.238933 |
| 0.412004 | −1.41986 | 3.238933 | −0.7598 | 0.717868 | 3.238933 |
| 0.359408 | −1.36134 | 3.238933 | −0.72438 | 0.649279 | 3.238933 |
| 0.305153 | −1.29962 | 3.238933 | −0.68707 | 0.577848 | 3.238933 |
| 0.249121 | −1.23483 | 3.238933 | −0.64798 | 0.503455 | 3.238933 |
| 0.191668 | −1.16695 | 3.238933 | −0.60687 | 0.426456 | 3.238933 |
| 0.133031 | −1.09576 | 3.238933 | −0.56375 | 0.346614 | 3.238933 |
| 0.073327 | −1.02124 | 3.238933 | −0.5185 | 0.264166 | 3.238933 |
| 0.012675 | −0.94342 | 3.238933 | −0.47112 | 0.179112 | 3.238933 |

TABLE 11-continued

| SUCTION SIDE | | | PRESSURE SIDE | | |
|---|---|---|---|---|---|
| X | Y | Z | X | Y | Z |
| −0.04869 | −0.86203 | 3.238933 | −0.42148 | 0.091451 | 3.238933 |
| −0.10875 | −0.7797 | 3.238933 | −0.37125 | 0.004265 | 3.238933 |
| −0.16727 | −0.69654 | 3.238933 | −0.3202 | −0.08257 | 3.238933 |
| −0.22436 | −0.61244 | 3.238933 | −0.26867 | −0.16904 | 3.238933 |
| −0.27992 | −0.52738 | 3.238933 | −0.21643 | −0.25504 | 3.238933 |
| −0.33394 | −0.4415 | 3.238933 | −0.16347 | −0.34069 | 3.238933 |
| −0.38689 | −0.35479 | 3.238933 | −0.10993 | −0.42598 | 3.238933 |
| −0.43854 | −0.26736 | 3.238933 | −0.05615 | −0.51115 | 3.238933 |
| −0.48924 | −0.17923 | 3.238933 | −0.00213 | −0.59609 | 3.238933 |
| −0.53864 | −0.09038 | 3.238933 | 0.052122 | −0.68091 | 3.238933 |
| −0.58685 | −0.00083 | 3.238933 | 0.106496 | −0.76573 | 3.238933 |
| −0.634 | 0.089437 | 3.238933 | 0.161224 | −0.85019 | 3.238933 |
| −0.6783 | 0.177453 | 3.238933 | 0.214413 | −0.93181 | 3.238933 |
| −0.72012 | 0.2631 | 3.238933 | 0.265943 | −1.01035 | 3.238933 |
| −0.75933 | 0.346377 | 3.238933 | 0.315933 | −1.08604 | 3.238933 |
| −0.79617 | 0.427048 | 3.238933 | 0.364383 | −1.15866 | 3.238933 |
| −0.83052 | 0.50535 | 3.238933 | 0.411175 | −1.22831 | 3.238933 |
| −0.86263 | 0.580928 | 3.238933 | 0.456308 | −1.295 | 3.238933 |
| −0.89248 | 0.653781 | 3.238933 | 0.499783 | −1.35885 | 3.238933 |
| −0.9202 | 0.723791 | 3.238933 | 0.539704 | −1.4169 | 3.238933 |
| −0.94448 | 0.787759 | 3.238933 | 0.576071 | −1.46938 | 3.238933 |
| −0.96569 | 0.845686 | 3.238933 | 0.608647 | −1.51617 | 3.238933 |
| −0.98369 | 0.897453 | 3.238933 | 0.637552 | −1.55751 | 3.238933 |
| −0.99885 | 0.946495 | 3.238933 | 0.662665 | −1.59317 | 3.238933 |
| −1.00987 | 0.989615 | 3.238933 | 0.683988 | −1.62326 | 3.238933 |
| −1.01591 | 1.023257 | 3.238933 | 0.702349 | −1.64896 | 3.238933 |
| −1.01852 | 1.050503 | 3.238933 | 0.717749 | −1.67052 | 3.238933 |
| −1.01816 | 1.071115 | 3.238933 | 0.730543 | −1.68829 | 3.238933 |
| −1.01544 | 1.08616 | 3.238933 | 0.74073 | −1.70239 | 3.238933 |
| −1.012 | 1.093978 | 3.238933 | 0.748549 | −1.71329 | 3.238933 |
| −1.00857 | 1.098243 | 3.238933 | 0.75151 | −1.723 | 3.238933 |
| −1.00632 | 1.099901 | 3.238933 | 0.750207 | −1.73141 | 3.238933 |
| −1.00513 | 1.100493 | 3.238933 | 0.747009 | −1.73745 | 3.238933 |
| 0.736347 | −1.69753 | 3.554985 | −1.00857 | 1.080355 | 3.555103 |
| 0.732201 | −1.70037 | 3.555103 | −1.00786 | 1.080592 | 3.555103 |
| 0.725804 | −1.70251 | 3.555103 | −1.00655 | 1.080948 | 3.554985 |
| 0.717512 | −1.70239 | 3.555103 | −1.00395 | 1.081184 | 3.555103 |
| 0.708509 | −1.69789 | 3.554985 | −0.99862 | 1.080474 | 3.555103 |
| 0.698914 | −1.68853 | 3.555103 | −0.99092 | 1.077157 | 3.555103 |
| 0.686357 | −1.67621 | 3.555103 | −0.97883 | 1.068272 | 3.555103 |
| 0.670839 | −1.66093 | 3.554985 | −0.96486 | 1.054176 | 3.555103 |
| 0.651885 | −1.64221 | 3.555103 | −0.94815 | 1.033682 | 3.555103 |
| 0.629496 | −1.61982 | 3.555103 | −0.92932 | 1.006555 | 3.555103 |
| 0.603317 | −1.59364 | 3.555103 | −0.90681 | 0.970069 | 3.555103 |
| 0.572517 | −1.56261 | 3.555103 | −0.88276 | 0.92695 | 3.555103 |
| 0.537216 | −1.52659 | 3.555103 | −0.85801 | 0.880276 | 3.555103 |
| 0.497295 | −1.48549 | 3.554985 | −0.83064 | 0.827562 | 3.554985 |
| 0.452991 | −1.43941 | 3.555103 | −0.80008 | 0.768924 | 3.555103 |
| 0.404541 | −1.388 | 3.555103 | −0.76655 | 0.7046 | 3.554985 |
| 0.351826 | −1.33137 | 3.554985 | −0.73125 | 0.637315 | 3.555103 |
| 0.297453 | −1.27155 | 3.554985 | −0.69406 | 0.567305 | 3.554985 |
| 0.241421 | −1.20877 | 3.555103 | −0.6552 | 0.494571 | 3.554985 |
| 0.184205 | −1.1429 | 3.554985 | −0.61422 | 0.419111 | 3.554985 |
| 0.125686 | −1.07384 | 3.554985 | −0.57133 | 0.341046 | 3.555103 |
| 0.066101 | −1.00146 | 3.554985 | −0.52632 | 0.260257 | 3.555103 |
| 0.005568 | −0.92565 | 3.554985 | −0.47917 | 0.176979 | 3.554985 |
| −0.05556 | −0.8464 | 3.554985 | −0.42965 | 0.091214 | 3.554985 |
| −0.11526 | −0.76608 | 3.554985 | −0.37943 | 0.005805 | 3.554985 |
| −0.17354 | −0.68482 | 3.555103 | −0.32861 | −0.07913 | 3.555103 |
| −0.23029 | −0.60249 | 3.554985 | −0.2772 | −0.16371 | 3.555103 |
| −0.28537 | −0.51921 | 3.555103 | −0.22496 | −0.24782 | 3.555103 |
| −0.33927 | −0.43487 | 3.554985 | −0.17212 | −0.33157 | 3.555103 |
| −0.39187 | −0.34993 | 3.555103 | −0.11858 | −0.41485 | 3.554985 |
| −0.44351 | −0.26417 | 3.554985 | −0.06468 | −0.49789 | 3.555103 |
| −0.49386 | −0.17769 | 3.554985 | −0.01054 | −0.58081 | 3.554985 |
| −0.54314 | −0.09038 | 3.555103 | 0.043712 | −0.66349 | 3.554985 |
| −0.59123 | −0.00237 | 3.555103 | 0.098322 | −0.74618 | 3.555103 |
| −0.63814 | 0.086476 | 3.555103 | 0.15305 | −0.82863 | 3.555103 |
| −0.68233 | 0.173189 | 3.555103 | 0.206239 | −0.90823 | 3.555103 |
| −0.72391 | 0.257532 | 3.555103 | 0.257769 | −0.98488 | 3.555103 |
| −0.763 | 0.339506 | 3.554985 | 0.307759 | −1.05868 | 3.555103 |
| −0.79961 | 0.418875 | 3.555103 | 0.356209 | −1.12952 | 3.554985 |
| −0.83372 | 0.495755 | 3.555103 | 0.403001 | −1.19751 | 3.554985 |
| −0.86559 | 0.569911 | 3.554985 | 0.448134 | −1.26255 | 3.554985 |
| −0.89532 | 0.641342 | 3.554985 | 0.491727 | −1.32474 | 3.554985 |
| −0.9228 | 0.710049 | 3.555103 | 0.531648 | −1.38136 | 3.555103 |

TABLE 11-continued

| SUCTION SIDE | | | PRESSURE SIDE | | |
|---|---|---|---|---|---|
| X | Y | Z | X | Y | Z |
| −0.94697 | 0.772833 | 3.555103 | 0.568016 | −1.43242 | 3.554985 |
| −0.96794 | 0.829575 | 3.554985 | 0.600711 | −1.47814 | 3.554985 |
| −0.98582 | 0.880276 | 3.555103 | 0.629615 | −1.5183 | 3.555103 |
| −1.00087 | 0.928489 | 3.554985 | 0.654728 | −1.55301 | 3.555103 |
| −1.01189 | 0.97078 | 3.555103 | 0.67617 | −1.58239 | 3.555103 |
| −1.01816 | 1.00383 | 3.555103 | 0.694413 | −1.60738 | 3.554985 |
| −1.02113 | 1.030484 | 3.555103 | 0.709812 | −1.62847 | 3.555103 |
| −1.02113 | 1.05074 | 3.555103 | 0.722606 | −1.64576 | 3.555103 |
| −1.01887 | 1.065666 | 3.555103 | 0.732794 | −1.65951 | 3.555103 |
| −1.01568 | 1.073485 | 3.554985 | 0.740612 | −1.67017 | 3.554985 |
| −1.01248 | 1.077749 | 3.555103 | 0.743692 | −1.67953 | 3.555103 |
| −1.01035 | 1.079408 | 3.555103 | 0.742744 | −1.68782 | 3.554985 |
| −1.00916 | 1.08 | 3.555103 | 0.739783 | −1.69386 | 3.555103 |
| 0.740138 | −1.67597 | 3.713129 | −1.01117 | 1.080474 | 3.713129 |
| 0.735992 | −1.67882 | 3.713129 | −1.01058 | 1.080711 | 3.713129 |
| 0.729714 | −1.68095 | 3.713129 | −1.00928 | 1.081066 | 3.713129 |
| 0.721421 | −1.68083 | 3.713129 | −1.00655 | 1.081421 | 3.713129 |
| 0.712418 | −1.67645 | 3.713129 | −1.00134 | 1.080592 | 3.713129 |
| 0.702705 | −1.66732 | 3.713129 | −0.99376 | 1.077275 | 3.713129 |
| 0.690148 | −1.65524 | 3.713129 | −0.9818 | 1.068391 | 3.713129 |
| 0.674393 | −1.64008 | 3.713129 | −0.96782 | 1.054294 | 3.713129 |
| 0.655321 | −1.62172 | 3.713129 | −0.95123 | 1.0338 | 3.713129 |
| 0.632695 | −1.5998 | 3.713129 | −0.93252 | 1.006792 | 3.713129 |
| 0.606278 | −1.57398 | 3.713129 | −0.91013 | 0.970543 | 3.713129 |
| 0.575242 | −1.54342 | 3.713129 | −0.88608 | 0.927542 | 3.713129 |
| 0.539585 | −1.508 | 3.713129 | −0.86144 | 0.881105 | 3.713129 |
| 0.499427 | −1.4676 | 3.713129 | −0.83396 | 0.828746 | 3.713129 |
| 0.454768 | −1.42211 | 3.713129 | −0.80351 | 0.770464 | 3.713129 |
| 0.405962 | −1.37141 | 3.713129 | −0.76987 | 0.706495 | 3.713129 |
| 0.352892 | −1.3155 | 3.713129 | −0.73445 | 0.639684 | 3.713129 |
| 0.298282 | −1.25639 | 3.713129 | −0.69737 | 0.570148 | 3.713129 |
| 0.242014 | −1.19431 | 3.713129 | −0.65828 | 0.497769 | 3.713129 |
| 0.184561 | −1.12916 | 3.713129 | −0.6173 | 0.422784 | 3.713129 |
| 0.125805 | −1.06069 | 3.713129 | −0.57429 | 0.345192 | 3.713129 |
| 0.066101 | −0.98902 | 3.713129 | −0.52916 | 0.264995 | 3.713129 |
| 0.005568 | −0.9138 | 3.713129 | −0.48178 | 0.18231 | 3.713129 |
| −0.05579 | −0.83514 | 3.713129 | −0.43214 | 0.097137 | 3.713129 |
| −0.11562 | −0.75542 | 3.713129 | −0.38192 | 0.01232 | 3.713129 |
| −0.1739 | −0.67475 | 3.713129 | −0.33086 | −0.07202 | 3.713129 |
| −0.23064 | −0.59301 | 3.713129 | −0.27921 | −0.15589 | 3.713129 |
| −0.28584 | −0.51021 | 3.713129 | −0.22685 | −0.23941 | 3.713129 |
| −0.33974 | −0.42657 | 3.713129 | −0.17378 | −0.32245 | 3.713129 |
| −0.39258 | −0.34211 | 3.713129 | −0.12 | −0.40501 | 3.713129 |
| −0.44423 | −0.25694 | 3.713129 | −0.06575 | −0.48734 | 3.713129 |
| −0.49469 | −0.17094 | 3.713129 | −0.01137 | −0.56944 | 3.713129 |
| −0.54409 | −0.08423 | 3.713129 | 0.043356 | −0.65141 | 3.713129 |
| −0.59218 | 0.003317 | 3.713129 | 0.098203 | −0.73327 | 3.713129 |
| −0.63921 | 0.091688 | 3.713129 | 0.153287 | −0.815 | 3.713129 |
| −0.6834 | 0.177808 | 3.713129 | 0.206831 | −0.8939 | 3.713129 |
| −0.72509 | 0.261797 | 3.713129 | 0.258717 | −0.96983 | 3.713129 |
| −0.76419 | 0.343297 | 3.713129 | 0.309062 | −1.0428 | 3.713129 |
| −0.80079 | 0.42231 | 3.713129 | 0.357749 | −1.11305 | 3.713129 |
| −0.83491 | 0.498717 | 3.713129 | 0.404896 | −1.18034 | 3.713129 |
| −0.86677 | 0.572517 | 3.713129 | 0.450266 | −1.24478 | 3.713129 |
| −0.89651 | 0.643593 | 3.713129 | 0.494097 | −1.30638 | 3.713129 |
| −0.92399 | 0.711945 | 3.713129 | 0.534255 | −1.36253 | 3.713129 |
| −0.94827 | 0.774373 | 3.713129 | 0.57074 | −1.41311 | 3.713129 |
| −0.96936 | 0.83076 | 3.713129 | 0.603554 | −1.45836 | 3.713129 |
| −0.98736 | 0.881342 | 3.713129 | 0.632576 | −1.49816 | 3.713129 |
| −1.00253 | 0.9292 | 3.713129 | 0.657808 | −1.53252 | 3.713129 |
| −1.01366 | 0.971254 | 3.713129 | 0.67925 | −1.56166 | 3.713129 |
| −1.02018 | 1.004185 | 3.713129 | 0.697729 | −1.58642 | 3.713129 |
| −1.02326 | 1.03072 | 3.713129 | 0.713129 | −1.60727 | 3.713129 |
| −1.02338 | 1.050859 | 3.713129 | 0.725923 | −1.62444 | 3.713129 |
| −1.02124 | 1.065785 | 3.713129 | 0.73611 | −1.63806 | 3.713129 |
| −1.01828 | 1.073603 | 3.713129 | 0.744047 | −1.64861 | 3.713129 |
| −1.01508 | 1.077868 | 3.713129 | 0.747246 | −1.65797 | 3.713129 |
| −1.01295 | 1.079526 | 3.713129 | 0.746416 | −1.66626 | 3.713129 |
| −1.01177 | 1.080237 | 3.713129 | 0.743455 | −1.67218 | 3.713129 |
| 0.742507 | −1.64683 | 3.871154 | −1.01414 | 1.089121 | 3.871154 |
| 0.738361 | −1.64967 | 3.871154 | −1.01354 | 1.089358 | 3.871154 |
| 0.732083 | −1.65192 | 3.871154 | −1.01224 | 1.089714 | 3.871154 |
| 0.723909 | −1.65192 | 3.871154 | −1.00963 | 1.090069 | 3.871154 |
| 0.714906 | −1.64766 | 3.871154 | −1.00442 | 1.08924 | 3.871154 |
| 0.705074 | −1.63854 | 3.871154 | −0.99684 | 1.085804 | 3.871154 |
| 0.692399 | −1.62669 | 3.871154 | −0.98499 | 1.07692 | 3.871154 |

TABLE 11-continued

| SUCTION SIDE | | | PRESSURE SIDE | | |
|---|---|---|---|---|---|
| X | Y | Z | X | Y | Z |
| 0.676525 | −1.61189 | 3.871154 | −0.97114 | 1.062823 | 3.871154 |
| 0.657335 | −1.59376 | 3.871154 | −0.95467 | 1.04233 | 3.871154 |
| 0.634472 | −1.5722 | 3.871154 | −0.93619 | 1.015558 | 3.871154 |
| 0.607937 | −1.54685 | 3.871154 | −0.91404 | 0.979309 | 3.871154 |
| 0.576545 | −1.51676 | 3.871154 | −0.88999 | 0.936426 | 3.871154 |
| 0.540651 | −1.48193 | 3.871154 | −0.86547 | 0.890227 | 3.871154 |
| 0.500138 | −1.44213 | 3.871154 | −0.83822 | 0.837986 | 3.871154 |
| 0.455123 | −1.39735 | 3.871154 | −0.80766 | 0.780059 | 3.871154 |
| 0.405844 | −1.34748 | 3.871154 | −0.77402 | 0.716446 | 3.871154 |
| 0.352537 | −1.29228 | 3.871154 | −0.7386 | 0.64999 | 3.871154 |
| 0.297453 | −1.234 | 3.871154 | −0.7014 | 0.580809 | 3.871154 |
| 0.240948 | −1.17264 | 3.871154 | −0.66231 | 0.508904 | 3.871154 |
| 0.183139 | −1.10807 | 3.871154 | −0.62132 | 0.434274 | 3.871154 |
| 0.124265 | −1.04032 | 3.871154 | −0.5782 | 0.357157 | 3.871154 |
| 0.064324 | −0.96936 | 3.871154 | −0.53295 | 0.277433 | 3.871154 |
| 0.003672 | −0.89473 | 3.871154 | −0.48557 | 0.195222 | 3.871154 |
| −0.05769 | −0.81666 | 3.871154 | −0.43581 | 0.110642 | 3.871154 |
| −0.11751 | −0.73753 | 3.871154 | −0.38547 | 0.026535 | 3.871154 |
| −0.17579 | −0.65745 | 3.871154 | −0.33429 | −0.05722 | 3.871154 |
| −0.23254 | −0.57619 | 3.871154 | −0.28253 | −0.14049 | 3.871154 |
| −0.28786 | −0.49386 | 3.871154 | −0.22993 | −0.22342 | 3.871154 |
| −0.34176 | −0.4107 | 3.871154 | −0.17674 | −0.30586 | 3.871154 |
| −0.39459 | −0.32683 | 3.871154 | −0.12284 | −0.38772 | 3.871154 |
| −0.44636 | −0.24213 | 3.871154 | −0.06835 | −0.46946 | 3.871154 |
| −0.49682 | −0.1566 | 3.871154 | −0.0135 | −0.55084 | 3.871154 |
| −0.54622 | −0.07037 | 3.871154 | 0.041579 | −0.6321 | 3.871154 |
| −0.59431 | 0.016821 | 3.871154 | 0.096782 | −0.71325 | 3.871154 |
| −0.64134 | 0.104837 | 3.871154 | 0.152221 | −0.79427 | 3.871154 |
| −0.68553 | 0.190602 | 3.871154 | 0.20612 | −0.87234 | 3.871154 |
| −0.72711 | 0.274235 | 3.871154 | 0.258361 | −0.94756 | 3.871154 |
| −0.7662 | 0.35538 | 3.871154 | 0.309062 | −1.01994 | 3.871154 |
| −0.80268 | 0.433919 | 3.871154 | 0.358105 | −1.0896 | 3.871154 |
| −0.8368 | 0.510089 | 3.871154 | 0.40537 | −1.15629 | 3.871154 |
| −0.86855 | 0.583534 | 3.871154 | 0.451096 | −1.22014 | 3.871154 |
| −0.89828 | 0.654255 | 3.871154 | 0.495044 | −1.28114 | 3.871154 |
| −0.92576 | 0.722251 | 3.871154 | 0.535439 | −1.33682 | 3.871154 |
| −0.94993 | 0.784442 | 3.871154 | 0.572162 | −1.38693 | 3.871154 |
| −0.97114 | 0.840592 | 3.871154 | 0.605212 | −1.43171 | 3.871154 |
| −0.98914 | 0.890819 | 3.871154 | 0.634353 | −1.47115 | 3.871154 |
| −1.00454 | 0.93844 | 3.871154 | 0.659822 | −1.50527 | 3.871154 |
| −1.01591 | 0.980375 | 3.871154 | 0.681382 | −1.53406 | 3.871154 |
| −1.02255 | 1.01307 | 3.871154 | 0.699862 | −1.5587 | 3.871154 |
| −1.02575 | 1.039487 | 3.871154 | 0.71538 | −1.57931 | 3.871154 |
| −1.0261 | 1.059506 | 3.871154 | 0.728292 | −1.59625 | 3.871154 |
| −1.02409 | 1.074314 | 3.871154 | 0.738598 | −1.60987 | 3.871154 |
| −1.02113 | 1.082132 | 3.871154 | 0.746416 | −1.6203 | 3.871154 |
| −1.01805 | 1.086515 | 3.871154 | 0.749496 | −1.62942 | 3.871154 |
| −1.01591 | 1.088174 | 3.871154 | 0.748549 | −1.63735 | 3.871154 |
| −1.01485 | 1.088884 | 3.871154 | 0.745706 | −1.64316 | 3.871154 |
| 0.745587 | −1.61757 | 4.02918 | −1.02089 | 1.111747 | 4.02918 |
| 0.741441 | −1.62053 | 4.02918 | −1.0203 | 1.111984 | 4.02918 |
| 0.735163 | −1.62278 | 4.02918 | −1.01899 | 1.112339 | 4.02918 |
| 0.726989 | −1.62267 | 4.02918 | −1.01627 | 1.112695 | 4.02918 |
| 0.717986 | −1.61828 | 4.02918 | −1.01106 | 1.111866 | 4.02918 |
| 0.708154 | −1.60928 | 4.02918 | −1.00359 | 1.108312 | 4.02918 |
| 0.69536 | −1.59755 | 4.02918 | −0.99187 | 1.099309 | 4.02918 |
| 0.679368 | −1.58274 | 4.02918 | −0.97812 | 1.085094 | 4.02918 |
| 0.660059 | −1.56486 | 4.02918 | −0.96178 | 1.0646 | 4.02918 |
| 0.637078 | −1.54342 | 4.02918 | −0.94342 | 1.03771 | 4.02918 |
| 0.610306 | −1.5183 | 4.02918 | −0.92138 | 1.001461 | 4.02918 |
| 0.578677 | −1.48845 | 4.02918 | −0.89745 | 0.958578 | 4.02918 |
| 0.542428 | −1.45374 | 4.02918 | −0.87305 | 0.91226 | 4.02918 |
| 0.50156 | −1.41429 | 4.02918 | −0.84569 | 0.86002 | 4.02918 |
| 0.456308 | −1.36987 | 4.02918 | −0.81524 | 0.802211 | 4.02918 |
| 0.406555 | −1.32036 | 4.02918 | −0.78148 | 0.738598 | 4.02918 |
| 0.352774 | −1.26551 | 4.02918 | −0.74594 | 0.672142 | 4.02918 |
| 0.297216 | −1.2077 | 4.02918 | −0.70875 | 0.60308 | 4.02918 |
| 0.240237 | −1.14669 | 4.02918 | −0.66965 | 0.531175 | 4.02918 |
| 0.181955 | −1.08261 | 4.02918 | −0.62843 | 0.456782 | 4.02918 |
| 0.122488 | −1.01532 | 4.02918 | −0.58531 | 0.379664 | 4.02918 |
| 0.062192 | −0.9446 | 4.02918 | −0.53994 | 0.300059 | 4.02918 |
| 0.001066 | −0.87044 | 4.02918 | −0.49232 | 0.217966 | 4.02918 |
| −0.06065 | −0.79262 | 4.02918 | −0.44245 | 0.133504 | 4.02918 |
| −0.12083 | −0.71372 | 4.02918 | −0.39175 | 0.049398 | 4.02918 |
| −0.17935 | −0.63376 | 4.02918 | −0.34034 | −0.03412 | 4.02918 |
| −0.23633 | −0.55273 | 4.02918 | −0.28821 | −0.11728 | 4.02918 |

TABLE 11-continued

| SUCTION SIDE | | | PRESSURE SIDE | | |
|---|---|---|---|---|---|
| X | Y | Z | X | Y | Z |
| −0.29177 | −0.47064 | 4.02918 | −0.2355 | −0.19996 | 4.02918 |
| −0.34602 | −0.38772 | 4.02918 | −0.18195 | −0.28217 | 4.02918 |
| −0.39897 | −0.30397 | 4.02918 | −0.12758 | −0.36379 | 4.02918 |
| −0.45098 | −0.21939 | 4.02918 | −0.07273 | −0.44505 | 4.02918 |
| −0.50168 | −0.13398 | 4.02918 | −0.01741 | −0.52608 | 4.02918 |
| −0.55108 | −0.04774 | 4.02918 | 0.038144 | −0.60699 | 4.02918 |
| −0.59941 | 0.039329 | 4.02918 | 0.09382 | −0.68778 | 4.02918 |
| −0.64644 | 0.127226 | 4.02918 | 0.149733 | −0.76833 | 4.02918 |
| −0.69074 | 0.21311 | 4.02918 | 0.204107 | −0.84616 | 4.02918 |
| −0.73232 | 0.296624 | 4.02918 | 0.256821 | −0.92103 | 4.02918 |
| −0.77141 | 0.377769 | 4.02918 | 0.307878 | −0.99305 | 4.02918 |
| −0.80802 | 0.456426 | 4.02918 | 0.357157 | −1.06235 | 4.02918 |
| −0.84213 | 0.532596 | 4.02918 | 0.404896 | −1.12869 | 4.02918 |
| −0.87388 | 0.606041 | 4.02918 | 0.450977 | −1.1923 | 4.02918 |
| −0.90361 | 0.676762 | 4.02918 | 0.495281 | −1.25307 | 4.02918 |
| −0.9311 | 0.744876 | 4.02918 | 0.536032 | −1.30839 | 4.02918 |
| −0.95526 | 0.807068 | 4.02918 | 0.572991 | −1.35826 | 4.02918 |
| −0.97647 | 0.863218 | 4.02918 | 0.606278 | −1.40292 | 4.02918 |
| −0.99459 | 0.913445 | 4.02918 | 0.635656 | −1.44213 | 4.02918 |
| −1.01011 | 0.960948 | 4.02918 | 0.661362 | −1.47601 | 4.02918 |
| −1.0216 | 1.002764 | 4.02918 | 0.68304 | −1.50468 | 4.02918 |
| −1.02835 | 1.035459 | 4.02918 | 0.701639 | −1.5292 | 4.02918 |
| −1.03179 | 1.061994 | 4.02918 | 0.717394 | −1.54969 | 4.02918 |
| −1.03226 | 1.082014 | 4.02918 | 0.730306 | −1.56663 | 4.02918 |
| −1.03048 | 1.096821 | 4.02918 | 0.74073 | −1.58002 | 4.02918 |
| −1.02776 | 1.104758 | 4.02918 | 0.748667 | −1.59044 | 4.02918 |
| −1.02468 | 1.109023 | 4.02918 | 0.752221 | −1.59957 | 4.02918 |
| −1.02267 | 1.110799 | 4.02918 | 0.751629 | −1.60786 | 4.02918 |
| −1.02148 | 1.11151 | 4.02918 | 0.748786 | −1.61378 | 4.02918 |
| 0.751984 | −1.59838 | 4.187206 | −1.02906 | 1.150365 | 4.187206 |
| 0.747838 | −1.60134 | 4.187206 | −1.02847 | 1.150602 | 4.187206 |
| 0.74156 | −1.60347 | 4.187206 | −1.02717 | 1.150957 | 4.187206 |
| 0.733149 | −1.60324 | 4.187206 | −1.02444 | 1.151313 | 4.187206 |
| 0.724264 | −1.59874 | 4.187206 | −1.01923 | 1.150365 | 4.187206 |
| 0.714314 | −1.58961 | 4.187206 | −1.01177 | 1.146693 | 4.187206 |
| 0.701402 | −1.57777 | 4.187206 | −1.00004 | 1.137334 | 4.187206 |
| 0.685291 | −1.56296 | 4.187206 | −0.98642 | 1.122882 | 4.187206 |
| 0.665864 | −1.54484 | 4.187206 | −0.97019 | 1.102033 | 4.187206 |
| 0.642646 | −1.52328 | 4.187206 | −0.95194 | 1.074788 | 4.187206 |
| 0.615518 | −1.49805 | 4.187206 | −0.92991 | 1.038065 | 4.187206 |
| 0.583771 | −1.46796 | 4.187206 | −0.90622 | 0.994709 | 4.187206 |
| 0.547167 | −1.43325 | 4.187206 | −0.8817 | 0.947917 | 4.187206 |
| 0.505824 | −1.39356 | 4.187206 | −0.85445 | 0.895321 | 4.187206 |
| 0.460099 | −1.3489 | 4.187206 | −0.82389 | 0.836801 | 4.187206 |
| 0.409872 | −1.29903 | 4.187206 | −0.79013 | 0.772596 | 4.187206 |
| 0.355498 | −1.24395 | 4.187206 | −0.75459 | 0.705666 | 4.187206 |
| 0.299348 | −1.1859 | 4.187206 | −0.71728 | 0.635893 | 4.187206 |
| 0.241658 | −1.12466 | 4.187206 | −0.67807 | 0.563396 | 4.187206 |
| 0.182784 | −1.06034 | 4.187206 | −0.63672 | 0.488411 | 4.187206 |
| 0.122725 | −0.99269 | 4.187206 | −0.59337 | 0.410701 | 4.187206 |
| 0.061718 | −0.92162 | 4.187206 | −0.54776 | 0.330385 | 4.187206 |
| −0.00012 | −0.84711 | 4.187206 | −0.4999 | 0.2477 | 4.187206 |
| −0.06243 | −0.76892 | 4.187206 | −0.44956 | 0.162527 | 4.187206 |
| −0.1232 | −0.68956 | 4.187206 | −0.39862 | 0.077828 | 4.187206 |
| −0.18219 | −0.60912 | 4.187206 | −0.34673 | −0.0064 | 4.187206 |
| −0.23964 | −0.5275 | 4.187206 | −0.29425 | −0.09003 | 4.187206 |
| −0.29556 | −0.44482 | 4.187206 | −0.24095 | −0.17331 | 4.187206 |
| −0.35029 | −0.3613 | 4.187206 | −0.18681 | −0.25599 | 4.187206 |
| −0.40371 | −0.27696 | 4.187206 | −0.13196 | −0.33808 | 4.187206 |
| −0.45607 | −0.19179 | 4.187206 | −0.07641 | −0.41982 | 4.187206 |
| −0.50713 | −0.10578 | 4.187206 | −0.02026 | −0.5012 | 4.187206 |
| −0.557 | −0.01895 | 4.187206 | 0.035893 | −0.58247 | 4.187206 |
| −0.60557 | 0.068825 | 4.187206 | 0.092399 | −0.66361 | 4.187206 |
| −0.65283 | 0.157433 | 4.187206 | 0.149023 | −0.74464 | 4.187206 |
| −0.69737 | 0.243909 | 4.187206 | 0.203988 | −0.8227 | 4.187206 |
| −0.73919 | 0.328253 | 4.187206 | 0.257414 | −0.89805 | 4.187206 |
| −0.7784 | 0.410109 | 4.187206 | 0.308944 | −0.97042 | 4.187206 |
| −0.815 | 0.489477 | 4.187206 | 0.358934 | −1.04008 | 4.187206 |
| −0.84924 | 0.566239 | 4.187206 | 0.407147 | −1.10677 | 4.187206 |
| −0.88111 | 0.640276 | 4.187206 | 0.453702 | −1.17074 | 4.187206 |
| −0.91084 | 0.711708 | 4.187206 | 0.498598 | −1.23187 | 4.187206 |
| −0.93832 | 0.780296 | 4.187206 | 0.539704 | −1.28742 | 4.187206 |
| −0.96261 | 0.84308 | 4.187206 | 0.577137 | −1.33765 | 4.187206 |
| −0.98381 | 0.899704 | 4.187206 | 0.610661 | −1.38255 | 4.187206 |
| −1.00193 | 0.950286 | 4.187206 | 0.640395 | −1.42199 | 4.187206 |
| −1.01745 | 0.998262 | 4.187206 | 0.666338 | −1.45611 | 4.187206 |

TABLE 11-continued

| SUCTION SIDE | | | PRESSURE SIDE | | |
|---|---|---|---|---|---|
| X | Y | Z | X | Y | Z |
| −1.02906 | 1.040434 | 4.187206 | 0.688253 | −1.4849 | 4.187206 |
| −1.03593 | 1.073366 | 4.187206 | 0.707088 | −1.50954 | 4.187206 |
| −1.03949 | 1.10002 | 4.187206 | 0.722961 | −1.53015 | 4.187206 |
| −1.04008 | 1.120158 | 4.187206 | 0.73611 | −1.54709 | 4.187206 |
| −1.03842 | 1.135202 | 4.187206 | 0.746535 | −1.56071 | 4.187206 |
| −1.03581 | 1.143139 | 4.187206 | 0.75459 | −1.57102 | 4.187206 |
| −1.03285 | 1.14764 | 4.187206 | 0.758381 | −1.58014 | 4.187206 |
| −1.03084 | 1.149417 | 4.187206 | 0.757907 | −1.58843 | 4.187206 |
| −1.02965 | 1.150128 | 4.187206 | 0.755183 | −1.59459 | 4.187206 |
| 0.754353 | −1.59127 | 4.268825 | −1.03191 | 1.175716 | 4.268825 |
| 0.750326 | −1.59423 | 4.268825 | −1.03119 | 1.175952 | 4.268825 |
| 0.743929 | −1.59649 | 4.268825 | −1.02989 | 1.176426 | 4.268825 |
| 0.735518 | −1.59613 | 4.268825 | −1.02729 | 1.176663 | 4.268825 |
| 0.726634 | −1.59139 | 4.268825 | −1.02195 | 1.175597 | 4.268825 |
| 0.716683 | −1.58215 | 4.268825 | −1.01449 | 1.171806 | 4.268825 |
| 0.703652 | −1.57031 | 4.268825 | −1.00288 | 1.162448 | 4.268825 |
| 0.687423 | −1.55538 | 4.268825 | −0.98926 | 1.147759 | 4.268825 |
| 0.667877 | −1.53726 | 4.268825 | −0.97315 | 1.126673 | 4.268825 |
| 0.644541 | −1.51558 | 4.268825 | −0.95502 | 1.099072 | 4.268825 |
| 0.617295 | −1.49011 | 4.268825 | −0.93311 | 1.061994 | 4.268825 |
| 0.585311 | −1.4599 | 4.268825 | −0.90954 | 1.018164 | 4.268825 |
| 0.54847 | −1.42496 | 4.268825 | −0.88525 | 0.971017 | 4.268825 |
| 0.507009 | −1.38503 | 4.268825 | −0.85801 | 0.917947 | 4.268825 |
| 0.461046 | −1.34014 | 4.268825 | −0.82756 | 0.859072 | 4.268825 |
| 0.410582 | −1.29003 | 4.268825 | −0.7938 | 0.794393 | 4.268825 |
| 0.355854 | −1.23459 | 4.268825 | −0.75838 | 0.726871 | 4.268825 |
| 0.299348 | −1.17619 | 4.268825 | −0.72107 | 0.656624 | 4.268825 |
| 0.241421 | −1.11459 | 4.268825 | −0.68186 | 0.583534 | 4.268825 |
| 0.182191 | −1.04991 | 4.268825 | −0.64051 | 0.507956 | 4.268825 |
| 0.121895 | −0.9818 | 4.268825 | −0.59716 | 0.429654 | 4.268825 |
| 0.060533 | −0.91037 | 4.268825 | −0.55155 | 0.348865 | 4.268825 |
| −0.00154 | −0.83538 | 4.268825 | −0.50369 | 0.265469 | 4.268825 |
| −0.06409 | −0.75672 | 4.268825 | −0.45335 | 0.179704 | 4.268825 |
| −0.12509 | −0.67688 | 4.268825 | −0.40217 | 0.094531 | 4.268825 |
| −0.18432 | −0.59585 | 4.268825 | −0.35017 | 0.009714 | 4.268825 |
| −0.2419 | −0.51364 | 4.268825 | −0.29745 | −0.07451 | 4.268825 |
| −0.29793 | −0.43048 | 4.268825 | −0.24403 | −0.15814 | 4.268825 |
| −0.35289 | −0.34638 | 4.268825 | −0.18965 | −0.24142 | 4.268825 |
| −0.40655 | −0.26144 | 4.268825 | −0.13469 | −0.32411 | 4.268825 |
| −0.45903 | −0.17579 | 4.268825 | −0.07878 | −0.4062 | 4.268825 |
| −0.51021 | −0.08908 | 4.268825 | −0.02239 | −0.48806 | 4.268825 |
| −0.56008 | −0.00166 | 4.268825 | 0.034235 | −0.56979 | 4.268825 |
| −0.60877 | 0.086713 | 4.268825 | 0.090977 | −0.65129 | 4.268825 |
| −0.65615 | 0.176032 | 4.268825 | 0.147957 | −0.73279 | 4.268825 |
| −0.70069 | 0.263218 | 4.268825 | 0.203159 | −0.81133 | 4.268825 |
| −0.74251 | 0.348154 | 4.268825 | 0.256821 | −0.88715 | 4.268825 |
| −0.7816 | 0.430484 | 4.268825 | 0.308707 | −0.96 | 4.268825 |
| −0.81832 | 0.510326 | 4.268825 | 0.358815 | −1.03001 | 4.268825 |
| −0.85244 | 0.58768 | 4.268825 | 0.407384 | −1.09718 | 4.268825 |
| −0.88419 | 0.66231 | 4.268825 | 0.454176 | −1.16138 | 4.268825 |
| −0.91392 | 0.734215 | 4.268825 | 0.49919 | −1.22286 | 4.268825 |
| −0.94128 | 0.803277 | 4.268825 | 0.540533 | −1.27878 | 4.268825 |
| −0.96545 | 0.866416 | 4.268825 | 0.578203 | −1.32936 | 4.268825 |
| −0.98653 | 0.923514 | 4.268825 | 0.611964 | −1.37437 | 4.268825 |
| −1.00466 | 0.974452 | 4.268825 | 0.641935 | −1.41406 | 4.268825 |
| −1.02018 | 1.022784 | 4.268825 | 0.667877 | −1.44829 | 4.268825 |
| −1.03167 | 1.065192 | 4.268825 | 0.69003 | −1.47731 | 4.268825 |
| −1.03866 | 1.098243 | 4.268825 | 0.708983 | −1.50207 | 4.268825 |
| −1.04221 | 1.125133 | 4.268825 | 0.724975 | −1.5228 | 4.268825 |
| −1.04292 | 1.14539 | 4.268825 | 0.738124 | −1.53974 | 4.268825 |
| −1.04126 | 1.160434 | 4.268825 | 0.748667 | −1.55337 | 4.268825 |
| −1.03866 | 1.168489 | 4.268825 | 0.756841 | −1.56391 | 4.268825 |
| −1.0357 | 1.172991 | 4.268825 | 0.76075 | −1.57303 | 4.268825 |
| −1.03368 | 1.174768 | 4.268825 | 0.760395 | −1.58132 | 4.268825 |
| −1.0325 | 1.175479 | 4.268825 | 0.75767 | −1.58748 | 4.268825 |
| 0.755064 | −1.57623 | 4.503257 | −1.02883 | 1.265982 | 4.503257 |
| 0.750799 | −1.57919 | 4.503257 | −1.02811 | 1.266219 | 4.503257 |
| 0.744284 | −1.58132 | 4.503257 | −1.02681 | 1.266574 | 4.503257 |
| 0.735637 | −1.58085 | 4.503257 | −1.02409 | 1.266693 | 4.503257 |
| 0.726871 | −1.57552 | 4.503257 | −1.01876 | 1.26539 | 4.503257 |
| 0.716683 | −1.56628 | 4.503257 | −1.01141 | 1.261007 | 4.503257 |
| 0.703415 | −1.55408 | 4.503257 | −1.00004 | 1.250938 | 4.503257 |
| 0.68695 | −1.53891 | 4.503257 | −0.98677 | 1.235419 | 4.503257 |
| 0.666811 | −1.52043 | 4.503257 | −0.97125 | 1.213267 | 4.503257 |
| 0.643119 | −1.4984 | 4.503257 | −0.95372 | 1.1846 | 4.503257 |
| 0.6154 | −1.47246 | 4.503257 | −0.93264 | 1.146101 | 4.503257 |

TABLE 11-continued

| SUCTION SIDE | | | PRESSURE SIDE | | |
|---|---|---|---|---|---|
| X | Y | Z | X | Y | Z |
| 0.582705 | −1.44154 | 4.503257 | −0.90989 | 1.100849 | 4.503257 |
| 0.545271 | −1.40588 | 4.503257 | −0.88632 | 1.052162 | 4.503257 |
| 0.502981 | −1.36513 | 4.503257 | −0.86002 | 0.997433 | 4.503257 |
| 0.456189 | −1.31917 | 4.503257 | −0.8304 | 0.936663 | 4.503257 |
| 0.404896 | −1.268 | 4.503257 | −0.79771 | 0.86997 | 4.503257 |
| 0.34922 | −1.21137 | 4.503257 | −0.76312 | 0.800434 | 4.503257 |
| 0.291885 | −1.15155 | 4.503257 | −0.72675 | 0.727937 | 4.503257 |
| 0.233129 | −1.08865 | 4.503257 | −0.68849 | 0.652715 | 4.503257 |
| 0.17307 | −1.02231 | 4.503257 | −0.64798 | 0.574886 | 4.503257 |
| 0.111945 | −0.95266 | 4.503257 | −0.60545 | 0.494215 | 4.503257 |
| 0.04999 | −0.87945 | 4.503257 | −0.56055 | 0.410938 | 4.503257 |
| −0.01256 | −0.80245 | 4.503257 | −0.51341 | 0.325173 | 4.503257 |
| −0.07558 | −0.72166 | 4.503257 | −0.46365 | 0.23692 | 4.503257 |
| −0.13658 | −0.63957 | 4.503257 | −0.41295 | 0.14926 | 4.503257 |
| −0.19581 | −0.55605 | 4.503257 | −0.36142 | 0.062073 | 4.503257 |
| −0.25315 | −0.47135 | 4.503257 | −0.30906 | −0.02452 | 4.503257 |
| −0.30918 | −0.38571 | 4.503257 | −0.25576 | −0.11052 | 4.503257 |
| −0.36403 | −0.29911 | 4.503257 | −0.2015 | −0.19593 | 4.503257 |
| −0.41745 | −0.21169 | 4.503257 | −0.14642 | −0.28087 | 4.503257 |
| −0.46958 | −0.12344 | 4.503257 | −0.09038 | −0.36521 | 4.503257 |
| −0.52039 | −0.03412 | 4.503257 | −0.03364 | −0.44908 | 4.503257 |
| −0.56991 | 0.056032 | 4.503257 | 0.023455 | −0.53271 | 4.503257 |
| −0.61801 | 0.147246 | 4.503257 | 0.08079 | −0.61635 | 4.503257 |
| −0.6648 | 0.239289 | 4.503257 | 0.138243 | −0.69974 | 4.503257 |
| −0.70851 | 0.329082 | 4.503257 | 0.193919 | −0.7803 | 4.503257 |
| −0.7495 | 0.416505 | 4.503257 | 0.247937 | −0.85789 | 4.503257 |
| −0.78776 | 0.501204 | 4.503257 | 0.300296 | −0.93252 | 4.503257 |
| −0.82353 | 0.583416 | 4.503257 | 0.350997 | −1.00419 | 4.503257 |
| −0.8567 | 0.662902 | 4.503257 | 0.400158 | −1.07289 | 4.503257 |
| −0.88762 | 0.739546 | 4.503257 | 0.447542 | −1.13852 | 4.503257 |
| −0.91629 | 0.813465 | 4.503257 | 0.493386 | −1.2013 | 4.503257 |
| −0.9427 | 0.884422 | 4.503257 | 0.535439 | −1.2584 | 4.503257 |
| −0.96604 | 0.949338 | 4.503257 | 0.573702 | −1.30981 | 4.503257 |
| −0.9863 | 1.007858 | 4.503257 | 0.608174 | −1.35577 | 4.503257 |
| −1.00359 | 1.060217 | 4.503257 | 0.638855 | −1.39605 | 4.503257 |
| −1.01852 | 1.109733 | 4.503257 | 0.665508 | −1.431 | 4.503257 |
| −1.02954 | 1.15309 | 4.503257 | 0.688134 | −1.46037 | 4.503257 |
| −1.03605 | 1.186969 | 4.503257 | 0.707562 | −1.48549 | 4.503257 |
| −1.03937 | 1.214333 | 4.503257 | 0.723909 | −1.50657 | 4.503257 |
| −1.03996 | 1.234946 | 4.503257 | 0.737414 | −1.52387 | 4.503257 |
| −1.0383 | 1.250345 | 4.503257 | 0.748193 | −1.53773 | 4.503257 |
| −1.0357 | 1.258519 | 4.503257 | 0.756604 | −1.54839 | 4.503257 |
| −1.03273 | 1.263139 | 4.503257 | 0.760987 | −1.55739 | 4.503257 |
| −1.0306 | 1.265034 | 4.503257 | 0.760987 | −1.56592 | 4.503257 |
| −1.02942 | 1.265745 | 4.503257 | 0.758262 | −1.5722 | 4.503257 |
| 0.750563 | −1.56012 | 4.819308 | −1.00419 | 1.411806 | 4.819308 |
| 0.74618 | −1.5632 | 4.819308 | −1.00347 | 1.412043 | 4.819308 |
| 0.739427 | −1.56533 | 4.819308 | −1.00205 | 1.412162 | 4.819308 |
| 0.730543 | −1.56438 | 4.819308 | −0.99921 | 1.411925 | 4.819308 |
| 0.721777 | −1.55846 | 4.819308 | −0.99412 | 1.409674 | 4.819308 |
| 0.711234 | −1.54886 | 4.819308 | −0.98713 | 1.404343 | 4.819308 |
| 0.697611 | −1.53643 | 4.819308 | −0.9767 | 1.392616 | 4.819308 |
| 0.680553 | −1.52079 | 4.819308 | −0.96462 | 1.375558 | 4.819308 |
| 0.659822 | −1.50172 | 4.819308 | −0.9504 | 1.351629 | 4.819308 |
| 0.635301 | −1.47897 | 4.819308 | −0.93441 | 1.320829 | 4.819308 |
| 0.606752 | −1.4522 | 4.819308 | −0.91522 | 1.280079 | 4.819308 |
| 0.573109 | −1.42045 | 4.819308 | −0.89437 | 1.232221 | 4.819308 |
| 0.53461 | −1.38361 | 4.819308 | −0.87293 | 1.180928 | 4.819308 |
| 0.491135 | −1.34144 | 4.819308 | −0.84865 | 1.123238 | 4.819308 |
| 0.44304 | −1.29406 | 4.819308 | −0.82164 | 1.059151 | 4.819308 |
| 0.390326 | −1.24111 | 4.819308 | −0.79155 | 0.988904 | 4.819308 |
| 0.333346 | −1.18235 | 4.819308 | −0.75957 | 0.915577 | 4.819308 |
| 0.27459 | −1.12051 | 4.819308 | −0.7258 | 0.839408 | 4.819308 |
| 0.214531 | −1.05524 | 4.819308 | −0.69003 | 0.760158 | 4.819308 |
| 0.153169 | −0.98653 | 4.819308 | −0.65212 | 0.678184 | 4.819308 |
| 0.090977 | −0.91416 | 4.819308 | −0.61196 | 0.593366 | 4.819308 |
| 0.028075 | −0.83799 | 4.819308 | −0.56944 | 0.505824 | 4.819308 |
| −0.03518 | −0.75779 | 4.819308 | −0.52442 | 0.415676 | 4.819308 |
| −0.09856 | −0.67345 | 4.819308 | −0.47668 | 0.322922 | 4.819308 |
| −0.15945 | −0.58732 | 4.819308 | −0.428 | 0.230879 | 4.819308 |
| −0.21808 | −0.49966 | 4.819308 | −0.37801 | 0.139546 | 4.819308 |
| −0.27495 | −0.41082 | 4.819308 | −0.32695 | 0.048806 | 4.819308 |
| −0.33038 | −0.32091 | 4.819308 | −0.27483 | −0.04134 | 4.819308 |
| −0.38428 | −0.22993 | 4.819308 | −0.22152 | −0.13078 | 4.819308 |
| −0.43664 | −0.13801 | 4.819308 | −0.16703 | −0.21951 | 4.819308 |
| −0.48746 | −0.0449 | 4.819308 | −0.11147 | −0.30752 | 4.819308 |

TABLE 11-continued

| SUCTION SIDE | | | PRESSURE SIDE | | |
|---|---|---|---|---|---|
| X | Y | Z | X | Y | Z |
| −0.53686 | 0.049161 | 4.819308 | −0.05485 | −0.39506 | 4.819308 |
| −0.5846 | 0.144403 | 4.819308 | 0.002725 | −0.4819 | 4.819308 |
| −0.63056 | 0.240474 | 4.819308 | 0.060533 | −0.56873 | 4.819308 |
| −0.67499 | 0.337256 | 4.819308 | 0.118223 | −0.65556 | 4.819308 |
| −0.71621 | 0.431668 | 4.819308 | 0.174373 | −0.73931 | 4.819308 |
| −0.75447 | 0.523356 | 4.819308 | 0.228865 | −0.81986 | 4.819308 |
| −0.79013 | 0.612438 | 4.819308 | 0.281816 | −0.89733 | 4.819308 |
| −0.82318 | 0.698677 | 4.819308 | 0.333346 | −0.97161 | 4.819308 |
| −0.85362 | 0.782073 | 4.819308 | 0.383337 | −1.04268 | 4.819308 |
| −0.88182 | 0.862507 | 4.819308 | 0.431787 | −1.11056 | 4.819308 |
| −0.908 | 0.939862 | 4.819308 | 0.478697 | −1.17536 | 4.819308 |
| −0.93192 | 1.014255 | 4.819308 | 0.521935 | −1.23412 | 4.819308 |
| −0.95277 | 1.082132 | 4.819308 | 0.561382 | −1.28707 | 4.819308 |
| −0.97078 | 1.143494 | 4.819308 | 0.597038 | −1.33421 | 4.819308 |
| −0.98582 | 1.198341 | 4.819308 | 0.628667 | −1.37568 | 4.819308 |
| −0.99862 | 1.250108 | 4.819308 | 0.656268 | −1.41145 | 4.819308 |
| −1.00798 | 1.29536 | 4.819308 | 0.679723 | −1.44166 | 4.819308 |
| −1.01331 | 1.330424 | 4.819308 | 0.69998 | −1.46736 | 4.819308 |
| −1.01579 | 1.358736 | 4.819308 | 0.71692 | −1.48892 | 4.819308 |
| −1.01591 | 1.380059 | 4.819308 | 0.731017 | −1.50657 | 4.819308 |
| −1.01402 | 1.395933 | 4.819308 | 0.74227 | −1.52067 | 4.819308 |
| −1.01129 | 1.404343 | 4.819308 | 0.750918 | −1.53157 | 4.819308 |
| −1.00833 | 1.4092 | 4.819308 | 0.756012 | −1.54069 | 4.819308 |
| −1.00608 | 1.410977 | 4.819308 | 0.756367 | −1.54934 | 4.819308 |
| −1.0049 | 1.411569 | 4.819308 | 0.753879 | −1.55597 | 4.819308 |

It will also be appreciated that the airfoil 200 disclosed in the above scalable Tables 1-11 may be non-scaled, scaled up or scaled down geometrically for use in other similar turbine/compressor designs. Consequently, the coordinate values set forth in Tables 1-11 may be non-scaled, scaled upwardly or scaled downwardly such that the general airfoil profile shape remains unchanged. A scaled version of the coordinates in Tables 1-11 would be represented by X, Y and Z coordinate values of Tables 1-11, with the X, Y and Z non-dimensional coordinate values converted to inches or mm (or any suitable dimensional system), multiplied or divided by a constant number. The constant number may be a fraction, decimal fraction, integer or mixed number.

The article of manufacture may also have a suction-side nominal airfoil profile substantially in accordance with suction-side Cartesian coordinate values of X, Y and Z set forth in a scalable table, the scalable table selected from the group of tables consisting of TABLES 1-11. The Cartesian coordinate values of X, Y and Z are non-dimensional values convertible to dimensional distances by multiplying the Cartesian coordinate values of X, Y and Z by a number. The X and Y coordinates, when connected by smooth continuing arcs, define airfoil profile sections at each Z height. The airfoil profile sections at each Z height are joined smoothly with one another to form a complete suction-side airfoil shape. The X, Y and Z coordinate values being scalable as a function of a number to provide a non-scaled, scaled-up or scaled-down airfoil profile.

The article of manufacture may also have a pressure-side nominal airfoil profile substantially in accordance with pressure-side Cartesian coordinate values of X, Y and Z set forth in a scalable table, the scalable table selected from the group of tables consisting of TABLES 1-11. The Cartesian coordinate values of X, Y and Z are non-dimensional values convertible to dimensional distances by multiplying the Cartesian coordinate values of X, Y and Z by a number. X and Y are coordinates which, when connected by smooth continuing arcs, define airfoil profile sections at each Z height. The airfoil profile sections at each Z height are joined smoothly with one another to form a complete pressure-side airfoil shape. The X, Y and Z values being scalable as a function of the number to provide at least one of a non-scaled, scaled-up and scaled-down airfoil.

The article of manufacture may be an airfoil or a rotor blade configured for use with a compressor. The suction-side airfoil shape may lie in an envelope within +/−5% of a chord length in a direction normal to a suction-side airfoil surface location, or +/−0.25 inches in a direction normal to a suction-side airfoil surface location.

The number, used to convert the non-dimensional values to dimensional distances, may be a fraction, decimal fraction, integer or mixed number. The height of the article of manufacture may be about 1 inch to about 20 inches or more, or any suitable height as desired in the specific application.

A compressor 2, according to an aspect of the present invention, may include a plurality of rotor blades 22. Each of the rotor blades 22 include an airfoil 200 having a suction-side 310 airfoil shape, the airfoil 200 having a nominal profile substantially in accordance with suction-side 310 Cartesian coordinate values of X, Y and Z set forth in a scalable table, the scalable table selected from the group of tables consisting of TABLES 1-11. The Cartesian coordinate values of X, Y and Z are non-dimensional values convertible to dimensional distances by multiplying the Cartesian coordinate values of X, Y and Z by a number. The number, used to convert the non-dimensional values to dimensional distances, may be a fraction, decimal fraction, integer or mixed number. X and Y are coordinates which, when connected by smooth continuing arcs, define airfoil profile sections at each Z height. The airfoil profile sections at each Z height being joined smoothly with one another to form a complete suction-side 310 airfoil shape.

The compressor 2, according to an aspect of the present invention, may also have a plurality of rotor blades 22 having a pressure-side 320 nominal airfoil profile substantially in accordance with pressure-side Cartesian coordinate values of X, Y and Z set forth in scalable Tables 1-11. The Cartesian coordinate values of X, Y and Z are non-dimensional values convertible to dimensional distances by multiplying the Cartesian coordinate values of X, Y and Z by a number. The number (which would be the same number used for the suction side) may be a fraction, decimal fraction, integer or mixed number. X and Y are coordinates which, when connected by smooth continuing arcs, define airfoil profile sections at each Z height, the airfoil profile sections at each Z height being joined smoothly with one another to form a complete pressure-side airfoil shape.

An important term in this disclosure is profile. The profile is the range of the variation between measured points on an airfoil surface and the ideal position listed in scalable Tables 1-11. The actual profile on a manufactured blade may be different than those in scalable Tables 1-11 and the design is robust to this variation meaning that mechanical and aerodynamic function are not impaired. As noted above, an approximately + or − 5% chord and/or 0.25 inch profile tolerance is used herein. The X, Y and Z values are all non-dimensionalized.

The following are non-limiting examples of the airfoil profiles embodied by the present invention. On some compressors, each airfoil profile section (e.g., at each Z height) may be connected by substantially smooth continuing arcs. On other compressors, some of the airfoil profile sections may be connected by substantially smooth continuing arcs. Embodiments of the present invention may also be employed by a compressor having stage(s) with no airfoil profile sections connected by substantially smooth continuing arcs.

The disclosed airfoil shape increases reliability and is specific to the machine conditions and specifications. The airfoil shape provides a unique profile to achieve (1) interaction between other stages in the compressor; (2) aerodynamic efficiency; and (3) normalized aerodynamic and mechanical blade or vane loadings. The disclosed loci of points allow the gas turbine and compressor or any other suitable turbine/compressor to run in an efficient, safe and smooth manner. As also noted, any scale of the disclosed airfoil may be adopted as long as (1) interaction between other stages in the compressor; (2) aerodynamic efficiency; and (3) normalized aerodynamic and mechanical blade loadings are maintained in the scaled compressor.

The airfoil 200 described herein thus improves overall compressor 2 efficiency. Specifically, the airfoil 200 provides the desired turbine/compressor efficiency lapse rate (ISO, hot, cold, part load, etc.). The airfoil 200 also meets all aeromechanics, loading and stress requirements.

It should be understood that the finished article of manufacture, blade or vane does not necessarily include all the sections defined in the one or more tables listed above. The portion of the airfoil proximal to a platform (or dovetail) and/or tip may not be defined by an airfoil profile section. It should be considered that the airfoil proximal to the platform or tip may vary due to several imposed constraints. The airfoil contains a main profile section that is substantially defined between the inner and outer flowpath walls. The remaining sections of the airfoil may be partly, at least partly or completely located outside of the flowpath. At least some of these remaining sections may be employed to improve the curve fitting of the airfoil at its radially inner or outer portions. The skilled reader will appreciate that a suitable fillet radius may be applied between the platform and the airfoil portion of the article of manufacture, blade or vane.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An article of manufacture having a nominal airfoil profile substantially in accordance with Cartesian coordinate values of X, Y and Z set forth in a scalable table, the scalable table selected from the group of tables consisting of TABLES 1-11, wherein the Cartesian coordinate values of X, Y and Z are non-dimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined with one another to form a complete airfoil shape.

2. The article of manufacture according to claim 1, wherein the article of manufacture comprises a rotor blade configured for use with a compressor.

3. The article of manufacture according to claim 1, wherein the airfoil shape lies in an envelope within:

+/−5% of a chord length in a direction normal to an airfoil surface location.

4. The article of manufacture according to claim 1, wherein the number, used to convert the non-dimensional values to dimensional distances, is one of a fraction, decimal fraction, integer and mixed number.

5. The article of manufacture according to claim 1, wherein a height of the article of manufacture is about 1 inch to about 20 inches.

6. An article of manufacture having a suction-side nominal airfoil profile substantially in accordance with suction-side Cartesian coordinate values of X, Y and Z set forth in a scalable table, the scalable table selected from the group of tables consisting of TABLES 1-11, wherein the Cartesian coordinate values of X, Y and Z are nondimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined with one another to form a complete suction-side airfoil shape, the X, Y and Z coordinate values being scalable as a function of the number to provide one of a non-scaled, scaled-up and scaled-down airfoil profile.

7. The article of manufacture according to claim 6, wherein the article of manufacture comprises a rotor blade configured for use with a compressor.

8. The article of manufacture according to claim 6, wherein the suction-side airfoil shape lies in an envelope within:

+/−5% of a chord length in a direction normal to a suction-side airfoil surface location.

9. The article of manufacture according to claim 6, wherein the number, used to convert the non-dimensional values to dimensional distances, is one of a fraction, decimal fraction, integer and mixed number.

10. The article of manufacture according to claim 6, wherein a height of the article of manufacture is about 1 inch to about 20 inches.

11. The article of manufacture according to claim 6, further comprising the article of manufacture having a pressure-side nominal airfoil profile substantially in accordance with pressure-side Cartesian coordinate values of X, Y and Z set forth in the scalable table, wherein the Cartesian coordinate values of X, Y and Z are nondimensional values convertible to dimensional distances by multiplying the Cartesian coordinate values of X, Y and Z by the number, and wherein X and Y are coordinates which, when connected by continuing arcs, define airfoil profile sections at each Z height, the airfoil profile sections at each Z height being joined with one another to form a complete pressure-side airfoil shape, the X, Y and Z values being scalable as a function of the number to provide one of a non-scaled, scaled-up and scaled-down airfoil.

12. A compressor comprising a plurality of rotor blades, each of the rotor blades including an airfoil having a suction-side airfoil shape, the airfoil having a nominal profile substantially in accordance with suction-side Cartesian coordinate values of X, Y and Z set forth in a scalable table, the scalable table selected from the group of tables consisting of TABLES 1-11, wherein the Cartesian coordinate values of X, Y and Z are non-dimensional values convertible to dimensional distances by multiplying the Cartesian coordinate values of X, Y and Z by a number, and wherein X and Y are coordinates which, when connected by continuing arcs, define airfoil profile sections at each Z height, the airfoil profile sections at each Z height being joined with one another to form a complete suction-side airfoil shape.

13. The compressor according to claim 12, wherein the suction-side airfoil shape lies in an envelope within:

+/−5% of a chord length in a direction normal to a suction-side airfoil surface location.

14. The compressor according to claim 12, wherein the number, used to convert the non-dimensional values to dimensional distances, is one of a fraction, decimal fraction, integer and mixed number.

15. The compressor according to claim 12, wherein a height of each rotor blade is about 1 inch to about 20 inches.

16. The compressor according to claim 12, further comprising each of the plurality of rotor blades having a pressure-side nominal airfoil profile substantially in accordance with pressure-side Cartesian coordinate values of X, Y and Z set forth in the scalable table, wherein the Cartesian coordinate values of X, Y and Z are nondimensional values convertible to dimensional distances by multiplying the Cartesian coordinate values of X, Y and Z by the number, and wherein X and Y are coordinates which, when connected by continuing arcs, define airfoil profile sections at each Z height, the airfoil profile sections at each Z height being joined with one another to form a complete pressure-side airfoil shape.

17. The compressor according to claim 16, wherein the pressure-side airfoil shape lies in an envelope within:

+/−5% of a chord length in a direction normal to a pressure-side airfoil surface location.

18. The compressor according to claim 16, wherein the number, used to convert the non-dimensional values to dimensional distances, is one of a fraction, decimal fraction, integer and mixed number.

* * * * *